US007481274B2

(12) United States Patent
Vinegar et al.

(10) Patent No.: US 7,481,274 B2
(45) Date of Patent: *Jan. 27, 2009

(54) TEMPERATURE LIMITED HEATERS WITH RELATIVELY CONSTANT CURRENT

(75) Inventors: Harold J. Vinegar, Bellaire, TX (US); Chester Ledlie Sandberg, Palo Alto, CA (US); Christopher Kelvin Harris, Houston, TX (US)

(73) Assignee: Shell Oil Company, Houston, TX (US)

( * ) Notice: Subject to any disclaimer, the term of this patent is extended or adjusted under 35 U.S.C. 154(b) by 423 days.

This patent is subject to a terminal disclaimer.

(21) Appl. No.: 11/112,878

(22) Filed: Apr. 22, 2005

(65) Prior Publication Data

US 2006/0005968 A1 Jan. 12, 2006

Related U.S. Application Data

(60) Provisional application No. 60/565,077, filed on Apr. 23, 2004.

(51) Int. Cl.
*E21B 36/04* (2006.01)

(52) U.S. Cl. ..... 166/302; 166/60; 392/301

(58) Field of Classification Search ..... 166/302, 166/60; 392/301

See application file for complete search history.

(56) References Cited

U.S. PATENT DOCUMENTS

| | | | |
|---|---|---|---|
| 48,994 | A | 7/1865 | Parry |
| 94,813 | A | 9/1869 | Dickey |
| 326,439 | A | 9/1885 | McEachen |
| 345,586 | A | 7/1886 | Hall |
| 760,304 | A | 5/1904 | Butler |
| 1,269,747 | A | 6/1918 | Rogers |
| 1,342,741 | A | 6/1920 | Day |
| 1,510,655 | A | 10/1924 | Clark |
| 1,634,236 | A | 6/1927 | Ranney |

(Continued)

FOREIGN PATENT DOCUMENTS

| | | |
|---|---|---|
| CA | 899 987 | 5/1972 |

(Continued)

OTHER PUBLICATIONS

PCT "International Search Report and Written Opinion" for International Application No. PCT/US2005/013923 mailed Jul. 25, 2005; 9 pages.

(Continued)

*Primary Examiner*—John Kreck

(57) ABSTRACT

Certain embodiments provide a system configured to heat a subsurface formation. The system includes an electrical power supply. A heater section includes one or more electrical conductors electrically coupled to the electrical power supply. At least one of the electrical conductors includes ferromagnetic material. The heater section provides a first heat output when time-varying electrical current is applied to the heater section below a selected temperature, and a second heat output approximately at and above the selected temperature during use. The second heat output is reduced compared to the first heat output. The system is configured to allow heat to transfer from the heater section to a part of the formation. The electrical power supply is configured to provide a relatively constant amount of time-varying electrical current that remains within about 15% of a selected constant current value when a load of the electrical conductors changes.

16 Claims, 104 Drawing Sheets

U.S. PATENT DOCUMENTS

| | | | |
|---|---|---|---|
| 1,646,599 | A | 10/1927 | Schaefer |
| 1,666,488 | A | 4/1928 | Crawshaw |
| 1,681,523 | A | 8/1928 | Downey et al. |
| 1,913,395 | A | 6/1933 | Karrick |
| 2,244,255 | A | 6/1941 | Looman |
| 2,244,256 | A | 6/1941 | Looman |
| 2,319,702 | A | 5/1943 | Moon |
| 2,390,770 | A | 12/1945 | Barton et al. |
| 2,423,674 | A | 7/1947 | Agren |
| 2,444,755 | A | 7/1948 | Steffen |
| 2,466,945 | A | 4/1949 | Greene |
| 2,472,445 | A | 6/1949 | Sprong |
| 2,481,051 | A | 9/1949 | Uren |
| 2,484,063 | A | 10/1949 | Ackley |
| 2,497,868 | A | 2/1950 | Dalin |
| 2,548,360 | A | 4/1951 | Germain |
| 2,593,477 | A | 4/1952 | Newman et al. |
| 2,595,979 | A | 5/1952 | Pevere et al. |
| 2,630,306 | A | 3/1953 | Evans |
| 2,630,307 | A | 3/1953 | Martin |
| 2,634,961 | A | 4/1953 | Ljungstrom |
| 2,642,943 | A | 6/1953 | Smith et al. |
| 2,670,802 | A | 3/1954 | Ackley |
| 2,685,930 | A | 5/1954 | Albaugh |
| 2,695,163 | A | 11/1954 | Pearce et al. |
| 2,703,621 | A | 3/1955 | Ford |
| 2,714,930 | A | 8/1955 | Carpenter |
| 2,732,195 | A | 1/1956 | Ljungstrom |
| 2,734,579 | A | 2/1956 | Elkins |
| 2,743,906 | A | 5/1956 | Coyle |
| 2,757,739 | A | 8/1956 | Douglas et al. |
| 2,771,954 | A | 11/1956 | Jenks et al. |
| 2,777,679 | A | 1/1957 | Ljungstrom |
| 2,780,449 | A | 2/1957 | Fisher et al. |
| 2,780,450 | A | 2/1957 | Ljungstrom |
| 2,786,660 | A | 3/1957 | Alleman |
| 2,789,805 | A | 4/1957 | Ljungstrom |
| 2,793,696 | A | 5/1957 | Morse |
| 2,794,504 | A | 6/1957 | Carpenter |
| 2,801,089 | A | 7/1957 | Scott, Jr. |
| 2,803,305 | A | 8/1957 | Behning et al. |
| 2,804,149 | A | 8/1957 | Kile |
| 2,819,761 | A | 1/1958 | Popham et al. |
| 2,825,408 | A | 3/1958 | Watson |
| 2,841,375 | A | 7/1958 | Salomonsson |
| 2,857,002 | A | 10/1958 | Pevere et al. |
| 2,890,754 | A | 6/1959 | Hoffstrom et al. |
| 2,890,755 | A | 6/1959 | Eurenius et al. |
| 2,902,270 | A | 9/1959 | Salomonsson et al. |
| 2,906,337 | A | 9/1959 | Henning |
| 2,906,340 | A | 9/1959 | Herzog |
| 2,914,309 | A | 11/1959 | Salomonsson |
| 2,923,535 | A | 2/1960 | Ljungstrom |
| 2,932,352 | A | 4/1960 | Stegemeier |
| 2,939,689 | A | 6/1960 | Ljungstrom |
| 2,942,223 | A | 6/1960 | Lennox et al. |
| 2,954,826 | A | 10/1960 | Sievers |
| 2,958,519 | A | 11/1960 | Hurley |
| 2,969,226 | A | 1/1961 | Huntington |
| 2,970,826 | A | 2/1961 | Woodruff |
| 2,974,937 | A | 3/1961 | Kiel |
| 2,991,046 | A | 7/1961 | Yahn |
| 2,994,376 | A | 8/1961 | Crawford et al. |
| 2,997,105 | A | 8/1961 | Campion et al. |
| 2,998,457 | A | 8/1961 | Paulsen |
| 3,004,601 | A | 10/1961 | Bodine |
| 3,004,603 | A | 10/1961 | Rogers et al. |
| 3,007,521 | A | 11/1961 | Trantham et al. |
| 3,010,513 | A | 11/1961 | Gerner |
| 3,010,516 | A | 11/1961 | Schleicher |
| 3,016,053 | A | 1/1962 | Medovick |
| 3,017,168 | A | 1/1962 | Carr |
| 3,032,102 | A | 2/1962 | Parker |
| 3,026,940 | A | 3/1962 | Spitz |
| 3,036,632 | A | 5/1962 | Koch et al. |
| 3,044,545 | A | 7/1962 | Tooke |
| 3,048,221 | A | 8/1962 | Tek |
| 3,050,123 | A | 8/1962 | Scott |
| 3,051,235 | A | 8/1962 | Banks |
| 3,061,009 | A | 10/1962 | Shirley |
| 3,062,282 | A | 11/1962 | Schleicher |
| 3,095,031 | A | 6/1963 | Eurenius et al. |
| 3,105,545 | A | 10/1963 | Prats et al. |
| 3,106,244 | A | 10/1963 | Parker |
| 3,110,345 | A | 11/1963 | Reed et al. |
| 3,113,619 | A | 12/1963 | Reichle |
| 3,113,620 | A | 12/1963 | Hemminger |
| 3,113,623 | A | 12/1963 | Krueger |
| 3,114,417 | A | 12/1963 | McCarthy |
| 3,116,792 | A | 1/1964 | Purre |
| 3,120,264 | A | 2/1964 | Barron |
| 3,127,935 | A | 4/1964 | Poettmann et al. |
| 3,127,936 | A | 4/1964 | Eurenius |
| 3,131,763 | A | 5/1964 | Kunetka et al. |
| 3,132,692 | A | 5/1964 | Marx et al. |
| 3,137,347 | A | 6/1964 | Parker |
| 3,139,928 | A | 7/1964 | Broussard |
| 3,142,336 | A | 7/1964 | Doscher |
| 3,149,670 | A | 9/1964 | Grant |
| 3,149,672 | A | 9/1964 | Orkiszewski et al. |
| 3,163,745 | A | 12/1964 | Boston |
| 3,164,207 | A | 1/1965 | Thessen et al. |
| 3,165,154 | A | 1/1965 | Santourian |
| 3,170,842 | A | 2/1965 | Kehler |
| 3,181,613 | A | 5/1965 | Krueger |
| 3,182,721 | A | 5/1965 | Hardy |
| 3,183,675 | A | 5/1965 | Schroeder |
| 3,191,679 | A | 6/1965 | Miller |
| 3,194,315 | A | 7/1965 | Rogers |
| 3,205,942 | A | 9/1965 | Sandberg |
| 3,205,944 | A | 9/1965 | Walton |
| 3,205,946 | A | 9/1965 | Prats et al. |
| 3,207,220 | A | 9/1965 | Williams |
| 3,208,531 | A | 9/1965 | Tamplen |
| 3,209,825 | A | 10/1965 | Alexander et al. |
| 3,221,811 | A | 12/1965 | Prats |
| 3,233,668 | A | 2/1966 | Hamilton et al. |
| 3,237,689 | A | 3/1966 | Justheim |
| 3,241,611 | A | 3/1966 | Dougan |
| 3,246,695 | A | 4/1966 | Robinson |
| 3,250,327 | A | 5/1966 | Crider |
| 3,267,680 | A | 8/1966 | Schlumberger |
| 3,273,640 | A | 9/1966 | Huntington |
| 3,275,076 | A | 9/1966 | Sharp |
| 3,284,281 | A | 11/1966 | Thomas |
| 3,285,335 | A | 11/1966 | Reistle, Jr. |
| 3,288,648 | A | 11/1966 | Jones |
| 3,294,167 | A | 12/1966 | Vogel |
| 3,302,707 | A | 2/1967 | Slusser |
| 3,316,344 | A | 4/1967 | Kidd et al. |
| 3,316,962 | A | 5/1967 | Lange |
| 3,332,480 | A | 7/1967 | Parrish |
| 3,338,306 | A | 8/1967 | Cook |
| 3,342,258 | A | 9/1967 | Prats |
| 3,342,267 | A | 9/1967 | Cotter et al. |
| 3,349,845 | A | 10/1967 | Holbert et al. |
| 3,352,355 | A | 11/1967 | Putman |
| 3,358,756 | A | 12/1967 | Vogel |
| 3,362,751 | A | 1/1968 | Tinlin |
| 3,372,754 | A | 3/1968 | McDonald |
| 3,379,248 | A | 4/1968 | Strange |
| 3,380,913 | A | 4/1968 | Henderson |
| 3,386,508 | A | 6/1968 | Bielstein et al. |
| 3,389,975 | A | 6/1968 | Van Nostrand |

3,399,623 A 9/1968 Creed
3,410,977 A 11/1968 Ando
3,434,541 A 3/1969 Cook et al.
3,455,383 A 7/1969 Prats et al.
3,465,819 A 9/1969 Dixon
3,477,058 A 11/1969 Vedder et al.
3,485,300 A 12/1969 Engle
3,501,201 A 3/1970 Closmann et al.
3,502,372 A 3/1970 Prats
3,513,249 A 5/1970 James
3,513,913 A 5/1970 Bruist
3,515,837 A 6/1970 Ando
3,528,501 A 9/1970 Parker
3,529,075 A 9/1970 McDonald
3,529,682 A 9/1970 Coyne et al.
3,537,528 A 11/1970 Herce et al.
3,542,131 A 11/1970 Walton et al.
3,542,276 A 11/1970 James
3,547,193 A 12/1970 Gill
3,562,401 A 2/1971 Long
3,565,171 A 2/1971 Closmann
3,578,080 A 5/1971 Closmann
3,580,987 A 5/1971 Priaroggia
3,593,789 A 7/1971 Prats
3,595,082 A 7/1971 Miller et al.
3,599,714 A 8/1971 Messman et al.
3,605,890 A 9/1971 Holm
3,614,986 A 10/1971 Gill
3,618,663 A 11/1971 Needham
3,629,551 A 12/1971 Ando
3,661,423 A 5/1972 Garrett
3,675,715 A 7/1972 Speller, Jr.
3,679,812 A 7/1972 Owens
3,680,633 A 8/1972 Bennett
3,700,280 A 10/1972 Papadopoulos et al.
3,757,860 A 9/1973 Pritchett
3,759,328 A 9/1973 Ueber et al.
3,759,574 A 9/1973 Beard
3,766,982 A 10/1973 Justheim
3,770,398 A 11/1973 Abraham et al.
3,779,602 A 12/1973 Beard et al.
3,794,116 A 2/1974 Higgins
3,804,169 A 4/1974 Closmann
3,804,172 A 4/1974 Closmann et al.
3,809,159 A 5/1974 Young et al.
3,823,787 A 7/1974 Haworth et al.
3,853,185 A 12/1974 Dahl et al.
3,881,551 A 5/1975 Terry et al.
3,882,941 A 5/1975 Pelofsky
3,893,918 A 7/1975 Favret, Jr.
3,907,045 A 9/1975 Dahl et al.
3,922,148 A 11/1975 Child
3,924,680 A 12/1975 Terry
3,941,421 A 3/1976 Burton, III et al.
3,947,683 A 3/1976 Schultz et al.
3,948,319 A 4/1976 Pritchett
3,948,755 A 4/1976 McCollum et al.
3,950,029 A 4/1976 Timmins
3,952,802 A 4/1976 Terry
3,954,140 A 5/1976 Hendrick
3,973,628 A 8/1976 Colgate
3,986,349 A 10/1976 Egan
3,986,556 A 10/1976 Haynes
3,986,557 A 10/1976 Striegler et al.
3,987,851 A 10/1976 Tham
3,993,132 A 11/1976 Cram et al.
3,994,340 A 11/1976 Anderson et al.
3,994,341 A 11/1976 Anderson et al.
3,999,607 A 12/1976 Pennington et al.
4,005,752 A 2/1977 Cha
4,006,778 A 2/1977 Redford et al.
4,008,762 A 2/1977 Fisher et al.
4,010,800 A 3/1977 Terry
4,016,239 A 4/1977 Fenton
4,018,280 A 4/1977 Daviduk et al.
4,019,575 A 4/1977 Pisio et al.
4,026,357 A 5/1977 Redford
4,029,360 A 6/1977 French
4,031,956 A 6/1977 Terry
4,042,026 A 8/1977 Pusch et al.
4,043,393 A 8/1977 Fisher et al.
4,048,637 A 9/1977 Jacomini
4,049,053 A 9/1977 Fisher et al.
4,057,293 A 11/1977 Garrett
4,067,390 A 1/1978 Camacho et al.
4,076,761 A 2/1978 Chang et al.
4,084,637 A 4/1978 Todd
4,087,130 A 5/1978 Garrett
4,089,372 A 5/1978 Terry
4,089,374 A 5/1978 Terry
4,091,869 A 5/1978 Hoyer
4,093,025 A 6/1978 Terry
4,093,026 A 6/1978 Ridley
4,096,163 A 6/1978 Chang et al.
4,099,567 A 7/1978 Terry
4,114,688 A 9/1978 Terry
4,119,349 A 10/1978 Albulescu et al.
4,125,159 A 11/1978 Vann
4,130,575 A 12/1978 Jorn et al.
4,133,825 A 1/1979 Stroud et al.
4,138,442 A 2/1979 Chang et al.
4,140,180 A 2/1979 Bridges et al.
4,140,181 A 2/1979 Ridley et al.
4,144,935 A 3/1979 Bridges et al.
4,148,359 A 4/1979 Laumbach et al.
4,158,467 A 6/1979 Larson et al.
4,183,405 A 1/1980 Magnie
4,184,548 A 1/1980 Ginsburgh et al.
4,185,692 A 1/1980 Terry
4,186,801 A 2/1980 Madgavkar et al.
4,193,451 A 3/1980 Dauphine
4,197,911 A 4/1980 Anada
4,199,024 A 4/1980 Rose et al.
4,228,853 A 10/1980 Harvey et al.
4,228,854 A 10/1980 Sacuta
4,243,101 A 1/1981 Grupping
4,250,230 A 2/1981 Terry
4,250,962 A 2/1981 Madgavkar et al.
4,252,191 A 2/1981 Pusch et al.
4,256,945 A 3/1981 Carter et al.
4,265,307 A 5/1981 Elkins
4,273,188 A 6/1981 Vogel et al.
4,274,487 A 6/1981 Hollingsworth et al.
4,277,416 A 7/1981 Grant
4,282,587 A 8/1981 Silverman
RE30,738 E 9/1981 Bridges et al.
4,299,086 A 11/1981 Madgavkar et al.
4,299,285 A 11/1981 Tsai et al.
4,303,126 A 12/1981 Blevins
4,305,463 A 12/1981 Zakiewicz
4,306,621 A 12/1981 Boyd et al.
4,324,292 A 4/1982 Jacobs et al.
4,344,483 A 8/1982 Fisher et al.
4,353,418 A 10/1982 Hoekstra et al.
4,359,687 A 11/1982 Vinegar et al.
4,363,361 A 12/1982 Madgavkar et al.
4,366,668 A 1/1983 Madgavkar et al.
4,378,048 A 3/1983 Madgavkar et al.
4,380,930 A 4/1983 Podhrasky et al.
4,381,641 A 5/1983 Madgavkar et al.
4,382,469 A 5/1983 Bell et al.
4,384,613 A 5/1983 Owen et al.
4,384,614 A 5/1983 Justheim
4,385,661 A 5/1983 Fox
4,390,067 A 6/1983 Willman
4,390,973 A 6/1983 Rietsch 4,396,062 A 8/1983 Iskander
4,397,732 A 8/1983 Hoover et al.
4,398,151 A 8/1983 Vinegar et al.
4,399,866 A 8/1983 Dearth
4,401,099 A 8/1983 Collier
4,401,163 A 8/1983 Elkins
4,407,973 A 10/1983 van Dijk et al.
4,409,090 A 10/1983 Hanson et al.
4,410,042 A 10/1983 Shu
4,412,124 A 10/1983 Kobayashi
4,412,585 A 11/1983 Bouck
4,417,782 A 11/1983 Clarke et al.
4,418,752 A 12/1983 Boyer et al.
4,423,311 A 12/1983 Varney, Sr.
4,425,967 A 1/1984 Hoekstra
4,428,700 A 1/1984 Lennemann
4,429,745 A 2/1984 Cook
4,437,519 A 3/1984 Cha et al.
4,440,224 A 4/1984 Kreinin et al.
4,442,896 A 4/1984 Reale et al.
4,444,255 A 4/1984 Geoffrey et al.
4,444,258 A 4/1984 Kalmar
4,445,574 A 5/1984 Vann
4,446,917 A 5/1984 Todd
4,452,491 A 6/1984 Seglin et al.
4,455,215 A 6/1984 Jarrott et al.
4,456,065 A 6/1984 Heim et al.
4,457,365 A 7/1984 Kasevich et al.
4,457,374 A 7/1984 Hoekstra et al.
4,458,757 A 7/1984 Bock et al.
4,458,767 A 7/1984 Hoehn, Jr.
4,474,238 A 10/1984 Gentry et al.
4,479,541 A 10/1984 Wang
4,485,869 A 12/1984 Sresty et al.
4,489,782 A 12/1984 Perkins
4,491,179 A 1/1985 Pirson et al.
4,498,531 A 2/1985 Vrolyk
4,498,535 A 2/1985 Bridges
4,499,209 A 2/1985 Hoek et al.
4,501,326 A 2/1985 Edmunds
4,501,445 A 2/1985 Gregoli
4,513,816 A 4/1985 Hubert
4,518,548 A 5/1985 Yarbrough
4,524,826 A 6/1985 Savage
4,524,827 A 6/1985 Bridges et al.
4,530,401 A 7/1985 Hartman et al.
4,537,252 A 8/1985 Puri
4,538,682 A 9/1985 McManus et al.
4,540,882 A 9/1985 Vinegar et al.
4,542,648 A 9/1985 Vinegar et al.
4,545,435 A 10/1985 Bridges et al.
4,549,396 A 10/1985 Garwood et al.
4,552,214 A 11/1985 Forgac et al.
4,570,715 A 2/1986 Van Meurs et al.
4,571,491 A 2/1986 Vinegar et al.
4,572,229 A 2/1986 Mueller et al.
4,572,299 A 2/1986 Van Egmond et al.
4,573,530 A 3/1986 Audeh et al.
4,576,231 A 3/1986 Dowling et al.
4,577,503 A 3/1986 Imaino et al.
4,577,690 A 3/1986 Medlin
4,583,046 A 4/1986 Vinegar et al.
4,583,242 A 4/1986 Vinegar et al.
4,585,066 A 4/1986 Moore et al.
4,592,423 A 6/1986 Savage et al.
4,597,441 A 7/1986 Ware et al.
4,597,444 A 7/1986 Hutchinson
4,598,392 A 7/1986 Pann
4,598,770 A 7/1986 Shu et al.
4,598,772 A 7/1986 Holmes
4,605,489 A 8/1986 Madgavkar
4,605,680 A 8/1986 Beuther et al.
4,608,818 A 9/1986 Goebel et al.
4,609,041 A 9/1986 Magda
4,613,754 A 9/1986 Vinegar et al.
4,616,705 A 10/1986 Stegemeier et al.
4,623,401 A 11/1986 Derbyshire et al.
4,623,444 A 11/1986 Che et al.
4,626,665 A 12/1986 Fort, III
4,635,197 A 1/1987 Vinegar et al.
4,637,464 A 1/1987 Forgac et al.
4,640,352 A 2/1987 Van Meurs et al.
4,640,353 A 2/1987 Schuh
4,644,283 A 2/1987 Vinegar et al.
4,645,004 A 2/1987 Bridges et al.
4,645,906 A 2/1987 Yagnik et al.
4,651,825 A 3/1987 Wilson
4,658,215 A 4/1987 Vinegar et al.
4,662,437 A 5/1987 Renfro
4,662,438 A 5/1987 Taflove et al.
4,662,439 A 5/1987 Puri
4,662,443 A 5/1987 Puri et al.
4,663,711 A 5/1987 Vinegar et al.
4,669,542 A 6/1987 Venkatesan
4,671,102 A 6/1987 Vinegar et al.
4,682,652 A 7/1987 Huang et al.
4,691,771 A 9/1987 Ware et al.
4,694,907 A 9/1987 Stahl et al.
4,695,713 A 9/1987 Krumme
4,698,149 A 10/1987 Mitchell
4,698,583 A 10/1987 Sandberg
4,701,587 A 10/1987 Carter et al.
4,704,514 A 11/1987 Van Egmond et al.
4,706,751 A 11/1987 Gondouin
4,716,960 A 1/1988 Eastlund et al.
4,717,814 A 1/1988 Krumme
4,719,423 A 1/1988 Vinegar et al.
4,728,892 A 3/1988 Vinegar et al.
4,730,162 A 3/1988 Vinegar et al.
4,733,057 A 3/1988 Stanzel et al.
4,734,115 A 3/1988 Howard et al.
4,743,854 A 5/1988 Vinegar et al.
4,744,245 A 5/1988 White
4,752,673 A 6/1988 Krumme
4,756,367 A 7/1988 Puri et al.
4,762,425 A 8/1988 Shakkottai et al.
4,766,958 A 8/1988 Faecke
4,769,602 A 9/1988 Vinegar et al.
4,769,606 A 9/1988 Vinegar et al.
4,772,634 A 9/1988 Farooque
4,776,638 A 10/1988 Hahn
4,785,163 A 11/1988 Sandberg
4,787,452 A 11/1988 Jennings, Jr.
4,794,226 A 12/1988 Derbyshire
4,808,925 A 2/1989 Baird
4,814,587 A 3/1989 Carter
4,817,711 A 4/1989 Jeambey
4,818,370 A 4/1989 Gregoli et al.
4,821,798 A 4/1989 Bridges et al.
4,823,890 A 4/1989 Lang
4,827,761 A 5/1989 Vinegar et al.
4,828,031 A 5/1989 Davis
4,848,460 A 7/1989 Johnson, Jr. et al.
4,848,924 A 7/1989 Nuspl et al.
4,849,611 A 7/1989 Whitney et al.
4,852,648 A 8/1989 Akkerman et al.
4,856,341 A 8/1989 Vinegar et al.
4,856,587 A 8/1989 Nielson
4,860,544 A 8/1989 Krieg et al.
4,866,983 A 9/1989 Vinegar et al.
4,884,455 A 12/1989 Vinegar et al.
4,885,080 A 12/1989 Brown et al.
4,886,118 A 12/1989 Van Meurs et al.
4,893,504 A 1/1990 OMeara, Jr. et al.
4,895,206 A 1/1990 Price
4,912,971 A 4/1990 Jeambey 4,913,065 A 4/1990 Hemsath
4,926,941 A 5/1990 Glandt et al.
4,927,857 A 5/1990 McShea, III et al.
4,928,765 A 5/1990 Nielson
4,974,425 A 12/1990 Krieg et al.
4,982,786 A 1/1991 Jennings, Jr.
4,983,319 A 1/1991 Gregoli et al.
4,984,594 A 1/1991 Vinegar et al.
4,985,313 A 1/1991 Penneck et al.
4,987,368 A 1/1991 Vinegar
4,994,093 A 2/1991 Wetzel et al.
5,008,085 A 4/1991 Bain et al.
5,011,329 A 4/1991 Nelson et al.
5,020,596 A 6/1991 Hemsath
5,027,896 A 7/1991 Anderson
5,046,559 A 9/1991 Glandt
5,050,386 A 9/1991 Krieg et al.
5,054,551 A 10/1991 Duerksen
5,059,303 A 10/1991 Taylor et al.
5,060,287 A 10/1991 Van Egmond
5,060,726 A 10/1991 Glandt et al.
5,064,006 A 11/1991 Waters et al.
5,065,501 A 11/1991 Henschen et al.
5,065,818 A 11/1991 Van Egmond
5,066,852 A 11/1991 Willbanks
5,073,625 A 12/1991 Derbyshire
5,082,054 A 1/1992 Kiamanesh
5,082,055 A 1/1992 Hemsath
5,085,276 A 2/1992 Rivas et al.
5,097,903 A 3/1992 Wilensky
5,099,918 A 3/1992 Bridges et al.
5,103,920 A 4/1992 Patton
5,126,037 A 6/1992 Showalter
5,145,003 A 9/1992 Duerksen
5,168,927 A 12/1992 Stegemeier et al.
5,182,427 A 1/1993 McGaffigan
5,182,792 A 1/1993 Goncalves
5,189,283 A 2/1993 Carl, Jr. et al.
5,190,405 A 3/1993 Vinegar et al.
5,201,219 A 4/1993 Bandurski et al.
5,207,273 A 5/1993 Cates et al.
5,209,987 A 5/1993 Penneck et al.
5,211,230 A 5/1993 Ostapovich et al.
5,217,076 A 6/1993 Masek
5,226,961 A 7/1993 Nahm et al.
5,229,583 A 7/1993 van Egmond et al.
5,230,387 A 7/1993 Waters et al.
5,236,039 A 8/1993 Edelstein et al.
5,247,994 A 9/1993 Nenniger
5,255,742 A 10/1993 Mikus
5,261,490 A 11/1993 Ebinuma
5,285,846 A 2/1994 Mohn
5,289,882 A 3/1994 Moore
5,295,763 A 3/1994 Stenborg et al.
5,297,626 A 3/1994 Vinegar et al.
5,305,239 A 4/1994 Kinra
5,305,829 A 4/1994 Kumar
5,306,640 A 4/1994 Vinegar et al.
5,316,664 A 5/1994 Gregoli et al.
5,318,116 A 6/1994 Vinegar et al.
5,332,036 A 7/1994 Shirley et al.
5,339,897 A 8/1994 Leaute
5,339,904 A 8/1994 Jennings, Jr.
5,340,467 A 8/1994 Gregoli et al.
5,349,859 A 9/1994 Kleppe
5,360,067 A 11/1994 Meo, III
5,363,094 A 11/1994 Staron et al.
5,366,012 A 11/1994 Lohbeck
5,377,756 A 1/1995 Northrop et al.
5,388,640 A 2/1995 Puri et al.
5,388,641 A 2/1995 Yee et al.
5,388,642 A 2/1995 Puri et al.
5,388,643 A 2/1995 Yee et al.
5,388,645 A 2/1995 Puri et al.
5,391,291 A 2/1995 Winquist et al.
5,392,854 A 2/1995 Vinegar et al.
5,400,430 A 3/1995 Nenniger
5,404,952 A 4/1995 Vinegar et al.
5,409,071 A 4/1995 Wellington et al.
5,411,086 A 5/1995 Burcham et al.
5,411,089 A 5/1995 Vinegar et al.
5,411,104 A 5/1995 Stanley
5,415,231 A 5/1995 Northrop et al.
5,431,224 A 7/1995 Laali
5,433,271 A 7/1995 Vinegar et al.
5,435,666 A 7/1995 Hassett et al.
5,437,506 A 8/1995 Gray
5,439,054 A 8/1995 Chaback et al.
5,454,666 A 10/1995 Chaback et al.
5,456,315 A 10/1995 Kisman et al.
5,497,087 A 3/1996 Vinegar et al.
5,498,960 A 3/1996 Vinegar et al.
5,512,732 A 4/1996 Yagnik et al.
5,517,593 A 5/1996 Nenniger et al.
5,525,322 A 6/1996 Willms
5,541,517 A 7/1996 Hartmann et al.
5,545,803 A 8/1996 Heath et al.
5,553,189 A 9/1996 Stegemeier et al.
5,554,453 A 9/1996 Steinfeld et al.
5,566,755 A 10/1996 Seidle et al.
5,571,403 A 11/1996 Scott et al.
RE35,386 E 12/1996 Wu et al.
5,579,575 A 12/1996 Lamome et al.
5,621,844 A 4/1997 Bridges
5,621,845 A 4/1997 Bridges et al.
5,624,188 A 4/1997 West
5,632,336 A 5/1997 Notz et al.
5,652,389 A 7/1997 Schaps et al.
5,656,239 A 8/1997 Stegemeier et al.
5,713,415 A 2/1998 Bridges
5,730,550 A 3/1998 Andersland et al.
5,751,895 A 5/1998 Bridges
5,759,022 A 6/1998 Koppang et al.
5,760,307 A 6/1998 Latimer et al.
5,769,569 A 6/1998 Hosseini
5,777,229 A 7/1998 Geier et al.
5,782,301 A 7/1998 Neuroth
5,823,256 A 10/1998 Moore
5,826,655 A 10/1998 Snow et al.
5,828,797 A 10/1998 Minott et al.
5,861,137 A 1/1999 Edlund
5,862,858 A 1/1999 Wellington et al.
5,868,202 A 2/1999 Hsu
5,877,996 A 3/1999 Krokstad et al.
5,899,269 A 5/1999 Wellington et al.
5,899,958 A 5/1999 Dowell et al.
5,911,898 A 6/1999 Jacobs et al.
5,926,437 A 7/1999 Ortiz
5,935,421 A 8/1999 Brons et al.
5,968,349 A 10/1999 Duyvesteyn et al.
5,984,010 A 11/1999 Elias et al.
5,984,582 A 11/1999 Schwert
5,985,138 A 11/1999 Humphreys
5,997,214 A 12/1999 de Rouffignac et al.
6,015,015 A 1/2000 Luft et al.
6,016,867 A 1/2000 Gregoli et al.
6,016,868 A 1/2000 Gregoli et al.
6,019,172 A 2/2000 Wellington et al.
6,023,554 A 2/2000 Vinegar et al.
6,026,914 A 2/2000 Adams et al.
6,035,701 A 3/2000 Lowry et al.
6,039,121 A 3/2000 Kisman
6,056,057 A 5/2000 Vinegar et al.
6,078,868 A 6/2000 Dubinsky
6,079,499 A 6/2000 Mikus et al.
6,084,826 A 7/2000 Leggett, III 6,085,512 A 7/2000 Agee et al.
6,088,294 A 7/2000 Leggett, III et al.
6,094,048 A 7/2000 Vinegar et al.
6,102,122 A 8/2000 de Rouffignac
6,102,137 A 8/2000 Ward et al.
6,102,622 A 8/2000 Vinegar et al.
6,110,358 A 8/2000 Aldous et al.
6,112,808 A 9/2000 Isted
6,152,987 A 11/2000 Ma et al.
6,155,117 A 12/2000 Stevens et al.
6,172,124 B1 1/2001 Wolflick et al.
6,173,775 B1 1/2001 Elias et al.
6,192,748 B1 2/2001 Miller
6,193,010 B1 2/2001 Minto
6,196,350 B1 3/2001 Minto
6,269,310 B1 7/2001 Washbourne
6,288,372 B1 9/2001 Sandberg et al.
6,328,104 B1 12/2001 Graue
6,353,706 B1 3/2002 Bridges
6,354,373 B1 3/2002 Vercaemer et al.
6,357,526 B1 3/2002 Abdel-Halim et al.
6,388,947 B1 5/2002 Washbourne et al.
6,412,559 B1 7/2002 Gunter et al.
6,422,318 B1 7/2002 Rider
6,427,124 B1 7/2002 Dubinsky et al.
6,467,543 B1 10/2002 Talwani et al.
6,485,232 B1 11/2002 Vinegar et al.
6,499,536 B1 12/2002 Ellingsen
6,540,018 B1 4/2003 Vinegar
6,581,684 B2 6/2003 Wellington et al.
6,584,406 B1 6/2003 Harmon et al.
6,585,046 B2 7/2003 Neuroth et al.
6,588,266 B2 7/2003 Tubel et al.
6,588,503 B2 7/2003 Karanikas et al.
6,588,504 B2 7/2003 Wellington et al.
6,591,906 B2 7/2003 Wellington et al.
6,591,907 B2 7/2003 Zhang et al.
6,607,033 B2 8/2003 Wellington et al.
6,609,570 B2 8/2003 Wellington et al.
6,679,332 B2 1/2004 Vinegar et al.
6,684,948 B1 2/2004 Savage
6,688,387 B1 2/2004 Wellington et al.
6,698,515 B2 3/2004 Karanikas et al.
6,702,016 B2 3/2004 de Rouffignac et al.
6,708,758 B2 3/2004 de Rouffignac et al.
6,712,135 B2 3/2004 Wellington et al.
6,712,136 B2 3/2004 de Rouffignac et al.
6,712,137 B2 3/2004 Vinegar et al.
6,715,546 B2 4/2004 Vinegar et al.
6,715,547 B2 4/2004 Vinegar et al.
6,715,548 B2 4/2004 Wellington et al.
6,715,549 B2 4/2004 Wellington et al.
6,715,550 B2 4/2004 Vinegar et al.
6,719,047 B2 4/2004 Fowler et al.
6,722,429 B2 4/2004 de Rouffignac et al.
6,722,430 B2 4/2004 Vinegar et al.
6,722,431 B2 4/2004 Karanikas et al.
6,725,920 B2 4/2004 Zhang et al.
6,725,921 B2 4/2004 de Rouffignac et al.
6,725,928 B2 4/2004 Vinegar et al.
6,729,395 B2 5/2004 Shahin, Jr. et al.
6,729,396 B2 5/2004 Vinegar et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,736,215 B2 5/2004 Maher et al.
6,736,222 B2 5/2004 Kuckes et al.
6,739,393 B2 5/2004 Vinegar et al.
6,739,394 B2 5/2004 Vinegar et al.
6,742,587 B2 6/2004 Vinegar et al.
6,742,588 B2 6/2004 Wellington et al.
6,742,589 B2 6/2004 Berchenko et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,749,021 B2 6/2004 Vinegar et al.
6,752,210 B2 6/2004 de Rouffignac et al.
6,758,268 B2 7/2004 Vinegar et al.
6,761,216 B2 7/2004 Vinegar et al.
6,763,886 B2 7/2004 Schoeling et al.
6,769,483 B2 8/2004 de Rouffignac et al.
6,769,485 B2 8/2004 Vinegar et al.
6,782,947 B2 8/2004 de Rouffignac et al.
6,789,625 B2 9/2004 de Rouffignac et al.
6,805,194 B2 10/2004 Davidson et al.
6,805,195 B2 10/2004 Vinegar et al.
6,820,688 B2 11/2004 Vinegar et al.
6,854,534 B2 2/2005 Livingstone
6,866,097 B2 3/2005 Vinegar et al.
6,871,707 B2 3/2005 Karanikas et al.
6,877,554 B2 4/2005 Stegemeier et al.
6,877,555 B2 4/2005 Karanikas et al.
6,880,633 B2 4/2005 Wellington et al.
6,880,635 B2 4/2005 Vinegar et al.
6,889,769 B2 5/2005 Wellington et al.
6,896,053 B2 5/2005 Berchenko et al.
6,902,003 B2 6/2005 Maher et al.
6,902,004 B2 6/2005 de Rouffignac et al.
6,910,536 B2 6/2005 Wellington et al.
6,913,078 B2 7/2005 Shahin, Jr. et al.
6,913,079 B2 7/2005 Tubel
6,915,850 B2 7/2005 Vinegar et al.
6,918,442 B2 7/2005 Wellington et al.
6,918,443 B2 7/2005 Wellington et al.
6,923,257 B2 8/2005 Wellington et al.
6,923,258 B2 8/2005 Wellington et al.
6,929,067 B2 8/2005 Vinegar et al.
6,932,155 B2 8/2005 Vinegar et al.
6,948,562 B2 9/2005 Wellington et al.
6,948,563 B2 9/2005 Wellington et al.
6,951,247 B2 10/2005 de Rouffignac et al.
6,953,087 B2 10/2005 de Rouffignac et al.
6,958,704 B2 10/2005 Vinegar et al.
6,959,761 B2 11/2005 Berchenko et al.
6,964,300 B2 11/2005 Vinegar et al.
6,966,372 B2 11/2005 Wellington et al.
6,966,374 B2 11/2005 Vinegar et al.
6,969,123 B2 11/2005 Vinegar et al.
6,973,967 B2 12/2005 Stegemeier et al.
6,981,548 B2 1/2006 Wellington et al.
6,981,553 B2 1/2006 Stegemeier et al.
6,988,566 B2 1/2006 Lockerd, Sr. et al.
6,991,032 B2 1/2006 Berchenko et al.
6,994,160 B2 2/2006 Wellington et al.
6,994,168 B2 2/2006 Wellington et al.
6,994,169 B2 2/2006 Zhang et al.
6,997,255 B2 2/2006 Wellington et al.
6,997,518 B2 2/2006 Vinegar et al.
7,004,247 B2 2/2006 Cole et al.
7,004,251 B2 2/2006 Ward et al.
7,011,154 B2 3/2006 Maher et al.
7,032,660 B2 4/2006 Vinegar et al.
7,036,583 B2 5/2006 de Rouffignac et al.
7,040,397 B2 5/2006 de Rouffignac et al.
7,040,398 B2 5/2006 Wellington et al.
7,040,399 B2 5/2006 Wellington et al.
7,040,400 B2 5/2006 de Rouffignac et al.
7,055,600 B2 6/2006 Messier et al.
7,063,145 B2 6/2006 Veenstra et al.
7,066,254 B2 6/2006 Vinegar et al.
7,066,257 B2 6/2006 Wellington et al.
7,073,578 B2 7/2006 Vinegar et al.
7,077,198 B2 7/2006 Vinegar et al.

7,077,199 B2 7/2006 Vinegar et al.
7,086,465 B2 8/2006 Wellington et al.
7,086,468 B2 8/2006 de Rouffignac et al.
7,090,013 B2 8/2006 Wellington et al.
7,096,941 B2 8/2006 de Rouffignac et al.
7,096,942 B1 8/2006 de Rouffignac et al.
7,096,953 B2 8/2006 de Rouffignac et al.
7,100,994 B2 9/2006 Vinegar et al.
7,104,319 B2 9/2006 Vinegar et al.
7,114,566 B2 10/2006 Vinegar et al.
7,121,341 B2 10/2006 Vinegar et al.
7,121,342 B2 10/2006 Vinegar et al.
7,128,153 B2 10/2006 Vinegar et al.
7,147,059 B2 12/2006 Hirsch et al.
7,156,176 B2 1/2007 Vinegar et al.
7,165,615 B2 1/2007 Vinegar et al.
7,170,424 B2 1/2007 Vinegar et al.
7,219,734 B2 5/2007 Vinegar et al.
7,225,866 B2 6/2007 Berchenko et al.
7,320,364 B2 1/2008 Fairbanks et al.
2001/0049342 A1 12/2001 Passey et al.
2002/0004533 A1 1/2002 Wallace et al.
2002/0018697 A1 2/2002 Vinegar et al.
2002/0027001 A1 3/2002 Wellington et al.
2002/0028070 A1 3/2002 Holen
2002/0029885 A1 3/2002 de Rouffignac et al.
2002/0033253 A1 3/2002 de Rouffignac et al.
2002/0033256 A1 3/2002 Wellington et al.
2002/0033257 A1 3/2002 Shahin, Jr. et al.
2002/0034380 A1 3/2002 Maher et al.
2002/0035307 A1 3/2002 Vinegar et al.
2002/0036085 A1 3/2002 Bass et al.
2002/0036089 A1 3/2002 Vinegar et al.
2002/0038069 A1 3/2002 Wellington et al.
2002/0038709 A1 4/2002 Wellington et al.
2002/0038711 A1 4/2002 de Rouffignac et al.
2002/0040778 A1 4/2002 Wellington et al.
2002/0040779 A1 4/2002 Wellington et al.
2002/0040780 A1 4/2002 Wellington et al.
2002/0040781 A1 4/2002 Keedy et al.
2002/0043365 A1 4/2002 Berchenko et al.
2002/0043367 A1 4/2002 de Rouffignac et al.
2002/0046883 A1 4/2002 Wellington et al.
2002/0049360 A1 4/2002 Wellington et al.
2002/0053431 A1 5/2002 Wellington et al.
2002/0056551 A1 5/2002 Wellington et al.
2002/0057905 A1 5/2002 Wellington et al.
2002/0076212 A1 6/2002 Zhang et al.
2002/0077515 A1 6/2002 Wellington et al.
2002/0084074 A1 7/2002 de Rouffignac et al.
2002/0104654 A1 8/2002 Vinegar et al.
2002/0112890 A1 8/2002 Wentworth et al.
2002/0112987 A1 8/2002 Hou et al.
2002/0132862 A1 9/2002 Vinegar et al.
2002/0153141 A1 10/2002 Hartman et al.
2003/0029617 A1 2/2003 Brown et al.
2003/0038734 A1 2/2003 Hirsch et al.
2003/0051872 A1 3/2003 de Rouffignac
2003/0066642 A1 4/2003 Wellington et al.
2003/0075318 A1 4/2003 Keedy et al.
2003/0079877 A1 5/2003 Wellington et al.
2003/0080604 A1 5/2003 Vinegar et al.
2003/0085034 A1 5/2003 Wellington et al.
2003/0098149 A1 5/2003 Wellington et al.
2003/0098605 A1 5/2003 Vinegar et al.
2003/0100451 A1 5/2003 Messier et al.
2003/0102124 A1 6/2003 Vinegar et al.
2003/0102125 A1 6/2003 Wellington et al.
2003/0102126 A1 6/2003 Sumnu-Dindoruk et al.
2003/0102130 A1 6/2003 Vinegar et al.
2003/0111223 A1 6/2003 de Rouffignac et al.
2003/0116315 A1 6/2003 Wellington et al.
2003/0130136 A1 7/2003 de Rouffignac et al.
2003/0131989 A1 7/2003 Zakiewicz
2003/0131993 A1 7/2003 Zhang et al.
2003/0131994 A1 7/2003 Vinegar et al.
2003/0131996 A1 7/2003 Vinegar et al.
2003/0136559 A1 7/2003 Wellington et al.
2003/0137181 A1 7/2003 Wellington et al.
2003/0141067 A1 7/2003 de Rouffignac et al.
2003/0141068 A1 7/2003 de Rouffignac et al.
2003/0142964 A1 7/2003 Wellington et al.
2003/0146002 A1 8/2003 Vinegar et al.
2003/0148894 A1 8/2003 Vinegar et al.
2003/0155111 A1 8/2003 Vinegar et al.
2003/0157380 A1 8/2003 Assarabowski et al.
2003/0164239 A1 9/2003 Wellington et al.
2003/0173072 A1 9/2003 Vinegar et al.
2003/0173078 A1 9/2003 Wellington et al.
2003/0173080 A1 9/2003 Berchenko et al.
2003/0173081 A1 9/2003 Vinegar et al.
2003/0173085 A1 9/2003 Vinegar et al.
2003/0173088 A1 9/2003 Livingstone
2003/0178191 A1 9/2003 Maher et al.
2003/0183390 A1 10/2003 Veenstra et al.
2003/0192691 A1 10/2003 Vinegar et al.
2003/0192693 A1 10/2003 Wellington et al.
2003/0196788 A1 10/2003 Vinegar et al.
2003/0196789 A1 10/2003 Wellington et al.
2003/0196801 A1 10/2003 Vinegar et al.
2003/0196810 A1 10/2003 Vinegar et al.
2003/0201098 A1 10/2003 Karanikas et al.
2003/0205378 A1 11/2003 Wellington et al.
2003/0209348 A1 11/2003 Ward et al.
2003/0213594 A1 11/2003 Wellington et al.
2004/0011950 A1 1/2004 Harkins
2004/0020642 A1 2/2004 Vinegar et al.
2004/0035582 A1 2/2004 Zupanick
2004/0040715 A1 3/2004 Wellington et al.
2004/0079553 A1 4/2004 Livingstone
2004/0104030 A1 6/2004 Livingstone
2004/0140095 A1 7/2004 Vinegar et al.
2004/0140096 A1 7/2004 Sandberg et al.
2004/0144540 A1 7/2004 Sandberg et al.
2004/0144541 A1 7/2004 Picha et al.
2004/0145969 A1 7/2004 Bai et al.
2004/0146288 A1 7/2004 Vinegar et al.
2004/0177966 A1 9/2004 Vinegar et al.
2004/0211554 A1 10/2004 Vinegar et al.
2004/0211557 A1 10/2004 Cole et al.
2005/0006097 A1 1/2005 Sandberg et al.
2005/0051327 A1 3/2005 Vinegar et al.
2005/0269077 A1 12/2005 Sandberg
2005/0269088 A1 12/2005 Vinegar et al.
2005/0269089 A1 12/2005 Sandberg et al.
2005/0269090 A1 12/2005 Vinegar et al.
2005/0269091 A1 12/2005 Pastor-Sanz et al.
2005/0269092 A1 12/2005 Vinegar et al.
2005/0269093 A1 12/2005 Sandberg et al.
2005/0269094 A1 12/2005 Harris
2005/0269095 A1 12/2005 Fairbanks
2005/0269313 A1 12/2005 Vinegar et al.
2006/0051080 A1 3/2006 Carr
2006/0213657 A1 9/2006 Berchenko et al.
2006/0289536 A1 12/2006 Vinegar et al.
2007/0045265 A1 3/2007 McKinzie
2007/0045266 A1 3/2007 Sandberg et al.
2007/0045267 A1 3/2007 Vinegar et al.
2007/0045268 A1 3/2007 Vinegar et al.
2007/0095536 A1 5/2007 Vinegar et al.
2007/0095537 A1 5/2007 Vinegar et al.
2007/0108200 A1 5/2007 McKinzie et al.
2007/0108201 A1 5/2007 Vinegar et al.
2007/0119098 A1 5/2007 Diaz et al.
2007/0131411 A1 6/2007 Vinegar et al.
2007/0131415 A1 6/2007 Vinegar et al.

| | | | |
|---|---|---|---|
| 2007/0133959 | A1 | 6/2007 | Vinegar et al. |
| 2007/0133960 | A1 | 6/2007 | Vinegar et al. |
| 2007/0284108 | A1 | 12/2007 | Hinson et al. |
| 2007/0289733 | A1 | 12/2007 | Roes et al. |

FOREIGN PATENT DOCUMENTS

| | | |
|---|---|---|
| CA | 983704 | 2/1976 |
| CA | 1196594 | 11/1985 |
| CA | 1253555 | 5/1989 |
| CA | 1288043 | 8/1991 |
| CA | 2015460 | 10/1991 |
| CA | 1168283 | 5/1994 |
| CA | 2 152 521 | 6/2000 |
| EP | 107 927 | 5/1984 |
| EP | 0 130 671 | 9/1985 |
| EP | 0 940 558 | 9/1999 |
| GB | 156396 | 1/1921 |
| GB | 674082 | 6/1952 |
| GB | 697189 | 9/1953 |
| GB | 120 4405 | 9/1970 |
| GB | 1454324 | 11/1976 |
| GB | 1501310 | 2/1978 |
| GB | 2086416 | 5/1982 |
| SE | 121737 | 3/1948 |
| SE | 123136 | 11/1948 |
| SE | 123137 | 11/1948 |
| SE | 123138 | 11/1948 |
| SE | 126674 | 11/1949 |
| WO | 95/06093 | 3/1995 |
| WO | 97/01017 | 1/1997 |
| WO | 9723924 | 7/1997 |
| WO | 99/01640 | 1/1999 |
| WO | 0019061 | 4/2000 |

OTHER PUBLICATIONS

Bosch et al. "Evaluation of Downhole Electric Impedance Heating Systems for Paraffin Control in Oil Wells," IEEE Transactions on Industrial Applications, 1991, vol. 28; pp. 190-194.
McGee et al. "Electrical Heating with Horizontal Wells, The Heat Transfer Problem," International Conference on Horizontal Well Technology, Calgary, Alberta Canada, 1996; 14 pages.
"IEEE Recommended Practice for Electrical Impedance, Induction, and Skin Effect Heating of Pipelines and Vessels," IEEE Std. 844-200, 2000; 6 pages.
U.S. Patent and Trademark Office, "Office Communication," for U.S. Appl. No. 09/841,193 mailed Mar. 24, 2003; 18 pages.
U.S. Patent and Trademark Office, "Office Communication," for U.S. Appl. No. 09/841,193 mailed Oct. 31, 2003; 25 pages.
U.S. Patent and Trademark Office, "Office Communication," for U.S. Appl. No. 10/279,288 mailed Apr. 12, 2005; 11 pages.
U.S. Patent and Trademark Office, "Office Communication," for U.S. Appl. No. 10/693,816 mailed Aug. 24, 2005; 14 pages.
U.S. Patent and Trademark Office, "Office Communication," for U.S. Appl. No. 10/693,700 mailed Aug. 25, 2005; 14 pages.
U.S. Patent and Trademark Office, "Office Communication," for U.S. Appl. No. 10/693,819 mailed Sep. 22, 2005; 7 pages.
U.S. Patent and Trademark Office, "Office Communication," for U.S. Appl. No. 10/279,288 mailed Oct. 7, 2005; 13 pages.
U.S. Patent and Trademark Office, "Office Communication," for U.S. Appl. No. 10/693,820 mailed Dec. 15, 2005; 13 pages.
Bosch et al., "Evaluation of Downhole Electric Impedance Heating Systems for Paraffin Control in Oil Wells;" Industry Applications Society 37th Annual Petroleum and Chemical Industry Conference; The Institute of Electrical and Electronics Engineers Inc., Sep. 1990, pp. 223-227.
Eastlund et al., "New System Stops Paraffin Build-up," Petroleum Engineer, Jan. 1989, (3 pages).
Lundquist, "Refining Of Swedish Shale Oil," pp. 621-627.
Ljungstroöm, "The Shale Oil Question, Old and New Viewpoints," A Lecture in the Engineering Science Academy, Feb. 23, 1950, published in Teknisk Trdskrift, Jan. 1951 p. 33-40.
"Underground Shale Oil Pyrolysis According to the Ljungström Method," Svenska Skifferolje Aktiebolaget (Swedish Shale Oil Corp. ), IVA, vol. 24, 1953, No. 3, pp. 118-123.
Yen et al., "Oil Shale," Developments in Petroleum Science 5, 1976, pp. 187-189, 197-198.
Tissot et al., "Geochemistry and Pyrolysis of Oil Shales," Geochemistry and Chemistry of Oil Shales, American Chemical Society, 1983, pp. 1-11.
Salomonsson, "The Ljungstroöm In-Situ Method of Shale Oil Recovery," Oil Shale and Cannel Coal, vol. 2, Proceedings of the Second Oil Shale and Cannel Coal Conference, Institute of Petroleum, 1951, London, pp. 260-280.
Glass, "The Thermal and Structural Properties of a Hanna Basin Coal," Transactions of the ASME, Jun. 1984, vol. 106, pp. 266-271.
Glass, "The Thermal and Structural Properties of the Coal in the Big Coal Seam," In Situ, 1984, vol. 8, pp. 193-205.
Badzioch et al., "Investigation of the Temperature Variation of the Thermal Conductivity and Thermal Diffusivity of Coal," Fuel, 1964, vol. 43; pp. 267-280.
Olness et al., "The Historical Development of Underground Coal Gasification," Jun. 1977; 60 pages.
Thorsness et al., "Hill Coal Block Gasification Experiments: Laboratory Results and Field Plans," Jul. 1981; 23 pages.
Stephens, "The Hoe Creek Experiements: LLNL's Underground Coal Gasification Project in Wyoming," Oct. 1981; 162 pages.
Thorsness et al., "Review of Underground Coal Gasification Field Experiments at Hoe Creek;" 34 pages.
Bissell et al, "Shale Oil Cracking Kinetics and Diagnostics," Nov. 1983; 27 pages.
Cummins et al. Thermal Degradation of Green River Kerogen at 150° to 350° C. Rate of Production Formation, 1972; 18 pages.
Lewis et al., "Oil Shale Retorting Processes: A Technical Overview," Mar. 1984; 18 pages.
Piwinskii et al., "The Permittivity and Electrical Conductivity of Oil Shale," Apr. 28, 1975; 12 pages.
Reynolds et al. "Analysis of Oil Shale and Petroleum Source Rock Pyrolysis by Triple Quadrupole Mass Spectrometry: Comparisons of Gas Evolution at the Heating Rate of 10° C./Min.," Oct. 1990; 57 pages.
Sandholtz et al., "Operating Laboratory Oil Shale Retorts In An In-Situ Mode," Aug. 1977; 16 pages.
Wise et al., "A Laboratory Study of Green River Oil Shale Retorting Under Pressure In a Nitrogen Atmosphere," Sep. 1976; 24 pages.
Hill et al., "Results of the Centralia Underground Coal Gasification Field Test," Aug. 1984; 18 pages.
McMurray, "Proposed Field Test of the Lims Method Thermal Oil Recovery Process in Athabasca McMurray Tar Sands," Alberta; Husky Oil Company Cody, Wyoming; 23 pages.
Berchenko et al., "In Situ Measurement of Some Thermoporoelastic Parameters of a Granite," Poromechanics, A Tribute to Maurice Biot, 1998, pp. 545-550.
The VertiTrak System Brochure, Baker Hughes, INT-01-1307A4, 2001; 8 pages.
Rangel-German et al., "Electrical-Heating-Assisted Recovery for Heavy Oil", pp. 1-43.
Kovscek, A. R., "Reservoir Engineering Analysis of Novel Thermal Oil Recovery Techniques applicable to Alaskan North Slope Heavy Oils", pp. 1-6.
European "International Search Report" for International Application No. PCT/EP 01/04657 mailed on Aug. 21, 2001; 3 pages.
European "International Search Report" for International Application No. PCT/EP 01/04658 mailed on Aug. 21, 2001; 2 pages.
European "International Search Report" for International Application No. PCT/EP 01/04659 mailed on Aug. 21, 2001; 2 pages.
European "International Search Report" for International Application No. PCT/EP 01/04665 mailed on Aug. 21, 2001; 3 pages.
European "International Search Report" for International Application No. PCT/EP 01/04670 mailed on Aug. 21, 2001; 2 pages.
European "International Search Report" for International Application No. PCT/EP 01/04645 mailed on Aug. 27, 2001; 3 pages.
European "International Search Report" for International Application No. PCT/EP 01/04666 mailed Dec. 21, 2001; 7 pages.

European "International Search Report" for International Application No. PCT/EP 01/11730 mailed Dec. 21, 2001; 2 pages.
European "International Search Report" for International Application No. PCT/EP 01/04644 mailed Jan. 2, 2002; 9 pages.
European "International Search Report" for International Application No. PCT/EP 01/11819 mailed Mar. 1, 2002; 2 pages.
PCT "International Search Report" for International Application No. PCT/US02/34209 mailed on Feb. 19, 2003; 7 pages.
PCT "International Preliminary Examination Report" for International Application No. PCT/US02/34209 mailed on Jan. 23, 2004; 5 pages.
PCT "International Search Report" for International Application No. PCT/US02/34212 mailed on Feb. 19, 2003; 8 pages.
PCT "International Preliminary Examination Report" for International Application No. PCT/US02/34212 mailed on Jan. 23, 2004; 6 pages.
PCT "International Search Report" for International Application No. PCT/US02/34265 mailed on Feb. 19, 2003; 8 pages.
PCT "International Preliminary Examination Report" for International Application No. PCT/US02/34265 mailed on Jan. 23, 2004; 6 pages.
PCT "International Search Report" for International Application No. PCT/US02/12941 faxed on Apr. 30, 2003; 6 pages.
PCT "International Search Report" for International Application No. PCT/US02/34198 mailed on May 7, 2003; 4 pages.
PCT "International Preliminary Examination Report" for International Application No. PCT/US02/34198 mailed on Jan. 23, 2004; 5 pages.
PCT "International Search Report" for International Application No. PCT/US02/34203 mailed on May 7, 2003; 7 pages.
PCT "International Preliminary Examination Report" for International Application No. PCT/US02/34203 mailed on Jan. 23, 2004; 5 pages.
PCT "International Search Report" for International Application No. PCT/US 02/34266 mailed on May 7, 2003; 12 pages.
PCT "International Preliminary Examination Report" for International Application No. PCT/US02/34266 mailed on Jan. 23, 2004; 9 pages.
PCT "International Search Report" for International Applicaton No. PCT/US02/34384 mailed on May 7, 2003; 8 pages.
PCT "International Preliminary Examination Report" for International Application No. PCT/US02/34384 mailed on Jan. 23, 2004; 6 pages.
PCT "International Search Report" for International Application No. PCT/US02/34272 mailed on May 15, 2003; 11 pages.
PCT "International Preliminary Examination Report" for International Application No. PCT/US02/34272 mailed on Jan. 23, 2004; 9 pages.
PCT "International Search Report" for International Application No. PCT/US02/34274 mailed on Jun. 4, 2003; 9 pages.
PCT "International Preliminary Examination Report" for International Application No. PCT/US02/34274 mailed on Jan. 23, 2004; 5 pages.
PCT "International Search Report" for International Application No. PCT/US02/13311 mailed on Oct. 14, 2003; 8 pages.
PCT, "Search Report" for International Application No. PCT/US02/13121 mailed Dec. 2004; 7 pages.
PCT, "Written Opinion" for International Application No. PCT/US02/13121 mailed Feb. 24, 2005; 6 pages.
PCT "International Search Report" for International Application No. PCT/US02/34533 mailed on May 7, 2003, 7 pages.
PCT "International Preliminary Examination Report" for International Application No. PCT/US02/34533 mailed on Jan. 23, 2004; 5 pages.
PCT "International Search Report" for International Application No. PCT/US02/34198 mailed on Aug. 7, 2003; 9 pages.
Burnham, "Oil Shale Retorting Dependence of timing and composition on temperature and heating rate," Jan. 27, 1995; 23 pages.
Campbell, et al., "Kinetics of oil generation from Colorado Oil Shale" IPC Business Press, Fuel, 1978; 3 pages.
Hill et al., "The Characteristics of a Low Temperature in situ Shale Oil," American Institute of Mining, Metallurgical & Petroleum Engineers, 1967; pp. 75-90.
de Rouffignac. "In Situ Resistive Heating of Oil Shale for Oil Production-A Summary of the Swedish Data;" 4 pages.
Dougan, et al. "The Potential for in situ Retorting of Oil Shale in the Piceance Creek Basin of Northwestern Colorado," Quarterly of the Colorado School of Mines; pp. 57-72.
Hill et al. "Direct Production of Low Pour Point High Gravity Shale Oil," I&EC Product Research and Development, 1967, vol. 6; pp. 52-59.
SSAB report, "A Brief Description of the Ljungstrom Method for Shale Oil Production," 1950; 12 pages.
Salomonsson, SSAB report, "The Lungström In Situ-Method for Shale Oil Recovery," 1950; 28 pages.
"Swedish shale oil-Production method in Sweden," Organisation for European Economic Co-operation, 1952; 70 pages.
SSAB report, "Kvarn Torp," 1958; 36 pages.
SSAB report, "Kvarn Torp," 1951; 35 pages.
SSAB report, "Summary study of the shale oil works at Narkes Kvarntorp," 15 pages.
Vogel et al. "An Analog Computer for Studying Heat Transfer during a Thermal Recovery Process," AIME Petroleum Transactions, 1955; pp. 205-212.
"Skiferolja Genom Uppvarmning Av Skifferberget," Faxin Department och Namder, 1941; 3 pages.
"Aggregleringens orsaker och ransoneringen grunder,",Av director E.F.Cederlund I Statens livesmedelskonmmission; 1 page.
Ronnby, E. "Kvarntorp-Sveriges Storsta skifferoljeindustri," 1943; 9 pages.
SAAB report, "The Swedish Shale Oil Industry," 1948; 8 pages.
Gejrot et al., "The Shale Oil Industry in Sweden," Carlo Colombo Publishers-Rome, Proceedings of the Fourth World Petroleum Congress, 1955; 8 pages.
Hedback, T. J., The Swedish Shale as Raw Material for Production of Power, Oil and Gas, XIth Sectional Meeting World Power Conference, 1957; 9 pages.
SAAB, "Santa Cruz, California, Field Test of the Lins Method for the Recovery of Oil from Sand," 1955 vol. 1; 141 pages.
SAAB, "Santa Cruz, California, Field Test of the Lins Method for the Recovery of Oil from Sand-Figures," 1955 vol. 2; 146 pages.
"Santa Cruz, California, Field Test of the Lins Method for the Recovery of Oil from Sand-Memorandum re: tests," 1955 vol. 3; 256 pages.
Helander, "Santa Cruz, California, Field Test of Carbon Steel Burner Casings for the Lins Method of Oil Recovery," 1959; 38 pages.
Helander et al., Santa Cruz, California, Field Test of Fluidized Bed Burners for the Lins Method of Oil Recovery, 1959; 86 pages.
SSAB report, "Bradford Residual Oil, Athabasa Ft. McMurray," 1951; 207 pages.
"Lins Burner Test Results-English," 1959-1960; 148 pages.
SSAB "Annual Reports, SSAB Laboratory, Address Annually Issues-Shale and Ash, Oil, Gas, Waste Water, Analytical," 1953-1954, 166 pages. (Swedish).
SSAB report, "Financial Matter, Swedish taxes, etc.," 1960-1961; 37 pages. (Swedish).
SSAB report, "Cost For Mining," 1959-1979; 13 pages. (Swedish).
SSAB report, "Cost Comparison of Mining and Processing of Shale and Dolomite Using Various Production Alternatives", 1960; 64 pages. (Swedish).
SSAB report, "Assessment of Future Mining Alternatives of Shale and Dolomite," 1962; 59 pages. (Swedish).
SSAB report. "Kartong 2 Shale: Ljungstromsanlaggningen," 104 pages. (Swedish).
SAAB, "Photos," 18 pages.
SAAB report, "Swedish Geological Survey Report, Plan to Delineate Oil shale Resource in Narkes Area (near Kvarntorp)," 1941; 13 pages. (Swedish).
SAAB report, "Recovery Efficiency," 1941; 61 pages. (Swedish).
SAAB report, "Geologic Work Conducted to Assess Possibility of Expanding Shale Mining Area in Kvarntorp; Drilling Results, Seismic Results," 1942; 79 pages. (Swedish).
SSAB report, "Ojematinigar vid Norrtorp," 1941; 141 pages. (Swedish).
SSAB report, "Inhopplingschema, Norrtorp II 20/3-17/8," 1945; 50 pages. (Swedish).

SSAB report, "Secondary Recovery after LINS," 1945; 81 pages. (Swedish).
PCT "International Search Report and Written Opinion" for International Application No. PCT/US2005013889 mailed Jul. 25, 2005; 9 pages.
SSAB report, "Maps and Diagrams, Geology," 1947; 137 pages. (Swedish).
SSAB report, "Styrehseprotoholl," 1943; 10 pages. (Swedish).
SSAB report, "Early Shale Retorting Trials" 1951-1952; 134 pages. (Swedish).
SSAB report, "Analysis of Lujunstrom Oil and its Use as Liquid Fuel," Thesis by E. Pals, 1949; 83 pages. (Swedish).
SSAB report, "Environmental Sulphur and Effect on Vegetation," 1951; 50 pages. (Swedish).
SSAB report, "Tar Sands." vol. 135 1953; 20 pages. (Swedish, pp. 12-15 English translation).
SSAB report, "Assessment of Skanes Area (Southern Sweden) Shales as Fuel Source," 1954; 54 pages. (Swedish).
SSAB report, "From as Utre Dn Text Geology Reserves," 1960; 93 pages. (Swedish).
SSAB report, "Kvarntorps-Environmental Area Assessment," 1981; 50 pages. (Swedish).
HT17. U.S. Patent and Trademark Office, "Office Communication," U.S. Appl. No. 11/112,881 mailed May 18, 2007; 8 pages; available in Pair.
SR42.PCT "International Search Report and Written Opinion" for International Application No. PCT/US2006/014776, 13 pages.
SR43 PCT "International Search Report and Written Opinion" for International Application No. PCT/US2006/015101, 13 pages.
SR44. PCT "International Search Report and Written Opinion" for International Application No. PCT/US2006/015105, 12 pages.
SR45 PCT "International Search Report and Written Opinion" for International Application No. PCT/US2006/015106, mailed Aug. 7, 2006; 9 pages.
SR48 PCT "International Search Report and Written Opinion" for International Application No. PCT/US2006/015167, mailed Aug. 29, 2006; 9 pages.
SR49 PCT "International Search Report and Written Opinion" for International Application No. PCT/US2006/015169, mailed Sep. 6, 2006; 10 pages.
SR50 PCT "International Search Report and Written Opinion" for International Application No. PCT/US2006/015084, mailed Sep. 6, 2006; 8 pages.
SR51 PCT "International Search Report and Written Opinion" for International Application No. PCT/US2006/015166, mailed Aug. 30, 2006; 6 pages.
U.S. Patent and Trademark Office, "Office Communication," for U.S. Appl. No. 10/279,288 mailed Mar. 16, 2006; 5 pages (available in Pair).
U.S. Patent and Trademark Office, "Office Communication," for U.S. Appl. No. 11/112,881 mailed Apr. 28, 2006; 12 pages.
U.S. Patent and Trademark Office, "Office Communication," for U.S. Appl. No. 10/693,820 mailed Jul. 10, 2006; available in Pair.
U.S. Patent and Trademark Office, "Office Communication," for U.S. Appl. No. 10/693,700 mailed Aug. 25, 2006; available in Pair.
U.S. Patent and Trademark Office, "Office Communication," for U.S. Appl. No. 10/693,840 mailed Sep. 15, 2006; available in Pair.
U.S. Patent and Trademark Office, "Office Communication," for U.S. Appl. No. 11/112,881 mailed Dec. 6, 2006; 12 pages.
U.S. Patent and Trademark Office, "Office Communication," for U.S. Appl. No. 11/112,714 mailed May 21, 2007; 14 pages; available in Pair.
U.S. Patent and Trademark Office, "Office Communication," for U.S. Appl. No. 11/113,346 mailed Mar. 1, 2007; 12 pages;available in Pair.
U.S. Patent and Trademark Office, "Office Communication," for U.S. Appl. No. 11/112,855 mailed Jul. 20, 2007; 4 pages; available in Pair.
U.S. Patent and Trademark Office, "Office Communication," for U.S. Appl. No. 11/582,567 mailed Jun. 6, 2007; 10 pages; available in Pair.
U.S. Patent and Trademark Office, "Office Communications," for U.S. Appl. No. 10/693,820 mailed Jul. 27, 2007; 9 pages; available in Pair.
U.S. Patent and Trademark Office, "Office Communication," for U.S. Appl. No. 10/693,700 mailed Jul. 27, 2007; 8 pages; available in Pair.
U.S. Patent and Trademark Office, "Office Communication," for U.S. Appl. No. 10/693,840 mailed Jul. 27, 2007; 13 pages; available in Pair.
U.S. Patent and Trademark Office, "Office Communication," for U.S. Appl. No. 11/112,863 mailed Aug. 20, 2007; 8 pages; available in Pair.
U.S. Patent and Trademark Office, "Office Communication," for U.S. Appl. No. 11/112,713 mailed Aug. 20, 2007; 6 pages; available in Pair.
PCT "International Search Report and Written Opinion" for International Application No. PCT/US2006/041122, mailed Mar. 9, 2007; 9 pages.
PCT "International Search Report and Written Opinion" for International Application No. PCT/US2006/041183, mailed Mar. 9, 2007; 7 pages.
Gray, "American Institute of Physics Handbook", McGraw-Hill, Inc. 1963, pp. 5-170 through 5-176.
Lyman et al. "Metals Handbook", American Society For Metals, 1961, p. 291.
U.S. Patent and Trademark Office, "Office Communication," for U.S. Appl. No. 10/693,840 mailed Jan. 8, 2008; 11 pages; available in Pair.
U.S. Patent and Trademark Office, "Office Communication," for U.S. Appl. No. 10/693,820 mailed Jan. 8, 2008; 8 pages; available in Pair.
U.S. Patent and Trademark Office, "Office Communication," for U.S. Appl. No. 10/693,700 mailed Jan. 8, 2008; 7 pages; available in Pair.
U.S. Patent and Trademark Office, "Office Communication," for U.S. Appl. No. 11/112,863 mailed May 16, 2008; available in Pair.
U.S. Patent and Trademark Office, "Office Communication," for U.S. Appl. No. 11/657,442 mailed Mar. 4, 2008; available in Pair.
U.S. Patent and Trademark Office, "Office Communication," for U.S. Appl. No. 10/693,820 mailed Jan. 8, 2008; 8 pages; available in Pair.
U.S. Patent and Trademark Office, "Office Communication," for U.S. Appl. No. 10/693,700 mailed Jan. 8, 2008; 7 pages; available in Pair.
U.S. Patent and Trademark Office, "Office Communication," for U.S. Appl. No. 11/112,713 mailed Feb. 12, 2008; available in Pair.
U.S. Patent and Trademark Office, "Office Communication," for U.S. Appl. No. 11/113,342 mailed Jan. 15, 2008; available in Pair.
U.S. Patent and Trademark Office, "Office Communication," for U.S. Appl. No. 10/693,840 mailed Jan. 8, 2008; available in Pair.
U.S. Patent and Trademark Office, "Office Communication," for U.S. Appl. No. 11/112,863 mailed Jun. 16, 2008; available in Pair.
U.S. Patent and Trademark Office, "Notice of Allowance" for U.S. Appl. No. 11/657,442; mailed Jun. 13, 2008, available in Pair.
U.S. Patent and Trademark Office, "Office Communication," for U.S. Appl. No. 11/113,353 mailed Jul. 25, 2008; available in Pair.
U.S. Patent and Trademark Office, "Office Communication," for U.S. Appl. No. 11/788,870 mailed Jul. 23, 2008; available in Pair.
U.S. Patent and Trademark Office, "Office Communication," for U.S. Appl. No. 11/788,858 mailed Jul. 24, 2008; available in Pair.
U.S. Patent and Trademark Office, "Office Communication," for U.S. Appl. No. 10/693,816 mailed Aug. 5, 2008; available in Pair.
U.S. Patent and Trademark Office, "Office Communication," for U.S. Appl. No. 11/584,801 mailed Aug. 11, 2008; available in Pair.
U.S. Patent and Trademark Office, "Office Communication," for U.S. Appl. No. 10/693,820 mailed Aug. 18, 2008; 8 pages; available in Pair.
U.S. Patent and Trademark Office, "Office Communication," for U.S. Appl. No. 10/693,700 mailed Aug. 18, 2008; 7 pages; available in Pair.
U.S. Patent and Trademark Office, "Office Communication," for U.S. Appl. No. 10/693,840 mailed Aug. 18, 2008; available in Pair.

TEMPERATURE LIMITED HEATERS WITH RELATIVELY CONSTANT CURRENT

PRIORITY CLAIM

This application claims priority to Provisional Patent Application No. 60/565,077 entitled "THERMAL PROCESSES FOR SUBSURFACE FORMATIONS" to Vinegar et al. filed on Apr. 23, 2004.

RELATED PATENTS

This patent application incorporates by reference in its entirety each of U.S. Pat. No. 6,688,387 to Wellington et al.; Pat. No. 6,698,515 to Karanikas et al.; Pat. No. 6,880,633 to Wellington et al.; and Pat. No. 6,782,947 to de Rouffignac et al. This patent application incorporates by reference in its entirety each of U.S. Patent Application Publication Nos. 2003-0102126 to Sumnu-Dindoruk et al.; 2003-0205378 to Wellington et al.; 2004-0146288 to Vinegar et al.; and 2005-0051327 to Vinegar et al. This patent application incorporates by reference in its entirety U.S. patent application Ser. No. 10/831,351 to Vinegar et al.

BACKGROUND

1. Field of the Invention

The present invention relates generally to methods and systems for production of hydrocarbons, hydrogen, and/or other products from various subsurface formations such as hydrocarbon containing formations.

2. Description of Related Art

Hydrocarbons obtained from subterranean (e.g., sedimentary) formations are often used as energy resources, as feedstocks, and as consumer products. Concerns over depletion of available hydrocarbon resources and concerns over declining overall quality of produced hydrocarbons have led to development of processes for more efficient recovery, processing and/or use of available hydrocarbon resources. In situ processes may be used to remove hydrocarbon materials from subterranean formations. Chemical and/or physical properties of hydrocarbon material in a subterranean formation may need to be changed to allow hydrocarbon material to be more easily removed from the subterranean formation. The chemical and physical changes may include in situ reactions that produce removable fluids, composition changes, solubility changes, density changes, phase changes, and/or viscosity changes of the hydrocarbon material in the formation. A fluid may be, but is not limited to, a gas, a liquid, an emulsion, a slurry, and/or a stream of solid particles that has flow characteristics similar to liquid flow.

A wellbore may be formed in a formation. In some embodiments wellbores may be formed using reverse circulation drilling methods. Reverse circulation methods are suggested, for example, in published U.S. Patent Application Publication Nos. 2003-0173088 to Livingstone, 2004-0104030 to Livingstone, 2004-0079553 to Livingstone, and U.S. Pat. No. 6,854,534 to Livingstone, and Pat. No. 4,823,890 to Lang, the disclosures of which are incorporated herein by reference. Reverse circulation methods generally involve circulating a drilling fluid to a drilling bit through an annulus between concentric tubulars to the borehole in the vicinity of the drill bit, and then through openings in the drill bit and to the surface through the center of the concentric tubulars, with cuttings from the drilling being carried to the surface with the drilling fluid rising through the center tubular. A wiper or shroud may be provided above the drill bit and above a point where the drilling fluid exits the annulus to prevent the drilling fluid from mixing with formation fluids. The drilling fluids may be, but is not limited to, air, water, brines and/or conventional drilling fluids.

In some embodiments, a casing or other pipe system may be placed or formed in a wellbore. U.S. Pat. No. 4,572,299 issued to Van Egmond et al., which is incorporated by reference as if fully set forth herein, describes spooling an electric heater into a well. In some embodiments, components of a piping system may be welded together. Quality of formed wells may be monitored by various techniques. In some embodiments, quality of welds may be inspected by a hybrid electromagnetic acoustic transmission technique known as EMAT. EMAT is described in U.S. Pat. No. 5,652,389 to Schaps et al.; Pat. No. 5,760,307 to Latimer et al.; Pat. No. 5,777,229 to Geier et al.; and Pat. No. 6,155,117 to Stevens et al., each of which is incorporated by reference as if fully set forth herein.

In some embodiments, an expandable tubular may be used in a wellbore. Expandable tubulars are described in U.S. Pat. No. 5,366,012 to Lohbeck, and Pat No. 6,354,373 to Vercaemer et al., each of which is incorporated by reference as if fully set forth herein.

Heaters may be placed in wellbores to heat a formation during an in situ process. Examples of in situ processes utilizing downhole heaters are illustrated in U.S. Pat. No. 2,634,961 to Ljungstrom; Pat. No. 2,732,195 to Ljungstrom; Pat. No. 2,780,450 to Ljungstrom; Pat. No. 2,789,805 to Ljungstrom; Pat. No. 2,923,535 to Ljungstrom; and Pat. No. 4,886,118 to Van Meurs et al.; each of which is incorporated by reference as if fully set forth herein.

Application of heat to oil shale formations is described in U.S. Pat. No. 2,923,535 to Ljungstrom and Pat. No. 4,886,118 to Van Meurs et al. Heat may be applied to the oil shale formation to pyrolyze kerogen in the oil shale formation. The heat may also fracture the formation to increase permeability of the formation. The increased permeability may allow formation fluid to travel to a production well where the fluid is removed from the oil shale formation. In some processes disclosed by Ljungstrom, for example, an oxygen containing gaseous medium is introduced to a permeable stratum, preferably while still hot from a preheating step, to initiate combustion.

A heat source may be used to heat a subterranean formation. Electric heaters may be used to heat the subterranean formation by radiation and/or conduction. An electric heater may resistively heat an element. U.S. Pat. No. 2,548,360 to Germain, which is incorporated by reference as if fully set forth herein, describes an electric heating element placed in a viscous oil in a wellbore. The heater element heats and thins the oil to allow the oil to be pumped from the wellbore. U.S. Pat. No. 4,716,960 to Eastlund et al., which is incorporated by reference as if fully set forth herein, describes electrically heating tubing of a petroleum well by passing a relatively low voltage current through the tubing to prevent formation of solids. U.S. Pat. No. 5,065,818 to Van Egmond, which is incorporated by reference as if fully set forth herein, describes an electric heating element that is cemented into a well borehole without a casing surrounding the heating element.

U.S. Pat. No. 6,023,554 to Vinegar et al., which is incorporated by reference as if fully set forth herein, describes an electric heating element that is positioned in a casing. The heating element generates radiant energy that heats the casing. A granular solid fill material may be placed between the casing and the formation. The casing may conductively heat the fill material, which in turn conductively heats the formation.

U.S. Pat. No. 4,570,715 to Van Meurs et al., which is incorporated by reference as if fully set forth herein, describes an electric heating element. The heating element has an electrically conductive core, a surrounding layer of insulating material, and a surrounding metallic sheath. The conductive core may have a relatively low resistance at high temperatures. The insulating material may have electrical resistance, compressive strength, and heat conductivity properties that are relatively high at high temperatures. The insulating layer may inhibit arcing from the core to the metallic sheath. The metallic sheath may have tensile strength and creep resistance properties that are relatively high at high temperatures.

U.S. Pat. No. 5,060,287 to Van Egmond, which is incorporated by reference as if fully set forth herein, describes an electrical heating element having a copper-nickel alloy core.

Obtaining permeability in an oil shale formation (e.g., between injection and production wells) tends to be difficult because oil shale is often substantially impermeable. Many methods have attempted to link injection and production wells. These methods include: hydraulic fracturing such as methods investigated by Dow Chemical and Laramie Energy Research Center; electrical fracturing (e.g., by methods investigated by Laramie Energy Research Center); acid leaching of limestone cavities (e.g., by methods investigated by Dow Chemical); steam injection into permeable nahcolite zones to dissolve the nahcolite (e.g., by methods investigated by Shell Oil and Equity Oil); fracturing with chemical explosives (e.g., by methods investigated by Talley Energy Systems); fracturing with nuclear explosives (e.g., by methods investigated by Project Bronco); and combinations of these methods. Many of these methods, however, have relatively high operating costs and lack sufficient injection capacity.

Large deposits of heavy hydrocarbons (e.g., heavy oil and/or tar) contained in relatively permeable formations (e.g., in tar sands) are found in North America, South America, Africa, and Asia. Tar can be surface-mined and upgraded to lighter hydrocarbons such as crude oil, naphtha, kerosene, and/or gas oil. Surface milling processes may further separate the bitumen from sand. The separated bitumen may be converted to light hydrocarbons using conventional refinery methods. Mining and upgrading tar sand is usually substantially more expensive than producing lighter hydrocarbons from conventional oil reservoirs.

In situ production of hydrocarbons from tar sand may be accomplished by heating and/or injecting a gas into the formation. U.S. Pat. No. 5,211,230 to Ostapovich et al. and Pat. No. 5,339,897 to Leaute, which are incorporated by reference as if fully set forth herein, describe a horizontal production well located in an oil-bearing reservoir. A vertical conduit may be used to inject an oxidant gas into the reservoir for in situ combustion.

U.S. Pat. No. 2,780,450 to Ljungstrom describes heating bituminous geological formations in situ to convert or crack a liquid tar-like substance into oils and gases.

U.S. Pat. No. 4,597,441 to Ware et al., which is incorporated by reference as if fully set forth herein, describes contacting oil, heat, and hydrogen simultaneously in a reservoir. Hydrogenation may enhance recovery of oil from the reservoir.

U.S. Pat. No. 5,046,559 to Glandt and Pat. No. 5,060,726 to Glandt et al., which are incorporated by reference as if fully set forth herein, describe preheating a portion of a tar sand formation between an injector well and a producer well. Steam may be injected from the injector well into the formation to produce hydrocarbons at the producer well.

As outlined above, there has been a significant amount of effort to develop methods and systems to economically produce hydrocarbons, hydrogen, and/or other products from hydrocarbon containing formations. At present, however, there are still many hydrocarbon containing formations from which hydrocarbons, hydrogen, and/or other products cannot be economically produced. Thus, there is still a need for improved methods and systems for production of hydrocarbons, hydrogen, and/or other products from various hydrocarbon containing formations.

SUMMARY

Embodiments described herein generally relate to systems, methods, and heaters for treating a subsurface formation. Embodiments described herein also generally relate to heaters that have novel components therein. Such heaters can be obtained by using the systems and methods described herein.

In certain embodiments, the invention provides one or more systems, methods, and/or heaters. In some embodiments, the systems, methods, and/or heaters are used for treating a subsurface formation.

In certain embodiments, the invention provides a system configured to heat at least a part of a subsurface formation, including: an electrical power supply; a heater section including one or more electrical conductors electrically coupled to the electrical power supply and configured to be placed in an opening in the formation, at least one of the electrical conductors including ferromagnetic material; wherein the heater section (a) provides a first heat output when time-varying electrical current is applied to the heater section below a selected temperature, and (b) provides a second heat output approximately at and above the selected temperature during use, the second heat output being reduced compared to the first heat output; wherein the system is configured to allow heat to transfer from the heater section to a part of the formation; and the electrical power supply configured to provide a relatively constant amount of time-varying electrical current that remains within about 15% of a selected constant current value when a load of the electrical conductors changes.

In certain embodiments, the invention provides a method for heating a subsurface formation, including: applying time-varying electrical current to a heater section to provide an electrically resistive heat output, the heater section including one or more electrical conductors electrically coupled to the electrical power supply and configured to be placed in an opening in the formation, at least one of the electrical conductors including ferromagnetic material; providing a first heat output when time-varying electrical current is applied to the heater section below a selected temperature; providing a second heat output approximately at and above the selected temperature during use, the second heat output being reduced compared to the first heat output; allowing the heat to transfer from the heater section to a part of the subsurface formation; and wherein the applied electrical current remains within about 15% of a selected constant current value when a load of the electrical conductors changes.

In further embodiments, features from specific embodiments may be combined with features from other embodiments. For example, features from one embodiment may be combined with features from any of the other embodiments.

In further embodiments, treating a subsurface formation is performed using any of the methods, systems, or heaters described herein.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which:

FIG. 138 depicts data of electrical resistance versus temperature for a composite 0.75" diameter, 6 foot long Alloy 52 rod with a 0.375" diameter copper core at various applied electrical currents.

FIG. 139 depicts data of power output versus temperature for a composite 10.75" diameter, 6 foot long Alloy 52 rod with a 0.375" diameter copper core at various applied electrical currents.

FIG. 140 depicts data for values of skin depth versus temperature for a solid 2.54 cm diameter, 1.8 m long 410 stainless steel rod at various applied AC electrical currents.

FIG. 141 depicts temperature versus time for a temperature limited heater.

FIG. 142 depicts temperature versus log time data for a 2.5 cm solid 410 stainless steel rod and a 2.5 cm solid 304 stainless steel rod.

FIG. 143 depicts experimentally measured resistance versus temperature at several currents for a temperature limited heater with a copper core, a carbon steel ferromagnetic conductor, and a stainless steel 347H stainless steel support member.

FIG. 144 depicts experimentally measured resistance versus temperature at several currents for a temperature limited heater with a copper core, an iron-cobalt ferromagnetic conductor, and a stainless steel 347H stainless steel support member.

FIG. 145 depicts experimentally measured power factor versus temperature at two AC currents for a temperature limited heater with a copper core, a carbon steel ferromagnetic conductor, and a 347H stainless steel support member.

FIG. 146 depicts experimentally measured turndown ratio versus maximum power delivered for a temperature limited heater with a copper core, a carbon steel ferromagnetic conductor, and a 347H stainless steel support member.

FIG. 147 depicts examples of relative magnetic permeability versus magnetic field for both the found correlations and raw data for carbon steel.

FIG. 148 shows the resulting plots of skin depth versus magnetic field for four temperatures and 400 A current.

FIG. 149 shows a comparison between the experimental and numerical (calculated) results for currents of 300 A, 400 A, and 500 A.

Figure 150:
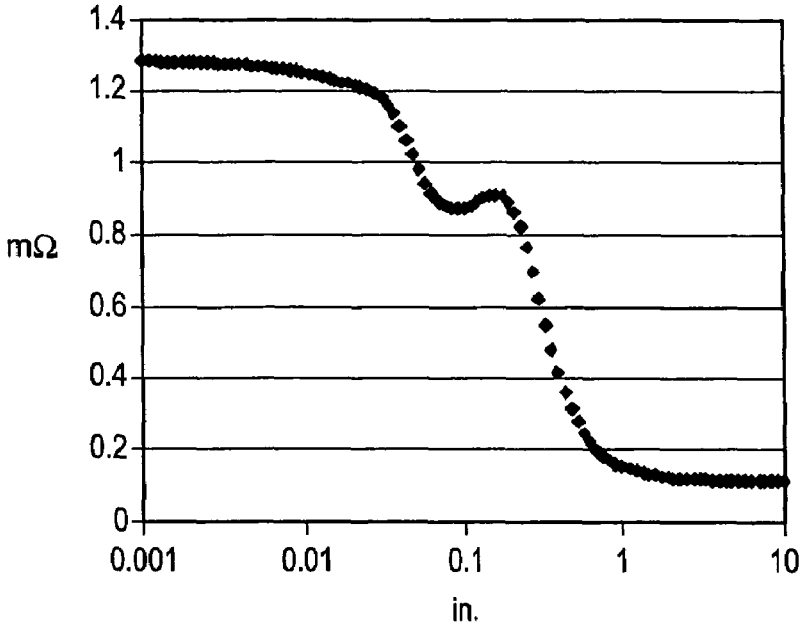

FIG. 150 shows the AC resistance per foot of the heater element as a function of skin depth at 1100° F. calculated from the theoretical model.

Figure 151:
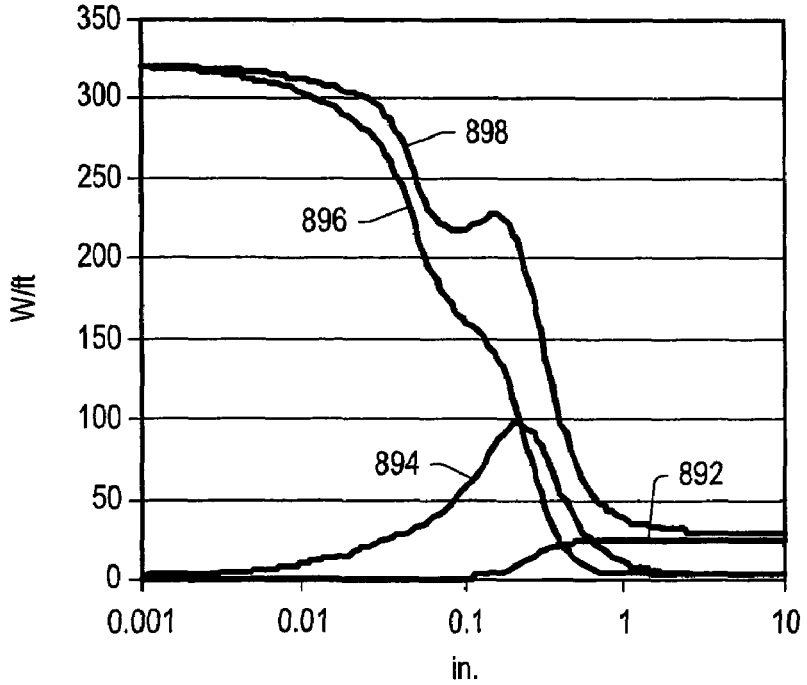

FIG. 151 depicts the power generated per unit length in each heater component versus skin depth for a temperature limited heater.

Figure 152A:
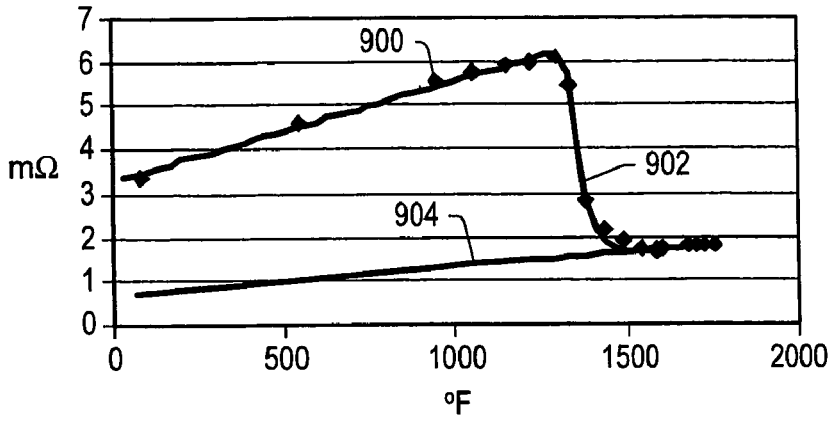
Figure 152B:
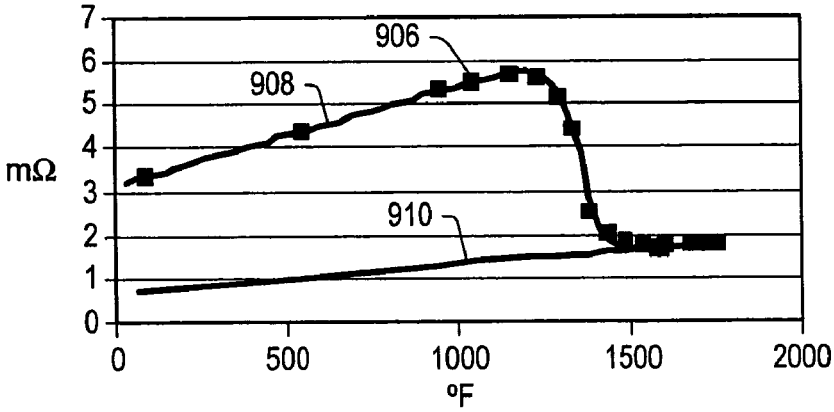
Figure 152C:
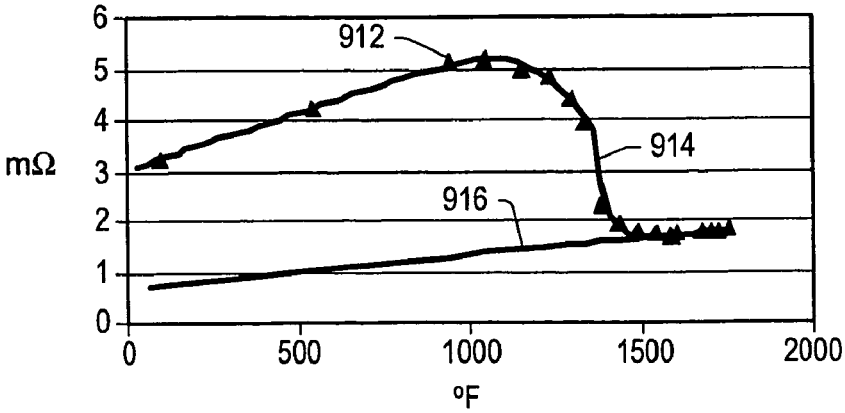

FIGS. 152A-C compare the results of theoretical calculations with experimental data for resistance versus temperature in a temperature limited heater.

Figure 153:
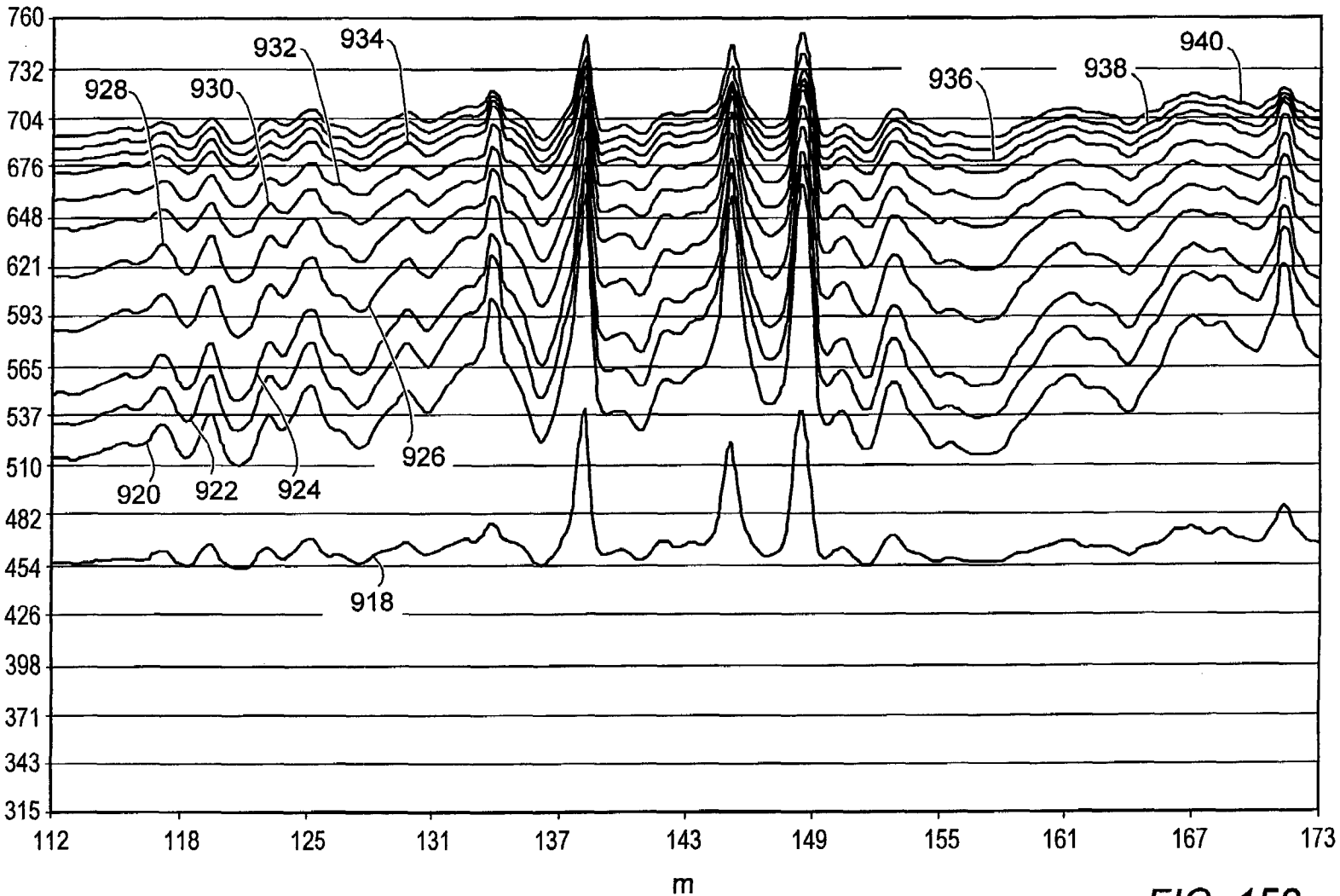

FIG. 153 displays temperature of the center conductor of a conductor-in-conduit heater as a function of formation depth for a Curie temperature heater with a turndown ratio of 2:1.

Figure 154:
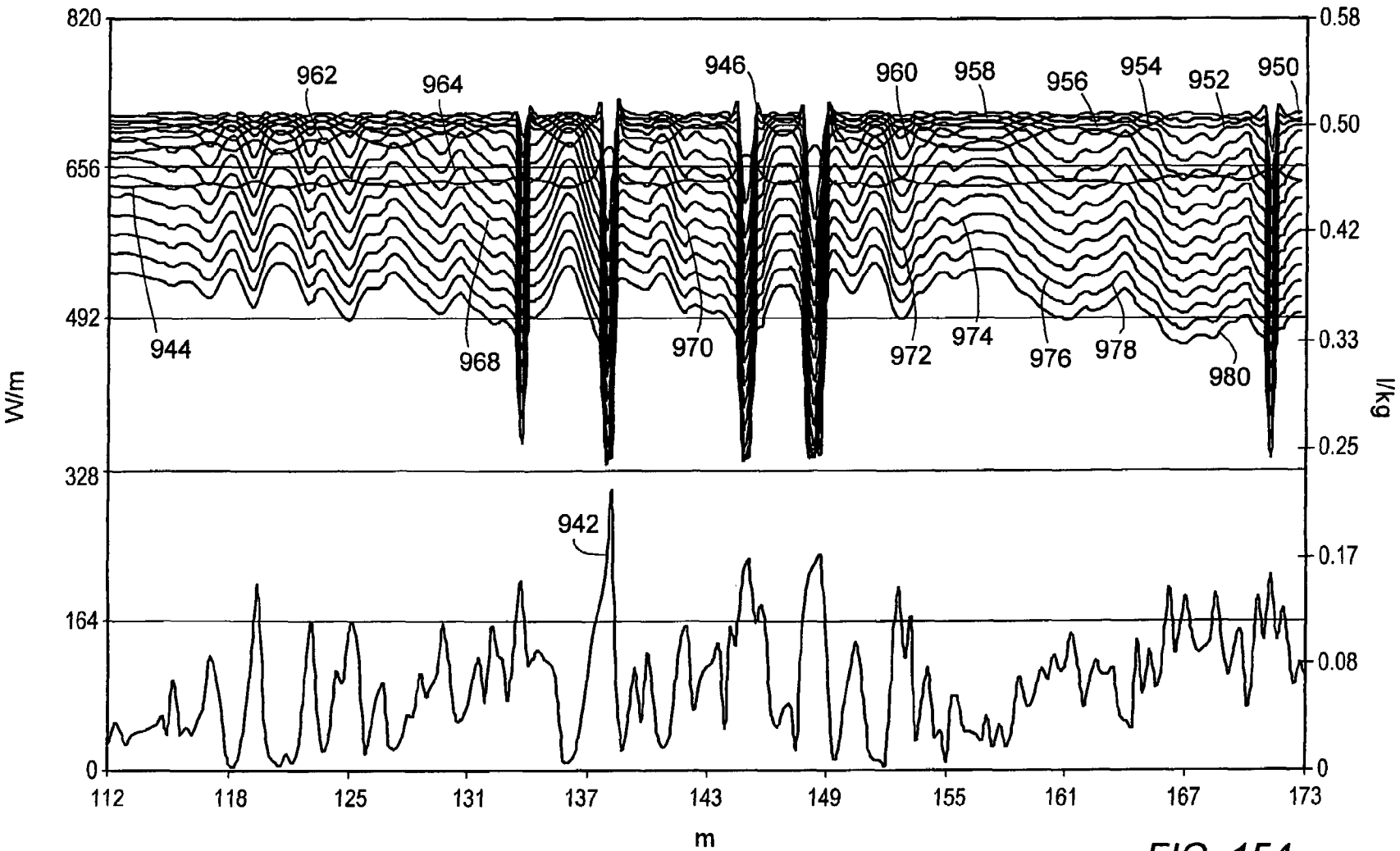

FIG. 154 displays heater heat flux through a formation for a turndown ratio of 2:1 along with the oil shale richness profile.

Figure 155:
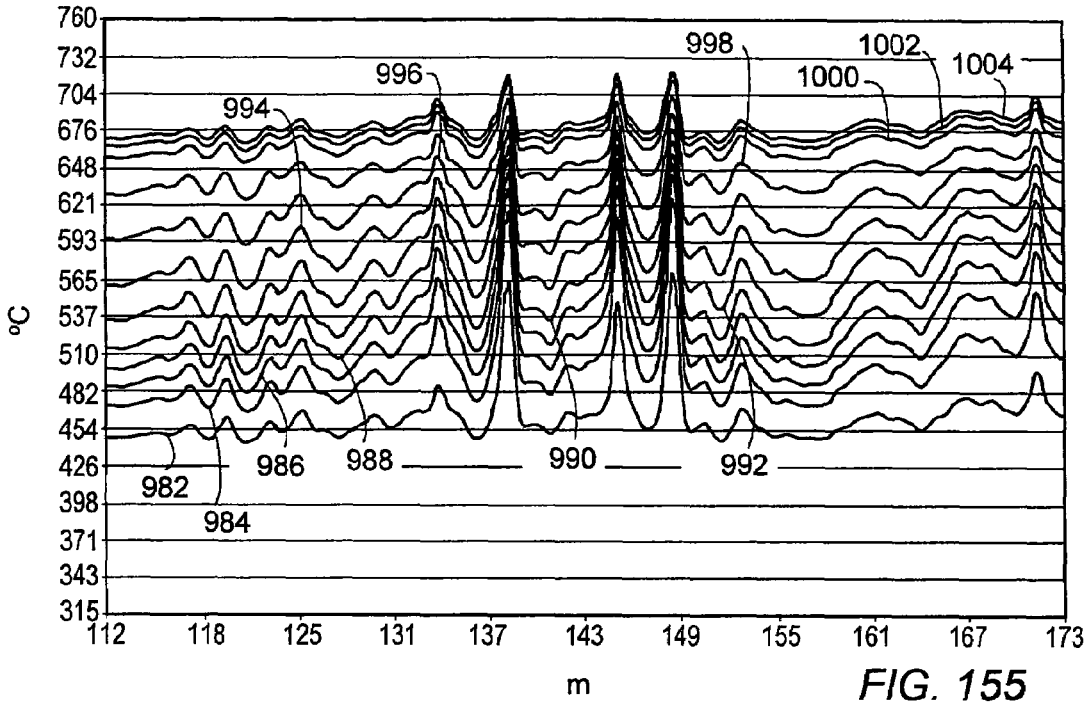

FIG. 155 displays heater temperature as a function of formation depth for a turndown ratio of 3:1.

Figure 156:
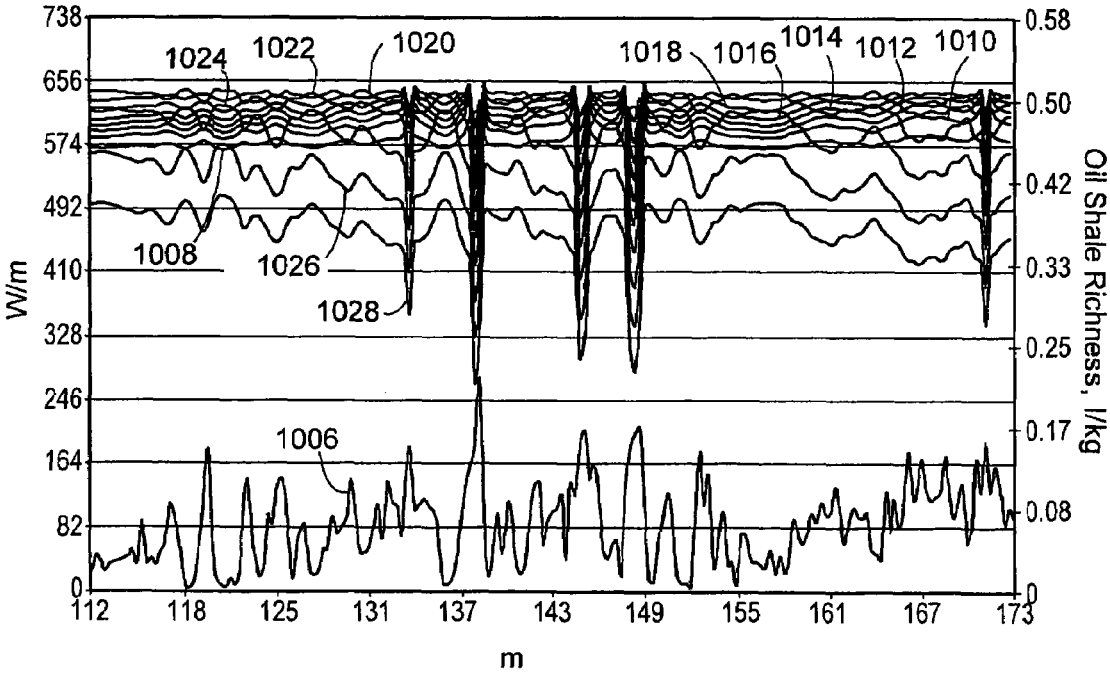

FIG. 156 displays heater heat flux through a formation for a turndown ratio of 3:1 along with the oil shale richness profile.

Figure 157:
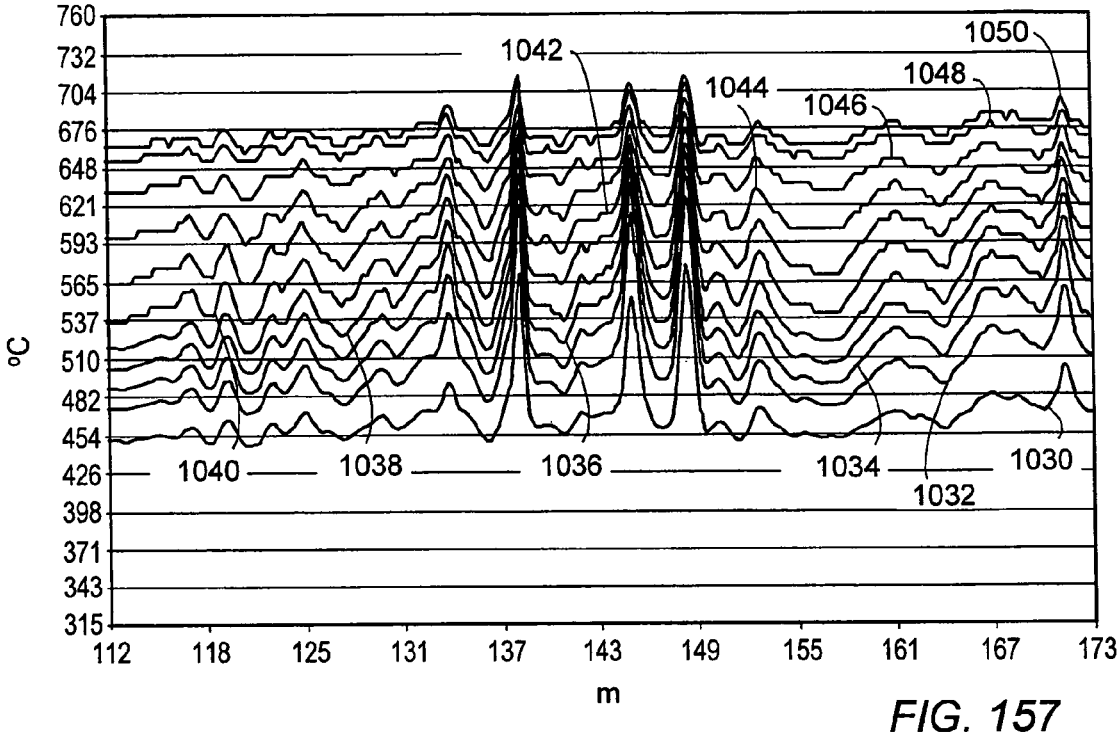

FIG. 157 displays heater temperature as a function of formation depth for a turndown ratio of 4:1.

Figure 158:
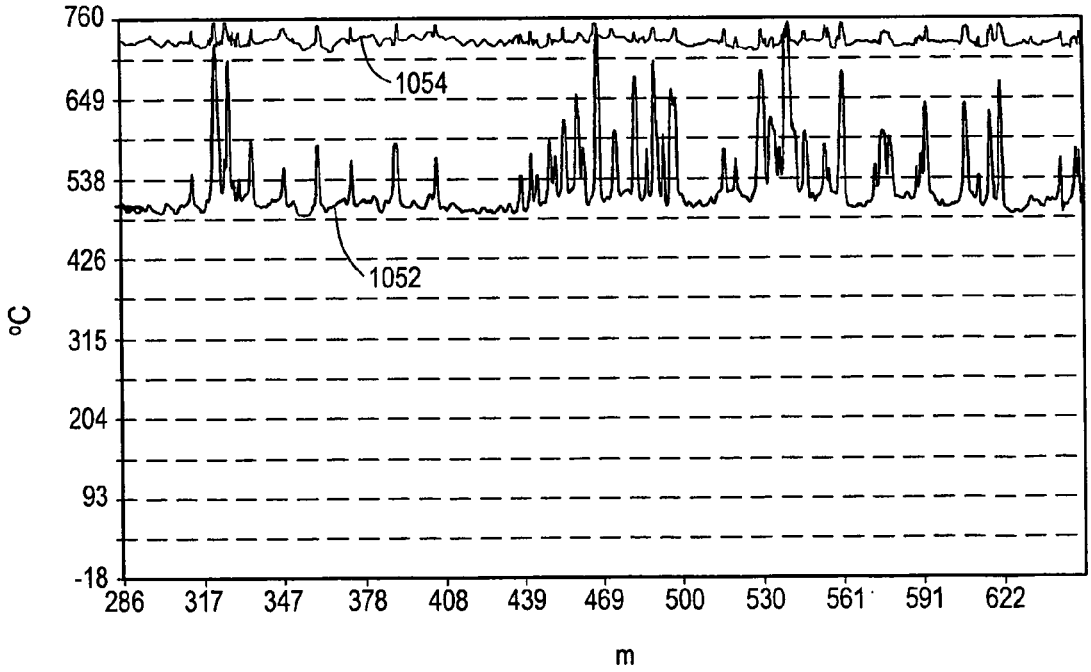

FIG. 158 depicts heater temperature versus depth for heaters used in a simulation for heating oil shale.

Figure 159:
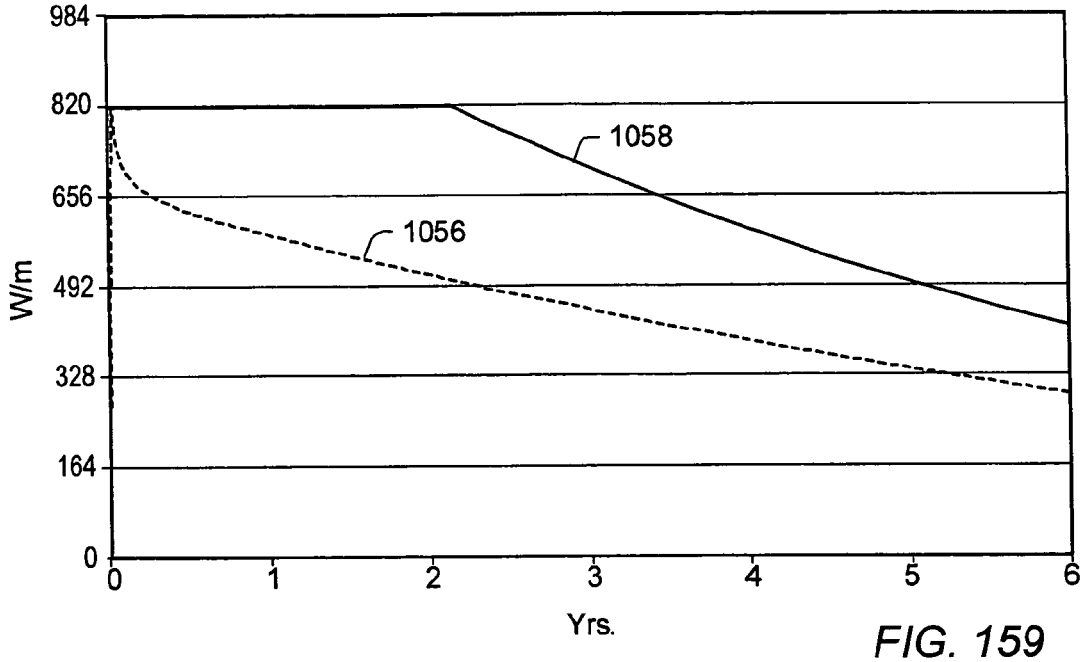

FIG. 159 depicts heater heat flux versus time for heaters used in a simulation for heating oil shale.

Figure 160:
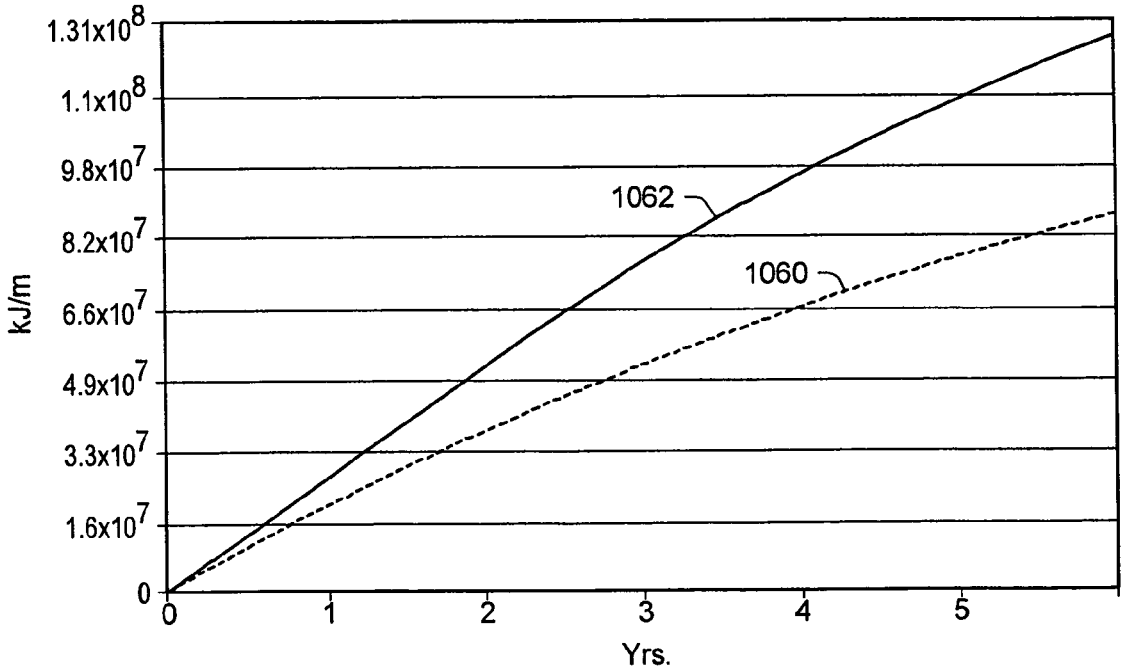

FIG. 160 depicts accumulated heat input versus time in a simulation for heating oil shale.

Figure 161:
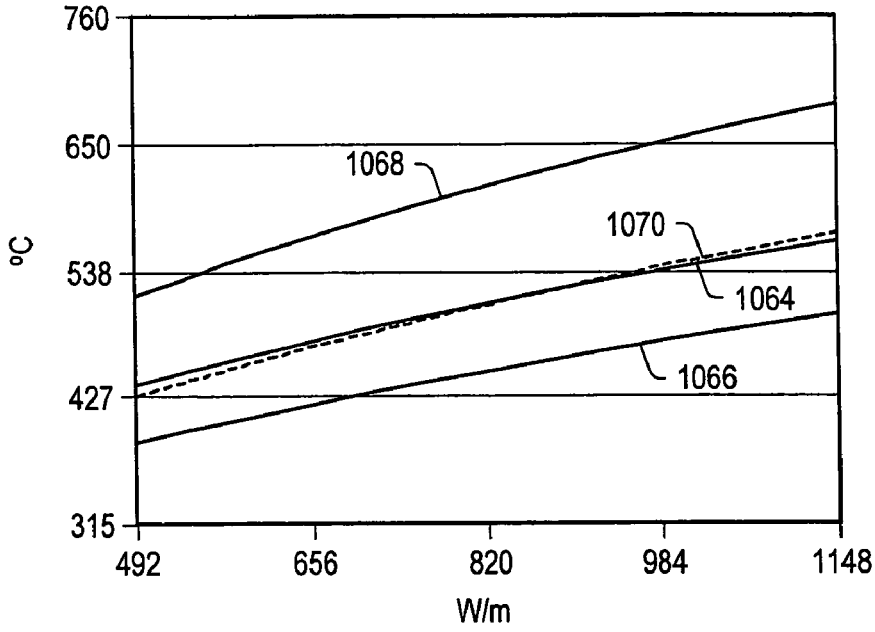

FIG. 161 shows heater rod temperature as a function of the power generated within a rod.

Figure 162:
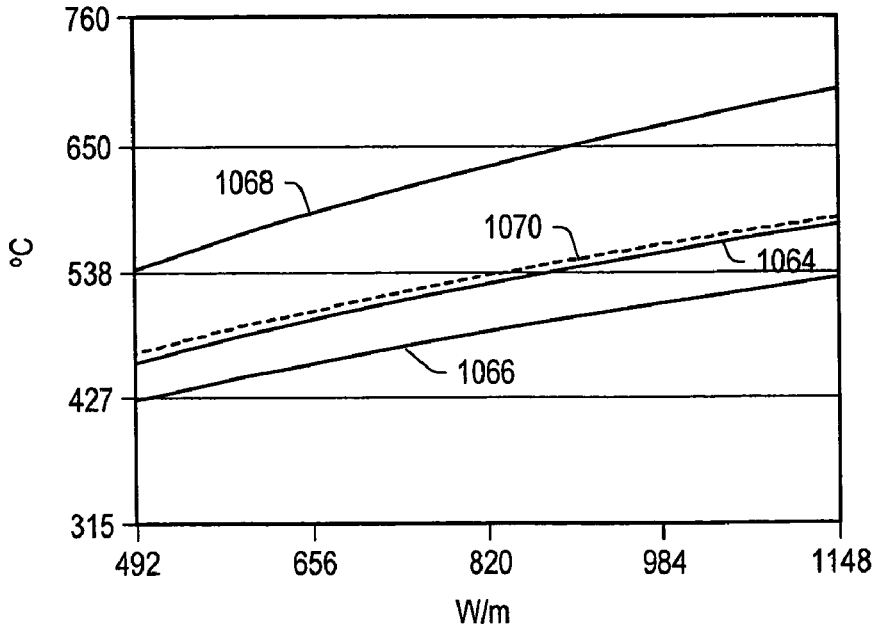

FIG. 162 shows heater rod temperature as a function of the power generated within a rod.

Figure 163:
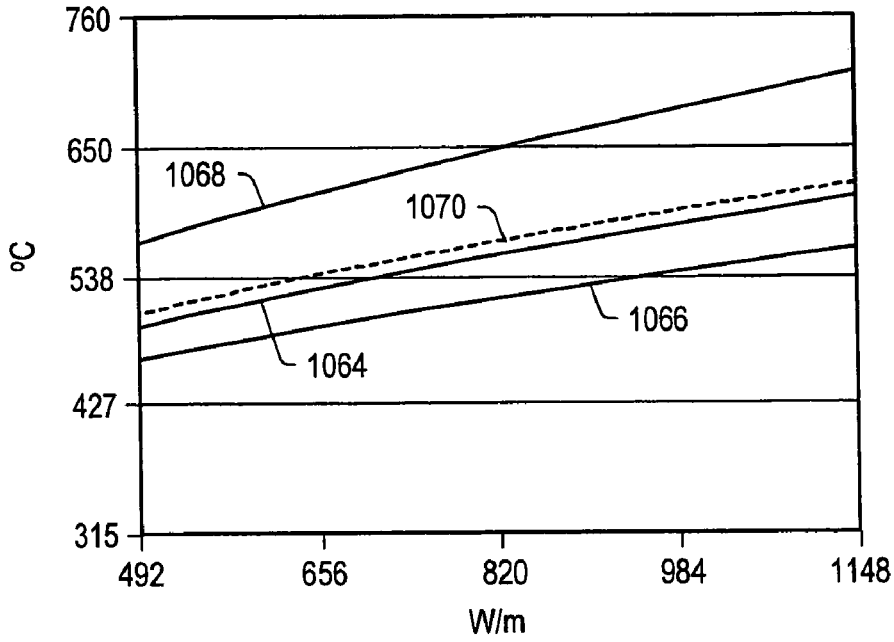

FIG. 163 shows heater rod temperature as a function of the power generated within a rod.

Figure 164:
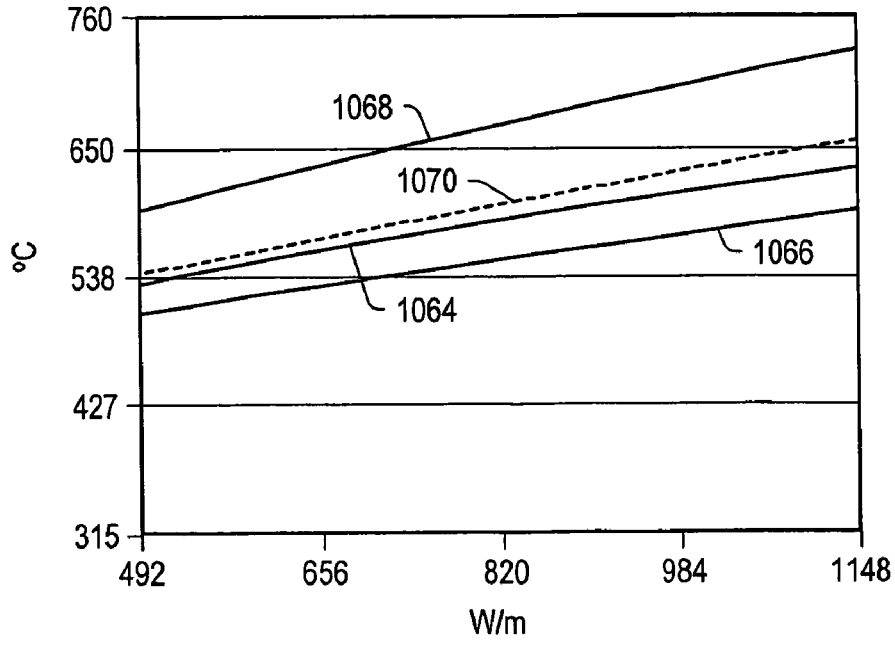

FIG. 164 shows heater rod temperature as a function of the power generated within a rod.

Figure 165:
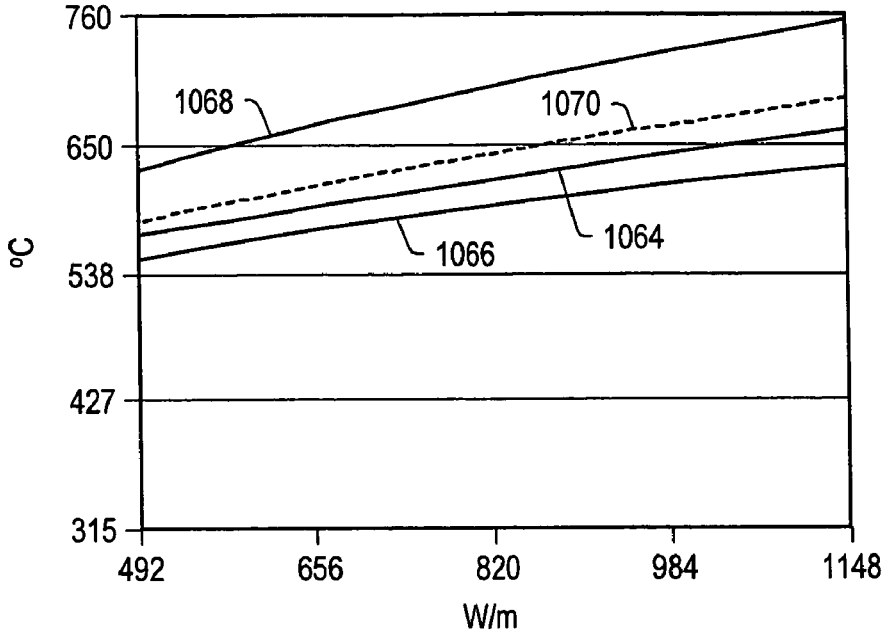

FIG. 165 shows heater rod temperature as a function of the power generated within a rod.

Figure 166:
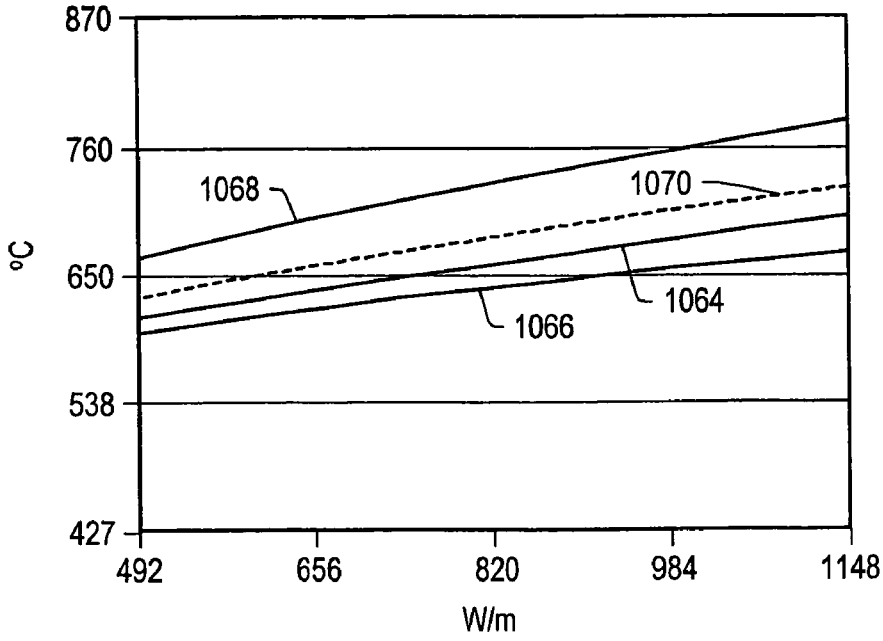

FIG. 166 shows heater rod temperature as a function of the power generated within a rod.

Figure 167:
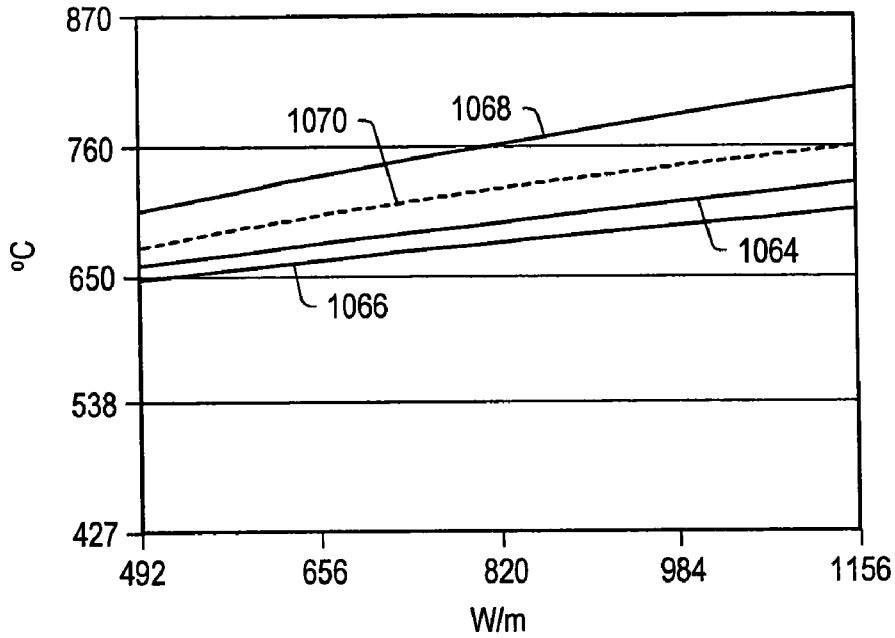

FIG. 167 shows heater rod temperature as a function of the power generated within a rod.

Figure 168:
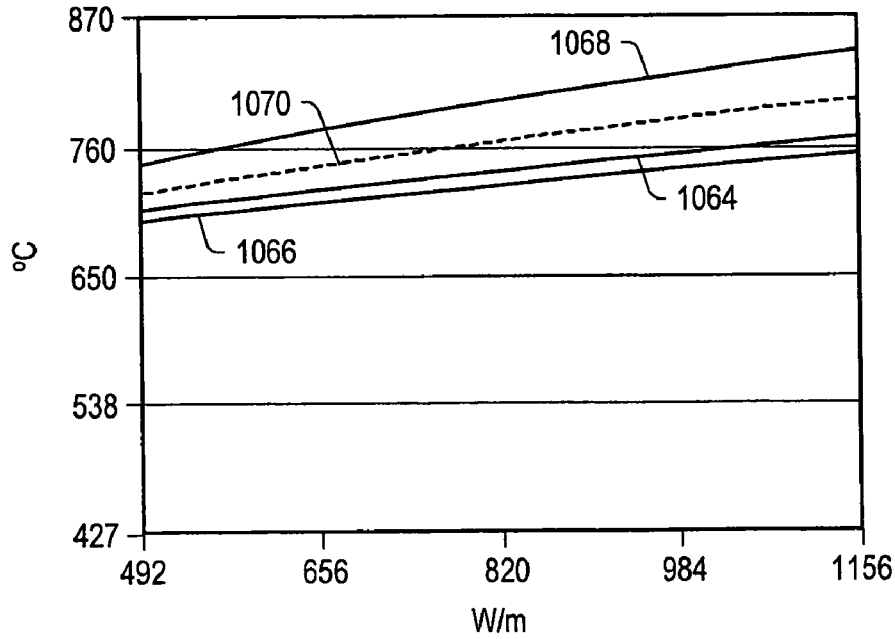

FIG. 168 shows heater rod temperature as a function of the power generated within a rod.

Figure 169:
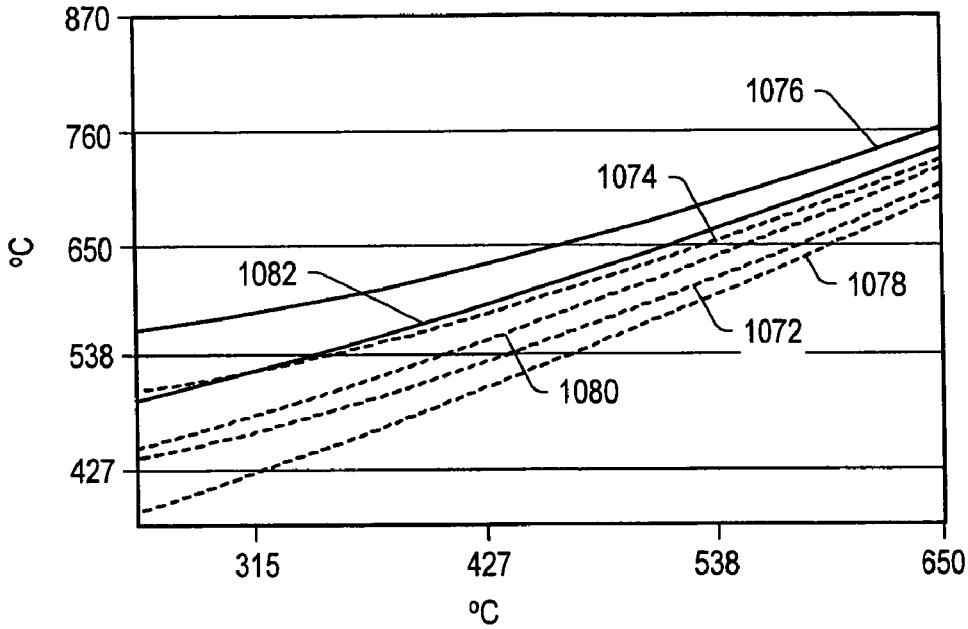

FIG. 169 shows a plot of center heater rod temperature versus conduit temperature for various heater powers with air or helium in the annulus.

Figure 170:
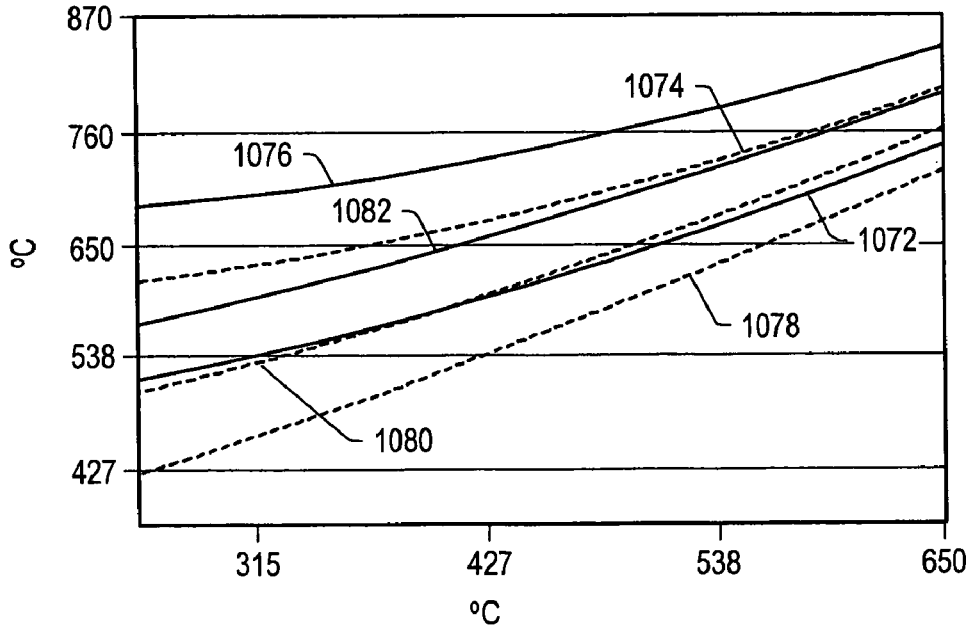

FIG. 170 shows a plot of center heater rod temperature versus conduit temperature for various heater powers with air or helium in the annulus.

Figure 171:
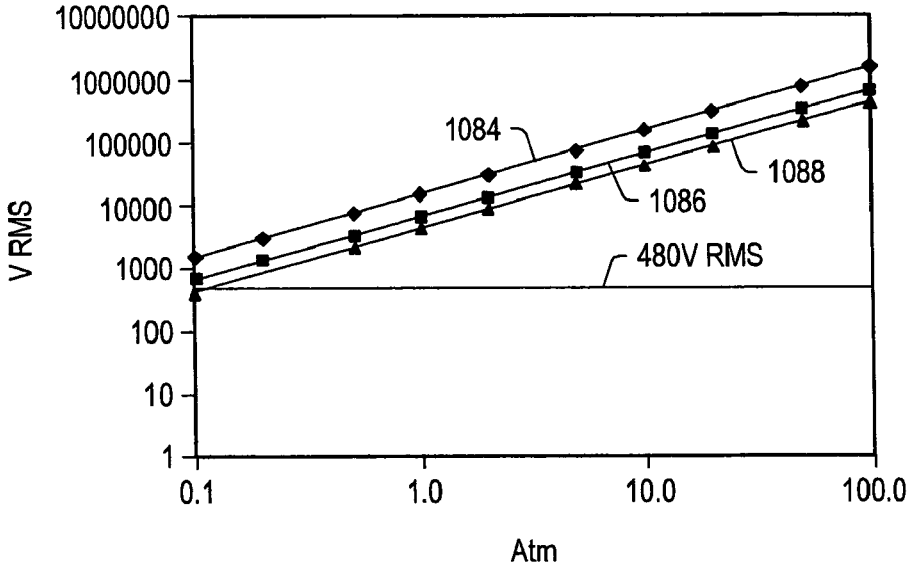

FIG. 171 depicts spark gap breakdown voltages versus pressure at different temperatures for a conductor-in-conduit heater with air in the annulus.

Figure 172:
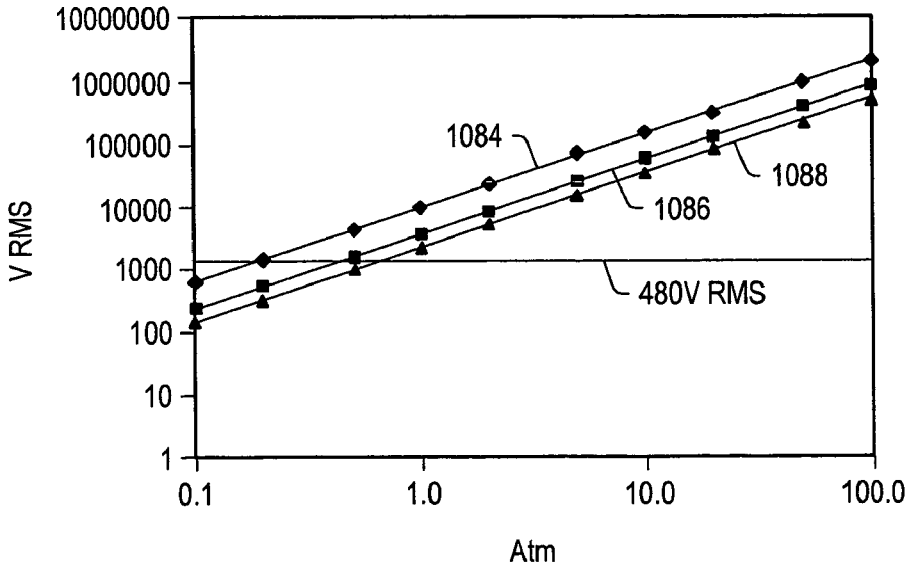

FIG. 172 depicts spark gap breakdown voltages versus pressure at different temperatures for a conductor-in-conduit heater with helium in the annulus.

Figure 173:
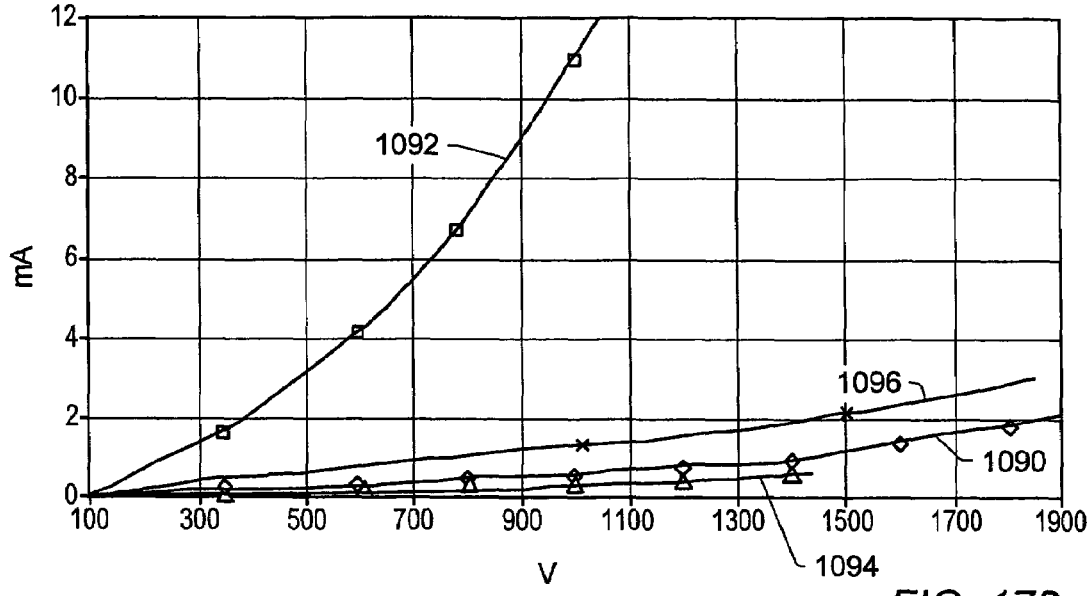

FIG. 173 depicts data of leakage current measurements versus voltage for alumina and silicon nitride centralizers at selected temperatures.

Figure 174:
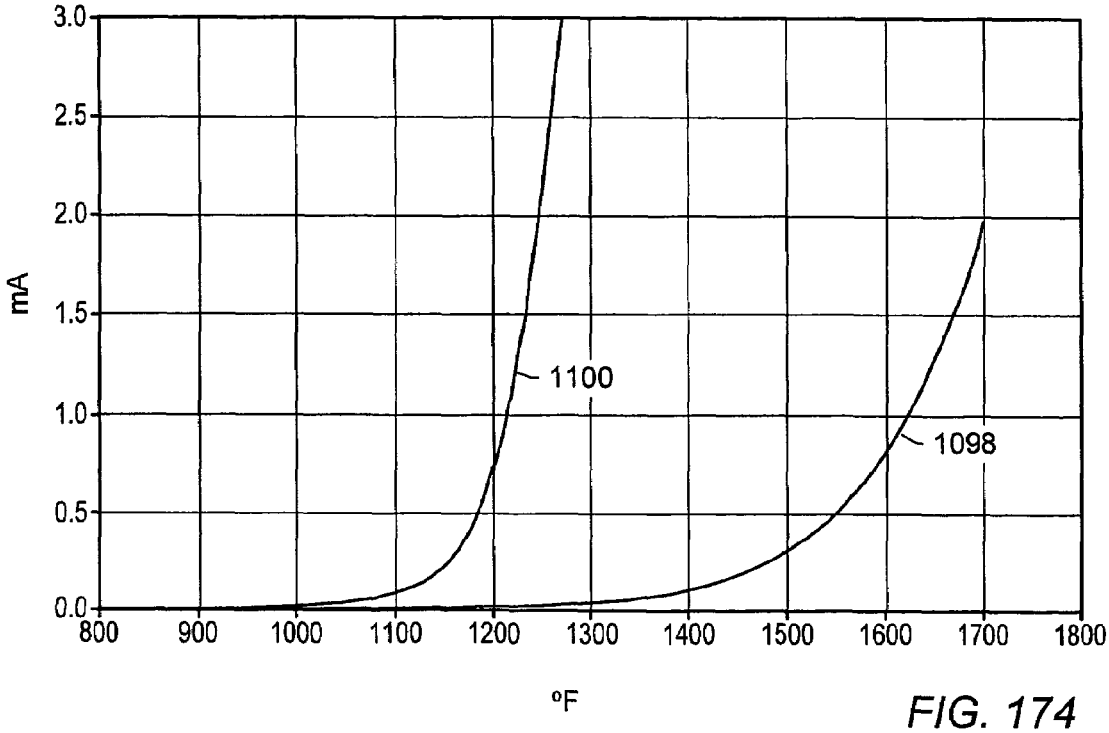

FIG. 174 depicts leakage current measurements versus temperature for two different types of silicon nitride.

Figure 175:
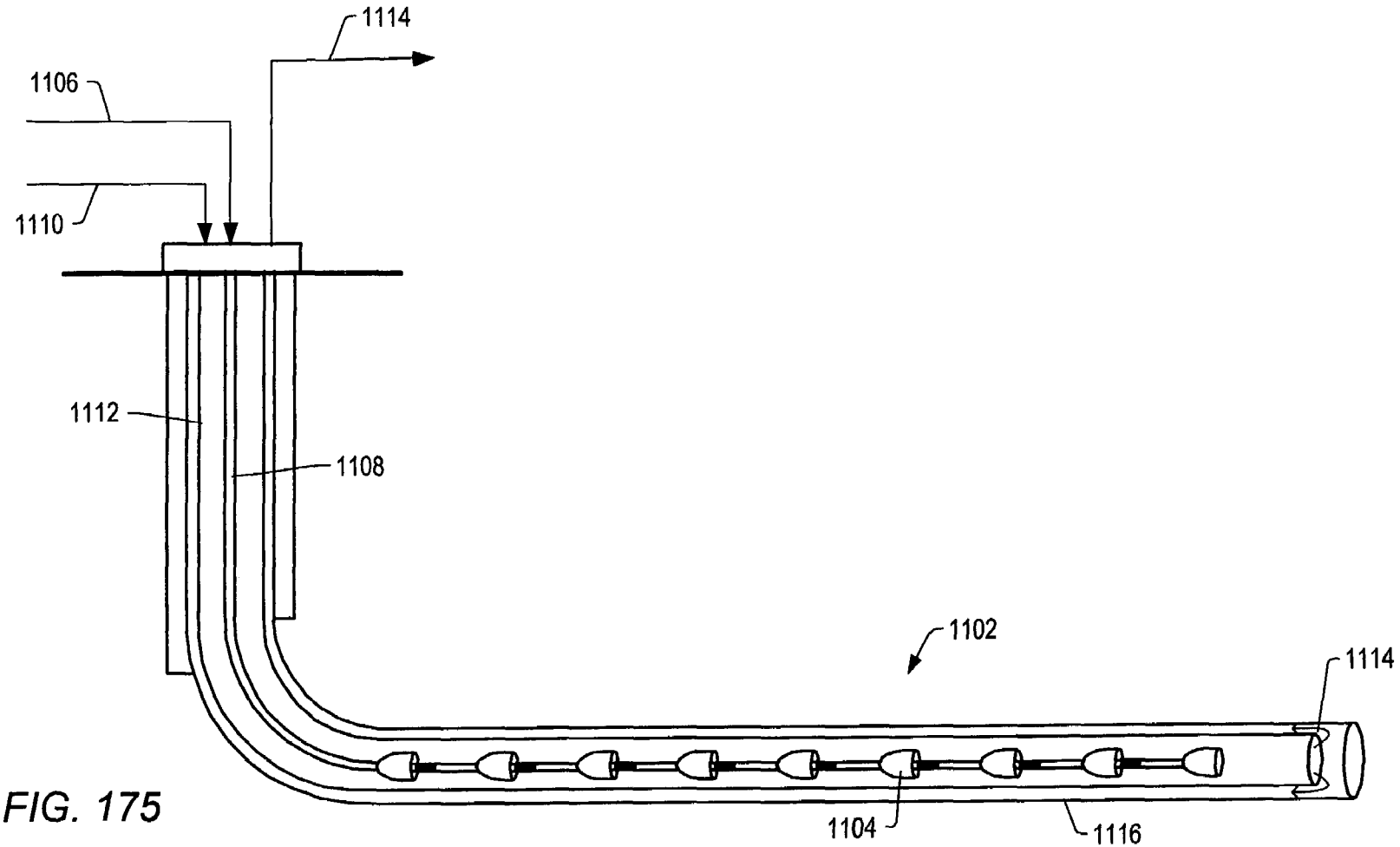

FIG. 175 depicts a schematic representation of an embodiment of a downhole oxidizer assembly.

Figure 176:
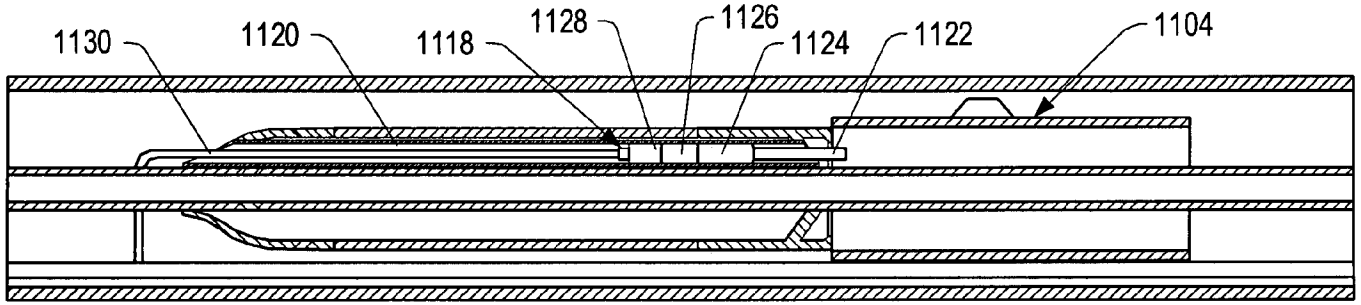

FIG. 176 depicts an embodiment of an ignition system positioned in a cross-sectional representation of an oxidizer.

Figure 177:
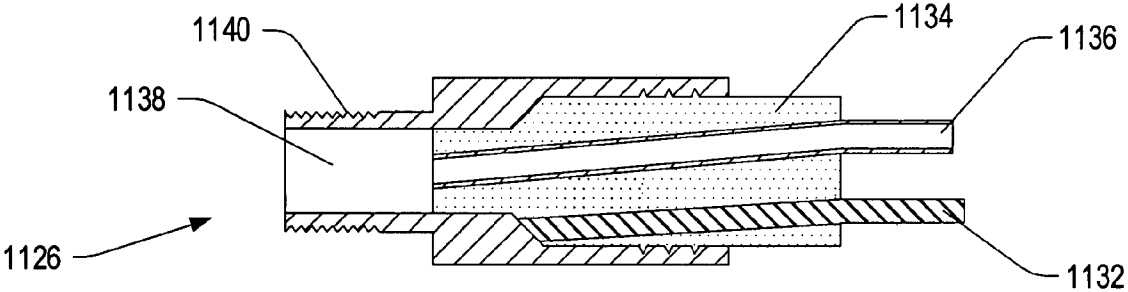

FIG. 177 depicts a cross-sectional representation of an embodiment of a transitional piece of an ignition system.

Figure 178:
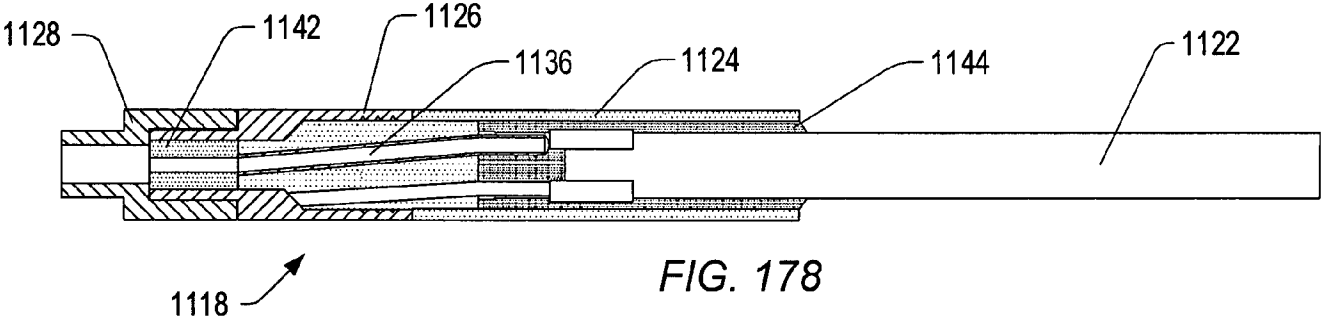

FIG. 178 depicts a cross-sectional representation of an embodiment of an ignition system.

Figure 179:
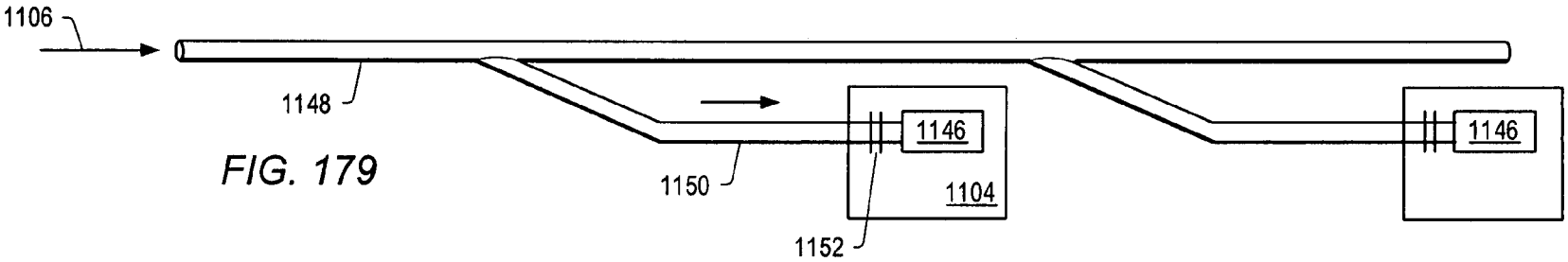

FIG. 179 depicts a catalytic material proximate an oxidizer in a downhole oxidizer assembly.

Figure 180:
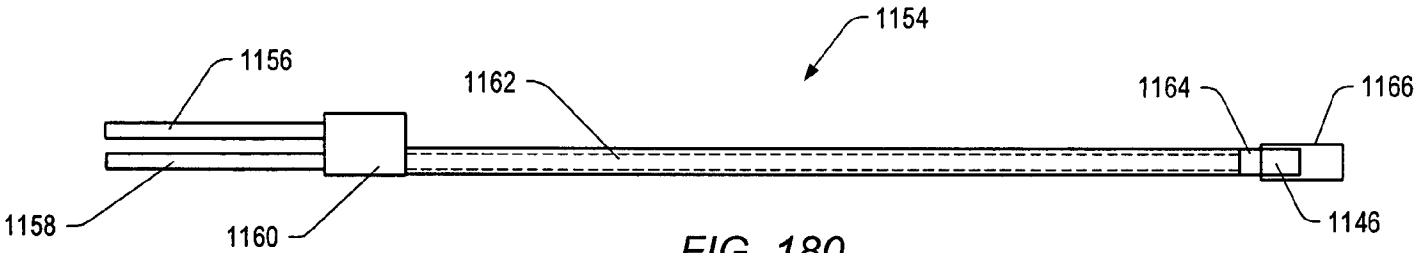

FIG. 180 depicts an embodiment of a catalytic igniter system.

Figure 181:
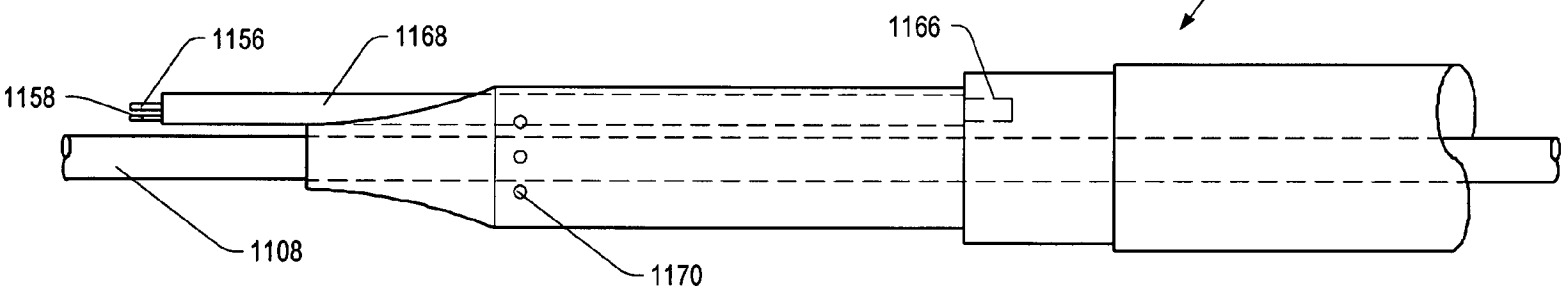

FIG. 181 depicts a cross-sectional representation of a portion of an oxidizer that uses a catalytic igniter system.

Figure 182:
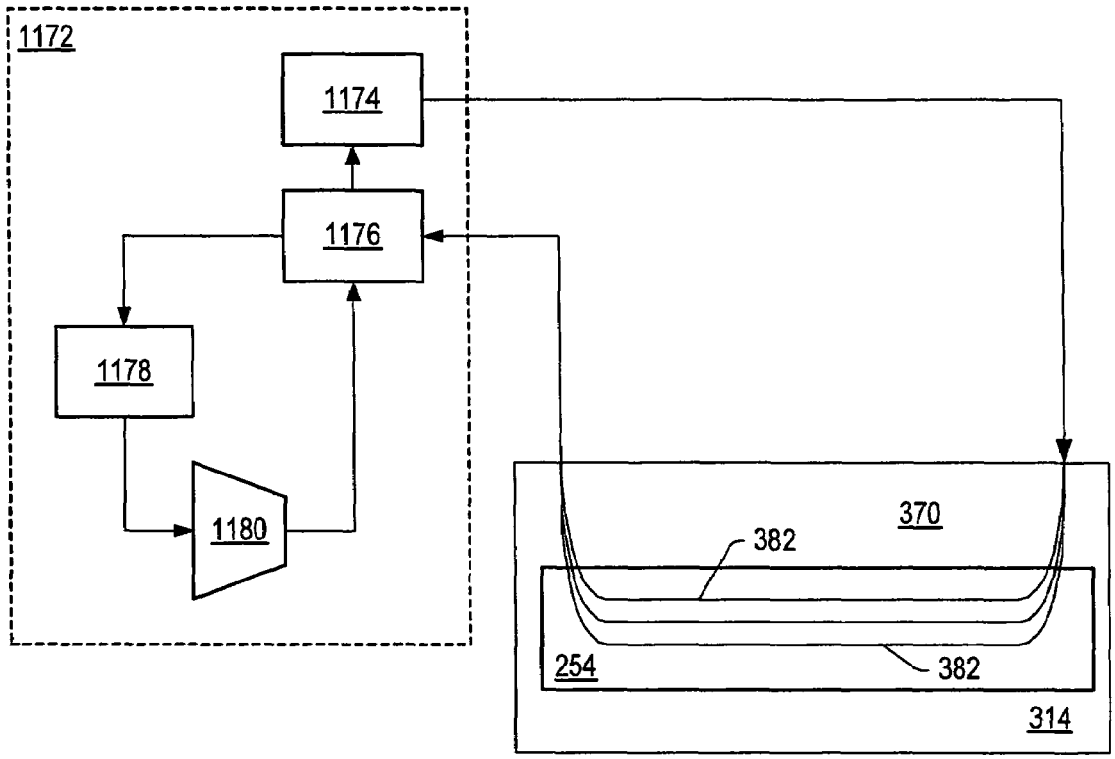

FIG. 182 depicts a schematic representation of a closed loop circulation system for heating a portion of a formation.

Figure 183:
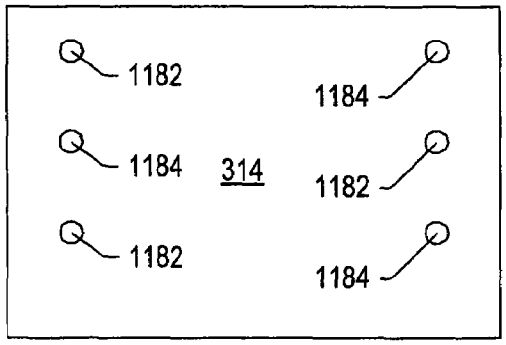

FIG. 183 depicts a plan view of wellbore entries and exits from a portion of a formation to be heated using a closed loop circulation system.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, siicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and animoma.

A "formation" includes one or more hydrocarbon containing layers, one or more non-hydrocarbon layers, an overburden, and/or an underburden. The "overburden" and/or the "underburden" include one or more different types of impermeable materials. For example, overburden and/or underburden may include rock, shale, mudstone, or wet/tight carbonate. In some embodiments of in situ conversion processes, the overburden and/or the underburden may include a hydrocarbon containing layer or hydrocarbon containing layers that are relatively impermeable and are not subjected to temperatures during in situ conversion processing that result in significant characteristic changes of the hydrocarbon containing layers of the overburden and/or the underburden. For example, the underburden may contain shale or mudstone, but the underburden is not allowed to heat to pyrolysis temperatures during the in situ conversion process. In some cases, the overburden and/or the underburden may be somewhat permeable.

A "formation" includes one or more hydrocarbon containing layers, one or more non-hydrocarbon layers, an overburden, and/or an underburden. The "overburden" and/or the "underburden" include one or more different types of impermeable materials. For example, overburden and/or underburden may include rock, shale, mudstone, or wet/tight carbonate. In some embodiments of in situ conversion processes, the overburden and/or the underburden may include a hydrocarbon containing layer or hydrocarbon containing layers that are relatively impermeable and are not subjected to temperatures during in situ conversion processing that results in significant characteristic changes of the hydrocarbon containing layers of the overburden and/or the underburden. For example, the underburden may contain shale or mudstone, but the underburden is not allowed to heat to pyrolysis temperatures during the in situ conversion process. In some cases, the overburden and/or the underburden may be somewhat permeable.

"Kerogen" is a solid, insoluble hydrocarbon that has been converted by natural degradation and that principally contains carbon, hydrogen, nitrogen, oxygen, and sulfur. Coal and oil shale are typical examples of materials that contain kerogen. "Bitumen" is a non-crystalline solid or viscous hydrocarbon material that is substantially soluble in carbon disulfide. "Oil" is a fluid containing a mixture of condensable hydrocarbons.

"Formation fluids" and "produced fluids" refer to fluids removed from the formation and may include pyrolyzation fluid, synthesis gas, mobilized hydrocarbon, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation.

"Thermally conductive fluid" includes fluid that has a higher thermal conductivity than air at standard temperature and pressure (STP) (0° C. and 101.325 kPa).

"Carbon number" refers to the number of carbon atoms in a molecule. A hydrocarbon fluid may include various hydrocarbons with different carbon numbers. The hydrocarbon fluid may be described by a carbon number distribution. Carbon numbers and/or carbon number distributions may be determined by true boiling point distribution and/or gas-liquid chromatography.

A "heat source" is any system for providing heat to at least a portion of a formation substantially by conductive and/or radiative heat transfer. For example, a heat source may include electric heaters such as an insulated conductor, an elongated member, and/or a conductor disposed in a conduit. A heat source may also include systems that generate heat by burning a fuel external to or in a formation, such as surface burners, downhole gas burners, flameless distributed combustors, and natural distributed combustors. In some embodiments, heat provided to or generated in one or more heat sources may be supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electric resistance heaters, some heat sources may provide heat from combustion, and some heat sources may provide heat from one or more other energy sources (e.g., chemical reactions, solar energy, wind energy, biomass, or other sources of renewable energy). A chemical reaction may include an exothermic reaction (e.g., an oxidation reaction). A heat source may also include a heater that provides heat to a zone proximate and/or surrounding a heating location such as a heater well.

A "heater" is any system for generating heat in a well or a near wellbore region. Heaters may be, but are not limited to, electric heaters, burners, combustors that react with material in or produced from a formation, and/or combinations thereof.

"Insulated conductor" refers to any elongated material that is able to conduct electricity and that is covered, in whole or in part, by an electrically insulating material.

"Temperature limited heater" generally refers to a heater that regulates heat output (for example, reduces heat output) above a specified temperature without the use of external controls such as temperature controllers, power regulators, rectifiers, or other devices. Temperature limited heaters may be AC (alternating current) or modulated (for example, "chopped") DC (direct current) powered electrical resistance heaters.

"Curie temperature" is the temperature above which a ferromagnetic material loses all of its ferromagnetic properties. In addition to losing all of its ferromagnetic properties above the Curie temperature, the ferromagnetic material begins to lose its ferromagnetic properties when an increasing electrical current is passed through the ferromagnetic material.

"Time-varying current" refers to electrical current that produces skin effect electricity flow in a ferromagnetic conductor and has a magnitude that varies with time. Time-varying current includes both alternating current (AC) and modulated direct current (DC).

"Alternating current (AC)" refers to a time-varying current that reverses direction substantially sinusoidally. AC produces skin effect electricity flow in a ferromagnetic conductor.

"Modulated direct current (DC)" refers to any substantially non-sinusoidal time-varying current that produces skin effect electricity flow in a ferromagnetic conductor.

"Turndown ratio" for the temperature limited heater is the ratio of the highest AC or modulated DC resistance below the Curie temperature to the lowest resistance above the Curie temperature for a given current.

In the context of reduced heat output heating systems, apparatus, and methods, the term "automatically" means such systems, apparatus, and methods function in a certain way without the use of external control (for example, external controllers such as a controller with a temperature sensor and a feedback loop, PID controller, or predictive controller).

"Nitride" refers to a compound of nitrogen and one or more other elements of the Periodic Table. Nitrides include, but are not limited to, silicon nitride, boron nitride, or alumina nitride.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

"Orifices" refer to openings (e.g., openings in conduits) having a wide variety of sizes and cross-sectional shapes including, but not limited to, circles, ovals, squares, rectangles, triangles, slits, or other regular or irregular shapes.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (e.g., a relatively permeable formation such as a tar sands formation) that is reacted or reacting to form a pyrolyzation fluid.

"Cracking" refers to a process involving decomposition and molecular recombination of organic compounds to produce a greater number of molecules than were initially present. In cracking, a series of reactions take place accompanied by a transfer of hydrogen atoms between molecules. For example, naphtha may undergo a thermal cracking reaction to form ethene and $H_2$.

"Superposition of heat" refers to providing heat from two or more heat sources to a selected section of a formation such that the temperature of the formation at least at one location between the heat sources is influenced by the heat sources.

"Thermal conductivity" is a property of a material that describes the rate at which heat flows, in steady state, between two surfaces of the material for a given temperature difference between the two surfaces.

"Fluid pressure" is a pressure generated by a fluid in a formation. "Lithostatic pressure" (sometimes referred to as "lithostatic stress") is a pressure in a formation equal to a weight per unit area of an overlying rock mass. "Hydrostatic pressure" is a pressure in a formation exerted by a column of water.

"Condensable hydrocarbons" are hydrocarbons that condense at 25° C. and one atmosphere absolute pressure. Condensable hydrocarbons may include a mixture of hydrocarbons having carbon numbers greater than 4. "Non-condensable hydrocarbons" are hydrocarbons that do not condense at 25° C. and one atmosphere absolute pressure. Non-condensable hydrocarbons may include hydrocarbons having carbon numbers less than 5.

"Olefins" are molecules that include unsaturated hydrocarbons having one or more non-aromatic carbon-carbon double bonds.

"Synthesis gas" is a mixture including hydrogen and carbon monoxide. Additional components of synthesis gas may include water, carbon dioxide, nitrogen, methane, and other gases. Synthesis gas may be generated by a variety of processes and feedstocks. Synthesis gas may be used for synthesizing a wide range of compounds.

A "dipping" formation refers to a formation that slopes downward or inclines from a plane parallel to the Earth's surface, assuming the plane is flat (i.e., a "horizontal" plane).

"Subsidence" is a downward movement of a portion of a formation relative to an initial elevation of the surface.

"Thickness" of a layer refers to the thickness of a cross section of the layer, wherein the cross section is normal to a face of the layer.

"Coring" is a process that generally includes drilling a hole into a formation and removing a substantially solid mass of the formation from the hole.

"Enriched air" refers to air having a larger mole fraction of oxygen than air in the atmosphere. Air is typically enriched to increase combustion-supporting ability of the air.

"Rich layers" in a hydrocarbon containing formation are relatively thin layers (typically about 0.2 m to about 0.5 m thick). Rich layers generally have a richness of about 0.150 L/kg or greater. Some rich layers have a richness of about 0.170 L/kg or greater, of about 0.190 L/kg or greater, or of about 0.210 L/kg or greater. Lean layers of the formation have a richness of about 0.100 L/kg or less and are generally thicker than rich layers. The richness and locations of layers are determined, for example, by coring and subsequent Fischer assay of the core, density or neutron logging, or other logging methods. Rich layers have a lower initial thermal conductivity than other layers of the formation. Typically, rich layers have a thermal conductivity 1.5 times to 3 times lower than the thermal conductivity of lean layers. In addition, rich layers have a higher thermal expansion coefficient than lean layers of the formation.

"API gravity" refers to API gravity at 15.5° C. (60° F.). API gravity is as determined by ASTM Method D6822. "ASTM" refers to American Standard Testing and Materials.

"Heavy hydrocarbons" are viscous hydrocarbon fluids. Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may also include aromatics or other complex ring hydrocarbons.

Heavy hydrocarbons may be found in a relatively permeable formation. The relatively permeable formation may include heavy hydrocarbons entrained in, for example, sand or carbonate. "Relatively permeable" is defined, with respect to formations or portions thereof, as an average permeability of 10 millidarcy or more (e.g., 10 or 100 millidarcy). "Relatively low permeability" is defined, with respect to formations or portions thereof, as an average permeability of less than about 10 millidarcy. One darcy is equal to about 0.99 square micrometers. An impermeable layer generally has a permeability of less than about 0.1 millidarcy.

"Tar" is a viscous hydrocarbon that generally has a viscosity greater than about 10,000 centipoise at 15° C. The specific gravity of tar generally is greater than 1.000. Tar may have an API gravity less than 10°.

A "tar sands formation" is a formation in which hydrocarbons are predominantly present in the form of heavy hydrocarbons and/or tar entrained in a mineral grain framework or other host lithology (e.g., sand or carbonate).

In some cases, a portion or all of a hydrocarbon portion of a relatively permeable formation may be predominantly heavy hydrocarbons and/or tar with no supporting mineral grain framework and only floating (or no) mineral matter (e.g., asphalt lakes).

Certain types of formations that include heavy hydrocarbons may also be, but are not limited to, natural mineral waxes, or natural asphaltites. "Natural mineral waxes" typically occur in substantially tubular veins that may be several meters wide, several kilometers long, and hundreds of meters deep. "Natural asphaltites" include solid hydrocarbons of an aromatic composition and typically occur in large veins. In situ recovery of hydrocarbons from formations such as natural mineral waxes and natural asphaltites may include melting to form liquid hydrocarbons and/or solution mining of hydrocarbons from the formations.

"Upgrade" refers to increasing the quality of hydrocarbons. For example, upgrading heavy hydrocarbons may result in an increase in the API gravity of the heavy hydrocarbons.

"Thermal fracture" refers to fractures created in a formation caused by expansion or contraction of a formation and/or fluids in the formation, which is in turn caused by increasing/decreasing the temperature of the formation and/or fluids in the formation, and/or by increasing/decreasing a pressure of fluids in the formation due to heating.

Figure 1:
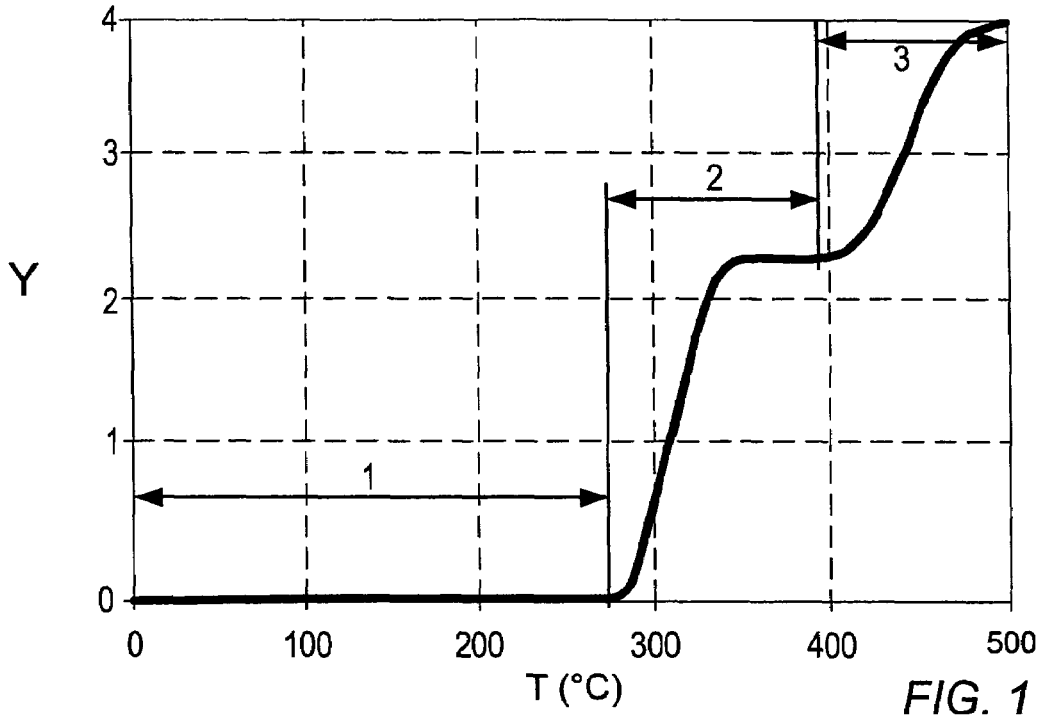
FIG. 1 depicts an illustration of stages of heating a hydrocarbon containing formation.

Hydrocarbons in formations may be treated in various ways to produce many different products. In certain embodiments, hydrocarbons in formations are treated in stages. FIG. 1 depicts an illustration of stages of heating the hydrocarbon containing formation. FIG. 1 also depicts an example of yield ("Y") in barrels of oil equivalent per ton (y axis) of formation fluids from the formation versus temperature ("T") of the heated formation in degrees Celsius (x axis).

Desorption of methane and vaporization of water occurs during stage 1 heating. Heating of the formation through stage 1 may be performed as quickly as possible. For example, when the hydrocarbon containing formation is initially heated, hydrocarbons in the formation desorb adsorbed methane. The desorbed methane may be produced from the formation. If the hydrocarbon containing formation is heated further, water in the hydrocarbon containing formation is vaporized. Water may occupy, in some hydrocarbon containing formations, between 10% and 50% of the pore volume in the formation. In other formations, water occupies larger or smaller portions of the pore volume. Water typically is vaporized in a formation between 160° C. and 285° C. at pressures of 600 kPa absolute to 7000 kPa absolute. In some embodiments, the vaporized water produces wettability changes in the formation and/or increased formation pressure. The wettability changes and/or increased pressure may affect pyrolysis reactions or other reactions in the formation. In certain embodiments, the vaporized water is produced from the formation. In other embodiments, the vaporized water is used for steam extraction and/or distillation in the formation or outside the formation. Removing the water from and increasing the pore volume in the formation increases the storage space for hydrocarbons in the pore volume.

In certain embodiments, after stage 1 heating, the formation is heated further, such that a temperature in the formation reaches (at least) an initial pyrolyzation temperature (such as a temperature at the lower end of the temperature range shown as stage 2). Hydrocarbons in the formation may be pyrolyzed throughout stage 2. A pyrolysis temperature range varies depending on the types of hydrocarbons in the formation. The pyrolysis temperature range may include temperatures between 250° C. and 900° C. The pyrolysis temperature range for producing desired products may extend through only a portion of the total pyrolysis temperature range. In some embodiments, the pyrolysis temperature range for producing desired products may include temperatures between 250° C. and 400° C. or temperatures between 270° C. and 350° C. If a temperature of hydrocarbons in a formation is slowly raised through the temperature range from 250° C. to 400° C., production of pyrolysis products may be substantially complete when the temperature approaches 400° C. Average temperature of the hydrocarbons may be raised at a rate of less than 5° C. per day, less than 2° C. per day, less than 1° C. per day, or less than 0.5° C. per day through the pyrolysis temperature range for producing desired products Heating the hydrocarbon containing formation with a plurality of heat sources may establish thermal gradients around the heat sources that slowly raise the temperature of hydrocarbons in the formation through the pyrolysis temperature range.

The rate of temperature increase through the pyrolysis temperature range for desired products may affect the quality and quantity of the formation fluids produced from the hydrocarbon containing formation. Raising the temperature slowly through the pyrolysis temperature range for desired products may inhibit mobilization of large chain molecules in the formation. Raising the temperature slowly through the pyrolysis temperature range for desired products may limit reactions between mobilized hydrocarbons that produce undesired products. Slowly raising the temperature of the formation through the pyrolysis temperature range for desired products may allow for the production of high quality, high API gravity hydrocarbons from the formation. Slowly raising the temperature of the formation through the pyrolysis temperature range for desired products may allow for the removal of a large amount of the hydrocarbons present in the formation as hydrocarbon product.

In some in situ conversion embodiments, a portion of a formation is heated to a desired temperature instead of slowly heating the temperature through a temperature range. In some embodiments, the desired temperature is 300° C., 325° C., or 350° C. Other temperatures may be selected as the desired temperature. Superposition of heat from heat sources allows the desired temperature to be relatively quickly and efficiently established in the formation. Energy input into the formation from the heat sources may be adjusted to maintain the temperature in the formation substantially at the desired temperature. The heated portion of the formation is maintained substantially at the desired temperature until pyrolysis declines such that production of desired formation fluids from the formation becomes uneconomical. Parts of a formation that are subjected to pyrolysis may include regions brought into a pyrolysis temperature range by heat transfer from only one heat source.

In certain embodiments, formation fluids including pyrolyzation fluids are produced from the formation. As the temperature of the formation increases, the amount of condensable hydrocarbons in the produced formation fluid may decrease. At high temperatures, the formation may produce mostly methane and/or hydrogen. If the hydrocarbon containing formation is heated throughout an entire pyrolysis range, the formation may produce only small amounts of hydrogen towards an upper limit of the pyrolysis range. After all of the available hydrogen is depleted, a minimal amount of fluid production from the formation will typically occur.

After pyrolysis of hydrocarbons, a large amount of carbon and some hydrogen may still be present in the formation. A significant portion of carbon remaining in the formation can be produced from the formation in the form of synthesis gas. Synthesis gas generation may take place during stage 3 heating depicted in FIG. 1. Stage 3 may include heating a hydrocarbon containing formation to a temperature sufficient to allow synthesis gas generation. For example, synthesis gas may be produced in a temperature range from about 400° C. to about 1200° C., about 500° C. to about 1100° C., or about 550° C. to about 1000° C. The temperature of the heated portion of the formation when the synthesis gas generating fluid is introduced to the formation determines the composition of synthesis gas produced in the formation. The generated synthesis gas may be removed from the formation through a production well or production wells.

Total energy content of fluids produced from the hydrocarbon containing formation may stay relatively constant throughout pyrolysis and synthesis gas generation. During pyrolysis at relatively low formation temperatures, a significant portion of the produced fluid may be condensable hydrocarbons that have a high energy content. At higher pyrolysis temperatures, however, less of the formation fluid may include condensable hydrocarbons. More non-condensable formation fluids may be produced from the formation. Energy content per unit volume of the produced fluid may decline slightly during generation of predominantly non-condensable formation fluids. During synthesis gas generation, energy content per unit volume of produced synthesis gas declines significantly compared-to energy content of pyrolyzation fluid. The volume of the produced synthesis gas, however, will in many instances increase substantially, thereby compensating for the decreased energy content.

Figure 2:
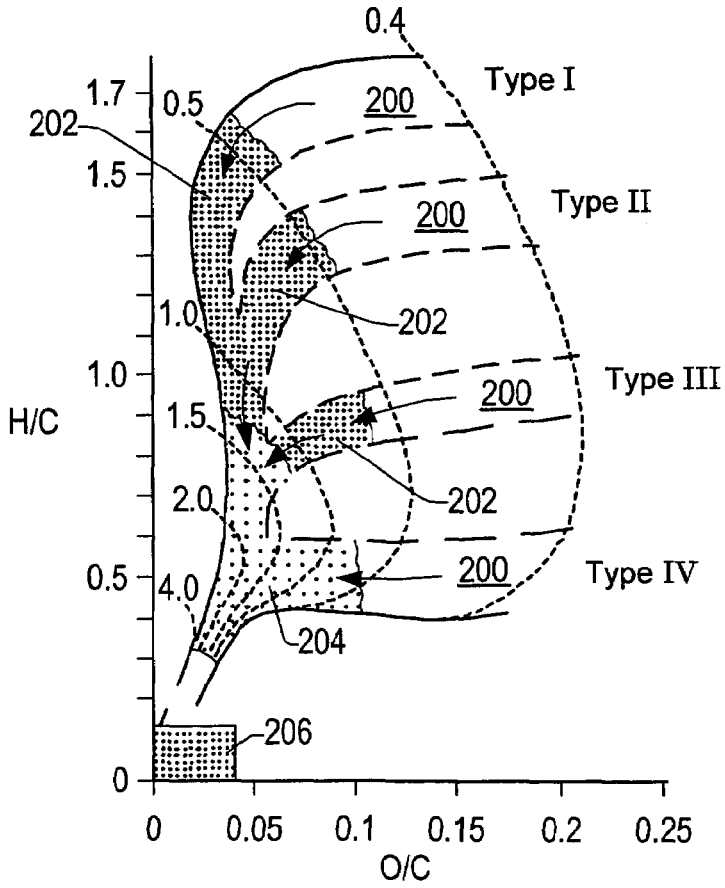
FIG. 2 depicts a diagram that presents several properties of kerogen resources.

FIG. 2 depicts a van Krevelen diagram. The van Krevelen diagram is a plot of atomic hydrogen to carbon ratio (H/C y axis) versus atomic oxygen to carbon ratio (O/C x axis) for various types of kerogen. The van Krevelen diagram shows the maturation sequence for various types of kerogen that typically occurs over geological time due to temperature, pressure, and biochemical degradation. The maturation sequence may be accelerated by heating in situ at a controlled rate and/or a controlled pressure.

The van Krevelen diagram may be useful for selecting a resource for practicing various in situ conversion embodiments. Treating a formation containing kerogen in region 200 may produce carbon dioxide, non-condensable hydrocarbons, hydrogen, and water, along with a relatively small amount of condensable hydrocarbons. Treating a formation containing kerogen in region 202 may produce condensable and non-condensable hydrocarbons, carbon dioxide, hydrogen, and water. Treating a formation containing kerogen in region 204 will in many instances produce methane and hydrogen. A formation containing kerogen in region 202 may be selected for treatment because treating region 202 kerogen may produce large quantities of valuable hydrocarbons, and low quantities of undesirable products such as carbon dioxide and water. A region 202 kerogen may produce large quantities of valuable hydrocarbons and low quantities of undesirable products because the region 202 kerogen has already undergone dehydration and/or decarboxylation over geological time. In addition, region 202 kerogen can be further treated to make other useful products (e.g., methane, hydrogen, and/or synthesis gas) as the kerogen transforms to region 204 kerogen.

If a formation containing kerogen in region 200 or region 202 is selected for in situ conversion, in situ thermal treatment may accelerate maturation of the kerogen along paths represented by arrows in FIG. 2. For example, region 200 kerogen may transform to region 202 kerogen and possibly then to region 204 kerogen. Region 202 kerogen may transform to region 204 kerogen. In situ conversion may expedite maturation of kerogen and allow production of valuable products from the kerogen.

If region 200 kerogen is treated, a substantial amount of carbon dioxide may be produced due to decarboxylation of hydrocarbons in the formation. In addition to carbon dioxide, region 200 kerogen may produce some hydrocarbons, such as methane. Treating region 200 kerogen may produce substantial amounts of water due to dehydration of kerogen in the formation. Production of water from kerogen may leave hydrocarbons remaining in the formation enriched in carbon. Oxygen content of the hydrocarbons may decrease faster than hydrogen content of the hydrocarbons during production of water and carbon dioxide from the formation. Therefore, production of water and carbon dioxide from region 200 kerogen may result in a larger decrease in the atomic oxygen to carbon ratio than in the atomic hydrogen to carbon ratio (see region 200 arrows in FIG. 2 which depict more horizontal than vertical movement).

If region 202 kerogen is treated, some of the hydrocarbons in the formation may be pyrolyzed to produce condensable and non-condensable hydrocarbons. For example, treating region 202 kerogen may result in production of oil from hydrocarbons, as well as some carbon dioxide and water. In situ conversion of region 202 kerogen may produce significantly less carbon dioxide and water than is produced during in situ conversion of region 200 kerogen. Therefore, the atomic hydrogen to carbon ratio of the kerogen may decrease rapidly as the kerogen in region 202 is treated. The atomic oxygen to carbon ratio of region 202 kerogen may decrease much slower than the atomic hydrogen to carbon ratio of region 202 kerogen.

Kerogen in region 204 may be treated to generate methane and hydrogen. For example, if such kerogen was previously treated (e.g., the kerogen was previously region 202 kerogen), then after pyrolysis longer hydrocarbon chains of the hydrocarbons may have cracked and been produced from the formation. Carbon and hydrogen, however, may still be present in the formation.

If kerogen in region 204 is heated to a synthesis gas generating temperature and a synthesis gas generating fluid such as steam is added to the kerogen of region 204, then at least a portion of remaining hydrocarbons in the formation may be produced from the formation in the form of synthesis gas. For kerogen in region 204, the atomic hydrogen to carbon ratio and the atomic oxygen to carbon ratio in the hydrocarbons may significantly decrease as the temperature rises. Hydrocarbons in the formation may be transformed into relatively pure carbon in region 204. Heating region 204 kerogen to still higher temperatures may transform such kerogen into graphite 206.

The van Krevelen diagram shown in FIG. 2 classifies various natural deposits of kerogen. For example, kerogen may be classified into four distinct groups: type I, type II, type III, and type IV, which are illustrated by the four branches of the van Krevelen diagram. The van Krevelen diagram shows the maturation sequence for kerogen that typically occurs over geological time due to temperature and pressure. Classification of kerogen type may depend upon precursor materials of the kerogen. The precursor materials transform over time into macerals. Macerals are microscopic structures that have different structures and properties depending on the precursor materials from which they are derived.

The dashed lines in FIG. 2 correspond to vitrinite reflectance. Vitrinite reflectance is a measure of maturation. As kerogen undergoes maturation, the composition of the kerogen usually changes due to expulsion of volatile matter such as carbon dioxide, methane, water, and oil. Vitrinite reflectance of kerogen indicates the level to which kerogen has matured. As vitrinite reflectance increases, the volatile matter in, and producible from, the kerogen tends to decrease. In addition, the moisture content of kerogen generally decreases as the rank increases.

Figure 3:
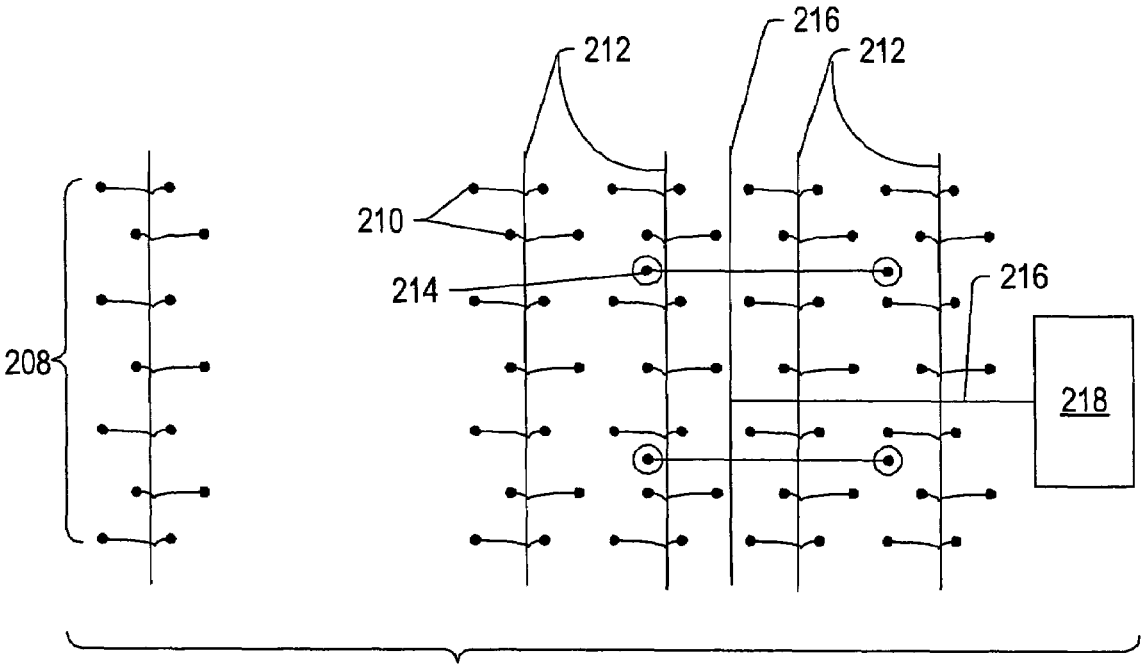
FIG. 3 shows a schematic view of an embodiment of a portion of an in situ conversion system for treating a hydrocarbon containing formation.

FIG. 3 depicts a schematic view of an embodiment of a portion of the in situ conversion system for treating the hydrocarbon containing formation. The in situ conversion system may include barrier wells 208. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 208 are dewatering wells. Dewatering wells may remove liquid water and/or inhibit liquid water from entering a portion of the formation to be heated, or to the formation being heated. In the embodiment depicted in FIG. 3, the dewatering wells are shown extending only along one side of heat sources 210, but dewatering wells typically encircle all heat sources 210 used, or to be used, to heat the formation.

Heat sources 210 are placed in at least a portion of the formation. Heat sources 210 may include electric heaters such as insulated conductors, conductor-in-conduit heaters, surface burners, flameless distributed combustors, and/or natural distributed combustors. Heat sources 210 may also include other types of heaters. Heat sources 210 provide heat to at least a portion of the formation to heat hydrocarbons in the formation. Energy may be supplied to heat sources 210 through supply lines 212. Supply lines 212 may be structurally different depending on the type of heat source or heat sources used to heat the formation. Supply lines 212 for heat sources may transmit electricity for electric heaters, may transport fuel for combustors, or may transport heat exchange fluid that is circulated in the formation.

When the formation is heated, the heat input into the formation may cause expansion of the formation and geomechanical motion. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 214 to be spaced relatively far apart in the formation.

Production wells 214 are used to remove formation fluid from the formation. In some embodiments, production well 214 includes a heat source. The heat source in the production well may heat one or more portions of the formation at or near the production well. In some in situ conversion process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well may remain on after the heat source in the lower portion of the production well is deactivated. The heat source in the upper portion of the well may inhibit condensation and reflux of formation fluid.

In some embodiments, the heat source in production well 214 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds ($C_6$ and above) in the production well, (5) and/or (3) increase formation permeability at or proximate the production well.

Subsurface pressure in the formation may correspond to the fluid pressure generated in the formation. As temperatures in the heated portion of the formation increase, the pressure in the heated portion may increase as a result of increased fluid generation and vaporization of water. Controlling rate of fluid removal from the formation may allow for control of pressure in the formation. Pressure in the formation may be determined at a number of different locations, such as near or at production wells, near or at heat sources, or at monitor wells.

In some hydrocarbon containing formations, production of hydrocarbons from the formation is inhibited until at least some hydrocarbons in the formation have been pyrolyzed. Formation fluid may be produced from the formation when the formation fluid is of a selected quality. In some embodiments, the selected quality includes an API gravity of at least about 20°, 30°, or 40°. Inhibiting production until at least some hydrocarbons are pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to pyrolysis temperatures before substantial permeability has been generated in the heated portion of the formation. An initial lack of permeability may inhibit the transport of generated fluids to production wells 214. During initial heating, fluid pressure in the formation may increase proximate the heat sources 210. The increased fluid pressure may be released, monitored, altered, and/or controlled through one or more heat sources 210. For example, selected heat sources 210 or separate pressure relief wells may include pressure relief valves that allow for removal of some fluid from the formation.

In some embodiments, pressure generated by expansion of pyrolysis fluids or other fluids generated in the formation may be allowed to increase although an open path to production wells 214 or any other pressure sink may not yet exist in the formation. The fluid pressure may be allowed to increase towards a lithostatic pressure. Fractures in the hydrocarbon containing formation may form when the fluid approaches the lithostatic pressure. For example, fractures may form from heat sources 210 to production wells 214 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After pyrolysis temperatures are reached and production from the formation is allowed, pressure in the formation may be varied to alter and/or control a composition of formation fluid produced, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ conversion process embodiments, pressure in the formation may be maintained high enough to promote production of formation fluid with an API gravity of greater than 20°. Maintaining increased pressure in the formation may inhibit formation subsidence during in situ conversion. Maintaining increased pressure may facilitate vapor phase production of fluids from the formation. Vapor phase production may allow for a reduction in size of collection conduits used to transport fluids produced from the formation. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. $H_2$ in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. Therefore, $H_2$ in the liquid phase may inhibit the generated pyrolyzation fluids from reacting with each other and/or with other compounds in the formation.

Formation fluid produced from production wells 214 may be transported through collection piping 216 to treatment facilities 218. Formation fluids may also be produced from heat sources 210. For example, fluid may be produced from heat sources 210 to control pressure in the formation adjacent to the heat sources. Fluid produced from heat sources 210 may be transported through tubing or piping to collection piping 216 or the produced fluid may be transported through tubing or piping directly to treatment facilities 218. Treatment facilities 218 may include separation units, reaction units, upgrading units, fuel cells, turbines, storage vessels, and/or other systems and units for processing produced formation fluids.

Figure 4:
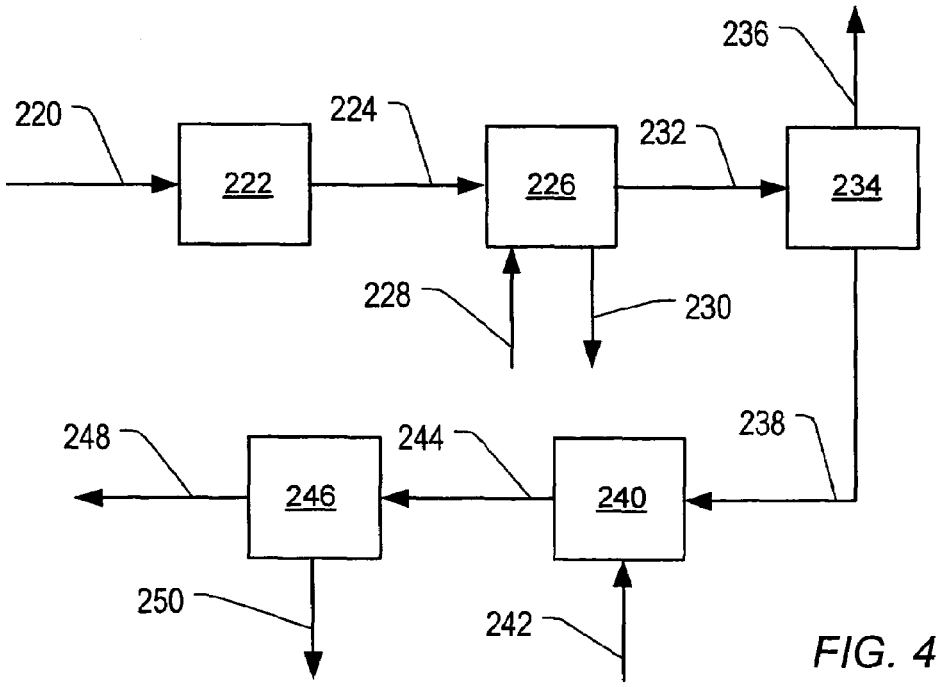
FIG. 4 depicts a schematic representation of an embodiment of a system for producing pipeline gas.

Formation fluid produced from the in situ conversion process may be sent to a separator to split the stream into an in situ conversion process liquid stream and an in situ conversion process gas stream. The liquid stream and the gas stream may be further treated to yield desired products. All or a portion of the gas stream may be treated to yield a gas that meets natural gas pipeline specifications. FIG. 4 depicts a schematic representation of an embodiment of a system for producing pipeline gas from the in situ conversion process gas stream.

In situ conversion process gas 220 is sent to unit 222. Unit 222 scrubs in situ conversion process gas 220 to remove sulfur compounds and/or carbon dioxide. Unit 222 may contain, but is not limited to containing, diethanolamine, diisopropanolamine, a combination of amines, and/or a sulfinol composition.

Gas stream 224 from unit 222 passes to hydrogenation reactor 226. Hydrogenation reactor 226 has a nickel-based catalyst. Suitable catalysts include, but are not limited to, Criterion 424, DN-140, DN-200, and DN-3100 available from Criterion Catalysts & Technologies (Houston, Tex.). Hydrogenation reactor 226 hydrogenates olefins and converts carbon monoxide to methane. Hydrogenation reactor 226 may operate at a temperature of about 66° C. Inlet hydrogen stream 228 may enter hydrogenation reactor 226. Hydrogenation reactor 226 includes a knockout pot. The knockout pot removes any heavy by-products 230 from the product gas stream.

Gas stream 232 from hydrogenation reactor 226 passes to hydrogen separation unit 234. Hydrogen separation unit 234 may be any suitable unit capable of separating hydrogen from the incoming gas stream. Hydrogen separation unit 234 may be a membrane unit, a pressure swing adsorption unit, a liquid absorption unit or a cryogenic unit. In an embodiment, hydrogen separation unit 234 is a membrane unit. Hydrogen separation unit 234 may include PRISM membranes available from Air Products and Chemicals, Inc. (Allentown, Pa.). The membrane separation unit may be operated at about 66° C. Hydrogen rich stream 236 produced from hydrogen separation unit 234 may be used as a feed stream to hydrogenation reactor 226.

Gas stream 238 from hydrogen separation unit 234 passes to oxidation reactor 240. Oxidation reactor 240 further reduces the amount of hydrogen in gas stream 238 by oxidation to form water. In some embodiments, the oxidation reactor is not needed. In some embodiments, inlet stream 242 may provide pure oxygen to oxidation reactor 240. In some embodiments, inlet stream 242 may provide air or oxygen enriched air. Air or oxygen enriched air may be provided if the amount of oxygen needed to remove the remaining hydrogen is low enough so that the nitrogen in the inlet stream would not result in a nitrogen content of the product gas that exceeds pipeline specifications. Oxidation reactor 240 may include a catalyst. In some embodiments, the catalyst is palladium on alumina base with about 0.2% by weight loading. Oxidation reactor 240 may be operated at a temperature of about 66° C.

Resulting gas stream 244 from oxidation reactor 240 passes to dehydration unit 246. Dehydration unit 246 may be a standard gas plant glycol dehydration unit. Pipeline gas 248 and water 250 may leave dehydration unit 246.

Wellbores may be formed in the ground using any desired method. Wellbores may be drilled, impacted, and/or vibrated in the ground. In some embodiments, wellbores are formed using reverse circulation drilling. Reverse circulation drilling may minimize formation damage due to contact with drilling muds and cuttings. Reverse circulation drilling may inhibit contamination of cuttings so that recovered cuttings can be used as a substitute for coring. Reverse circulation drilling may significantly reduce the volume of drilling fluid. The drilling fluid may be, for example, air, water, brine, or a drilling mud. The reduction may significantly reduce drilling costs. Formation water production is reduced when using reverse circulation drilling. Reverse circulation drilling permits use of air drilling without resulting in excessive air pockets being left in the formation. Prevention of air pockets in the formation during formation of wellbores is desirable, especially if the wellbores are to be used as freeze wells for forming a barrier around a treatment area.

Reverse circulation drilling systems may include components to enable directional drilling. For example, steerable motors, bent subs for altering the direction of the borehole, or autonomous drilling packages could be included.

When drilling a wellbore, a magnet or magnets may be inserted into a first opening to provide a magnetic field used to guide a drilling mechanism that forms an adjacent opening or adjacent openings. The magnetic field may be detected by a 3-axis fluxgate magnetometer in the opening being drilled. A control system may use information detected by the magnetometer to determine and implement operation parameters needed to form an opening that is a selected distance away from the first opening (within desired tolerances).

Various types of wellbores may be formed using magnetic tracking. For example, wellbores formed by magnetic tracking may be used for in situ conversion processes, for steam assisted gravity drainage processes, for the formation of perimeter barriers or frozen barriers, and/or for soil remediation processes. Magnetic tracking may be used to form wellbores for processes that require relatively small tolerances or variations in distances between adjacent wellbores. For example, vertical and/or horizontally positioned heater wells and/or production wells may need to be positioned parallel to each other with relatively little or no variance in parallel alignment to allow for substantially uniform heating and/or production from the treatment area in the formation.

In certain embodiments, a magnetic string is placed in a vertical well. The magnetic string in the vertical well is used to guide the drilling of a horizontal well such that the horizontal well connects to the vertical well at a desired location, or passes the vertical well at a selected distance relative to the vertical well at a selected depth in the formation, or stops a selected distance away from the vertical well. In some embodiments, the magnetic string is placed in a horizontal well. The magnetic string in the horizontal well is used to guide the drilling of a vertical well such that the vertical well connects to the horizontal well at a desired location, or passes the horizontal well at a selected distance relative to the horizontal well, or stops at a selected distance away from the horizontal well.

Analytical equations may be used to determine the spacing between adjacent wellbores using measurements of magnetic field strengths. The magnetic field from a first wellbore may be measured by a magnetometer in a second wellbore. Analysis of the magnetic field strengths using derivations of analytical equations may determine the coordinates of the second wellbore relative to the first wellbore.

Figure 5:
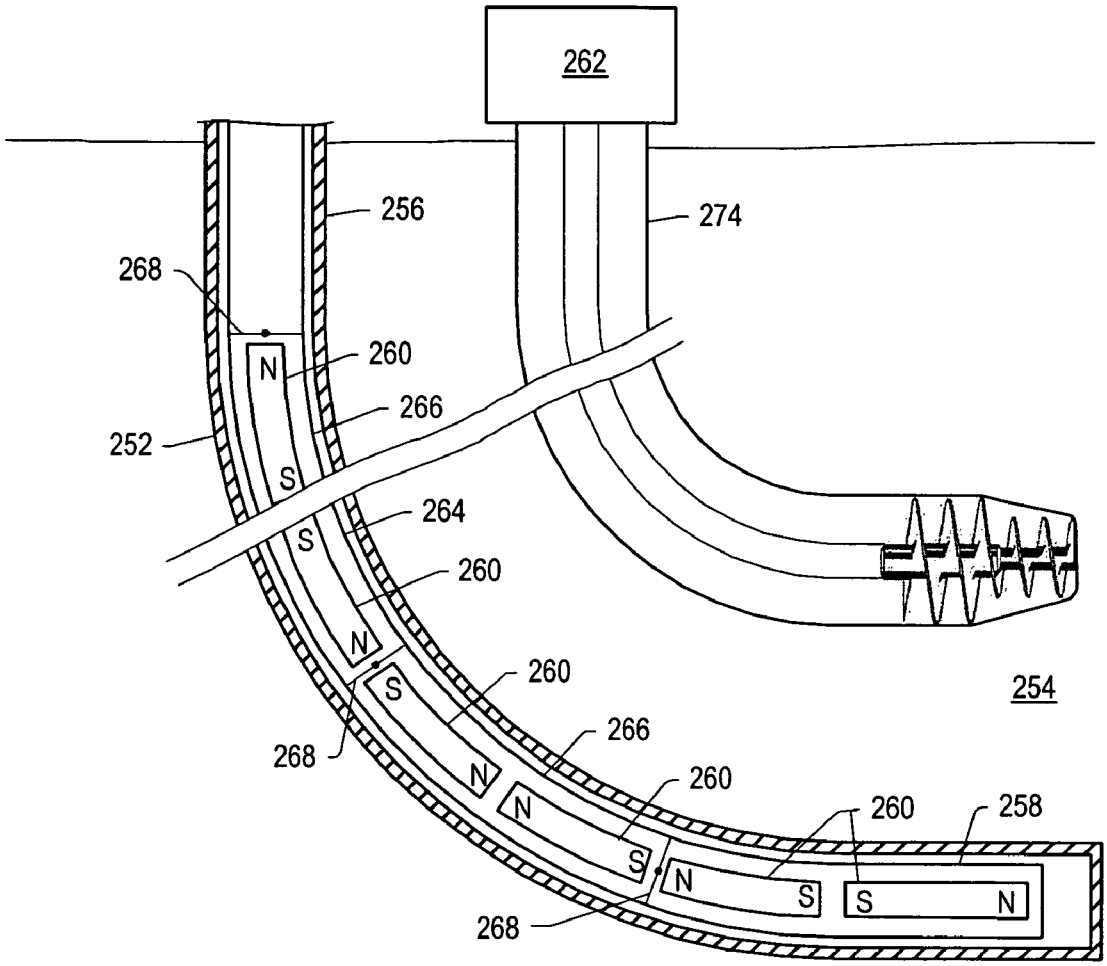
FIG. 5 depicts a schematic representation of an embodiment of a magnetostatic drilling operation.

FIG. 5 depicts a schematic representation of an embodiment of a magnetostatic drilling operation to form an opening that is an approximate desired distance away from an existing opening. Opening 252 may be formed in hydrocarbon layer 254. In some embodiments, opening 252 may be formed in any hydrocarbon containing formation, other types of subsurface formations, or for any subsurface application, such as soil remediation, solution mining, or steam-assisted gravity drainage. Opening 252 may be formed substantially horizontally in hydrocarbon layer 254. For example, opening 252 may be formed substantially parallel to a boundary of hydrocarbon layer 254. Opening 252 may be formed in other orientations in hydrocarbon layer 254 depending on, for example, a desired use of the opening, formation depth, a formation type, etc. Opening 252 may include casing 256. In certain embodiments, opening 252 may be an open (or uncased) wellbore. In some embodiments, magnetic string 258 may be inserted into opening 252. Magnetic string 258 may be unwound from a reel into opening 252. In an embodiment, magnetic string 258 includes one or more magnet segments 260. In other embodiments, magnetic string 258 may include one or more movable permanent longitudinal magnets. The movable permanent longitudinal magnet may have a north and a south pole. Magnetic string 258 may have a longitudinal axis that is substantially parallel (for example, within about 5% of parallel) or coaxial with a longitudinal axis of opening 252.

Magnetic strings may be moved through an opening using a variety of methods. In an embodiment, the magnetic string is coupled to a drill string and moved through the opening as the drill string moves through the opening. Alternatively, magnetic strings may be installed using coiled tubing. Some embodiments may include coupling the magnetic string to a tractor system that moves through the opening. For example, commercially available tractor systems from Welltec Well Technologies (Denmark) or Schlumberger Technology Co. (Houston, Tex.) may be used. In certain embodiments, magnetic strings may be pulled by cable or wireline from either end of the opening. In an embodiment, magnetic strings may be pumped through the opening using air and/or water. For example, a pig may be moved through the opening by pumping air and/or water through the opening when the magnetic string is coupled to the pig.

In some embodiments, casing 256 may be a conduit. Casing 256 may be made of a material that is not significantly influenced by a magnetic field (e.g., non-magnetic alloy such as non-magnetic stainless steel (e.g., 304, 310, 316 stainless steel), reinforced polymer pipe, or brass tubing). The casing may be the conduit of a conductor-in-conduit heater, or the casing may be a perforated liner. If the casing is not significantly influenced by a magnetic field, then the magnetic flux will not be shielded.

In some embodiments, drilling apparatus 262 may include a magnetic guidance sensor probe. The magnetic guidance sensor probe may contain a 3-axis fluxgate magnetometer and a 3-axis inclinometer. The inclinometer is typically used to determine the rotation of the sensor probe relative to Earth's gravitational field. A general magnetic guidance sensor probe may be obtained from Tensor Energy Products (Round Rock, Tex.). The magnetic guidance sensor may be placed inside the drilling string coupled to a drill bit. In certain embodiments, the magnetic guidance sensor probe may be located inside the drilling string of a river crossing rig.

Magnet segments 260 may be placed in conduit 264. Conduit 264 may be a threaded or seamless coiled tubular. Conduit 264 may be formed by coupling one or more sections 266. Sections 266 may include non-magnetic materials such as, but not limited to, stainless steel. In certain embodiments, conduit 264 is formed by coupling several threaded tubular sections. Sections 266 may have any length desired. Sections 266 may have a length chosen to produce magnetic fields with selected distances between junctions of opposing poles in magnetic string 258. The distance between junctions of opposing poles may determine the accuracy in determining the distance between adjacent wellbores. Typically, the distance between junctions of opposing poles is chosen to be on the same scale as the distance between adjacent wellbores. The distance between junctions may range from about 1 m to about 100 m, from about 5 m to about 90 m, or from about 20 m to about 70 m.

Conduit 264 may be a threaded stainless steel tubular. In an embodiment, conduit 264 is 2½ inch Schedule 40, 304 stainless steel tubular formed from 20 ft long sections 266. With 20 ft long sections 266, the distance between opposing poles will be about 20 ft. In some embodiments, sections 266 may be coupled as the conduit is formed and/or inserted into opening 252. Conduit 264 may have a length between about 375 ft and about 525 ft. Shorter or longer lengths of conduit 264 may be used depending on a desired application of the magnetic string.

In an embodiment, sections 266 of conduit 264 may include two magnet segments 260. More or less than two segments may also be used in sections 266. Magnet segments 260 may be arranged in sections 266 such that adjacent magnet segments have opposing polarities at the junction of the segments, as shown in FIG. 5. In an embodiment, one section 266 includes two magnet segments 260 of opposing polarities. The polarity between adjacent sections 266 may be arranged such that the sections have attracting polarities, as shown in FIG. 5. Arranging the opposing poles approximate the center of each section may make assembly of the magnet segments in each section relatively easy. In an embodiment, the approximate centers of adjacent sections 266 have opposite poles. For example, the approximate center of one section may have north poles and the adjacent section (or sections on each end of the one section) may have south poles as shown in FIG. 5.

Fasteners 268 may be placed at the ends of sections 266 to hold magnet segments 260 in the sections. Fasteners 268 may include, but are not limited to, pins, bolts, or screws. Fasteners 268 may be made of non-magnetic materials. In some embodiments, ends of sections 266 may be closed off (e.g., end caps placed on the ends) to enclose magnet segments 260 in the sections. In certain embodiments, fasteners 268 may also be placed at junctions of opposing poles of adjacent magnet segments 260 to inhibit the adjacent segments from moving apart.

Figure 6:
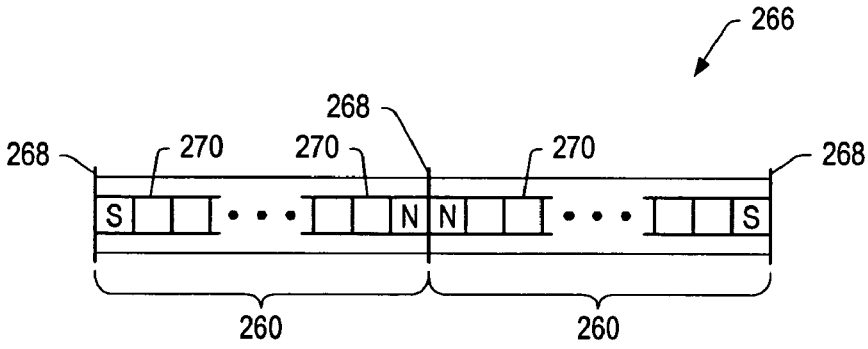
FIG. 6 depicts an embodiment of a section of a conduit with two magnet segments.

FIG. 6 depicts an embodiment of section 266 with two magnet segments 260 with opposing poles. Magnet segments 260 may include one or more magnets 270 coupled to form a single magnet segment. Magnet segments 260 and/or magnets 270 may be positioned in a linear array. Magnets 270 may be Alnico magnets or other types of magnets (such as neodymium iron or samarium cobalt) with sufficient magnetic strength to produce a magnetic field that can be sensed in a nearby wellbore. Alnico magnets are made primarily from alloys of aluminum, nickel and cobalt and may be obtained, for example, from Adams Magnetic Products Co. (Elmhurst, Ill.). Using permanent magnets in magnet segments 260 may reduce the infrastructure associated with magnetic tracking compared to using inductive coils or magnetic field producing wires since there is no need to provide electrical current. In an embodiment, magnets 270 are Alnico magnets about 6 cm in diameter and about 15 cm in length. Assembling a magnet segment from several individual magnets increases the strength of the magnetic field produced by the magnet segment. Increasing the strength of the magnetic fields produced by magnet segments may advantageously increase the maximum distance for sensing the magnetic fields. The pole strength of a magnet segment may be between about 100 Gauss and about 2000 Gauss, or between about 1000 Gauss and about 2000 Gauss. In an embodiment, the pole strength of the magnet segment is 1500 Gauss. Magnets 270 may be coupled with attracting poles coupled such that magnet segment 260 is formed with a south pole at one end and a north pole at a second end. In one embodiment, 40 magnets 270 of about 15 cm in length are coupled to form magnet segment 260 of about 6 m in length. Opposing poles of magnet segments 260 may be aligned proximate the center of section 266 as shown in FIGS. 5 and 6. Magnet segments 260 may be placed in section 266 and the magnet segments may be held in the section with fasteners 268. One or more sections 266 may be coupled as shown in FIG. 5 to form a magnetic string. In certain embodiments, un-magnetized magnet segments 260 may be coupled together inside sections 266. Sections 266 may be magnetized with a magnetizing coil after magnet segments 260 have been assembled together into the sections.

Figure 7:
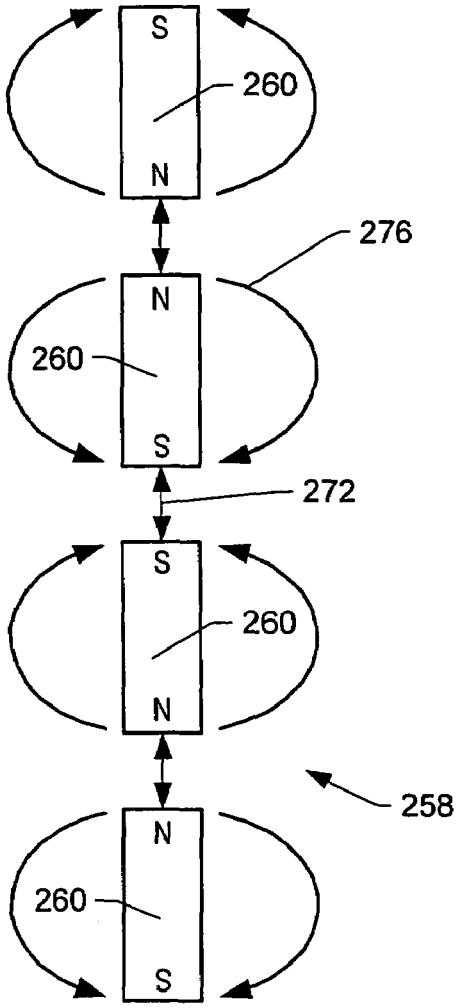
FIG. 7 depicts a schematic of a portion of a magnetic string.

FIG. 7 depicts a schematic of an embodiment of a portion of magnetic string 258. Magnet segments 260 may be positioned such that adjacent segments have opposing poles. In some embodiments, force may be applied to minimize distance 272 between magnet segments 260. Additional segments may be added to increase the length of magnetic string 258. In certain embodiments, magnet segments 260 may be located in sections 266, as shown in FIG. 5. Magnetic strings may be coiled after assembling. Installation of the magnetic string may include uncoiling the magnetic string. Coiling and uncoiling of the magnetic string may also be used to change position of the magnetic string relative to a sensor in a nearby wellbore, for example, drilling apparatus 262 in opening 274, as shown in FIG. 5.

Magnetic strings may include multiple south-south and north-north opposing pole junctions. As shown in FIG. 7, the multiple opposing pole junctions may induce a series of magnetic fields 276. Alternating the polarity of portions in the magnetic string may provide a sinusoidal variation of the magnetic field along the length of the magnetic string. The magnetic field variations may allow for control of the desired spacing between drilled wellbores. In certain embodiments, a series of magnetic fields 276 may be sensed at greater distances than individual magnetic fields. Increasing the distance between opposing pole junctions in the magnetic string may increase the radial distance at which a magnetometer may detect the magnetic field. In some embodiments, the distance between opposing pole junctions in the magnetic string may be varied. For example, more magnets may be used in portions proximate Earth's surface than in portions positioned deeper in the formation.

Some wellbores formed in the formation may be used to facilitate formation of a perimeter barrier around a treatment area. Heat sources in the treatment area may heat hydrocarbons in the formation within the treatment area. The perimeter barrier may be, but is not limited to, a frozen barrier formed by freeze wells, dewatering wells, a grout wall formed in the formation, a sulfur cement barrier, a barrier formed by a gel produced in the formation, a barrier formed by precipitation of salts in the formation, a barrier formed by a polymerization reaction in the formation, and/or sheets driven into the formation. Heat sources, production wells, injection wells, dewatering wells, and/or monitoring wells may be installed in the treatment area defined by the barrier prior to, simultaneously with, or after installation of the barrier.

A frozen barrier defining the treatment area may be formed by freeze wells. In an embodiment, refrigerant is circulated through freeze wells to form low temperature zones around each freeze well. The freeze wells are placed in the formation so that the low temperature zones overlap and form a low temperature zone around the treatment area. The low temperature zone established by freeze wells is maintained below the freezing temperature of aqueous formation fluid in the formation. Aqueous formation fluid entering the low temperature zone freezes and forms the frozen barrier. In other embodiments, the freeze barrier is formed by batch operated freeze wells. A cold fluid, such as liquid nitrogen, is introduced into the freeze wells to form low temperature zones around the freeze wells. The fluid is replenished as needed.

In some embodiments, two or more rows of freeze wells are located about all or a portion of the perimeter of the treatment area to form a thick interconnected low temperature zone. Thick low temperature zones may be formed adjacent to areas in the formation where there is a high flow rate of aqueous fluid in the formation. The thick barrier may ensure that breakthrough of the frozen barrier established by the freeze wells does not occur.

Vertically positioned freeze wells and/or horizontally positioned freeze wells may be positioned around sides of the treatment area. If the upper layer (the overburden) or the lower layer (the underburden) of the formation is likely to allow fluid flow into the treatment area or out of the treatment area, horizontally positioned freeze wells may be used to form an upper and/or a lower barrier for the treatment area. In some embodiments, an upper barrier and/or a lower barrier may not be necessary if the upper layer and/or the lower layer are substantially impermeable. If the upper freeze barrier is formed, portions of heat sources, production wells, injection wells, and/or dewatering wells that pass through the low temperature zone created by the freeze wells forming the upper freeze barrier wells may be insulated and/or heat traced so that the low temperature zone does not adversely affect the functioning of the heat sources, production wells, injection wells and/or dewatering wells passing through the low temperature zone.

Spacing between adjacent freeze wells may be a function of a number of different factors. The factors may include, but are not limited to, physical properties of formation material, type of refrigeration system, coldness and thermal properties of the refrigerant, flow rate of material into or out of the treatment area, time for forming the low temperature zone, and economic considerations. Consolidated or partially consolidated formation material may allow for a large separation distance between freeze wells. A separation distance between freeze wells in consolidated or partially consolidated formation material may be from about 3 m to about 20 m, about 4 m to about 15 m, or about 5 m to about 10 m. In an embodiment, the spacing between adjacent freeze wells is about 5 m. Spacing between freeze wells in unconsolidated or substantially unconsolidated formation material, such as in tar sand, may need to be smaller than spacing in consolidated formation material. A separation distance between freeze wells in unconsolidated material may be from about 1 m to about 5 m.

Freeze wells may be placed in the formation so that there is minimal deviation in orientation of one freeze well relative to an adjacent freeze well. Excessive deviation may create a large separation distance between adjacent freeze wells that may not permit formation of an interconnected low temperature zone between the adjacent freeze wells. Factors that influence the manner in which freeze wells are inserted into the ground include, but are not limited to, freeze well insertion time, depth that the freeze wells are to be inserted, formation properties, desired well orientation, and economics.

Relatively low depth wellbores for freeze wells may be impacted and/or vibrationally inserted into some formations. Wellbores for freeze wells may be impacted and/or vibrationally inserted into formations to depths from about 1 m to about 100 m without excessive deviation in orientation of freeze wells relative to adjacent freeze wells in some types of formations.

Wellbores for freeze wells placed deep in the formation, or wellbores for freeze wells placed in formations with layers that are difficult to impact or vibrate a well through, may be placed in the formation by directional drilling and/or geosteering. Acoustic signals, electrical signals, magnetic signals, and/or other signals produced in a first wellbore may be used to guide directional drilling of adjacent wellbores so that desired spacing between adjacent wells is maintained. Tight control of the spacing between wellbores for freeze wells is an important factor in minimizing the time for completion of barrier formation.

After formation of the wellbore for the freeze well, the wellbore may be backflushed with water adjacent to the part of the formation that is to be reduced in temperature to form a portion of the freeze barrier. The water may displace drilling fluid remaining in the wellbore. The water may displace indigenous gas in cavities adjacent to the formation. In some embodiments, the wellbore is filled with water from a conduit up to the level of the overburden. In some embodiments, the wellbore is backflushed with water in sections. The wellbore maybe treated in sections having lengths of about 20 ft, about 30 ft, about 40 ft, about 50 ft, or greater. Pressure of the water in the wellbore is maintained the fracture pressure of the formation. In some embodiments, the water, or a portion of the water is removed from the wellbore, and a freeze well is placed in the formation.

Figure 8:
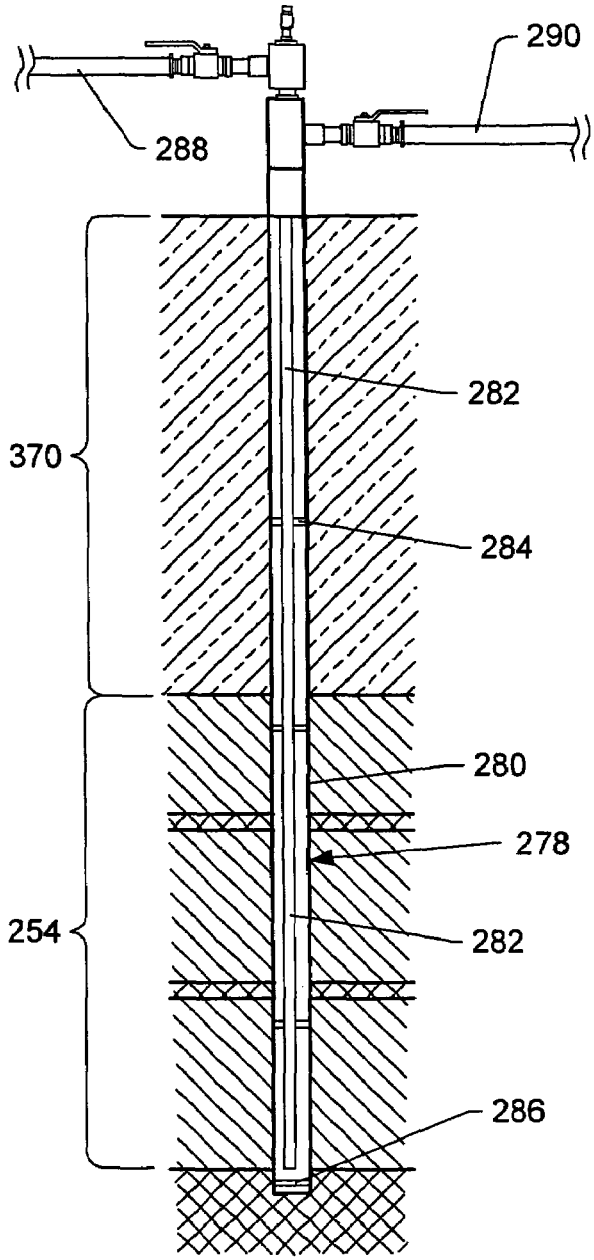
FIG. 8 depicts an embodiment of a freeze well for a circulated liquid refrigeration system, wherein a cutaway view of the freeze well is represented below ground surface.

FIG. 8 depicts an embodiment of freeze well 278. Freeze well 278 may include canister 280, inlet conduit 282, spacers 284, and wellcap 286. Spacers 284 may position inlet conduit 282 in canister 280 so that an annular space formed between the casing and the conduit. Spacers 284 may promote turbulent flow of refrigerant in the annular space between inlet conduit 282 and canister 280, but the spacers may also cause a significant fluid pressure drop. Turbulent fluid flow in the annular space may be promoted by roughening the inner surface of canister 280, by roughening the outer surface of inlet conduit 282, and/or by having a small cross-sectional area annular space that allows for high refrigerant velocity in the annular space. In some embodiments, spacers are not used.

Formation refrigerant may flow through cold side conduit 288 from a refrigeration unit to inlet conduit 282 of freeze well 278. The formation refrigerant may flow through an annular space between inlet conduit 282 and canister 280 to warm side conduit 290. Heat may transfer from the formation to canister 280 and from the casing to the formation refrigerant in the annular space. Inlet conduit 282 may be insulated to inhibit heat transfer to the formation refrigerant during passage of the formation refrigerant into freeze well 278. In an embodiment, inlet conduit 282 is a high density polyethylene tube. At cold temperatures, some polymers may exhibit a large amount of thermal contraction. For example, an 800 ft initial length of polyethylene conduit subjected to a temperature of about −25° C. may contract by 20 ft or more. If a high density polyethylene conduit, or other polymer conduit, is used, the large thermal contraction of the material must be taken into account in determining the final depth of the freeze well. For example, the freeze well may be drilled deeper than needed, and the conduit may be allowed to shrink back during use. In some embodiments, inlet conduit 282 is an insulated metal tube. In some embodiments, the insulation may be a polymer coating, such as, but not limited to, polyvinylchloride, high density polyethylene, and/or polystyrene.

Freeze well 278 may be introduced into the formation using a coiled tubing rig. In an embodiment, canister 280 and inlet conduit 282 are wound on a single reel. The coiled tubing rig introduces the canister and inlet conduit 282 into the formation. In an embodiment, canister 280 is wound on a first reel and inlet conduit 282 is wound on a second reel. The coiled tubing rig introduces canister 280 into the formation. Then, the coiled tubing rig is used to introduce inlet conduit 282 into the canister. In other embodiments, freeze well is assembled in sections at the wellbore site and introduced into the formation.

Various types of refrigeration systems may be used to form a low temperature zone. Determination of an appropriate refrigeration system may be based on many factors, including, but not limited to: type of freeze well; a distance between adjacent freeze wells; refrigerant; time frame in which to form a low temperature zone; depth of the low temperature zone; temperature differential to which the refrigerant will be subjected; chemical and physical properties of the refrigerant; environmental concerns related to potential refrigerant releases, leaks, or spills; economics; formation water flow in the formation; composition and properties of formation water, including the salinity of the formation water; and various properties of the formation such as thermal conductivity, thermal diffusivity, and heat capacity.

A circulated fluid refrigeration system may utilize a liquid refrigerant (formation refrigerant) that is circulated through freeze wells. Some of the desired properties for the formation refrigerant are: a low working temperature, a low viscosity at the working temperature, a high density, a high specific heat capacity, a high thermal conductivity, a low cost, low corrosiveness, and a low toxicity. A low working temperature of the formation refrigerant allows a large low temperature zone to be established around a freeze well. The low working temperature of formation refrigerant should be about −20° C. or lower. Formation refrigerants having low working temperatures of at least −60° C. may include aqua ammonia, potassium formate solutions such as Dynalene® HC-50 (Dynalene® Heat Transfer Fluids (Whitehall, Pa.)) or FREEZIUM® (Kemira Chemicals (Helsinki, Finland)); silicone heat transfer fluids such as Syltherm XLT® (Dow Corning Corporation (Midland, Mich.); hydrocarbon refrigerants such as propylene; and chlorofluorocarbons such as R-22. Aqua ammonia is a solution of ammonia and water with a weight percent of ammonia between about 20% and about 40%. Aqua ammonia has several properties and characteristics that make use of aqua ammonia as the formation refrigerant desirable. Such properties and characteristics include, but are not limited to, a very low freezing point, a low viscosity, ready availability, and low cost.

Formation refrigerant that is capable of being chilled below a freezing temperature of aqueous formation fluid may be used to form the low temperature zone around the treatment area. The following equation (the Sanger equation) may be used to model the time $t_1$ needed to form a frozen barrier of radius R around a freeze well having a surface temperature of $T_s$:

$$t_1 = \frac{R^2 L_1}{4k_f v_s}\left(2\ln\frac{R}{r_o} - 1 + \frac{c_{vf} v_s}{L_1}\right) \tag{1}$$

in which:

$$L_1 = L\frac{a_r^2 - 1}{2\ln a_r} c_{vu} v_o$$

$$a_r = \frac{R_A}{R}.$$

In these equations, $k_f$ is the thermal conductivity of the frozen material; $c_{vf}$ and $c_{vu}$ are the volumetric heat capacity of the frozen and unfrozen material, respectively; $r_o$ is the radius of the freeze well; $v_s$ is the temperature difference between the freeze well surface temperature $T_s$ and the freezing point of water $T_o$; $v_o$ is the temperature difference between the ambient ground temperature $T_g$ and the freezing point of water $T_o$; L is the volumetric latent heat of freezing of the formation; R is the radius at the frozen-unfrozen interface; and $R_A$ is a radius at which there is no influence from the refrigeration pipe. The temperature of the formation refrigerant is an adjustable variable that may significantly affect the spacing between freeze wells.

EQN. 1 implies that a large low temperature zone may be formed by using a refrigerant having an initial temperature that is very low. The use of formation refrigerant having an initial cold temperature of about −50° C. or lower is desirable. Formation refrigerants having initial temperatures warmer than about −50° C. may also be used, but such formation refrigerants require longer times for the low temperature zones produced by individual freeze wells to connect. In addition, such formation refrigerants may require the use of closer freeze well spacings and/or more freeze wells.

The physical properties of the material used to construct the freeze wells may be a factor in the determination of the coldest temperature of the formation refrigerant used to form the low temperature zone around the treatment area. Carbon steel may be used as a construction material of freeze wells. ASTM A333 grade 6 steel alloys and ASTM A333 grade 3 steel alloys may be used for low temperature applications. ASTM A333 grade 6 steel alloys typically contain little or no nickel and have a low working temperature limit of about −50° C. ASTM A333 grade 3 steel alloys typically contain nickel and have a much colder low working temperature limit. The nickel in the ASTM A333 grade 3 alloy adds ductility at cold temperatures, but also significantly raises the cost of the metal. In some embodiments, the coldest temperature of the refrigerant is from about −35° C. to about −55° C., from about −38° C. to about −47° C. or from about −40° C. to about −45° C. to allow for the use of ASTM A333 grade 6 steel alloys for construction of canisters for freeze wells. Stainless steels, such as 304 stainless steel, may be used to form freeze wells, but the cost of stainless steel is typically much more than the cost of ASTM A333 grade 6 steel alloy.

A refrigeration unit may be used to reduce the temperature of formation refrigerant to the low working temperature. In some embodiments, the refrigeration unit may utilize an ammonia vaporization cycle. Refrigeration units are available from Cool Man Inc. (Milwaukee, Wis.), Gartner Refrigeration & Manufacturing (Minneapolis, Minn.), and other suppliers. In some embodiments, a cascading refrigeration system may be utilized with a first stage of ammonia and a second stage of carbon dioxide. The circulating refrigerant through the freeze wells may be 30% by weight ammonia in water (aqua ammonia). Alternatively, a single stage carbon dioxide refrigeration system may be used.

Figure 9:
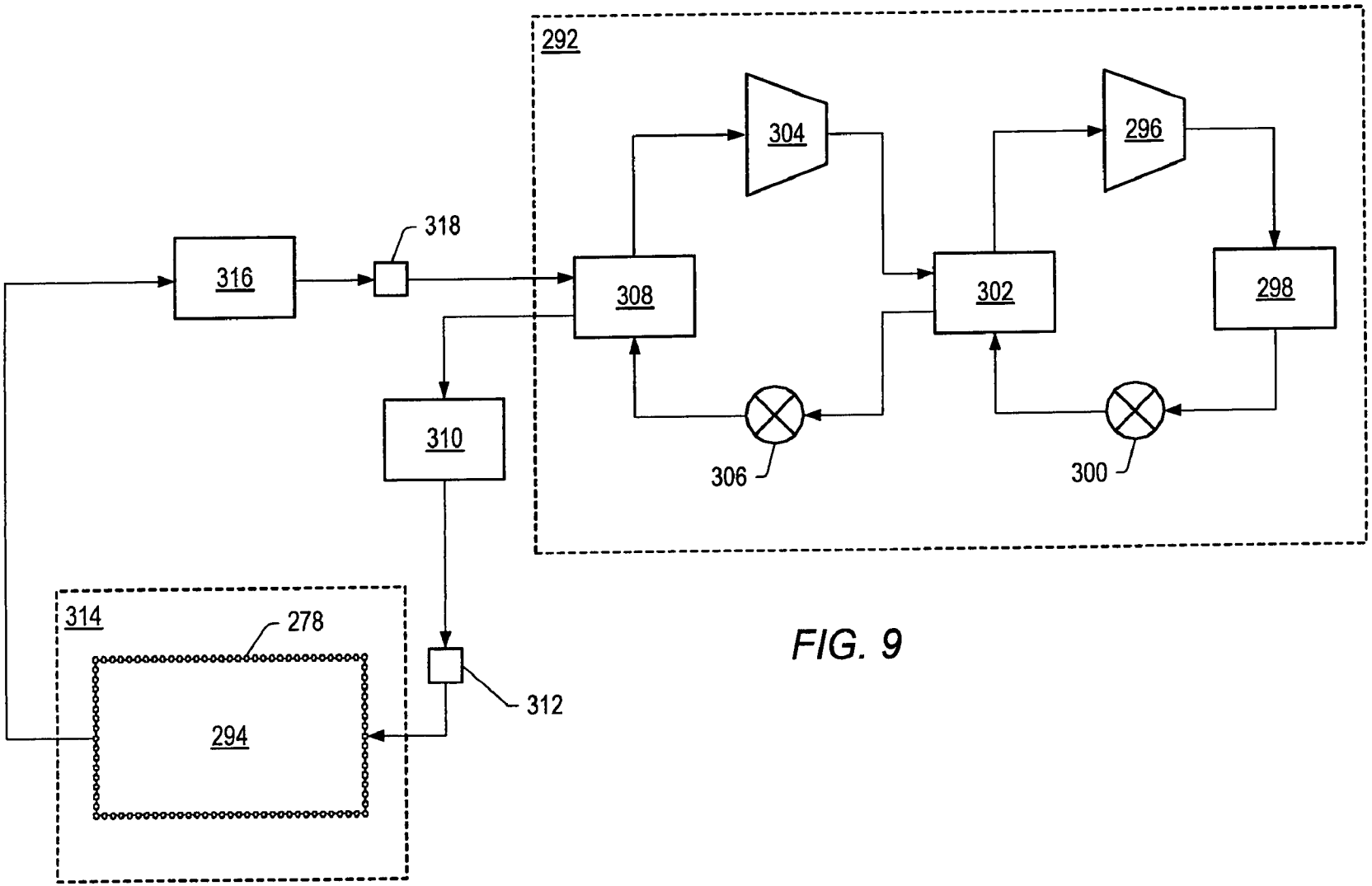
FIG. 9 depicts a schematic representation of an embodiment of a refrigeration system for forming a low temperature zone around a treatment area.

FIG. 9 depicts an embodiment of refrigeration system 292 used to cool formation refrigerant that forms a low temperature zone around treatment area 294. Refrigeration system 292 may include a high stage refrigeration system and a low stage refrigeration system arranged in a cascade relationship. The high stage refrigeration system and the low stage refrigeration system may utilize conventional vapor compression refrigeration cycles.

The high stage refrigeration system includes compressor 296, condenser 298, expansion valve 300, and heat exchanger 302. In some embodiments, the high stage refrigeration system uses ammonia as the refrigerant. The low stage refrigeration system includes compressor 304, heat exchanger 302, expansion valve 306, and heat exchanger 308. In some embodiments, the low stage refrigeration system uses carbon dioxide as the refrigerant. High stage refrigerant from high stage expansion valve 300 cools low stage refrigerant exiting low stage compressor 304 in heat exchanger 302.

Low stage refrigerant exiting low stage expansion valve 306 is used to cool formation refrigerant in heat exchanger 308. The formation refrigerant passes from heat exchanger 308 to storage vessel 310. Pump 312 transports formation refrigerant from storage vessel 310 to freeze wells 278 in formation 314. Refrigeration system 292 is operate so that the formation refrigerant from pump 312 is at the desired temperature. The desired temperature may be in the range from about −35° C. to about −55° C.

Formation refrigerant passes from the freeze wells 278 to storage vessel 316. Pump 318 is used to transport the formation refrigerant from storage vessel 316 to heat exchanger 308. In some embodiments, storage vessel 310 and storage vessel 316 are a single tank with a warm side for formation refrigerant returning from the freeze wells, and a cold side for formation refrigerant from heat exchanger 308.

In some embodiments, a double barrier containment system is used to isolate a contained area. The double barrier containment system may be formed with a first barrier and a second barrier. The first barrier may be formed around at least a portion of the contained zone to inhibit fluid from entering or exiting the contained zone. The second barrier may be formed around at least a portion of the first barrier to isolate an inter-barrier zone between the first barrier and the second barrier. In some embodiments, the treatment area of the in situ conversion process is a portion of the contained zone. The double barrier containment system may allow greater project depths than a single barrier containment system. Greater depths are possible with the double barrier containment system because the stepped differential pressures across the first barrier and the second barrier is less than the differential pressure across a single barrier. The smaller differential pressures across the first barrier and the second barrier make a breach of the double barrier containment system less likely to occur at depth for the double barrier containment system as compared to the single barrier containment system.

The double barrier containment system reduces the probability that a barrier breach will affect the contained zone or the formation on the outside of the double barrier. That is, the probability that the location and/or time of occurrence of the breach in the first barrier will coincide with the location and/or time of occurrence of the breach in the second barrier is low, especially if the distance between the first barrier and the second barrier is relatively large (for example, greater than about 15 m). Having a double barrier may reduce or eliminate influx of fluid into the contained zone following a breach of the first barrier or the second barrier. The contained zone may not be affected if the second barrier breaches. If the first barrier breaches, only a portion of the fluid in the inter-barrier zone is able to enter the contained zone. Also, fluid from the contained zone will not pass the second barrier. Recovery from a breach of a barrier of the double barrier containment system may require less time and fewer resources than recovery from a breach of a single barrier containment system. For example, reheating a contained zone following a breach of a double barrier containment system may require less energy than reheating a similarly sized contained zone following a breach of a single barrier containment system.

The first barrier and the second barrier may be the same type of barrier or different types of barriers. In some embodiments, the first barrier and the second barrier are formed by freeze wells. In some embodiments, the first barrier is formed by freeze wells, and the second barrier is a grout wall. The grout wall may be formed of cement, sulfur, sulfur cement, or combinations thereof. In some embodiments, a portion of the first barrier and/or a portion of the second barrier is a natural barrier, such as an impermeable rock formation.

Figure 10:
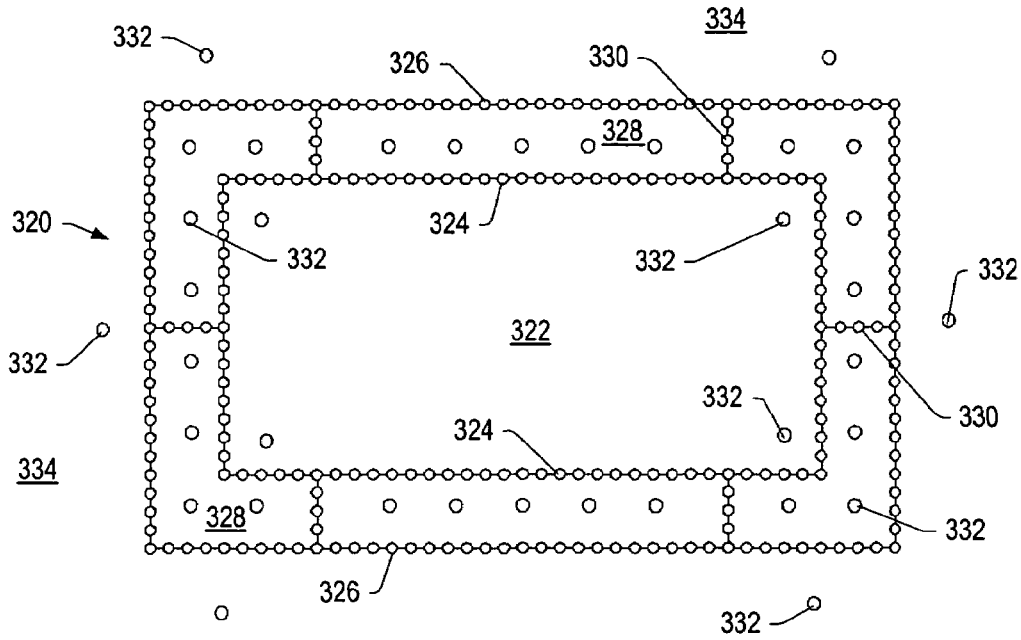
FIG. 10 depicts a schematic representation of a double barrier containment system.

FIG. 10 depicts an embodiment of double barrier containment system 320. The perimeter of contained zone 322 may be surrounded by first barrier 324. First barrier 324 may be surrounded by second barrier 326. Inter-barrier zones 328 may be isolated between first barrier 324, second barrier 326 and partitions 330. Creating sections with partitions 330 between first barrier 324 and second barrier 326 limits the amount of fluid held in individual inter-barrier zones 328. Partitions 330 may strengthen double barrier containment system 320. In some embodiments, the double barrier containment system may not include any partitions.

The inter-barrier zone may have a thickness from about 1 m to about 300 m. In some embodiments, the thickness of the inter-barrier zone is from about 10 m to about 100 m, or from about 20 m to about 50 m.

Pumping/monitor wells 332 may be positioned in contained zone 322, inter-barrier zones 328, and/or outer zone 334 outside of second barrier 326. Pumping/monitor wells 332 allow for removal of fluid from contained zone 322, inter-barrier zones 328, or outer zone 334. Pumping/monitor wells 332 also allow for monitoring of fluid levels in contained zone 322, inter-barrier zones 328, and outer zone 334.

In some embodiments, a portion of contained zone 322 is heated by heat sources. The closest heat sources to first barrier 324 may be installed a desired distance away from the first barrier. In some embodiments, the desired distance between the closest heat sources and first barrier 324 is in a range between about 5 m and about 300 m, between about 10 m and about 200 m, or between about 15 m and about 50 m. For example, the desired distance between the closest heat sources and first barrier 324 may be about 40 m.

Figure 11:
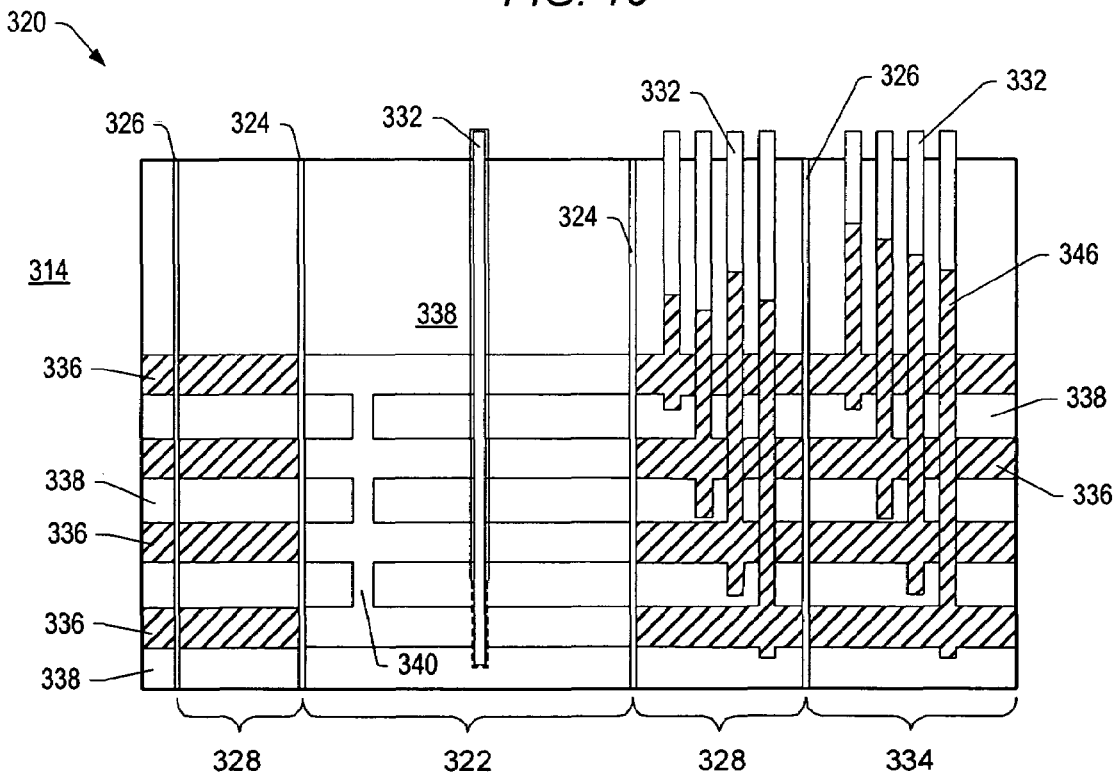
FIG. 11 depicts a cross-sectional view of a double barrier containment system.

FIG. 11 depicts a cross-sectional view of double barrier containment system 320 used to isolate contained zone 322 in formation 314. Formation 314 may include one or more fluid bearing zones 336 and one or more impermeable zones 338. First barrier 324 may at least partially surround contained zone 322. Second barrier 326 may at least partially surround first barrier 324. In some embodiments, impermeable zones 338 are located above and/or below contained zone 322. Thus, contained zone 322 is sealed around the sides and from the top and bottom. In some embodiments, one or more paths 340 are formed to allow communication between two or more fluid bearing zones 336 in contained zone 322. Fluid in contained zone 322 may be pumped from the zone. Fluid in inter-barrier zone 328 and fluid in outer zone 334 is inhibited from reaching the contained zone. During in situ conversion of hydrocarbons in contained zone 322, formation fluid generated in the contained zone is inhibited from passing into inter-barrier zone 328 and outer zone 334.

After sealing contained zone 322, fluid levels in a given fluid bearing zone 336 may be changed so that the fluid head in inter-barrier zone 328 and the fluid head in outer zone 334 are different. The amount of fluid and/or the pressure of the fluid in individual fluid bearing zones 336 may be adjusted after first barrier 324 and second barrier 326 are formed. Having different fluid head levels in contained zone 322, fluid bearing zones 336 in inter-barrier zone 328, and in the fluid bearing zones in outer zone 334 allows for determination of the occurrence of a breach in first barrier 324 and/or second barrier 326. In some embodiments, the differential pressure across first barrier 324 and second barrier 326 is adjusted to reduce stresses applied to first barrier 324 and/or second barrier 326, or stresses on certain strata of the formation.

Some fluid bearing zones 336 may contain native fluid that is difficult to freeze because of a high salt content or compounds that reduce the freezing point of the fluid. If first barrier 324 and/or second barrier 326 are low temperature zones established by freeze wells, the native fluid that is difficult to freeze may be removed from fluid bearing zones 336 in inter-barrier zone 328 through pumping/monitor wells 332. The native fluid is replaced with a fluid that the freeze wells are able to more easily freeze.

In some embodiments, pumping/monitor wells 332 may be positioned in contained zone 322, inter-barrier zone 328, and/or outer zone 334. Pumping/monitor wells 332 may be used to test for freeze completion of frozen barriers and/or for pressure testing frozen barriers and/or strata. Pumping/monitor wells 332 may be used to remove fluid and/or to monitor fluid levels in contained zone 322, inter-barrier zone 328, and/or outer zone 334. Using pumping/monitor wells 332 to monitor fluid levels in contained zone 322, inter-barrier zone 328, and/or outer zone 334 may allow detection of a breach in first barrier 324 and/or second barrier 326. Pumping/monitor wells 332 allow pressure in contained zone 322, each fluid bearing zone 336 in inter-barrier zone 328, and each fluid bearing zone in outer zone 334 to be independently monitored so that the occurrence and/or the location of a breach in first barrier 324 and/or second barrier 326 can be determined.

In some embodiments, fluid pressure in inter-barrier zone 328 is maintained greater than the fluid pressure in contained zone 322, and less than the fluid pressure in outer zone 334. If a breach of first barrier 324 occurs, fluid from inter-barrier zone 328 flows into contained zone 322, resulting in a detectable fluid level drop in the inter-barrier zone. If a breach of second barrier 326 occurs, fluid from the outer zone flows into inter-barrier zone 328, resulting in a detectable fluid level rise in the inter-barrier zone.

Figure 12:
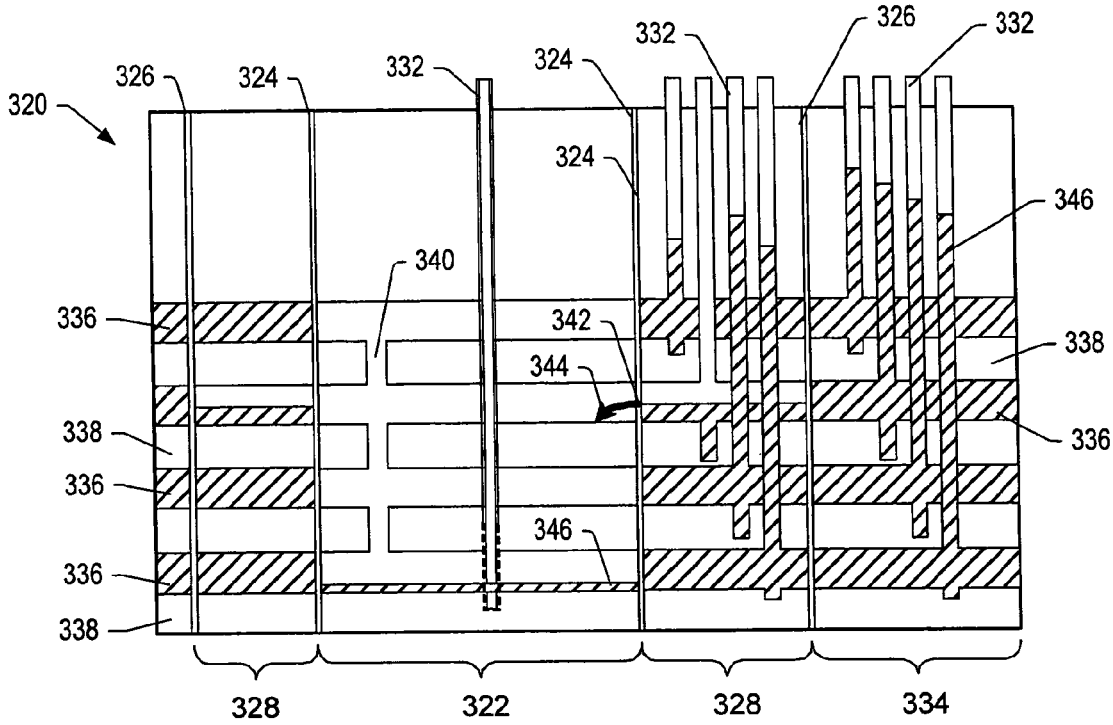
FIG. 12 depicts a schematic representation of a breach in the first barrier of a double barrier containment system.

A breach of first barrier 324 may allow fluid from inter-barrier zone 328 to enter contained zone 322. FIG. 12 depicts breach 342 in first barrier 324 of double barrier containment system 320. Arrow 344 indicates flow direction of fluid 346 from inter-barrier zone 328 to contained zone 322 through breach 342. The fluid level in fluid bearing zone 336 proximate breach 342 of inter-barrier zone 328 falls to the height of the breach.

Path 340 allows fluid 346 to flow from breach 342 to the bottom of contained zone 322, increasing the fluid level in the bottom of the contained zone. The volume of fluid that flows into contained zone 322 from inter-barrier zone 328 is typically small compared to the volume of the contained zone. The volume of fluid able to flow into contained zone 322 from inter-barrier zone 328 is limited because second barrier 326 inhibits recharge of fluid 346 into the affected fluid bearing zone. In some embodiments, the fluid that enters contained zone 322 may be pumped from the contained zone using pumping/monitor wells 332 in the contained zone. In some embodiments, the fluid that enters contained zone 322 may be evaporated by heaters in the contained zone that are part of the in situ conversion process system. The recovery time for the heated portion of contained zone 322 from cooling caused by the introduction of fluid from inter-barrier zone 328 is brief. The recovery time may be less than a month, less than a week, or less than a day.

Pumping/monitor wells 332 in inter-barrier zone 328 may allow assessment of the location of breach 342. When breach 342 initially forms, fluid flowing into contained zone 322 from fluid bearing zone 336 proximate the breach creates a cone of depression in the fluid level of the affected fluid bearing zone in inter-barrier zone 328. Time analysis of fluid level data from pumping/monitor wells 332 in the same fluid bearing zone as breach 342 can be used to determine the general location of the breach.

When breach 342 of first barrier 324 is detected, pumping/monitor wells 332 located in the fluid bearing zone that allows fluid to flow into contained zone 322 may be activated to pump fluid out of the inter-barrier zone. Pumping the fluid out of the inter-barrier zone reduces the amount of fluid 346 that can pass through breach 342 into contained zone 322.

Breach 342 may be caused by ground shift. If first barrier 324 is a low temperature zone formed by freeze wells, the temperature of the formation at breach 342 in the first barrier is below the freezing point of fluid 346 in inter-barrier zone 328. Passage of fluid 346 from inter-barrier zone 328 through breach 342 may result in freezing of the fluid in the breach and self-repair of first barrier 324.

Figure 13:
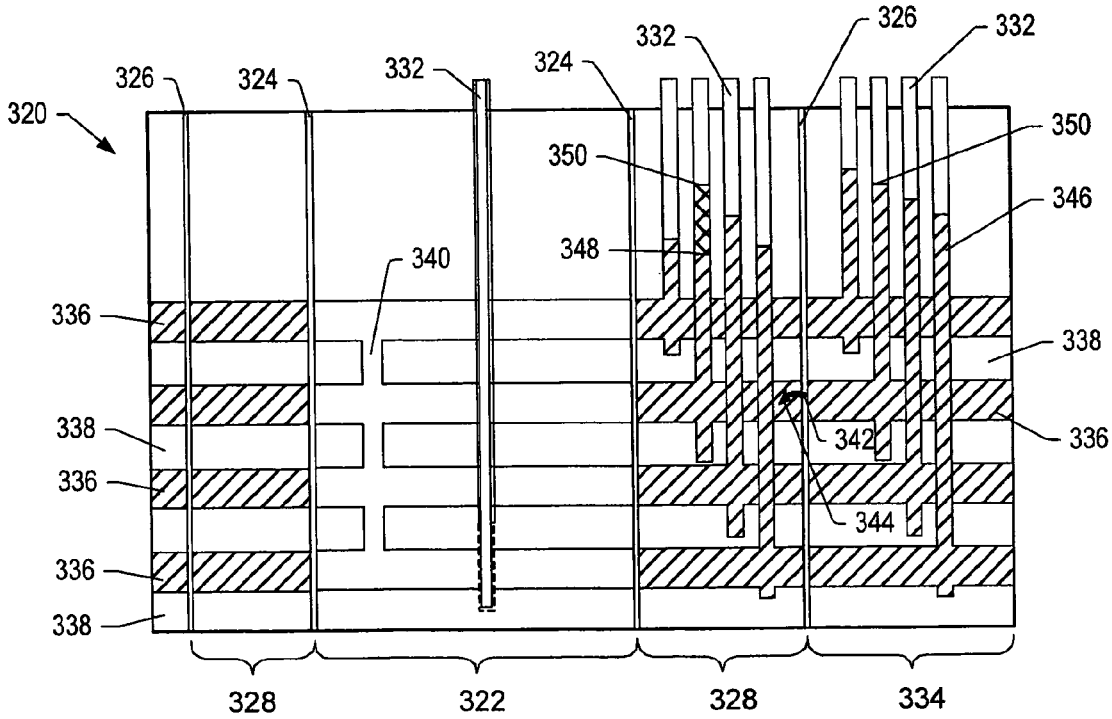
FIG. 13 depicts a schematic representation of a breach in the second barrier of a double barrier containment system.

A breach of the second barrier may allow fluid in the outer zone to enter the inter-barrier zone. The first barrier may inhibit fluid entering the inter-barrier zone from reaching the contained zone. FIG. 13 depicts breach 342 in second barrier 326 of double barrier containment system 320. Arrow 344 indicates flow direction of fluid 346 from outside of second barrier 326 to inter-barrier zone 328 through breach 342. As fluid 346 flows through breach 342 in second barrier 326, the fluid level in the portion of inter-barrier zone 328 proximate the breach rises from initial level 348 to a level that is equal to level 350 of fluid in the same fluid bearing zone in outer zone 334. An increase of fluid 346 in fluid bearing zone 336 may be detected by pumping/monitor well 332 positioned in the fluid bearing zone proximate breach 342.

Breach 342 may be caused by ground shift. If second barrier 326 is a low temperature zone formed by freeze wells, the temperature of the formation at breach 342 in the second barrier is below the freezing point of fluid 346 entering from outer zone 334. Fluid from outer zone 334 in breach 342 may freeze and self-repair second barrier 326.

First barrier and second barrier of the double barrier containment system may be formed by freeze wells. In an embodiment, first barrier is formed first. The cooling load needed to maintain the first barrier is significantly less than the cooling load needed to form the first barrier. After formation of the first barrier, the excess cooling capacity that the refrigeration system used to form the first barrier may be used to form a portion of the second barrier. In some embodiments, the second barrier is formed first and the excess cooling capacity that the refrigeration system used to form the second barrier is used to form a portion of the first barrier. After the first and second barriers are formed, excess cooling capacity supplied by the refrigeration system or refrigeration systems used to form the first barrier and the second barrier may be used to form a barrier or barriers around the next contained zone that is to be processed by the in situ conversion process.

Grout may be used in combination with freeze wells to provide a barrier for the in situ conversion process. The grout fills cavities (vugs) in the formation and reduces the permeability of the formation. Grout may have better thermal conductivity than gas and/or formation fluid that fills cavities in the formation. Placing grout in the cavities may allow for faster low temperature zone formation. The grout forms a perpetual barrier in the formation that may strengthen the formation. The use of grout in unconsolidated or substantially unconsolidated formation material may allow for larger well spacing than is possible without the use of grout. The combination of grout and the low temperature zone formed by freeze wells may constitute a double barrier for environmental regulation purposes.

Grout may be injected into the formation at a pressure that is high, but below the fracture pressure of the formation. Grout may be applied to the formation from a freeze wellbore. In some embodiments, grouting is performed in 50 foot increments in the freeze wellbore. Larger or smaller increments may be used if desired. In some embodiments, grout is only applied to certain portions of the formation. For example, grout may be applied to the formation through the freeze wellbore only adjacent to aquifer zones and/or to relatively high permeability zones (for example, zones with a permeability greater than about 0.1 darcy). Applying grout to aquifers may inhibit water from one aquifer migrating to a different aquifer when an established low temperature zone thaws.

Grout used in the formation may be any type of grout including, but not limited to, fine cement, micro fine cement, sulfur, sulfur cement, viscous thermoplastics, or combinations thereof. Fine cement may be ASTM type 3 Portland cement. Fine cement may be less expensive than micro fine cement. In an embodiment, a freeze wellbore is formed in the formation. Selected portions of the freeze wellbore are grouted using fine cement. Then, micro fine cement is injected into the formation through the freeze wellbore. The fine cement may reduce the permeability down to about 10 millidarcy. The micro fine cement may further reduce the permeability to about 0.1 millidarcy. After the grout is introduced into the formation, a freeze wellbore canister may be inserted into the formation. The process may be repeated for each freeze well that will be used to form the barrier.

In some embodiments, fine cement is introduced into every other freeze wellbore. Micro fine cement is introduced into the remaining wellbores. For example, grout may be used in a formation with freeze wellbores set at about 5 m spacing. A first wellbore is drilled and fine cement is introduced into the formation through the wellbore. A freeze well canister is positioned in the first wellbore. A second wellbore is drilled 10 m away from the first wellbore. Fine cement is introduced into the formation through the second wellbore. A freeze well canister is positioned in the second wellbore. A third wellbore is drilled between the first wellbore and the second wellbore. In some embodiments, grout from the first and/or second wellbores may be detected in the cuttings of the third wellbore. Micro fine cement is introduced into the formation through the third wellbore. A freeze wellbore canister is positioned in the third wellbore. The same procedure is used to form the remaining freeze wells that will form the barrier around the treatment area.

A temperature monitoring system may be installed in wellbores of freeze wells and/or in monitor wells adjacent to the freeze wells to monitor the temperature profile of the freeze wells and/or the low temperature zone established by the freeze wells. The monitoring system may be used to monitor progress of low temperature zone formation. The monitoring system may be used to determine the location of high temperature areas, potential breakthrough locations, or breakthrough locations after the low temperature zone has formed. Periodic monitoring of the temperature profile of the freeze wells and/or low temperature zone established by the freeze wells may allow additional cooling to be provided to potential trouble areas before breakthrough occurs. Additional cooling may be provided at or adjacent to breakthroughs and high temperature areas to ensure the integrity of the low temperature zone around the treatment area. Additional cooling may be provided by increasing refrigerant flow through selected freeze wells, installing an additional freeze well or freeze wells, and/or by providing a cryogenic fluid, such as liquid nitrogen, to the high temperature areas. Providing additional cooling to potential problem areas before breakthrough occurs may be more time efficient and cost efficient than sealing a breach, reheating a portion of the treatment area that has been cooled by influx of fluid, and/or remediating an area outside of the breached frozen barrier.

In some embodiments, a traveling thermocouple may be used to monitor the temperature profile of selected freeze wells or monitor wells. In some embodiments, the temperature monitoring system includes thermocouples placed at discrete locations in the wellbores of the freeze wells, in the freeze wells, and/or in the monitoring wells. In some embodiments, the temperature monitoring system comprises a fiber optic temperature monitoring system.

Fiber optic temperature monitoring systems are available from Sensornet (London, United Kingdom), Sensa (Houston, Tex.), Luna Energy (Blacksburg, Va.), Lios Technology GMBH (Cologne, Germany), Oxford Electronics Ltd. (Hampshire, United Kingdom), and Sabeus Sensor Systems (Calabasas, Calif.). The fiber optic temperature monitoring system includes a data system and one or more fiber optic cables. The data system includes one or more lasers for sending light to the fiber optic cable; and one or more computers, software and peripherals for receiving, analyzing, and outputting data. The data system may be coupled to one or more fiber optic cables.

A single fiber optic cable may be several kilometers long. The fiber optic cable may be installed in many freeze wells and/or monitor wells. In some embodiments, two fiber optic cables may be installed in each freeze well and/or monitor well. The two fiber optic cables may be coupled together. Using two fiber optic cables per well allows for compensation due to optical losses that occur in the wells and allows for better accuracy of measured temperature profiles.

A fiber of a fiber optic cable may be placed in a polymer tube. The polymer tube may be filled with a heat transfer fluid. The heat transfer fluid may be a gel or liquid that does not freeze at or above the temperature of formation refrigerant used to cool the formation. In some embodiments the heat transfer fluid in the polymer tube is the same as the formation refrigerant, for example, a fluid available from Dynalene® Heat Transfer Fluids or aqua ammonia. In some embodiments, the fiber is blown into the tube using the heat transfer fluid. Using the heat transfer fluid to insert the fiber into the polymer tube removes moisture from the polymer tube.

The polymer tube and fiber may be placed in stainless steel tubing, such as ¼ inch 304 stainless steel tubing, to form the fiber optic cable. The stainless steel tubing may be prestressed to accommodate thermal contraction at low temperatures. The stainless steel tubing may be filled with the heat transfer fluid. In some embodiments, the polymer tube is blown into the stainless steel tubing with the heat transfer fluid. Using the heat transfer fluid to insert the polymer tube and fiber into the stainless steel tubing removes moisture from the stainless steel tubing. In some embodiments, two fibers are positioned in the same stainless steel tubing.

In some embodiments, the fiber optic cable is strapped to the canister of the freeze well as the canister is inserted into the formation. The fiber optic cable may be coiled around the canister adjacent to the portions of the formation that are to be reduced to low temperature to form the low temperature zone. Coiling the fiber optic cable around the canister allows a large length of the fiber optic cable to be adjacent to areas that are to be reduced to low temperature. The large length allows for better resolution of the temperature profile for the areas to be reduced to low temperatures. In some embodiments, the fiber optic cable is placed in the canister of the freeze well.

Figure 14:
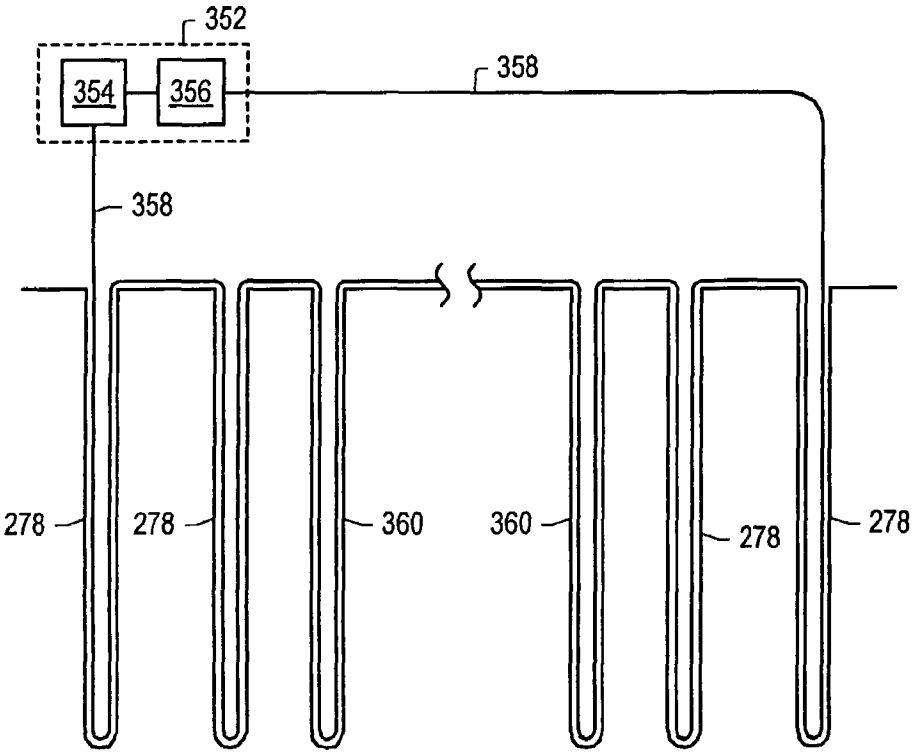
FIG. 14 depicts a schematic representation of a fiber optic cable system used to monitor temperature in and near freeze wells.

FIG. 14 depicts a schematic representation of a fiber optic temperature monitoring system. Data system 352 includes laser 354 and analyzer 356. Laser 354 injects short, intense laser pulses into fiber optic cable 358. Fiber op cable 358 is positioned in plurality of freeze wells 278 and monitor wells 360. Backscattering and reflection of light in fiber optic cable 358 may be measured as a function of time by analyzer 356 of the data system 352. Analysis of the backscattering and reflection of light data yields a temperature profile along the length of fiber optic cable 358.

In some embodiments, the fiber optic temperature monitoring system utilizes Brillouin or Raman scattering systems. Such systems provide spatial resolution of about 1 m and temperature resolution of about 0.1° C. With sufficient averaging and temperature calibration, the systems may be accurate to about 0.5° C.

In some embodiments, the fiber optic temperature monitoring system may be a Bragg system that uses a fiber optic cable etched with closely spaced Bragg gratings. The Bragg gratings may be formed in 1 foot increments along selected lengths of the fiber. Fibers with Bragg gratings are available from Luna Energy. The Bragg system only requires a single fiber optic cable to be placed in each well that is to be monitored. The Bragg system is able to measure the fiber temperature in a few seconds.

The fiber optic temperature monitoring system may be used to detect the location of a breach or a potential breach. The search for potential breaches may be performed at scheduled intervals, for example, every two or three months. To determine the location of the breach or potential breach, flow of formation refrigerant to the freeze wells of interest is stopped. In some embodiments, the flow of formation refrigerant to all of the freeze wells is stopped. The rise in the temperature profiles as well as the rate of change of the temperature profiles provided by the fiber optic temperature monitoring system for each freeze well can be used to determine the location of any breaches or hot spots in the low temperature zone maintained by the freeze wells. The temperature profile monitored by the fiber optic temperature monitoring system for the two freeze wells closest to the hot spot or fluid flow will show the quickest and greatest change in temperature. A temperature change of a few degrees Centigrade in the temperature profiles of the freeze wells closest to a troubled area may be sufficient to isolate the location of the trouble area. The shut down time of flow of circulation fluid in the freeze wells of interest needed to detect breaches, potential breaches, and hot spots may be on the order of a few hours or days, depending on the well spacing and the amount of fluid flow affecting the low temperature zone.

Fiber optic temperature monitoring systems may also be used to monitor temperatures in heated portions of the formation during in situ conversion processes. The fiber of a fiber optic cable used in the heated portion of the formation may be clad with a reflective material to facilitate retention of a signal or signals transmitted down the fiber. In some embodiments, the fiber is clad with gold, copper, nickel, and/or alloys thereof. The cladding may be formed of a material that is able to withstand chemical and temperature conditions in the heated portion of the formation. For example, gold cladding may allow an optical sensor to be used up to temperatures of about 700° C. In some embodiments, the fiber is clad with nickel. The fiber may be dipped in or run through a bath of liquid nickel. The clad fiber may then be allowed to cool to secure the nickel to the fiber.

Figure 15:
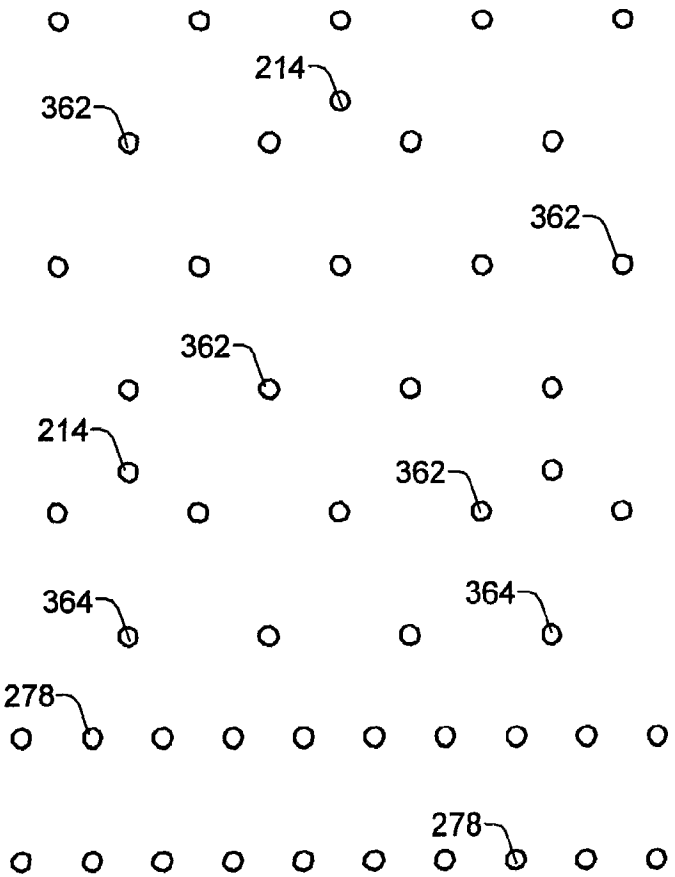
FIG. 15 depicts a schematic view of a well layout including heat interceptor wells.

In some embodiments, heaters that heat hydrocarbons in the formation may be close to the low temperature zone established by freeze wells. In some embodiments, heaters may be may be 20 m, 10 m, 5 m or less from an edge of the low temperature zone established by freeze wells. In some embodiments, heat interceptor wells may be positioned between the low temperature zone and the heaters to reduce the heat load applied to the low temperature zone from the heated part of the formation. FIG. 15 depicts a schematic view of the well layout plan for heater wells 362, production wells 214, heat interceptor wells 364, and freeze wells 278 for a portion of an in situ conversion system embodiment. Heat interceptor wells 364 are positioned between heater wells 362 and freeze wells 278.

Some heat interceptor wells may be formed in the formation specifically for the purpose of reducing the heat load applied to the low temperature zone established by freeze wells. Some heat interceptor wells may be heater wellbores, monitor wellbores, production wellbores, dewatering wellbores or other type of wellbores that are converted for use as heat interceptor wells.

In some embodiments, heat interceptor wells may function as heat pipes to reduce the heat load applied to the low temperature zone. A liquid heat transfer fluid may be placed in the heat interceptor wellbores. The liquid may include, but is not limited to, water, alcohol, and/or alkanes. Heat supplied to the formation from the heaters may advance to the heat interceptor wellbores and vaporize the liquid heat transfer fluid in the heat interceptor wellbores. The resulting vapor may rise in the wellbores. Above the heated portion of the formation adjacent to the overburden, the vapor may condense and flow by gravity back to the area adjacent to the heated part of the formation. The heat absorbed by changing the phase of the liquid heat transfer fluid reduces the heat load applied to the low temperature zone. Using heat interceptor wells that function as heat pipes may be advantageous for formations with thick overburdens that are able to absorb the heat applied as the heat transfer fluid changes phase from vapor to liquid. The wellbore may include wicking material, packing to increase surface area adjacent to a portion of the overburden, or other material to promote heat transfer to or from the formation and the heat transfer fluid.

In some embodiments, a heat transfer fluid is circulated through the heat interceptor wellbores in a closed loop system. A heat exchanger reduces the temperature of the heat transfer fluid after the heat transfer fluid leaves the heat interceptor wellbores. Cooled heat transfer fluid is pumped through the heat interceptor wellbores. In some embodiments, the heat transfer fluid does not undergo a phase change during use. In some embodiments, the heat transfer fluid may change phases during use. The heat transfer fluid may be, but is not limited to, water, alcohol, and/or glycol.

A potential source of heat loss from the heated formation is due to reflux in wells. Refluxing occurs when vapors condense in a well and flow into a portion of the well adjacent to the heated portion of the formation. Vapors may condense in the well adjacent to the overburden of the formation to form condensed fluid. Condensed fluid flowing into the well adjacent to the heated formation absorbs heat from the formation. Heat absorbed by condensed fluids cools the formation and necessitates additional energy input into the formation to maintain the formation at a desired temperature. Some fluids condensed in the overburden and flowing into the portion of the well adjacent to the heated formation may react to produce undesired compounds and/or coke. Inhibiting fluids from refluxing may significantly improve the thermal efficiency of the in situ conversion system and/or the quality of the product produced from the in situ conversion system.

For some well embodiments, the portion of the well adjacent to the overburden section of the formation is cemented to the formation. In some well embodiments, the well includes packing material placed near the transition from the heated section of the formation to the overburden. The packing material inhibits formation fluid from passing from the heated section of the formation into the section of the wellbore adjacent to the overburden. Cables, conduits, devices, and/or instruments may pass through the packing material, but the packing material inhibits formation fluid from passing up the wellbore adjacent to the overburden section of the formation.

The flow of production fluid up the well to the surface is desired for some types of wells, especially for production wells. Flow of production fluid up the well is also desirable for some heater wells that are used to control pressure in the formation. The overburden, or a conduit in the well used to transport formation fluid from the heated portion of the formation to the surface may be heated to inhibit condensation on or in the conduit. Providing heat in the overburden, however, may be costly and/or may lead to increased cracking or coking of formation fluid as the formation fluid is being produced from the formation.

To avoid the need to heat the overburden or to heat the conduit passing through the overburden, one or more diverters may be placed in the wellbore to inhibit fluid from refluxing into the wellbore adjacent to the heated portion of the formation. In some embodiments, the diverter retains fluid above the heated portion of the formation. Fluids retained in the diverter may be removed from the diverter using a pump, gas lifting, and/or other fluid removal technique. In some embodiments, the diverter directs fluid to a pump, gas lift assembly, or other fluid removal device located below the heated portion of the formation.

Figure 16:
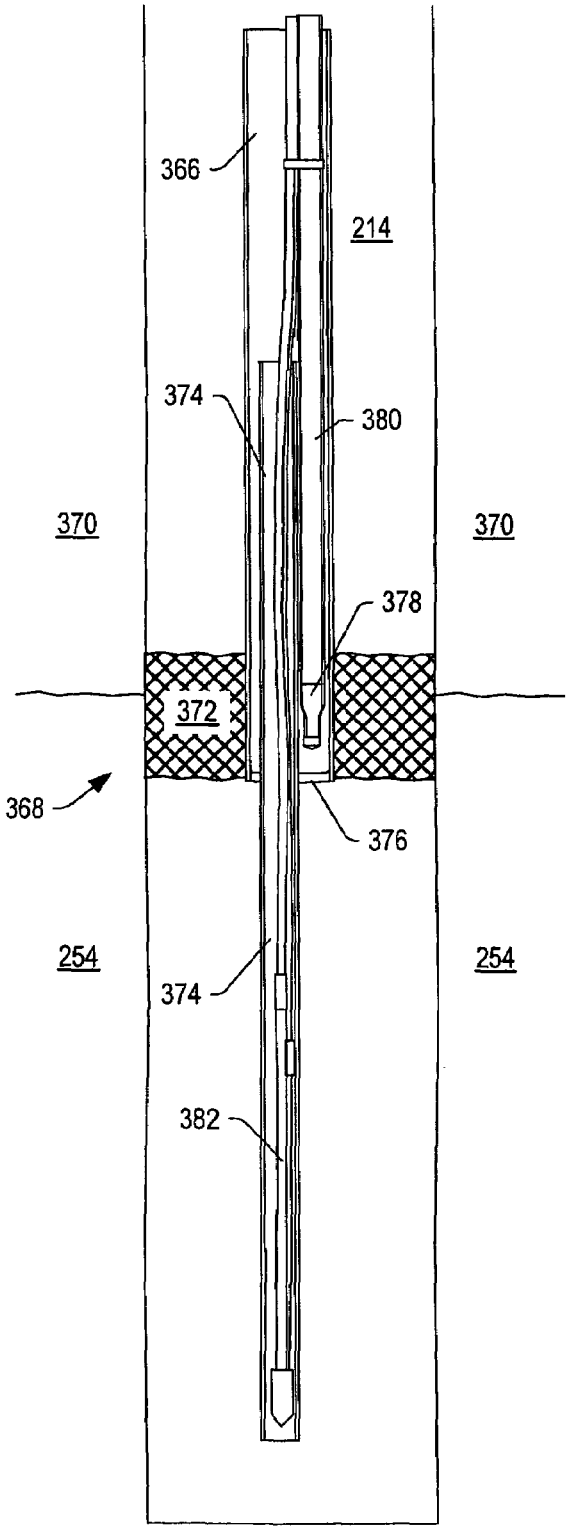
FIG. 16 depicts a schematic representation of an embodiment of a diverter device in the production well.

FIG. 16 depicts an embodiment of a diverter in a production well. Production well 214 includes conduit 366. In some embodiments, diverter 368 is coupled to or located proximate production conduit 366 in overburden 370. In some embodiments, the diverter is placed in the heated portion of the formation. Diverter 368 may be located at or near an interface of overburden 370 and hydrocarbon layer 254. Hydrocarbon layer 254 is heated by heat sources located in the formation. Diverter 368 may include packing 372, riser 374, and seal 376 in production conduit 366. Formation fluid in the vapor phase from the heated formation moves from hydrocarbon layer 254 into riser 374. In some embodiments, riser 374 is perforated below packing 372 to facilitate movement of fluid into the riser. Packing 372 inhibits passage of the vapor phase formation fluid into an upper portion of production well 214. Formation fluid in the vapor phase moves through riser 374 into production conduit 366. A non-condensable portion of the formation fluid rises through production conduit 366 to the surface. The vapor phase formation fluid in production conduit 366 may cool as it rises towards the surface in the production conduit. If a portion of the vapor phase formation fluid condenses to liquid in production conduit 366, the liquid flows by gravity towards seal 376. Seal 376 inhibits liquid from entering the heated portion of the formation. Liquid collected above seal 376 is removed by pump 378 through conduit 380. Pump 378 may be, but is not limited to being, a sucker rod pump, an electrical pump, or a progressive cavity pump (Moyno style). In some embodiments, liquid above seal 376 is gas lifted through conduit 380. Producing condensed fluid may reduce costs associated with removing heat from fluids at the wellhead of the production well.

In some embodiments, production well 214 includes heater 382. Heater 382 provides heat to vaporize liquids in a portion of production well 214 proximate hydrocarbon layer 254. Heater 382 may be located in production conduit 366 or may be coupled to the outside of the production conduit. In embodiments where the heater is located outside of the production conduit, a portion of the heater passes through the packing material.

In some embodiments, a diluent may be introduced into production conduit 366 and/or conduit 380. The diluent is used to inhibit clogging in production conduit 366, pump 378, and/or conduit 380. The diluent may be, but is not limited to being, water, an alcohol, a solvent, or a surfactant.

In some embodiments, riser 374 extends to the surface of production well 214. Perforations and a baffle in riser 374 located above seal 376 direct condensed liquid from the riser into production conduit 366.

In certain embodiments, two or more diverters may be located in the production well. Two or more diverters provide a simple way of separating initial fractions of condensed fluid produced from the in situ conversion system. A pump may be placed in each diverters to remove condensed fluid from the diverters.

Figure 17:
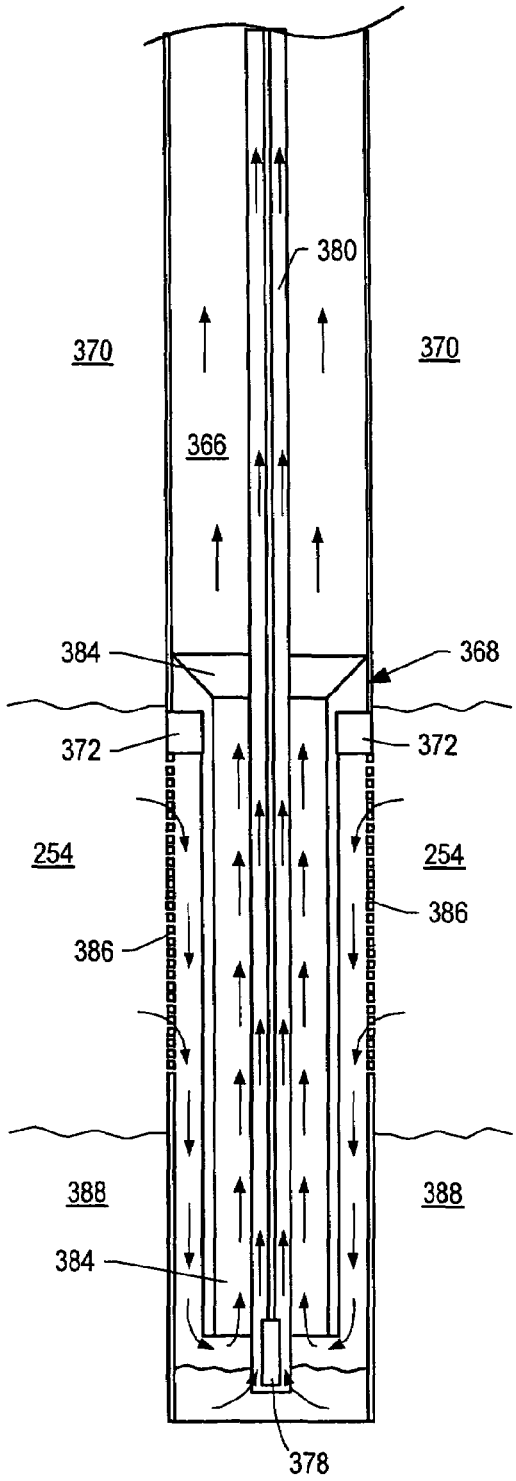
FIG. 17 depicts a schematic representation of an embodiment of the baffle in the production well.

In some embodiments, fluids (gases and liquids) may be directed towards the bottom of the production well using the diverter. The fluids may be produced from the bottom of the production well. FIG. 17 depicts an embodiment of the diverter that directs fluid towards the bottom of the production well. Diverter 368 may include packing material 372 and baffle 384 positioned in production conduit 366. Baffle may be a pipe positioned around conduit 380. Production conduit 366 may have openings 386 that allow fluids to enter the production conduit from hydrocarbon layer 254. In some embodiments, all or a portion of the openings are adjacent to a non-hydrocarbon layer of the formation through which heated formation fluid flows. Openings 386 include, but are not limited to, screens, perforations, slits, and/or slots. Hydrocarbon layer 254 may be heated using heaters located in other portions of the formation and/or a heater located in production conduit 366.

Baffle 384 and packing material 372 direct formation fluid entering production conduit 366 to unheated zone 388. Unheated zone 388 is in the underburden of the formation. A portion of the formation fluid may condense on the outer surface of baffle 384 or on walls of production conduit 366 adjacent to unheated zone 388. Liquid fluid from the formation and/or condensed fluid may flow by gravity to a bottom portion of production conduit 366. Liquid and condensate in the bottom portion of production conduit 366 may be pumped to the surface through conduit 380 using pump 378. Pump 378 may be placed 1 m, 5 m, 10 m, 20 m or more into the underburden. In some embodiments, the pump may be placed in a non-cased (open) portion of the wellbore. Non-condensed fluid initially travels through the annular space between baffle 384 and conduit 380, and then through the annular space between production conduit 366 and conduit 380 to the surface, as indicated by arrows in FIG. 17. If a portion of the non-condensed fluid condenses adjacent to overburden 370 while traveling to the surface, the condensed fluid will flow by gravity toward the bottom portion of production conduit 366 to the intake for pump 378. Heat absorbed by the condensed fluid as the fluid passes through the heated portion of the formation is from contact with baffle 384, not from direct contact with the formation. Baffle 384 is heated by formation fluid and radiative heat transfer from the formation. Significantly less heat from the formation is transferred to the condensed fluid as the fluid flows through baffle 384 adjacent to the heated portion than if the condensed fluid was able to contact the formation. The condensed fluid flowing down the baffle may absorb enough heat from the vapor in the wellbore to condense a portion of the vapor on the outer surface of baffle 384. The condensed portion of the vapor may flow down the baffle to the bottom portion of the wellbore.

In some embodiments, diluent may be introduced into production conduit 366 and/or conduit 380. The diluent is used to inhibit clogging in production conduit 366, pump 378, and conduit 380. The diluent may include, but is not limited to, water, an alcohol, a solvent, a surfactant, or combinations thereof. Different diluents may be introduced at different times. For example, a solvent may be introduced when production first begins to put into solution high molecular weight hydrocarbons that are initially produced from the formation. At a later time, water may be substituted for the solvent.

Figure 18:
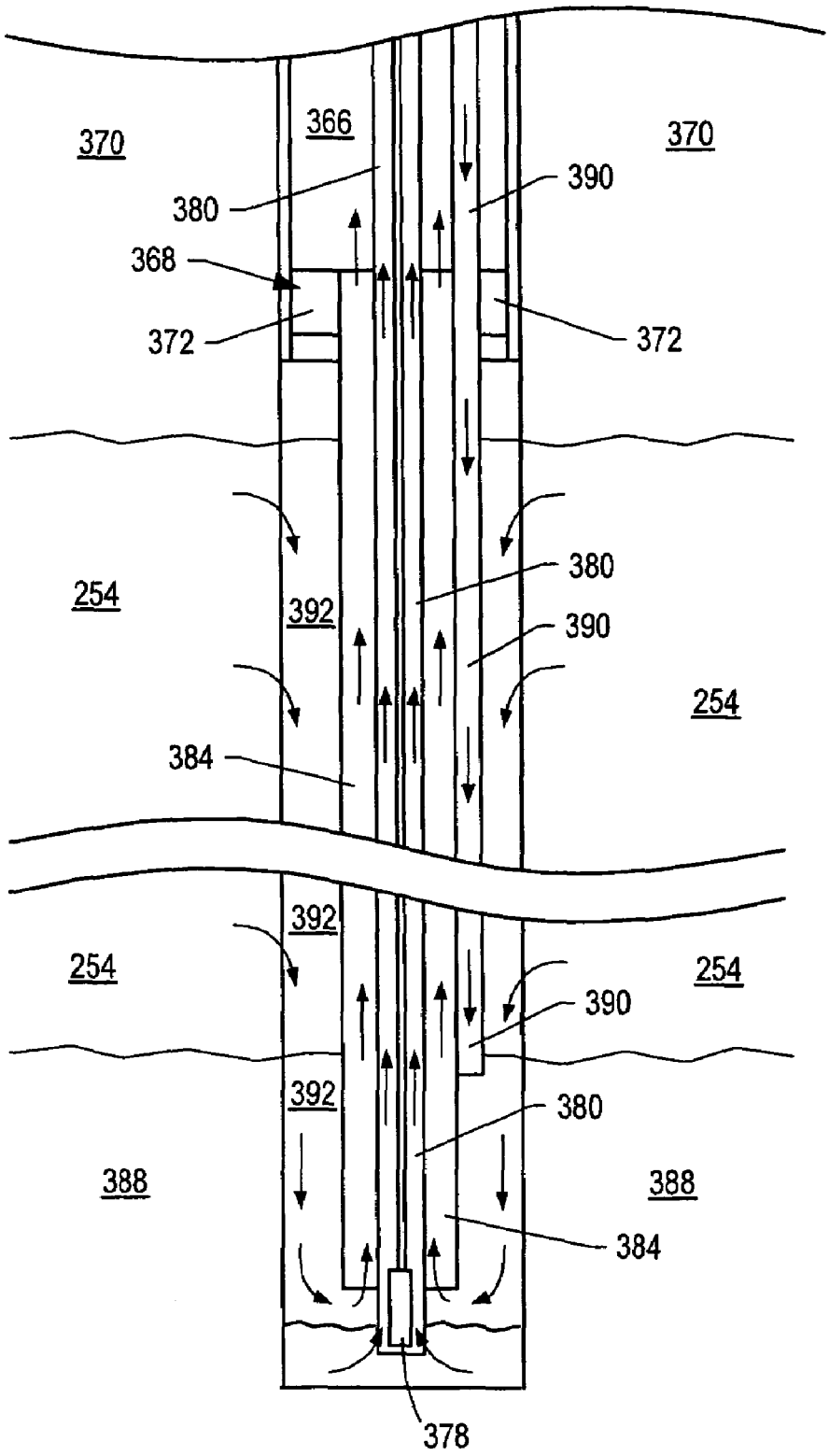
FIG. 18 depicts a schematic representation of an embodiment of the baffle in the production well.

In some embodiments, a separate conduit may introduce the diluent to the wellbore near the underburden, as depicted in FIG. 18. Production conduit 366 directs vapor produced from the formation to the surface through overburden 370. If a portion of the vapor condenses in production conduit 366, the condensate can flow down baffle 384 to the intake for pump 378. Diverter 368, comprising packing material 372 and baffle 384, directs formation fluid flow from heated hydrocarbon layer 254 to unheated zone 388. Liquid formation fluid is transported by pump 378 through conduit 380 to the surface. Vapor formation fluid is transported through baffle 384 to production conduit 366. Conduit 390 may be strapped to baffle 384. Conduit 390 may introduce the diluent to wellbore 392 adjacent to unheated zone 388. The diluent may promote condensation of formation fluid and/or inhibit clogging of pump 378. Diluent in conduit 390 may be at a high pressure. If the diluent changes phase from liquid to vapor while passing through the heated portion of the formation, the change in pressure as the diluent leaves conduit 390 allows the diluent to condense.

Some formation layers may have material characteristics that lead to sloughing in a wellbore. For example, lean clay-rich layers of an oil shale formation may slough when heated. Sloughing refers to the shedding or casting off of formation material (for example, rock or clay) into the wellbore. Layers rich in expanding clays (for example, smectites or illites) have a high tendency for sloughing. Clays may reduce permeability in lean layers. When heat is rapidly provided to layers with reduced permeability, water and/or other fluids may be unable to escape from the layer. Water and/or other fluids that cannot escape the layer build up pressure in the layer until the pressure causes a mechanical failure of material. This mechanical failure occurs when the internal pressure exceeds the tensile strength of rock in the layer and produces sloughing.

Sloughing of material in the wellbore may lead to overheating, plugging, equipment deformation, and/or fluid flow problems in the wellbore. Sloughed material may catch or be trapped in or around the heater in the wellbore. For example, sloughed material may get trapped between the heater and the wall of the formation above an expanded rich layer that contacts or approaches the heater. The sloughed material may be loosely packed and have low thermal conductivity. Low thermal conductivity sloughed material may lead to overheating of the heater and/or slow heat transfer to the formation. Sloughed material in a hydrocarbon containing formation (such as an oil shale formation) may have an average particle diameter between 1 millimeter ("mm") and 2.5 centimeter ("cm"), between 1.5 mm and 2 cm, or between 5 mm and 1 cm.

Volumes of the subsurface formation with very low permeability (for example, 10 microdarcy ("μdarcy") or less, 20 μdarcy or less, or 50 μdarcy or less) may have a tendency to slough. For oil shale, these volumes are typically lean layers with clay contents of 5% by volume or greater. The clay may be smectite clay or illite clay. Material in volumes with very low permeability may rubbilize during heating of the subsurface formation. The rubbilization may be caused by expansion of clay bound water, other clay bound fluids, and/or gases in the rock matrix.

Several techniques may be used to inhibit sloughing or problems associated with sloughing. The techniques include initially heating the wellbore so that there is an initial slow temperature increase in the near wellbore region, pretreating the wellbore with a stabilizing fluid prior to heating, providing a controlled explosion in the wellbore prior to heating, placing a liner or screen in the wellbore, and sizing the wellbore and equipment placed in the wellbore so that sloughed material does not cause problems in the wellbore. The various techniques may be used independently or in combination with each other.

In some embodiments, the permeability of a volume (a zone) of the subsurface formation is assessed. In certain embodiments, clay content of the zone of the subsurface formation is assessed. The volume or zones of assessed permeability and/or clay content are at or near a wellbore (for example, within 1 m, 0.5 m, or 0.3 m of the wellbore). The permeability may be assessed by, for example, Stoneley wave attenuation acoustic logging. Clay content may be assessed by, for example, a pulsed neutron logging system, such as RST (Reservoir Saturation Tool) logging from Schlumberger Oilfield Services (Houston, Tex.). The clay content is assessed from the difference between density and neutron logs. If the assessment shows that one or more zones near the wellbore have a permeability below a selected value (for example, at most 10 μdarcy, at most 20 μdarcy, or at most 50 μdarcy) and/or a clay content above a selected value (for example, at least 5% by volume, at least 3% by volume, or at least 2% by volume), initial heating of the formation at or near the wellbore may be controlled to maintain the heating rate below a selected value. The selected heating rate varies depending on type of formation, pattern of wellbores in the formation, type of heater used, spacing of wellbores in the formation, or other factors.

Initial heating may be maintained at or below the selected heating rate for a specified length of time. After a certain amount of time, the permeability at or near the wellbores may increase to a value such that sloughing is no longer likely to occur due to slow expansion of gases in the layer. Slower heating rates allow time for water or other fluids to vaporize and escape the layer, inhibiting rapid pressure buildup in the layer. A slow initial heating rate allows expanding water vapor and other fluids to create microfractures in the formation instead of wellbore failure, which may occur when the formation is heated rapidly. As a heat front moves away from the wellbore, the rate of temperature rise lessens. For example, the rate of temperature rise is typically greatly reduced at distances of 0.1 m, 0.3 m, 0.5 m, 1 m, 3 m, from the wellbore. In certain embodiments, the heating rate of a subsurface formation at or near the wellbore (for example, within 3 m of the wellbore, within 1 m of the wellbore, within 0.5 m of the wellbore, or within 0.3 m of the wellbore) is maintained below 20° C./day for at least 15 days. In some embodiments, the heating rate of a subsurface formation at or near the wellbore is maintained below 10° C./day for at least 30 days. In some embodiments, the heating rate of a subsurface formation at or near the wellbore is maintained below 5° C./day for at least 60 days. In some embodiments, the heating rate of a subsurface formation at or near the wellbore is maintained below 2° C./day for at least 150 days.

In certain embodiments, the wellbore in the formation that has zones or areas that lead to sloughing is pretreated to inhibit sloughing during heating. The wellbore may be treated before the heater is placed in the wellbore. In some embodiments, the wellbore with a selected clay content is treated with one or more clay stabilizers. For example, clay stabilizers may be added to a brine solution used during formation of a wellbore. Clay stabilizers include, but are not limited to, lime or other calcium containing materials well known in the oilfield industry. In some embodiments, the use of clay stabilizers that include halogens is limited (or avoided) to reduce (or avoid) corrosion problems with the heater or other equipment used in the wellbore.

In certain embodiments, the wellbore is treated by providing a controlled explosion in the wellbore. The controlled explosion may be provided along selected lengths or in selected sections of the wellbore. The controlled explosion is provided by placing the controlled explosive system into the wellbore. The controlled explosion may be implemented by controlling the velocity of vertical propagation of the explosion in the wellbore. One example of a controlled explosive system is Primacord® explosive cord available from The Ensign-Bickford Company (Spanish Fork, Utah). A controlled explosive system may be set to explode along selected lengths or selected sections of a wellbore. The explosive system may be controlled to limit the amount of explosion in the wellbore.

Figure 19:
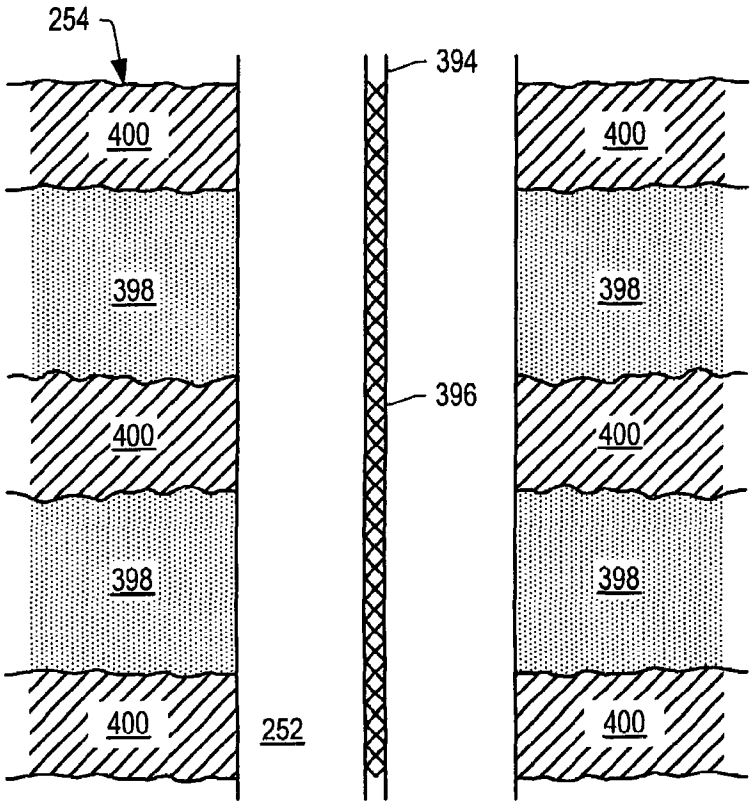
FIG. 19 depicts an embodiment for providing a controlled explosion in an opening.

FIG. 19 depicts an embodiment for providing a controlled explosion in an opening. Opening 252 is formed in hydrocarbon layer 254. Explosive system 394 is placed in opening 252. In an embodiment, explosive system 394 includes Primacord®. In certain embodiments, explosive system 394 has explosive section 396. In some embodiments, explosive section 396 is located proximate layers with a relatively high clay content and/or layers with very low permeability that are to be heated (such as lean layers 398). In some embodiments, a non-explosive portion of explosive system 394 may be located proximate layers rich in hydrocarbons and low in clay content (such as rich layers 400). In some embodiments, the explosive portion may extend adjacent to lean layers 398 and rich layers 400. Explosive section 396 may be controllably exploded at or near the wellbore.

Figure 20:
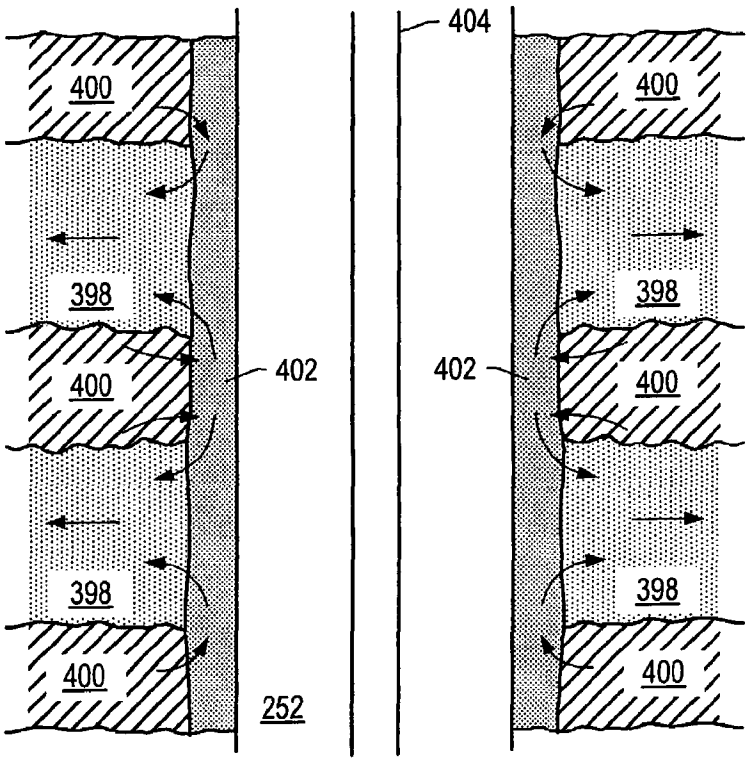
FIG. 20 depicts an embodiment of an opening after a controlled explosion in the opening.

FIG. 20 depicts an embodiment of an opening after the controlled explosion in the opening. The controlled explosion increases the permeability of zones 402. In certain embodiments, zones 402 have a width between 0.1 m and 3 m, between 0.2 m and 2 m, or between 0.3 m and 1 m extending outward from the wall of opening 252 into lean layers 398 and rich layers 400. In one embodiment, the width is 0.3 m. The permeabilities of zones 402 are increased by microfracturing in the zones. After zones 402 have been created, heater 404 is installed in opening 252. In some embodiments, rubble formed by the controlled explosion in opening 252 is removed (for example, drilled out or scooped out) before installing heater 404 in the opening. In some embodiments, opening 252 is drilled deeper (drilled beyond a needed length) before initiating a controlled explosion. The overdrilled opening may allow rubble from the explosion to fall into the extra portion (the bottom) of the opening, and thus inhibit interference of rubble with a heater installed in the opening.

Providing the controlled explosion in the wellbore creates microfracturing and increases permeability of the formation in a region near the wellbore. In an embodiment, the controlled explosion creates microfracturing with limited or no rubbilization of material in the formation. The increased permeability allows gas release in the formation during early stages of heating. The gas release inhibits buildup of gas pressure in the formation that may cause sloughing of material in the near wellbore region.

In certain embodiments, the increased permeability created by providing the controlled explosion is advantageous in early stages of heating a formation. In some embodiments, the increased permeability includes increased horizontal permeability and increased vertical permeability. The increased vertical permeability may connect layers (such as rich and lean layers) in the formation. As shown by the arrows in FIG. 20, fluids produced in rich layers 400 from heat provided by heater 404 flow from rich layers to lean layers 398 through zones 402. The increased permeability of zones 402 facilitates flow from rich layers 400 to lean layers 398. Fluids in lean layers 398 flow to the production wellbore or a lower temperature wellbore for production. This flow pattern inhibits fluids from being overheated by heater 404. Overheating of fluids by heater 404 may lead to coking in or at opening 252. Zones 402 have widths that extend beyond a coking radius from a wall of opening 252 to allow fluids to flow coaxially or parallel to the opening at a distance outside the coking radius. Reducing heating of the fluids may also improve product quality by inhibiting thermal cracking and the production of olefins and other low quality products. More heat may be provided to hydrocarbon layer 254 at a higher rate by heater 404 during early stages of heating because formation fluids flow from zones 402 and through lean layers 398.

Figure 21:
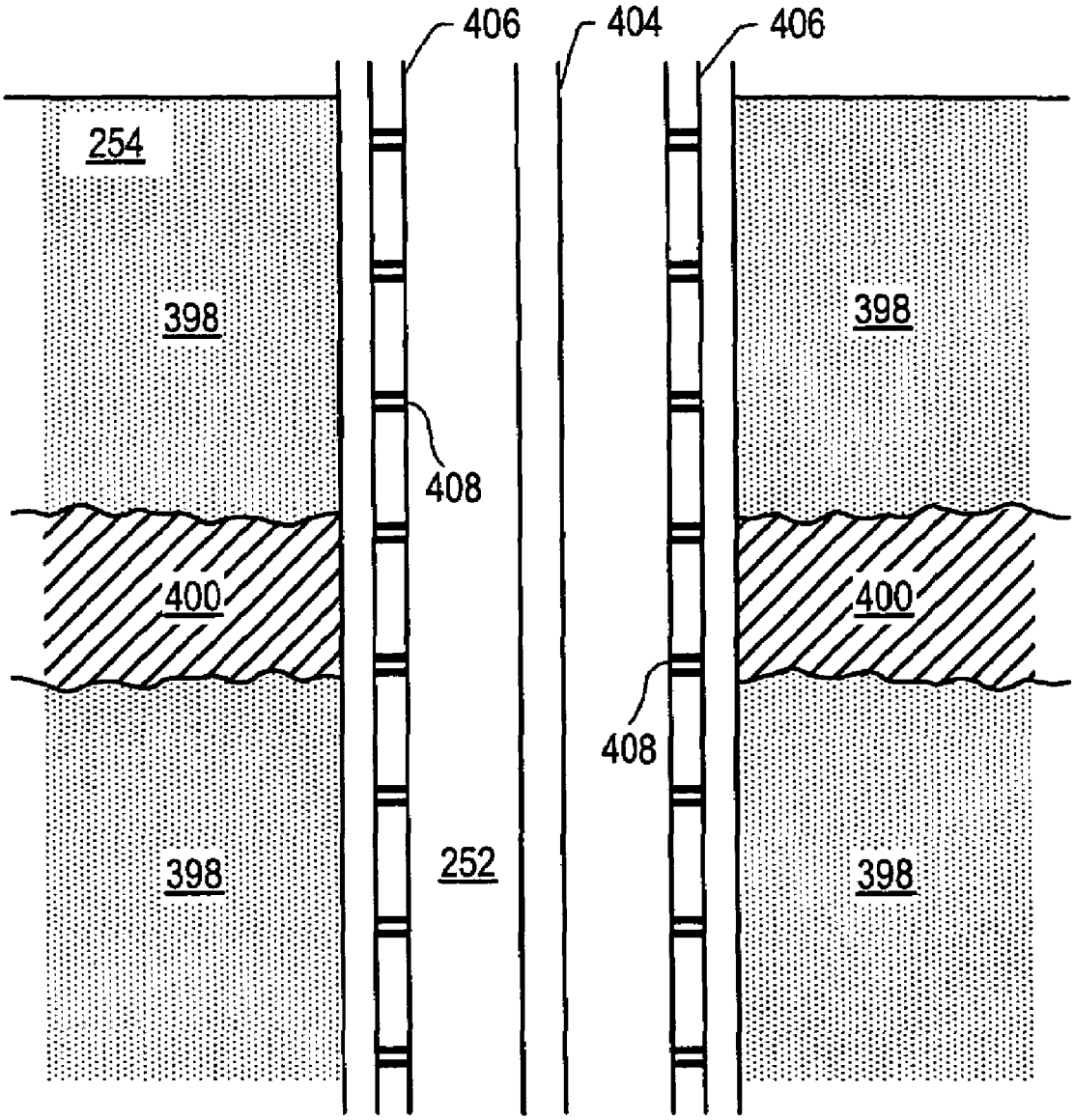
FIG. 21 depicts an embodiment of a liner in the opening.

In certain embodiments, a perforated liner (or a perforated conduit) is placed in the wellbore outside of the heater to inhibit sloughed material from contacting the heater. FIG. 21 depicts an embodiment of a liner in the opening. In certain embodiments, liner 406 is made of carbon steel or stainless steel. In some embodiments, liner 406 inhibits expanded material from deforming heater 404. Liner 406 has a diameter that is only slightly smaller than an initial diameter of opening 252. Liner 406 has openings 408 that allow fluid to pass through the liner. Openings 408 are, for example, slots or slits. Openings 408 are sized so that fluids pass through liner 406 but sloughed material or other particles do not pass through the liner.

In some embodiments, liner 406 is selectively placed at or near layers that may lead to sloughing (such as rich layers 400). For example, layers with relatively low permeability (for example, at most 10 μdarcy, at most 20 μdarcy, or at most 50 μdarcy) may lead to sloughing. In certain embodiments, liner 406 is a screen, a wire mesh or other wire construction, and/or a deformable liner. For example, liner 406 may be an expandable tubular with openings 408. Liner 406 may be expanded with a mandrel or "pig" after installation of the liner into the opening. Liner 406 may deform or bend when the formation is heated, but sloughed material from the formation will be too large to pass through openings 408 in the liner.

Figure 22:
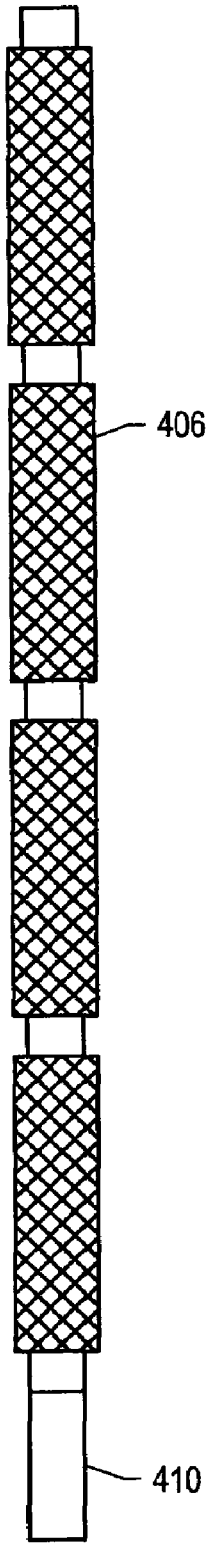
FIG. 22 depicts an embodiment of the liner in a stretched configuration.
Figure 23:
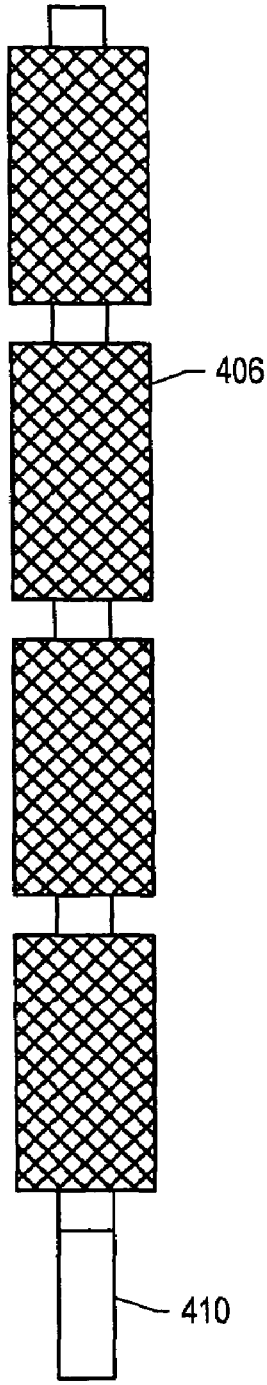
FIG. 23 depicts an embodiment of the liner in an expanded configuration.

In some embodiments, liner 406 is an expandable screen installed in the opening in a stretched configuration. Liner 406 may be relaxed following installation. FIG. 22 depicts an embodiment of liner 406 in a stretched configuration. Liner 406 has weight 410 attached to a bottom of the liner. Weight 410 hangs freely and provides tension to stretch liner 406. Weight 410 may stop moving when the weight contacts a bottom surface (for example, a bottom of the opening). In some embodiments, the weight is released from the liner. With tension from weight 410 removed, liner 406 relaxes into an expanded configuration, as shown in FIG. 23. In some embodiments, liner 406 is installed in the opening in a compacted configuration and expanded with a mandrel or pig. Typically, expandable liners are perforated or slotted tubulars that are placed in the wellbore and expanded by forcing a mandrel through the liner. These expandable liners may be expanded against the wall of the wellbore to inhibit sloughing of material from the walls. Examples of typical expandable liners are available from Weatherford U.S., L.P. (Alice, Tex.) and Halliburton Energy Services (Houston, Tex.).

In certain embodiments, the wellbore or opening is sized such that sloughed material in the wellbore does not inhibit heating in the wellbore. The wellbore and the heater maybe sized so that an annulus between the heater and the wellbore is small enough to inhibit particles of a selected size (for example, a size of sloughed material) from freely moving (for example, falling due to gravity, movement due to fluid pressures, or movement due to geological phenomena) in the annulus. In some embodiments, selected portions of the annulus are sized to inhibit particles from freely moving. In certain embodiments, the annulus between the heater and the wellbore has a width of at most 2.5 cm, at most 2 cm, or at most 1.5 cm. Different methods to reduce the effects of sloughing described herein may be used either alone or in combination.

Temperature limited heaters may be in configurations and/or may include materials that provide automatic temperature limiting properties for the heater at certain temperatures. In certain embodiments, ferromagnetic materials are used in temperature limited heaters. Ferromagnetic material may self-limit temperature at or near the Curie temperature of the material to provide a reduced amount of heat at or near the Curie temperature when an time-varying current is applied to the material. In certain embodiments, the ferromagnetic material self-limits temperature of the temperature limited heater at a selected temperature that is approximately the Curie temperature. In certain embodiments, the selected temperature is within about 35° C., within about 25° C., within about 20° C., or within about 10° C. of the Curie temperature. In certain embodiments, ferromagnetic materials are coupled with other materials (for example, highly conductive materials, high strength materials, corrosion resistant materials, or combinations thereof) to provide various electrical and/or mechanical properties. Some parts of the temperature limited heater may have a lower resistance (caused by different geometries and/or by using different ferromagnetic and/or non-ferromagnetic materials) than other parts of the temperature limited heater. Having parts of the temperature limited heater with various materials and/or dimensions allows for tailoring the desired heat output from each part of the heater.

Temperature limited heaters may be more reliable than other heaters. Temperature limited heaters may be less apt to break down or fail due to hot spots in the formation. In some embodiments, temperature limited heaters allow for substantially uniform heating of the formation. In some embodiments, temperature limited heaters are able to heat the formation more efficiently by operating at a higher average heat output along the entire length of the heater. The temperature limited heater operates at the higher average heat output along the entire length of the heater because power to the heater does not have to be reduced to the entire heater, as is the case with typical constant wattage heaters, if a temperature along any point of the heater exceeds, or is about to exceed, a maximum operating temperature of the heater. Heat output from portions of a temperature limited heater approaching a Curie temperature of the heater automatically reduces without controlled adjustment of the time-varying current applied to the heater. The heat output automatically reduces due to changes in electrical properties (for example, electrical resistance) of portions of the temperature limited heater. Thus, more power is supplied by the temperature limited heater during a greater portion of a heating process.

In certain embodiments, the system including temperature limited heaters initially provides a first heat output and then provides a reduced (second heat output) heat output, near, at, or above the Curie temperature of an electrically resistive portion of the heater when the temperature limited heater is energized by a time-varying current. The first heat output is the heat output at temperatures below which the temperature limited heater begins to self-limit. In some embodiments, the first heat output is the heat output at a temperature 50° C., 75°

C., 100° C., or 125° C. below the Curie temperature of the ferromagnetic material in the temperature limited heater.

The temperature limited heater may be energized by time-varying current (alternating current or modulated direct current) supplied at the wellhead. The wellhead may include a power source and other components (for example, modulation components, transformers, and/or capacitors) used in supplying power to the temperature limited heater. The temperature limited heater may be one of many heaters used to heat a portion of the formation.

In certain embodiments, the temperature limited heater includes a conductor that operates as a skin effect or proximity effect heater when time-varying current is applied to the conductor. The skin effect limits the depth of current penetration into the interior of the conductor. For ferromagnetic materials, the skin effect is dominated by the magnetic permeability of the conductor. The relative magnetic permeability of ferromagnetic materials is typically between 10 and 1000 (for example, the relative magnetic permeability of ferromagnetic materials is typically at least 10 and may be at least 50, 100, 500, 1000 or greater). As the temperature of the ferromagnetic material is raised above the Curie temperature and/or as the applied electrical current is increased, the magnetic permeability of the ferromagnetic material decreases substantially and the skin depth expands rapidly (for example, the skin depth expands as the inverse square root of the magnetic permeability). The reduction in magnetic permeability results in a decrease in the AC or modulated DC resistance of the conductor near, at, or above the Curie temperature and/or as the applied electrical current is increased. When the temperature limited heater is powered by a substantially constant current source, portions of the heater that approach, reach, or are above the Curie temperature may have reduced heat dissipation. Sections of the temperature limited heater that are not at or near the Curie temperature may be dominated by skin effect heating that allows the heater to have high heat dissipation due to a higher resistive load.

Curie temperature heaters have been used in soldering equipment, heaters for medical applications, and heating elements for ovens (for example, pizza ovens). Some of these uses are disclosed in U.S. Pat. No. 5,579,575 to Lamome et al.; Pat. No. 5,065,501 to Henschen et al.; and Pat. No. 5,512,732 to Yagnik et al., all of which are incorporated by reference as if fully set forth herein. U.S. Pat. No. 4,849,611 to Whitney et al., which is incorporated by reference as if fully set forth herein, describes a plurality of discrete, spaced-apart heating units including a reactive component, a resistive heating component, and a temperature responsive component.

An advantage of using the temperature limited heater to heat hydrocarbons in the formation is that the conductor is chosen to have a Curie temperature in a desired range of temperature operation. Operation within the desired operating temperature range allows substantial heat injection into the formation while maintaining the temperature of the temperature limited heater, and other equipment, below design limit temperatures. Design limit temperatures are temperatures at which properties such as corrosion, creep, and/or deformation are adversely affected. The temperature limiting properties of the temperature limited heater inhibits overheating or burnout of the heater adjacent to low thermal conductivity "hot spots" in the formation. In some embodiments, the temperature limited heater is able to lower or control heat output and/or withstand heat at temperatures above 25° C., 37° C., 100° C., 250° C., 500° C., 700° C., 800° C., 900° C., or higher up to 1131° C., depending on the materials used in the heater.

The temperature limited heater allows for more heat injection into the formation than constant wattage heaters because the energy input into the temperature limited heater does not have to be limited to accommodate low thermal conductivity regions adjacent to the heater. For example, in Green River oil shale there is a difference of at least a factor of 3 in the thermal conductivity of the lowest richness oil shale layers and the highest richness oil shale layers. When heating such a formation, substantially more heat is transferred to the formation with the temperature limited heater than with the conventional heater that is limited by the temperature at low thermal conductivity layers. The heat output along the entire length of the conventional heater needs to accommodate the low thermal conductivity layers so that the heater does not overheat at the low thermal conductivity layers and burn out. The heat output adjacent to the low thermal conductivity layers that are at high temperature will reduce for the temperature limited heater, but the remaining portions of the temperature limited heater that are not at high temperature will still provide high heat output. Because heaters for heating hydrocarbon formations typically have long lengths (for example, at least 10 m, 100 m, 300 m, at least 500 m, 1 km or more up to about 10 km), the majority of the length of the temperature limited heater may be operating below the Curie temperature while only a few portions are at or near the Curie temperature of the temperature limited heater.

The use of temperature limited heaters allows for efficient transfer of heat to the formation. Efficient transfer of heat allows for reduction in time needed to heat the formation to a desired temperature. For example, in Green River oil shale, pyrolysis typically requires 9.5 years to 10 years of heating when using a 12 m heater well spacing with conventional constant wattage heaters. For the same heater spacing, temperature limited heaters may allow a larger average heat output while maintaining heater equipment temperatures below equipment design limit temperatures. Pyrolysis in the formation may occur at an earlier time with the larger average heat output provided by temperature limited heaters than the lower average heat output provided by constant wattage heaters. For example, in Green River oil shale, pyrolysis may occur in 5 years using temperature limited heaters with a 12 m heater well spacing. Temperature limited heaters counteract hot spots due to inaccurate well spacing or drilling where heater wells come too close together. In certain embodiments, temperature limited heaters allow for increased power output over time for heater wells that have been spaced too far apart, or limit power output for heater wells that are spaced too close together. Temperature limited heaters also supply more power in regions adjacent the overburden and underburden to compensate for temperature losses in these regions.

Temperature limited heaters may be advantageously used in many types of formations. For example, in tar sands formations or relatively permeable formations containing heavy hydrocarbons, temperature limited heaters may be used to provide a controllable low temperature output for reducing the viscosity of fluids, mobilizing fluids, and/or enhancing the radial flow of fluids at or near the wellbore or in the formation. Temperature limited heaters may be used to inhibit excess coke formation due to overheating of the near wellbore region of the formation.

The use of temperature limited heaters, in some embodiments, eliminates or reduces the need for expensive temperature control circuitry. For example, the use of temperature limited heaters eliminates or reduces the need to perform temperature logging and/or the need to use fixed thermocouples on the heaters to monitor potential overheating at hot spots.

In certain embodiments, the temperature limited heater is deformation tolerant. Localized movement of material in a wellbore may result in lateral stresses on the heater that could deform its shape. Locations along a length of a heater at which the wellbore approaches or closes on the heater may be hot spots where a standard heater overheats and has the potential to burn out. These hot spots may lower the yield strength and creep strength of the metal, allowing crushing or deformation of the heater. The temperature limited heater may be formed with S curves (or other non-linear shapes) that accommodate deformation of the temperature limited heater without causing failure of the heater.

In some embodiments, temperature limited heaters are more economical to manufacture or make than standard heaters. Typical ferromagnetic materials include iron, carbon steel, or ferritic stainless steel. Such materials are inexpensive as compared to nickel-based heating alloys (such as nichrome, Kanthal™ (Bulten-Kanthal AB, Sweden), and/or LOHM™ (Driver-Harris Company, Harrison, N.J.)) typically used in insulated conductor (mineral insulated cable) heaters. In one embodiment of the temperature limited heater, the temperature limited heater is manufactured in continuous lengths as an insulated conductor heater to lower costs and improve reliability.

In some embodiments, a temperature limited heater is placed in a heater well using a coiled tubing rig. A heater that can be coiled on a spool may be manufactured by using metal such as ferritic stainless steel (for example, 409 stainless steel) that is welded using electrical resistance welding (ERW). To form a heater section, a metal strip from a roll is passed through a first former where it is shaped into a tubular and then longitudinally welded using ERW. The tubular is passed through a second former where a conductive strip (for example, a copper strip) is applied, drawn down tightly on the tubular through a die, and longitudinally welded using ERW. A sheath may be formed by longitudinally welding a support material (for example, steel such as 347H or 347HH) over the conductive strip material. The support material may be a strip rolled over the conductive strip material. An overburden section of the heater may be formed in a similar manner. In certain embodiments, the overburden section uses a non-ferromagnetic material such as 304 stainless steel or 316 stainless steel instead of a ferromagnetic material. The heater section and overburden section may be coupled together using standard techniques such as butt welding using an orbital welder. In some embodiments, the overburden section material (the non-ferromagnetic material) may be pre-welded to the ferromagnetic material before rolling. The pre-welding may eliminate the need for a separate coupling step (for example, butt welding). In an embodiment, a flexible cable (for example, a furnace cable such as a MGT 1000 furnace cable) may be pulled through the center after forming the tubular heater. An end bushing on the flexible cable may be welded to the tubular heater to provide an electrical current return path. The tubular heater, including the flexible cable, may be coiled onto a spool before installation into a heater well. In an embodiment, a temperature limited heater is installed using a coiled tubing rig. The coiled tubing rig may place the temperature limited heater in a deformation resistant container in a formation. The deformation resistant container may be placed in the heater well using conventional methods.

In an embodiment, a Curie heater includes a furnace cable inside a ferromagnetic conduit (for example, a ¾" Schedule 80 446 stainless steel pipe). The ferromagnetic conduit may be clad with copper or another suitable conductive material. The ferromagnetic conduit may be placed in a deformation-tolerant conduit or deformation resistant container. The deformation-tolerant conduit may tolerate longitudinal deformation, radial deformation, and creep. The deformation-tolerant conduit may also support the ferromagnetic conduit and furnace cable. The deformation-tolerant conduit may be selected based on creep and/or corrosion resistance near or at the Curie temperature. In one embodiment, the deformation-tolerant conduit is 1½" Schedule 80 347 stainless steel pipe (outside diameter of about 4.826 cm) or 1½" Schedule 160 347H stainless steel pipe (outside diameter of about 4.826 cm).

The diameter and/or materials of the deformation-tolerant conduit may vary depending on, for example, characteristics of the formation to be heated or desired heat output characteristics of the heater. In certain embodiments, air is removed from the annulus between the deformation-tolerant conduit and the clad ferromagnetic conduit. The space between the deformation-tolerant conduit and the clad ferromagnetic conduit may be flushed with a pressurized inert gas (for example, helium, nitrogen, argon, or mixtures thereof). In some embodiments, the inert gas may include a small amount of hydrogen to act as a "getter" for residual oxygen. The inert gas may pass down the annulus from the surface, enter the inner diameter of the ferromagnetic conduit through a small hole near the bottom of the heater, and flow up inside the ferromagnetic conduit. Removal of the air in the annulus may reduce oxidation of materials in the heater (for example, the nickel-coated copper wires of the furnace cable) to provide a longer life heater, especially at elevated temperatures. Thermal conduction between a furnace cable and the ferromagnetic conduit, and between the ferromagnetic conduit and the deformation-tolerant conduit, may be improved when the inert gas is helium. The pressurized inert gas in the annular space may also provide additional support for the deformation-tolerant conduit against high formation pressures. Pressurized inert gas also inhibits arcing between metal conductors in the annular space compared to inert gas at atmospheric pressure.

In certain embodiments, a thermally conductive fluid such as helium may be placed inside void volumes of the temperature limited heater where heat is transferred. Placing thermally conductive fluid inside void volumes of the temperature limited heater may improve thermal conduction inside the void volumes. Thermally conductive fluids include, but are not limited to, gases that are thermally conductive, electrically insulating, and radiantly transparent. In certain embodiments, thermally conductive fluid in the void volumes has a higher thermal conductivity than air at standard temperature and pressure (STP) (0° C. and 101.325 kPa). Radiantly transparent gases include gases with diatomic or single atoms that do not absorb a significant amount of infrared energy. In certain embodiments, thermally conductive fluids include helium and/or hydrogen. Thermally conductive fluids may also be thermally stable at operating temperatures in the temperature limited heater so that the thermally conductive fluids do not thermally crack at operating temperature in the temperature limited heater.

Thermally conductive fluid may be placed inside a conductor, inside a conduit, and/or inside a jacket of a temperature limited heater. The thermally conductive fluid may be placed in the space (the annulus) between one or more components (for example, conductor, conduit, or jacket) of the temperature limited heater. In some embodiments, thermally conductive fluid is placed in the space (the annulus) between the temperature limited heater and a conduit.

In certain embodiments, air and/or other fluid in the space (the annulus) is displaced by a flow of thermally conductive fluid during introduction of the thermally conductive fluid into the space. In some embodiments, air and/or other fluid is removed (for example, vacuumed, flushed, or pumped out) from the space before introducing thermally conductive fluid in the space. Reducing the partial pressure of oxygen in the space reduces the rate of oxidation of heater components in the space. The thermally conductive fluid is introduced in a specific volume and/or to a selected pressure in the space. Thermally conductive fluid may be introduced such that the space has at least a minimum volume percentage of thermally conductive fluid above a selected value. In certain embodiments, the space has at least 50%, 75%, or 90% by volume of thermally conductive fluid.

Placing thermally conductive fluid inside the space of the temperature limited heater increases thermal heat transfer in the space. The increased thermal heat transfer is caused by reducing resistance to heat transfer in the space with the thermally conductive fluid. Reducing resistance to heat transfer in the space allows for increased power output from the temperature limited heater to the subsurface formation. Reducing the resistance to heat transfer inside the space with the thermally conductive fluid allows for smaller diameter electrical conductors (for example, a smaller diameter inner conductor, a smaller diameter outer conductor, and/or a smaller diameter conduit), a larger outer radius (for example, a larger radius of a conduit or a jacket), and/or an increased space width. Reducing the diameter of electrical conductors reduces material costs. Increasing the outer radius of the conduit or the jacket and/or increasing the annulus space width provides additional annular space. Additional annular space may accommodate deformation of the conduit and/or the jacket without causing heater failure. Increasing the outer radius of the conduit or the jacket and/or increasing the annulus width may provide additional annular space to protect components (for example, spacers, connectors, and/or conduits) in the annulus.

As the annular width of the temperature limited heater is increased, however, greater heat transfer is needed across the annular space to maintain good heat output properties for the heater. In some embodiments, especially for low temperature heaters, radiative heat transfer is minimally effective in transferring heat across the annular space of the heater. Conductive heat transfer in the annular space is important in such embodiments to maintain good heat output properties for the heater. A thermally conductive fluid provides increased heat transfer across the annular space.

In certain embodiments, the thermally conductive fluid located in the space is also electrically insulating to inhibit arcing between conductors in the temperature limited heater. Arcing across the space or gap is a problem with longer heaters that require higher operating voltages. Arcing may be a problem with shorter heaters and/or at lower voltages depending on the operating conditions of the heater. Increasing the pressure of the fluid in the space increases the spark gap breakdown voltage in the space and inhibits arcing across the space. Certain gases, such as $SF_6$ or $N_2$, have greater resistance to electrical breakdown but have lower thermal conductivities than helium or hydrogen because of their higher molecular weights. Thus, gases such as $SF_6$ or $N_2$ may be less desirable in some embodiments.

Pressure of thermally conductive fluid in the space may be increased to a pressure between 200 kPa and 60,000 kPa, between 500 kPa and 50,000 kPa, between 700 kPa and 45,000 kPa, or between 1000 kPa and 40,000 kPa. In an embodiment, the pressure of the thermally conductive fluid is increased to at least 700 kPa or at least 1000 kPa. In certain embodiments, the pressure of the thermally conductive fluid needed to inhibit arcing across the space depends on the temperature in the space. Electrons may track along surfaces (for example, insulators, connectors, or shields) in the space and cause arcing or electrical degradation of the surfaces. High pressure fluid in the space may inhibit electron tracking along surfaces in the space. Helium has about one-seventh the breakdown voltage of air at atmospheric pressure. Thus, higher pressures of helium (for example, 7 atm (707 kPa) or greater of helium) may be used to compensate for the lower breakdown voltage of helium as compared to air.

Temperature limited heaters may be used for heating hydrocarbon formations including, but not limited to, oil shale formations, coal formations, tar sands formations, and heavy viscous oils. Temperature limited heaters may be used for remediation of contaminated soil. Temperature limited heaters may also be used in the field of environmental remediation to vaporize or destroy soil contaminants. Embodiments of temperature limited heaters are used to heat fluids in a wellbore or sub-sea pipeline to inhibit deposition of paraffin or various hydrates. In some embodiments, a temperature limited heater is used for solution mining of a subsurface formation (for example, an oil shale or a coal formation). In certain embodiments, a fluid (for example, molten salt) is placed in a wellbore and heated with a temperature limited heater to inhibit deformation and/or collapse of the wellbore. In some embodiments, the temperature limited heater is attached to a sucker rod in the wellbore or is part of the sucker rod itself. In some embodiments, temperature limited heaters are used to heat a near wellbore region to reduce near wellbore oil viscosity during production of high viscosity crude oils and during transport of high viscosity oils to the surface. In some embodiments, a temperature limited heater enables gas lifting of a viscous oil by lowering the viscosity of the oil without coking the oil. Temperature limited heaters may be used in sulfur transfer lines to maintain temperatures between about 110° C. and about 130° C.

Certain embodiments of temperature limited heaters may be used in chemical or refinery processes at elevated temperatures that require control in a narrow temperature range to inhibit unwanted chemical reactions or damage from locally elevated temperatures. Some applications may include, but are not limited to, reactor tubes, cokers, and distillation towers. Temperature limited heaters may also be used in pollution control devices (for example, catalytic converters, and oxidizers) to allow rapid heating to a control temperature without complex temperature control circuitry. Additionally, temperature limited heaters may be used in food processing to avoid damaging food with excessive temperatures. Temperature limited heaters may also be used in the heat treatment of metals (for example, annealing of weld joints). Temperature limited heaters may also be used in floor heaters, cauterizers, and/or various other appliances. Temperature limited heaters may be used with biopsy needles to destroy tumors by raising temperatures in vivo.

Some embodiments of temperature limited heaters may be useful in certain types of medical and/or veterinary devices. For example, a temperature limited heater may be used to therapeutically treat tissue in a human or an animal. A temperature limited heater for a medical or veterinary device may have ferromagnetic material including a palladium-copper alloy with a Curie temperature of about 50° C. A high frequency (for example, a frequency greater than about 1 MHz) may be used to power a relatively small temperature limited heater for medical and/or veterinary use.

The ferromagnetic alloy or ferromagnetic alloys used in the temperature limited heater determine the Curie temperature of the heater. Curie temperature data for various metals is listed in "American Institute of Physics Handbook," Second Edition, McGraw-Hill, pages 5-170 through 5-176. Ferromagnetic conductors may include one or more of the ferromagnetic elements (iron, cobalt, and nickel) and/or alloys of these elements. In some embodiments, ferromagnetic conductors include iron-chromium (Fe—Cr) alloys that contain tungsten (W) (for example, HCM12A and SAVE12 (Sumitomo Metals Co., Japan) and/or iron alloys that contain chromium (for example, Fe—Cr alloys, Fe—Cr—W alloys, Fe—Cr—V (vanadium) alloys, Fe—Cr—Nb (Niobium) alloys). Of the three main ferromagnetic elements, iron has a Curie temperature of approximately 770° C.; cobalt (Co) has a Curie temperature of approximately 1131° C.; and nickel has a Curie temperature of approximately 358° C. An iron-cobalt alloy has a Curie temperature higher than the Curie temperature of iron. For example, iron-cobalt alloy with 2% by weight cobalt has a Curie temperature of approximately 800° C.; iron-cobalt alloy with 12% by weight cobalt has a Curie temperature of approximately 900° C.; and iron-cobalt alloy with 20% by weight cobalt has a Curie temperature of approximately 950° C. Iron-nickel alloy has a Curie temperature lower than the Curie temperature of iron. For example, iron-nickel alloy with 20% by weight nickel has a Curie temperature of approximately 720° C., and iron-nickel alloy with 60% by weight nickel has a Curie temperature of approximately 560° C.

Some non-ferromagnetic elements used as alloys raise the Curie temperature of iron. For example, an iron-vanadium alloy with 5.9% by weight vanadium has a Curie temperature of approximately 815° C. Other non-ferromagnetic elements (for example, carbon, aluminum, copper, silicon, and/or chromium) may be alloyed with iron or other ferromagnetic materials to lower the Curie temperature. Non-ferromagnetic materials that raise the Curie temperature may be combined with non-ferromagnetic materials that lower the Curie temperature and alloyed with iron or other ferromagnetic materials to produce a material with a desired Curie temperature and other desired physical and/or chemical properties. In some embodiments, the Curie temperature material is a ferrite such as $NiFe_2O_4$. In other embodiments, the Curie temperature material is a binary compound such as $FeNi_3$ or $Fe_3Al$.

Certain embodiments of temperature limited heaters may include more than one ferromagnetic material. Such embodiments are within the scope of embodiments described herein if any conditions described herein apply to at least one of the ferromagnetic materials in the temperature limited heater.

Ferromagnetic properties generally decay as the Curie temperature is approached. The "Handbook of Electrical Heating for Industry" by C. James Erickson (IEEE Press, 1995) shows a typical curve for 1% carbon steel (steel with 1% carbon by weight). The loss of magnetic permeability starts at temperatures above 650° C. and tends to be complete when temperatures exceed 730° C. Thus, the self-limiting temperature may be somewhat below the actual Curie temperature of the ferromagnetic conductor. The skin depth for current flow in 1% carbon steel is 0.132 cm at room temperature and increases to 0.445 cm at 720° C. From 720° C. to 730° C., the skin depth sharply increases to over 2.5 cm. Thus, a temperature limited heater embodiment using 1% carbon steel begins to self-limit between 650° C. and 730° C.

Skin depth generally defines an effective penetration depth of time-varying current into the conductive material. In general, current density decreases exponentially with distance from an outer surface to the center along the radius of the conductor. The depth at which the current density is approximately 1/e of the surface current density is called the skin depth. For a solid cylindrical rod with a diameter much greater than the penetration depth, or for hollow cylinders with a wall thickness exceeding the penetration depth, the skin depth, δ, is:

$$\delta=1981.5*(\rho/(\mu*f))^{1/2}; \quad (2)$$

in which: δ=skin depth in inches;

ρ=resistivity at operating temperature (ohm-cm);

μ=relative magnetic permeability; and f=frequency (Hz).

EQN. 2 is obtained from "Handbook of Electrical Heating for Industry" by C. James Erickson (IEEE Press, 1995). For most metals, resistivity (ρ) increases with temperature. The relative magnetic permeability generally varies with temperature and with current. Additional equations may be used to assess the variance of magnetic permeability and/or skin depth on both temperature and/or current. The dependence of μ on current arises from the dependence of μ on the magnetic field.

Materials used in the temperature limited heater may be selected to provide a desired turndown ratio. Turndown ratios of at least 1.1:1, 2:1, 3:1, 4:1, 5:1, 10:1, 30:1, or 50:1 may be selected for temperature limited heaters. Larger turndown ratios may also be used. A selected turndown ratio may depend on a number of factors including, but not limited to, the type of formation in which the temperature limited heater is located (for example, a higher turndown ratio may be used for an oil shale formation with large variations in thermal conductivity between rich and lean oil shale layers) and/or a temperature limit of materials used in the wellbore (for example, temperature limits of heater materials). In some embodiments, the turndown ratio is increased by coupling additional copper or another good electrical conductor to the ferromagnetic material (for example, adding copper to lower the resistance above the Curie temperature).

The temperature limited heater may provide a minimum heat output (power output) below the Curie temperature of the heater. In certain embodiments, the minimum heat output is at least 400 W/m (Watts per meter), 600 W/m, 700 W/m, 800 W/m, or higher up to 2000 W/m. The temperature limited heater reduces the amount of heat output by a section of the heater when the temperature of the section of the heater approaches or is above the Curie temperature. The reduced amount of heat may be substantially less than the heat output below the Curie temperature. In some embodiments, the reduced amount of heat is at most 400 W/m, 200 W/m, 100 W/m or may approach 0 W/m.

In certain embodiments, the temperature limited heater operates substantially independently of the thermal load on the heater in a certain operating temperature range. "Thermal load" is the rate that heat is transferred from a heating system to its surroundings. It is to be understood that the thermal load may vary with temperature of the surroundings and/or the thermal conductivity of the surroundings. In an embodiment, the temperature limited heater operates at or above the Curie temperature of the temperature limited heater such that the operating temperature of the heater increases at most by 3° C., 2° C., 1.5° C., 1° C., or 0.5° C. for a decrease in thermal load of 1 W/m proximate to a portion of the heater. In certain embodiments, the temperature limited heater operates in such a manner at a relatively constant current.

The AC or modulated DC resistance and/or the heat output of the temperature limited heater may decrease as the temperature approaches the Curie temperature and decrease sharply near or above the Curie temperature due to the Curie effect. In certain embodiments, the value of the electrical resistance or heat output above or near the Curie temperature is at most one-half of the value of electrical resistance or heat output at a certain point below the Curie temperature. In some embodiments, the heat output above or near the Curie temperature is at most 90%, 70%, 50%, 30%, 20%, 10%, or less (down to 1%) of the heat output at a certain point below the Curie temperature (for example, 30° C. below the Curie temperature, 40° C. below the Curie temperature, 50° C. below the Curie temperature, or 100° C. below the Curie temperature). In certain embodiments, the electrical resistance above or near the Curie temperature decreases to 80%, 70%, 60%, 50%, or less (down to 1%) of the electrical resistance at a certain point below the Curie temperature (for example, 30° C. below the Curie temperature, 40° C. below the Curie temperature, 50° C. below the Curie temperature, or 100° C. below the Curie temperature).

In some embodiments, AC frequency is adjusted to change the skin depth of the ferromagnetic material. For example, the skin depth of 1% carbon steel at room temperature is 0.132 cm at 60 Hz, 0.0762 cm at 180 Hz, and 0.046 cm at 440 Hz. Since heater diameter is typically larger than twice the skin depth, using a higher frequency (and thus a heater with a smaller diameter) reduces heater costs. For a fixed geometry, the higher frequency results in a higher turndown ratio. The turndown ratio at a higher frequency is calculated by multiplying the turndown ratio at a lower frequency by the square root of the higher frequency divided by the lower frequency. In some embodiments, a frequency between 100 Hz and 1000 Hz, between 140 Hz and 200 Hz, or between 400 Hz and 600 Hz is used (for example, 180 Hz, 540 Hz, or 720 Hz). In some embodiments, high frequencies may be used. The frequencies may be greater than 1000 Hz.

To maintain a substantially constant skin depth until the Curie temperature of the temperature limited heater is reached, the heater may be operated at a lower frequency when the heater is cold and operated at a higher frequency when the heater is hot. Line frequency heating is generally favorable, however, because there is less need for expensive components such as power supplies, transformers, or current modulators that alter frequency. Line frequency is the frequency of a general supply of current. Line frequency is typically 60 Hz, but may be 50 Hz or another frequency depending on the source for the supply of the current. Higher frequencies may be produced using commercially available equipment such as solid state variable frequency power supplies. Transformers that convert three-phase power to single-phase power with three times the frequency are commercially available. For example, high voltage three-phase power at 60 Hz may be transformed to single-phase power at 180 Hz and at a lower voltage. Such transformers are less expensive and more energy efficient than solid state variable frequency power supplies. In certain embodiments, transformers that convert three-phase power to single-phase power are used to increase the frequency of power supplied to the temperature limited heater.

In certain embodiments, modulated DC (for example, chopped DC, waveform modulated DC, or cycled DC) may be used for providing electrical power to the temperature limited heater. A DC modulator or DC chopper may be coupled to a DC power supply to provide an output of modulated direct current. In some embodiments, the DC power supply may include means for modulating DC. One example of a DC modulator is a DC-to-DC converter system. DC-to-DC converter systems are generally known in the art. DC is typically modulated or chopped into a desired waveform. Waveforms for DC modulation include, but are not limited to, square-wave, sinusoidal, deformed sinusoidal, deformed square-wave, triangular, and other regular or irregular waveforms.

The modulated DC waveform generally defines the frequency of the modulated DC. Thus, the modulated DC waveform may be selected to provide a desired modulated DC frequency. The shape and/or the rate of modulation (such as the rate of chopping) of the modulated DC waveform may be varied to vary the modulated DC frequency. DC may be modulated at frequencies that are higher than generally available AC frequencies. For example, modulated DC may be provided at frequencies of at least 1000 Hz. Increasing the frequency of supplied current to higher values advantageously increases the turndown ratio of the temperature limited heater.

In certain embodiments, the modulated DC waveform is adjusted or altered to vary the modulated DC frequency. The DC modulator may be able to adjust or alter the modulated DC waveform at any time during use of the temperature limited heater and at high currents or voltages. Thus, modulated DC provided to the temperature limited heater is not limited to a single frequency or even a small set of frequency values. Waveform selection using the DC modulator typically allows for a wide range of modulated DC frequencies and for discrete control of the modulated DC frequency. Thus, the modulated DC frequency is more easily set at a distinct value whereas AC frequency is generally limited to multiples of the line frequency. Discrete control of the modulated DC frequency allows for more selective control over the turndown ratio of the temperature limited heater. Being able to selectively control the turndown ratio of the temperature limited heater allows for a broader range of materials to be used in designing and constructing the temperature limited heater.

In certain embodiments, electrical power for the temperature limited heater is initially supplied using non-modulated DC or very low frequency modulated DC. Using DC, or low frequency DC, at earlier times of heating reduces inefficiencies associated with higher frequencies. DC and/or low frequency modulated DC may also be cheaper to use during initial heating times. After a selected temperature is reached in a temperature limited heater; modulated DC, higher frequency modulated DC, or AC is used for providing electrical power to the temperature limited heater so that the heat output will decrease near, at, or above the Curie temperature.

In some embodiments, the modulated DC frequency or the AC frequency is adjusted to compensate for changes in properties (for example, subsurface conditions such as temperature or pressure) of the temperature limited heater during use. The modulated DC frequency or the AC frequency provided to the temperature limited heater is varied based on assessed downhole conditions. For example, as the temperature of the temperature limited heater in the wellbore increases, it may be advantageous to increase the frequency of the current provided to the heater, thus increasing the turndown ratio of the heater. In an embodiment, the downhole temperature of the temperature limited heater in the wellbore is assessed.

In certain embodiments, the modulated DC frequency, or the AC frequency, is varied to adjust the turndown ratio of the temperature limited heater. The turndown ratio may be adjusted to compensate for hot spots occurring along a length of the temperature limited heater. For example, the turndown ratio is increased because the temperature limited heater is getting too hot in certain locations. In some embodiments, the modulated DC frequency, or the AC frequency, are varied to adjust a turndown ratio without assessing a subsurface condition.

At or near the Curie temperature of the ferromagnetic material, a relatively small change in voltage may cause a relatively large change in current to the load. The relatively small change in voltage may produce problems in the power supplied to the temperature limited heater, especially at or near the Curie temperature. The problems include, but are not limited to, reducing the power factor, tripping a circuit breaker, and/or blowing a fuse. In some cases, voltage changes may be caused by a change in the load of the temperature limited heater. In certain embodiments, an electrical current supply (for example, a supply of modulated DC or AC) provides a relatively constant amount of current that does not substantially vary with changes in load of the temperature limited heater. In an embodiment, the electrical current supply provides an amount of electrical current that remains within 15%, within 10%, within 5%, or within 2% of a selected constant current value when a load of the temperature limited heater changes.

Temperature limited heaters may generate an inductive load. The inductive load is due to some applied electrical current being used by the ferromagnetic material to generate a magnetic field in addition to generating a resistive heat output. As downhole temperature changes in the temperature limited heater, the inductive load of the heater changes due to changes in the ferromagnetic properties of ferromagnetic materials in the heater with temperature. The inductive load of the temperature limited heater may cause a phase shift between the current and the voltage applied to the heater.

A reduction in actual power applied to the temperature limited heater may be caused by a time lag in the current waveform (for example, the current has a phase shift relative to the voltage due to an inductive load) and/or by distortions in the current waveform (for example, distortions in the current waveform caused by introduced harmonics due to a non-linear load). Thus, it may take more current to apply a selected amount of power due to phase shifting or waveform distortion. The ratio of actual power applied and the apparent power that would have been transmitted if the same current were in phase and undistorted is the power factor. The power factor is always less than or equal to 1. The power factor is 1 when there is no phase shift or distortion in the waveform.

Actual power applied to a heater due to a phase shift may be described by EQN. 3:

$$P=I\times V\times\cos(\theta); \quad (3)$$

in which P is the actual power applied to a heater; I is the applied current; V is the applied voltage; and θ is the phase angle difference between voltage and current. Other phenomena such as waveform distortion may contribute to further lowering of the power factor. If there is no distortion in the waveform, then cos(θ) is equal to the power factor At higher frequencies (for example, modulated DC frequencies of at least 1000 Hz, 1500 Hz, or 2000 Hz), the problem with phase shifting and/or distortion is more pronounced. In certain embodiments, a capacitor is used to compensate for phase shifting caused by the inductive load. Capacitive load may be used to balance the inductive load because current for capacitance is 180 degrees out of phase from current for inductance. In some embodiments, a variable capacitor (for example, a solid state switching capacitor) is used to compensate for phase shifting caused by a varying inductive load. In an embodiment, the variable capacitor is placed at the wellhead for the temperature limited heater. Placing the variable capacitor at the wellhead allows the capacitance to be varied more easily in response to changes in the inductive load of the temperature limited heater. In certain embodiments, the variable capacitor is placed subsurface with the temperature limited heater, subsurface within the heater, or as close to the heating conductor as possible to minimize line losses due to the capacitor. In some embodiments, the variable capacitor is placed at a central location for a field of heater wells (in some embodiments, one variable capacitor may be used for several temperature limited heaters). In one embodiment, the variable capacitor is placed at the electrical junction between the field of heaters and the utility supply of electricity.

In certain embodiments, the variable capacitor is used to maintain the power factor of the temperature limited heater or the power factor of the electrical conductors in the temperature limited heater above a selected value. In some embodiments, the variable capacitor is used to maintain the power factor of the temperature limited heater above the selected value of 0.85, 0.9, or 0.95. In certain embodiments, the capacitance in the variable capacitor is varied to maintain the power factor of the temperature limited heater above the selected value.

In some embodiments, the modulated DC waveform is pre-shaped to compensate for phase shifting and/or harmonic distortion. The waveform may be pre-shaped by modulating the waveform into a specific shape. For example, the DC modulator is programmed or designed to output a waveform of a particular shape. In certain embodiments, the pre-shaped waveform is varied to compensate for changes in the inductive load of the temperature limited heater caused by changes in the phase shift and/or the harmonic distortion. Electrical measurements may be used to assess the phase shift and/or the harmonic distortion. In certain embodiments, heater conditions (for example, downhole temperature or pressure) are assessed and used to determine the pre-shaped waveform. In some embodiments, the pre-shaped waveform is determined through the use of a simulation or calculations based on the heater design. Simulations and/or heater conditions may also be used to determine the capacitance needed for the variable capacitor.

In some embodiments, the modulated DC waveform modulates DC between 100% (full current load) and 0% (no current load). For example, a square-wave may modulate 100 A DC between 100% (100 A) and 0% (0 A) (full wave modulation), between 100% (100 A) and 50% (50 A), or between 75% (75 A) and 25% (25 A). The lower current load (for example, the 0%, 25%, or 50% current load) may be defined as the base current load.

Generally, a temperature limited heater designed for higher voltage and lower current will have a smaller skin depth. Decreasing the current may decrease the skin depth of the ferromagnetic material. The smaller skin depth allows the temperature limited heater to have a smaller diameter, thereby reducing equipment costs. In certain embodiments, the applied current is at least 1 amp, 10 amps, 70 amps, 100 amps, 200 amps, 500 amps, or greater up to 2000 amps. In some embodiments, current is supplied at voltages above 200 volts, above 480 volts, above 650 volts, above 1000 volts, above 1500 volts, or higher up to 10000 volts.

In certain embodiments, the temperature limited heater includes an inner conductor inside an outer conductor. The inner conductor and the outer conductor are radially disposed about a central axis. The inner and outer conductors may be separated by an insulation layer. In certain embodiments, the inner and outer conductors are coupled at the bottom of the temperature limited heater. Electrical current may flow into the temperature limited heater through the inner conductor and return through the outer conductor. One or both conductors may include ferromagnetic material.

The insulation layer may comprise an electrically insulating ceramic with high thermal conductivity, such as magnesium oxide, aluminum oxide, silicon dioxide, beryllium oxide, boron nitride, silicon nitride, or combinations thereof. The insulating layer may be a compacted powder (for example, compacted ceramic powder). Compaction may improve thermal conductivity and provide better insulation resistance. For lower temperature applications, polymer insulation made from, for example, fluoropolymers, polyimides, polyamides, and/or polyethylenes, may be used. In some embodiments, the polymer insulation is made of perfluoroalkoxy (PFA) or polyetheretherketone (PEEK™ (Victrex Ltd, England)). The insulating layer may be chosen to be substantially infrared transparent to aid heat transfer from the inner conductor to the outer conductor. In an embodiment, the insulating layer is transparent quartz sand. The insulation layer may be air or a non-reactive gas such as helium, nitrogen, or sulfur hexafluoride. If the insulation layer is air or a non-reactive gas, there may be insulating spacers designed to inhibit electrical contact between the inner conductor and the outer conductor. The insulating spacers may be made of, for example, high purity aluminum oxide or another thermally conducting, electrically insulating material such as silicon nitride. The insulating spacers may be a fibrous ceramic material such as Nextel™ 312 (3M Corporation, St. Paul, Minn.), mica tape, or glass fiber. Ceramic material may be made of alumina, alumina-silicate, alumina-borosilicate, silicon nitride, boron nitride, or other materials.

The insulation layer may be flexible and/or substantially deformation tolerant. For example, if the insulation layer is a solid or compacted material that substantially fills the space between the inner and outer conductors, the temperature limited heater may be flexible and/or substantially deformation tolerant. Forces on the outer conductor can be transmitted through the insulation layer to the solid inner conductor, which may resist crushing. Such a temperature limited heater may be bent, dog-legged, and spiraled without causing the outer conductor and the inner conductor to electrically short to each other. Deformation tolerance may be important if the wellbore is likely to undergo substantial deformation during heating of the formation.

In certain embodiments, an outermost layer of the temperature limited heater (for example, the outer conductor) is chosen for corrosion, yield strength, and/or creep resistance. In one embodiment, austentitic (non-ferromagnetic) stainless steels such as 201, 304H, 347H, 347H, 316H, 310, 347HP, NF709 (Nippon Steel Corp., Japan) stainless steels, or combinations thereof may be used in the outer conductor. The outermost layer may also include a clad conductor. For example, a corrosion resistant alloy such as 800H or 347H stainless steel may be clad for corrosion protection over a ferromagnetic carbon steel tubular. If high temperature strength is not required, the outermost layer may be constructed from the ferromagnetic metal with good corrosion resistance such as one of the ferritic stainless steels. In one embodiment, a ferritic alloy of 82.3% by weight iron with 17.7% by weight chromium (Curie temperature of 678° C.) provides desired corrosion resistance.

The Metals Handbook, vol. 8, page 291 (American Society of Materials (ASM)) includes a graph of Curie temperature of iron-chromium alloys versus the amount of chromium in the alloys. In some temperature limited heater embodiments, a separate support rod or tubular (made from 347H stainless steel) is coupled to the temperature limited heater made from an iron-chromium alloy to provide yield strength and/or creep resistance. In certain embodiments, the support material and/or the ferromagnetic material is selected to provide a 100,000 hour creep-rupture strength of at least 20.7 MPa at 650° C. In some embodiments, the 100,000 hour creep-rupture strength is at least 13.8 MPa at 650° C. or at least 6.9 MPa at 650° C. For example, 347H steel has a favorable creep-rupture strength at or above 650° C. In some embodiments, the 100,000 hour creep-rupture strength ranges from 6.9 MPa to 41.3 MPa or more for longer heaters and/or higher earth or fluid stresses.

In temperature limited heater embodiments with both an inner ferromagnetic conductor and an outer ferromagnetic conductor, the skin effect current path occurs on the outside of the inner conductor and on the inside of the outer conductor. Thus, the outside of the outer conductor may be clad with the corrosion resistant alloy, such as stainless steel, without affecting the skin effect current path on the inside of the outer conductor.

A ferromagnetic conductor with a thickness of at least the skin depth at the Curie temperature allows a substantial decrease in resistance of the ferromagnetic material as the skin depth increases sharply near the Curie temperature. In certain embodiments when the ferromagnetic conductor is not clad with a highly conducting material such as copper, the thickness of the conductor may be 1.5 times the skin depth near the Curie temperature, 3 times the skin depth near the Curie temperature, or even 10 or more times the skin depth near the Curie temperature. If the ferromagnetic conductor is clad with copper, thickness of the ferromagnetic conductor may be substantially the same as the skin depth near the Curie temperature. In some embodiments, the ferromagnetic conductor clad with copper has a thickness of at least three-fourths of the skin depth near the Curie temperature.

In certain embodiments, the temperature limited heater includes a composite conductor with a ferromagnetic tubular and a non-ferromagnetic, high electrical conductivity core. The non-ferromagnetic, high electrical conductivity core reduces a required diameter of the conductor. For example, the conductor may be composite 1.19 cm diameter conductor with a core of 0.575 cm diameter copper clad with a 0.298 cm thickness of ferritic stainless steel or carbon steel surrounding the core. The core or non-ferromagnetic conductor may be copper or copper alloy. The core or non-ferromagnetic conductor may also be made of other metals that exhibit low electrical resistivity and relative magnetic permeabilities near 1 (for example, substantially non-ferromagnetic materials such as aluminum and aluminum alloys, phosphor bronze, beryllium copper, and/or brass). A composite conductor allows the electrical resistance of the temperature limited heater to decrease more steeply near the Curie temperature. As the skin depth increases near the Curie temperature to include the copper core, the electrical resistance decreases very sharply.

The composite conductor may increase the conductivity of the temperature limited heater and/or allow the heater to operate at lower voltages. In an embodiment, the composite conductor exhibits a relatively flat resistance versus temperature profile at temperatures below a region near the Curie temperature of the ferromagnetic conductor of the composite conductor. In some embodiments, the temperature limited heater exhibits a relatively flat resistance versus temperature profile between 100° C. and 750° C. or between 300° C. and 600° C. The relatively flat resistance versus temperature profile may also be exhibited in other temperature ranges by adjusting, for example, materials and/or the configuration of materials in the temperature limited heater. In certain embodiments, the relative thickness of each material in the composite conductor is selected to produce a desired resistivity versus temperature profile for the temperature limited heater.

In certain embodiments, the relative thickness of each material in a composite conductor is selected to produce a desired resistivity versus temperature profile for a temperature limited heater. In an embodiment, the composite conductor is an inner conductor surrounded by 0.127 cm thick magnesium oxide powder as an insulator. The outer conductor may be 304H stainless steel with a wall thickness of 0.127 cm. The outside diameter of the heater may be about 1.65 cm.

A composite conductor (for example, a composite inner conductor or a composite outer conductor) may be manufactured by methods including, but not limited to, coextrusion, roll forming, tight fit tubing (for example, cooling the inner member and heating the outer member, then inserting the inner member in the outer member, followed by a drawing operation and/or allowing the system to cool), explosive or electromagnetic cladding, arc overlay welding, longitudinal strip welding, plasma powder welding, billet coextrusion, electroplating, drawing, sputtering, plasma deposition, coextrusion casting, magnetic forming, molten cylinder casting (of inner core material inside the outer or vice versa), insertion followed by welding or high temperature braising, shielded active gas welding (SAG), and/or insertion of an inner pipe in an outer pipe followed by mechanical expansion of the inner pipe by hydroforming or use of a pig to expand and swage the inner pipe against the outer pipe. In some embodiments, a ferromagnetic conductor is braided over a non-ferromagnetic conductor. In certain embodiments, composite conductors are formed using methods similar to those used for cladding (for example, cladding copper to steel). A metallurgical bond between copper cladding and base ferromagnetic material may be advantageous. Composite conductors produced by a coextrusion process that forms a good metallurgical bond (for example, a good bond between copper and 446 stainless steel) may be provided by Anomet Products, Inc. (Shrewsbury, Mass.).

Several methods may also be used to form a composite conductor of more than two conductors (for example, a three part composite conductor or a four part composite conductor). One method is to form two parts of the composite conductor by coextrusion and then swaging down the third and/or fourth parts of the composite conductor onto the coextruded parts. A second method involves forming two or more parts of the composite conductor by coextrusion or another method, bending a strip of the outer conductor around the formed parts, and then welding the outer conductor together. The welding of the outer conductor may penetrate deep enough to create good electrical contact to the inner parts of the composite conductor. Another method is to swage all parts of the composite conductor onto one another either simultaneously or in two or more steps. In another method, all parts of the composite conductor are coextruded simultaneously. In another method, explosive cladding may be used to form a composite conductor. Explosive cladding may involve placing a first material in a second material and submerging the composite material in a substantially non-compressible fluid. An explosive charge may be set off in the fluid to bind the first material to the second material.

In an embodiment, two or more conductors are joined to form a composite conductor by various methods (for example, longitudinal strip welding) to provide tight contact between the conducting layers. In certain embodiments, two or more conducting layers and/or insulating layers are combined to form a composite heater with layers selected such that the coefficient of thermal expansion decreases with each successive layer from the inner layer toward the outer layer. As the temperature of the heater increases, the innermost layer expands to the greatest degree. Each successive outwardly lying layer expands to a slightly lesser degree, with the outermost layer expanding the least. This sequential expansion may provide relatively intimate contact between layers for good electrical contact between layers.

In an embodiment, two or more conductors are drawn together to form a composite conductor. In certain embodiments, a relatively malleable ferromagnetic conductor (for example, iron such as 1018 steel) may be used to form a composite conductor. A relatively soft ferromagnetic conductor typically has a low carbon content. A relatively malleable ferromagnetic conductor may be useful in drawing processes for forming composite conductors and/or other processes that require stretching or bending of the ferromagnetic conductor. In a drawing process, the ferromagnetic conductor may be annealed after one or more steps of the drawing process. The ferromagnetic conductor may be annealed in an inert gas atmosphere to inhibit oxidation of the conductor. In some embodiments, oil is placed on the ferromagnetic conductor to inhibit oxidation of the conductor during processing.

The diameter of a temperature limited heater may be small enough to inhibit deformation of the heater by a collapsing formation. In certain embodiments, the outside diameter of a temperature limited heater is less than about 5 cm. In some embodiments, the outside diameter of a temperature limited heater is less than about 4 cm, less than about 3 cm, or between about 2 cm and about 5 cm.

In heater embodiments described herein (including, but not limited to, temperature limited heaters, insulated conductor heaters, conductor-in-conduit heaters, and elongated member heaters), a largest transverse cross-sectional dimension of a heater may be selected to provide a desired ratio of the largest transverse cross-sectional dimension to wellbore diameter (for example, initial wellbore diameter). The largest transverse cross-sectional dimension is the largest dimension of the heater on the same axis as the wellbore diameter (for example, the diameter of a cylindrical heater or the width of a vertical heater). In certain embodiments, the ratio of the largest transverse cross-sectional dimension to wellbore diameter is selected to be less than about 1:2, less than about 1:3, or less than about 1:4. The ratio of heater diameter to wellbore diameter may be chosen to inhibit contact and/or deformation of the heater by the formation during heating. For example, the ratio of heater diameter to wellbore diameter may be chosen to inhibit closing in of the wellbore on the heater during heating. In certain embodiments, the wellbore diameter is determined by a diameter of a drill bit used to form the wellbore.

A wellbore diameter may shrink from an initial value of about 16.5 cm to about 6.4 cm during heating of a formation (for example, for a wellbore in oil shale with a richness greater than about 0.12 L/kg). At some point, expansion of formation material into the wellbore during heating results in a balancing between the hoop stress of the wellbore and the compressive strength due to thermal expansion of hydrocarbon, or kerogen, rich layers. The hoop stress of the wellbore itself may reduce the stress applied to a conduit (for example, a liner) located in the wellbore. At this point, the formation may no longer have the strength to deform or collapse a heater or a liner. For example, the radial stress provided by formation material may be about 12,000 psi (82.7 MPa) at a diameter of about 16.5 cm, while the stress at a diameter of about 6.4 cm after expansion may be about 3000 psi (20.7 MPa). A heater diameter may be selected to be less than about 3.8 cm to inhibit contact of the formation and the heater. A temperature limited heater may advantageously provide a higher heat output over a significant portion of the wellbore (for example, the heat output needed to provide sufficient heat to pyrolyze hydrocarbons in a hydrocarbon containing formation) than a constant wattage heater for smaller heater diameters (for example, less than about 5.1 cm).

Figure 24:
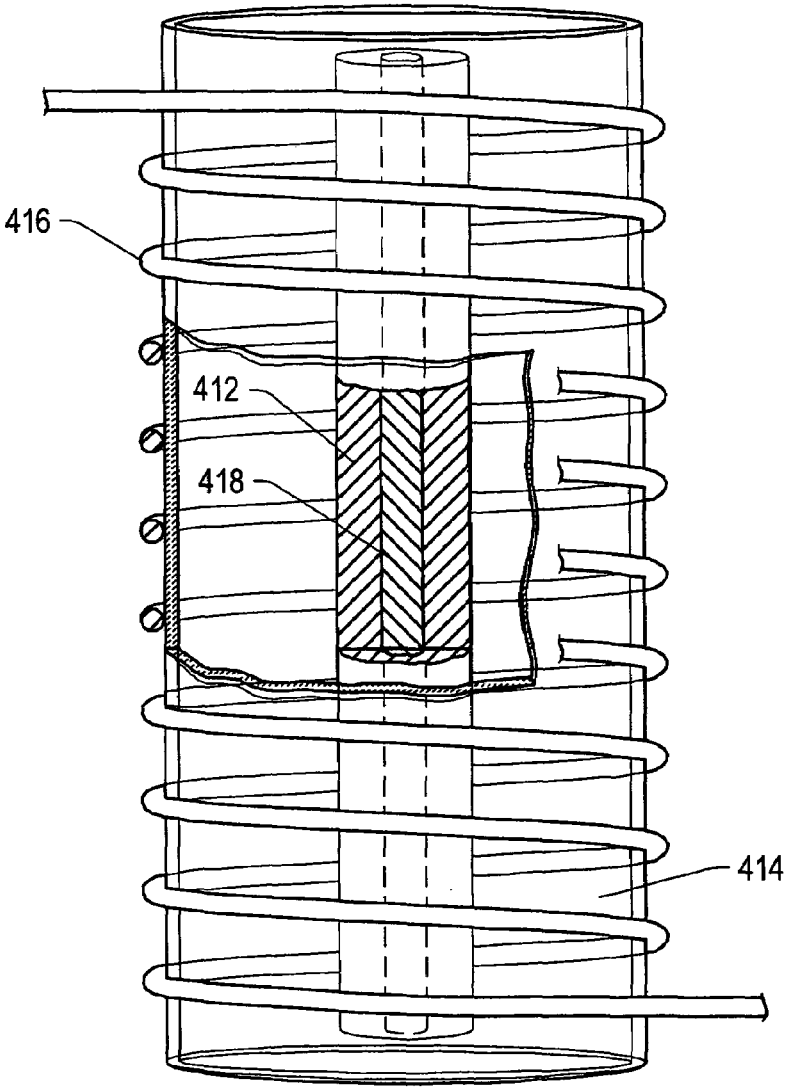
FIG. 24 depicts an embodiment of an apparatus for forming a composite conductor, with a portion of the apparatus shown in cross section.

FIG. 24 depicts an embodiment of an apparatus used to form a composite conductor. Ingot 412 may be a ferromagnetic conductor (for example, iron or carbon steel). Ingot 412 may be placed in chamber 414. Chamber 414 may be made of materials that are electrically insulating and able to withstand temperatures of about 800° C. or higher. In one embodiment, chamber 414 is a quartz chamber. In some embodiments, an inert, or non-reactive, gas (for example, argon or nitrogen with a small percentage of hydrogen) may be placed in chamber 414. In certain embodiments, a flow of inert gas is provided to chamber 414 to maintain a pressure in the chamber. Induction coil 416 may be placed around chamber 414. An alternating current may be supplied to induction coil 416 to inductively heat ingot 412. Inert gas inside chamber 414 may inhibit oxidation or corrosion of ingot 412.

Inner conductor 418 may be placed inside ingot 412. Inner conductor 418 may be a non-ferromagnetic conductor (for example, copper or aluminum) that melts at a lower temperature than ingot 412. In an embodiment, ingot 412 may be heated to a temperature above the melting point of inner conductor 418 and below the melting point of the ingot. Inner conductor 418 may melt and substantially fill the space inside ingot 412 (for example, the inner annulus of the ingot). A cap may be placed at the bottom of ingot 412 to inhibit inner conductor 418 from flowing and/or leaking out of the inner annulus of the ingot. After inner conductor 418 has sufficiently melted to substantially fill the inner annulus of ingot 412, the inner conductor and the ingot may be allowed to cool to room temperature. Ingot 412 and inner conductor 418 may be cooled at a relatively slow rate to allow inner conductor 418 to form a good soldering bond with ingot 412. The rate of cooling may depend on, for example, the types of materials used for the ingot and the inner conductor.

In some embodiments, a composite conductor may be formed by tube-in-tube milling of dual metal strips, such as the process performed by Precision Tube Technology (Houston, Tex.). A tube-in-tube milling process may also be used to form cladding on a conductor (for example, copper cladding inside carbon steel) or to form two materials into a tight fit tube-within-a-tube configuration.

Figure 25:
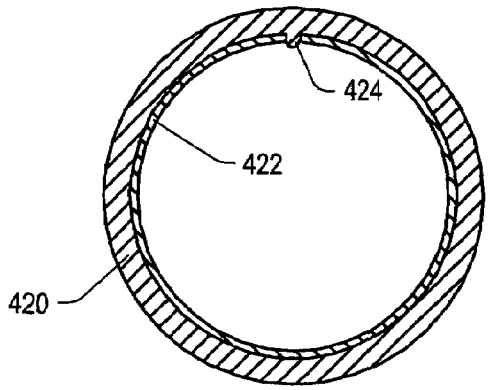
FIG. 25 depicts a cross-sectional representation of an embodiment of an inner conductor and an outer conductor formed by a tube-in-tube milling process.

FIG. 25 depicts a cross-section representation of an embodiment of an inner conductor and an outer conductor formed by a tube-in-tube milling process. Outer conductor 420 may be coupled to inner conductor 422. Outer conductor 420 may be weldable material such as steel. Inner conductor 422 may have a higher electrical conductivity than outer conductor 420. In an embodiment, inner conductor 422 is copper or aluminum. Weld bead 424 may be formed on outer conductor 420.

In a tube-in-tube milling process, flat strips of material for the outer conductor may have a thickness substantially equal to the desired wall thickness of the outer conductor. The width of the strips may allow formation of a tube of a desired inner diameter. The flat strips may be welded end-to-end to form an outer conductor of a desired length. Flat strips of material for the inner conductor may be cut such that the inner conductor formed from the strips fit inside the outer conductor. The flat strips of inner conductor material may be welded together end-to-end to achieve a length substantially the same as the desired length of the outer conductor. The flat strips for the outer conductor and the flat strips for the inner conductor may be fed into separate accumulators. Both accumulators may be coupled to a tube mill. The two flat strips may be sandwiched together at the beginning of the tube mill.

The tube mill may form the flat strips into a tube-in-tube shape. After the tube-in-tube shape has been formed, a non-contact high frequency induction welder may heat the ends of the strips of the outer conductor to a forging temperature of the outer conductor. The ends of the strips then may be brought together to forge weld the ends of the outer conductor into a weld bead. Excess weld bead material may be cut off. In some embodiments, the tube-in-tube produced by the tube mill is further processed (for example, annealed and/or pressed) to achieve a desired size and/or shape. The result of the tube-in-tube process may be an inner conductor in an outer conductor, as shown in FIG. 25.

FIGS. 26-71 depict various embodiments of temperature limited heaters. One or more features of an embodiment of the temperature limited heater depicted in any of these figures may be combined with one or more features of other embodiments of temperature limited heaters depicted in these figures. In certain embodiments described herein, temperature limited heaters are dimensioned to operate at a frequency of 60 Hz AC. It is to be understood that dimensions of the temperature limited heater may be adjusted from those described herein in order for the temperature limited heater to operate in a similar manner at other AC frequencies or with modulated DC.

Figure 28:
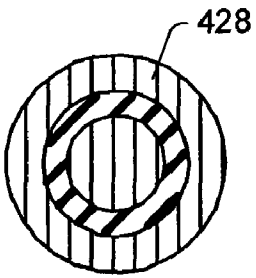
FIGS. 26, 27, and 28 depict cross-sectional representations of an embodiment of a temperature limited heater with an outer conductor having a ferromagnetic section and a non-ferromagnetic section.
Figure 26:
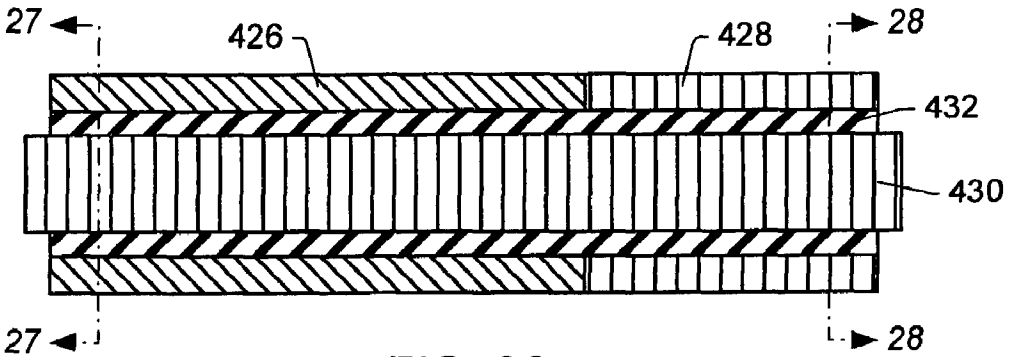
Figure 27:
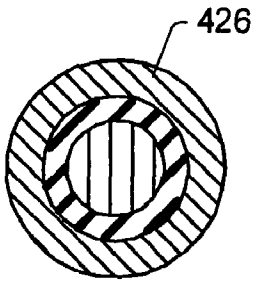

FIG. 26 depicts a cross-sectional representation of an embodiment of the temperature limited heater with an outer conductor having a ferromagnetic section and a non-ferromagnetic section. FIGS. 27 and 28 depict transverse cross-sectional views of the embodiment shown in FIG. 26. In one embodiment, ferromagnetic section 426 is used to provide heat to hydrocarbon layers in the formation. Non-ferromagnetic section 428 is used in the overburden of the formation. Non-ferromagnetic section 428 provides little or no heat to the overburden, thus inhibiting heat losses in the overburden and improving heater efficiency. Ferromagnetic section 426 includes a ferromagnetic material such as 409 stainless steel or 410 stainless steel. Ferromagnetic section 426 has a thickness of 0.3 cm. Non-ferromagnetic section 428 is copper with a thickness of 0.3 cm. Inner conductor 430 is copper. Inner conductor 430 has a diameter of 0.9 cm. Electrical insulator 432 is silicon nitride, boron nitride, magnesium oxide powder, or another suitable insulator material. Electrical insulator 432 has a thickness of 0.1 cm to 0.3 cm.

Figure 29:
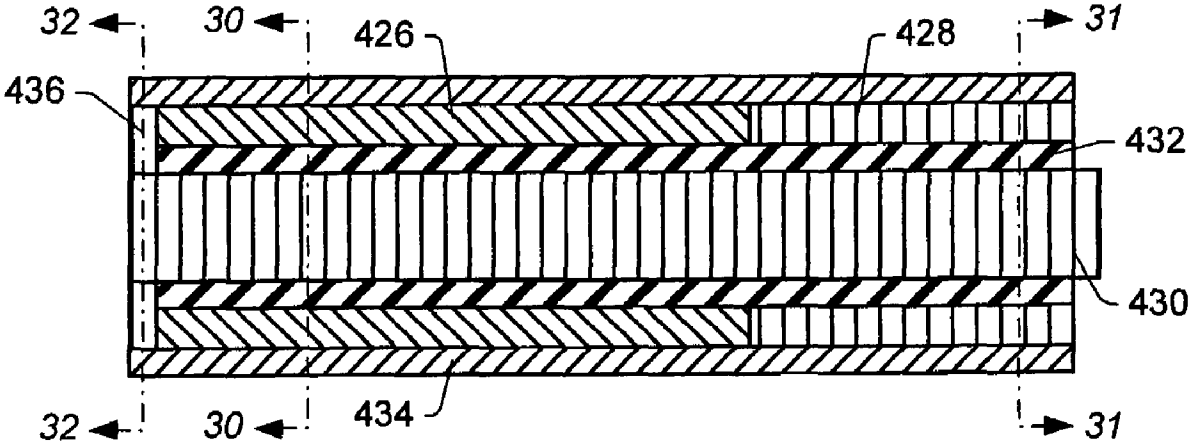
FIGS. 29, 30, 31, and 32 depict cross-sectional representations of an embodiment of a temperature limited heater with an outer conductor having a ferromagnetic section and a non-ferromagnetic section placed inside a sheath.
Figure 31:
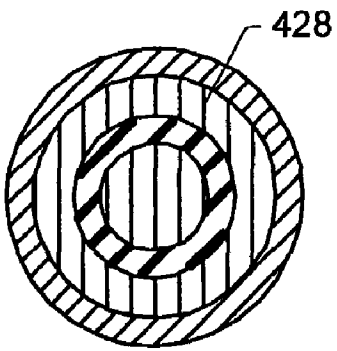
Figure 30:
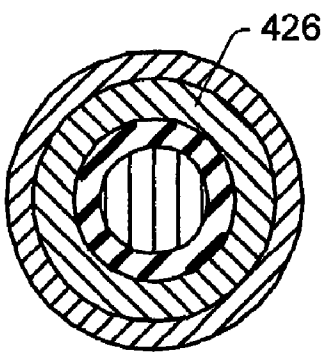
Figure 32:
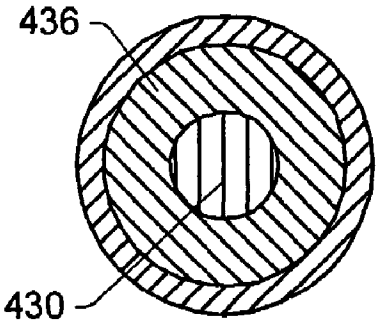

FIG. 29 depicts a cross-sectional representation of an embodiment of a temperature limited heater with an outer conductor having a ferromagnetic section and a non-ferromagnetic section placed inside a sheath. FIGS. 30, 31, and 32 depict transverse cross-sectional views of the embodiment shown in FIG. 29. Ferromagnetic section 426 is 410 stainless steel with a thickness of 0.6 cm. Non-ferromagnetic section 428 is copper with a thickness of 0.6 cm. Inner conductor 430 is copper with a diameter of 0.9 cm. Outer conductor 434 includes ferromagnetic material. Outer conductor 434 provides some heat in the overburden section of the heater. Providing some heat in the overburden inhibits condensation or refluxing of fluids in the overburden. Outer conductor 434 is 409, 410, or 446 stainless steel with an outer diameter of 3.0 cm and a thickness of 0.6 cm. Electrical insulator 432 includes compacted magnesium oxide powder with a thickness of 0.3 cm. In some embodiments, electrical insulator 432 includes silicon nitride, boron nitride, or hexagonal type boron nitride. Conductive section 436 may couple inner conductor 430 with ferromagnetic section 426 and/or outer conductor 434.

Figure 35:
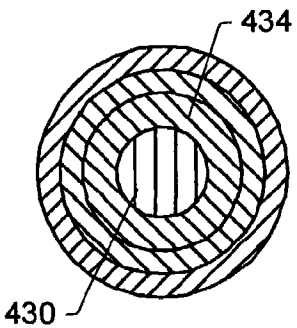
FIGS. 33, 34, and 35 depict cross-sectional representations of an embodiment of a temperature limited heater with a ferromagnetic outer conductor.
Figure 33:
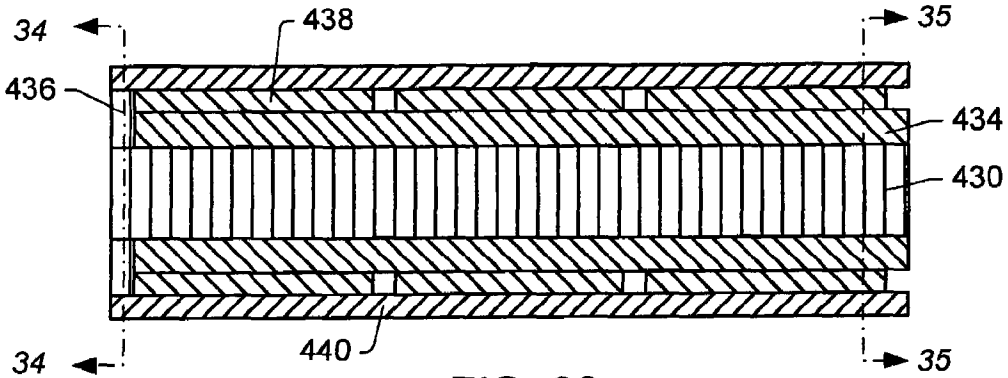
Figure 34:
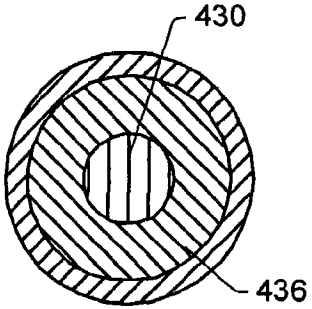

FIG. 33 depicts a cross-sectional representation of an embodiment of a temperature limited heater with a ferromagnetic outer conductor. The heater is placed in a corrosion resistant jacket. A conductive layer is placed between the outer conductor and the jacket. FIGS. 34 and 35 depict transverse cross-sectional views of the embodiment shown in FIG. 33. Outer conductor 434 is a ¾" Schedule 80 446 stainless steel pipe. In an embodiment, conductive layer 438 is placed between outer conductor 434 and jacket 440. Conductive layer 438 is a copper layer. Outer conductor 434 is clad with conductive layer 438. In certain embodiments, conductive layer 438 includes one or more segments (for example, conductive layer 438 includes one or more copper tube segments). Jacket 440 is a 1¼" Schedule 80 347H stainless steel pipe or a 1½" Schedule 160 347H stainless steel pipe. In an embodiment, inner conductor 430 is 4/0 MGT-1000 furnace cable with stranded nickel-coated copper wire with layers of mica tape and glass fiber insulation. 4/0 MGT-1000 furnace cable is UL type 5107 (available from Allied Wire and Cable (Phoenixville, Pa.). Conductive section 436 couples inner conductor 430 and jacket 440. In an embodiment, conductive section 436 is copper.

Figure 38:
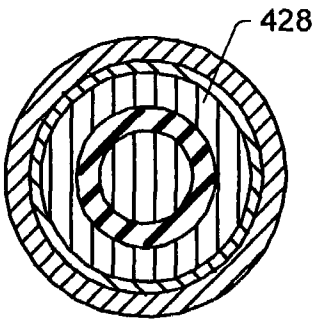
FIGS. 36, 37, and 38 depict cross-sectional representations of an embodiment of a temperature limited heater with an outer conductor.
Figure 36:
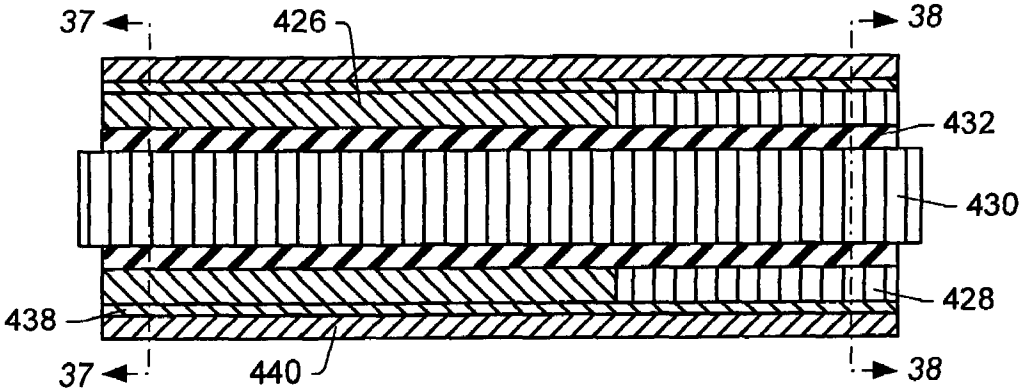
Figure 37:
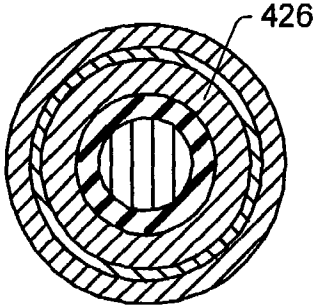

FIG. 36 depicts a cross-sectional representation of an embodiment of a temperature limited heater with an outer conductor. The outer conductor includes a ferromagnetic section and a non-ferromagnetic section. The heater is placed in a corrosion resistant jacket. A conductive layer is placed between the outer conductor and the jacket. FIGS. 37 and 38 depict transverse cross-sectional views of the embodiment shown in FIG. 36. Ferromagnetic section 426 is 409, 410, or 446 stainless steel with a thickness of 0.9 cm. Non-ferromagnetic section 428 is copper with a thickness of 0.9 cm. Ferromagnetic section 426 and non-ferromagnetic section 428 are placed in jacket 440. Jacket 440 is 304 or 347H stainless steel with a thickness of 0.1 cm. Conductive layer 438 is a copper layer. Electrical insulator 432 includes compacted silicon nitride, boron nitride, or magnesium oxide powder with a thickness of 0.1 to 0.3 cm. Inner conductor 430 is copper with a diameter of 1.0 cm.

In an embodiment, ferromagnetic section 426 is 446 stainless steel with a thickness of 0.9 cm. Jacket 440 is 410 stainless steel with a thickness of 0.6 cm. 410 stainless steel has a higher Curie temperature than 446 stainless steel. Such a temperature limited heater may "contain" current such that the current does not easily flow from the heater to the surrounding formation and/or to any surrounding water (for example, brine, groundwater, or formation water). In this embodiment, a majority of the current flows through ferromagnetic section 426 until the Curie temperature of the ferromagnetic section is reached. After the Curie temperature of ferromagnetic section 426 is reached, a majority of the current flows through conductive layer 438. The ferromagnetic properties of jacket 440 (410 stainless steel) inhibit the current from flowing outside the jacket and "contain" the current. Jacket 440 may also have a thickness that provides strength to the temperature limited heater.

Figure 39:
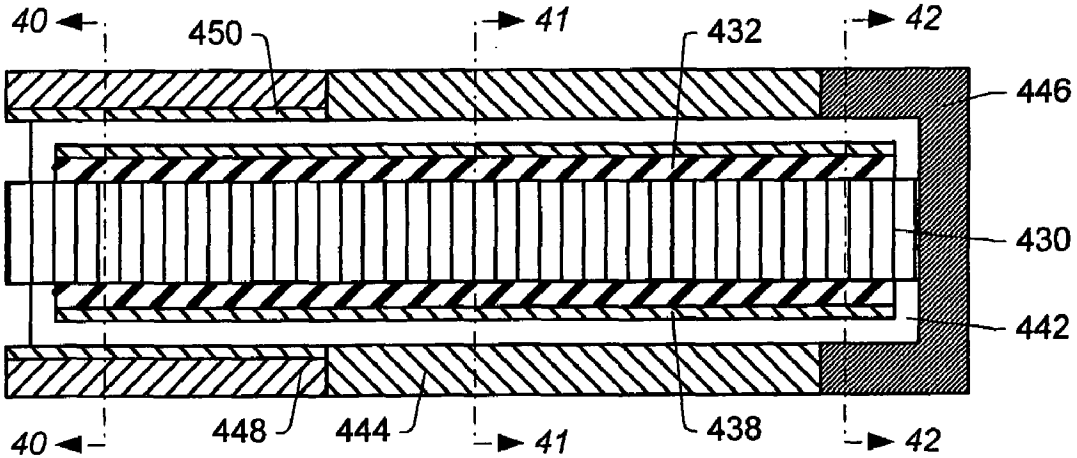
FIGS. 39, 40, 41, and 42 depict cross-sectional representations of an embodiment of a temperature limited heater.
Figure 42:
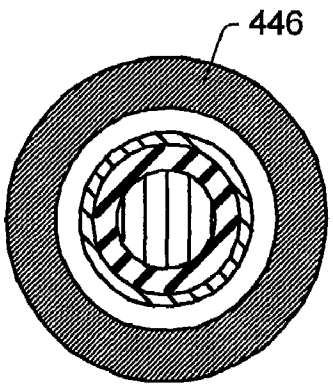
Figure 41:
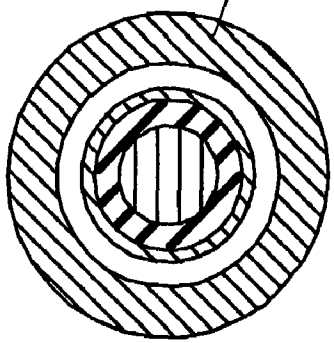
Figure 40:
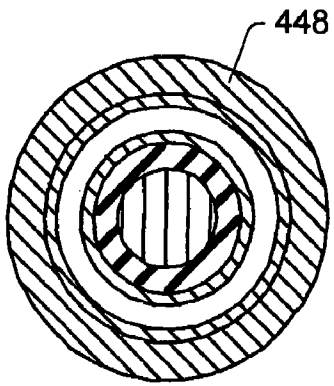

FIG. 39 depicts a cross-sectional representation of an embodiment of a temperature limited heater. The heating section of the temperature limited heater includes non-ferromagnetic inner conductors and a ferromagnetic outer conductor. The overburden section of the temperature limited heater includes a non-ferromagnetic outer conductor. FIGS. 40, 41, and 42 depict transverse cross-sectional views of the embodiment shown in FIG. 39. Inner conductor 430 is copper with a diameter of 1.0 cm. Electrical insulator 432 is placed between inner conductor 430 and conductive layer 438. Electrical insulator 432 includes compacted silicon nitride, boron nitride, or magnesium oxide powder with a thickness of 0.1 cm to 0.3 cm. Conductive layer 438 is copper with a thickness of 0.1 cm. Insulation layer 442 is annulus outside of conductive layer 438. The thickness of the annulus may be 0.3 cm. Insulation layer 442 is quartz sand.

Heating section 444 may provide heat to one or more hydrocarbon layers in the formation. Heating section 444 includes ferromagnetic material such as 409 stainless steel or 410 stainless steel. Heating section 444 has a thickness of 0.9 cm. Endcap 446 is coupled to an end of heating section 444. Endcap 446 electrically couples heating section 444 inner conductor 430 and/or conductive layer 438. Endcap 446 is 304 stainless steel. Heating section 444 is couple overburden section 448. Overburden section 448 includes carbon steel and/or other suitable support materials. Overburden section 448 has a thickness of 0.6 cm. Overburden section 448 is lined with conductive layer 450. Conductive layer 450 is copper with a thickness of 0.3 cm.

Figure 45:
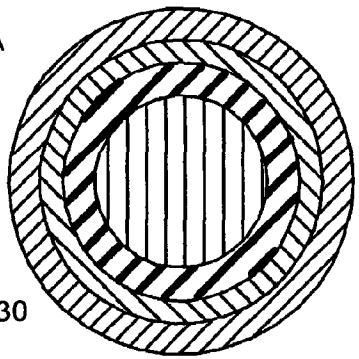
FIGS. 43, 44, and 45 depict cross-sectional representations of an embodiment of a temperature limited heater with an overburden section and a heating section.
Figure 43:
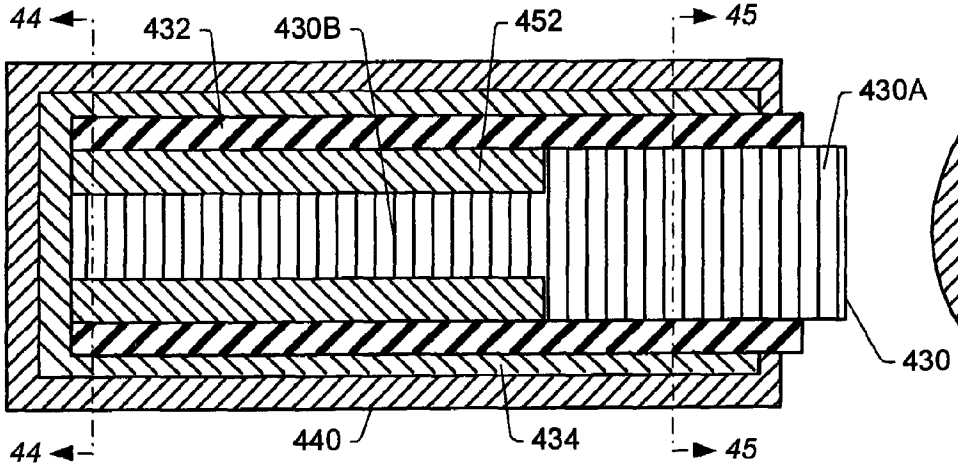
Figure 44:
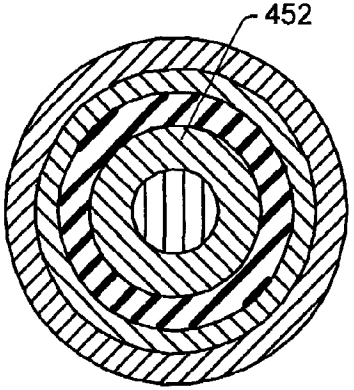

FIG. 43 depicts a cross-sectional representation of an embodiment of a temperature limited heater with an overburden section and a heating section. FIGS. 44 and 45 depict transverse cross-sectional views of the embodiment shown in FIG. 43. The overburden section includes portion 430A of inner conductor 430. Portion 430A is copper with a diameter of 1.3 cm. The heating section includes portion 430B of inner conductor 430. Portion 430B is copper with a diameter of 0.5 cm. Portion 430B is placed in ferromagnetic conductor 452. Ferromagnetic conductor 452 is 446 stainless steel with a thickness of 0.4 cm. Electrical insulator 432 includes compacted silicon nitride, boron nitride, or magnesium oxide powder with a thickness of 0.2 cm. Outer conductor 434 is copper with a thickness of 0.1 cm. Outer conductor 434 is placed in jacket 440. Jacket 440 is 316H or 347H stainless steel with a thickness of 0.2 cm.

Figure 46B:
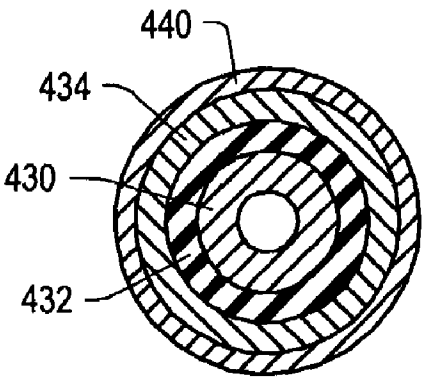
FIGS. 46A and 46B depict cross-sectional representations of an embodiment of a temperature limited heater.
Figure 46A:
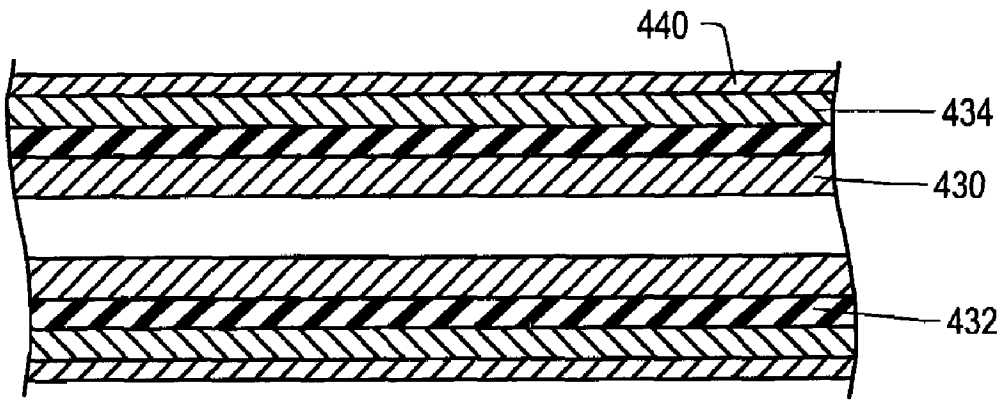

FIG. 46A and FIG. 46B depict cross-sectional representations of an embodiment of a temperature limited heater with a ferromagnetic inner conductor. Inner conductor 430 is a 1" Schedule XXS 446 stainless steel pipe. In some embodiments, inner conductor 430 includes 409 stainless steel, 410 stainless steel, Invar 36, alloy 42-6, alloy 52, or other ferromagnetic materials. Inner conductor 430 has a diameter of 2.5 cm. Electrical insulator 432 includes compacted silicon nitride, boron nitride, or magnesium oxide powders; or polymers, Nextel ceramic fiber, mica, or glass fibers. Outer conductor 434 is copper or any other non-ferromagnetic material such as aluminum. Outer conductor 434 is coupled to jacket 440. Jacket 440 is 304H, 316H, or 347H stainless steel. In this embodiment, a majority of the heat is produced in inner conductor 430.

Figure 47B:
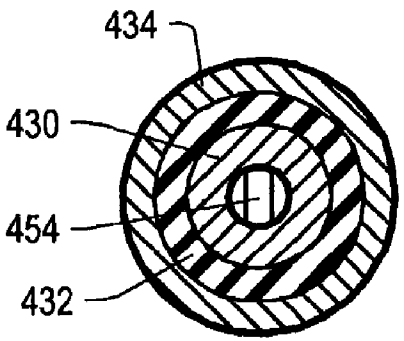
FIGS. 47A and 47B depict cross-sectional representations of an embodiment of a temperature limited heater.
Figure 47A:
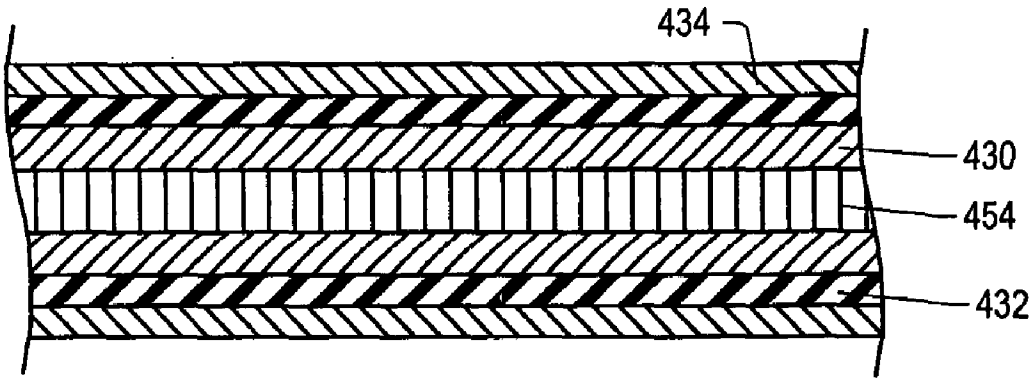

FIG. 47A and FIG. 47B depict cross-sectional representations of an embodiment of a temperature limited heater with a ferromagnetic inner conductor and a non-ferromagnetic core. Inner conductor 430 may be made of 446 stainless steel, 409 stainless steel, 410 stainless steel, carbon steel, Armco ingot iron, iron-cobalt alloys, or other ferromagnetic materials. Core 454 may be tightly bonded inside inner conductor 430. Core 454 is copper or other non-ferromagnetic material. In certain embodiments, core 454 is inserted as a tight fit inside inner conductor 430 before a drawing operation. In some embodiments, core 454 and inner conductor 430 are coextrusion bonded. Outer conductor 434 is 347H stainless steel. A drawing or rolling operation to compact electrical insulator 432 (for example, compacted silicon nitride, boron nitride, or magnesium oxide powder) may ensure good electrical contact between inner conductor 430 and core 454. In this embodiment, heat is produced primarily in inner conductor 430 until the Curie temperature is approached. Resistance then decreases sharply as current penetrates core 454.

Figure 48B:
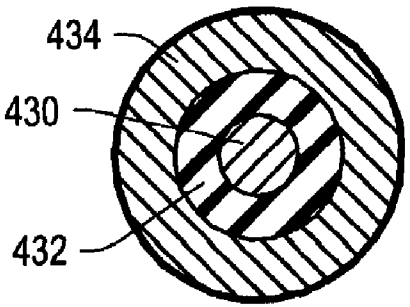
FIGS. 48A and 48B depict cross-sectional representations of an embodiment of a temperature limited heater.
Figure 48A:
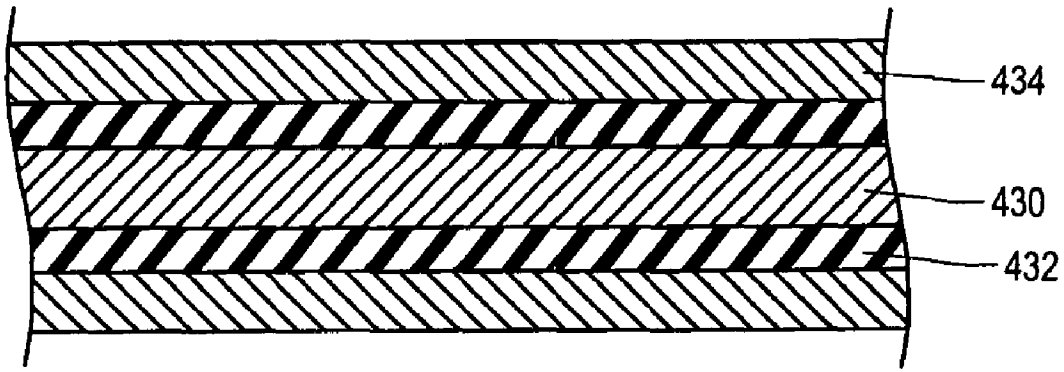

FIG. 48A and FIG. 48B depict cross-sectional representations of an embodiment of a temperature limited heater with a ferromagnetic outer conductor. Inner conductor 430 is nickel-clad copper. Electrical insulator 432 is silicon nitride, boron nitride, or magnesium oxide. Outer conductor 434 is a 1" Schedule XXS carbon steel pipe. In this embodiment, heat is produced primarily in outer conductor 434, resulting in a small temperature differential across electrical insulator 432.

Figure 49B:
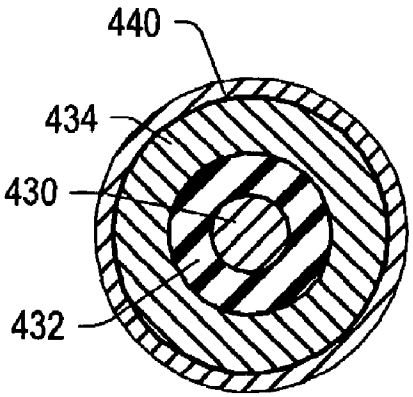
FIGS. 49A and 49B depict cross-sectional representations of an embodiment of a temperature limited heater.
Figure 49A:
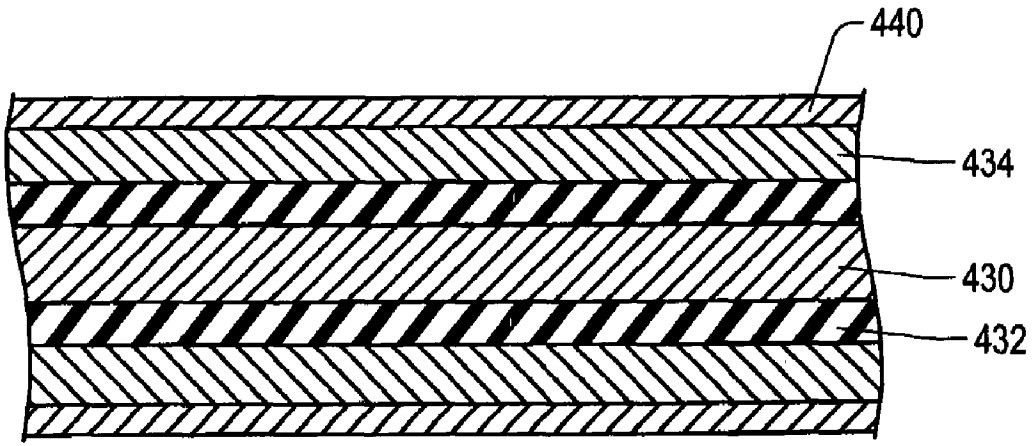

FIG. 49A and FIG. 49B depict cross-sectional representations of an embodiment of a temperature limited heater with a ferromagnetic outer conductor that is clad with a corrosion resistant alloy. Inner conductor 430 is copper. Outer conductor 434 is a 1" Schedule XXS carbon steel pipe. Outer conductor 434 is coupled to jacket 440. Jacket 440 is made of corrosion resistant material (for example, 347H stainless steel). Jacket 440 provides protection from corrosive fluids in the wellbore (for example, sulfidizing and carburizing gases). Heat is produced primarily in outer conductor 434, resulting in a small temperature differential across electrical insulator 432.

Figure 50B:
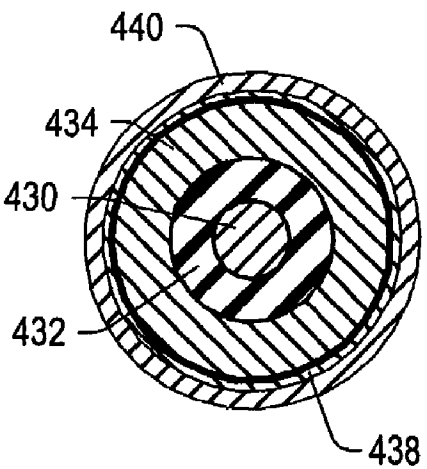
FIGS. 50A and 50B depict cross-sectional representations of an embodiment of a temperature limited heater.
Figure 50A:
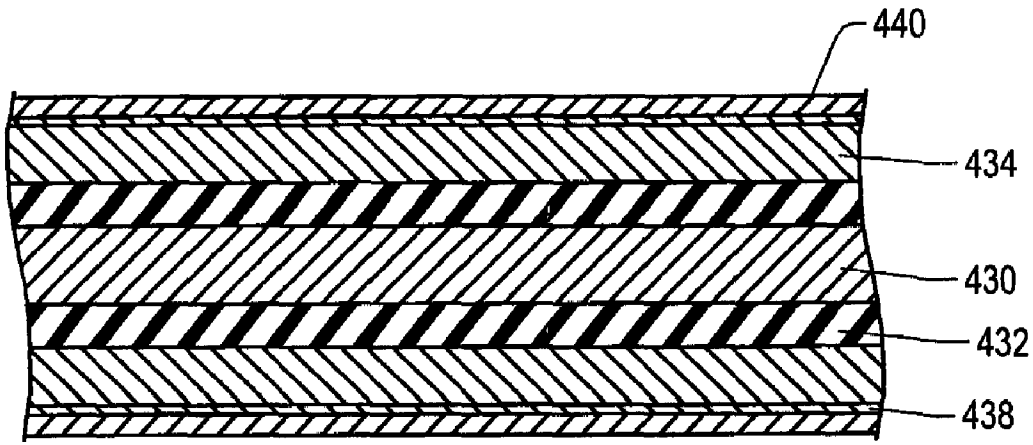

FIG. 50A and FIG. 50B depict cross-sectional representations of an embodiment of a temperature limited heater with a ferromagnetic outer conductor. The outer conductor is clad with a conductive layer and a corrosion resistant alloy. Inner conductor 430 is copper. Electrical insulator 432 is silicon nitride, boron nitride, or magnesium oxide. Outer conductor 434 is a 1" Schedule 80 446 stainless steel pipe. Outer conductor 434 is coupled to jacket 440. Jacket 440 is made from corrosion resistant material such as 347H stainless steel. In an embodiment, conductive layer 438 is placed between outer conductor 434 and jacket 440. Conductive layer 438 is a copper layer. Heat is produced primarily in outer conductor 434, resulting in a small temperature differential across electrical insulator 432. Conductive layer 438 allows a sharp decrease in the resistance of outer conductor 434 as the outer conductor approaches the Curie temperature. Jacket 440 provides protection from corrosive fluids in the wellbore.

Figure 51B:
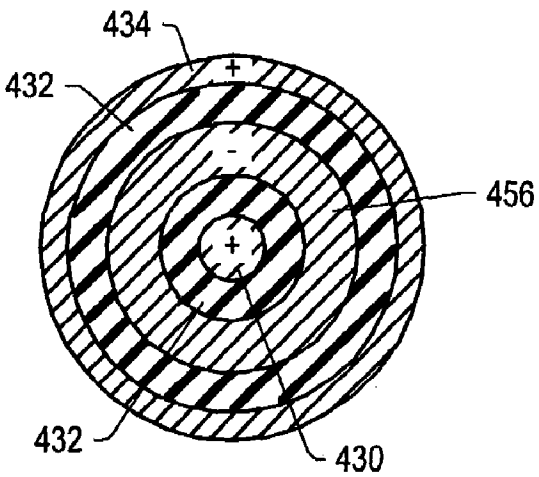
FIGS. 51A and 51B depict cross-sectional representations of an embodiment of a temperature limited heater.
Figure 51A:
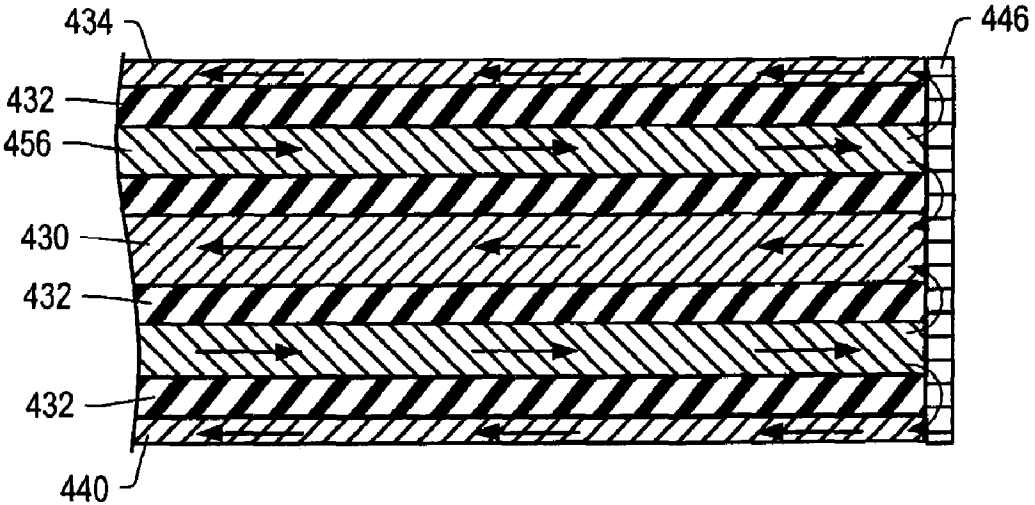

In an embodiment, a temperature limited heater includes triaxial conductors. FIG. 51A and FIG. 51B depict cross-sectional representations of an embodiment of a temperature limited heater with triaxial conductors. Inner conductor 430 may be copper or another highly conductive material. Electrical insulator 432 may be silicon nitride, boron nitride, or magnesium oxide (in certain embodiments, as compacted powders). Middle conductor 456 may include ferromagnetic material (for example, 446 stainless steel). In the embodiment of FIGS. 51A and 51B, outer conductor 434 is separated from middle conductor 456 by electrical insulator 432. Outer conductor 434 may include corrosion resistant, electrically conductive material (for example, stainless steel). In some embodiments, electrical insulator 432 is a space between conductors (for example, an air gap or other gas gap) that electrically insulates the conductors (for example, conductors 430, 434, and 456 may be in a conductor-in-conduit-in-conduit arrangement).

In a temperature limited heater with triaxial conductors, such as depicted in FIGS. 51A and 51B, electrical current may propagate through two conductors in one direction and through the third conductor in an opposite direction. In FIGS. 51A and 51B, electrical current may propagate in through middle conductor 456 in one direction and return through inner conductor 430 and outer conductor 434 in an opposite direction, as shown by the arrows in FIG. 51A and the +/− signs in FIG. 51B. In an embodiment, electrical current is split approximately in half between inner conductor 430 and outer conductor 434. Splitting the electrical current between inner conductor 430 and outer conductor 434 causes current propagating through middle conductor 456 to flow through both inside and outside skin depths of the middle conductor.

Current flows through both the inside and outside skin depths due to reduced magnetic field intensity from the current being split between the outer conductor and the inner conductor. Reducing the magnetic field intensity allows the skin depth of middle conductor 456 to remain relatively small with the same magnetic permeability. Thus, the thinner inside and outside skin depths may produce an increased Curie effect compared to the same thickness of ferromagnetic material with only one skin depth. The thinner inside and outside skin depths may produce a sharper turndown than one single skin depth in the same ferromagnetic material. Splitting the current between outer conductor 434 and inner conductor 430 may allow a thinner middle conductor 456 to produce the same Curie effect as a thicker middle conductor. In certain embodiments, the materials and thicknesses used for outer conductor 434, inner conductor 430 and middle conductor 456 have to be balanced to produce desired results in the Curie effect and turndown ratio of a triaxial temperature limited heater.

In some embodiments, the conductor (for example, an inner conductor, an outer conductor, or a ferromagnetic conductor) is the composite conductor that includes two or more different materials. In certain embodiments, the composite conductor includes two or more ferromagnetic materials. In some embodiments, the composite ferromagnetic conductor includes two or more radially disposed materials. In certain embodiments, the composite conductor includes a ferromagnetic conductor and a non-ferromagnetic conductor. In some embodiments, the composite conductor includes the ferromagnetic conductor placed over a non-ferromagnetic core. Two or more materials may be used to obtain a relatively flat electrical resistivity versus temperature profile in a temperature region below the Curie temperature and/or a sharp decrease (a high turndown ratio) in the electrical resistivity at or near the Curie temperature. In some cases, two or more materials are used to provide more than one Curie temperature for the temperature limited heater.

In certain embodiments, a composite electrical conductor is formed using a billet coextrusion process. A billet coextrusion process may include coupling together two or more electrical conductors at relatively high temperatures (for example, at temperatures that are near or above 75% of the melting temperature of a conductor). The electrical conductors may be drawn together at the relatively high temperatures (for example, under vacuum). Coextrusion at high temperatures under vacuum exposes fresh metal surfaces during drawing while inhibiting oxidation of the metal surfaces. This type of coextrusion improves the metallurgical bond between coextruded metals. The drawn together conductors may then be cooled to form a composite electrical conductor made from the two or more electrical conductors. In some embodiments, the composite electrical conductor is a solid composite electrical conductor. In certain embodiments, the composite electrical conductor may be a tubular composite electrical conductor.

In one embodiment, a copper core is billet coextruded with a stainless steel conductor (for example, 446 stainless steel). The copper core and the stainless steel conductor may be heated to a softening temperature in vacuum. At the softening temperature, the stainless steel conductor may be drawn over the copper core to form a tight fit. The stainless steel conductor and copper core may then be cooled to form a composite electrical conductor with the stainless steel surrounding the copper core.

Figure 53:
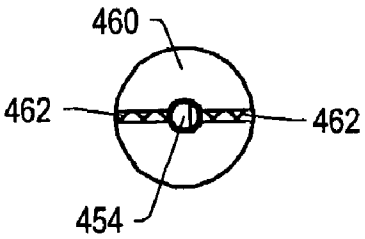
FIG. 53 depicts an end view of an embodiment of a coupled section of a composite electrical conductor.
Figure 52:
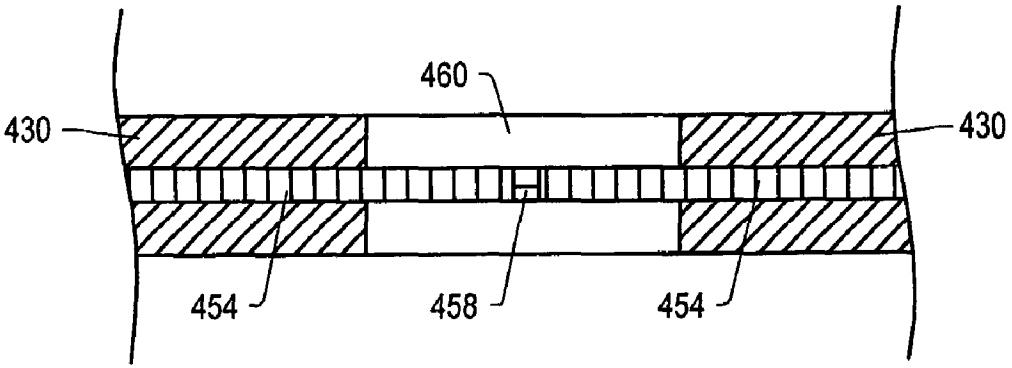
FIG. 52 depicts an embodiment of a coupled section of a composite electrical conductor.
Figure 54:
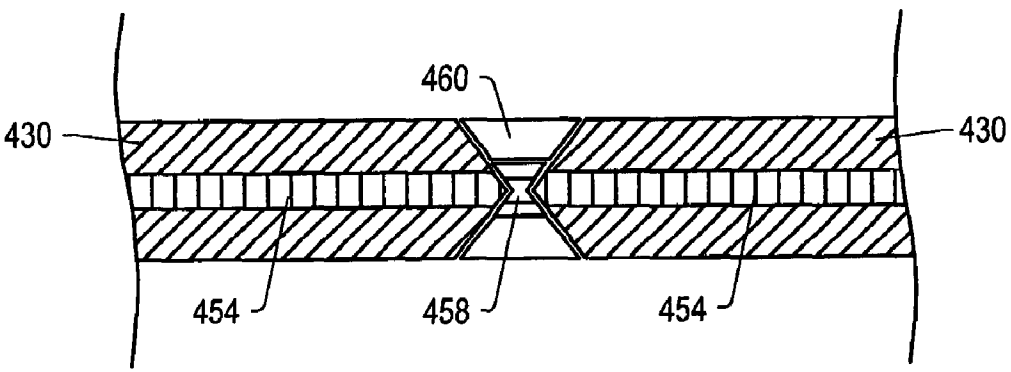
FIG. 54 depicts an embodiment for coupling together sections of a composite electrical conductor.

In some embodiments, a long, composite electrical conductor is formed from several sections of composite electrical conductor. The sections of composite electrical conductor may be formed by a billet coextrusion process. The sections of composite electrical conductor may be coupled together using a welding process. FIGS. 52, 53, and 54 depict embodiments of coupled sections of composite electrical conductors. In FIG. 52, core 454 extends beyond the ends of inner conductor 430 in each section of a composite electrical conductor. In an embodiment, core 454 is copper and inner conductor 430 is 446 stainless steel. Cores 454 from each section of the composite electrical conductor may be coupled together by, for example, brazing the core ends together. Core coupling material 458 may couple the core ends together, as shown in FIG. 52. Core coupling material 458 may be, for example Everdur, a copper-silicon alloy material (for example, an alloy with about 3% by weight silicon in copper). Alternatively, the copper core may be autogenously welded or filled with copper.

Inner conductor coupling material 460 may couple inner conductors 430 from each section of the composite electrical conductor. Inner conductor coupling material 460 may be material used for welding sections of inner conductor 430 together. In certain embodiments, inner conductor coupling material 460 may be used for welding stainless steel inner conductor sections together. In some embodiments, inner conductor coupling material 460 is 304 stainless steel or 310 stainless steel. A third material (for example, 309 stainless steel) may be used to couple inner conductor coupling material 460 to ends of inner conductor 430. The third material may be needed or desired to produce a better bond (for example, a better weld) between inner conductor 430 and inner conductor coupling material 460. The third material may be non-magnetic to reduce the potential for a hot spot to occur at the coupling.

In certain embodiments, inner conductor coupling material 460 surrounds the ends of cores 454 that protrude beyond the ends of inner conductors 430, as shown in FIG. 52. Inner conductor coupling material 460 may include one or more portions coupled together. Inner conductor coupling material 460 may be placed in a clam shell configuration around the ends of cores 454 that protrude beyond the ends of inner conductors 430, as shown in the end view depicted in FIG. 53. Coupling material 462 may be used to couple together portions (for example, halves) of inner conductor coupling material 460. Coupling material 462 may be the same material as inner conductor coupling material 460 or another material suitable for coupling together portions of the inner conductor coupling material.

In some embodiments, a composite electrical conductor includes inner conductor coupling material 460 with 304 stainless steel or 310 stainless steel and inner conductor 430 with 446 stainless steel or another ferromagnetic material. In such an embodiment, inner conductor coupling material 460 produces significantly less heat than inner conductor 430. The portions of the composite electrical conductor that include the inner conductor coupling material (for example, the welded portions or "joints" of the composite electrical conductor) may remain at lower temperatures than adjacent material during application of applied electrical current to the composite electrical conductor. The reliability and durability of the composite electrical conductor may be increased by keeping the joints of the composite electrical conductor at lower temperatures.

FIG. 54 depicts an embodiment for coupling together sections of a composite electrical conductor. Ends of cores 454 and ends of inner conductors 430 are beveled to facilitate coupling together the sections of the composite electrical conductor. Core coupling material 458 may couple (for example, braze) together the ends of each core 454. The ends of each inner conductor 430 may be coupled (for example, welded) together with inner conductor coupling material 460. Inner conductor coupling material 460 may be 309 stainless steel or another suitable welding material. In some embodiments, inner conductor coupling material 460 is 309 stainless steel. 309 stainless steel may reliably weld to both an inner conductor having 446 stainless steel and a core having copper. Using beveled ends when coupling together sections of a composite electrical conductor may produce a reliable and durable coupling between the sections of composite electrical conductor. FIG. 54 depicts a weld formed between ends of sections that have beveled surfaces.

The composite electrical conductor may be used as the conductor in any electrical heater embodiment described herein. For example, the composite conductor may be used as the conductor in a conductor-in-conduit heater or an insulated conductor heater. In certain embodiments, the composite conductor may be coupled to a support member such as a support conductor. The support member may be used to provide support to the composite conductor so that the composite conductor is not relied upon for strength at or near the Curie temperature. The support member may be useful for heaters of lengths of at least 100 m. The support member may be a non-ferromagnetic member that has good high temperature creep strength. Examples of materials that are used for a support member include, but are not limited to, Haynes® 625 alloy and Haynes® HR120® alloy (Haynes International, Kokomo, Ind.), NF709, Incoloy® 800H alloy and 347HP alloy (Allegheny Ludlum Corp., Pittsburgh, Pa.). In some embodiments, materials in a composite conductor are directly coupled (for example, brazed, metallurgically bonded, or swaged) to each other and/or the support member. Using a support member may reduce the need for the ferromagnetic member to provide support for the temperature limited heater, especially at or near the Curie temperature. Thus, the temperature limited heater may be designed with more flexibility in the selection of ferromagnetic materials.

Figure 55:
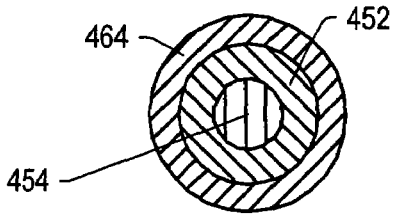
FIG. 55 depicts a cross-sectional representation of an embodiment of a composite conductor with a support member.

FIG. 55 depicts a cross-sectional representation of an embodiment of the composite conductor with the support member. Core 454 is surrounded by ferromagnetic conductor 452 and support member 464. In some embodiments, core 454, ferromagnetic conductor 452, and support member 464 are directly coupled (for example, brazed together or metallurgically bonded together). In one embodiment, core 454 is copper, ferromagnetic conductor 452 is 446 stainless steel, and support member 464 is 347H alloy. In certain embodiments, support member 464 is a Schedule 80 pipe. Support member 464 surrounds the composite conductor having ferromagnetic conductor 452 and core 454. Ferromagnetic conductor 452 and core 454 may be joined to form the composite conductor by, for example, a coextrusion process. For example, the composite conductor is a 1.9 cm outside diameter 446 stainless steel ferromagnetic conductor surrounding a 0.95 cm diameter copper core.

In certain embodiments, the diameter of core 454 is adjusted relative to a constant outside diameter of ferromagnetic conductor 452 to adjust the turndown ratio of the temperature limited heater. For example, the diameter of core 454 may be increased to 1.14 cm while maintaining the outside diameter of ferromagnetic conductor 452 at 1.9 cm to increase the turndown ratio of the heater.

Figure 56:
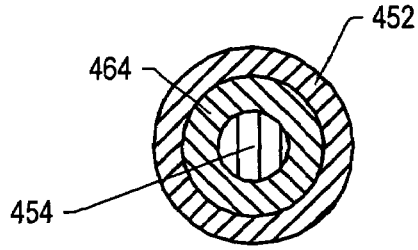
FIG. 56 depicts a cross-sectional representation of an embodiment of a composite conductor with a support member separating the conductors.

In some embodiments, conductors (for example, core 454 and ferromagnetic conductor 452) in the composite conductor are separated by support member 464. FIG. 56 depicts a cross-sectional representation of an embodiment of the composite conductor with support member 464 separating the conductors. In one embodiment, core 454 is copper with a diameter of 0.95 cm, support member 464 is 347H alloy with an outside diameter of 1.9 cm, and ferromagnetic conductor 452 is 446 stainless steel with an outside diameter of 2.7 cm. The support member depicted in FIG. 56 has a lower creep strength relative to the support members depicted in FIG. 55.

Figure 57:
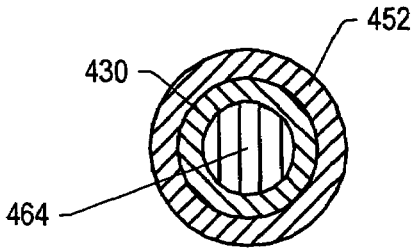
FIG. 57 depicts a cross-sectional representation of an embodiment of a composite conductor surrounding a support member.

In certain embodiments, support member 464 is located inside the composite conductor. FIG. 57 depicts a cross-sectional representation of an embodiment of the composite conductor surrounding support member 464. Support member 464 is made of 347H alloy. Inner conductor 430 is copper. Ferromagnetic conductor 452 is 446 stainless steel In one embodiment, support member 464 is 1.25 cm diameter 347H alloy, inner conductor 430 is 1.9 cm outside diameter copper, and ferromagnetic conductor 452 is 2.7 cm outside diameter 446 stainless steel. The turndown ratio is higher than the turndown ratio for the embodiments depicted in FIGS. 55, 56, and 58 for the same outside diameter, but it has a lower creep strength.

In some embodiments, the thickness of inner conductor 430, which is copper, is reduced and the thickness of support member 464 is increased to increase the creep strength at the expense of reduced turndown ratio. For example, the diameter of support member 464 is increased to 1.6 cm while maintaining the outside diameter of inner conductor 430 at 1.9 cm to reduce the thickness of the conduit. This reduction in thickness of inner conductor 430 results in a decreased turndown ratio relative to the thicker inner conductor embodiment but an increased creep strength.

Figure 58:
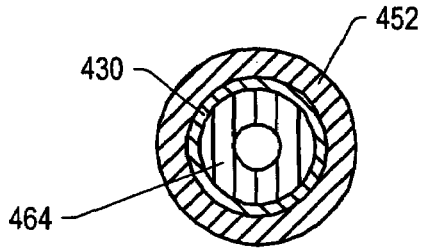
FIG. 58 depicts a cross-sectional representation of an embodiment of a composite conductor surrounding a conduit support member.

In one embodiment, support member 464 is a conduit (or pipe) inside inner conductor 430 and ferromagnetic conductor 452. FIG. 58 depicts a cross-sectional representation of an embodiment of the composite conductor surrounding support member 464. In one embodiment, support member 464 is 347H alloy with a 0.63 cm diameter center hole. In some embodiments, support member 464 is a preformed conduit. In certain embodiments, support member 464 is formed by having a dissolvable material (for example, copper dissolvable by nitric acid) located inside the support member during formation of the composite conductor. The dissolvable material is dissolved to form the hole after the conductor is assembled. In an embodiment, support member 464 is 347H alloy with an inside diameter of 0.63 cm and an outside diameter of 1.6 cm, inner conductor 430 is copper with an outside diameter of 1.8 cm, and ferromagnetic conductor 452 is 446 stainless steel with an outside diameter of 2.7 cm.

In certain embodiments, the composite electrical conductor is used as the conductor in the conductor-in-conduit heater. For example, the composite electrical conductor may be used as conductor 466 in FIG. 59.

Figure 59:
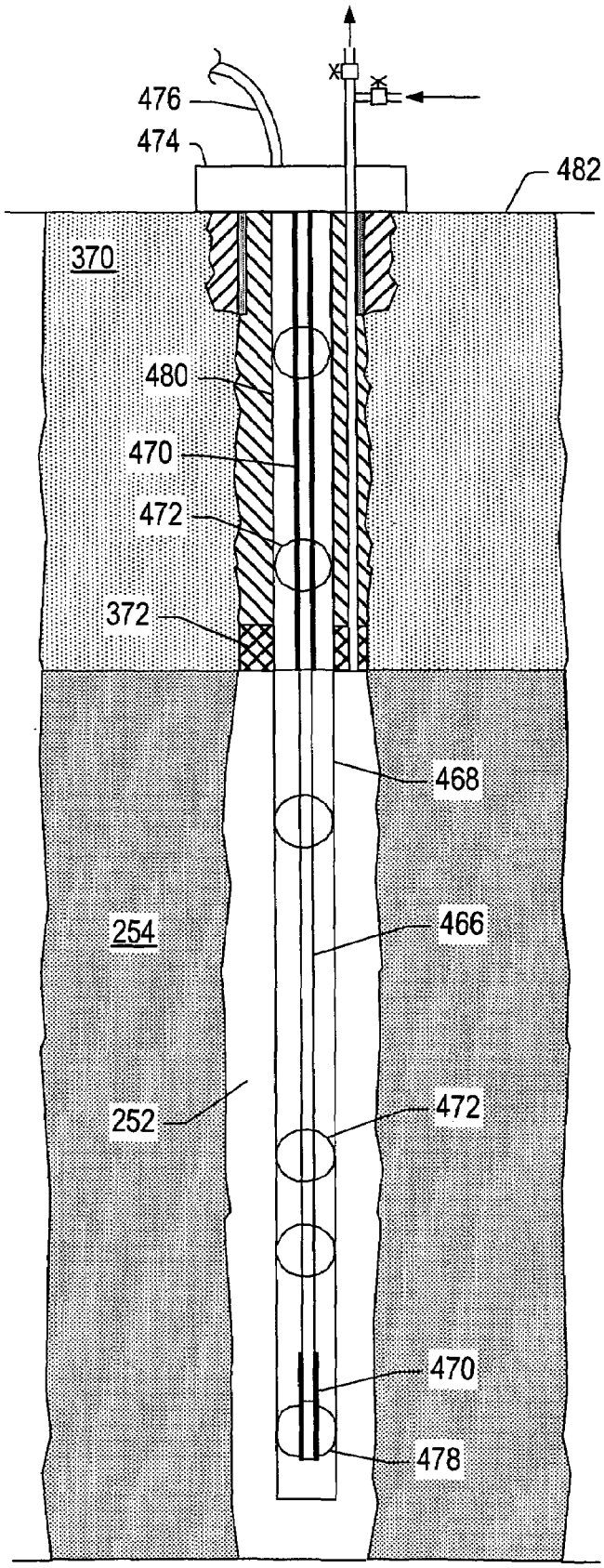
FIG. 59 depicts a cross-sectional representation of an embodiment of a conductor-in-conduit heat source.

FIG. 59 depicts a cross-sectional representation of an embodiment of the conductor-in-conduit heater. Conductor 466 is disposed in conduit 468. Conductor 466 is a rod or conduit of electrically conductive material. Low resistance sections 470 is present at both ends of conductor 466 to generate less heating in these sections. Low resistance section 470 is formed by having a greater cross-sectional area of conductor 466 in that section, or the sections are made of material having less resistance. In certain embodiments, low resistance section 470 includes a low resistance conductor coupled to conductor 466.

Conduit 468 is made of an electrically conductive material. Conduit 468 is disposed in opening 252 in hydrocarbon layer 254. Opening 252 has a diameter that accommodates conduit 468.

Conductor 466 may be centered in conduit 468 by centralizers 472. Centralizers 472 electrically isolate conductor 466 from conduit 468. Centralizers 472 inhibit movement and properly locate conductor 466 in conduit 468. Centralizers 472 are made of ceramic material or a combination of ceramic and metallic materials. Centralizers 472 inhibit deformation of conductor 466 in conduit 468. Centralizers 472 are touching or spaced at intervals between approximately 0.1 m (meters) and approximately 3 m or more along conductor 466.

A second low resistance section 470 of conductor 466 may couple conductor 466 to wellhead 474, as depicted in FIG. 59. Electrical current may be applied to conductor 466 from power cable 476 through low resistance section 470 of conductor 466. Electrical current passes from conductor 466 through sliding connector 478 to conduit 468. Conduit 468 may be electrically insulated from overburden casing 480 and from wellhead 474 to return electrical current to power cable 476. Heat may be generated in conductor 466 and conduit 468. The generated heat may radiate in conduit 468 and opening 252 to heat at least a portion of hydrocarbon layer 254.

Overburden casing 480 may be disposed in overburden 370. Overburden casing 480 is, in some embodiments, surrounded by materials (for example, reinforcing material and/or cement) that inhibit heating of overburden 370. Low resistance section 470 of conductor 466 may be placed in overburden casing 480. Low resistance section 470 of conductor 466 is made of, for example, carbon steel. Low resistance section 470 of conductor 466 may be centralized in overburden casing 480 using centralizers 472. Centralizers 472 are spaced at intervals of approximately 6 m to approximately 12 m or, for example, approximately 9 m along low resistance section 470 of conductor 466. In a heater embodiment, low resistance section 470 of conductor 466 is coupled to conductor 466 by one or more welds. In other heater embodiments, low resistance sections are threaded, threaded and welded, or otherwise coupled to the conductor. Low resistance section 470 generates little or no heat in overburden casing 480. Packing 372 may be placed between overburden casing 480 and opening 252. Packing 372 may be used as a cap at the junction of overburden 370 and hydrocarbon layer 254 to allow filling of materials in the annulus between overburden casing 480 and opening 252. In some embodiments, packing 372 inhibits fluid from flowing from opening 252 to surface 482.

Figure 60:
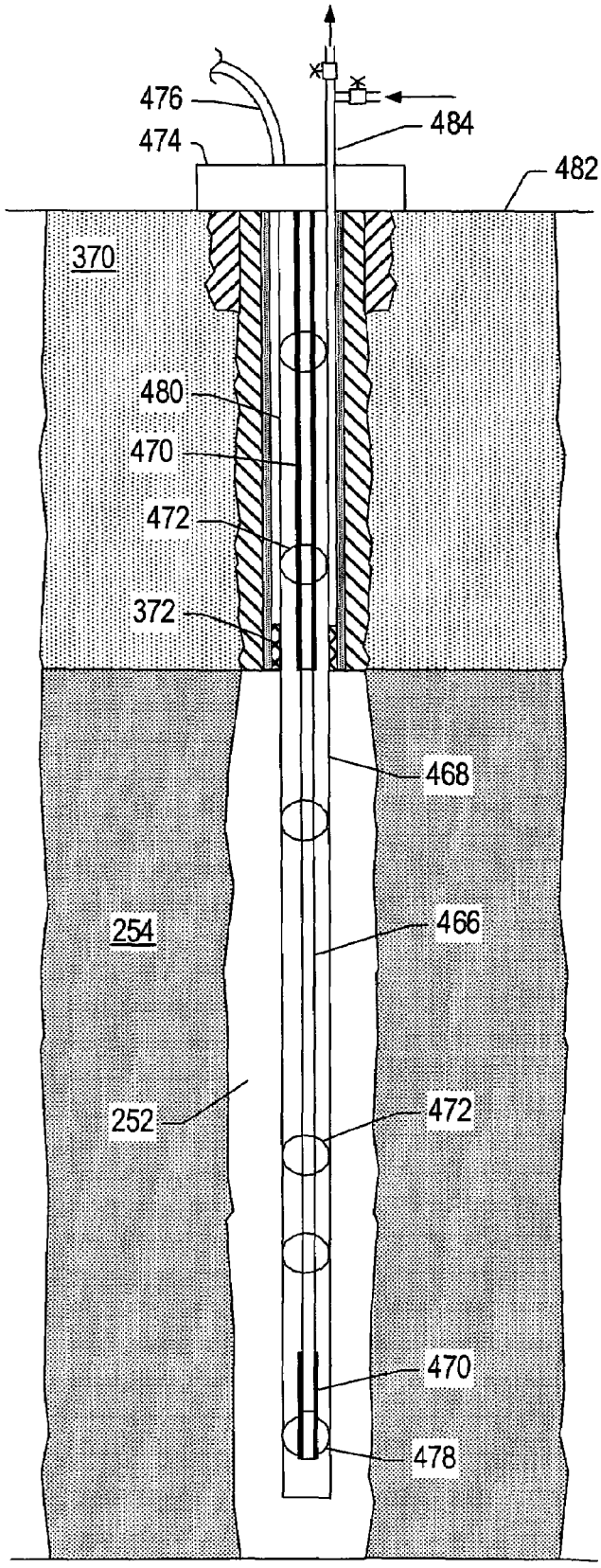
FIG. 60 depicts a cross-sectional representation of an embodiment of a removable conductor-in-conduit heat source.

FIG. 60 depicts a cross-sectional representation of an embodiment of a removable conductor-in-conduit heat source. Conduit 468 may be placed in opening 252 through overburden 370 such that a gap remains between the conduit and overburden casing 480. Fluids may be removed from opening 252 through the gap between conduit 468 and overburden casing 480. Fluids may be removed from the gap through conduit 484. Conduit 468 and components of the heat source included in the conduit that are coupled to wellhead 474 may be removed from opening 252 as a single unit. The heat source may be removed as a single unit to be repaired, replaced, and/or used in another portion of the formation.

Water or other fluids inside conduit 468 can adversely affect heating using the conductor-in-conduit heater. In certain embodiments, fluid inside conduit 468 is removed to reduce the pressure inside the conduit. The fluid may be removed by vacuum pumping or other means for reducing the pressure inside conduit 468. In some embodiments, the pressure is reduced outside conduit 468 and inside opening 252. In certain embodiments, the space inside conduit 468 or the space outside the conduit is vacuum pumped to a pressure below the vapor pressure of water at the downhole temperature of the conduit. For example, at a downhole temperature of 25° C., the space inside or outside conduit 468 would be vacuum pumped to a pressure below about 101 kPa.

In certain embodiments, the space inside or outside conduit 468 is vacuum pumped to a pressure below the vapor pressure of water at ice temperatures. The vapor pressure of ice at 0° C. is 610 Pa. As conduit 468 is vacuum pumped, water in the conduit gets colder until the water freezes. Thus, vacuum pumping to a pressure below the vapor pressure of water at ice temperatures indicates that most or all of the water has been removed from the space inside or outside conduit 468. In certain embodiments, high pumping capacity vacuum pumps (for example, a Kinney® CB245 vacuum pump available from Tuthill Co. (Burr Ridge, Ill.)) are used to vacuum pump below pressures of about 1 Pa. In some embodiments, a vacuum gauge is coupled between the vacuum pump and the wellhead for the heater. In some embodiments, a cold trap (for example, a dry ice trap or liquid nitrogen trap) is placed between conduit 468 and the vacuum pump to condense water from the conduit and inhibit water from contaminating pump oil.

As pressure in conduit 468 is decreased, ice in the conduit gets colder and the vapor pressure of the ice further decreases. For example, the vapor pressure of ice at (−10)° C. is 260 Pa. Thus, in certain embodiments, the space inside or outside conduit 468 is vacuum pumped to a pressure below 1 kPa, below 750 Pa, below 600 Pa, below 500 Pa, below 100 Pa, 15 Pa, below 10 Pa, below 5 Pa, or less. Vacuum pumping to such pressures improves the removal of water from conduit 468.

In some embodiments, conduit 468 is vacuum pumped to a selected pressure and then the conduit is closed off (pressure sealed), for example, by closing a valve on the wellhead. The pressure in conduit 468 is monitored for any pressure rise. If the pressure rises to a value near the vapor pressure of water or ice and at least temporarily stabilizes, there is most likely more water in the conduit and the conduit is then vacuum pumped again. If the pressure does not rise up to the vapor pressure of ice or water, then conduit 468 is considered dry. If the pressure continuously rises to pressures above the vapor pressure of ice or water, then there may be a leak in conduit 468 causing the pressure rise.

In certain embodiments, heat is provided by conductor 466 and/or conduit 468 during vacuum pumping of the conduit. The provided heat may increase the vapor pressure of water or ice in conduit 468. The provided heat may inhibit ice from forming in conduit 468. Providing heat in conduit 468 may decrease the time needed to remove (vacuum pump) water from the conduit. Providing heat in conduit 468 may increase the likelihood of removing substantially all the water from the conduit.

In some embodiments, a non-condensable gas (for example, dry nitrogen, argon, or helium) is backfilled inside or outside conduit 468 after vacuum pumping. In some embodiments, the space inside or outside conduit 468 is backfilled with the non-condensable gas to a pressure between 101 kPa and 10 MPa, between 202 kPa and 5 MPa, or between 500 kPa and 1 MPa. In some embodiments, the inside or outside of conduit 468 is vacuum pumped for a time, then backfilled with non-condensable gas, and then vacuum pumped again. This process may be repeated for several cycles to more completely remove water and other fluids from inside or outside conduit 468. In some embodiments, conduit 468 is operated with the backfilled non-condensable gas remaining inside or outside the conduit.

In some embodiments, a small amount of an oxidizing fluid, such as oxygen, is added to the non-condensable gas backfilled in conduit 468. The oxidizing fluid may oxidize metals of conduit 468 and/or conductor 466. The oxidation may increase the emissivity of the conduit and/or conductor metals. The small amount of oxidizing fluid may be between about 100 ppm and 25 ppm, between about 75 ppm and 40 ppm, or between about 60 ppm and 50 ppm in non-condensable gas. In one embodiment, at most 50 ppm of oxidizing fluid is in the non-condensable gas in conduit 468.

Figure 61:
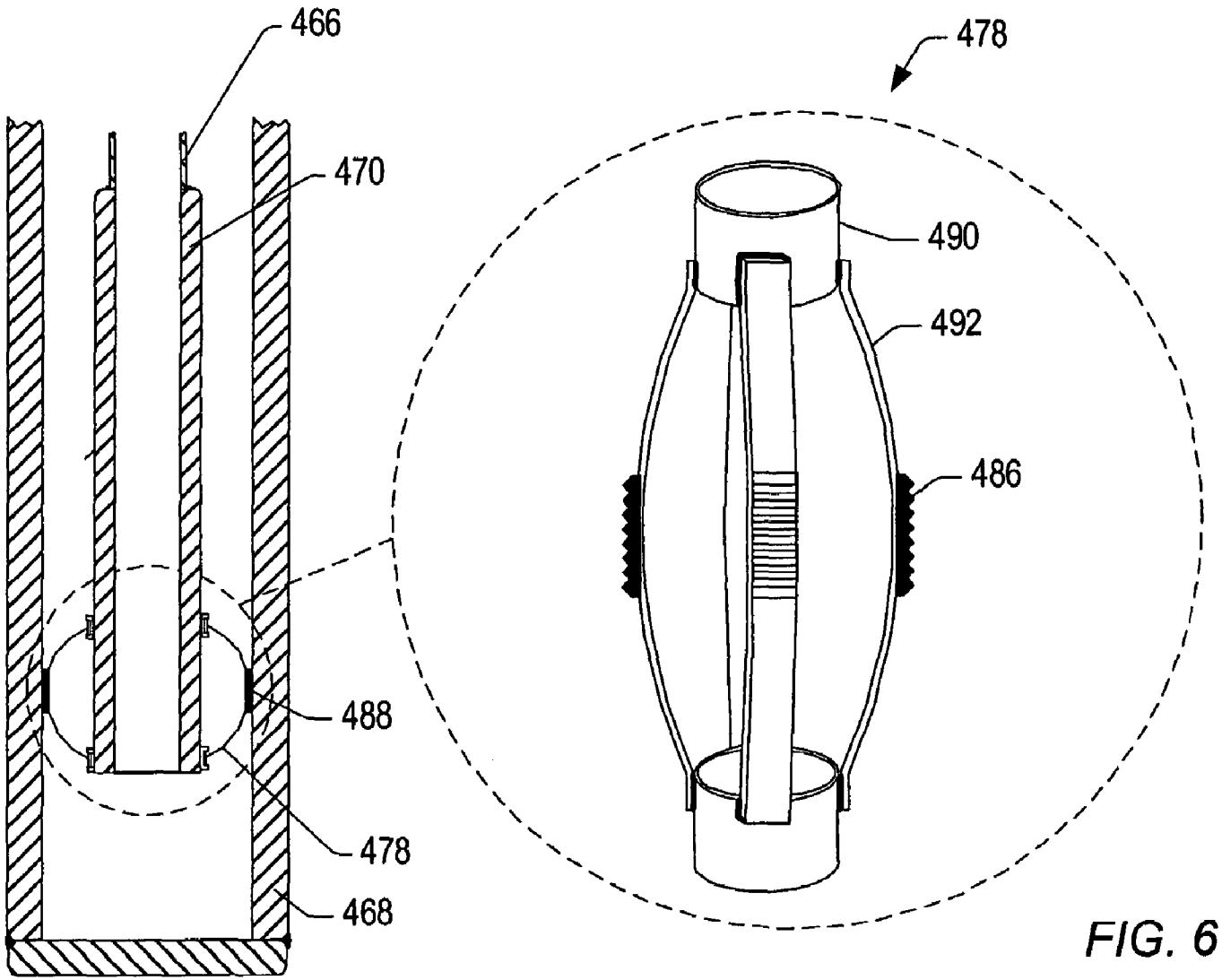
FIG. 61 depicts an embodiment of a sliding connector.

FIG. 61 depicts an embodiment of a sliding connector. Sliding connector 478 may be coupled near an end of conductor 466. Sliding connector 478 may be positioned near a bottom end of conduit 468. Sliding connector 478 may electrically couple conductor 466 to conduit 468. Sliding connector 478 may move during use to accommodate thermal expansion and/or contraction of conductor 466 and conduit 468 relative to each other. In some embodiments, sliding connector 478 may be attached to low resistance section 470 of conductor 466. The lower resistance of low resistance section 470 may allow the sliding connector to be at a temperature that does not exceed about 90° C. Maintaining sliding connector 478 at a relatively low temperature may inhibit corrosion of the sliding connector and promote good contact between the sliding connector and conduit 468.

Sliding connector 478 may include scraper 486. Scraper 486 may abut an inner surface of conduit 468 at point 488. Scraper 486 may include any metal or electrically conducting material (for example, steel or stainless steel). Centralizer 490 may couple to conductor 466. In some embodiments, sliding connector 478 is positioned on low resistance section 470 of conductor 466. Centralizer 490 may include any electrically conducting material (for example, a metal or metal alloy). Spring bow 492 may couple scraper 486 to centralizer 490. Spring bow 492 may include any metal or electrically conducting material (for example, copper-beryllium alloy). In some embodiments, centralizer 490, spring bow 492, and/or scraper 486 are welded together.

More than one sliding connector 478 may be used for redundancy and to reduce the current through each scraper 486. In addition, a thickness of conduit 468 may be increased for a length adjacent to sliding connector 478 to reduce heat generated in that portion of conduit. The length of conduit 468 with increased thickness may be, for example, approximately 6 m. In certain embodiments, electrical contact may be made between centralizer 490 and scraper 486 (shown in FIG. 61) on sliding connector 478 using an electrical conductor (for example, a copper wire) that has a lower electrical resistance than spring bow 492. Electrical current may flow through the electrical conductor rather than spring bow 492 so that the spring bow has a longer lifetime.

Figure 62A:
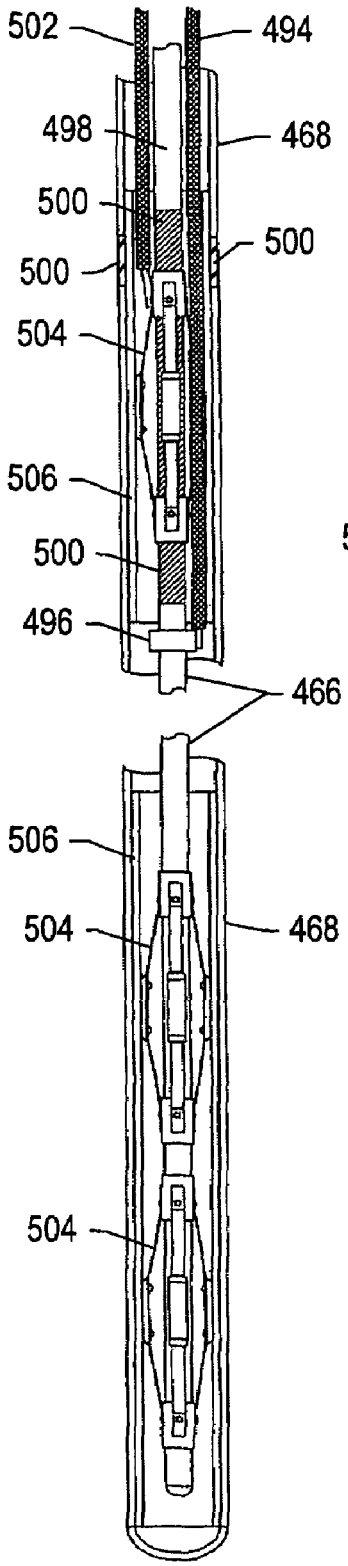
FIG. 62A depicts an embodiment of contacting sections for a conductor-in-conduit heater.

FIG. 62A depicts an embodiment of contacting sections for a conductor-in-conduit heater. Conductor 466 and conduit 468 form the conductor-in-conduit heater. In the upper contact section, lead-in cable 494 provides power to conductor 466 and conduit 468. Connector 496 couples lead-in cable 494 to conductor 466. Conductor 466 is s by rod 498. In certain embodiments, rod 498 is a sucker rod such as a fiberglass, stainless steel, or carbon steel sucker rod. A fiberglass sucker rod may have lower proximity effect losses than stainless steel or carbon steel. Rod 498 and conductor 466 are electrically isolated by isolation sub 500.

Return electrical current enters the upper contacting section through conduit 468. Conduit 468 is electrically coupled to return cable 502 through contactor 504. In certain embodiments, liner 506 is located on the inside of conduit 468 to promote electrical contact between the conduit and contactor 504. In certain embodiments, liner 506 is copper. In some embodiments, conduit 468 includes one or more isolation subs 500. Isolation subs 500 in conduit 468 inhibit any current flow to sections above the contacting section of the conduit.

Isolation subs 500 may be, for example fiberglass sections of conduit 468 or electrically insulating epoxy threaded sections in the conduit.

Figure 62B:
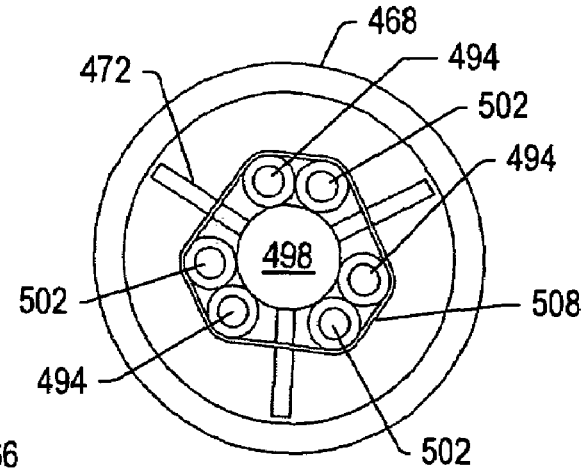
FIG. 62B depicts an aerial view of the upper contact section of the conductor-in-conduit heater in FIG. 62A.

Lead-in cable 494 and return cable 502 may be 4-0 copper cable with TEFLON® insulation. Using copper cables to make electrical contact in the upper contacting section may be less expensive than other contacting methods such as cladding. In certain embodiments, more than one cable is used for lead-in cable 494 and/or return cable 502. FIG. 62B depicts an aerial view of the upper contact section of the conductor-in-conduit heater in FIG. 62A with three lead-in cables 494 and three return cables 502. The cables are coupled to rod 498 with strap 508. Centralizers 472 maintain a position of rod 498 in conduit 468. The lead-in cables and return cables may be paired off in three pairs. Each pair may have one lead-in cable 494 and one return cable 502. Thus, in each cable pair, one cable carries current downwards (lead-in cables) and one cable carries current upwards (return cables). This opposite current flow in each pair reduces skin effect losses in the upper contacting section. In addition, splitting the lead-in and return current between several cables reduces electrical loss and heat loss in the upper contacting section.

In the lower contacting section shown in FIG. 62A, conductor 466 is electrically coupled to conduit 468 through contactor 504. In certain embodiments, liner 506 is located on the inside of conduit 468 to promote electrical contact between the conduit and contactor 504.

In some embodiments, a fiber optic system including an optical sensor is used to continuously monitor parameters (for example, temperature, pressure, and/or strain) along a portion and/or the entire length of a heater assembly. In certain embodiments, an optical sensor is used to monitor composition of gas at one or more locations along the optical sensor. The optical sensor may include, but is not limited to, a high temperature rated optical fiber (for example, a single mode fiber or a multimode fiber) or fiber optic cable. A Sensornet DTS system (Sensomet; London, U.K.) includes an optical fiber that is used to monitor temperature along a length of a heater assembly. A Sensomet DTS system includes an optical fiber that is used to monitor temperature and strain (and/or pressure) at the same time along a length of a heater assembly.

In some embodiments, an optical sensor used to monitor temperature, strain, and/or pressure is protected by positioning, at least partially, the optical sensor in a protective sleeve (such as an enclosed tube) resistant to conditions in a downhole environment. In certain embodiments, the protective sleeve is a small stainless steel tube. In some embodiments, an open-ended sleeve is used to allow determination of gas composition at the surface and/or at the terminal end of an oxidizer assembly. The optical sensor may be pre-installed in a protective sleeve and coiled on a reel. The sleeve may be uncoiled from the reel and coupled to a heater assembly. In some embodiments, an optical sensor in a protective sleeve is lowered into a section of the formation with a heater assembly.

Figure 63:
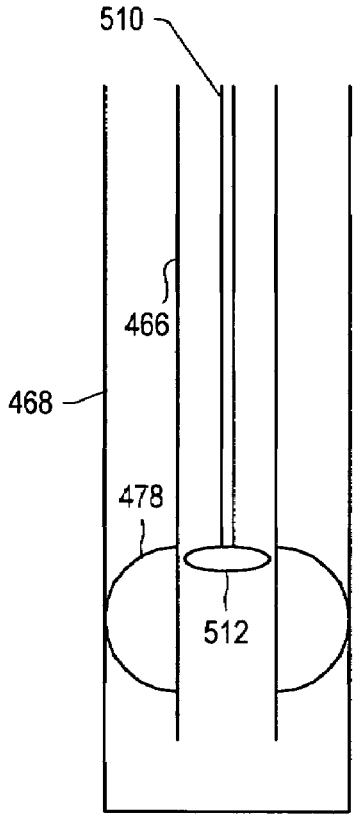
FIG. 63 depicts an embodiment of a fiber optic cable sleeve in a conductor-in-conduit heater.

In certain embodiments, the sleeve is placed down a hollow conductor of a conductor-in-conduit heater. In some embodiments, the fiber optic cable is a high temperature rated fiber optic cable. FIG. 63 depicts an embodiment of sleeve 510 in a conductor-in-conduit heater. Conductor 466 may be a hollow conductor. Sleeve 510 may be placed inside conductor 466. Sleeve 510 may be moved to a position inside conductor 466 by providing a pressurized fluid (for example, a pressurized inert gas) into the conductor to move the sleeve along a length of the conductor. Sleeve 510 may have a plug 512 located at an end of the sleeve so that the sleeve may be moved by the pressurized fluid. Plug 512 may be of a diameter slightly smaller than an inside diameter of conductor 466 so that the plug is allowed to move along the inside of the conductor. In some embodiments, plug 512 may have small openings to allow some fluid to flow past the plug. Conductor 466 may have an open end or a closed end with openings at the end to allow pressure release from the end of the conductor so that sleeve 510 and plug 512 can move along the inside of the conductor. In certain embodiments, sleeve 510 may be placed inside any hollow conduit or conductor in any type of heater.

Using a pressurized fluid to position sleeve 510 inside conductor 466 allows for selected positioning of the sleeve. The pressure of the fluid used to move sleeve 510 inside conductor 466 may be set to move the sleeve a selected distance in the conductor so that the sleeve is positioned as desired. In certain embodiments, sleeve 510 may be removable from conductor 466 so that the sleeve can be repaired and/or replaced.

Temperatures monitored by the fiber optic cable may depend upon positioning of sleeve 510. In certain embodiments, sleeve 510 is positioned in an annulus between the conduit and the conductor or between the conduit and an opening in the formation. In certain embodiments, sleeve 510 with enclosed fiber optic cable is wrapped spirally to enhance resolution.

In certain embodiments, centralizers (such as centralizers 472 depicted in FIGS. 59 and 60) are made of silicon nitride. In some embodiments, silicon nitride is gas pressure sintered reaction bonded silicon nitride. Gas pressure sintered reaction bonded silicon nitride can be made by sintering the silicon nitride at 1800° C. in a 10.3 MPa nitrogen atmosphere to inhibit degradation of the silicon nitride during sintering. One example of a gas pressure sintered reaction bonded silicon nitride is obtained from Ceradyne, Inc. (Costa Mesa, Calif., U.S.A.) as Ceralloy® 147-31N.

Gas pressure sintered reaction bonded silicon nitride may be ground to a fine finish. The fine finish (which gives a very low surface porosity of the silicon nitride) allows the silicon nitride to slide easily along metal surfaces without picking up metal particles from the surfaces. Gas pressure sintered reaction bonded silicon nitride is a very dense material with high tensile strength, high flexural mechanical strength, and high thermal impact stress characteristics. Gas pressure sintered reaction bonded silicon nitride is an excellent high temperature electrical insulator. Gas pressure sintered reaction bonded silicon nitride has about the same leakage current at 900° C. as alumina ($Al_2O_3$) at 760° C. Gas pressure sintered reaction bonded silicon nitride has a thermal conductivity of 25 watts per meter·K. The relatively high thermal conductivity promotes heat transfer away from the center conductor of a conductor-in-conduit heater.

Other types of silicon nitride such as, but not limited to, reaction-bonded silicon nitride or hot isostatically pressed silicon nitride may be used. Hot isostatic pressing includes sintering granular silicon nitride and additives at 100-200 MPa in nitrogen gas. Some silicon nitrides are made by sintering silicon nitride with yttrium oxide or cerium oxide to lower the sintering temperature so that the silicon nitride does not degrade (for example, by releasing nitrogen) during sintering. However, adding other material to the silicon nitride may increase the leakage current of the silicon nitride at elevated temperatures compared to purer forms of silicon nitride.

Figure 64:
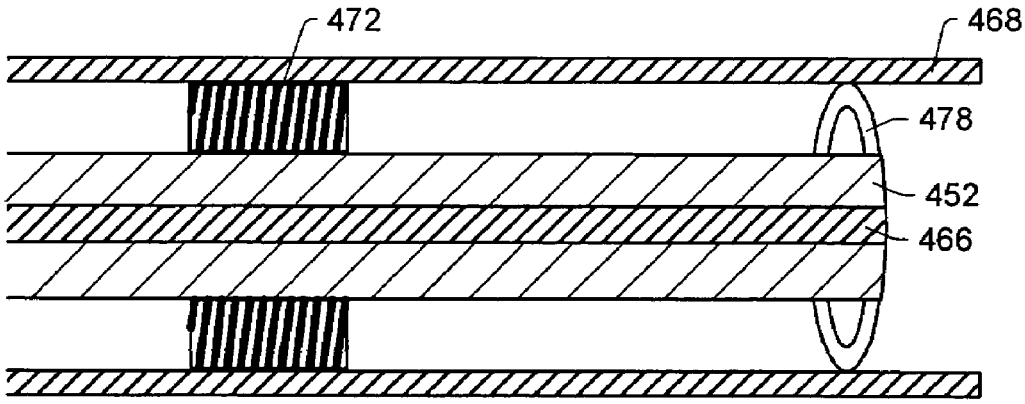
FIG. 64 depicts an embodiment of a conductor-in-conduit temperature limited heater.

FIG. 64 depicts an embodiment of a conductor-in-conduit temperature limited heater. Conductor 466 is coupled to ferromagnetic conductor 452 (for example, clad, coextruded, press fit, drawn inside). In some embodiments, ferromagnetic conductor 452 is coextruded over conductor 466. Ferromagnetic conductor 452 is coupled to the outside of conductor 466 so that current propagates only through the skin depth of the ferromagnetic conductor at room temperature. Ferromagnetic conductor 452 provides mechanical support for conductor 466 at elevated temperatures. Ferromagnetic conductor 452 is, for example, iron, iron alloy, or any other ferromagnetic material. In an embodiment, conductor 466 is copper and ferromagnetic conductor 452 is 446 stainless steel.

Conductor 466 and ferromagnetic conductor 452 are electrically coupled to conduit 468 with sliding connector 478. Conduit 468 is a non-ferromagnetic material such as, but not limited to, 347H stainless steel. In one embodiment, conduit 468 is a 1½" Schedule 80 347H stainless steel pipe. In another embodiment, conduit 468 is a Schedule XXH 347H stainless steel pipe. One or more centralizers 472 maintain the gap between conduit 468 and ferromagnetic conductor 452. In an embodiment, centralizer 472 is made of gas pressure sintered reaction bonded silicon nitride. Centralizer 472 may be held in position on ferromagnetic conductor 452 by one or more weld tabs located on the ferromagnetic conductor.

Figure 65B:
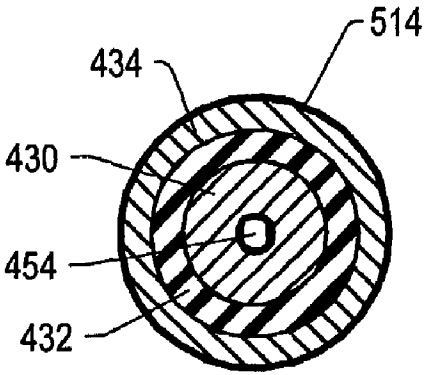
FIG. 65A and FIG. 65B depict an embodiment of an insulated conductor heater.
Figure 65A:
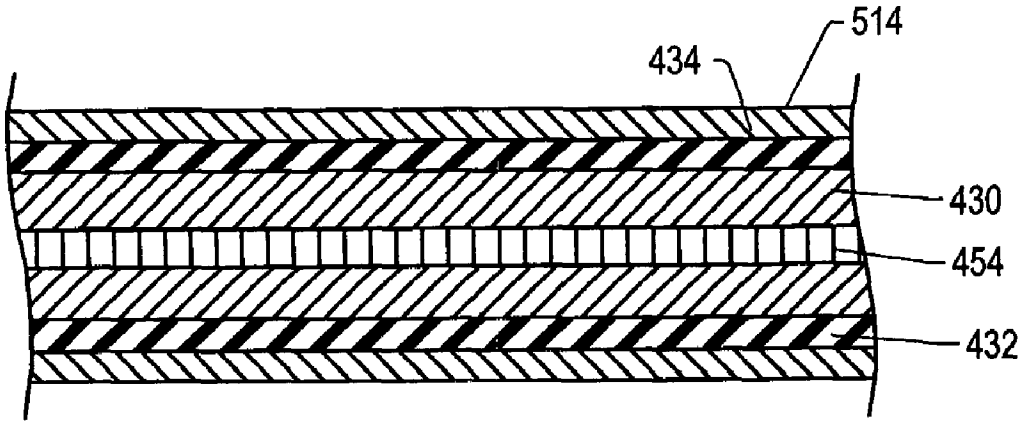

In certain embodiments, the composite electrical conductor may be used as a conductor in an insulated conductor heater. FIG. 65A and FIG. 65B depict an embodiment of the insulated conductor heater. Insulated conductor 514 includes core 454 and inner conductor 430. Core 454 and inner conductor 430 are a composite electrical conductor Core 454 and inner conductor 430 are located within insulator 432. Core 454, inner conductor 430, and insulator 432 are located inside outer conductor 434. Insulator 432 is silicon nitride, boron nitride, magnesium oxide, or another suitable electrical insulator. Outer conductor 434 is copper, steel, or any other electrical conductor.

In certain embodiments, insulator 432 is a powdered insulator. In some embodiments, insulator 432 is an insulator with a preformed shape (for example, preformed half-shells). Insulated conductor 514 may be formed using several techniques known in the art. Examples of techniques for forming insulated conductors include a "weld-fill-draw" method or a "fill-draw" method. Insulated conductors made using these techniques may be made by, for example, Tyco International, Inc. (Princeton, N.J.) or Watlow Electric Manufacturing Co. (St. Louis, Mo.).

Figure 66B:
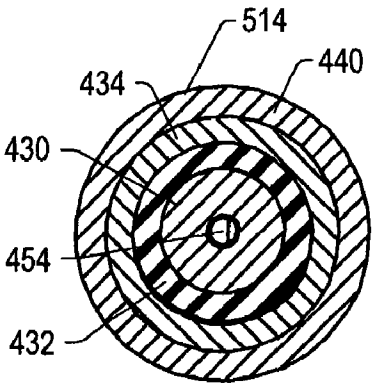
FIG. 66A and FIG. 66B depict an embodiment of an insulated conductor heater.
Figure 66A:
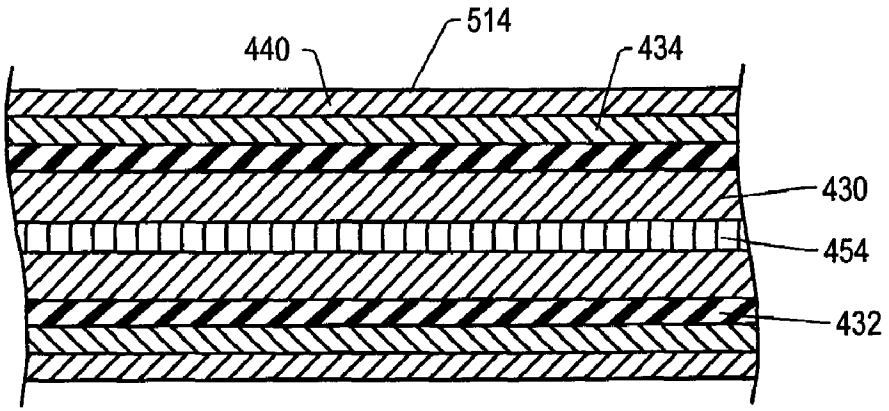

In some embodiments, jacket 440 is located outside outer conductor 434, as shown in FIG. 66A and FIG. 66B. In some embodiments, jacket 440 is 304 stainless steel and outer conductor 434 is copper. Jacket 440 provides corrosion resistance for the insulated conductor heater. In some embodiments, jacket 440 and outer conductor 434 are preformed strips that are drawn over insulator 432 to form insulated conductor 514.

Figure 67:
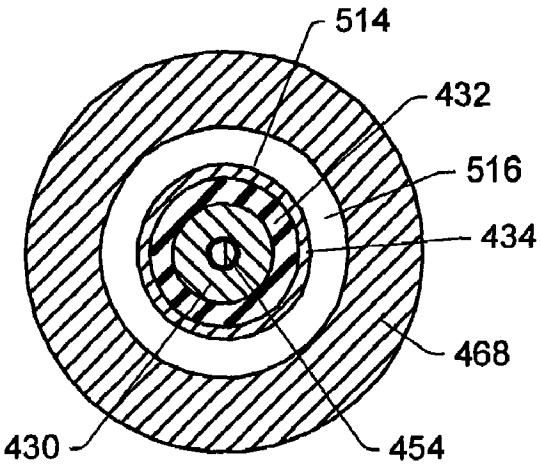
FIG. 67 depicts an embodiment of an insulated conductor located inside a conduit.

In certain embodiments, insulated conductor 514 is located in a conduit that provides protection (for example, corrosion protection, degradation protection, and mechanical deformation protection) for the insulated conductor. In FIG. 67, insulated conductor 514 is located inside conduit 468 with gap 516 separating the insulated conductor from the conduit.

For a temperature limited heater in which the ferromagnetic conductor provides a majority of the resistive heat output below the Curie temperature, a majority of the current flows through material with highly non-linear functions of magnetic field (H) versus magnetic induction (B). These non-linear functions may cause strong inductive effects and distortion that lead to decreased power factor in the temperature limited heater at temperatures below the Curie temperature. These effects may render the electrical power supply to the temperature limited heater difficult to control and may result in additional current flow through surface and/or overburden power supply conductors. Expensive and/or difficult to implement control systems such as variable capacitors or modulated power supplies may be used to attempt to compensate for these effects and to control temperature limited heaters where the majority of the resistive heat output is provided by current flow through the ferromagnetic material.

In certain temperature limited heater embodiments, the ferromagnetic conductor confines a majority of the flow of electrical current to an electrical conductor coupled to the ferromagnetic conductor when the temperature limited heater is below or near the Curie temperature of the ferromagnetic conductor. The electrical conductor may be a sheath, jacket, support member, corrosion resistant member, or other electrically resistive member. In some embodiments, the ferromagnetic conductor confines a majority of the flow of electrical current to the electrical conductor positioned between an outermost layer and the ferromagnetic conductor. The ferromagnetic conductor is located in the cross section of the temperature limited heater such that the magnetic properties of the ferromagnetic conductor at or below the Curie temperature of the ferromagnetic conductor confine the majority of the flow of electrical current to the electrical conductor. The majority of the flow of electrical current is confined to the electrical conductor due to the skin effect of the ferromagnetic conductor. Thus, the majority of the current is flowing through material with substantially linear resistive properties throughout most of the operating range of the heater.

In certain embodiments, the ferromagnetic conductor and the electrical conductor are located in the cross section of the temperature limited heater so that the skin effect of the ferromagnetic material limits the penetration depth of electrical current in the electrical conductor and the ferromagnetic conductor at temperatures below the Curie temperature of the ferromagnetic conductor. Thus, the electrical conductor provides a majority of the electrically resistive heat output of the temperature limited heater at temperatures up to a temperature at or near the Curie temperature of the ferromagnetic conductor. In certain embodiments, the dimensions of the electrical conductor may be chosen to provide desired heat output characteristics.

Because the majority of the current flows through the electrical conductor below the Curie temperature, the temperature limited heater has a resistance versus temperature profile that at least partially reflects the resistance versus temperature profile of the material in the electrical conductor. Thus, the resistance versus temperature profile of the temperature limited heater is substantially linear below the Curie temperature of the ferromagnetic conductor if the material in the electrical conductor has a substantially linear resistance versus temperature profile. For example, the temperature limited heater in which the majority of the current flows in the electrical conductor below the Curie temperature may have a resistance versus temperature profile similar to the profile shown in FIG. 144. The resistance of the temperature limited heater has little or no dependence on the current flowing through the heater until the temperature nears the Curie temperature. The majority of the current flows in the electrical conductor rather than the ferromagnetic conductor below the Curie temperature.

Figure 144:
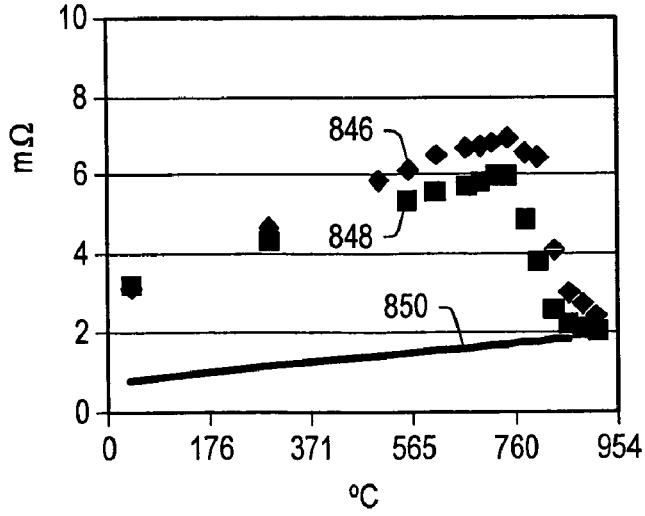

Resistance versus temperature profiles for temperature limited heaters in which the majority of the current flows in the electrical conductor also tend to exhibit sharper reductions in resistance near or at the Curie temperature of the ferromagnetic conductor. For example, the reduction in resistance shown in FIG. 144 is sharper than the reduction in resistance shown in FIG. 128. The sharper reductions in resistance near or at the Curie temperature are easier to control than more gradual resistance reductions near the Curie temperature.

In certain embodiments, the material and/or the dimensions of the material in the electrical conductor are selected so that the temperature limited heater has a desired resistance versus temperature profile below the Curie temperature of the ferromagnetic conductor.

Temperature limited heaters in which the majority of the current flows in the electrical conductor rather than the ferromagnetic conductor below the Curie temperature are easier to predict and/or control. Behavior of temperature limited heaters in which the majority of the current flows in the electrical conductor rather than the ferromagnetic conductor below the Curie temperature may be predicted by, for example, its resistance versus temperature profile and/or its power factor versus temperature profile. Resistance versus temperature profiles and/or power factor versus temperature profiles may be assessed or predicted by, for example, experimental measurements that assess the behavior of the temperature limited heater, analytical equations that assess or predict the behavior of the temperature limited heater, and/or simulations that assess or predict the behavior of the temperature limited heater.

In certain embodiments, assessed or predicted behavior of the temperature limited heater is used to control the temperature limited heater. The temperature limited heater may be controlled based on measurements (assessments) of the resistance and/or the power factor during operation of the heater. In some embodiments, the power, or current, supplied to the temperature limited heater is controlled based on assessment of the resistance and/or the power factor of the heater during operation of the heater and the comparison of this assessment versus the predicted behavior of the heater. In certain embodiments, the temperature limited heater is controlled without measurement of the temperature of the heater or a temperature near the heater. Controlling the temperature limited heater without temperature measurement eliminates operating costs associated with downhole temperature measurement. Controlling the temperature limited heater based on assessment of the resistance and/or the power factor of the heater also reduces the time for making adjustments in the power or current supplied to the heater compared to controlling the heater based on measured temperature.

As the temperature of the temperature limited heater approaches or exceeds the Curie temperature of the ferromagnetic conductor, reduction in the ferromagnetic properties of the ferromagnetic conductor allows electrical current to flow through a greater portion of the electrically conducting cross section of the temperature limited heater. Thus, the electrical resistance of the temperature limited heater is reduced and the temperature limited heater automatically provides reduced heat output at or near the Curie temperature of the ferromagnetic conductor. In certain embodiments, a highly electrically conductive member is coupled to the ferromagnetic conductor and the electrical conductor to reduce the electrical resistance of the temperature limited heater at or above the Curie temperature of the ferromagnetic conductor. The highly electrically conductive member may be an inner conductor, a core, or another conductive member of copper, aluminum, nickel, or alloys thereof.

The ferromagnetic conductor that confines the majority of the flow of electrical current to the electrical conductor at temperatures below the Curie temperature may have a relatively small cross section compared to the ferromagnetic conductor in temperature limited heaters that use the ferromagnetic conductor to provide the majority of resistive heat output up to or near the Curie temperature. A temperature limited heater that uses the electrical conductor to provide a majority of the resistive heat output below the Curie temperature has low magnetic inductance at temperatures below the Curie temperature because less current is flowing through the ferromagnetic conductor as compared to the temperature limited heater where the majority of the resistive heat output below the Curie temperature is provided by the ferromagnetic material. Magnetic field (H) at radius (r) of the ferromagnetic conductor is proportional to the current (I) flowing through the ferromagnetic conductor and the core divided by the radius, or:

$$H \propto I/r. \tag{4}$$

Since only a portion of the current flows through the ferromagnetic conductor for a temperature limited heater that uses the outer conductor to provide a majority of the resistive heat output below the Curie temperature, the magnetic field of the temperature limited heater may be significantly smaller than the magnetic field of the temperature limited heater where the majority of the current flows through the ferromagnetic material. The relative magnetic permeability ($\mu$) may be large for small magnetic fields.

The skin depth ($\delta$) of the ferromagnetic conductor is inversely proportional to the square root of the relative magnetic permeability ($\mu$):

$$\delta \propto (1/\mu)^{1/2}. \tag{5}$$

Increasing the relative magnetic permeability decreases the skin depth of the ferromagnetic conductor. However, because only a portion of the current flows through the ferromagnetic conductor for temperatures below the Curie temperature, the radius (or thickness) of the ferromagnetic conductor may be decreased for ferromagnetic materials with large relative magnetic permeabilities to compensate for the decreased skin depth while still allowing the skin effect to limit the penetration depth of the electrical current to the electrical conductor at temperatures below the Curie temperature of the ferromagnetic conductor. The radius (thickness) of the ferromagnetic conductor may be between 0.3 mm and 8 mm, between 0.3 mm and 2 mm, or between 2 mm and 4 mm depending on the relative magnetic permeability of the ferromagnetic conductor. Decreasing the thickness of the ferromagnetic conductor decreases costs of manufacturing the temperature limited heater, cost of ferromagnetic material tends to be a significant portion of the cost of the temperature limited heater. Increasing the relative magnetic permeability of the ferromagnetic conductor provides a higher turndown ratio and a sharper decrease in electrical resistance for the temperature limited heater at or near the Curie temperature of the ferromagnetic conductor.

Ferromagnetic materials (such as purified iron or iron-cobalt alloys) with high relative magnetic permeabilities (for example, at least 200, at least 1000, at least $1\times10^4$, or at least $1\times10^5$) and/or high Curie temperatures (for example, at least 600° C., at least 700° C., or at least 800° C.) tend to have less corrosion resistance and/or less mechanical strength at high temperatures. The electrical conductor may provide corrosion resistance and/or high mechanical strength at high temperatures for the temperature limited heater. Thus, the ferromagnetic conductor may be chosen primarily for its ferromagnetic properties.

Confining the majority of the flow of electrical current to the electrical conductor below the Curie temperature of the ferromagnetic conductor reduces variations in the power factor. Because only a portion of the electrical current flows through the ferromagnetic conductor below the Curie temperature, the non-linear ferromagnetic properties of the ferromagnetic conductor have little or no effect on the power factor of the temperature limited heater, except at or near the Curie temperature. Even at or near the Curie temperature, the effect on the power factor is reduced compared to temperature limited heaters in which the ferromagnetic conductor provides a majority of the resistive heat output below the Curie temperature. Thus, there is less or no need for external compensation (for example, variable capacitors or waveform modification) to adjust for changes in the inductive load of the temperature limited heater to maintain a relatively high power factor.

In certain embodiments, the temperature limited heater, which confines the majority of the flow of electrical current to the electrical conductor below the Curie temperature of the ferromagnetic conductor, maintains the power factor above 0.85, above 0.9, or above 0.95 during use of the heater. Any reduction in the power factor occurs only in sections of the temperature limited heater at temperatures near the Curie temperature. Most sections of the temperature limited heater are typically not at or near the Curie temperature during use. These sections have a high power factor that approaches 1.0. The power factor for the entire temperature limited heater is maintained above 0.85, above 0.9, or above 0.95 during use of the heater even if some sections of the heater have power factors below 0.85.

Maintaining high power factors also allows for less expensive power supplies and/or control devices such as solid state power supplies or SCRs (silicon controlled rectifiers). These devices may fail to operate properly if the power factor varies by too large an amount because of inductive loads. With the power factors maintained at the higher values; however, these devices may be used to provide power to the temperature limited heater. Solid state power supplies also have the advantage of allowing fine tuning and controlled adjustment of the power supplied to the temperature limited heater.

In some embodiments, transformers are used to provide power to the temperature limited heater. Multiple voltage taps may be made into the transformer to provide power to the temperature limited heater. Multiple voltage taps allows the current supplied to switch back and forth between the multiple voltages. This maintains the current within a range bound by the multiple voltage taps.

The highly electrically conductive member, or inner conductor, increases the turndown ratio of the temperature limited heater. In certain embodiments, thickness of the highly electrically conductive member is increased to increase the turndown ratio of the temperature limited heater. In some embodiments, the thickness of the electrical conductor is reduced to increase the turndown ratio of the temperature limited heater. In certain embodiments, the turndown ratio of the temperature limited heater is between 1.1 and 10, between 2 and 8, or between 3 and 6 (for example, the turndown ratio is at least 1.1, at least 2, or at least 3).

Figure 68:
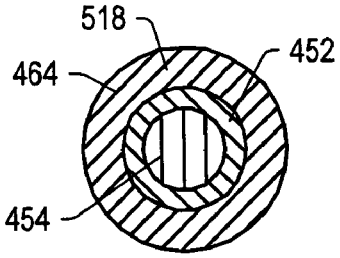
FIG. 68 depicts an embodiment of a temperature limited heater in which the support member provides a majority of the heat output below the Curie temperature of the ferromagnetic conductor.

FIG. 68 depicts an embodiment of a temperature limited heater in which the support member provides a majority of the heat output below the Curie temperature of the ferromagnetic conductor. Core 454 is an inner conductor of the temperature limited heater. In certain embodiments, core 454 is a highly electrically conductive material such as copper or aluminum. In some embodiments, core 454 is a copper alloy that provides mechanical strength and good electrically conductivity such as a dispersion strengthened copper. In one embodiment, core 454 is Glidcope® (SCM Metal Products, Inc., Research Triangle Park, N.C.). Ferromagnetic conductor 452 is a thin layer of ferromagnetic material between electrical conductor 518 and core 454. In certain embodiments, electrical conductor 518 is also support member 464. In certain embodiments, ferromagnetic conductor 452 is iron or an iron alloy. In some embodiments, ferromagnetic conductor 452 includes ferromagnetic material with a high relative magnetic permeability. For example, ferromagnetic conductor 452 may be purified iron such as Armco ingot iron (AK Steel Ltd., United Kingdom). Iron with some impurities typically has a relative magnetic permeability on the order of 400. Purifying the iron by annealing the iron in hydrogen gas ($H_2$) at 1450° C. increases the relative magnetic permeability of the iron. Increasing the relative magnetic permeability of ferromagnetic conductor 452 allows the thickness of the ferromagnetic conductor to be reduced. For example, the thickness of unpurified iron may be approximately 4.5 mm while the thickness of the purified iron is approximately 0.76 mm.

In certain embodiments, electrical conductor 518 provides support for ferromagnetic conductor 452 and the temperature limited heater. Electrical conductor 518 may be made of a material that provides good mechanical strength at temperatures near or above the Curie temperature of ferromagnetic conductor 452. In certain embodiments, electrical conductor 518 is a corrosion resistant member. Electrical conductor 518 (support member 464) may provide support for ferromagnetic conductor 452 and corrosion resistance. Electrical conductor 518 is made from a material that provides desired electrically resistive heat output at temperatures up to and/or above the Curie temperature of ferromagnetic conductor 452.

In an embodiment, electrical conductor 518 is 347H stainless steel. In some embodiments, electrical conductor 518 is another electrically conductive, good mechanical strength, corrosion resistant material. For example, electrical conductor 518 may be 304H, 316H, 347HH, NF709, Incoloy® 800H alloy (Inco Alloys International, Huntington, W. Va.), Haynes® HR120® alloy, or Inconel® 617 alloy.

In some embodiments, electrical conductor 518 (support member 464) includes different alloys in different portions of the temperature limited heater. For example, a lower portion of electrical conductor 518 (support member 464) is 347H stainless steel and an upper portion of the electrical conductor (support member) is NF709. In certain embodiments, different alloys are used in different portions of the electrical conductor (support member) to increase the mechanical strength of the electrical conductor (support member) while maintaining desired heating properties for the temperature limited heater.

In some embodiments, ferromagnetic conductor 452 includes different ferromagnetic conductors in different portions of the temperature limited heater. Different ferromagnetic conductors may be used in different portions of the temperature limited heater to vary the Curie temperature and, thus, the maximum operating temperature in the different portions. In some embodiments, the Curie temperature in an upper portion of the temperature limited heater is lower than the Curie temperature in a lower portion of the heater. The lower Curie temperature in the upper portion increases the creep-rupture strength lifetime in the upper portion of the heater.

In the embodiment depicted in FIG. 68, ferromagnetic conductor 452, electrical conductor 518, and core 454 are dimensioned so that the skin depth of the ferromagnetic conductor limits the penetration depth of the majority of the flow of electrical current to the support member when the temperature is below the Curie temperature of the ferromagnetic conductor. Thus, electrical conductor 518 provides a majority of the electrically resistive heat output of the temperature limited heater at temperatures up to a temperature at or near the Curie temperature of ferromagnetic conductor 452. In certain embodiments, the temperature limited heater depicted in FIG. 68 is smaller (for example, an outside diameter of 3 cm, 2.9 cm, 2.5 cm, or less) than other temperature limited heaters that do not use electrical conductor 518 to provide the majority of electrically resistive heat output. The temperature limited heater depicted in FIG. 68 may be smaller because ferromagnetic conductor 452 is thin as compared to the size of the ferromagnetic conductor needed for a temperature limited heater in which the majority of the resistive heat output is provided by the ferromagnetic conductor.

Figure 69:
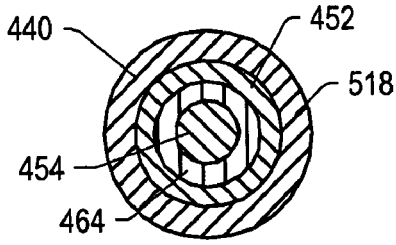
FIGS. 69 and 70 depict embodiments of temperature limited heaters in which the jacket provides a majority of the heat output below the Curie temperature of the ferromagnetic conductor.
Figure 70:
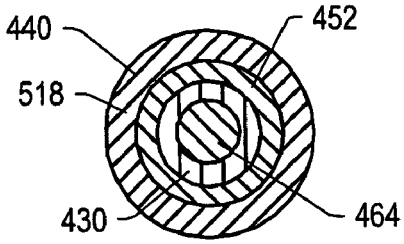

In some embodiments, the support member and the corrosion resistant member are different members in the temperature limited heater. FIGS. 69 and 70 depict embodiments of temperature limited heaters in which the jacket provides a majority of the heat output below the Curie temperature of the ferromagnetic conductor. In these embodiments, electrical conductor 518 is jacket 440. Electrical conductor 518, ferromagnetic conductor 452, support member 464, and core 454 (in FIG. 69) or inner conductor 430 (in FIG. 70) are dimensioned so that the skin depth of the ferromagnetic conductor limits the penetration depth of the majority of the flow of electrical current to the thickness of the jacket. In certain embodiments, electrical conductor 518 is a material that is corrosion resistant and provides electrically resistive heat output below the Curie temperature of ferromagnetic conductor 452. For example, electrical conductor 518 is 825 stainless steel or 347H stainless steel. In some embodiments, electrical conductor 518 has a small thickness (for example, on the order of 0.5 mm).

In FIG. 69, core 454 is highly electrically conductive material such as copper or aluminum. Support member 464 is 347H stainless steel or another material with good mechanical strength at or near the Curie temperature of ferromagnetic conductor 452.

In FIG. 70, support member 464 is the core of the temperature limited heater and is 347H stainless steel or another material with good mechanical strength at or near the Curie temperature of ferromagnetic conductor 452. Inner conductor 430 is highly electrically conductive material such as copper or aluminum.

In certain embodiments, middle conductor 456 in the temperature limited heater with triaxial conductors depicted in FIG. 51A and FIG. 51B includes an electrical conductor in addition to the ferromagnetic material. The electrical conductor may be on the outside of middle conductor 456. The electrical conductor and the ferromagnetic material are dimensioned so that the skin depth of the ferromagnetic material limits the penetration depth of the majority of the flow of electrical current to the electrical conductor when the temperature is below the Curie temperature of the ferromagnetic material. The electrical conductor provides a majority of the electrically resistive heat output of middle conductor 456 (and the triaxial temperature limited heater) at temperatures up to a temperature at or near the Curie temperature of ferromagnetic conductor. The electrical conductor is made from a material that provides desired electrically resistive heat output at temperatures up to and/or above the Curie temperature of ferromagnetic member. For example, the electrical conductor is 347H stainless steel, 304H, 316H, 347HH, NF709, Incoloy® 800H alloy, Haynes® HR120® alloy, or Inconel® 617 alloy.

Figure 71:
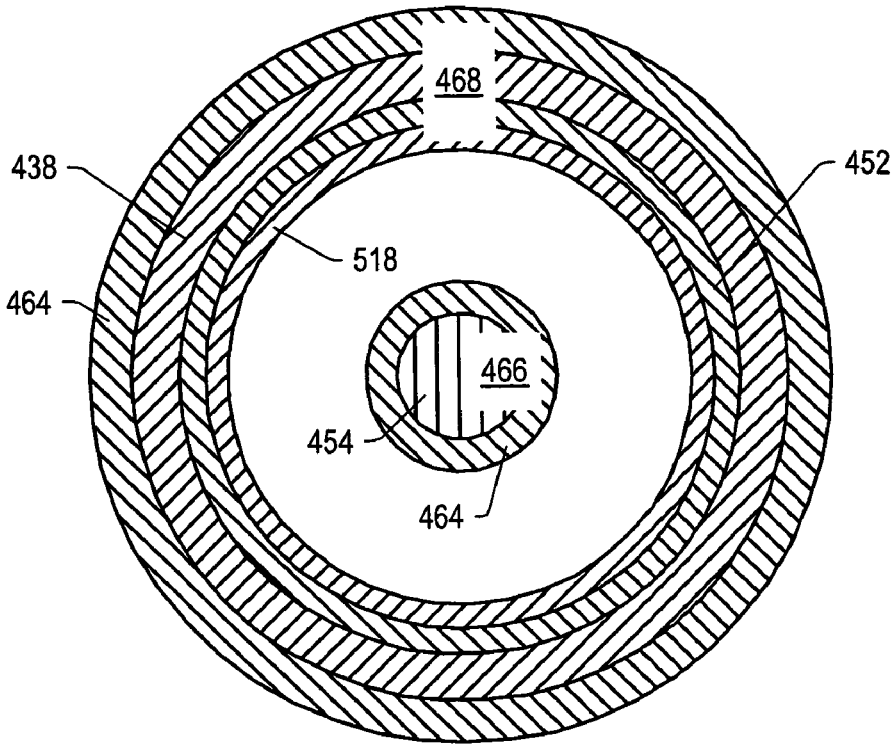
FIG. 71 depicts a high temperature embodiment of a temperature limited heater.

In certain embodiments, the materials and design of the temperature limited heater are chosen to allow use of the heater at high temperatures (for example, above 850° C.). FIG. 71 depicts a high temperature embodiment of the temperature limited heater. The heater depicted in FIG. 71 operates as a conductor-in-conduit heater with the majority of heat being generated in conduit 468. The conductor-in-conduit heater may provide a higher heat output because the majority of heat is generated in conduit 468 rather than conductor 466. Having the heat generated in conduit 468 reduces heat losses associated with transferring heat between the conduit and conductor 466.

Core 454 and conductive layer 438 are copper. In some embodiments, core 454 and conductive layer 438 are nickel if the operating temperatures is to be near or above the melting point of copper. Support members 464 are electrically conductive materials with good mechanical strength at high temperatures. Materials for support members 464 that withstand at least a maximum temperature of about 870° C. may be, but are not limited to, MO-RE® alloys (Duraloy Technologies, Inc. (Scottdale, Pa.)), CF8C+ (Metaltek Intl. (Waukesha, Wis.)), or Inconel® 617 alloy. Materials for support members 464 that withstand at least a maximum temperature of about 980° C. include, but are not limited to, Incoloy® Alloy MA 956. Support member 464 in conduit 468 provides mechanical support for the conduit. Support member 464 in conductor 466 provides mechanical support for core 454.

Electrical conductor 518 is a thin corrosion resistant material. In certain embodiments, electrical conductor 518 is 347H, 617, 625, or 800H stainless steel. Ferromagnetic conductor 452 is a high Curie temperature ferromagnetic material such as iron-cobalt alloy (for example, a 15% by weight cobalt, iron-cobalt alloy).

In certain embodiments, electrical conductor 518 provides the majority of heat output of the temperature limited heater at temperatures up to a temperature at or near the Curie temperature of ferromagnetic conductor 452. Conductive layer 438 increases the turndown ratio of the temperature limited heater.

Figure 72:
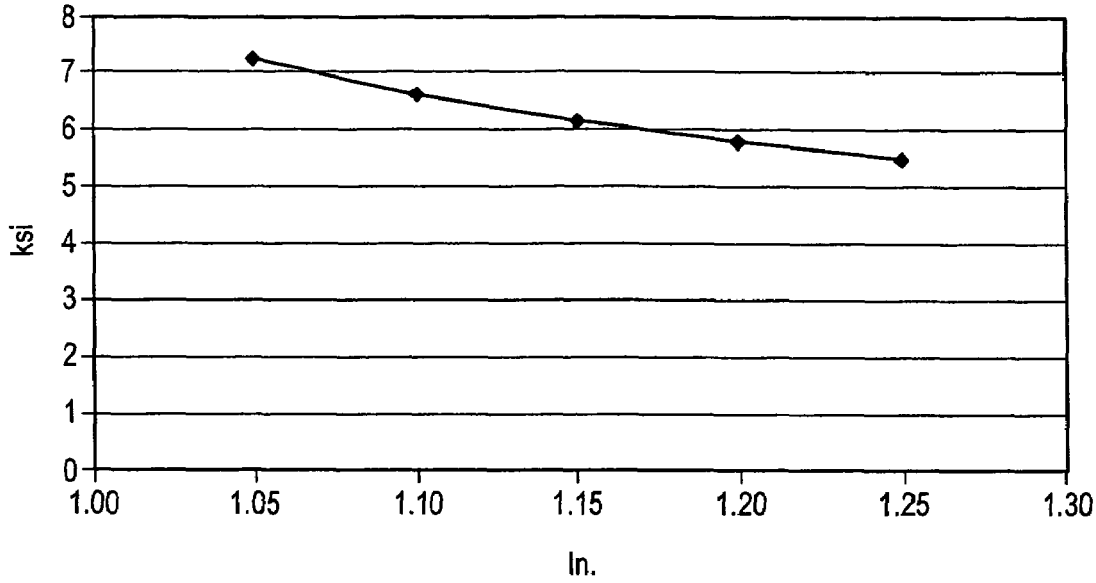
FIG. 72 depicts hanging stress versus outside diameter for the temperature limited heater shown in FIG. 68 with 347H as the support member.

For long vertical temperature limited heaters (for example, heaters at least 300 m, at least 500 m, or at least 1 km in length), the hanging stress becomes important in the selection of materials for the temperature limited heater. Without the proper selection of material, the support member may not have sufficient mechanical strength (for example, creep-rupture strength) to support the weight of the temperature limited heater at the operating temperatures of the heater. FIG. 72 depicts hanging stress (ksi (kilopounds per square inch)) versus outside diameter (in.) for the temperature limited heater shown in FIG. 68 with 347H as the support member. The hanging stress was assessed with the support member outside a 0.5" copper core and a 0.75" outside diameter carbon steel ferromagnetic conductor. This assessment assumes the support member bears the entire load of the heater and that the heater length is 1000 ft. (about 305 m). As shown in FIG. 72, increasing the thickness of the support member decreases the hanging stress on the support member. Decreasing the hanging stress on the support member allows the temperature limited heater to operate at higher temperatures.

In certain embodiments, materials for the support member are varied to increase the maximum allowable hanging stress at operating temperatures of the temperature limited heater and, thus, increase the maximum operating temperature of the temperature limited heater. Altering the materials of the support member affects the heat output of the temperature limited heater below the Curie temperature because changing the materials changes the resistance versus temperature profile of the support member. In certain embodiments, the support member is made of more than one material along the length of the heater so that the temperature limited heater maintains desired operating properties (for example, resistance versus temperature profile below the Curie temperature) as much as possible while providing sufficient mechanical properties to support the heater.

Figure 73:
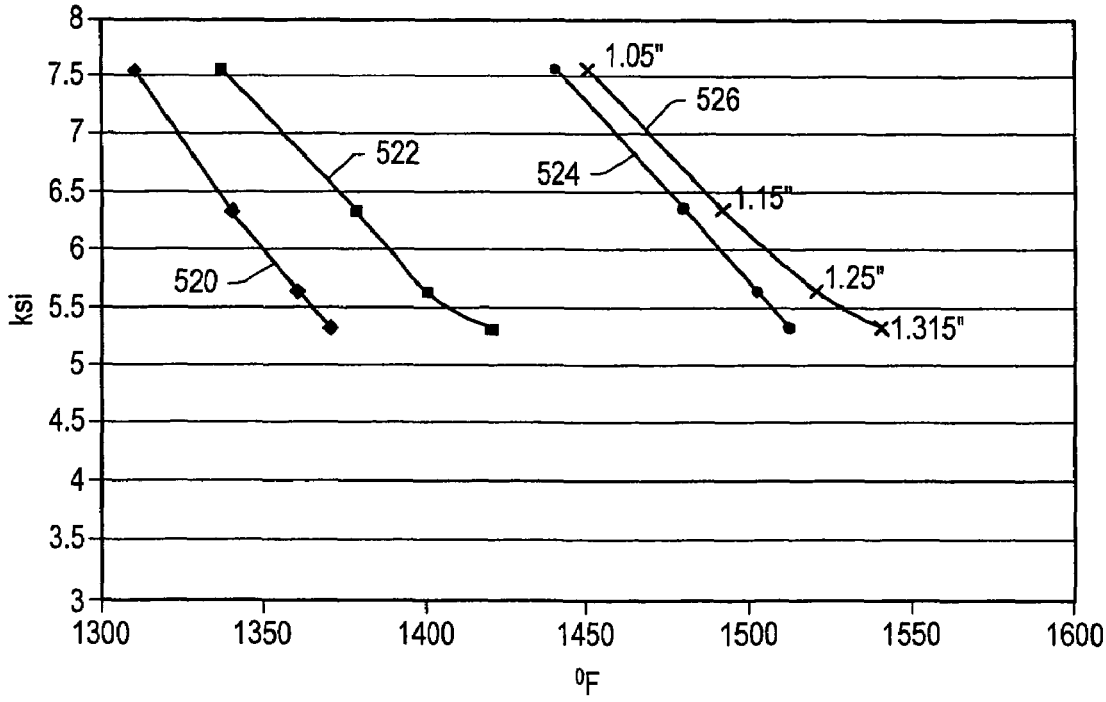
FIG. 73 depicts hanging stress versus temperature for several materials and varying outside diameters of the temperature limited heater.

FIG. 73 depicts hanging stress (ksi) versus temperature (° F.) for several materials and varying outside diameters for the temperature limited heaters. Curve 520 is for 347H stainless steel. Curve 522 is for Incoloy® alloy 800H. Curve 524 is for Haynes® HR120® alloy. Curve 526 is for NF709. Each of the curves includes four points that represent various outside diameters of the support member. The point with the highest stress for each curve corresponds to outside diameter of 1.05". The point with the second highest stress for each curve corresponds to outside diameter of 1.15". The point with the second lowest stress for each curve corresponds to outside diameter of 1.25". The point with the lowest stress for each curve corresponds to outside diameter of 1.315". As shown in FIG. 73, increasing the strength and/or outside diameter of the material and the support member increases the maximum operating temperature of the temperature limited heater.

Figure 74:
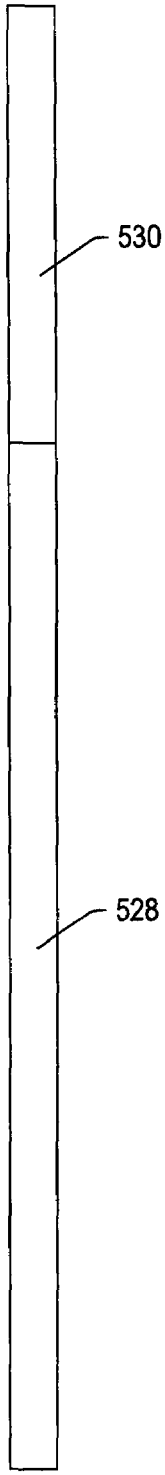
FIGS. 74, 75, and 76 depict examples of embodiments for temperature limited heaters that vary the materials of the support member along the length of the heaters to provide desired operating properties and sufficient mechanical properties.
Figure 75:
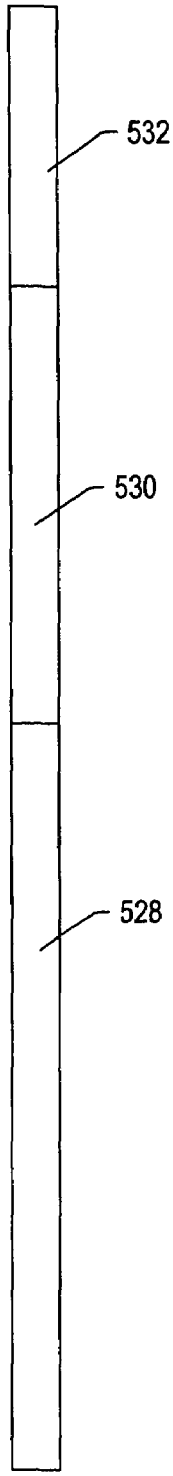
Figure 76:
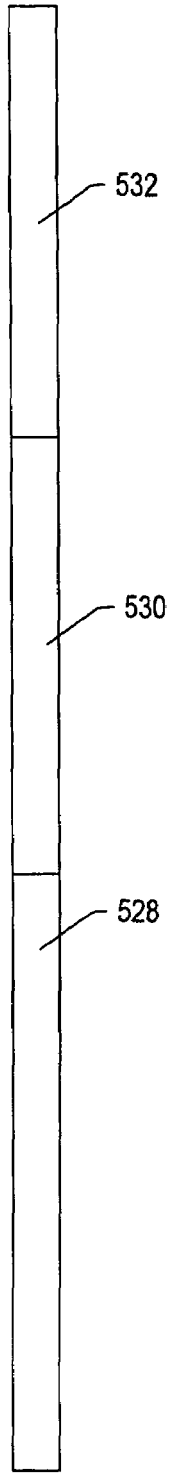

FIGS. 74, 75, and 76 depict examples of embodiments for temperature limited heaters able to provide desired heat output and mechanical strength for operating temperatures up to about 770° C. for 30,000 hrs. creep-rupture lifetime. The depicted temperature limited heaters have lengths of 1000 ft, copper cores of 0.5" diameter, and iron ferromagnetic conductors with outside diameters of 0.765". In FIG. 74, the support member in heater portion 528 is 347H stainless steel. The support member in heater portion 530 is Incoloy® alloy 800H. Portion 528 has a length of 750 ft and portion 530 has a length of 250 ft. The outside diameter of the support member is 1.315". In FIG. 75, the support member in heater portion 528 is 347H stainless steel. The support member in heater portion 530 is Incoloy® alloy 800H. The support member in heater portion 532 is Haynes® HR120 alloy. Portion 528 has a length of 650 ft, portion 530 length of 300 ft, and portion 532 has a length of 50 ft. The outside diameter of the support member is 1.15". In FIG. 76 the support member in heater portion 528 is 347H stainless steel. The support member in heater portion 530 is Incoloy® alloy 800H. The support member in heater portion 532 is Haynes® HR120 alloy. Portion 528 has a length of 55 ft, portion 530 has a length of 250 ft, and portion 532 has a length of 200 ft. The outside diameter of the support member is 1.05".

The materials of the support member along the length of the temperature limited heater may be varied to achieve a variety of desired operating properties. The choice of the materials of the temperature limited heater is adjusted depending on a desired use of the temperature limited heater. TABLE 1 lists examples of materials that may be used for the support member. The table provides the hanging stresses (σ) of the support members and the maximum operating temperatures of the temperature limited heaters for several different outside diameters (OD) of the support member. The core diameter and the outside diameter of the iron ferromagnetic conductor in each case are 0.5" and 0.765", respectively.

Figure 77:
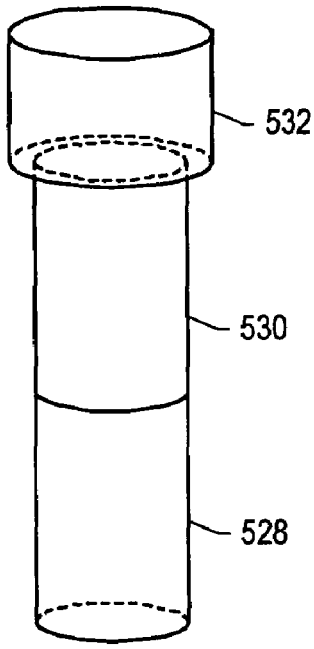
FIGS. 77 and 78 depict examples of embodiments for temperature limited heaters that vary the diameter and/or materials of the support member along the length of the heaters to provide desired operating properties and sufficient mechanical properties.
Figure 78:
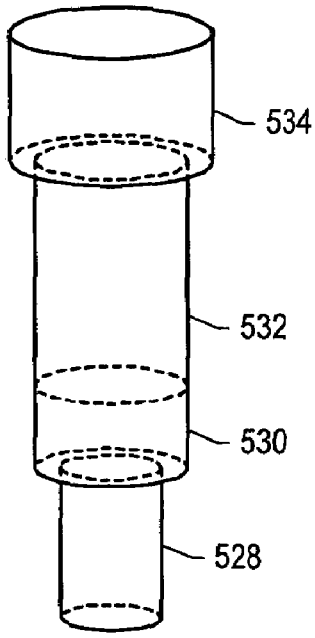

In certain embodiments, one or more portions of the temperature limited heater have varying outside diameters and/or materials to provide desired properties for the heater. FIGS. 77 and 78 depict examples of embodiments for temperature limited heaters that vary the diameter and/or materials of the support member along the length of the heaters to provide desired operating properties and sufficient mechanical properties (for example, creep-rupture strength properties) for operating temperatures up to about 834° C. for 30,000 hrs., heater lengths of 850 ft, a copper core diameter of 0.5", and an iron-cobalt (6% by weight cobalt) ferromagnetic conductor outside diameter of 0.75". In FIG. 77, portion 528 is 347H stainless steel with a length of 300 ft and an outside diameter of 1.15". Portion 530 is NF709 with a length of 400 ft and an outside diameter of 1.15". Portion 532 is NF709 with a length of 150 ft and an outside diameter of 1.25". In FIG. 78, portion 528 is 347H stainless steel with a length of 300 ft and an outside diameter of 1.15". Portion 530 is 347H stainless steel with a length of 100 ft and an outside diameter of 1.20". Portion 532 is NF709 with a length of 350 ft and an outside diameter of 1.20". Portion 534 is NF709 with a length of 100 ft and an outside diameter of 1.25".

In some embodiments, a relatively thin conductive layer is used to provide the majority of the electrically resistive heat output of the temperature limited heater at temperatures up to a temperature at or near the Curie temperature of the ferromagnetic conductor. Such a temperature limited heater may be used as the heating member in an insulated conductor heater. The heating member of the insulated conductor heater may be located inside a sheath with an insulation layer between the sheath and the heating member.

Figure 79B:
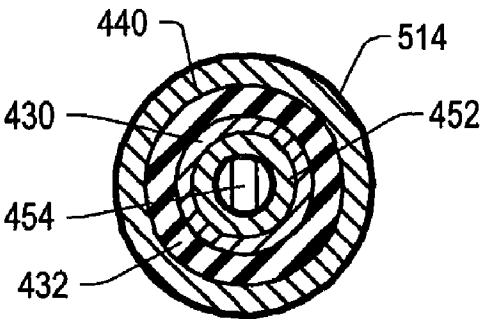
FIGS. 79A and 79B depict cross-sectional representations of an embodiment of a temperature limited heater component used in an insulated conductor heater.
Figure 79A:
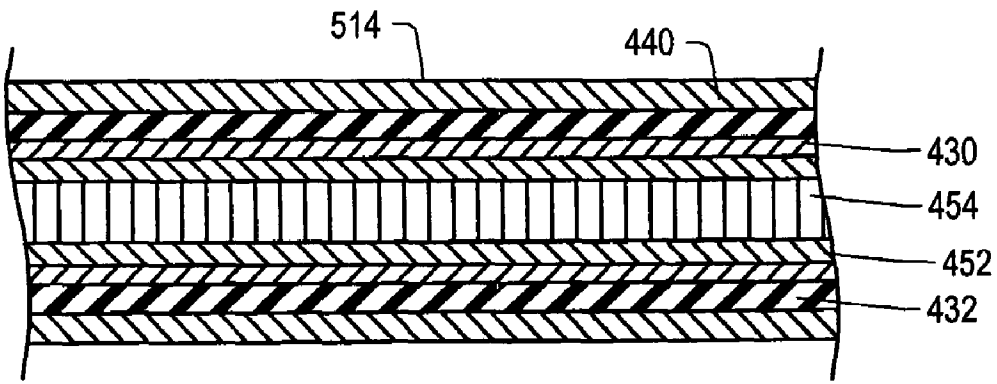

FIGS. 79A and 79B depict cross-sectional representations of an embodiment of the insulated conductor heater with the temperature limited heater as the heating member. Insulated conductor 514 includes core 454, ferromagnetic conductor 452, inner conductor 430, electrical insulator 432, and jacket 440. Core 454 is a copper core. Ferromagnetic conductor 452 is, for example, iron or an iron alloy.

Inner conductor 430 is a relatively thin conductive layer of non-ferromagnetic material with a higher electrical conductivity than ferromagnetic conductor 452. In certain embodiments, inner conductor 430 is copper. Inner conductor 430 may also be a copper alloy. Copper alloys typically have a flatter resistance versus temperature profile than pure copper. A flatter resistance versus temperature profile may provide less variation in the heat output as a function of temperature up to the Curie temperature. In some embodiments, inner conductor 430 is copper with 6% by weight nickel (for example, CuNi6 or LOHM™). In some embodiments, inner conductor 430 is CuNi10Fe1Mn alloy. Below the Curie temperature of ferromagnetic conductor 452, the magnetic properties of the ferromagnetic conductor confine the majority of

TABLE 1

| | OD = 1.05" | | OD = 1.15" | | OD = 1.25" | | OD = 1.315" | |
|---|---|---|---|---|---|---|---|---|
| Material | σ (ksi) | T (° F.) | σ (ksi) | T (° F.) | σ (ksi) | T (° F.) | σ (ksi) | T (° F.) |
| 347H stainless steel | 7.55 | 1310 | 6.33 | 1340 | 5.63 | 1360 | 5.31 | 1370 |
| Incoloy ® alloy 800H | 7.55 | 1337 | 6.33 | 1378 | 5.63 | 1400 | 5.31 | 1420 |
| Haynes ® HR120 ® alloy | 7.57 | 1450 | 6.36 | 1492 | 5.65 | 1520 | 5.34 | 1540 |
| HA230 | 7.91 | 1475 | 6.69 | 1510 | 5.99 | 1530 | 5.67 | 1540 |
| Haynes ® alloy 556 | 7.65 | 1458 | 6.43 | 1492 | 5.72 | 1512 | 5.41 | 1520 |
| NF709 | 7.57 | 1440 | 6.36 | 1480 | 5.65 | 1502 | 5.34 | 1512 |

the flow of electrical current to inner conductor 430. Thus, inner conductor 430 provides the majority of the resistive heat output of insulated conductor 514 below the Curie temperature.

In certain embodiments, inner conductor 430 is dimensioned, along with core 454 and ferromagnetic conductor 452, so that the inner conductor provides a desired amount of heat output and a desired turndown ratio. For example, inner conductor 430 may have a cross-sectional area that is around 2 or 3 times less than the cross-sectional area of core 454. Typically, inner conductor 430 has to have a relatively small cross-sectional area to provide a desired heat output if the inner conductor is copper or copper alloy. In an embodiment with copper inner conductor 430, core 454 has a diameter of 0.66 cm, ferromagnetic conductor 452 has an outside diameter of 0.91 cm, inner conductor 430 has an outside diameter of 1.03 cm, electrical insulator 442 has an outside diameter of 1.53 cm, and jacket 440 has an outside diameter of 1.79 cm. In an embodiment with a CuNi6 inner conductor 430, core 454 has a diameter of 0.66 cm, ferromegnic conductor, 452 has an outside diameter of 0.91 cm, inner conductor 430 has an outside diameter of 1.12 cm, electrical insulator 432 has an outside diameter of 1.63 cm, and jacket 440 has an outside diameter of 1.88 cm. Such insulated conductors are typically smaller and cheaper to manufacture than insulated conductors that do not use the thin inner conductor to provide the majority of heat output below the Curie temperature.

Electrical insulator 432 may be magnesium oxide, aluminum oxide, silicon dioxide, beryllium oxide, boron nitride, silicon nitride, or combinations thereof. In certain embodiments, electrical insulator 432 is a compacted powder of magnesium oxide. In some embodiments, electrical insulator 432 includes beads of silicon nitride.

In certain embodiments, a small layer of material is placed between electrical insulator 432 and inner conductor 430 to inhibit copper from migrating into the electrical insulator at higher temperatures. For example, the small layer of nickel (for example, about 0.5 mm of nickel) may be placed between electrical insulator 432 and inner conductor 430.

Jacket 440 is made of a corrosion resistant material such as, but not limited to, 347 stainless steel, 347H stainless steel, 446 stainless steel, or 825 stainless steel. In some embodiments, jacket 440 provides some mechanical strength for insulated conductor 514 at or above the Curie temperature of ferromagnetic conductor 452. In certain embodiments, jacket 440 is not used to conduct electrical current.

In certain embodiments of temperature limited heaters, three temperature limited heaters are coupled together in a three-phase wye configuration. Coupling three temperature limited heaters together in the three-phase wye configuration lowers the current in each of the individual temperature limited heaters because the current is split between the three individual heaters. Lowering the current in each individual temperature limited heater allows each heater to have a small diameter. The lower currents allow for higher relative magnetic permeabilities in each of the individual temperature limited heaters and, thus, higher turndown ratios. In addition, there may be no return current needed for each of the individual temperature limited heaters. Thus, the turndown ratio remains higher for each of the individual temperature limited heaters than if each temperature limited heater had its own return current path.

In the three-phase wye configuration, individual temperature limited heaters may be coupled together by shorting the sheaths, jackets, or canisters of each of the individual temperature limited heaters to the electrically conductive sections (the conductors providing heat) at their terminating ends (for example, the ends of the heaters at the bottom of a heater wellbore). In some embodiments, the sheaths, jackets, canisters, and/or electrically conductive sections are coupled to a support member that supports the temperature limited heaters in the wellbore.

Figure 80A:
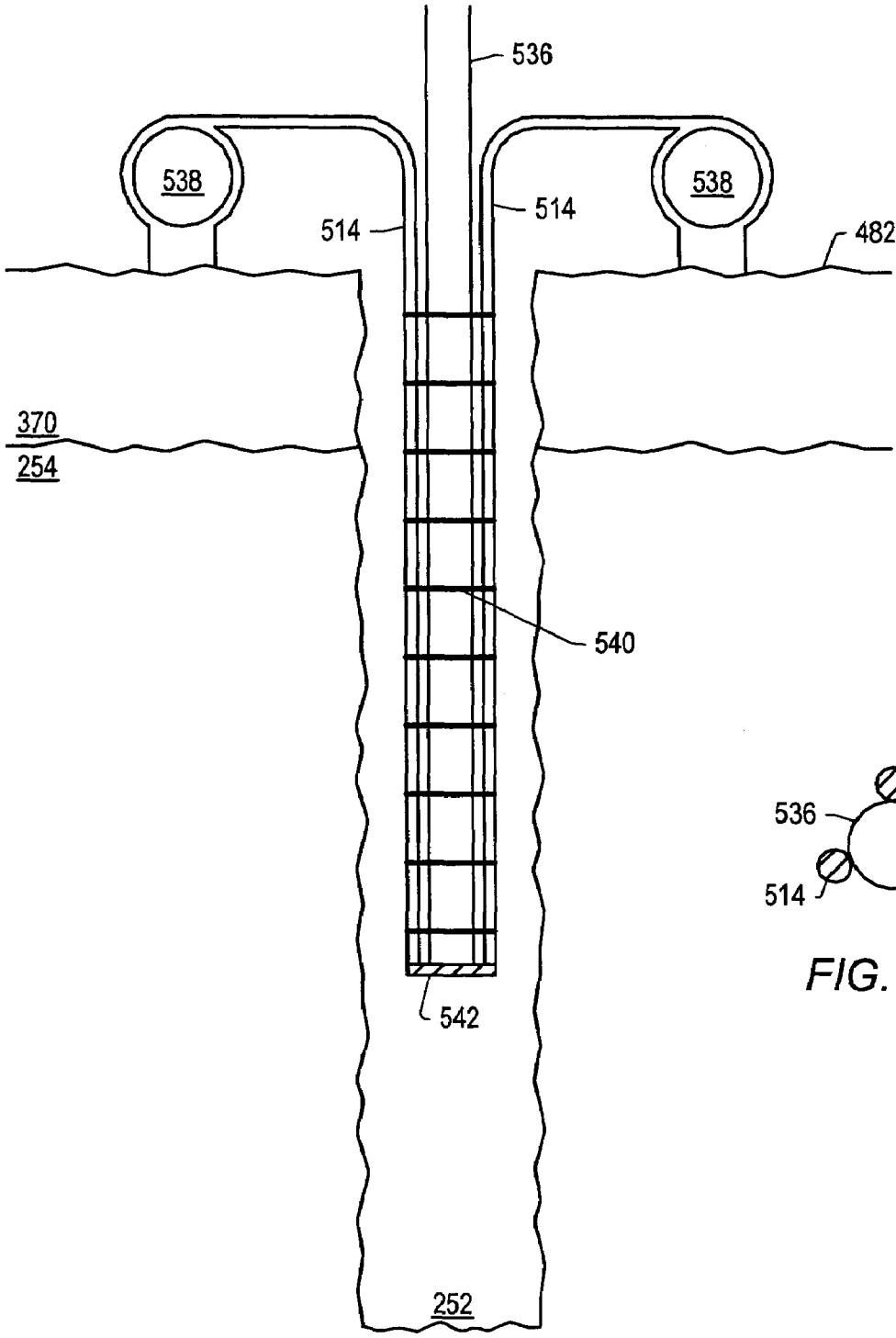
FIGS. 80A and 80B depict an embodiment for installing heaters in a wellbore.
Figure 80B:
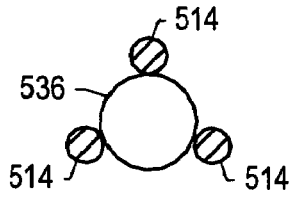

FIG. 80A depicts an embodiment for installing and coupling heaters in a wellbore. The embodiment in FIG. 80A depicts insulated conductor heaters being installed into the wellbore. Other types of heaters, such as conductor-in-conduit heaters, may also be installed in the wellbore using the embodiment depicted. Also, in FIG. 80A, two insulated conductors 514 are shown while a third insulated conductor is not seen from the view depicted. Typically, three insulated conductors 514 would be coupled to support member 536, as shown in FIG. 80B. In an embodiment, support member 536 is a thick walled 347H pipe. In some embodiments, thermocouples or other temperature sensors are placed inside support member 536. The three insulated conductors may be coupled in a three-phase wye configuration.

In FIG. 80A, insulated conductors 514 are coiled on coiled tubing rigs 538. As insulated conductors 514 are uncoiled from rigs 538, the insulated conductors are coupled to support member 536. In certain embodiments, insulated conductors 514 are simultaneously uncoiled and/or simultaneously coupled to support member 536. Insulated conductors 514 may be coupled to support member 536 using metal (for example, 304 stainless steel or Inconel® alloys) straps 540. In some embodiments, insulated conductors 514 are coupled to support member 536 using other types of fasteners such as buckles, wire holders, or snaps. Support member 536 along with insulated conductors 514 are installed into opening 252.

Insulated conductors 514 may be electrically coupled to each other (for example, for a three-phase wye configuration) in contactor section 542. In section 542, sheaths, jackets, canisters, and/or electrically conductive sections are coupled to each other and/or to support member 536 so that insulated conductors 514 are electrically coupled together. In certain embodiments, the sheaths of insulated conductors 514 are shorted to the conductors of the insulated conductors. The sheaths of individual insulated conductors 514 may then be shorted together to electrically couple the insulated conductors.

Figure 81A:
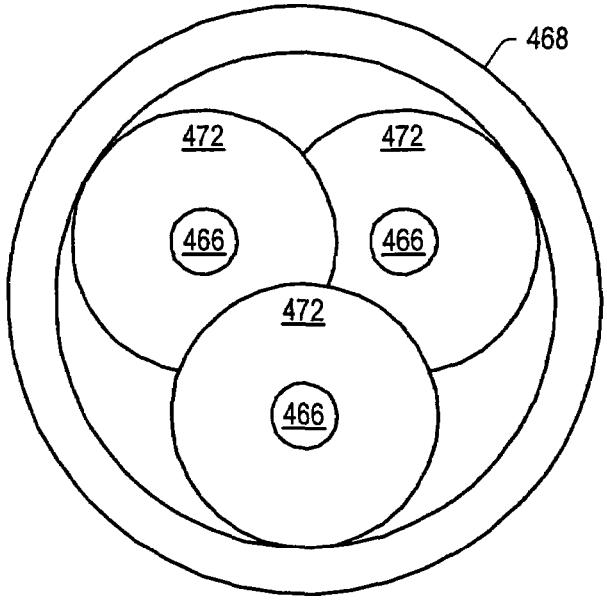
FIGS. 81A and 81B depict an embodiment of a three conductor-in-conduit heater.
Figure 81B:
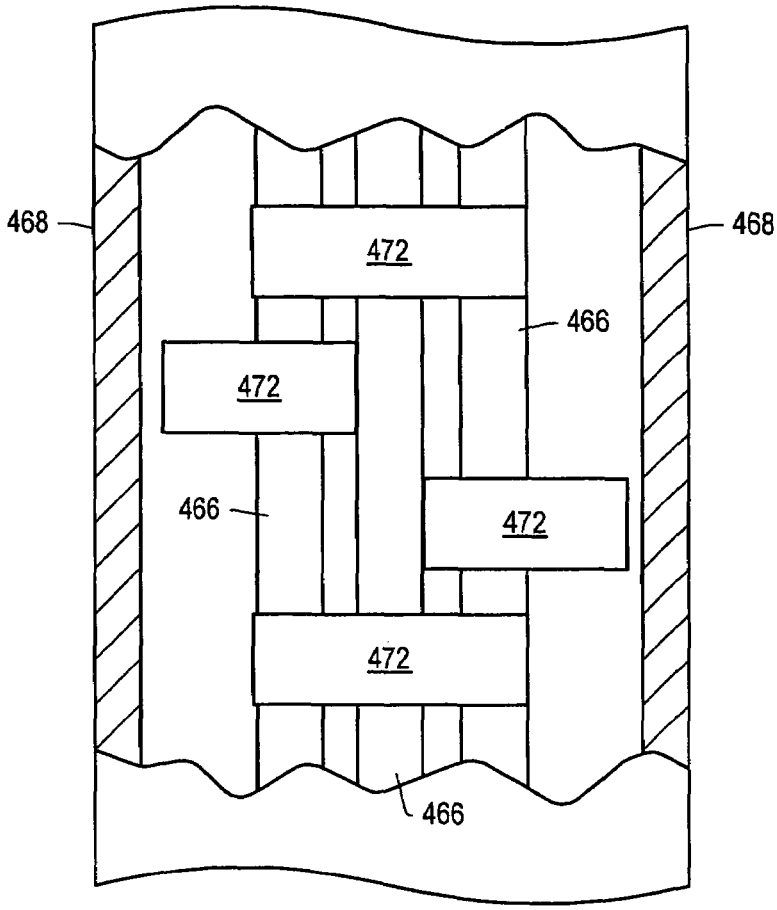

In certain embodiments, three conductors are located inside a single conduit to form a three conductor-in-conduit heater. FIGS. 81A and 81B depict an embodiment of a three conductor-in-conduit heater. FIG. 81A depicts a top down view of the three conductor-in-conduit heater. FIG. 81B depicts a side view representation with a cutout to show the internals of the three conductor-in-conduit heater. Three conductors 466 are located inside conduit 468. The three conductors 466 are substantially evenly spaced within conduit 468. In some embodiments, the three conductors 466 are coupled in a spiral configuration.

One or more centralizers 472 are placed around each conductor 466. Centralizers 472 are made from electrically insulating material such as silicon nitride or boron nitride. Centralizers 472 maintain a position of conductors 466 in conduit 468. Centralizers 472 also inhibit electrical contact between conductors 466 and conduit 468. In certain embodiments, centralizers 472 are spaced along the length of conductors 466 so that the centralizers surrounding one conductor overlap (as seen from the top down view) centralizers from another conductor. This reduces the number of centralizers needed for each conductor and allows for tight spacing of the conductors.

In certain embodiments, the three conductors 466 are coupled in a three-phase wye configuration. The three conductors 466 may be coupled at or near the bottom of the heaters in the three-phase wye configuration. In the three-phase wye configuration, conduit 468 is not electrically coupled to the three conductors 466. Thus, conduit 468 may only be used to provide strength for and/or inhibit corrosion of the three conductors 466.

In some embodiments, the temperature limited heater is used to achieve lower temperature heating (for example, for heating fluids in a production well, heating a surface pipeline, or reducing the viscosity of fluids in a wellbore or near wellbore region). Varying the ferromagnetic materials of the temperature limited heater allows for lower temperature heating. In some embodiments, the ferromagnetic conductor is made of material with a lower Curie temperature than that of 446 stainless steel. For example, the ferromagnetic conductor may be an alloy of iron and nickel. The alloy may have between 30% by weight and 42% by weight nickel with the rest being iron. In one embodiment, the alloy is Invar 36. Invar 36 is 36% by weight nickel in iron and has a Curie temperature of 277° C. In some embodiments, an alloy is a three component alloy with, for example, chromium, nickel, and iron. For example, an alloy may have 6% by weight chromium, 42% by weight nickel, and 52% by weight iron. A 2.5 cm diameter rod of Invar 36 has a turndown ratio of approximately 2 to 1 at the Curie temperature. Placing the Invar 36 alloy over a copper core may allow for a smaller rod diameter. A copper core may result in a high turndown ratio. The insulator in lower temperature heater embodiments may be made of a high performance polymer insulator (such as PFA or PEEK™) when used with alloys with a Curie temperature that is below the melting point or softening point of the polymer insulator.

In certain embodiments, a conductor-in-conduit temperature limited heater is used in lower temperature applications by using lower Curie temperature ferromagnetic materials. For example, a lower Curie temperature ferromagnetic material may be used for heating inside sucker pump rods. Heating sucker pump rods may be useful to lower the viscosity of fluids in the sucker pump or rod and/or to maintain a lower viscosity of fluids in the sucker pump rod. Lowering the viscosity of the oil may inhibit sticking of a pump used to pump the fluids. Fluids in the sucker pump rod may be heated up to temperatures less than about 250° C. or less than about 300° C. Temperatures need to be maintained below these values to inhibit coking of hydrocarbon fluids in the sucker pump system.

For lower temperature applications, ferromagnetic conductor 452 in FIG. 64 may be Alloy 42-6 coupled to conductor 466. Conductor 466 may be copper. In one embodiment, ferromagnetic conductor 452 is 1.9 cm outside diameter Alloy 42-6 over copper conductor 466 with a 2:1 outside diameter to copper diameter ratio. In some embodiments, ferromagnetic conductor 452 includes other lower temperature ferromagnetic materials such as Alloy 32, Alloy 52, Invar 36, iron-nickel-chromium alloys, iron-nickel alloys, nickel-chromium alloys, or other nickel alloys. Conduit 468 may be a hollow sucker rod made from carbon steel. The carbon steel or other material used in conduit 468 confines current to the inside of the conduit to inhibit stray voltages at the surface of the formation. Centralizer 544 may be made from gas pressure sintered reaction bonded silicon nitride. In some embodiments, centralizer 544 is made from polymers such as PFA or PEEK™. In certain embodiments, polymer insulation is clad along an entire length of the heater. Conductor 466 and ferromagnetic conductor 452 are electrically coupled to conduit 468 with sliding connector 478.

Figure 82:
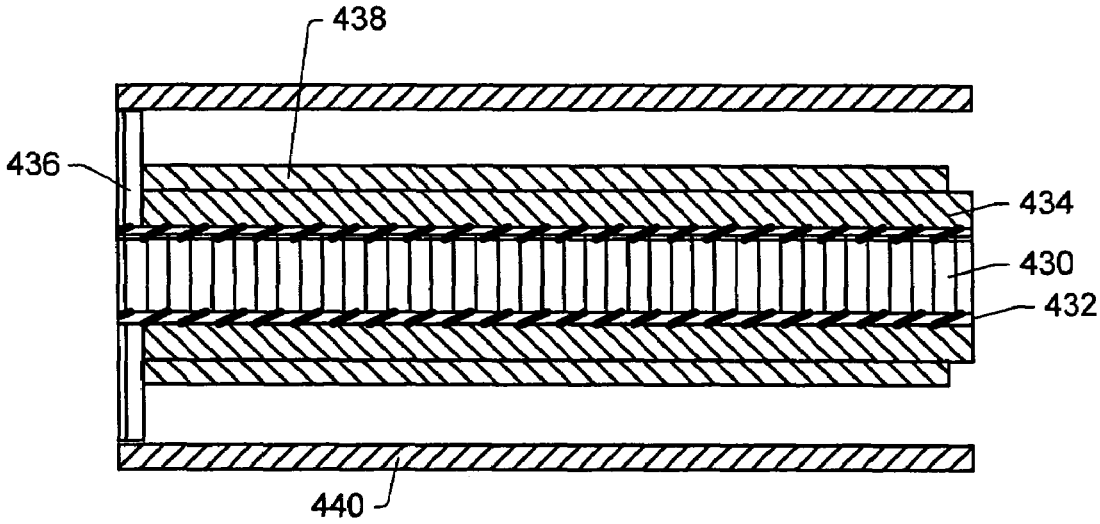
FIG. 82 depicts an embodiment of a temperature limited heater with a low temperature ferromagnetic outer conductor.

FIG. 82 depicts an embodiment of a temperature limited heater with a low temperature ferromagnetic outer conductor. Outer conductor 434 is glass sealing Alloy 42-6. Alloy 42-6 may be obtained from Carpenter Metals (Reading, Pa.) or Anomet Products, Inc. (Shrewsbury, Mass.). In some embodiments, outer conductor 434 includes other compositions and/or materials to get various Curie temperatures (for example, Carpenter Temperature Compensator "32" (Curie temperature of 199° C.; available from Carpenter Metals) or Invar 36). In an embodiment, conductive layer 438 is coupled (for example, clad, welded, or brazed) to outer conductor 434. Conductive layer 438 is a copper layer. Conductive layer 438 improves a turndown ratio of outer conductor 434. Jacket 440 is a ferromagnetic metal such as carbon steel. Jacket 440 protects outer conductor 434 from a corrosive environment. Inner conductor 430 may have electrical insulator 432. Electrical insulator 432 may be a mica tape winding with overlaid fiberglass braid. In an embodiment, inner conductor 430 and electrical insulator 432 are a 4/0 MGT-1000 furnace cable or 3/0 MGT-1000 furnace cable. 4/0 MGT-1000 furnace cable or 3/0 MGT-1000 furnace cable is available from Allied Wire and Cable (Phoenixville, Pa.). In some embodiments, a protective braid such as a stainless steel braid may be placed over electrical insulator 432.

Conductive section 436 electrically couples inner conductor 430 to outer conductor 434 and/or jacket 440. In some embodiments, jacket 440 touches or electrically contacts conductive layer 438 (for example, if the heater is placed in a horizontal configuration). If jacket 440 is a ferromagnetic metal such as carbon steel (with a Curie temperature above the Curie temperature of outer conductor 434), current will propagate only on the inside of the jacket. Thus, the outside of the jacket remains electrically safe during operation. In some embodiments, jacket 440 is drawn down (for example, swaged down in a die) onto conductive layer 438 so that a tight fit is made between the jacket and the conductive layer. The heater may be spooled as coiled tubing for insertion into a wellbore. In other embodiments, an annular space is present between conductive layer 438 and jacket 440, as depicted in FIG. 82.

Figure 83:
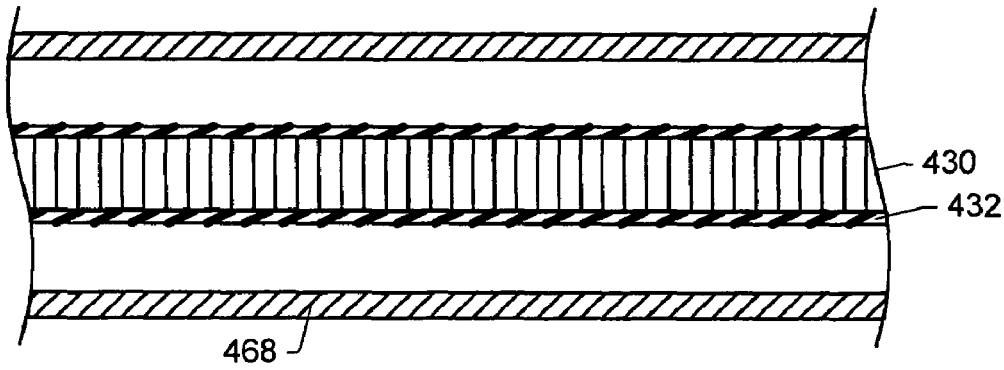
FIG. 83 depicts an embodiment of a temperature limited conductor-in-conduit heater.

FIG. 83 depicts an embodiment of a temperature limited conductor-in-conduit heater. Conduit 468 is a hollow sucker rod made of a ferromagnetic metal such as Alloy 42-6, Alloy 32, Alloy 52, Invar 36, iron-nickel-chromium alloys, iron-nickel alloys, nickel alloys, or nickel-chromium alloys. Inner conductor 430 has electrical insulator 432. Electrical insulator 432 is a mica tape winding with overlaid fiberglass braid. In an embodiment, inner conductor 430 and electrical insulator 432 are a 4/0 MGT-1000 furnace cable or 3/0 MGT-1000 furnace cable. In some embodiments, polymer insulations are used for lower temperature Curie heaters. In certain embodiments, a protective braid is placed over electrical insulator 432. Conduit 468 has a wall thickness that is greater than the skin depth at the Curie temperature (for example, 2 to 3 times the skin depth at the Curie temperature). In some embodiments, a more conductive conductor is coupled to conduit 468 to increase the turndown ratio of the heater.

Figure 84:
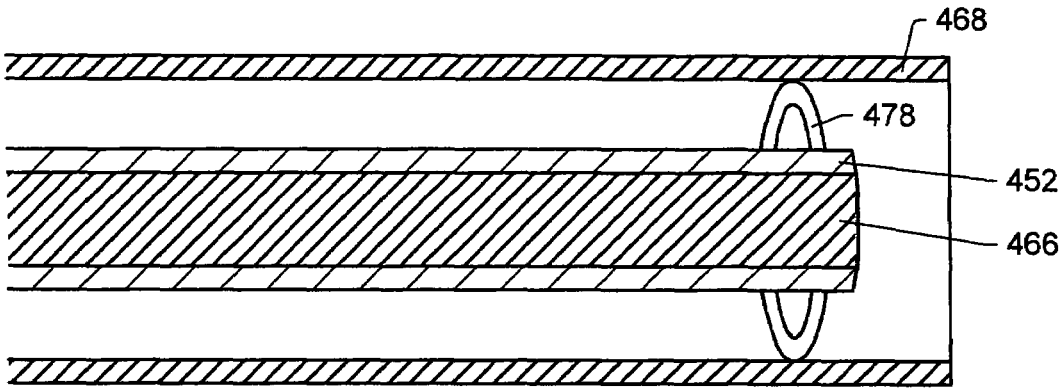
FIG. 84 depicts a cross-sectional representation of an embodiment of a conductor-in-conduit temperature limited heater.

FIG. 84 depicts a cross-sectional representation of an embodiment of a conductor-in-conduit temperature limited heater. Conductor 466 is coupled (for example, clad, coextruded, press fit, drawn inside) to ferromagnetic conductor 452. A metallurgical bond between conductor 466 and ferromagnetic conductor 452 is favorable. Ferromagnetic conductor 452 is coupled to the outside of conductor 466 so that current propagates through the skin depth of the ferromagnetic conductor at room temperature. Conductor 466 provides mechanical support for ferromagnetic conductor 452 at elevated temperatures. Ferromagnetic conductor 452 is iron, an iron alloy (for example, iron with 10% to 27% by weight chromium for corrosion resistance), or any other ferromagnetic material. In one embodiment, conductor 466 is 304 stainless steel and ferromagnetic conductor 452 is 446 stainless steel. Conductor 4 and ferromagnetic conductor 452 are electrically coupled to conduit 468 with sliding connector 478. Conduit 468 may be a non-ferromagnetic material such as austentitic stainless steel.

Figure 85:
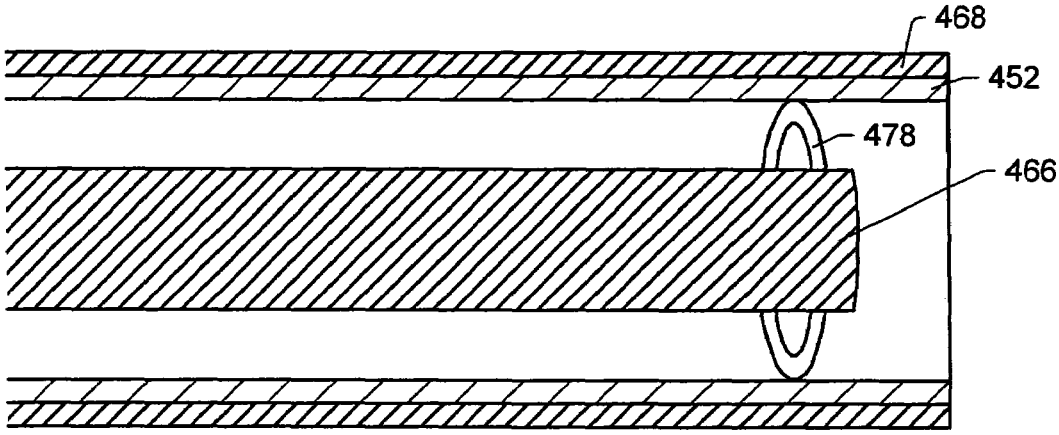
FIG. 85 depicts a cross-sectional representation of an embodiment of a conductor-in-conduit temperature limited heater.

FIG. 85 depicts a cross-sectional representation of an embodiment of a conductor-in-conduit temperature limited heater. Conduit 468 is coupled to ferromagnetic conductor 452 (for example, clad, press fit, or drawn inside of the ferromagnetic conductor). Ferromagnetic conductor 452 is coupled to the inside of conduit 468 to allow current to propagate through the skin depth of the ferromagnetic conductor at room temperature. Conduit 468 provides mechanical support for ferromagnetic conductor 452 at elevated temperatures. Conduit 468 and ferromagnetic conductor 452 are electrically coupled to conductor 466 with sliding connector 478.

Figure 86:
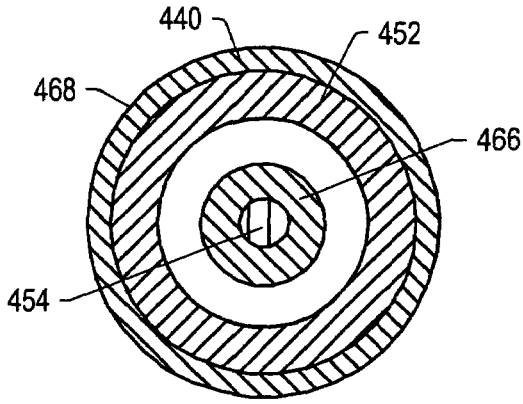
FIG. 86 depicts a cross-sectional view of an embodiment of a conductor-in-conduit temperature limited heater.

FIG. 86 depicts a cross-sectional view of an embodiment of a conductor-in-conduit temperature limited heater. Conductor 466 may surround core 454. In an embodiment, conductor 466 is 347H stainless steel and core 454 is copper. Conductor 466 and core 454 may be formed together as a composite conductor. Conduit 468 may include ferromagnetic conductor 452. In an embodiment, ferromagnetic conductor 452 is Sumitomo HCM12A or 446 stainless steel. Ferromagnetic conductor 452 may have a Schedule XXH thickness so that the conductor is inhibited from deforming. In certain embodiments, conduit 468 also includes jacket 440. Jacket 440 may include corrosion resistant material that inhibits electrons from flowing away from the heater and into a subsurface formation at higher temperatures (for example, temperatures near the Curie temperature of ferromagnetic conductor 452). For example, jacket 440 may be about a 0.4 cm thick sheath of 410 stainless steel. Inhibiting electrons from flowing to the formation may increase the safety of using a heater in a subsurface formation.

Figure 87:
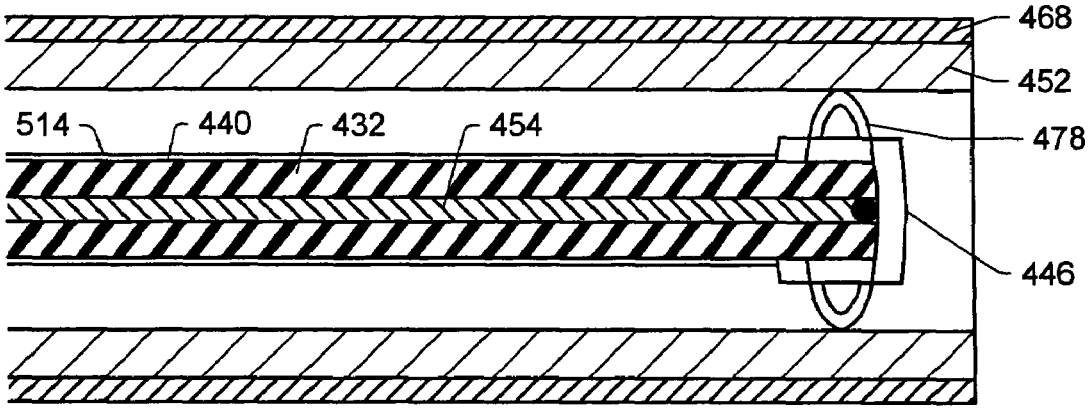
FIG. 87 depicts a cross-sectional representation of an embodiment of a conductor-in-conduit temperature limited heater with an insulated conductor.

FIG. 87 depicts a cross-sectional representation of an embodiment of a conductor-in-conduit temperature limited heater with an insulated conductor. Insulated conductor 514 may include core 454, electrical insulator 432, and jacket 440. Jacket 440 may be made of a corrosion resistant material (for example, stainless steel). Endcap 446 may be placed at an end of insulated conductor 514 to couple core 454 to sliding connector 478. Endcap 446 may be made of non-corrosive, electrically conducting materials such as nickel or stainless steel. Endcap 446 may be coupled to the end of insulated conductor 514 by any suitable method (for example, welding, soldering, braising). Sliding connector 478 may electrically couple core 454 and endcap 446 to ferromagnetic conductor 452. Conduit 468 may provide support for ferromagnetic conductor 452 at elevated temperatures.

Figure 88:
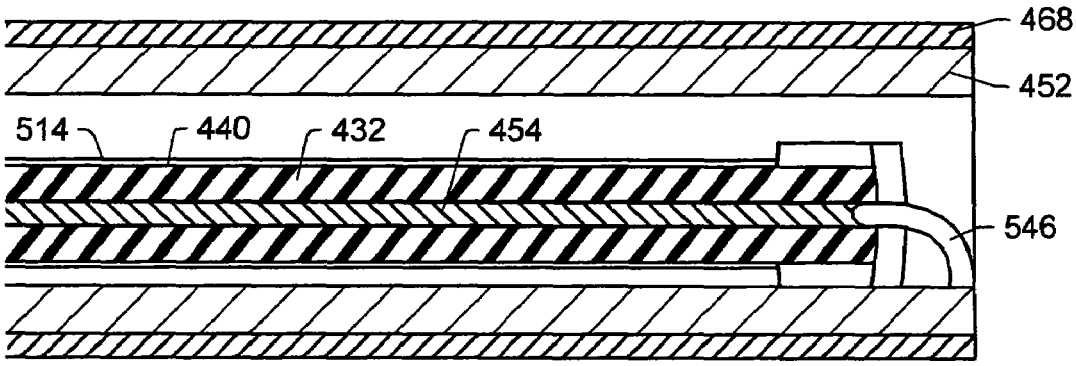
FIG. 88 depicts a cross-sectional representation of an embodiment of an insulated conductor-in-conduit temperature limited heater.

FIG. 88 depicts a cross-sectional representation of an embodiment of an insulated conductor-in-conduit temperature limited heater. Insulated conductor 514 may include core 454, electrical insulator 432, and jacket 440. Insulated conductor 514 may be coupled to ferromagnetic conductor 452 with connector 546. Connector 546 may be made of non-corrosive, electrically conducting materials such as nickel or stainless steel. Connector 546 may be coupled to insulated conductor 514 and coupled to ferromagnetic conductor 452 using suitable methods for electrically coupling (for example, welding, soldering, braising). Insulated conductor 514 may be placed along a wall of ferromagnetic conductor 452. Insulated conductor 514 may provide mechanical support for ferromagnetic conductor 452 at elevated temperatures. In some embodiments, other structures (for example, a conduit) are used to provide mechanical support for ferromagnetic conductor 452.

Figure 89:
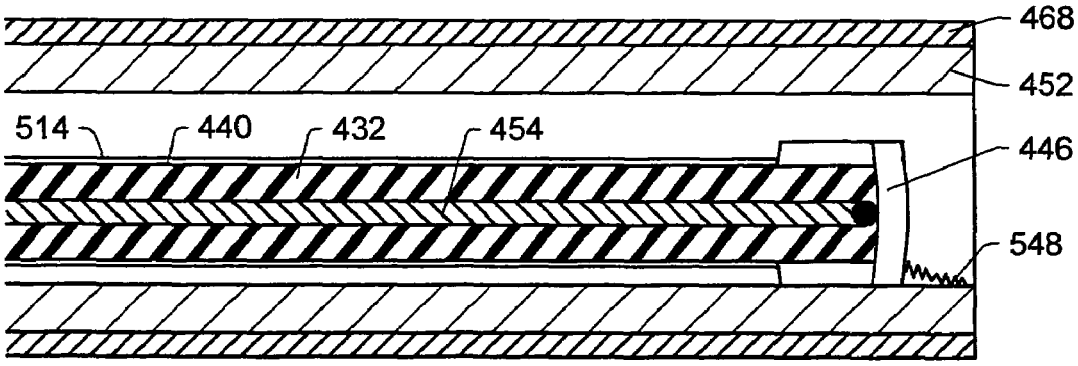
FIG. 89 depicts a cross-sectional representation of an embodiment of an insulated conductor-in-conduit temperature limited heater.

FIG. 89 depicts a cross-sectional representation of an embodiment of an insulated conductor-in-conduit temperature limited heater. Insulated conductor 514 may be coupled to endcap 446. Endcap 446 may be coupled to coupling 548. Coupling 548 may electrically couple insulated conductor 514 to ferromagnetic conductor 452. Coupling 548 may be a flexible coupling. For example, coupling 548 may include flexible materials (for example, braided wire). Coupling 548 may be made of non-corrosive materials such as nickel, stainless steel, and/or copper.

Figure 90:
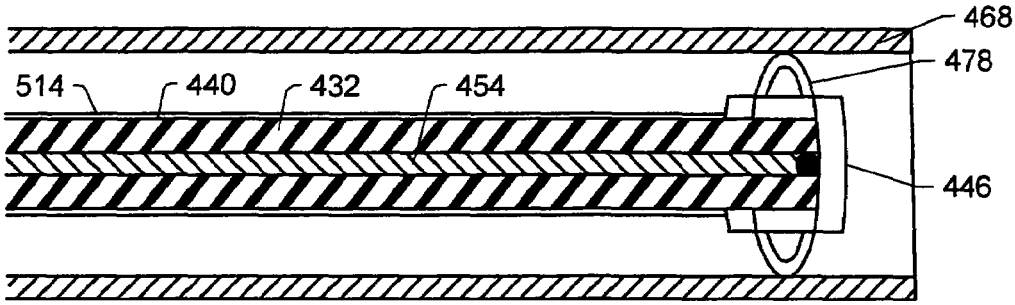
FIG. 90 depicts a cross-sectional representation of an embodiment of a conductor-in-conduit temperature limited heater with an insulated conductor.

FIG. 90 depicts a cross-sectional representation of an embodiment of a conductor-in-conduit temperature limited heater with an insulated conductor. Insulated conductor 514 includes core 454, electrical insulator 432, and jacket 440. Jacket 440 is made of a highly electrically conductive material such as copper. Core 454 is made of a lower temperature ferromagnetic material such as such as Alloy 42-6, Alloy 32, Invar 36, iron-nickel-chromium alloys, iron-nickel alloys, nickel alloys, or nickel-chromium alloys. In certain embodiments, the materials of jacket 440 and core 454 are reversed so that the jacket is the ferromagnetic conductor and the core is the highly conductive portion of the heater. Ferromagnetic material used in jacket 440 or core 454 may have a thickness greater than the skin depth at the Curie temperature (for example, 2 to 3 times the skin depth at the Curie temperature). Endcap 446 is placed at an end of insulated-conductor 514 to couple core 454 to sliding connector 478. Endcap 446 is made of non-corrosive, electrically conducting materials such as nickel or stainless steel. In certain embodiments, conduit 468 is a hollow sucker rod made from, for example, carbon steel.

Figure 91:
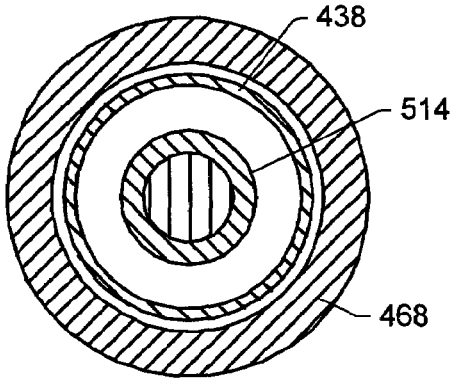
FIGS. 91 and 92 depict cross-sectional views of an embodiment of a temperature limited heater that includes an insulated conductor.
Figure 92:
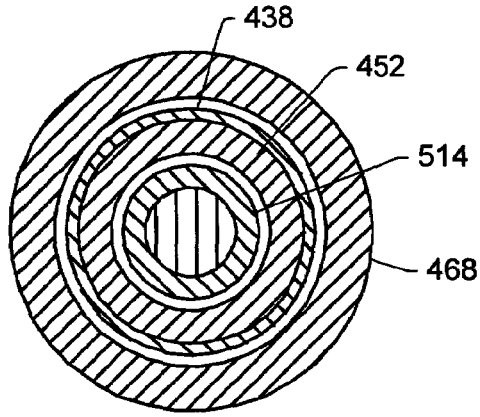

FIGS. 91 and 92 depict cross-sectional views of an embodiment of a temperature limited heater that includes an insulated conductor. FIG. 91 depicts a cross-sectional view of an embodiment of an overburden section of the temperature limited heater. The overburden section may include insulated conductor 514 placed in conduit 468. Conduit 468 may be 1¼" Schedule 80 carbon steel pipe internally clad with copper in the overburden section. Insulated conductor 514 may be a mineral insulated cable or polymer insulated cable. Conductive layer 438 may be placed in the annulus between insulated conductor 514 and conduit 468. Conductive layer 438 may be approximately 2.5 cm diameter copper tubing. The overburden section may be coupled to the heating section of the heater. FIG. 92 depicts a cross-sectional view of an embodiment of a heating section of the temperature limited heater. Insulated conductor 514 in the heating section may be a continuous portion of insulated conductor 514 in the overburden section. Ferromagnetic conductor 452 may be coupled to conductive layer 438. In certain embodiments, conductive layer 438 in the heating section is copper drawn over ferromagnetic conductor 452 and coupled to conductive layer 438 in the overburden section. Conduit 468 may include a heating section and an overburden section. These two sections may be coupled together to form conduit 468. The heating section may be 1¼" Schedule 80 347H stainless steel pipe. An end cap, or other suitable electrical connector, may couple ferromagnetic conductor 452 to insulated conductor 514 at a lower end of the heater. The lower end of the heater is understood to be the end farthest from the point the heater enters the hydrocarbon layer from the overburden section.

Figure 93:
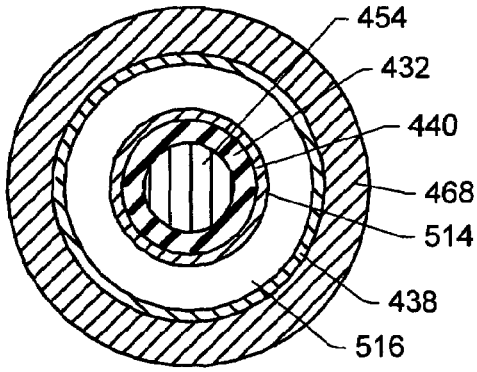
FIGS. 93 and 94 depict cross-sectional views of an embodiment of a temperature limited heater that includes an insulated conductor.
Figure 94:
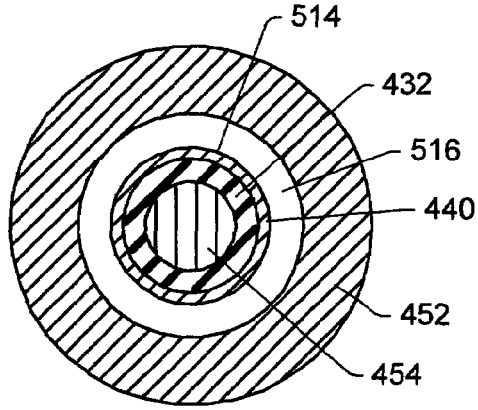

FIGS. 93 and 94 depict cross-sectional views of an embodiment of a temperature limited heater that includes an insulated conductor. FIG. 93 depicts a cross-sectional view of an embodiment of an overburden section of the temperature limited heater. Insulated conductor 514 may include core 454, electrical insulator 432, and jacket 440. Insulated conductor 514 may have a diameter of about 1.5 cm. Core 454 may be copper. Electrical insulator 432 may be silicon nitride, boron nitride, or magnesium oxide. Jacket 440 may be copper in the overburden section to reduce heat losses. Conduit 468 may be 1" Schedule 40 carbon steel in the overburden section. Conductive layer 438 may be coupled to conduit 468. Conductive layer 438 may be copper with a thickness of about 0.2 cm to reduce heat losses in the overburden section. Gap 516 may be an annular space between insulated conductor 514 and conduit 468. FIG. 94 depicts a cross-sectional view of an embodiment of a heating section of the temperature limited heater. Insulated conductor 514 in the heating section may be coupled to insulated conductor 514 in the overburden section. Jacket 440 in the heating section may be made of a corrosion resistant material (for example, 825 stainless steel). Ferromagnetic conductor 452 may be coupled to conduit 468 in the overburden section. Ferromagnetic conductor 452 may be Schedule 160 409, 410, or 446 stainless steel pipe. Gap 516 may be between ferromagnetic conductor 452 and insulated conductor 514. An end cap, or other suitable electrical connector, may couple ferromagnetic conductor 452 to insulated conductor 514 at a distal end of the heater. The distal end of the heater is understood to be the end farthest from the overburden section.

In certain embodiments, a temperature limited heater includes a flexible cable (for example, a furnace cable) as the inner conductor. For example, the inner conductor may be a 27% nickel-clad or stainless steel-clad stranded copper wire with four layers of mica tape surrounded by a layer of ceramic and/or mineral fiber (for example, alumina fiber, aluminosilicate fiber, borosilicate fiber, or aluminoborosilicate fiber). A stainless steel-clad stranded copper wire furnace cable may be available from Anomet Products, Inc. (Shrewsbury, Mass.). The inner conductor may be rated for applications at temperatures of 1000° C. or higher. The inner conductor may be pulled inside a conduit. The conduit may be a ferromagnetic conduit (for example, a ¾" Schedule 80 446 stainless steel pipe). The conduit may be covered with a layer of copper, or other electrical conductor, with a thickness of about 0.3 cm or any other suitable thickness. The assembly may be placed inside a support conduit (for example, a 1¼" Schedule 80 347H or 347HH stainless steel tubular). The support conduit may provide additional creep-rupture strength and protection for the copper and the inner conductor. For uses at temperatures greater than about 1000° C., the inner copper conductor may be plated with a more corrosion resistant alloy (for example, Incoloy® 825) to inhibit oxidation. In some embodiments, the top of the temperature limited heater is sealed to inhibit air from contacting the inner conductor.

In some embodiments, a ferromagnetic conductor of a temperature limited heater includes a copper core (for example, a 1.27 cm diameter copper core) placed inside a first steel conduit (for example, a 1" Schedule 80 347H or 347HH stainless steel pipe). A second steel conduit (for example, a 1" Schedule 80 446 stainless steel pipe) may be drawn down over the first steel conduit assembly. The first steel conduit may provide strength and creep resistance while the copper core may provide a high turndown ratio.

In some embodiments, a ferromagnetic conductor of a temperature limited heater (for example, a center or inner conductor of a conductor-in-conduit temperature limited heater) includes a heavy walled conduit (for example, an extra heavy wall 410 stainless steel pipe). The heavy walled conduit may have a diameter of about 2.5 cm. The heavy walled conduit may be drawn down over a copper rod. The copper rod may have a diameter of about 1.3 cm. The resulting heater may include a thick ferromagnetic sheath containing the copper rod. The thick ferromagnetic sheath may be the heavy walled conduit with, for example, about a 2.6 cm outside diameter after drawing. The heater may have a turndown ratio of about 8:1. The thickness of the heavy walled conduit may be selected to inhibit deformation of the heater. A thick ferromagnetic conduit may provide deformation resistance while adding minimal expense to the cost of the heater.

In another embodiment, a temperature limited heater includes a substantially U-shaped heater with a ferromagnetic cladding over a non-ferromagnetic core (in this context, the "U" may have a curved or, alternatively, orthogonal shape). A U-shaped, or hairpin, heater may have insulating support mechanisms (for example, polymer or ceramic spacers) that inhibit the two legs of the hairpin from electrically shorting to each other. In some embodiments, a hairpin heater is installed in a casing (for example, an environmental protection casing). The insulators may inhibit electrical shorting to the casing and may facilitate installation of the heater in the casing. The cross section of the hairpin heater may be, but is not limited to, circular, elliptical, square, or rectangular.

Figure 95:
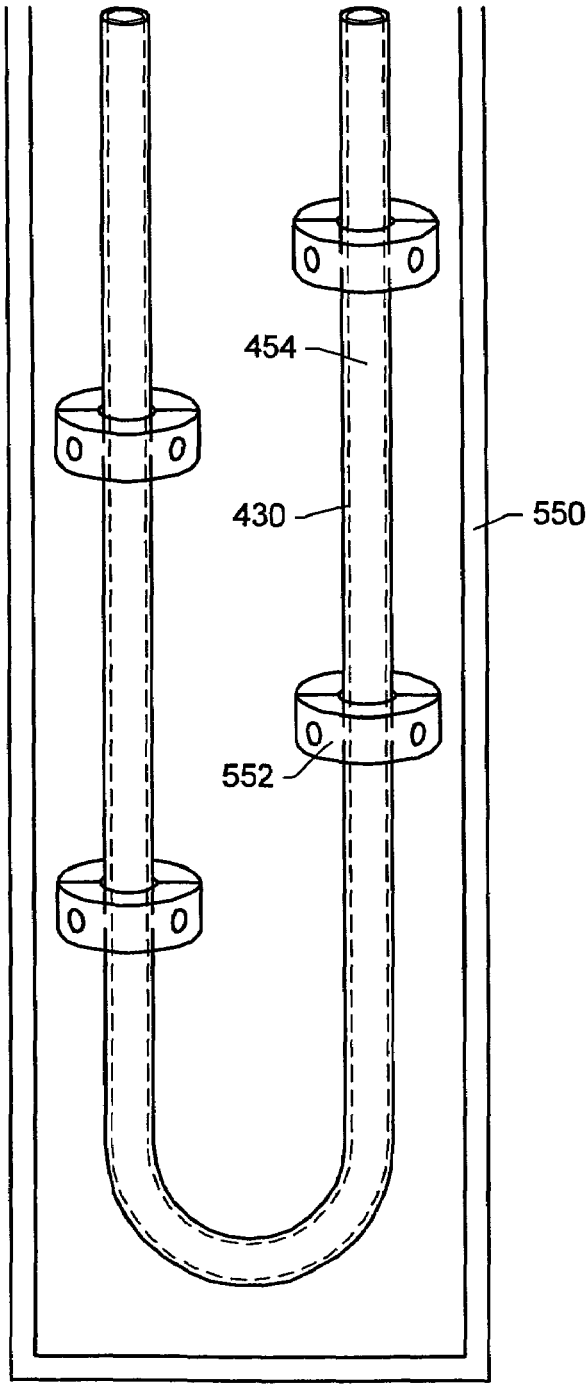
FIG. 95 depicts a schematic of an embodiment of a temperature limited heater.

FIG. 95 depicts an embodiment of a temperature limited heater with a hairpin inner conductor. Inner conductor 430 may be placed in a hairpin configuration with two legs coupled by a substantially U-shaped section at or near the bottom of the heater. Current may enter inner conductor 430 through one leg and exit through the other leg. Inner conductor 430 may be, but is not limited to, ferritic stainless steel, carbon steel, or iron. Core 454 may be placed inside inner conductor 430. In certain embodiments, inner conductor 430 may be clad to core 454. Core 454 may be a copper rod. The legs of the heater may be insulated from each other and from casing 550 by spacers 552. Spacers 552 may be alumina spacers (for example, about 90% to about 99.8% alumina) or silicon nitride spacers. Weld beads or other protrusions may be placed on inner conductor 430 to maintain a location of spacers 552 on the inner conductor. In some embodiments, spacers 552 include two sections that are fastened together around inner conductor 430. Casing 550 may be an environmentally protective casing made of, for example, stainless steel.

In certain embodiments, a temperature limited heater incorporates curves, helixes, bends, or waves in a relatively straight heater to allow thermal expansion and contraction of the heater without overstressing materials in the heater. When a cool heater is heated or a hot heater is cooled, the heater expands or contracts in proportion to the change in temperature and the coefficient of thermal expansion of materials in the heater. For long straight heaters that undergo wide variations in temperature during use and are fixed at more than one point in the wellbore (for example, due to mechanical deformation of the wellbore), the expansion or contraction may cause the heater to bend, kink, and/or pull apart. Use of an "S" bend or other curves, helixes, bends, or waves in the heater at intervals in the heated length may provide a spring effect and allow the heater to expand or contract more gently so that the heater does not bend, kink, or pull apart.

Figure 96:
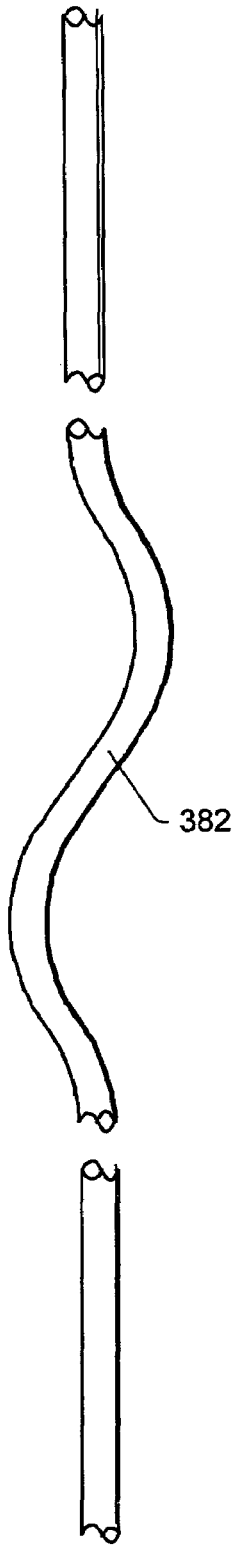
FIG. 96 depicts an embodiment of an "S" bend in a heater.

A 310 stainless steel heater subjected to about 500° C. temperature change may shrink/grow approximately 0.85% of the length of the heater with this temperature change. Thus, a length of about 3 m of a heater would contract about 2.6 cm when it cools through 500° C. If a long heater were affixed at about 3 m intervals, such a change in length could stretch and, possibly, break the heater. FIG. 96 depicts an embodiment of an "S" bend in a heater. The additional material in the "S" bend may allow for thermal contraction or expansion of heater 382 without damage to the heater.

In some embodiments, a temperature limited heater includes a sandwich construction with both current supply and current return paths separated by an insulator. The sandwich heater may include two outer layers of conductor, two inner layers of ferromagnetic material, and a layer of insulator between the ferromagnetic layers. The cross-sectional dimensions of the heater may be optimized for mechanical flexibility and spoolability. The sandwich heater may be formed as a bimetallic strip that is bent back upon itself. The sandwich heater may be inserted in a casing, such as an environmental protection casing. The sandwich heater may be separated from the casing with an electrical insulator.

A heater may include a section that passes through an overburden. In some embodiments, the portion of the heater in the overburden does not need to supply as much heat as a portion of the heater adjacent to hydrocarbon layers that are to be subjected to in situ conversion. In certain embodiments, a substantially non-heating section of a heater has limited or no heat output. A substantially non-heating section of a heater may be located adjacent to layers of the formation (for example, rock layers, non-hydrocarbon layers, or lean layers) that remain advantageously unheated. A substantially non-heating section of a heater may include a copper or aluminum conductor instead of a ferromagnetic conductor. In some embodiments, a substantially non-heating section of a heater includes a copper or copper alloy inner conductor. A substantially non-heating section may also include a copper outer conductor clad with a corrosion resistant alloy. In some embodiments, an overburden section includes a relatively thick ferromagnetic portion to inhibit crushing.

In certain embodiments, a temperature limited heater provides some heat to the overburden portion of a heater well and/or production well. Heat supplied to the overburden portion may inhibit formation fluids (for example, water and hydrocarbons) from refluxing or condensing in the wellbore. Refluxing fluids may use a large portion of heat energy supplied to a target section of the wellbore, thus limiting heat transfer from the wellbore to the target section.

A temperature limited heater may be constructed in sections that are coupled (welded) together. The sections may be 10 m long or longer. Construction materials for each section are chosen to provide a selected heat output for different parts of the formation. For example, an oil shale formation may contain layers with highly variable richnesses. Providing selected amounts of heat to individual layers, or multiple layers with similar richnesses, improves heating efficiency of the formation and/or inhibits collapse of the wellbore. A splice section may be formed between the sections, for example, by welding the inner conductors, filling the splice section with an insulator, and then welding the outer conductor. Alternatively, the heater is formed from larger diameter tubulars and drawn down to a desired length and diameter. A boron nitride, silicon nitride, magnesium oxide, or other type of insulation layer may be added by a weld-fill-draw method (starting from metal strip) or a fill-draw method (starting from tubulars) well known in the industry in the manufacture of mineral insulated heater cables. The assembly and filling can be done in a vertical or a horizontal orientation. The final heater assembly may be spooled onto a large diameter spool (for example, 1 m, 2 m, 3 m, or more in diameter) and transported to a site of a formation for subsurface deployment. Alternatively, the heater may be assembled on site in sections as the heater is lowered vertically into a wellbore.

The temperature limited heater may be a single-phase heater or a three-phase heater. In a three-phase heater embodiment, the temperature limited heater has a delta or a wye configuration. Each of the three ferromagnetic conductors in the three-phase heater may be inside a separate sheath. A connection between conductors may be made at the bottom of the heater inside a splice section. The three conductors may remain insulated from the sheath inside the splice section.

Figure 97:
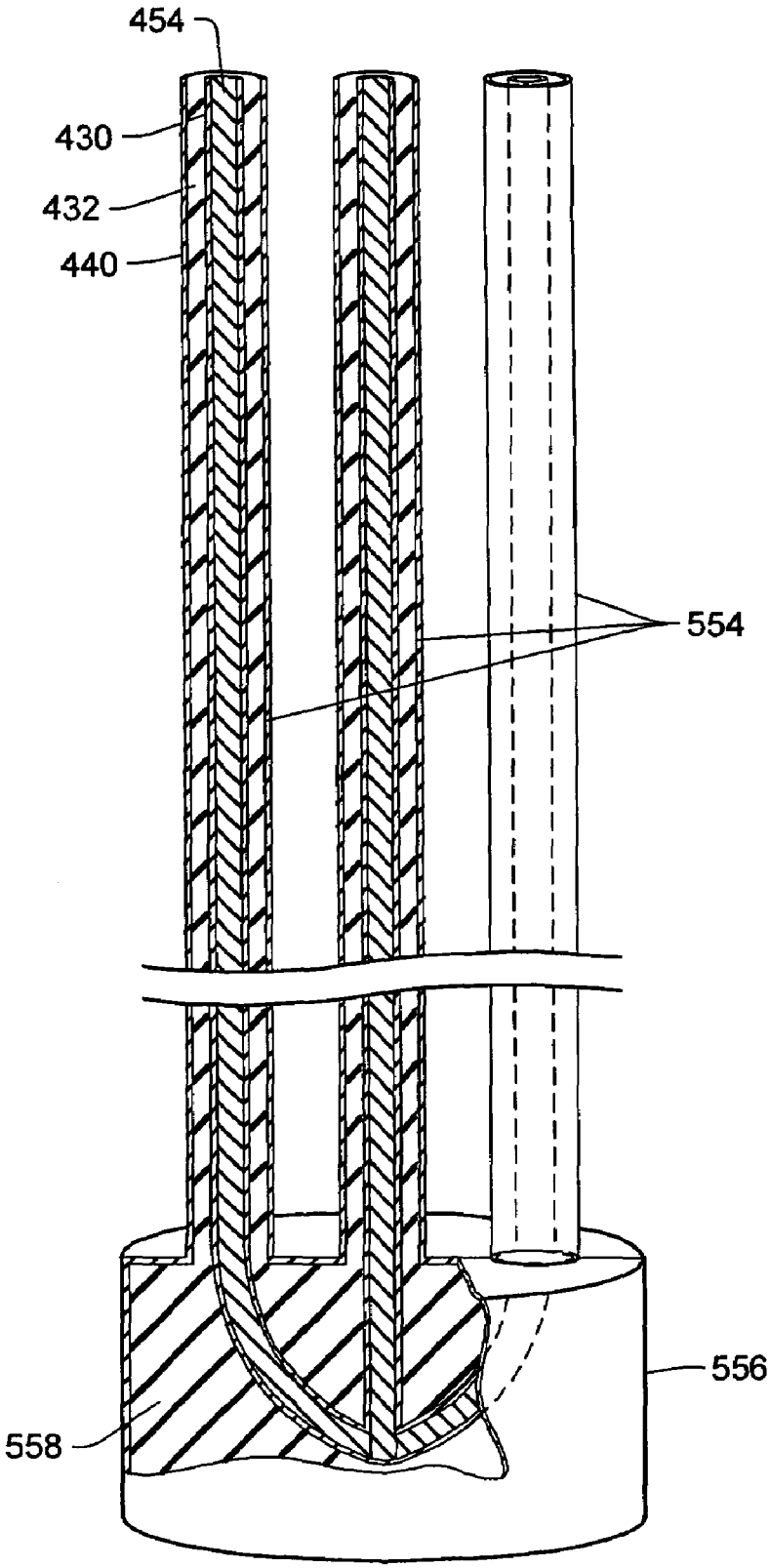
FIG. 97 depicts an embodiment of a three-phase temperature limited heater, with a portion shown in cross section.

FIG. 97 depicts an embodiment of a three-phase temperature limited heater with ferromagnetic inner conductors. Each leg 554 has inner conductor 430, core 454, and jacket 440. Inner conductors 430 are ferritic stainless steel or 1% carbon steel. Inner conductors 430 have core 454. Core 454 may be copper. Each inner conductor 430 is coupled to its own jacket 440. Jacket 440 is a sheath made of a corrosion resistant material (such as 304H stainless steel). Electrical insulator 432 is placed between inner conductor 430 and jacket 440. Inner conductor 430 is ferritic stainless steel or carbon steel with an outside diameter of 1.14 cm and a thickness of 0.445 cm. Core 454 is a copper core with a 0.25 cm diameter. Each leg 554 of the heater is coupled to terminal block 556. Terminal block 556 is filled with insulation material 558 and has an outer surface of stainless steel. Insulation material 558 is, in some embodiments, silicon nitride, boron nitride, magnesium oxide or other suitable electrically insulating material. Inner conductors 430 of legs 554 are coupled (welded) in terminal block 556. Jackets 440 of legs 554 are coupled (welded) to an outer surface of terminal block 556. Terminal block 556 may include two halves coupled together around the coupled portions of legs 554.

In an embodiment, the heated section of a three-phase heater is about 245 m long. The three-phase heater may be wye connected and operated at a current of about 150 A. The resistance of one leg of the heater may increase from about 1.1 ohms at room temperature to about 3.1 ohms at about 650° C. The resistance of one leg may decrease rapidly above about 720° C. to about 1.5 ohms. The voltage may increase from about 165 V at room temperature to about 465 V at 650° C. The voltage may decrease rapidly above about 720° C. to about 225 V. The heat output per leg may increase from about 102 watts/meter at room temperature to about 285 watts/meter at 650° C. The heat output per leg may decrease rapidly above about 720° C. to about 1.4 watts/meter. Other embodiments of inner conductor 430, core 454, jacket 440, and/or electrical insulator 432 may be used in the three-phase temperature limited heater shown in FIG. 97. Any embodiment of a single-phase temperature limited heater may be used as a leg of a three-phase temperature limited heater.

In some three-phase heater embodiments, three ferromagnetic conductors are separated by insulation inside a common outer metal sheath. The three conductors may be insulated from the sheath or the three conductors may be connected to the sheath at the bottom of the heater assembly. In another embodiment, a single outer sheath or three outer sheaths are ferromagnetic conductors and the inner conductors may be non-ferromagnetic (for example, aluminum, copper, or a highly conductive alloy). Alternatively, each of the three non-ferromagnetic conductors are inside a separate ferromagnetic sheath, and a connection between the conductors is made at the bottom of the heater inside a splice section. The three conductors may remain insulated from the sheath inside the splice section.

Figure 98:
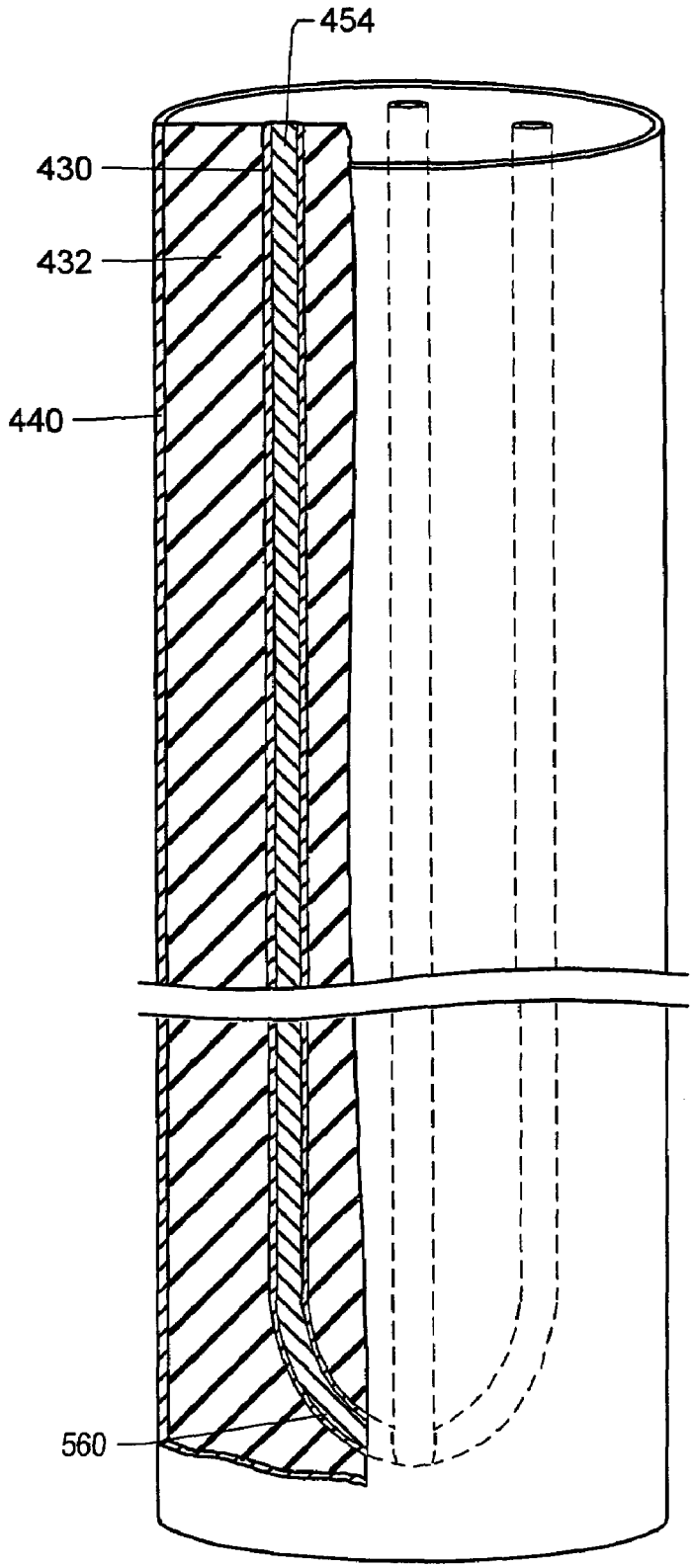
FIG. 98 depicts an embodiment of a three-phase temperature limited heater, with a portion shown in cross section.

FIG. 98 depicts an embodiment of a three-phase temperature limited heater with ferromagnetic inner conductors in a common jacket. Inner conductors 430 surround cores 454. Inner conductors 430 are placed in electrical insulator 432. Inner conductors 430 and electrical insulator 432 are placed in a single jacket 440. Jacket 440 is a sheath corrosion resistant material such as stainless steel. Jacket 440 has an outside diameter of between 2.5 cm and 5 cm (for example, 3.1 cm, 3.5 cm, or 3.8 cm). Inner conductors 430 are coupled at or near the bottom of the heater at termination 560. Termination 560 is a welded termination of inner conductors 430. Inner conductors 430 may be coupled in a wye configuration.

Figure 99:
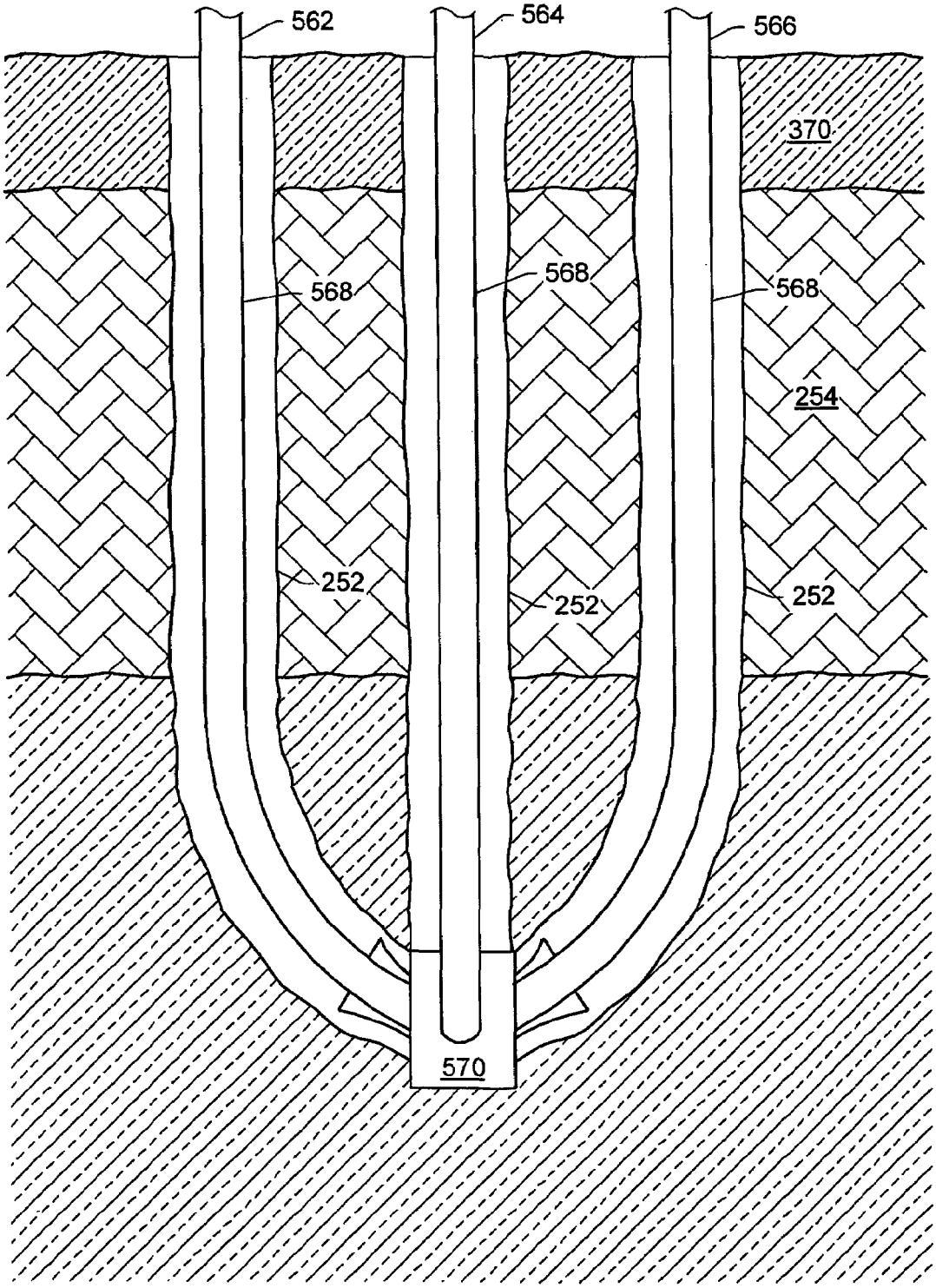
FIG. 99 depicts an embodiment of temperature limited heaters coupled together in a three-phase configuration.

In some embodiments, the three-phase heater includes three legs that are located in separate wellbores. The legs may be coupled in a common contacting section (for example, a central wellbore, a connecting wellbore, or a solution filled contacting section). FIG. 99 depicts an embodiment of temperature limited heaters coupled together in a three-phase configuration. Each leg 562, 564, 566 may be located in separate openings 252 in hydrocarbon layer 254. Each leg 562, 564, 566 may include heating element 568. Each leg 562, 564, 566 may be coupled to single contacting element 570 in one opening 252. Contacting element 570 may electrically couple legs 562, 564, 566 together in a three-phase configuration. Contacting element 570 may be located in, for example, a central opening in the formation. Contacting element 570 may be located in a portion of opening 252 below hydrocarbon layer 254 (for example, an underburden). In certain embodiments, magnetic tracking of a magnetic element located in a central opening (for example, opening 252 with leg 564) is used to guide the formation of the outer openings (for example, openings 252 with legs 562 and 566) so that the outer openings intersect the central opening. The central opening may be formed first using standard wellbore drilling methods. Contacting element 570 may include funnels, guides, or catchers for allowing each leg to be inserted into the contacting element.

Figure 100:
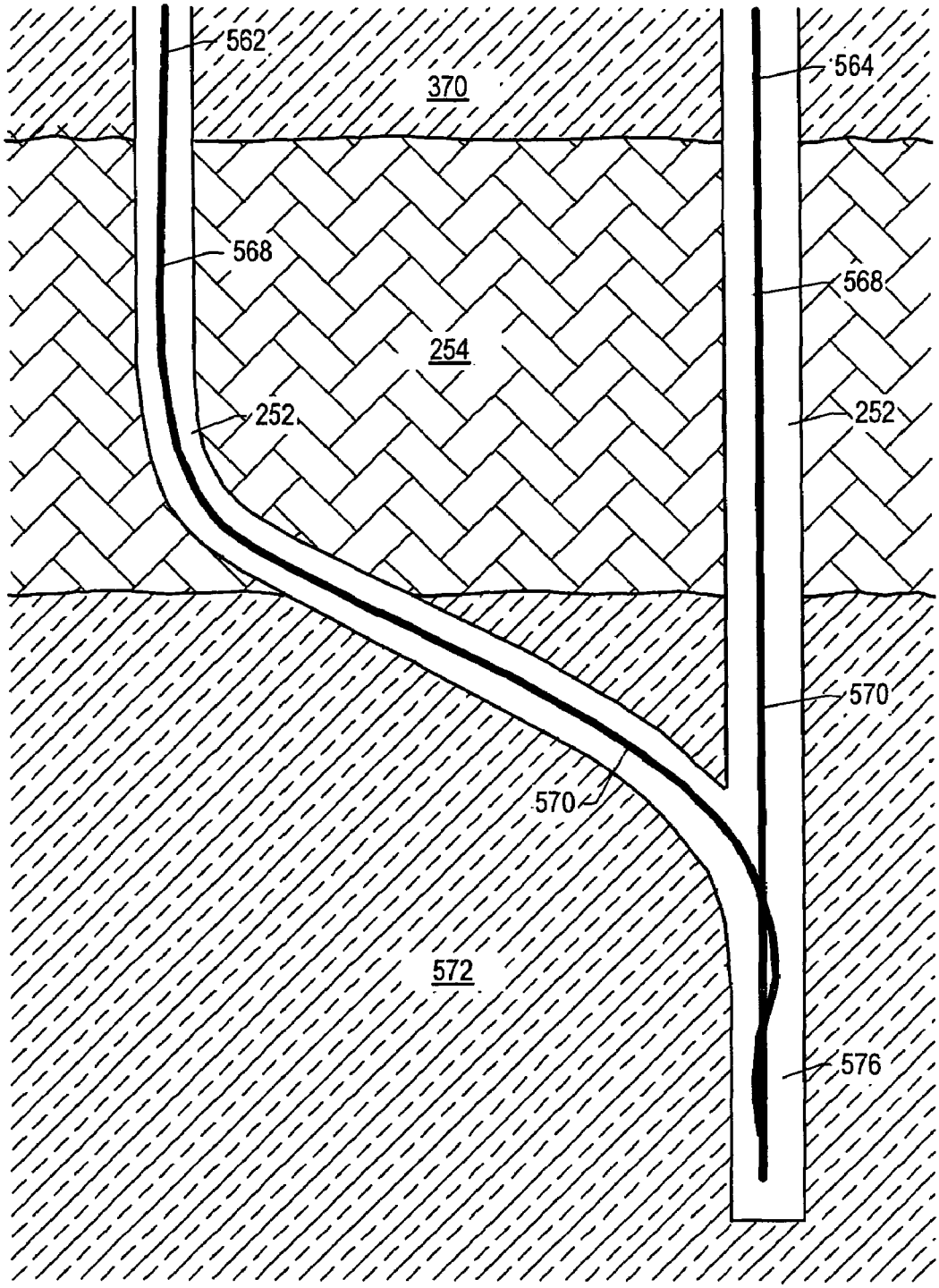
FIG. 100 depicts an embodiment of two temperature limited heaters coupled together in a single contacting section.

In certain embodiments, two legs in separate wellbores intercept in a single contacting section. FIG. 100 depicts an embodiment of two temperature limited heaters coupled together in a single contacting section. Legs 562 and 564 include one or more heating elements 568. Heating elements 568 may include one or more electrical conductors. In certain embodiments, legs 562 and 564 are electrically coupled in a single-phase configuration with one leg positively biased versus the other leg so that current flows downhole through one leg and returns through the other leg.

Heating elements 568 in legs 562 and 564 may be temperature limited heaters. In certain embodiments, heating elements 568 are solid rod heaters. For example, heating elements 568 may be rods made of a single ferromagnetic conductor element or composite conductors that include ferromagnetic material. During initial heating when water is present in the formation being heated, heating elements 568 may leak current into hydrocarbon layer 254. The current leaked into hydrocarbon layer 254 may resistively heat the hydrocarbon layer.

In some embodiments (for example, in oil shale formations), heating elements 568 do not need support members. Heating elements 568 may be partially or slightly bent, curved, made into an S-shape, or made into a helical shape to allow for expansion and/or contraction of the heating elements. In certain embodiments, solid rod heating elements 568 are placed in small diameter wellbores (for example, about 3¾" (about 9.5 cm) diameter wellbores). Small diameter wellbores may be less expensive to drill or form than larger diameter wellbores.

In certain embodiments, portions of legs 562 and 564 in overburden 370 have insulation (for example, polymer insulation) to inhibit heating the overburden. Heating elements 568 may be substantially vertical and substantially parallel to each other in hydrocarbon layer 254. At or near the bottom of hydrocarbon layer 254, leg 562 may be directionally drilled towards leg 564 to intercept leg 564 in contacting section 572. Directional drilling may be done by, for example, Vector Magnetics LLC (Ithaca, N.Y.). The depth of contacting section 572 depends on the length of bend in leg 562 needed to intercept leg 564. For example, for a 40 ft (about 12 m) spacing between vertical portions of legs 562 and 564, about 200 ft (about 61 m) is needed to allow the bend of leg 562 to intercept leg 564.

Figure 101:
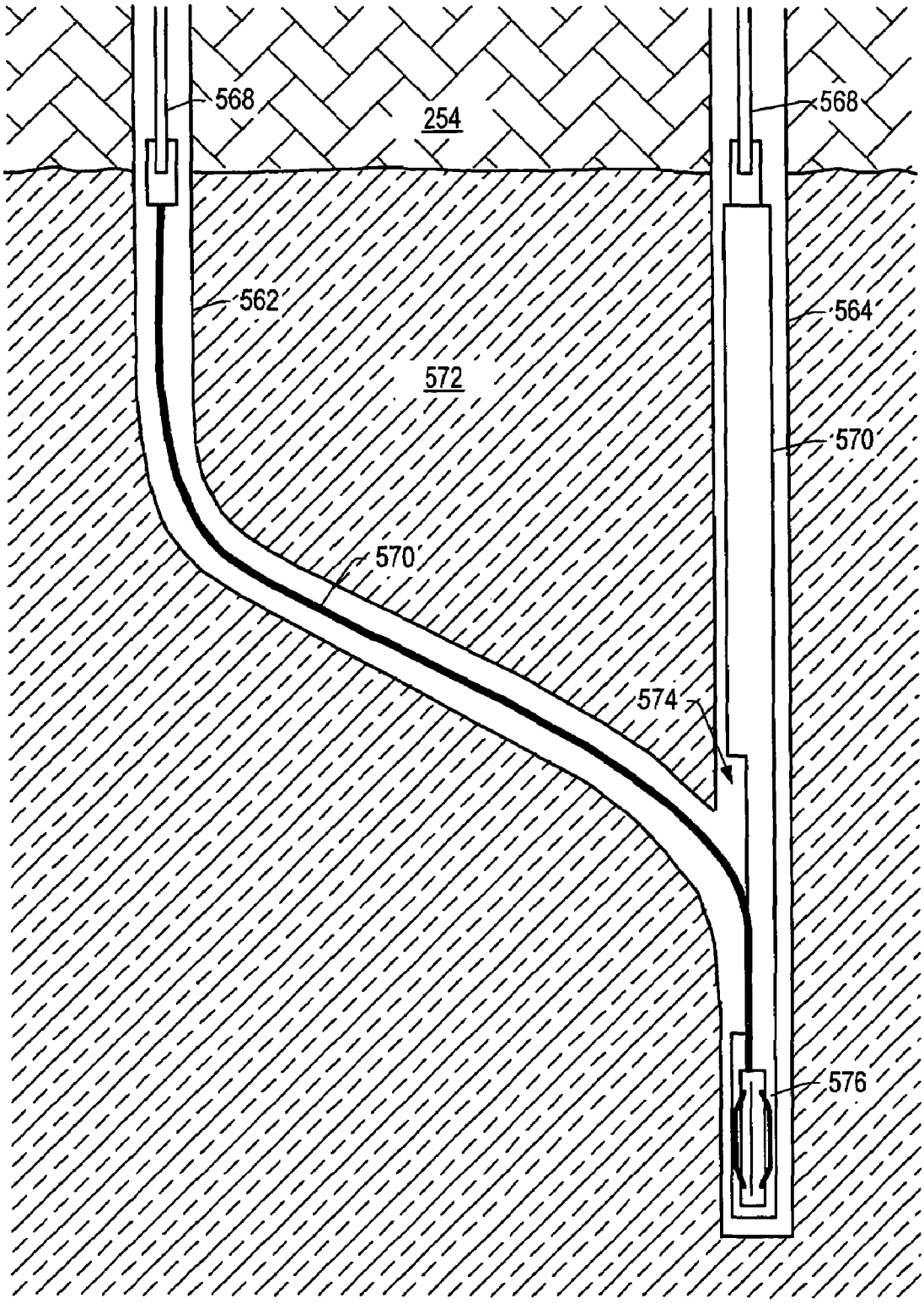
FIG. 101 depicts an embodiment of two temperature limited heaters with legs coupled in a contacting section.

FIG. 101 depicts an embodiment for coupling legs 562 and 564 in contacting section 572. Heating elements 568 are coupled to contacting elements 570 at or near junction of contacting section 572 and hydrocarbon layer 254. Contacting elements 570 may be copper or another suitable electrical conductor. In certain embodiments, contacting element 570 in leg 564 is a liner with opening 574. Contacting element 570 from leg 562 passes through opening 574. Contactor 576 is coupled to the end of contacting element 570 from leg 562. Contactor 576 provides electrical coupling between contacting elements in legs 562 and 564.

Figure 102:
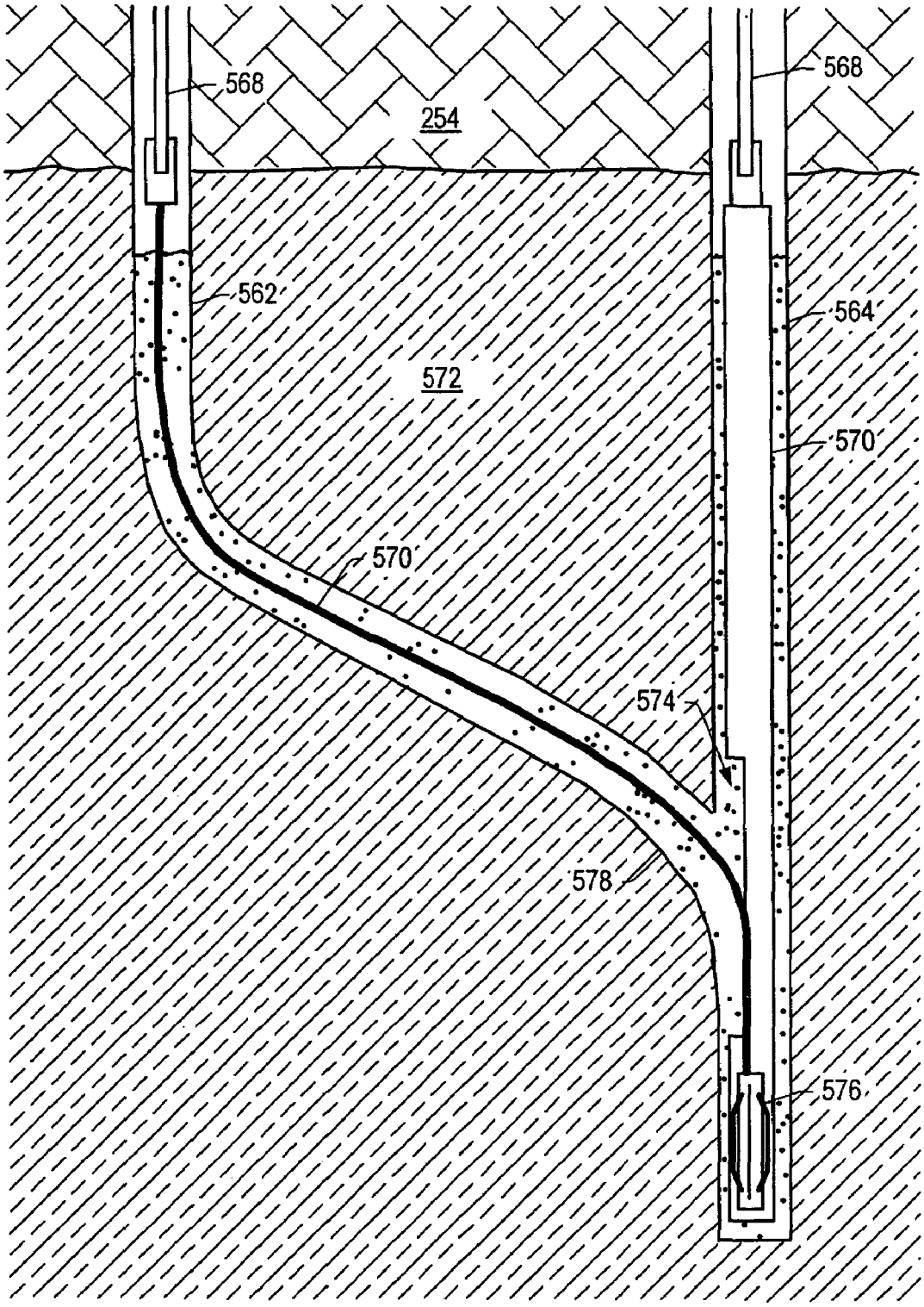
FIG. 102 depicts an embodiment of two temperature limited heaters with legs coupled in a contacting section with contact solution.

FIG. 102 depicts an embodiment for coupling legs 562 and 564 in contacting section 572 with contact solution 578 in the contacting section. Contact solution 578 is placed in portions of leg 562 and/or portions of leg 564 with contacting elements 570. Contact solution 578 promotes electrical contact between contacting elements 570. Contact solution 578 may be graphite based cement or another high electrical conductivity cement or solution (for example, brine or other ionic solutions).

Figure 103:
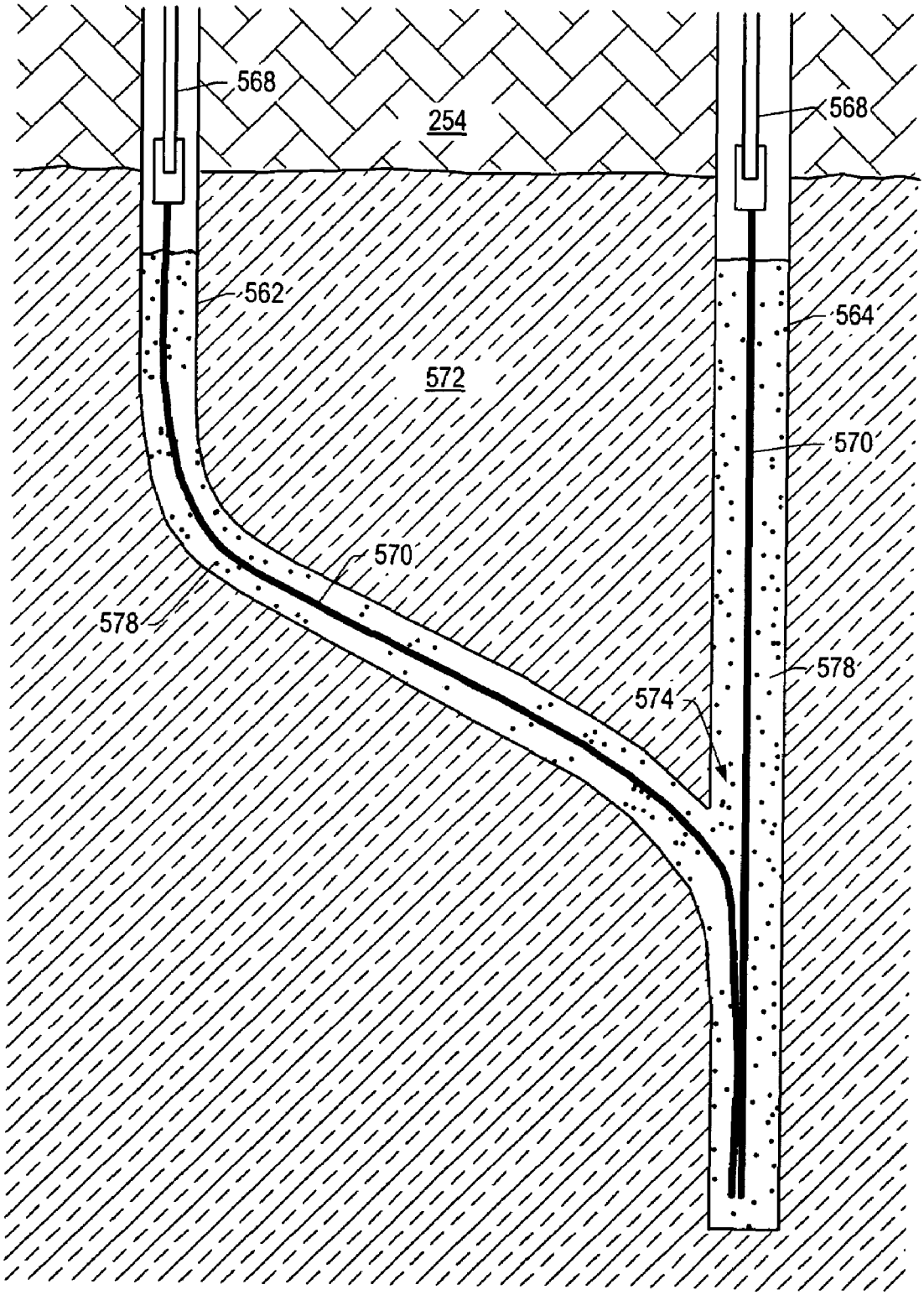
FIG. 103 depicts an embodiment of two temperature limited heaters with legs coupled without a contactor in a contacting section.

In some embodiments, electrical contact is made between contacting elements 570 using only contact solution 578. FIG. 103 depicts an embodiment for coupling legs 562 and 564 in contacting section 572 without a contactor. Contacting elements 570 may or may not touch in contacting section 572. Electrical contact between contacting elements 570 in contacting section 572 is made using contact solution 578.

In certain embodiments, contacting elements 570 include one or more fins or projections. The fins or projections may increase an electrical contact area of contacting elements 570. In some embodiments, legs 562 and 564 (for example, electrical conductors in heating elements 568) are electrically coupled together but do not physically contact each other. This type of electrical coupling may be accomplished with, for example, contact solution 578.

In some embodiments, the temperature limited heater includes a single ferromagnetic conductor with current returning through the formation. The heating element may be a ferromagnetic tubular (in an embodiment, 446 stainless steel (with 25% by weight chromium and a Curie temperature above 620° C.) clad over 304H, 316H, or 347H stainless steel) that extends through the heated target section and makes electrical contact to the formation in an electrical contacting section. The electrical contacting section may be located below a heated target section. For example, the electrical contacting section is in the underburden of the formation. In an embodiment, the electrical contacting section is a section 60 m deep with a larger diameter than the heater wellbore. The tubular in the electrical contacting section is a high electrical conductivity metal. The annulus in the electrical contacting section may be filled with a contact material/solution such as brine or other materials that enhance electrical contact with the formation (for example, metal beads, hematite, and/or graphite based cement). The electrical contacting section may be located in a low resistivity brine saturated zone (with higher porosity) to maintain electrical contact through the brine. In the electrical contacting section, the tubular diameter may also be increased to allow maximum current flow into the formation with lower heat dissipation in the fluid. Current may flow through the ferromagnetic tubular in the heated section and heat the tubular.

Figure 104:
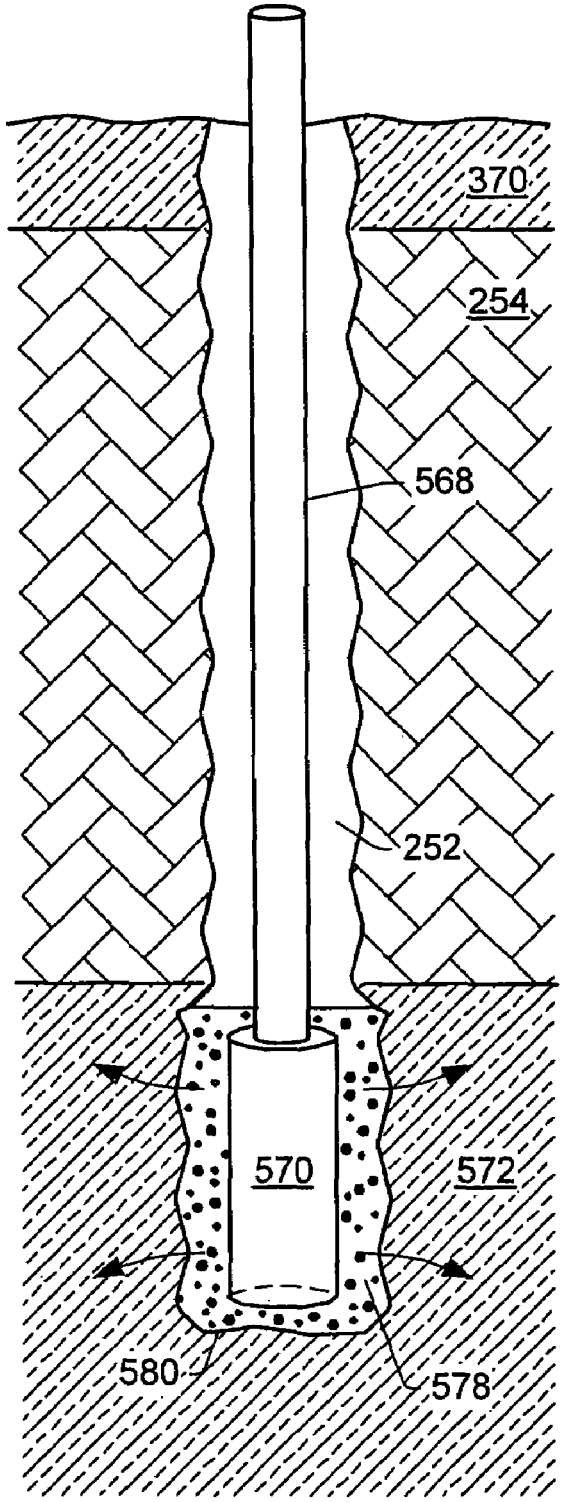
FIG. 104 depicts an embodiment of a temperature limited heater with current return through the formation.

FIG. 104 depicts an embodiment of a temperature limited heater with current return through the formation. Heating element 568 may be placed in opening 252 in hydrocarbon layer 254. Heating element 568 may be 446 stainless steel clad over a 304H stainless steel tubular that extends through hydrocarbon layer 254. Heating element 568 may be coupled to contacting element 570. Contacting element 570 may have a higher electrical conductivity than heating element 568. Contacting element 570 may be placed in electrical contacting section 572, located below hydrocarbon layer 254. Contacting element 570 may make electrical contact with the earth in contacting section 572. Contacting element 570 may be placed in contacting wellbore 580. Contacting element 570 may have a diameter between about 10 cm and about 20 cm (for example, about 15 cm). The diameter of contacting element 570 may be sized to increase contact area between contacting element 570 and contact solution 578. The contact area may be increased by increasing the diameter of contacting element 570. Increasing the diameter of contacting element 570 may increase the contact area without adding excessive cost to installation and use of the contacting element, contacting wellbore 580, and/or contact solution 578. Increasing the diameter of contacting element 570 may allow sufficient electrical contact to be maintained between the contacting element and contacting section 572. Increasing the contact area may also inhibit evaporation or boiling off of contact solution 578.

Contacting wellbore 580 may be, for example, a section about 60 m deep with a larger diameter wellbore than opening 252. The annulus of contacting wellbore 580 may be filled with contact solution 578. Contact solution 578 may be brine or other material (such as graphite based cement, electrically conducting particles such as hematite, or metal-coated sand or beads) that enhances electrical contact in contacting section 572. In some embodiments, contacting section 572 is a low resistivity brine saturated zone that maintains electrical contact through the brine. Contacting wellbore 580 may be under-reamed to a larger diameter (for example, a diameter between about 25 cm and about 50 cm) to allow maximum current flow into contacting section 572 with low heat output. Current may flow through heating element 568, boiling moisture from the wellbore, and heating until the heat output reduces near or at the Curie temperature.

In an embodiment, three-phase temperature limited heaters are made with current connection through the formation. Each heater includes a single Curie temperature heating element with an electrical contacting section in a brine saturated zone below a heated target section. In an embodiment, three such heaters are connected electrically at the surface in a three-phase wye configuration. The heaters may be deployed in a triangular pattern from the surface. In certain embodiments, the current returns through the earth to a neutral point between the three heaters. The three-phase Curie heaters may be replicated in a pattern that covers the entire formation.

Figure 105:
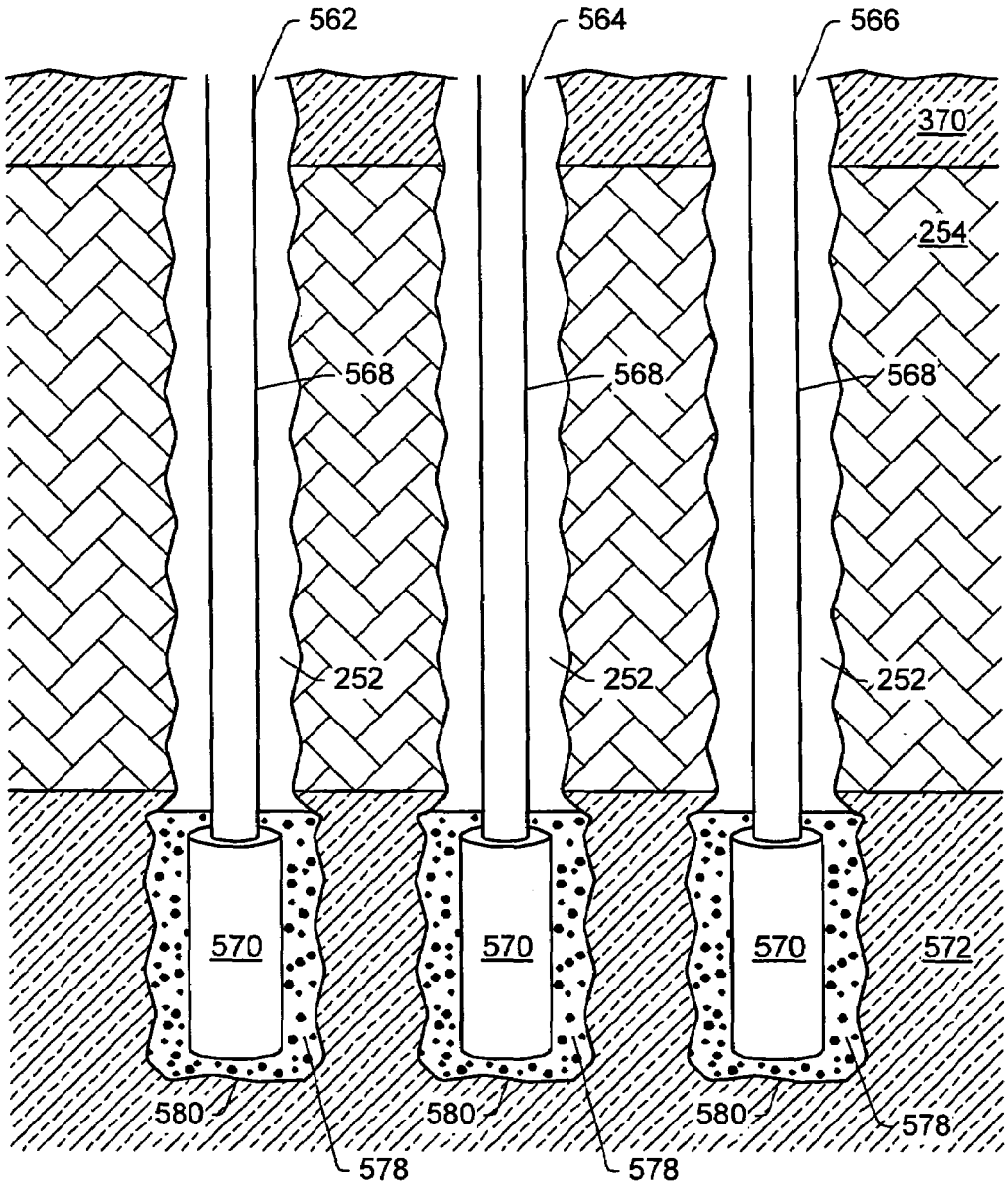
FIG. 105 depicts a representation of an embodiment of a three-phase temperature limited heater with current connection through the formation.
Figure 106:
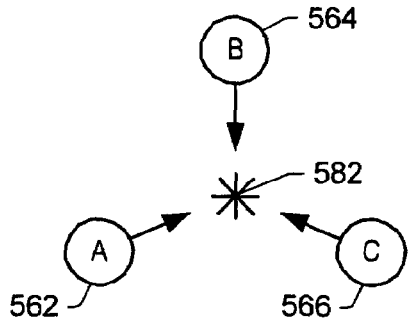
FIG. 106 depicts an aerial view of the embodiment shown in FIG. 105.

FIG. 105 depicts an embodiment of a three-phase temperature limited heater with current connection through the formation. Legs 562, 564, 566 may be placed in the formation. Each leg 562, 564, 566 may have heating element 568 that is placed in opening 252 in hydrocarbon layer 254. Each leg may have contacting element 570 placed in contact solution 578 in contacting wellbore 580. Each contacting element 570 may be electrically coupled to electrical contacting section 572 through contact solution 578. Legs 562, 564, 566 may be connected in a wye configuration that results in a neutral point in electrical contacting section 572 between the three legs. FIG. 106 depicts an aerial view of the embodiment of FIG. 105 with neutral point 582 shown positioned centrally among legs 562, 564, 566.

Figure 107:
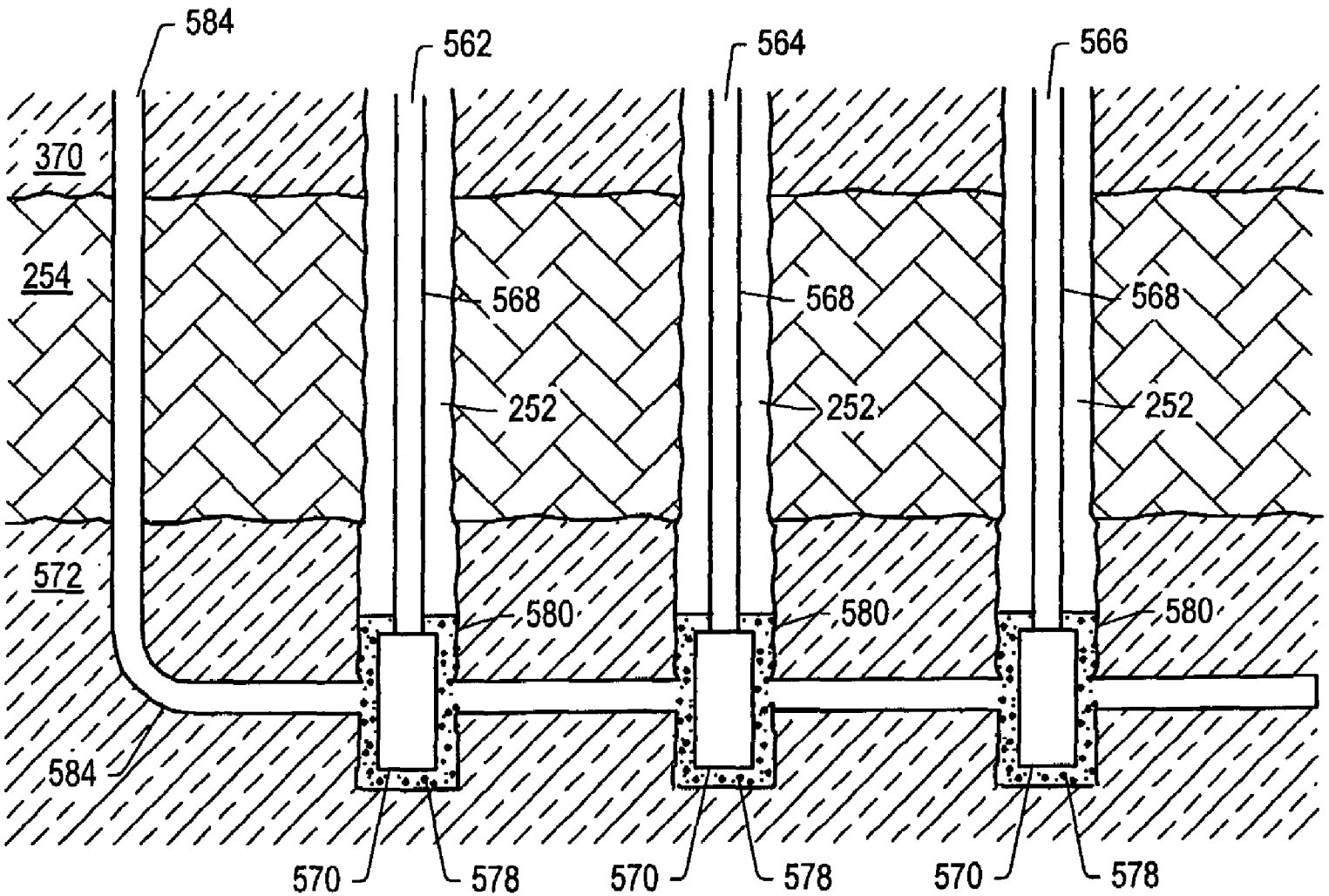
FIG. 107 depicts an embodiment of three temperature limited heaters electrically coupled to a horizontal wellbore in the formation.

FIG. 107 depicts an embodiment of three temperature limited heaters electrically coupled to a horizontal wellbore in the formation. Wellbore 584 may have a substantially horizontal portion in contacting section 572. Openings 252 may be directionally drilled to intersect wellbore 584 in contacting wellbores 580. In some embodiments, wellbore 584 is directionally drilled to intersect openings 252 in contacting wellbores 580. Contacting wellbores 580 may be underreamed. Underreaming may increase the likelihood of intersection between openings 252 and wellbore 584 during drilling and/or increase the contact volume in contacting wellbores 580.

In certain embodiments, legs 562, 564, 566 are coupled in a three-phase wye configuration. In some embodiments, legs 562, 564, 566, along with one or more other legs, are coupled through wellbore 584 in a single phase configuration in which the legs are alternately biased positively and negatively so that current alternately runs up and down the legs. In some embodiments, legs 562, 564, 566 are single phase heaters with current returning to the surface through wellbore 584.

In certain embodiments, legs 562, 564, 566 are electrically coupled in contacting wellbores 580 using contact solution 578. Contact solution 578 may be located in individual contacting wellbores 580 or may be located along the length of the horizontal portion of wellbore 584. In some embodiments, electrical contact is made between legs 562, 564, 566 and/or materials in wellbore 584 through other methods (for example, contactors or contacting elements such as funnels, guides, or catchers).

Figure 108:
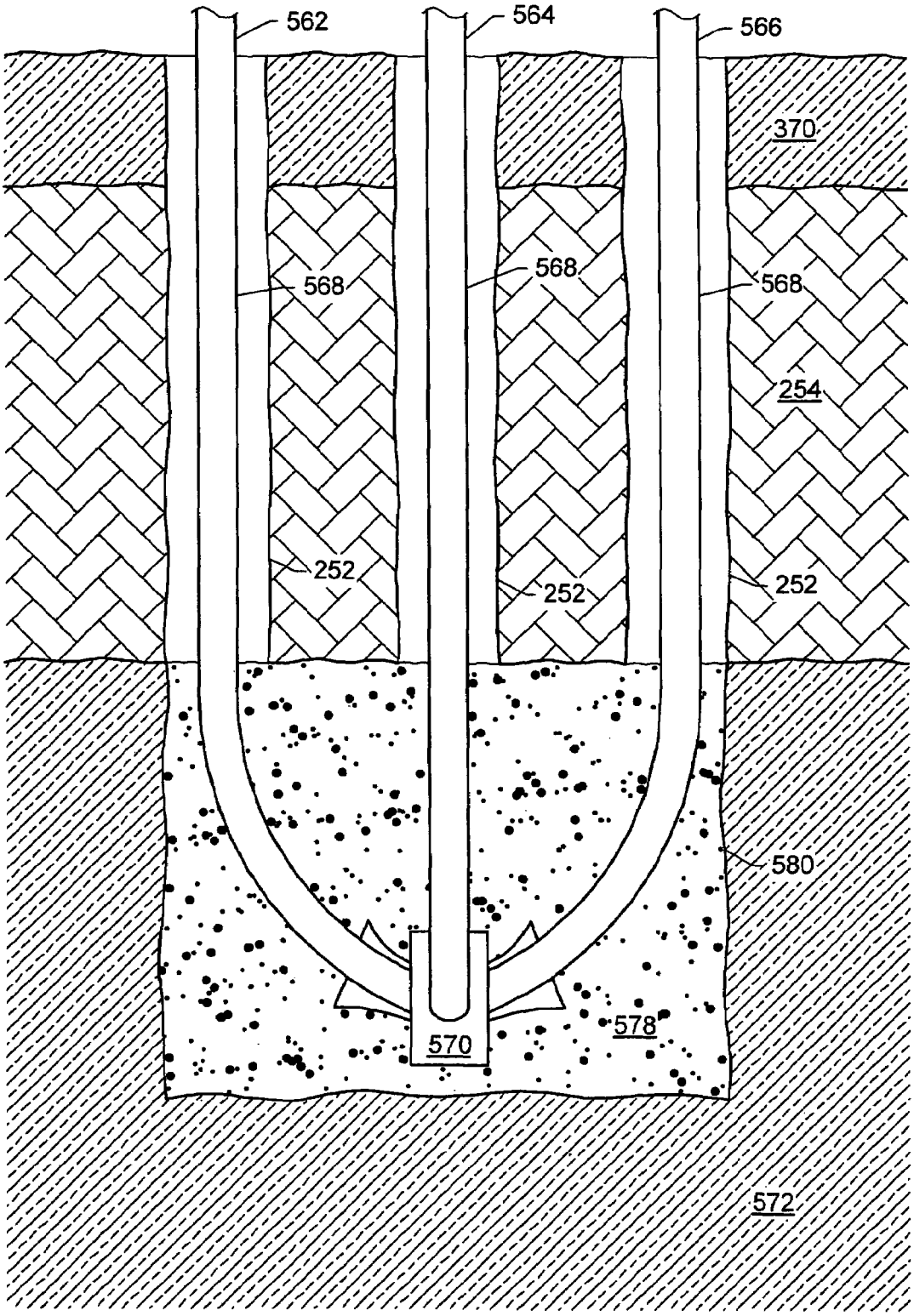
FIG. 108 depicts a representation of an embodiment of a three-phase temperature limited heater with a common current connection through the formation.

FIG. 108 depicts an embodiment of a three-phase temperature limited heater with a common current connection through the formation. In FIG. 108, each leg 562, 564, 566 couples to a single contacting element 570 in a single contacting wellbore 580. Legs 562 and 566 are directionally drilled to intercept leg 564 in wellbore 580. Contact element 570 may include funnels, guides, or catchers for allowing each leg to be inserted into the contacting element. In some embodiments, graphite based cement is used for contact solution 578.

A section of heater through a high thermal conductivity zone may be tailored to deliver more heat dissipation in the high thermal conductivity zone. Tailoring of the heater may be achieved by changing cross-sectional areas of the heating elements (for example, by changing ratios of copper to iron), and/or using different metals in the heating elements. Thermal conductance of the insulation layer may also be modified in certain sections to control the thermal output to raise or lower the apparent Curie temperature.

In an embodiment, the temperature limited heater includes a hollow core or hollow inner conductor. Layers forming the heater may be perforated to allow fluids from the wellbore (for example, formation fluids or water) to enter the hollow core. Fluids in the hollow core may be transported (for example, pumped or gas lifted) to the surface through the hollow core. In some embodiments, the temperature limited heater with the hollow core or the hollow inner conductor is used as a heater/production well or a production well. Fluids such as steam may be injected into the formation through the hollow inner conductor.

In certain embodiments, a temperature limited heater is utilized for heavy oil applications (for example, treatment of relatively permeable formations or tar sands formations). A temperature limited heater may provide a relatively low Curie temperature so that a maximum average operating temperature of the heater is less than 350° C., 300° C., 250° C., 225° C., 200° C., or 150° C. In an embodiment (for example, for a tar sands formation), a maximum temperature of the heater is less than about 250° C. to inhibit olefin generation and production of other cracked products. In some embodiments, a maximum temperature of the heater above about 250° C. is used to produce lighter hydrocarbon products. For example, the maximum temperature of the heater may be at or less than about 500° C.

A heater may heat a volume of formation adjacent to a production wellbore (a near production wellbore region) so that the temperature of fluid in the production wellbore and in the volume adjacent to the production wellbore is less than the temperature that causes degradation of the fluid. The heat source may be located in the production wellbore or near the production wellbore. In some embodiments, the heat source is a temperature limited heater. In some embodiments, two or more heat sources may supply heat to the volume. Heat from the heat source may reduce the viscosity of crude oil in or near the production wellbore. In some embodiments, heat from the heat source mobilizes fluids in or near the production wellbore and/or enhances the radial flow of fluids to the production wellbore. In some embodiments, reducing the viscosity of crude oil allows or enhances gas lifting of heavy oil (approximately at most 10° API gravity oil) or intermediate gravity oil (approximately 12° to 20° API gravity oil) from the production wellbore certain embodiments, the initial API gravity of oil in the formation is at most 10°, at most 20°, at most 25°, or at most 30°. In certain embodiments, the viscosity of oil in the formation is at least 0.05 Pa·s (50 cp). In some embodiments, the viscosity of oil in the formation is at least 0.10 Pa·s (100 cp), at least 0.15 Pa·s (150 cp), or at least at least 0.20 Pa·s (200 cp). Large amounts of natural gas may have to be utilized to provide gas lift of oil with viscosities above 0.05 Pa·s. Reducing the viscosity of oil at or near the production wellbore in the formation to a viscosity of 0.05 Pa·s (50 cp), 0.03 Pa·s (30 cp), 0.02 Pa·s (20 cp), 0.01 Pa·s (10 cp), or less (down to 0.001 Pa·s (1 cp) or lower) lowers the amount of natural gas needed to lift oil from the formation. In some embodiments, reduced viscosity oil is produced by other methods such as pumping.

The rate of production of oil from the formation may be increased by raising the temperature at or near a production wellbore to reduce the viscosity of the oil in the formation in and adjacent to the production wellbore. In certain embodiments, the rate of production of oil from the formation is increased by 2 times, 3 times, 4 times, or greater up to 20 times over standard cold production, which has no external heating of formation during production. Certain formations may be more economically viable for enhanced oil production using the heating of the near production wellbore region. Formations that have a cold production rate approximately between 0.05 $m^3$/(day per meter of wellbore length) and 0.20 $m^3$/(day per meter of wellbore length) may have significant improvements in production rate using heating to reduce the viscosity in the near production wellbore region. In some formations, production wells up to 775 m, up to 1000 m, or up to 1500 m in length are used. For example, production wells between 450 m and 775 m in length are used, between 550 m and 800 m are used, or between 650 m and 900 m are used. Thus, a significant increase in production is achievable in some formations. Heating the near production wellbore region may be used in formations where the cold production rate is not between 0.05 $m^3$/(day per meter of wellbore length) and 0.2 $m^3$/(day per meter of wellbore length), but heating such formations may not be as economically favorable. Higher cold production rates may not be significantly increased by heating the near wellbore region, while lower production rates may not be increased to an economically useful value.

Using the temperature limited heater to reduce the viscosity of oil at or near the production well inhibits problems associated with non-temperature limited heaters and heating the oil in the formation due to hot spots. One possible problem is that non-temperature limited heaters can causing coking of oil at or near the production well if the heater overheats the oil because the heaters are at too high a temperature. Higher temperatures in the production well may also cause brine to boil in the well, which may lead to scale formation in the well. Non-temperature limited heaters that reach higher temperatures may also cause damage to other wellbore components (for example, screens used for sand control, pumps, or valves). Hot spots may be caused by portions of the formation expanding against or collapsing on the heater. In some embodiments, the heater (either the temperature limited heater or another type of non-temperature limited heater) has sections that are lower because of sagging over long heater distances. These lower sections may sit in heavy oil or bitumen that collects in lower portions of the wellbore. At these lower sections, the heater may develop hot spots due to coking of the heavy oil or bitumen. A standard non-temperature limited heater may overheat at these hot spots, thus producing a non-uniform amount of heat along the length of the heater. Using the temperature limited heater may inhibit overheating of the heater at hot spots or lower sections and provide more uniform heating along the length of the wellbore.

In some embodiments, oil or bitumen cokes in a perforated liner or screen in a heater/production wellbore (for example, coke may form between the heater and the liner or between the liner and the formation). Oil or bitumen may also coke in a toe section of a heel and toe heater/production wellbore, as shown in and described below for FIG. 127. A temperature limited heater may limit a temperature of a heater/production wellbore below a coking temperature to inhibit coking in the well so that production in the wellbore does not plug up.

Figure 109:
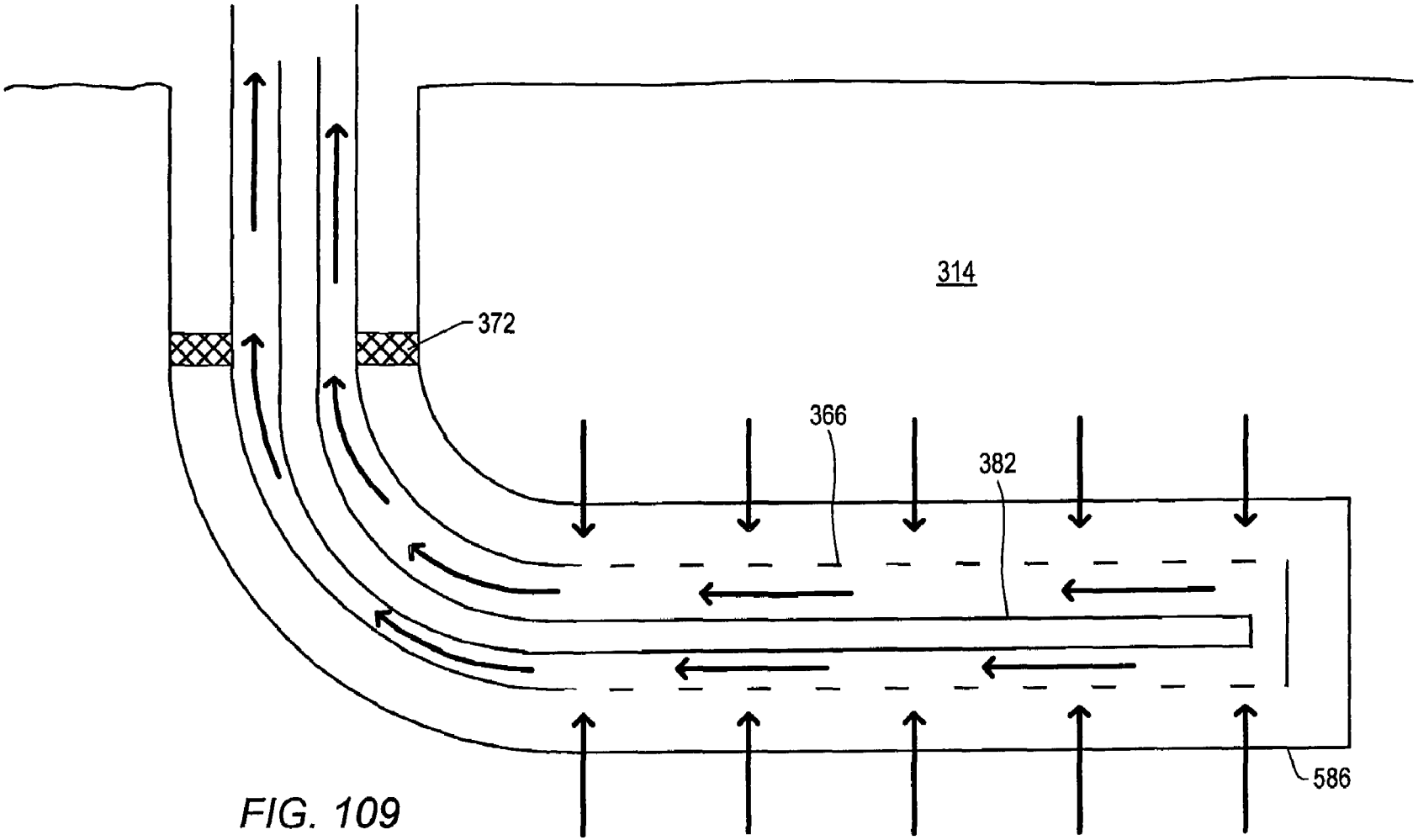
FIG. 109 depicts an embodiment for heating and producing from a formation with a temperature limited heater in a production wellbore.

FIG. 109 depicts an embodiment for heating and producing from the formation with the temperature limited heater in a production wellbore. Production conduit 366 is located in wellbore 586. In certain embodiments, a portion of wellbore 586 is located substantially horizontally in formation 314. In some embodiments, the wellbore is located substantially vertically in the formation. In an embodiment, wellbore 586 is an open wellbore (an uncased wellbore). In some embodiments, the wellbore has a casing or liner with perforations or openings to allow fluid to flow into the wellbore.

Conduit 366 may be made from carbon steel or more corrosion resistant materials such as stainless steel. Conduit 366 may include apparatus and mechanisms for gas lifting or pumping produced oil to the surface. For example, conduit 366 includes gas lift valves used in a gas lift process. Examples of gas lift control systems and valves are disclosed in U.S. Pat. No. 6,715,550 to Vinegar et al. and U.S. Patent Application Publication Nos. 2002-0036085 to Bass et al. and 2003-0038734 to Hirsch et al., each of which is incorporated by reference as if fully set forth herein. Conduit 366 may include one or more openings (perforations) to allow fluid to flow into the production conduit. In certain embodiments, the openings in conduit 366 are in a portion of the conduit that remains below the liquid level in wellbore 586. For example, the openings are in a horizontal portion of conduit 366.

Figure 110:
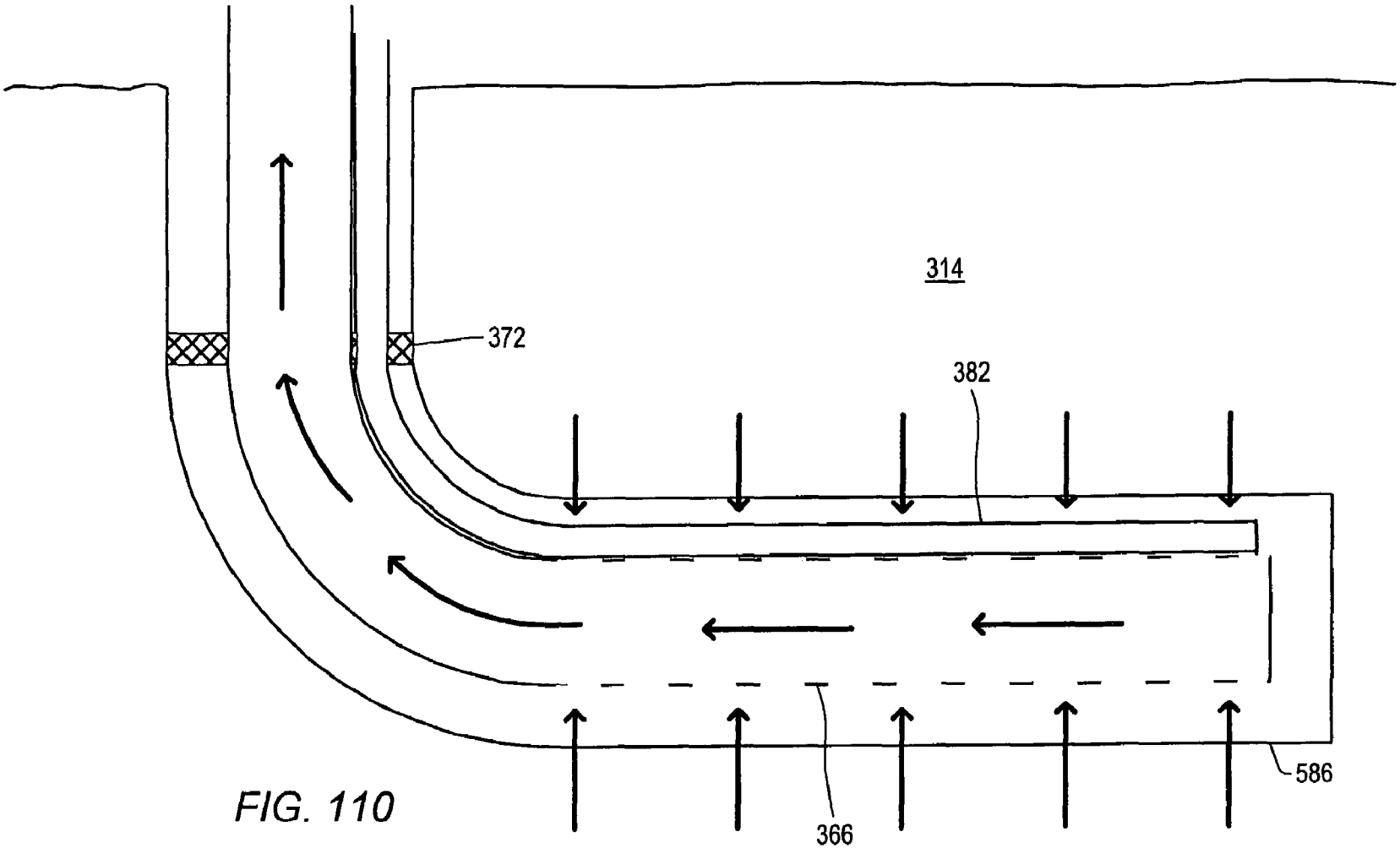
FIG. 110 depicts an embodiment for heating and producing from a formation with a temperature limited heater and a production wellbore.

Heater 382 is located in conduit 366, as shown in FIG. 109. In some embodiments, heater 382 is located outside conduit 366, as shown in FIG. 110. The heater located outside the production conduit may be coupled (strapped) to the production conduit. In some embodiments, more than one heater (for example, two, three, or four heaters) are placed about conduit 366. The use of more than one heater may reduce bowing or flexing of the production conduit caused by heating on only one side of the production conduit. In an embodiment, heater 382 is a temperature limited heater. Heater 382 provides heat to reduce the viscosity of fluid (such as oil or hydrocarbons) in and near wellbore 586. In certain embodiments, heater 382 raises the temperature of the fluid in wellbore 586 up to a temperature of 250° C. or less (for example, 225° C., 200° C., or 150° C.). Heater 382 may be at higher temperatures (for example, 275° C., 300° C., or 325° C.) because the heater provides heat to conduit 366 and there is some temperature differential between the heater and the conduit. Thus, heat produced from the heater does not raise the temperature of fluids in the wellbore above 250° C.

In certain embodiments, heater 382 includes ferromagnetic materials such as Carpenter Temperature Compensator "32", Alloy 42-6, Alloy 52, Invar 36, or other iron-nickel or iron-nickel-chromium alloys. In certain embodiments, nickel or nickel-chromium alloys are used in heater 382. In some embodiments, heater 382 includes a composite conductor with a more highly conductive material such as copper on the inside of the heater to improve the turndown ratio of the heater. Heat from heater 382 heats fluids in or near wellbore 586 to reduce the viscosity of the fluids and increase a production rate through conduit 366.

In certain embodiments, portions of heater 382 above the liquid level in wellbore 586 (such as the vertical portion of the wellbore depicted in FIGS. 109 and 110) have a lower maximum temperature than portions of the heater located below the liquid level. For example, portions of heater 382 above the liquid level in wellbore 586 may have a maximum temperature of 100° C. while portions of the heater located below the liquid level have a maximum temperature of 250° C. In certain embodiments, such a heater includes two or more ferromagnetic sections with different Curie temperatures to achieve the desired heating pattern. Providing less heat to portions of wellbore 586 above the liquid level and closer to the surface may save energy.

In certain embodiments, heater 382 is electrically isolated on the heater's outside surface and allowed to move freely in conduit 366. In some embodiments, electrically insulating centralizers are placed on the outside of heater 382 to maintain a gap between conduit 366 and the heater.

In some embodiments, heater 382 is cycled (turned on and off) so that fluids produced through conduit 366 are not overheated. In an embodiment, heater 382 is turned on for a specified amount of time until a temperature of fluids in or near wellbore 586 reaches a desired temperature (for example, the maximum temperature of the heater). During the heating time (for example, 10 days, 20 days, or 30 days), production through conduit 366 may be stopped to allow fluids in the formation to "soak" and obtain a reduced viscosity. After heating is turned off or reduced, production through conduit 366 is started and fluids from the formation are produced without excess heat being provided to the fluids. During production, fluids in or near wellbore 586 will cool down without heat from heater 382 being provided. When the fluids reach a temperature at which production significantly slows down, production is stopped and heater 382 is turned back on to reheat the fluids. This process may be repeated until a desired amount of production is reached. In some embodiments, some heat at a lower temperature is provided to maintain a flow of the produced fluids. For example, low temperature heat (for example, 100° C., 125° C., or 150° C.) may be provided in the upper portions of wellbore 586 to keep fluids from cooling to a lower temperature.

Figure 111:
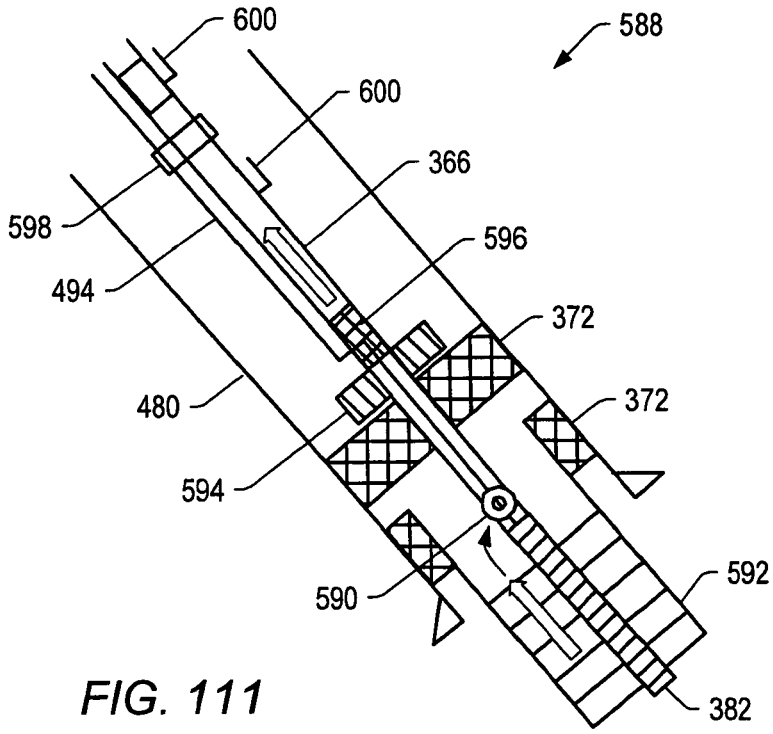
FIG. 111 depicts an embodiment of a heating/production assembly that may be located in a wellbore for gas lifting.

FIG. 111 depicts an embodiment of a heating/production assembly that may be located in a wellbore for gas lifting. Heating/production assembly 588 may be located in a wellbore in the formation (for example, wellbore 586 depicted in FIGS. 109 or 110). Conduit 366 is located inside casing 480. In an embodiment, conduit 366 is coiled tubing such as 6 cm diameter coiled tubing. Casing 480 has a diameter between 10 cm and 25 cm (for example, a diameter of 14 cm, 16 cm, or 18 cm). Heater 382 is coupled to an end of conduit 366. In some embodiments, heater 382 is located inside conduit 366. In some embodiments, heater 382 is a resistive portion of conduit 366. In some embodiments, heater 382 is coupled to a length of conduit 366.

Opening 590 is located at or near a junction of heater 382 and conduit 366. In some embodiments, opening 590 is a slot or a slit in conduit 366. In some embodiments, opening 590 includes more than one opening in conduit 366. Opening 590 allows production fluids to flow into conduit 366 from a wellbore. Perforated casing 592 allows fluids to flow into the heating/production assembly 588. In certain embodiments, perforated casing 592 is a wire wrapped screen. In one embodiment, perforated casing 592 is a 9 cm diameter wire wrapped screen.

Perforated casing 592 may be coupled to casing 480 with packing material 372. Packing material 372 inhibits fluids from flowing into casing 480 from outside perforated casing 592. Packing material 372 may also be placed inside casing 480 to inhibit fluids from flowing up the annulus between the casing and conduit 366. Seal assembly 594 is used to seal conduit 366 to packing material 372. Seal assembly 594 may fix a position of conduit 366 along a length of a wellbore. In some embodiments, seal assembly 594 allows for unsealing of conduit 366 so that the production conduit and heater 382 may be removed from the wellbore.

Feedthrough 596 is used to pass lead-in cable 494 to supply power to heater 382. Lead-in cable 494 may be secured to conduit 366 with clamp 598. In some embodiments, lead-in cable 494 passes through packing material 372 using a separate feedthrough.

A lifting gas (for example, natural gas, methane, carbon dioxide, propane, and/or nitrogen) may be provided to the annulus between conduit 366 and casing 480. Valves 600 are located along a length of conduit 366 to allow gas to enter the production conduit and provide for gas lifting of fluids in the production conduit. The lifting gas may mix with fluids in conduit 366 to lower the density of the fluids and allow for gas lifting of the fluids out of the formation. In certain embodiments, valves 600 are located in an overburden section of a formation so that gas lifting is provided in the overburden section. In some embodiments, fluids are produced through the annulus between conduit 366 and casing 480 and a lifting gas may be supplied through valves 600.

In an embodiment, fluids are produced using a pump coupled to conduit 366. The pump may be a submersible pump (for example, an electric or gas powered submersible pump). In some embodiments, a heater is coupled to conduit 366 to maintain the reduced viscosity of fluids in the conduit and/or the pump.

In certain embodiments, an additional conduit such as an additional coiled tubing conduit is placed in the formation. Sensors may be placed in the additional conduit. For example, a production logging tool may be placed in the additional conduit to identify locations of producing zones and/or to assess flow rates. In some embodiments, a temperature sensor (for example, a distributed temperature sensor, a fiber optic sensor, and/or an array of thermocouples) is placed in the additional conduit to determine a subsurface temperature profile.

Figure 112:
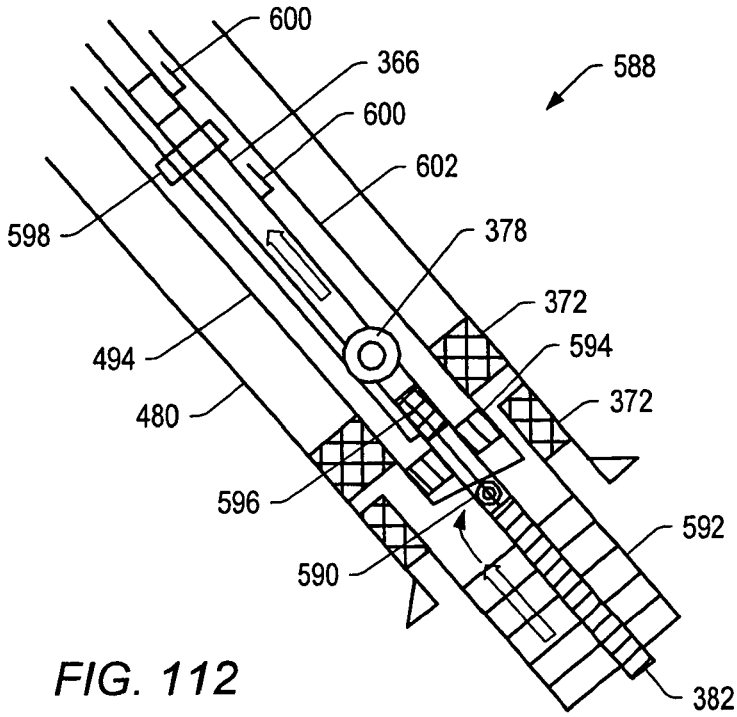
FIG. 112 depicts an embodiment of a heating/production assembly that may be located in a wellbore for gas lifting.

Some embodiments of the heating/production assembly are used in a well that preexists (for example, the heating/production assembly is retrofitted for a preexisting production well, heater well, or monitoring well). An example of the heating/production assembly that may be used in the preexisting well is depicted in FIG. 112. Some preexisting wells include a pump. The pump in the preexisting well may be left in the heating/production well retrofitted with the heating/production assembly.

FIG. 112 depicts an embodiment of the heating/production assembly that may be located in the wellbore for gas lifting. In FIG. 112, conduit 366 is located in outside production conduit 602. In an embodiment, outside production conduit 602 is 11.4 cm diameter production tubing. Casing 480 has a diameter of 24.4 cm. Perforated casing 592 has a diameter of 11.4 cm. Seal assembly 594 seals conduit 366 inside outside production conduit 602. In an embodiment, pump 378 is a jet pump such as a bottomhole assembly jet pump.

Figure 113:
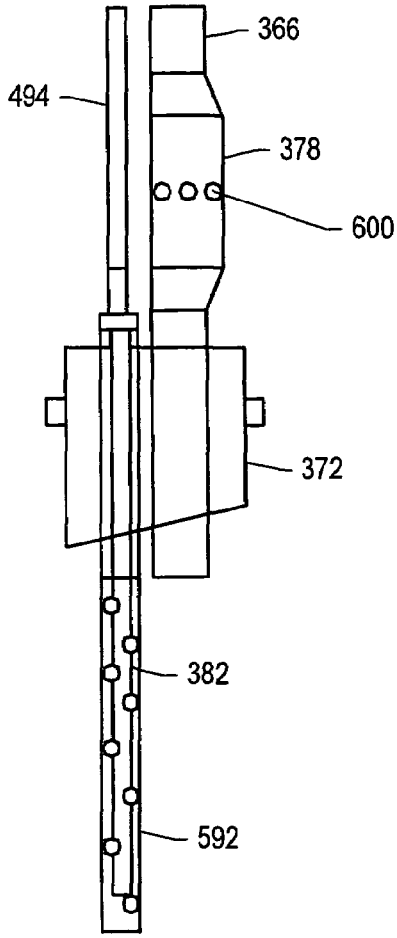
FIG. 113 depicts another embodiment of a heating/production assembly that may be located in a wellbore for gas lifting.

FIG. 113 depicts another embodiment of a heating/production assembly that may be located in a wellbore for gas lifting. Heater 382 is located inside perforated casing 592. Heater 382 is coupled to lead-in cable 494. Production conduit 366 extends through packing material 372. Pump 378 is located along conduit 366. In certain embodiments, pump 378 is a jet pump or a bean pump. Valves 600 are located along conduit 366 for supplying lift gas to the conduit.

Figure 114:
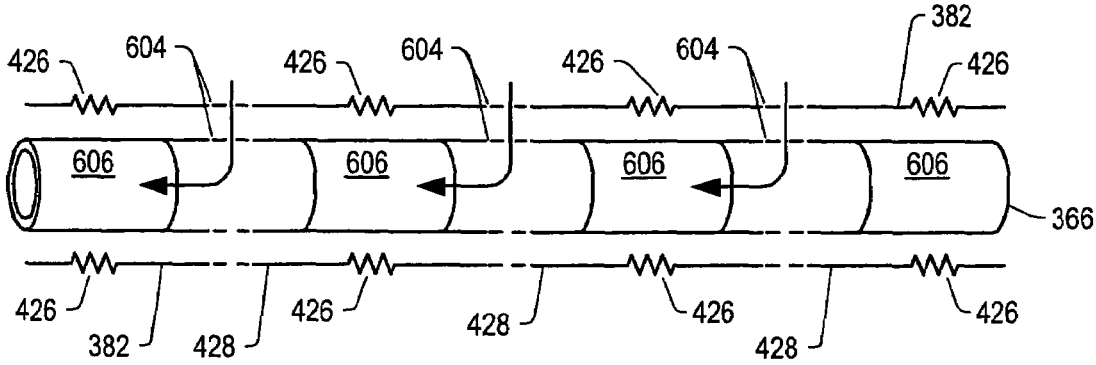
FIG. 114 depicts an embodiment of a production conduit and a heater.

In some embodiments, heat is inhibited from transferring into conduit 366. FIG. 114 depicts an embodiment of conduit 366 and heaters 382 that inhibit heat transfer into the conduit. Heaters 382 are coupled to conduit 366. Heater 382 include ferromagnetic sections 426 and non-ferromagnetic sections 428. Ferromagnetic sections 426 provide heat at a temperature that reduces the viscosity of fluids in or near a wellbore. Non-ferromagnetic sections 428 provide little or no heat. In certain embodiments, ferromagnetic sections 426 and non-ferromagnetic sections 428 are 6 m in length. In some embodiments, ferromagnetic sections 426 and non-ferromagnetic sections 428 are between 3 m and 12 m in length, between 4 m and 11 m in length, or between 5 m and 10 m in length. In certain embodiments, non-ferromagnetic sections 428 include perforations 604 to allow fluids to flow to conduit 366. In some embodiments, heater 382 is positioned so that perforations are not needed to allow fluids to flow to conduit 366.

Conduit 366 may have perforations 604 to allow fluid to enter the conduit. Perforations 604 coincide with non-ferromagnetic sections 428 of heater 382. Sections of conduit 366 that coincide with ferromagnetic sections 426 include insulation conduit 606. Conduit 606 may be a vacuum insulated tubular. For example, conduit 606 may be a vacuum insulated production tubular available from Oil Tech Services, Inc. (Houston, Tex.). Conduit 606 inhibits heat transfer into conduit 366 from ferromagnetic sections 426. Limiting the heat transfer into conduit 366 reduces heat loss and/or inhibits overheating of fluids in the conduit. In an embodiment, heater 382 provides heat along an entire length of the heater and conduit 366 includes conduit 606 along an entire length of the production conduit.

Figure 115:
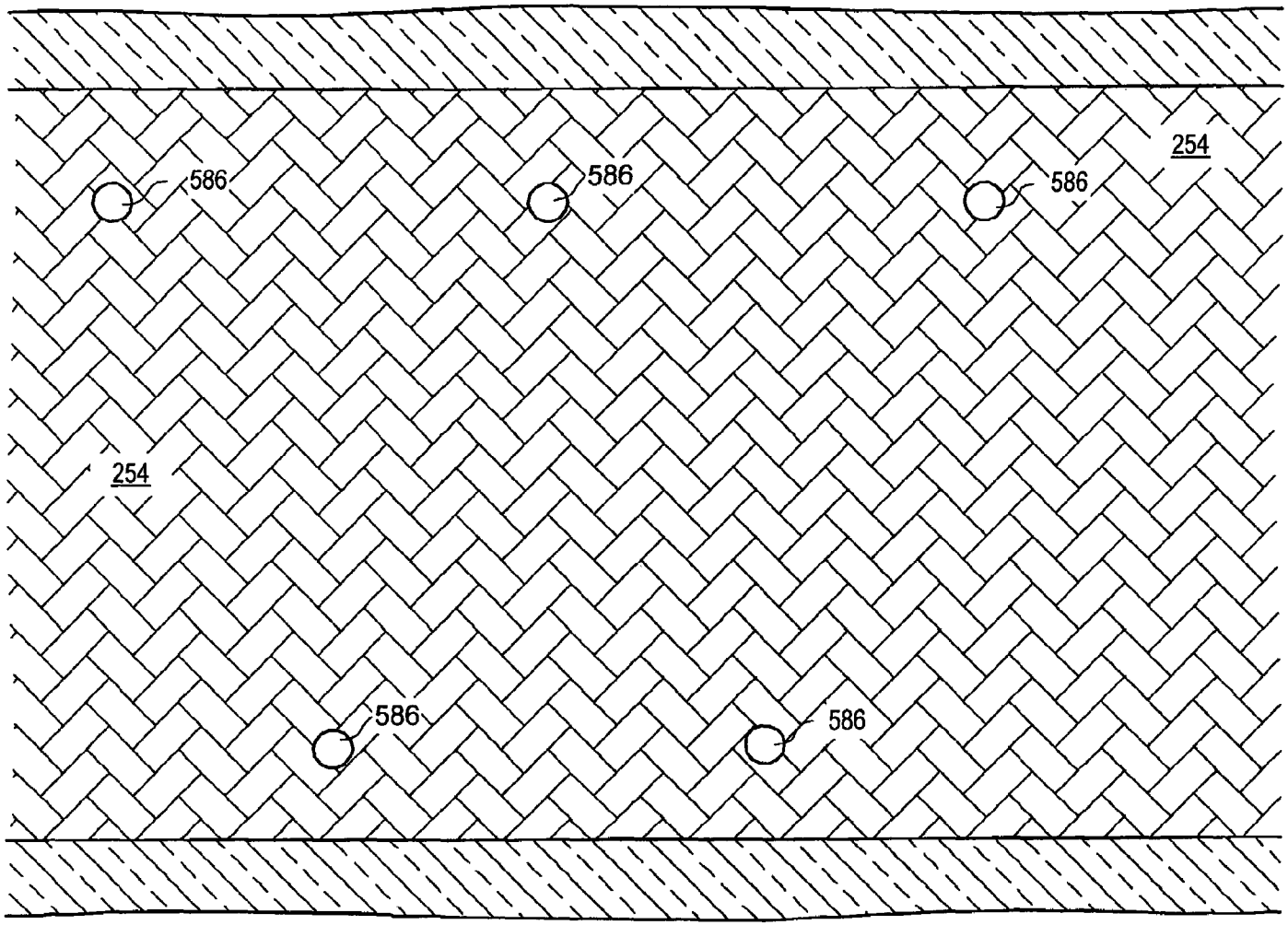
FIG. 115 depicts an embodiment for treating a formation.

In certain embodiments, more than one wellbore 586 is used to produce heavy oils from a formation using the temperature limited heater. FIG. 115 depicts an end view of an embodiment with wellbores 586 located in hydrocarbon layer 254. A portion of wellbores 586 are placed substantially horizontally in a triangular pattern in hydrocarbon layer 254. In certain embodiments, wellbores 586 have a spacing of 30 m to 60 m, 35 m to 55 m, or 40 m to 50 m. Wellbores 586 may include production conduits and heaters previously described. Fluids may be heated and produced through wellbores 586 at an increased production rate above a cold production rate for the formation. Production may continue for a selected time (for example, 5 years to 10 years, 6 years to 9 years, or 7 years to 8 years) until heat produced from each of wellbores 586 begins to overlap (superposition of heat begins). At such a time, heat from lower wellbores (such as wellbores 586 near the bottom of hydrocarbon layer 254) is continued, reduced, or turned off while production is continued. Production in upper wellbores (such as wellbores 586 near the top of hydrocarbon layer 254) may be stopped so that fluids in the hydrocarbon layer drain towards the lower wellbores. In some embodiments, power is increased to the upper wellbores and the temperature raised above the Curie temperature to increase the heat injection rate. Draining fluids in the formation in such a process increases total hydrocarbon recovery from the formation.

Production well lift systems may be used to efficiently transport formation fluid from the bottom of the production wells to the surface. Production well lift systems may provide and maintain the maximum required well drawdown (minimum reservoir producing pressure) and producing rates. The production well lift systems may operate efficiently over a wide range of high temperature/multiphase fluids (gas/vapor/steam/water/hydrocarbon liquids) and production rates expected during the life of a typical project.

Figure 116:
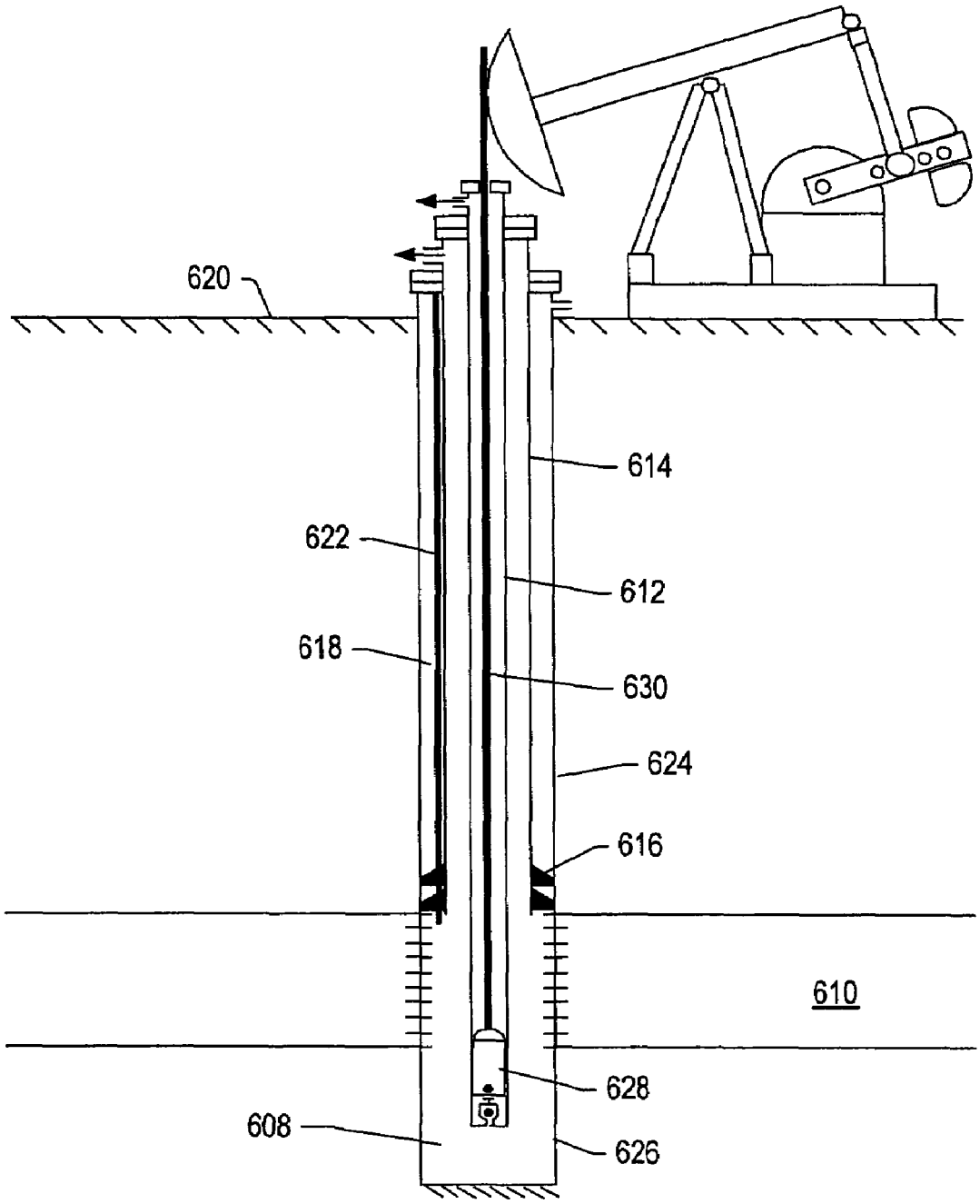
FIG. 116 depicts an embodiment of a dual concentric rod pump system.

FIG. 116 illustrates an embodiment of a dual concentric rod pump system use in production wells. The formation fluid enters wellbore 608 from heated portion 610. Formation fluid may be transported to the surface through inner conduit 612 and outer conduit 614. Inner conduit 612 and outer conduit 614 may be concentric. Concentric conduits may be advantageous over dual (side by side) conduits in conventional oilfield production wells. Inner conduit 612 may be used for production of liquids. Outer conduit 614 may allow vapor and/or gaseous phase formation fluids to flow to the surface along with some entrained liquids.

The diameter of outer conduit 614 may be chosen to allow a desired range of flow rates and/or to minimize the pressure drop and flowing reservoir pressure. Reflux seal 616 at the base of outer conduit 614 may inhibit hot produced gases and/or vapors from contacting the relatively cold wall of well casing 624 above heated portion 610. This minimizes potentially damaging and wasteful energy losses from heated portion 610 via condensation and recycling of fluids. Reflux seal 616 may be a dynamic seal, allowing outer conduit 614 to thermally expand and contract while being fixed at surface 620. Reflux seal 616 may be a one-way seal designed to allow fluids to be pumped down annulus 618 for treatment or for well kill operations. For example, down-facing elastomeric-type cups may be used in reflux seal 616 to inhibit fluids from flowing upward through annulus 618. In some embodiments, reflux seal 616 is a "fixed" design, with a dynamic wellhead seal that allows outer conduit 614 to move at surface 620, thereby reducing thermal stresses and cycling.

Conditions in any particular well or project could allow both ends of outer conduit 614 to be fixed. Outer conduit 614 may require no or infrequent retrieval for maintenance over the expected useful life of the production well. In some embodiments, utility bundle 622 is coupled to the outside of outer conduit 614. Utility bundle 622 may include, but is not limited to, conduits for monitoring, control, and/or treatment equipment such as temperature/pressure monitoring devices, chemical treatment lines, diluent injection lines, and cold fluid injection lines for cooling of the liquid pumping system. Coupling utility bundle 622 to outer conduit 614 may allow the utility bundle (and thus the potentially complex and sensitive equipment included in this bundle) to remain in place during retrieval and/or maintenance of inner conduit 612. In certain embodiments, outer conduit 614 is removed one or more times over the expected useful life of the production well.

Annulus 618 between well casing 624 and outer conduit 614 may provide a space to run utility bundle 622 and instrumentation, as well as thermal insulation to optimize and/or control temperature and/or behavior of the produced fluid. In some embodiments, annulus 618 is filled with one or more fluids or gases (pressurized or not) to allow regulation of the overall thermal conductivity and resulting heat transfer between the overburden and the formation fluid being produced. Using annulus 618 as a thermal barrier may allow: 1) optimization of temperature and/or phase behavior of the fluid stream for subsequent processing of the fluid stream at the surface, and/or 2) optimization of multiphase behavior to enable maximum natural flow of fluids and liquid stream pumping. The concentric configuration of outer conduit 614 and inner conduit 612 is advantageous in that the heat transfer/thermal effects on the fluid streams are more uniform than a conventional dual (parallel tubing) configuration.

Inner conduit 612 may be used for production of liquids. Liquids produced from inner conduit 612 may include fluids in liquid form that are not entrained with gas/vapor produced from outer conduit 614, as well as liquids that condense in the outer conduit. In some embodiments, the base of inner conduit 612 is positioned below the base of heated portion 610 (in sump 626) to assist in natural gravity separation of the liquid phase. Sump 626 may be a separation sump. Sump 626 may also provide thermal benefits (for example, cooler pump operation and reduced liquid flashing in the pump) depending upon the depth of the sump and overall fluid rates and/or temperatures.

Inner conduit 612 may include a pump system. In some embodiments, pump system 628 is an oilfield-type reciprocating rod pump. Such pumps are available in a wide variety of designs and configurations. Reciprocating rod pumps have the advantages of being widely available and cost effective. In addition, surveillance/evaluation analysis methods are well-developed and understood for this system. In certain embodiments, the prime mover is advantageously located on the surface for accessibility and maintenance. Location of the prime mover on the surface also protects the prime mover from the extreme temperature/fluid environment of the wellbore. FIG. 116 depicts a conventional oilfield-type beam-pumping unit on surface 620 for reciprocation of rod string 630. Other types of pumps may be used including, but not limited to, hydraulic pumps, long-stroke pumps, air-balance pumps, surface-driven rotary pumps, and MII pumps. A pump may be chosen depending on well conditions and desired pumping rates. In certain embodiments, inner conduit 612 is anchored to limit movement and wear of the inner conduit.

Concentric placement of outer conduit 614 and inner conduit 612 may facilitate maintenance of the inner conduit and the associated pump system, including intervention and/or replacement of downhole components. The concentric design allows for maintenance/removal/replacement of inner conduit 612 without disturbing outer conduit 614 and related components, thus lowering overall expenses, reducing well downtime, and/or improving overall project performance compared to a conventional parallel double conduit configuration. The concentric configuration may also be modified to account for unexpected changes in well condition over time. The pump system can be quickly removed and both conduits may be utilized for flowing production in the event of lower liquid rates or much higher vapor/gas rates than anticipated. Conversely, a larger or different system can easily be installed in the inner conduit without affecting the balance of the system components.

Various methods may be used to control the pump system to enhance efficiency and well production. These methods may include, for example, the use of on/off timers, pump-off detection systems to measure surface loads and model the downhole conditions, direct fluid level sensing devices, and sensors suitable for high-temperature applications (capillary tubing, etc.) to allow direct downhole pressure monitoring. In some embodiments, the pumping capacity is matched with available fluid to be pumped from the well.

Various design options and/or configurations for the conduits and/or rod string (including materials, physical dimensions, and connections) may be chosen to enhance overall reliability, cost, ease of initial installation, and subsequent intervention and/or maintenance for a given production well. For example, connections may be threaded, welded, or designed for a specific application. In some embodiments, sections of one or more of the conduits are connected as the conduit is lowered into the well. In certain embodiments, sections of one or more of the conduits are connected prior to insertion in the well, and the conduit is spooled (for example, at a different location) and later unspooled into the well. The specific conditions within each production well determine equipment parameters such as equipment sizing, conduit diameters, and sump dimensions for optimal operation and performance.

Figure 117:
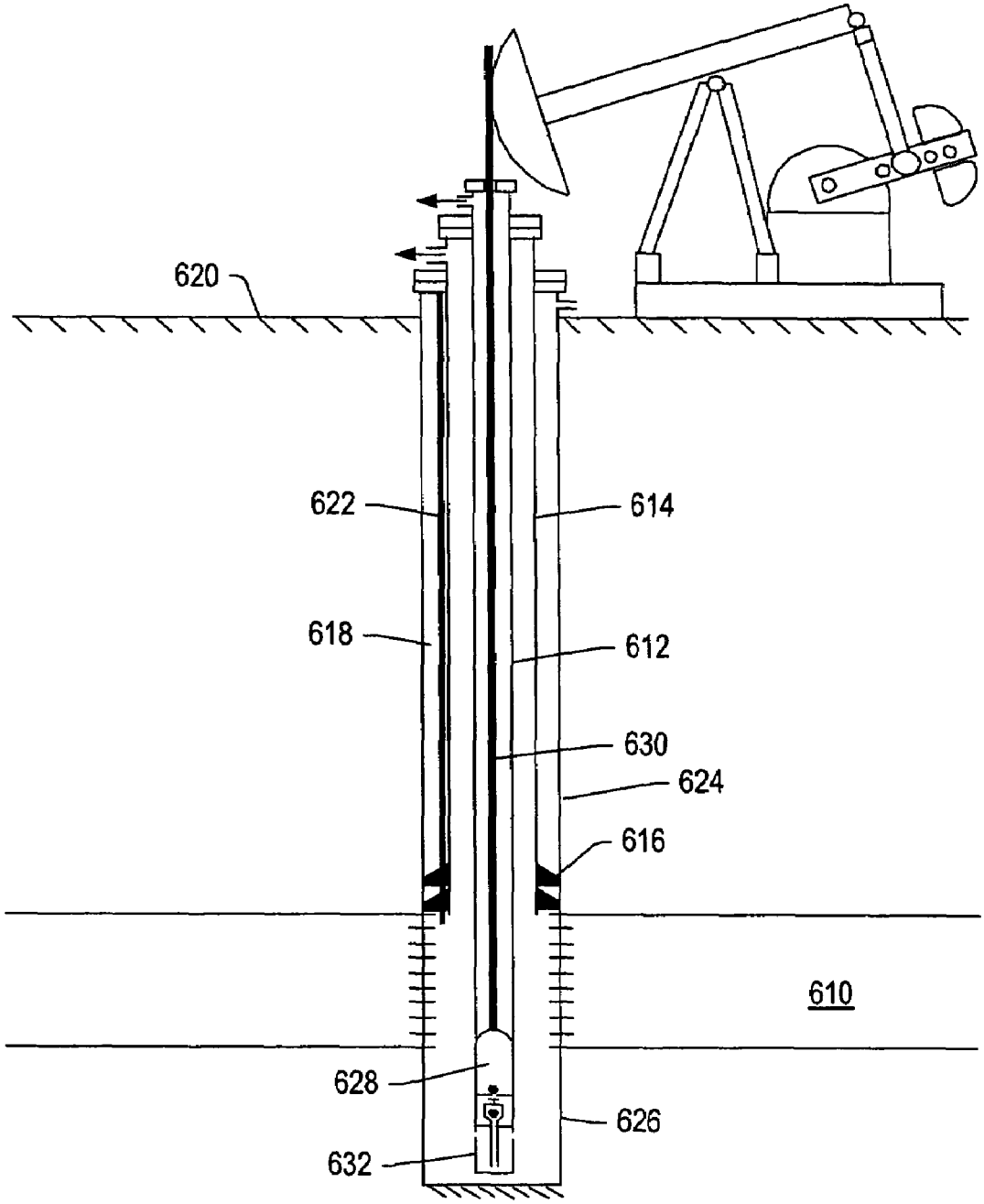
FIG. 117 depicts an embodiment of a dual concentric rod pump system with a 2-phase separator.

FIG. 117 illustrates an embodiment of the dual concentric rod pump system including 2-phase separator 632 at the bottom of inner conduit 612 to aid in additional separation and exclusion of gas/vapor phase fluids from rod pump 628. Use of 2-phase separator 632 may be advantageous at higher vapor and gas/liquid ratios. Use of 2-phase separator 632 may help prevent gas locking and low pump efficiencies in inner conduit 612.

Figure 118:
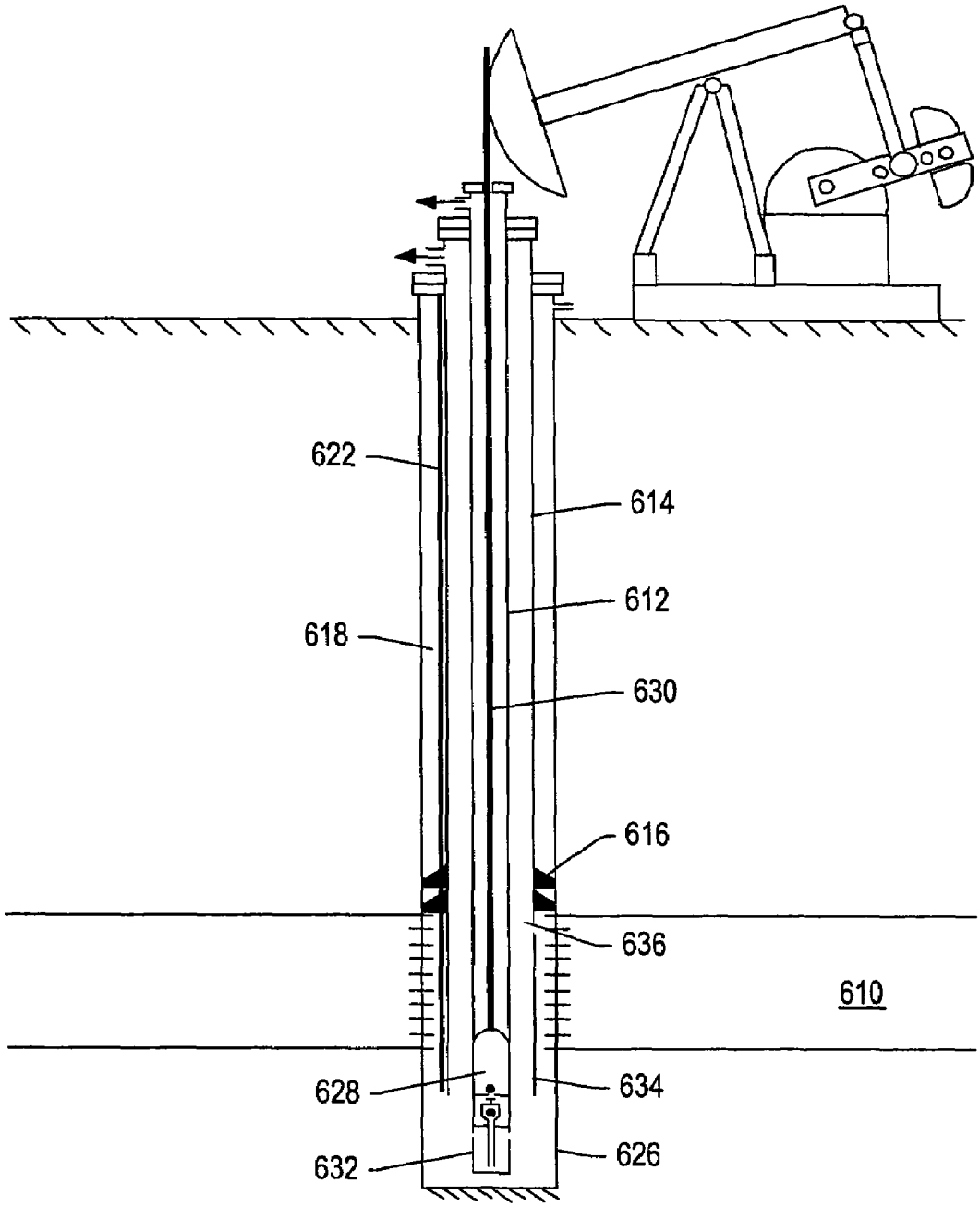
FIG. 118 depicts an embodiment of a dual concentric rod pump system with a gas/vapor shroud and sump.

FIG. 118 depicts an embodiment of the dual concentric rod pump system that includes gas/vapor shroud 634 extending down into sump 626. Gas/vapor shroud 634 may force the majority of the produced fluid stream down through the area surrounding sump 626, increasing the natural liquid separation. Gas/vapor shroud 634 may include sized gas/vapor vent 636 at the top of the heated zone to inhibit gas/vapor pressure from building up and being trapped behind the shroud. Thus, gas/vapor shroud 634 may increase overall well drawdown efficiency, and becomes more important as the thickness of heated portion 610 increases. The size of gas/vapor vent 636 may vary and can be determined based on the expected fluid volumes and desired operating pressures for any particular production well.

Figure 119:
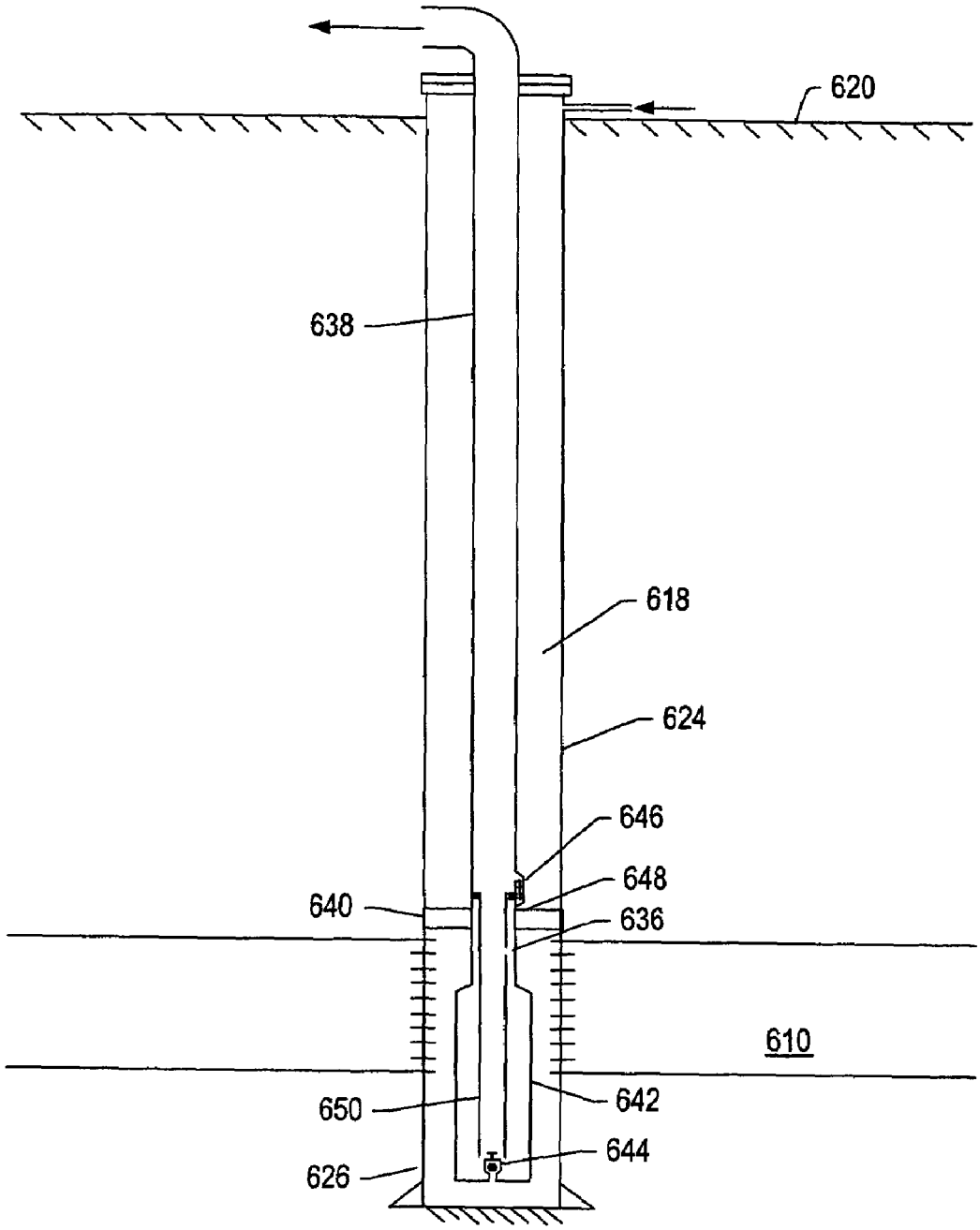
FIG. 119 depicts an embodiment of a gas lift system.

FIG. 119 depicts an embodiment of a gas lift system for use in production wells. Conduit 638 provides a path for fluids of all phases to be transported from heated portion 610 to surface 620. Packer/reflux seal assembly 640 is located above heated portion 610 to inhibit produced fluids from entering annulus 618 between conduit 638 and well casing 624 above the heated portion. Packer/reflux seal assembly 640 may reduce the refluxing of the fluid, thereby advantageously reducing energy losses. In this configuration, packer/reflux seal assembly 640 may substantially isolate the pressurized lift gas in annulus 618 above the packer/reflux seal assembly from heated portion 610. Thus, heated portion 610 may be exposed to the desired minimum drawdown pressure, maximizing fluid inflow to the well. As an additional aid in maintaining a minimum drawdown pressure, sump 626 may be located in the wellbore below heated portion 610. Produced fluids/liquids may therefore collect in the wellbore below heated portion 610 and not cause excessive backpressure on the heated portion. This becomes more advantageous as the thickness of heated portion 610 increases.

Fluids of all phases may enter the well from heated portion 610. These fluids are directed downward to sump 626. The fluids enter lift chamber 642 through check valve 644 at the base of the lift chamber. After sufficient fluid has entered lift chamber 642, lift gas injection valve 646 opens and allows pressurized lift gas to enter the top of the lift chamber. Crossover port 648 allows the lift gas to pass through packer/reflux seal assembly 640 into the top of lift chamber 642. The resulting pressure increase in lift chamber 642 closes check valve 644 at the base and forces the fluids into the bottom of diptube 650, up into conduit 638, and out of the lift chamber. Lift gas injection valve 646 remains open until sufficient lift gas has been injected to evacuate the fluid in lift chamber 642 to a collection device. Lift gas injection valve 646 then closes and allows lift chamber 642 to fill with fluid again. This "lift cycle" repeats (intermittent operation) as often as necessary to maintain the desired drawdown pressure within heated portion 610. Sizing of equipment, such as conduits, valves, and chamber lengths and/or diameters, is dependent upon the expected fluid rates produced from heated portion 610 and the desired minimum drawdown pressure to be maintained in the production well.

In some embodiments, the entire gas lift system may be retrievable from the well for repair, maintenance, and periodic design revisions due to changing well conditions. However, the need for retrieving conduit 638, packer/reflux seal assembly 640, and lift chamber 642 may be relatively infrequent. In some embodiments, lift gas injection valve 646 is configured to be positioned in the formation and/or to be retrieved from the formation along with conduit 638. In certain embodiments, lift gas injection valve 646 is configured to be separately retrievable via wireline or similar means without removing conduit 638 or other system components from the formation. Check valve 644 and/or diptube 650 may be individually installed and/or retrieved in a similar manner. The option to retrieve diptube 650 separately may allow resizing of gas/vapor vent 636. The option to retrieve these individual components (items that would likely require the most frequent well intervention, repair, and maintenance) greatly improves the attractiveness of the system from a well intervention and maintenance cost perspective.

Gas/vapor vent 636 may be located at the top of lift chamber 642 to allow gas and/or vapor entering the lift chamber from heated portion 610 to continuously vent into conduit 638 and inhibit an excess buildup of chamber pressure. Inhibiting an excess buildup of chamber pressure may increase overall system efficiency. Gas/vapor vent 636 may be sized to avoid excessive bypassing of injected lift gas into conduit 638 during the lift cycle, thereby promoting flow of the injected lift gas around the base of diptube 650.

The embodiment depicted in FIG. 119 includes a single lift gas injection valve 646 (rather than multiple intermediate "unloading" valves typically used in gas lift applications). Having a single lift gas injection valve greatly simplifies the downhole system design and/or mechanics, thereby reducing the complexity and cost, and increasing the reliability of the overall system. Having a single lift gas injection valve, however, does require that the available gas lift system pressure be sufficient to overcome and displace the heaviest fluid that might fill the entire wellbore, or some other means to initially "unload" the well in that event. Unloading valves may be used in some embodiments where the production wells are deep in the formation, for example, greater than 900 m deep, greater than 1000 m deep, or greater than 1500 m deep in the formation.

In some embodiments, the chamber/well casing internal diameter ratio is kept as high as possible to maximize volumetric efficiency of the system. Keeping the chamber/well casing internal diameter ratio as high as possible may allow overall drawdown pressure and fluid production into the well to be maximized while pressure imposed on the heated portion is minimized.

Lift gas injection valve 646 and the gas delivery and control system may be designed to allow large volumes of gas to be injected into lift chamber 642 in a relatively short period of time to maximize the efficiency and minimize the time period for fluid evacuation. This may allow liquid fallback in conduit 638 to be decreased (or minimized) while overall well fluid production potential is increased (or maximized).

Various methods may be used to allow control of lift gas injection valve 646 and the amount of gas injected during each lift cycle. Lift gas injection valve 646 may be designed to be self-controlled, sensitive to either lift chamber pressure or casing pressure. That is, lift gas injection valve 646 may be similar to tubing pressure-operated or casing pressure-operated valves routinely used in conventional oilfield gas lift applications. Alternatively, lift gas injection valve 646 may be controlled from the surface via either electric or hydraulic signal. These methods may be supplemented by additional controls that regulate the rate and/or pressure at which lift gas is injected into annulus 618 at surface 620. Other design and/or installation options for gas lift systems (for example, types of conduit connections and/or method of installation) may be chosen from a range of approaches known in the art.

Figure 120:
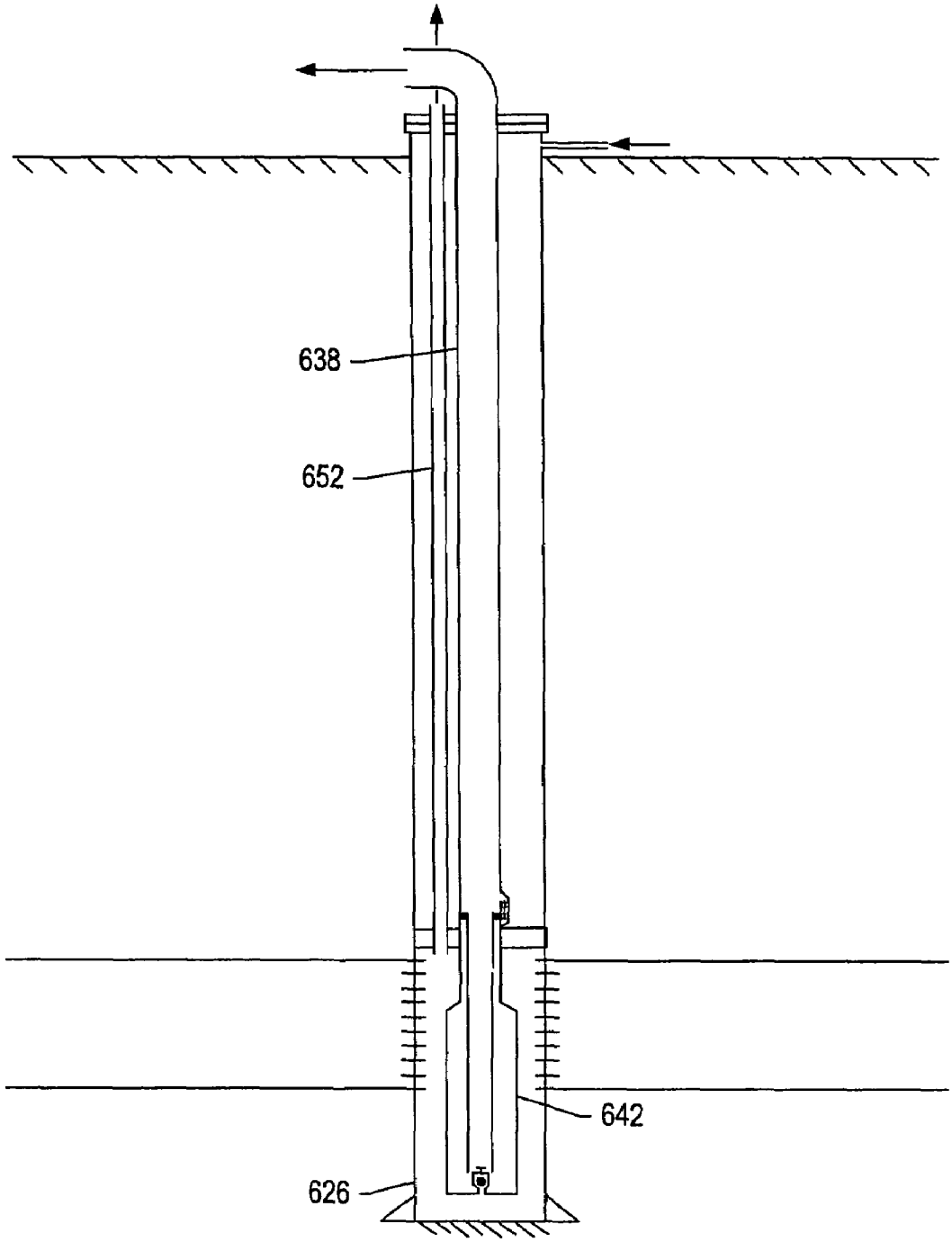
FIG. 120 depicts an embodiment of a gas lift system with an additional production conduit.

FIG. 120 illustrates an embodiment of a gas lift system that includes an additional parallel production conduit. Conduit 652 may allow continual flow of produced gas and/or vapor, bypassing lift chamber 642. Bypassing lift chamber 642 may avoid passing large volumes of gas and/or vapor through the lift chamber, which may reduce the efficiency of the system when the volumes of gas and/or vapor are large. In this embodiment, the lift chamber evacuates any liquids from the well accumulating in sump 626 that do not flow from the well along with the gas/vapor phases. Sump 626 would aid the natural separation of liquids for more efficient operation.

Figure 121:
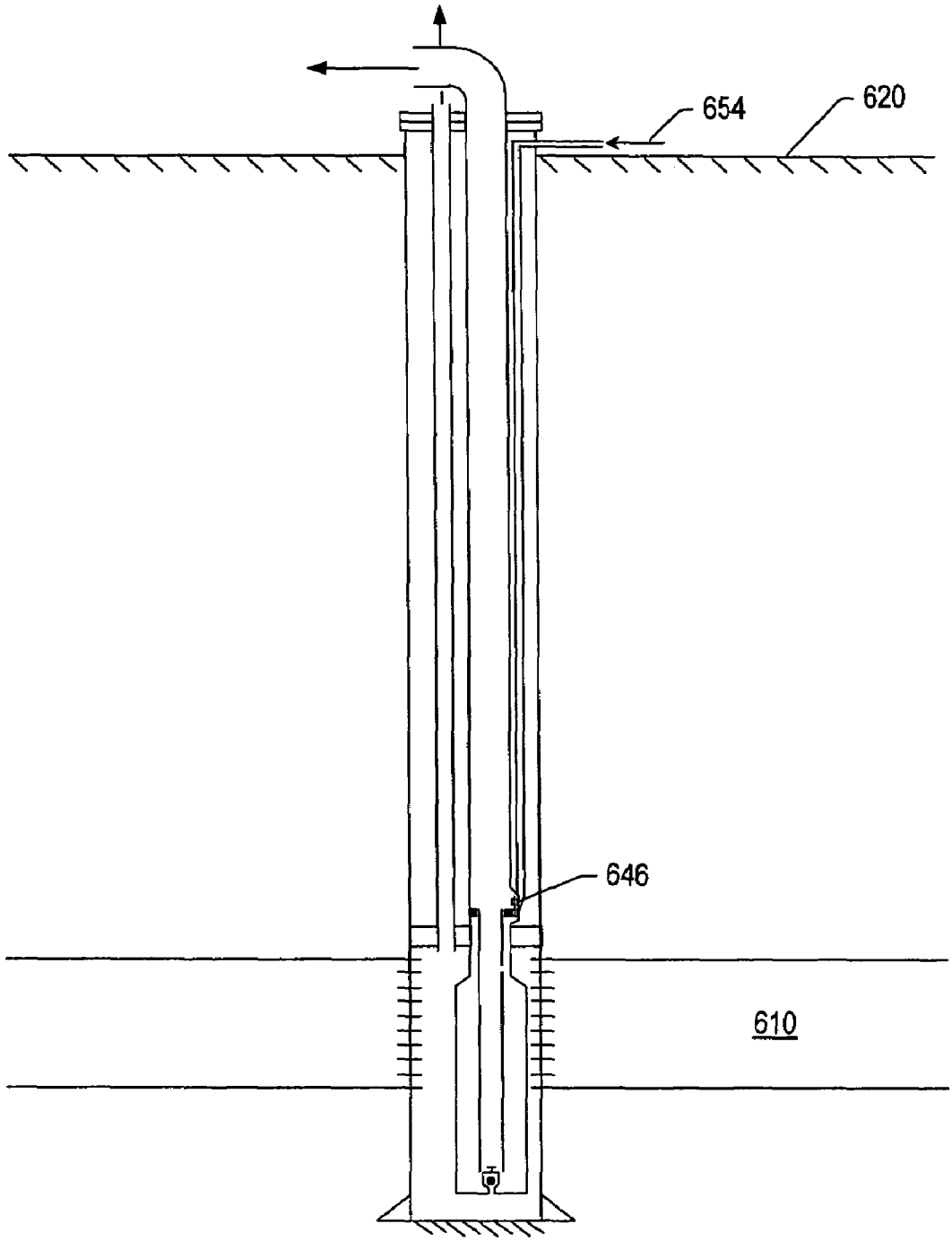
FIG. 121 depicts an embodiment of a gas lift system with an injection gas supply conduit.

FIG. 121 depicts an embodiment of a gas lift system including injection gas supply conduit 654 from surface 620 down to lift gas injection valve 646. There may be some advantages to this arrangement (for example, relating to wellbore integrity and/or barrier issues) compared to use of the casing annulus to transport the injection gas. While lift gas injection valve 646 is positioned downhole for control, this configuration may also facilitate the alternative option to control the lift gas injection entirely from surface 620. Controlling the lift gas injection entirely from surface 620 may eliminate the need for downhole injection valve 646 and reduce the need for and/or costs associated with wellbore intervention. Providing a separate lift gas conduit also permits the annulus around the production tubulars to be kept at a low pressure, or even under a vacuum, thus decreasing heat transfer from the production tubulars. This reduces condensation in conduit 652 and thus reflux back into heated portion 610.

Figure 122:
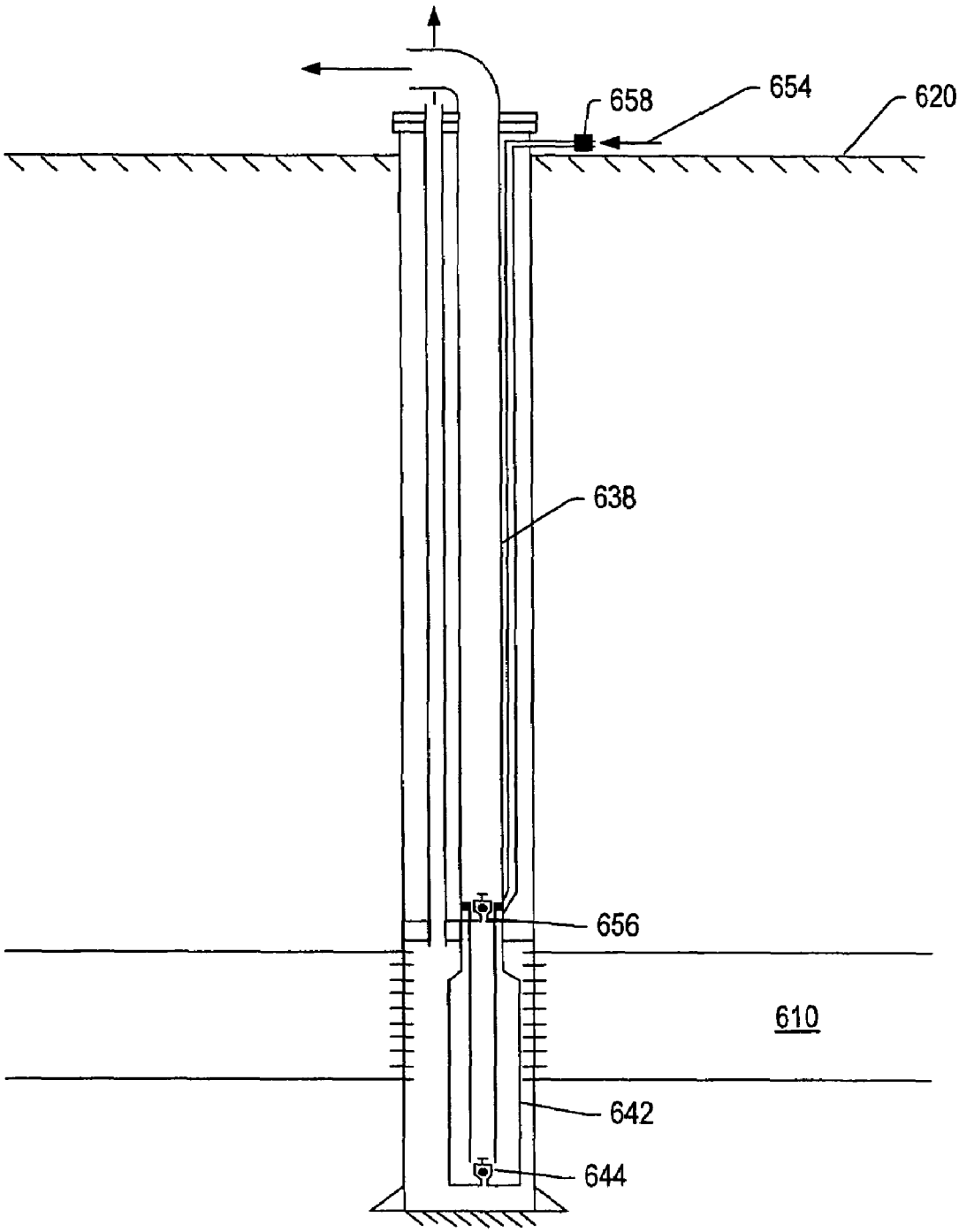
FIG. 122 depicts an embodiment of a gas lift system with an additional check valve.

FIG. 122 depicts an embodiment of a gas lift system with an additional check valve located at the top of the lift chamber/diptube. Check valve 656 may be retrieved separately via wireline or other means to reduce maintenance and reduce the complexity and/or cost associated with well intervention. Check valve 656 may inhibit liquid fallback from conduit 638 from returning to lift chamber 642 between lift cycles. In addition, check valve 656 may allow lift chamber 642 to be evacuated by displacing the chamber fluids and/or liquids only into the base of conduit 638 (the conduit remains full of fluid between cycles), potentially optimizing injection gas usage and energy. In some embodiments, the injection gas tubing pressure is bled down in this displacement mode to allow maximum drawdown pressure to be achieved with the surface injection gas control depicted in FIG. 122.

As depicted in FIG. 122, the downhole lift gas injection valve has been eliminated, and injection gas control valve 658 is located above surface 620. In some embodiments, the downhole valve is used in addition to injection gas control valve 658. Using the downhole control valve along with injection gas control valve 658 may allow the injection gas tubing pressure to be retained in the displacement cycle mode.

Figure 123:
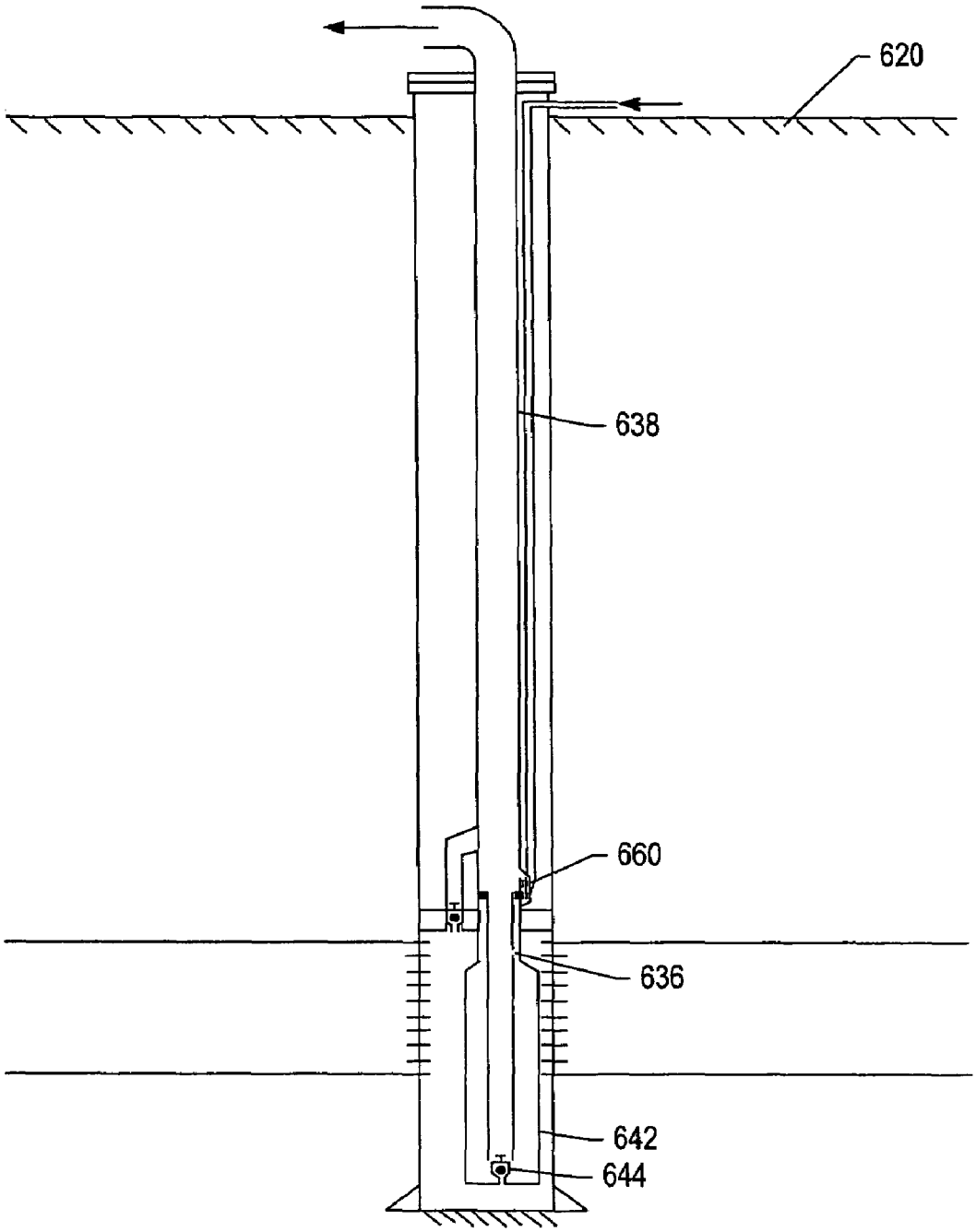
FIG. 123 depicts an embodiment of a gas lift system that allows mixing of the gas/vapor stream into the production conduit without a separate gas/vapor conduit for gas.

FIG. 123 depicts an embodiment of a gas lift system that allows mixing of the gas/vapor stream into conduit 638 (without a separate conduit for gas and/or vapor), while bypassing lift chamber 642. Gas/vapor vent 636 equipped with check valve 644 may allow continuous production of the gas/vapor phase fluids into conduit 638 above lift chamber 642 between lift cycles. Check valve 644 may be separately retrievable as previously described for the other operating components. The embodiment depicted in FIG. 123 may allow simplification of the downhole equipment arrangement through elimination of the separate conduit for gas/vapor production. In some embodiments, lift gas injection is controlled via downhole gas injection valve 660. In certain embodiments, lift gas injection is controlled at surface 620.

Figure 124:
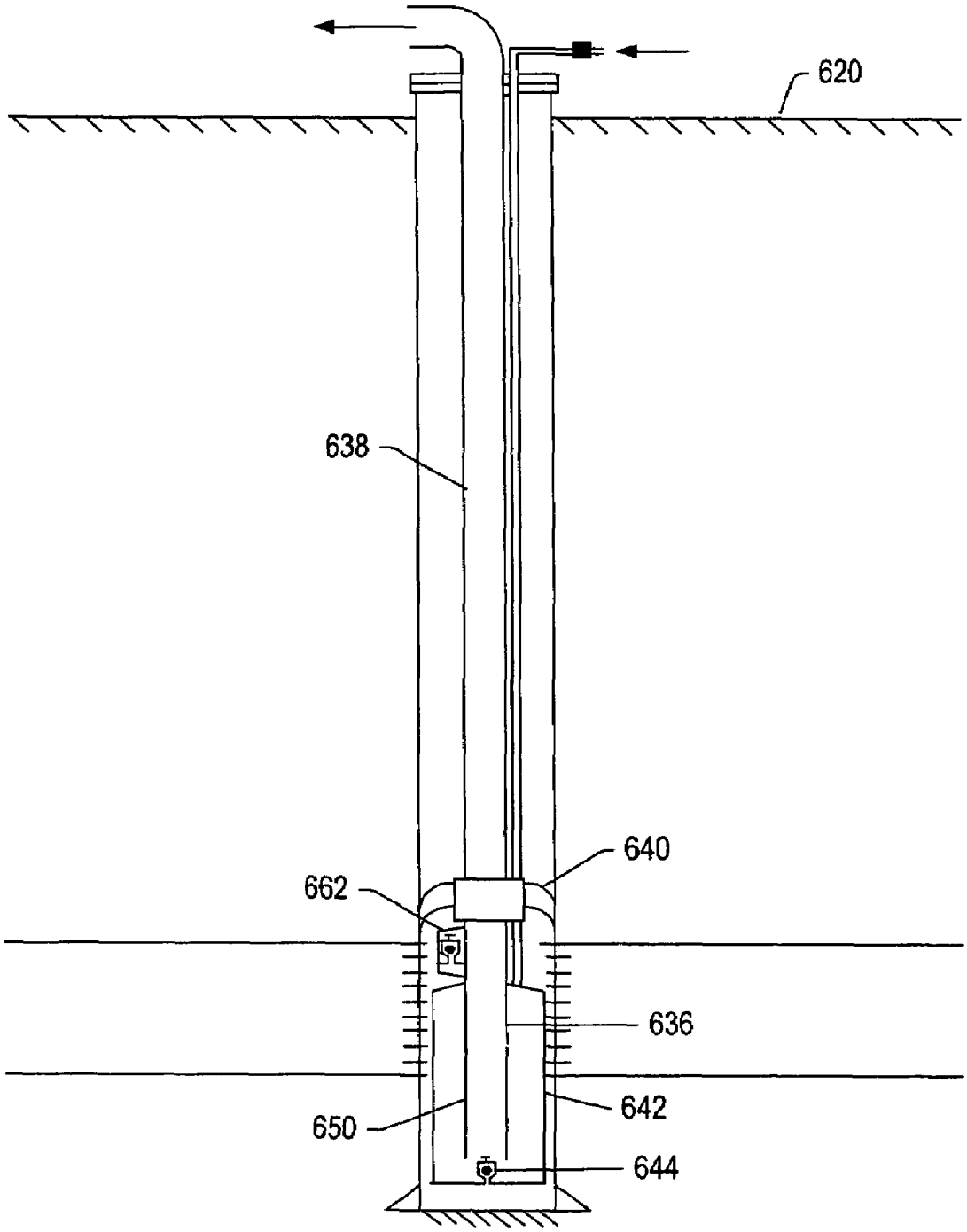
FIG. 124 depicts an embodiment of a gas lift system with a check valve/vent assembly below a packer/reflux seal assembly.

FIG. 124 depicts an embodiment of a gas lift system with check valve/vent assembly 662 below packer/reflux seal assembly 640, eliminating the flow through the packer/reflux seal assembly. With check valve 646 and gas/vapor vent 636 below packer/reflux seal assembly 640, the gas/vapor stream bypasses lift chamber 642 while retaining the single, commingled production stream to surface 620. Check valve 662 may be independently retrievable, as previously described.

As depicted in FIG. 124, diptube 650 may be an integral part of conduit 638 and lift chamber 642. With diptube 650 an integral part of conduit 638 and lift chamber 642, check valve 644 at the bottom of the lift chamber may be more easily accessed (for example, via non-rig intervention methods including, but not limited to, wireline and coil tubing), and a larger diptube diameter may be used for higher liquid/fluid volumes. The retrievable diptube arrangement, as previously described, may be applied here as well, depending upon specific well requirements.

Figure 125:
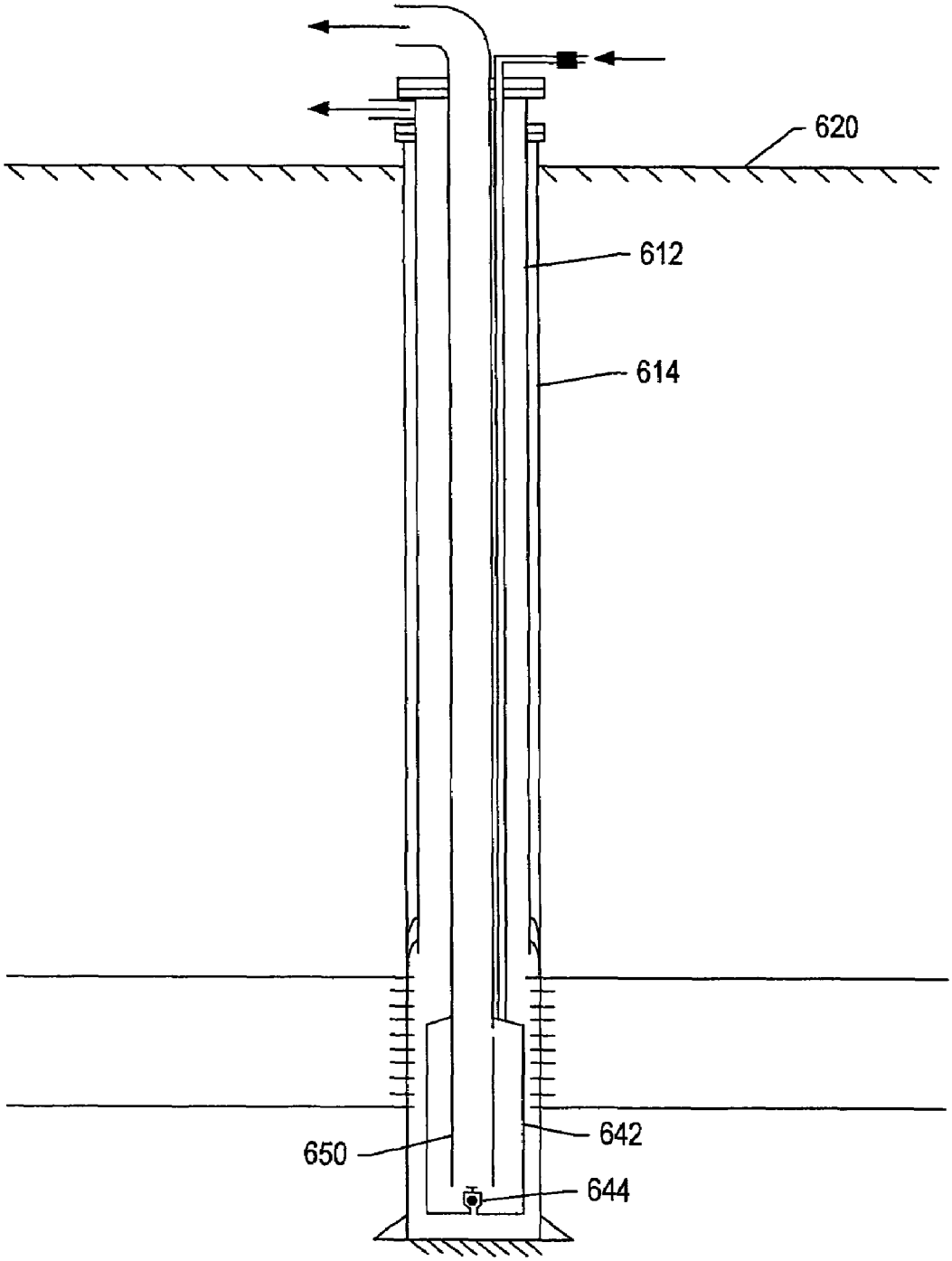
FIG. 125 depicts an embodiment of a gas lift system with concentric conduits.

FIG. 125 depicts an embodiment of a gas lift system with a separate flowpath to surface 620 for the gas/vapor phase of the production stream via a concentric conduit approach similar to that described previously for the pumping system concepts. This embodiment eliminates the need for a check valve/vent system to commingle the gas/vapor stream into the production tubing with the liquid stream from the chamber as depicted in FIGS. 123 and 124 while including advantages of the concentric inner conduit 612 and outer conduit 614 depicted in FIGS. 116-118.

Figure 126:
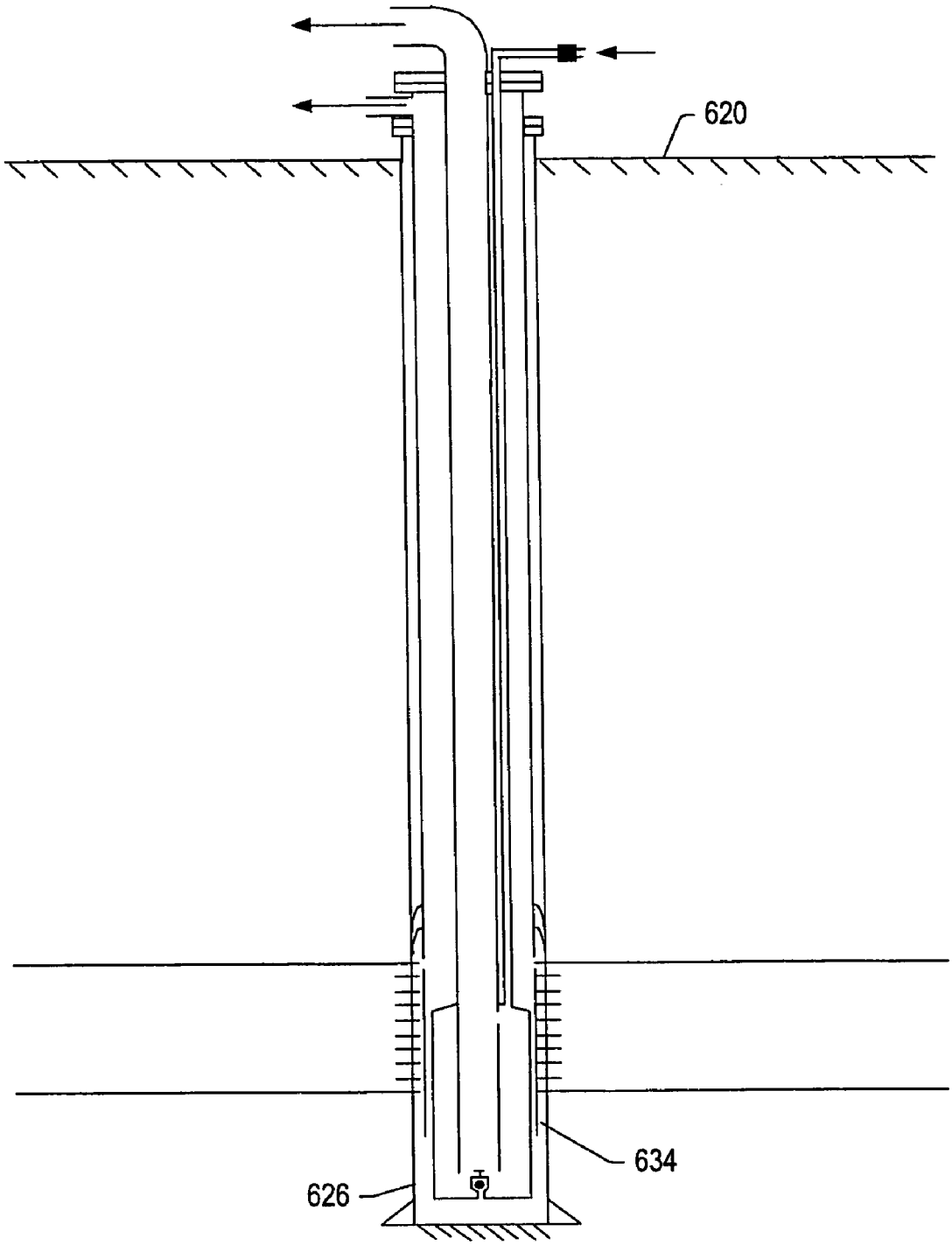
FIG. 126 depicts an embodiment of a gas lift system with a gas/vapor shroud and sump.

FIG. 126 depicts an embodiment of a gas lift system with gas/vapor shroud 634 extending down into the sump 626. Gas/vapor shroud 634 and sump 626 provide the same advantages as described with respect to FIG. 118.

In an embodiment, a temperature limited heater is used in a horizontal heater/production well. The temperature limited heater may provide selected amounts of heat to the "toe" and the "heel" of the horizontal portion of the well. More heat may be provided to the formation through the toe than through the heel, creating a "hot portion" at the toe and a "warm portion" at the heel. Formation fluids may be formed in the hot portion and produced through the warm portion, as shown in FIG. 127.

Figure 127:
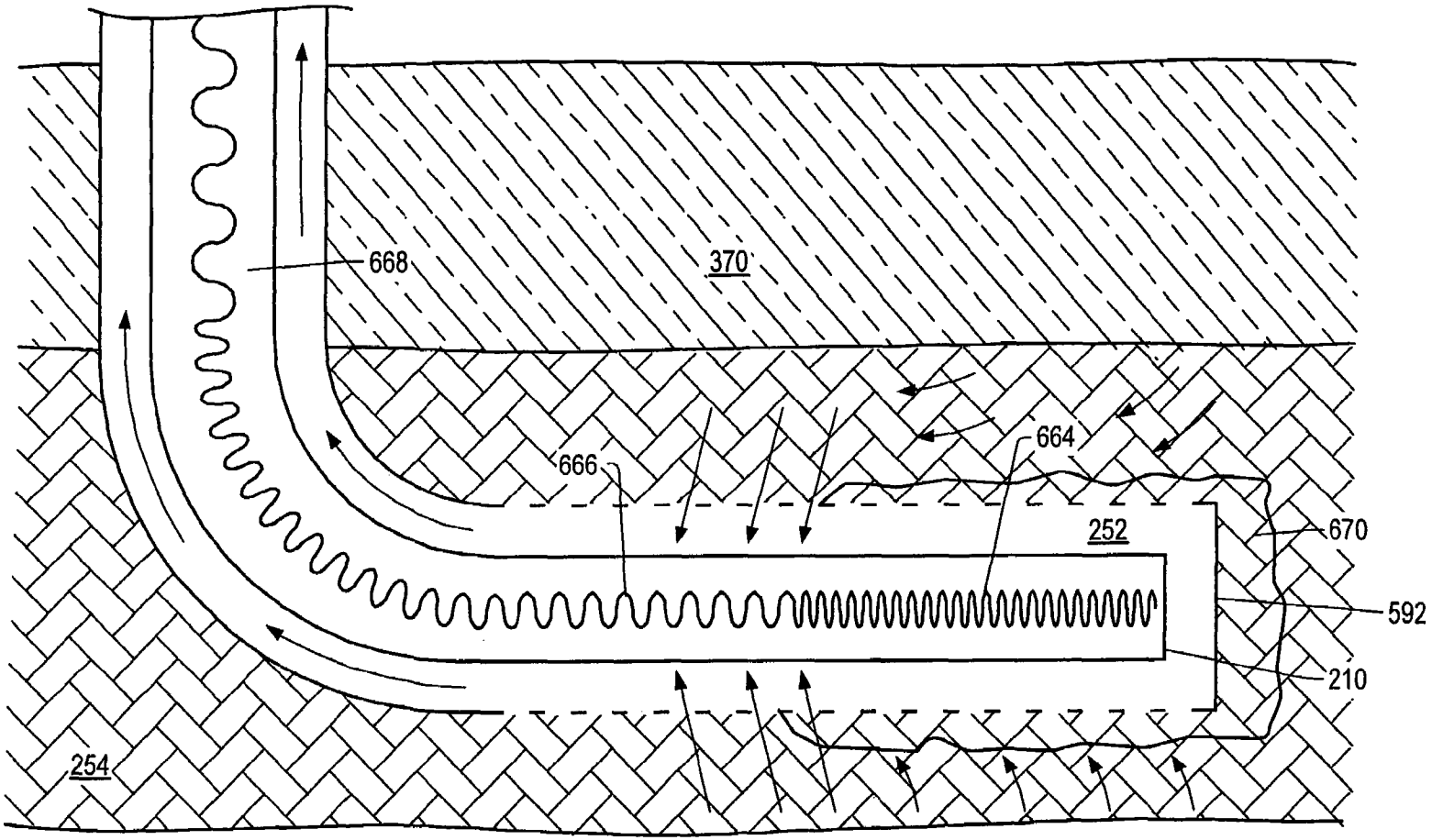
FIG. 127 depicts an embodiment of a heater well with selective heating.

FIG. 127 depicts an embodiment of a heater well for selectively heating a formation. Heat source 210 is placed in opening 252 in hydrocarbon layer 254. In certain embodiments, opening 252 is a substantially horizontal opening in hydrocarbon layer 254. Perforated casing 592 is placed in opening 252. Perforated casing 592 provides support that inhibits hydrocarbon and/or other material in hydrocarbon layer 254 from collapsing into opening 252. Perforations in perforated casing 592 allow for fluid flow from hydrocarbon layer 254 into opening 252. Heat source 210 may include hot portion 664. Hot portion 664 is a portion of heat source 210 that operates at higher heat output than adjacent portions of the heat source. For example, hot portion 664 may output between 650 W/m and 1650 W/m, 650 W/m and 1500 W/m, or 800 W/m and 1500 W/m. Hot portion 664 may extend from a "heel" of the heat source to the "toe" of the heat source. The heel of the heat source is the portion of the heat source closest to the point at which the heat source enters a hydrocarbon layer. The toe of the heat source is the end of the heat source furthest from the entry of the heat source into a hydrocarbon layer.

In an embodiment, heat source 210 includes warm portion 666. Warm portion 666 is a portion of heat source 210 that operates at lower heat outputs than hot portion 664. For example, warm portion 666 may output between 30 W/m and 1000 W/m, 30 W/m and 750 W/m, or 100 W/m and 750 W/m. Warm portion 666 may be located closer to the heel of heat source 210. In certain embodiments, warm portion 666 is a transition portion (for example, a transition conductor) between hot portion 664 and overburden portion 668. Overburden portion 668 is located in overburden 370. Overburden portion 668 provides a lower heat output than warm portion 666. For example, overburden portion 668 may output between 10 W/m and 90 W/m, 15 W/m and 80 W/m, or 25 W/m and 75 W/m. In some embodiments, overburden portion 668 provides as close to no heat (0 W/m) as possible to overburden 370. Some heat, however, may be used to maintain fluids produced through opening 252 in a vapor phase in overburden 370.

In certain embodiments, hot portion 664 of heat source 210 heats hydrocarbons to high enough temperatures to result in coke 670 forming in hydrocarbon layer 254. Coke 670 may occur in an area surrounding opening 252. Warm portion 666 may be operated at lower heat outputs so that coke does not form at or near the warm portion of heat source 210. Coke 670 may extend radially from opening 252 as heat from heat source 210 transfers outward from the opening. At a certain distance, however, coke 670 no longer forms because temperatures in hydrocarbon layer 254 at the certain distance will not reach coking temperatures. The distance at which no coke forms is a function of heat output (W/m from heat source 210), type of formation, hydrocarbon content in the formation, and/or other conditions in the formation.

The formation of coke 670 inhibits fluid flow into opening 252 through the coking. Fluids in the formation may, however, be produced through opening 252 at the heel of heat source 210 (for example, at warm portion 666 of the heat source) where there is little or no coke formation. The lower temperatures at the heel of heat source 210 reduce the possibility of increased cracking of formation fluids produced through the heel. Fluids may flow in a horizontal direction through the formation more easily than in a vertical direction. Typically, horizontal permeability in a relatively permeable formation is approximately 5 to 10 times greater than vertical permeability. Thus, fluids flow along the length of heat source 210 in a substantially horizontal direction. Producing formation fluids through opening 252 is possible at earlier times than producing fluids through production wells in hydrocarbon layer 254. The earlier production times through opening 252 is possible because temperatures near the opening increase faster than temperatures further away due to conduction of heat from heat source 210 through hydrocarbon layer 254. Early production of formation fluids may be used to maintain lower pressures in hydrocarbon layer 254 during start-up heating of the formation. Start-up heating of the formation is the time of heating before production begins at production wells in the formation. Lower pressures in the formation may increase liquid production from the formation. In addition, producing formation fluids through opening 252 may reduce the number of production wells needed in the formation.

In some embodiments, a temperature limited heater is used to heat a surface pipeline such as a sulfur transfer pipeline. For example, a surface sulfur pipeline may be heated to a temperature of about 100° C., about 110° C., or about 130° C. to inhibit solidification of fluids in the pipeline. Higher temperatures in the pipeline (for example, above about 130° C.) may induce undesirable degradation of fluids in the pipeline.

In some embodiments, a temperature limited heater positioned in a wellbore may heat steam that is provided to the wellbore. The heated steam may be introduced into a portion of a formation. In certain embodiments, the heated steam may be used as a heat transfer fluid to heat a portion of a formation. In an embodiment, the temperature limited heater includes ferromagnetic material with a selected Curie temperature. The use of a temperature limited heater may inhibit a temperature of the heater from increasing beyond a maximum selected temperature (for example, at or about the Curie temperature). Limiting the temperature of the heater may inhibit potential burnout of the heater. The maximum selected temperature may be a temperature selected to heat the steam to above or near 100% saturation conditions, superheated conditions, or supercritical conditions. Using a temperature limited heater to heat the steam may inhibit overheating of the steam in the wellbore. Steam introduced into a formation may be used for synthesis gas production, to heat the hydrocarbon containing formation, to carry chemicals into the formation, to extract chemicals from the formation, and/or to control heating of the formation.

A portion of a formation where steam is introduced or that is heated with steam may be at significant depths below the surface (for example, greater than about 1000 m, about 2500, or about 5000 m below the surface). If steam is heated at the surface of a formation and introduced to the formation through a wellbore, a quality of the heated steam provided to the wellbore at the surface may have to be relatively high to accommodate heat losses to a wellbore casing and/or the overburden as the steam travels down the wellbore. Heating the steam in the wellbore may allow the quality of the steam to be significantly improved before the steam is provided to the formation. A temperature limited heater positioned in a lower section of the overburden and/or adjacent to a target zone of the formation may be used to controllably heat steam to improve the quality of the steam injected into the formation and/or inhibit condensation along the length of the heater. In certain embodiments, the temperature limited heater improves the quality of the steam injected and/or inhibits condensation in the wellbore for long steam injection wellbores (especially for long horizontal steam injection wellbores).

A temperature limited heater positioned in a wellbore may be used to heat the steam to above or near 100% saturation conditions or superheated conditions. In some embodiments, a temperature limited heater may heat the steam so that the steam is above or near supercritical conditions. The static head of fluid above the temperature limited heater may facilitate producing 100% saturation, superheated, and/or supercritical conditions in the steam. Supercritical or near supercritical steam may be used to strip hydrocarbon material and/or other materials from the formation. In certain embodiments, steam introduced into a formation may have a high density (for example, a specific gravity of about 0.8 or above). Increasing the density of the steam may improve the ability of the steam to strip hydrocarbon material and/or other materials from the formation.

Non-restrictive examples are set forth below.

Figure 128:
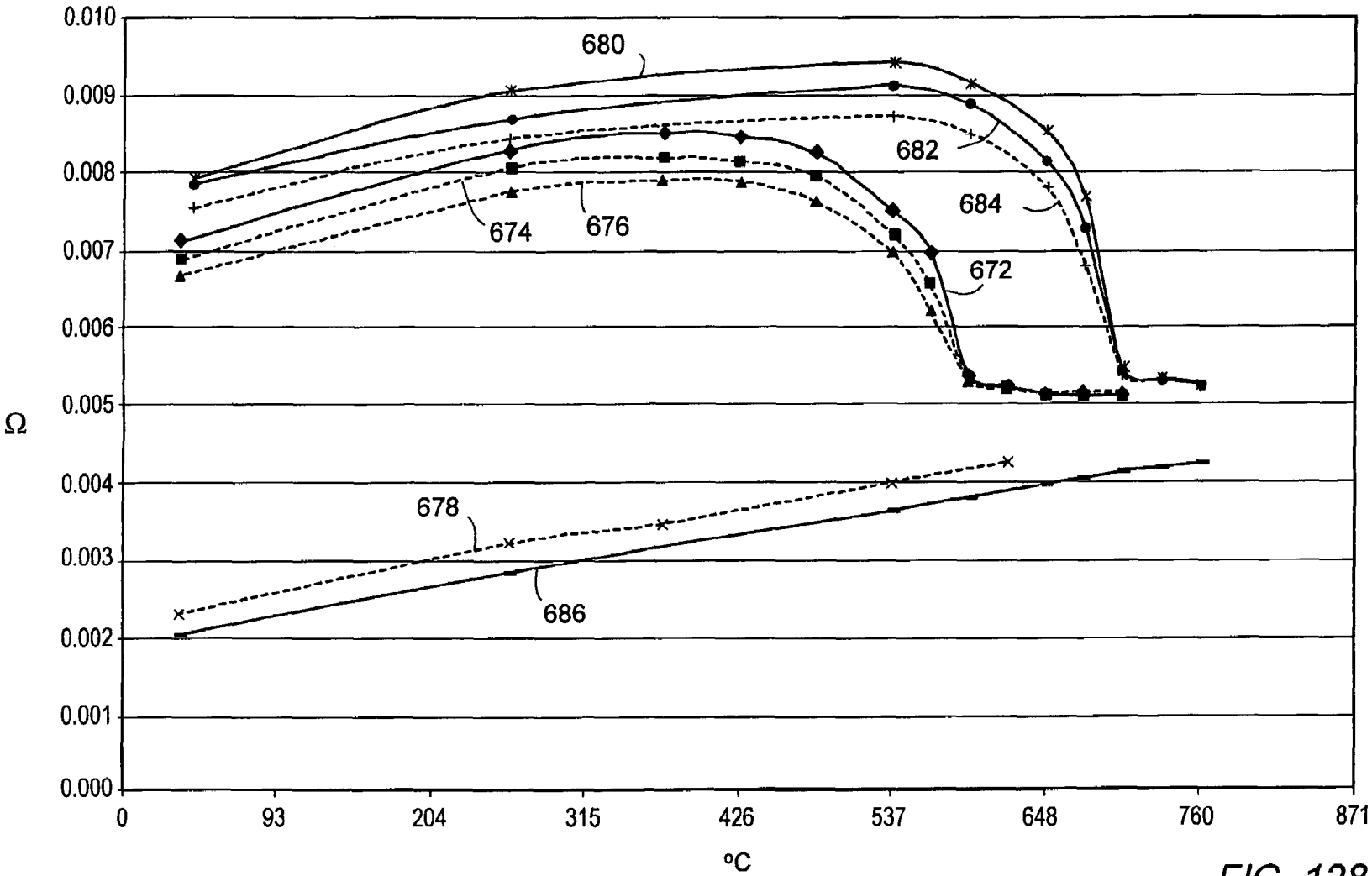
FIG. 128 depicts electrical resistance versus temperature at various applied electrical currents for a 446 stainless steel rod.

FIGS. 128-135 depict experimental data for temperature limited heaters. FIG. 128 depicts electrical resistance (Ω) versus temperature (° C.) at various applied electrical currents for a 446 stainless steel rod with a diameter of 2.5 and a 410 stainless steel rod with a diameter of 2.5 cm. Both rods had a length of 1.8 m. Curves 672-678 depict resistance profiles as a function of temperature for the 446 stainless steel rod at 440 amps AC (curve 672), 450 amps AC (curve 674), 500 amps AC (curve 676), and 10 amps DC (curve 678). Curves 680-686 depict resistance profiles as a function of temperature for the 410 stainless steel rod at 400 amps AC (curve 680), 450 amps AC (curve 682), 500 amps AC (curve 684), 10 amps DC (curve 686). For both rods, the resistance gradually increased with temperature until the Curie temperature was reached. At the Curie temperature, the resistance fell sharply. Above the Curie temperature, the resistance decreased slightly with increasing temperature. Both rods show a trend of decreasing resistance with increasing AC current. Accordingly, the turndown ratio decreased with increasing current. Thus, the rods provide a reduced amount of heat near and above the Curie temperature of the rods. In contrast, the resistance gradually increased with temperature through the Curie temperature with the applied DC current.

Figure 129:
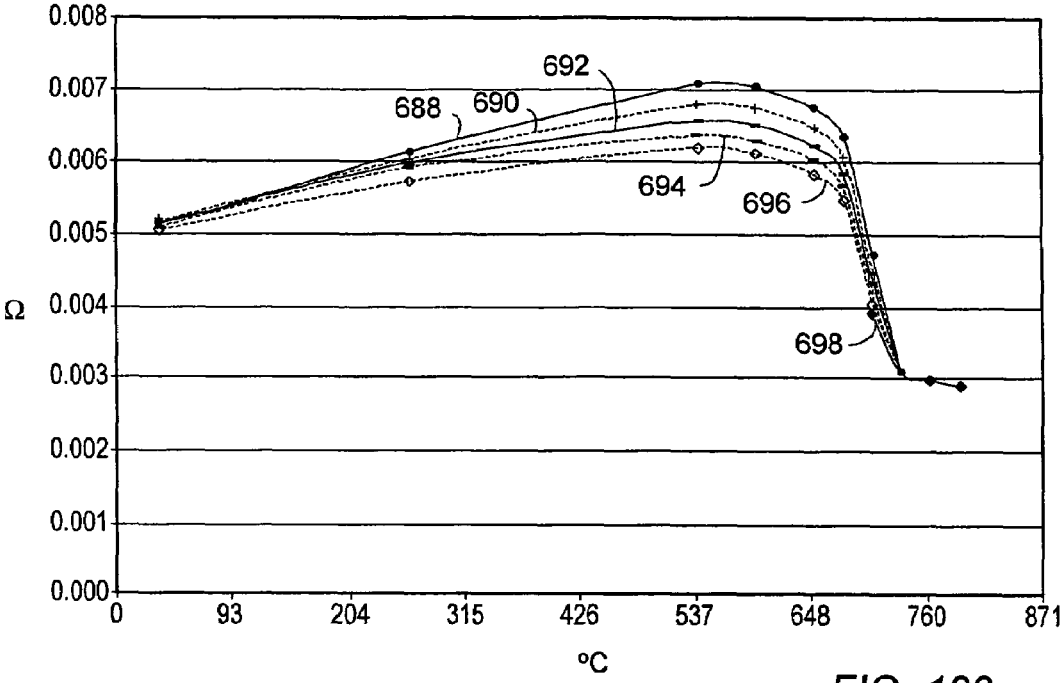
FIG. 129 shows resistance profiles as a function of temperature at various applied electrical currents for a copper rod contained in a conduit of Sumitomo HCM12A.

FIG. 129 shows resistance profiles as a function of temperature at various applied electrical currents for a copper rod contained in a conduit of Sumitomo HCM12A (a high strength 410 stainless steel). The Sumitomo conduit had a diameter of 5.1 cm, a length of 1.8 m, and a wall thickness of about 0.1 cm. Curves 688-698 show that at all applied currents (688: 300 amps AC; 690: 350 amps AC; 692: 400 amps AC; 694: 450 amps AC; 696: 500 amps AC; 698: 550 amps AC), resistance increased gradually with temperature until the Curie temperature was reached. At the Curie temperature, the resistance fell sharply. As the current increased, the resistance decreased, resulting in a smaller turndown ratio.

Figure 130:
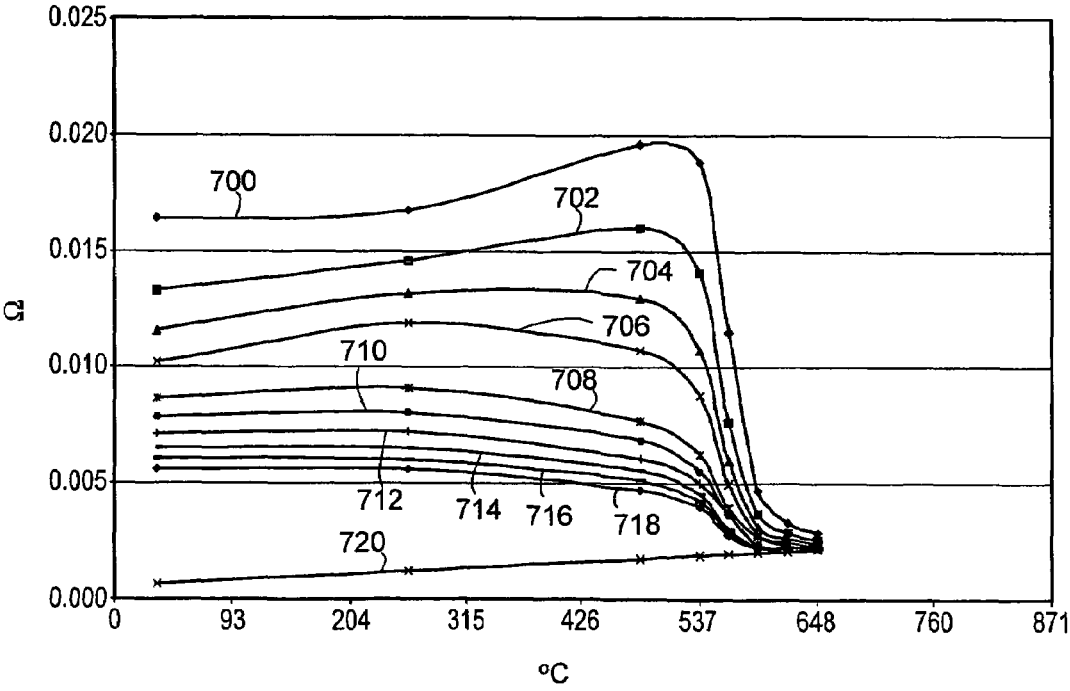
FIG. 130 depicts electrical resistance versus temperature at various applied electrical currents for a temperature limited heater.
Figure 131:
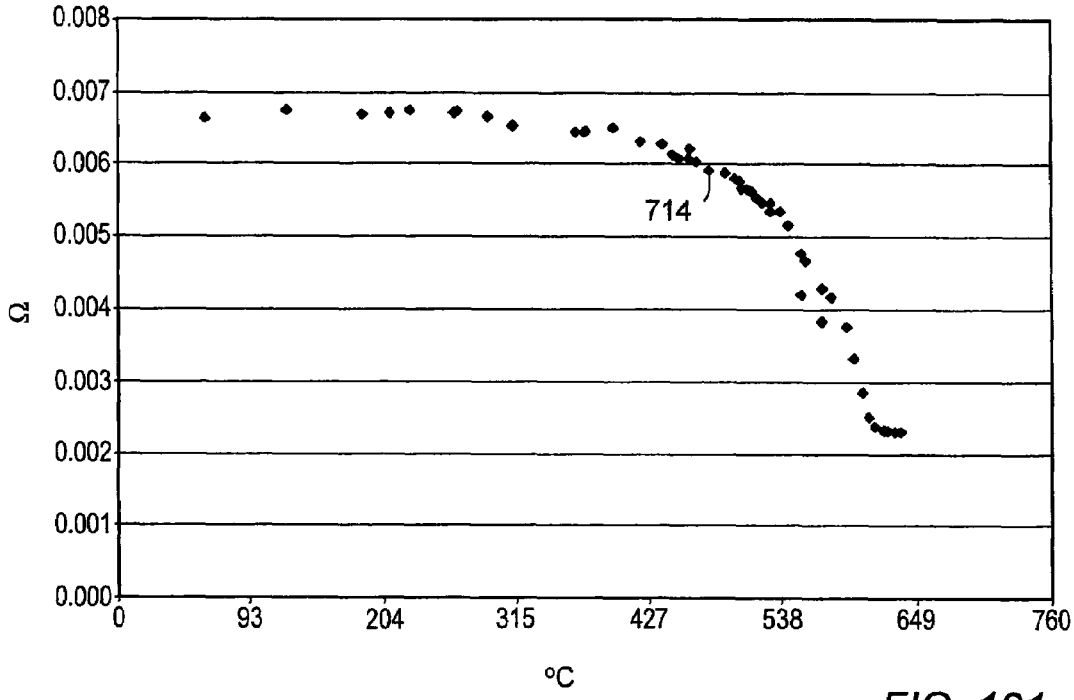
FIG. 131 depicts raw data for a temperature limited heater.
Figure 132:
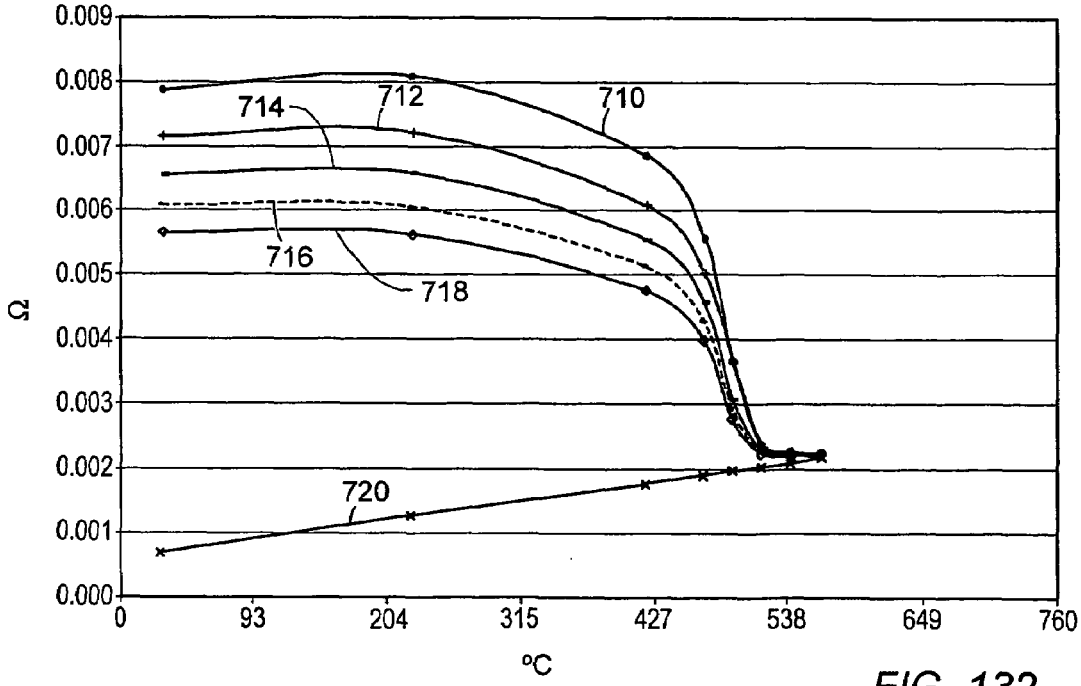
FIG. 132 depicts electrical resistance versus temperature at various applied electrical currents for a temperature limited heater.

FIG. 130 depicts electrical resistance versus temperature at various applied electrical currents for a temperature limited heater. The temperature limited heater included a 4/0 MGT-1000 furnace cable inside an outer conductor of ¾" Schedule 80 Sandvik (Sweden) 4C54 (446 stainless steel) with a 0.30 cm thick copper sheath welded onto the outside of the Sandvik 4C54 and a length of 1.8 m. Curves 700 through 718 show resistance profiles as a function of temperature for AC applied currents ranging from 40 amps to 500 amps (700: 40 amps; 702: 80 amps; 704: 120 amps; 706: 160 amps; 708: 250 amps; 710: 300 amps; 712: 350 amps; 714: 400 amps; 716: 450 amps; 718: 500 amps). FIG. 131 depicts the raw data for curve 714. FIG. 132 depicts the data for selected curves 710, 712, 714, 716, 718, and 720. At lower currents (below 250 amps), the resistance increased with increasing temperature up to the Curie temperature. At the Curie temperature, the resistance fell sharply. At higher currents (above 250 amps), the resistance decreased slightly with increasing temperature up to the Curie temperature. At the Curie temperature, the resistance fell sharply. Curve 720 shows resistance for an applied DC electrical current of 10 amps. Curve 720 shows a steady increase in resistance with increasing temperature, with little or no deviation at the Curie temperature.

Figure 133:
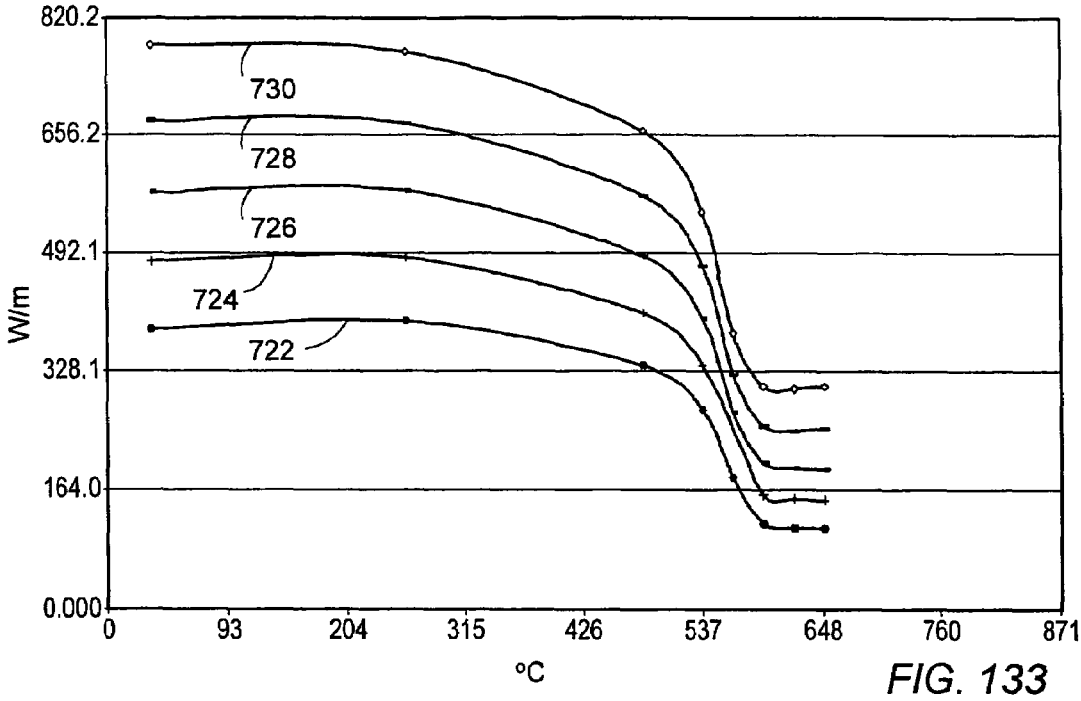
FIG. 133 depicts power versus temperature at various applied electrical currents for a temperature limited heater.

FIG. 133 depicts power versus temperature at various applied electrical currents for a temperature limited heater. The temperature limited heater included a 4/0 MGT-1000 furnace cable inside an outer conductor of ¾" Schedule 80 Sandvik (Sweden) 4C54 (446 stainless steel) with a 0.30 cm thick copper sheath welded onto the outside of the Sandvik 4C54 and a length of 1.8 m. Curves 722-730 depict power versus temperature for AC applied currents of 300 amps to 500 amps (722: 300 amps; 724: 350 amps; 726: 400 amps; 728: 450 amps; 730: 500 amps). Increasing the temperature gradually decreased the power until the Curie temperature was reached. At the Curie temperature, the power decreased rapidly.

Figure 134:
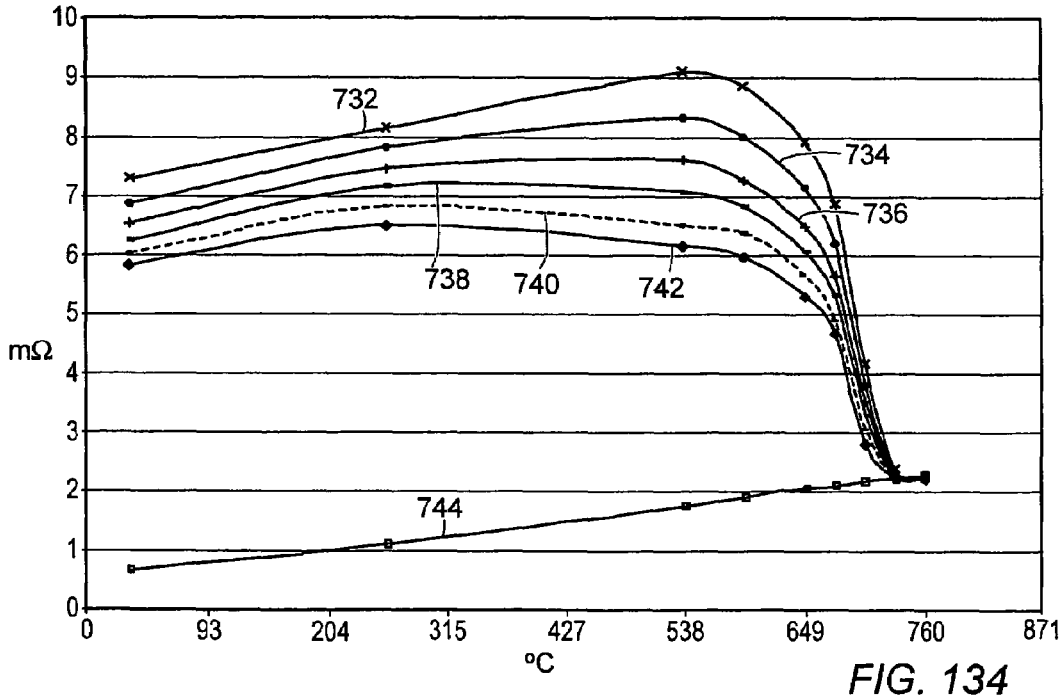
FIG. 134 depicts electrical resistance versus temperature at various applied electrical currents for a temperature limited heater.

FIG. 134 depicts electrical resistance (mΩ) versus temperature (° C.) at various applied electrical currents for a temperature limited heater. The temperature limited heater included a copper rod with a diameter of 1.3 cm inside an outer conductor of 2.5 cm Schedule 80 410 stainless steel pipe with a 0.15 cm thick copper Everdur™ (DuPont Engineering, Wilmington, Del.) welded sheath over the 410 stainless steel pipe and a length of 1.8 m. Curves 732-742 show resistance profiles as a function of temperature for AC applied currents ranging from 300 amps to 550 amps (732: 300 amps; 734: 350 amps; 736: 400 amps; 738: 450 amps; 740: 500 amps; 742: 550 amps). For these AC applied currents, the resistance gradually increases with increasing temperature up to the Curie temperature. At the Curie temperature, the resistance falls sharply. In contrast, curve 744 shows resistance for an applied DC electrical current of 10 amps. This resistance shows a steady increase with increasing temperature, and little or no deviation at the Curie temperature.

Figure 135:
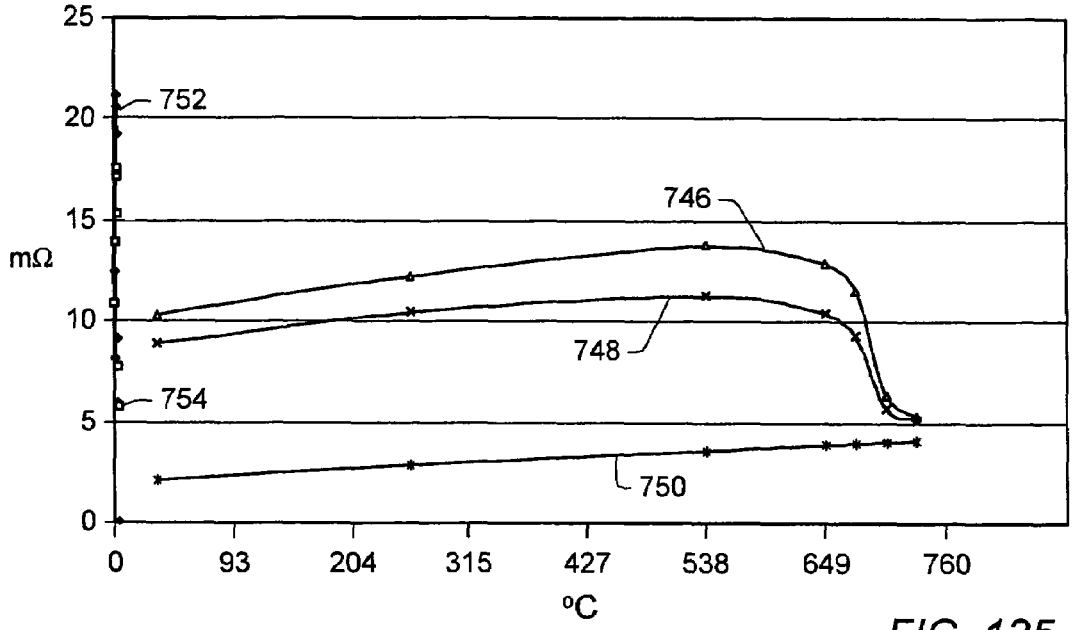
FIG. 135 depicts data of electrical resistance versus temperature for a solid 2.54 cm diameter, 1.8 m long 410 stainless steel rod at various applied electrical currents.

FIG. 135 depicts data of electrical resistance (mΩ) versus temperature (° C.) for a solid 2.54 cm diameter, 1.8 m long 410 stainless steel rod at various applied electrical currents. Curves 746, 748, 750, 752, and 754 depict resistance profiles as a function of temperature for the 410 stainless steel rod at 40 amps AC (curve 752), 70 amps AC (curve 754), 140 amps AC (curve 746), 230 amps AC (curve 748), and 10 amps DC (curve 750). For the applied AC currents of 140 amps and 230 amps, the resistance increased gradually with increasing temperature until the Curie temperature was reached. At the Curie temperature, the resistance fell sharply. In contrast, the resistance showed a gradual increase with temperature through the Curie temperature for an applied DC current.

Figure 136:
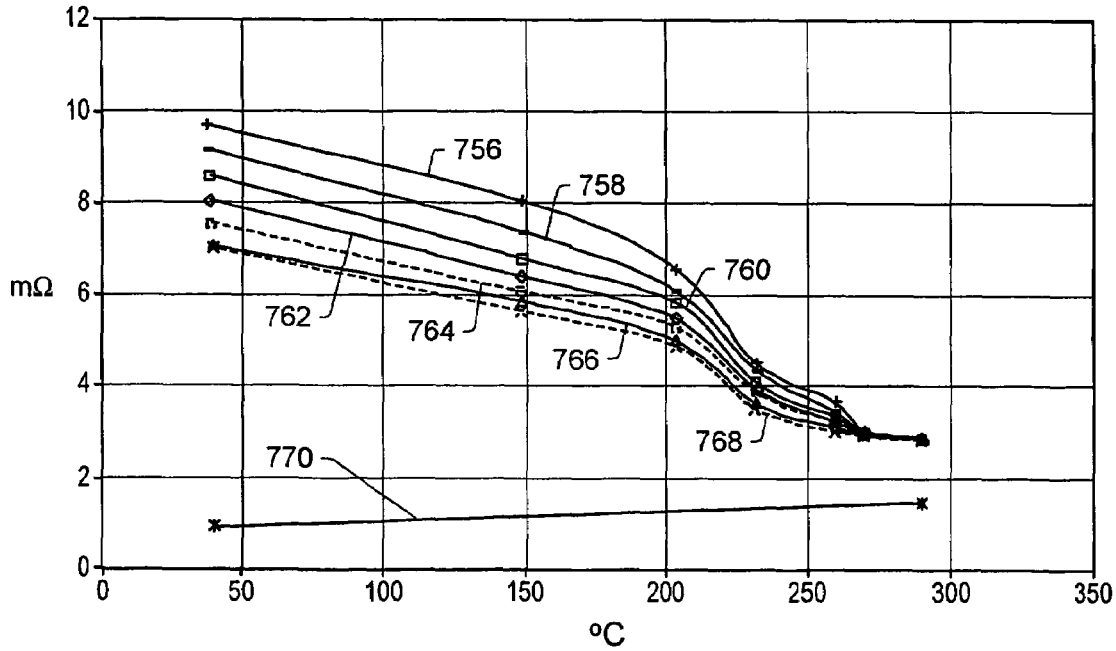
FIG. 136 depicts data of electrical resistance versus temperature for a composite 1.9 cm, 1.8 m long alloy 42-6 rod with a copper core (the rod has an outside diameter to copper diameter ratio of 2:1) at various applied electrical currents.

FIG. 136 depicts data of electrical resistance (milliohms (mΩ)) versus temperature (° C.) for a composite 0.75 inches (2.54 cm) diameter, 6 foot (1.8 m) long Alloy 42-6 rod with a 0.375 inch diameter copper core (the rod has an outside diameter to copper diameter ratio of 2:1) at various applied electrical currents. Curves 756, 758, 760, 762, 764, 766, 768, and 770 depict resistance profiles as a function of temperature for the copper cored alloy 42-6 rod at 300 A, AC (curve 756), 350 A AC (curve 758), 400 A AC (curve 760), 450 A AC (curve 762), 500 A AC (curve 764), 550 A AC (curve 766), 600 A AC (curve 768), and 10 A DC (curve 770). For the applied AC currents, the resistance decreased gradually with increasing temperature until the Curie temperature was reached. As the temperature approaches the Curie temperature, the resistance decreased more sharply. In contrast, the resistance showed a gradual increase with temperature for an applied DC current.

Figure 137:
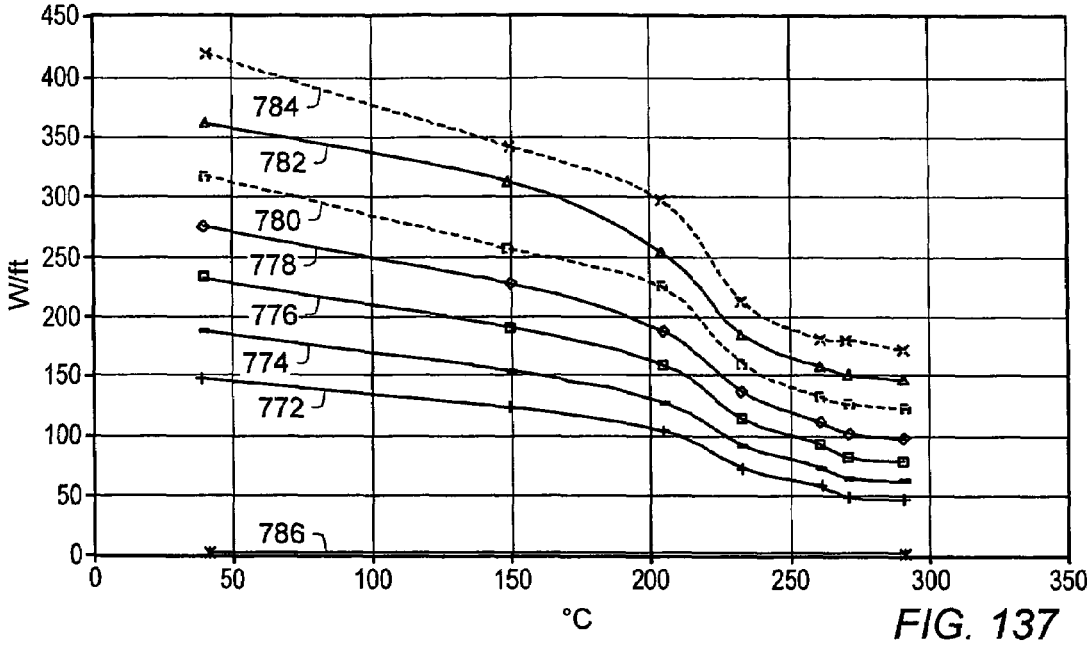
FIG. 137 depicts data of power output versus temperature for a composite 1.9 cm, 1.8 m long alloy 42-6 rod with a copper core (the rod has an outside diameter to copper diameter ratio of 2:1) at various applied electrical currents.

FIG. 137 depicts data of power output (watts per foot (W/ft)) versus temperature (° C.) for a composite 10.75 inches (1.9 cm) diameter, 6 foot (1.8 m) long Alloy 42-6 rod with a 0.375 inch diameter copper core (the rod has an outside diameter to copper diameter ratio of 2:1) at various applied electrical currents. Curves 772, 774, 776, 778, 780, 782, 784, and 786 depict power as a function of temperature for the copper cored alloy 42-6 rod at 300 A AC (curve 772), 350 A AC (curve 774), 400 A AC (curve 776), 450 A AC (curve 778), 500 A AC (curve 780), 550 A AC (curve 782), 600 A AC (curve 784), and 10 A DC (curve 786). For the applied AC currents, the power output decreased gradually with increasing temperature until the Curie temperature was reached. As the temperature approaches the Curie temperature, the power output decreased more sharply. In contrast, the power output showed a relatively flat profile with temperature for an applied DC current.

Figure 138:
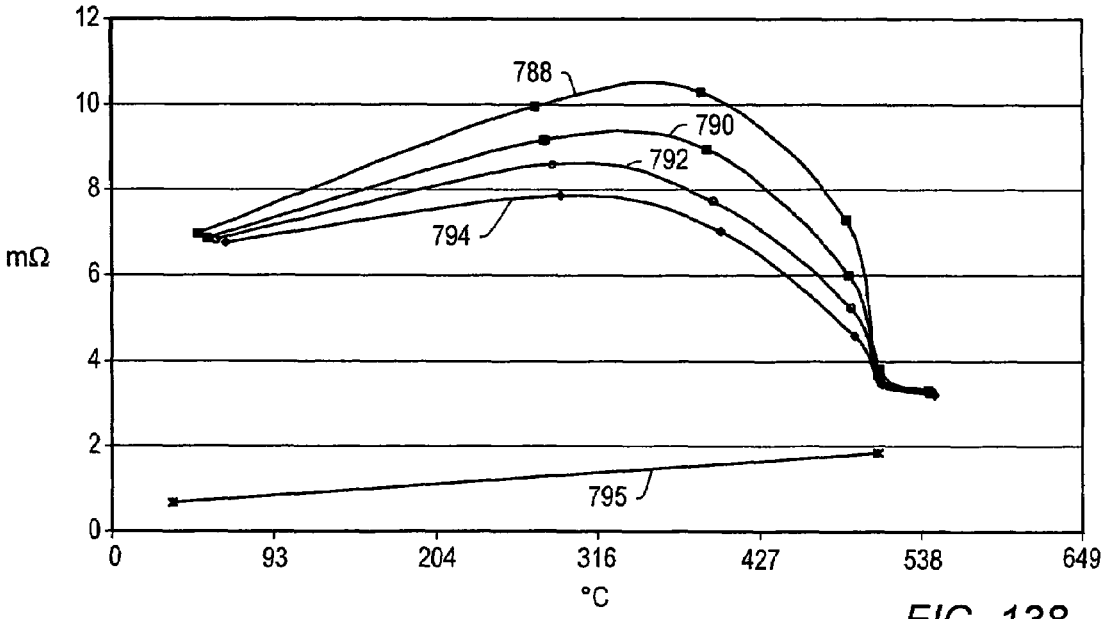

FIG. 138 depicts data of electrical resistance (milliohms (mΩ)) versus temperature (° C.) for a composite 0.75" diameter, 6 foot long Alloy 52 rod with a 0.375" diameter copper core at various applied electrical currents. Curves 788, 790, 792, 794, and 795 depict resistance profiles as a function of temperature for the copper cored Alloy 52 rod at 300 A AC (curve 788), 400 A AC (curve 790), 500 A AC (curve 792), 600 A AC (curve 794), and 10 A DC (curve 795). For the applied AC currents, the resistance increased gradually with increasing temperature until around 320° C. After 320° C., the resistance began to decrease gradually, decreasing more sharply as the temperature approached the Curie temperature. At the Curie temperature, the AC resistance decreased very sharply. In contrast, the resistance showed a gradual increase with temperature for an applied DC current. The turndown ratio for the 400 A applied AC current (curve 790) was 2.8.

Figure 139:
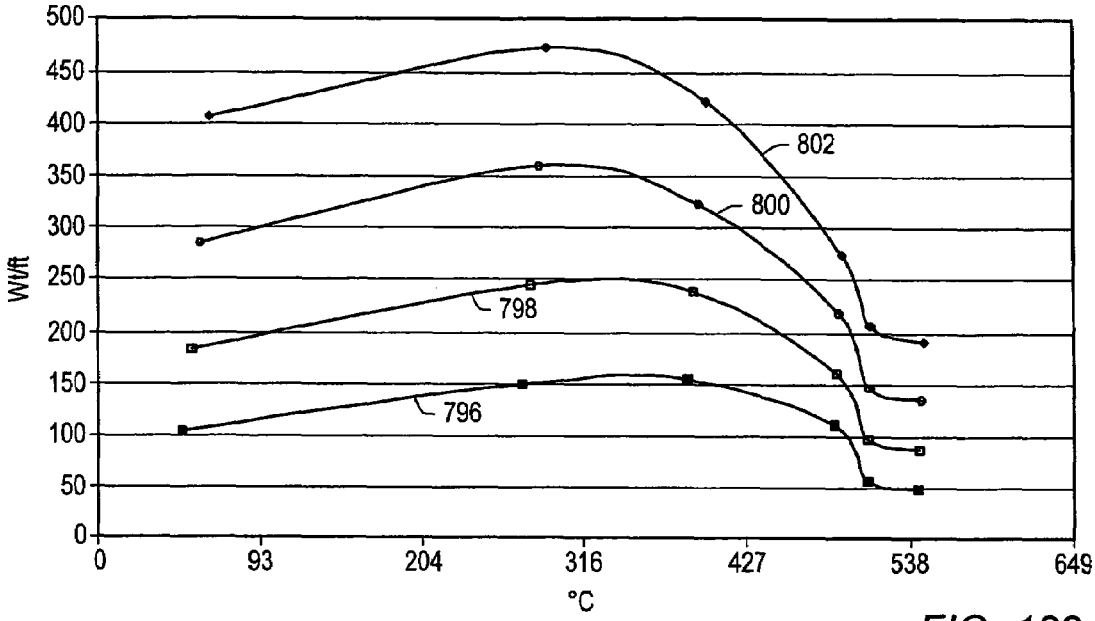

FIG. 139 depicts data of power output (watts per foot (W/ft)) versus temperature (° C.) for a composite 10.75" diameter, 6 foot long Alloy 52 rod with a 0.375" diameter copper core at various applied electrical currents. Curves 796, 798, 800, and 802 depict power as a function of temperature for the copper cored Alloy 52 rod at 300 A AC (curve 796 400 A AC (curve 798), 500 A AC (curve 800), and 600 A AC (curve 802). For the applied AC currents, the power output increased gradually with increasing temperature until around 320° C. After 320° C., the power output began to decrease gradually, decreasing more sharply as the temperature approached the Curie temperature. At the Curie temperature, the power output decreased very sharply.

Figure 140:
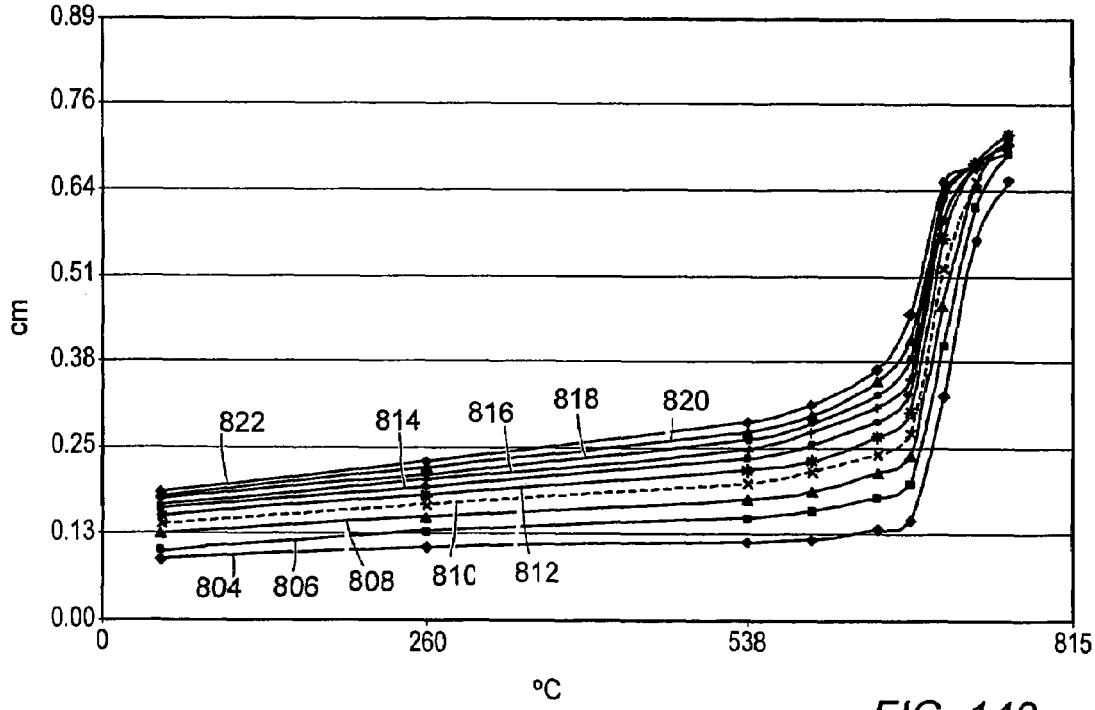

FIG. 140 depicts data for values of skin depth (cm) versus temperature (° C.) for a solid 2.54 cm diameter, 1.8 m long 410 stainless steel rod at various applied AC electrical currents. The skin depth was calculated using EQN. 6:

$$\delta = R_1 - R_1 \times (1 - (1/R_{AC}/R_{DC}))^{1/2}; \quad (6)$$

where δ is the skin depth, $R_1$ is the radius of the cylinder, $R_{AC}$ is the AC resistance, and $R_{DC}$ is the DC resistance. In FIG. 140, curves 804-822 show skin depth profiles as a function of temperature for applied AC electrical currents over a range of 50 amps to 500 amps (804: 50 amps; 806: 100 amps; 808: 150 amps; 810: 200 amps; 812: 250 amps; 814; 300 amps; 816: 350 amps; 818: 400 amps; 820: 450 amps; 822: 500 amps). For each applied AC electrical current, the skin depth gradually increased with increasing temperature up to the Curie temperature. At the Curie temperature, the skin depth increased sharply.

Figure 141:
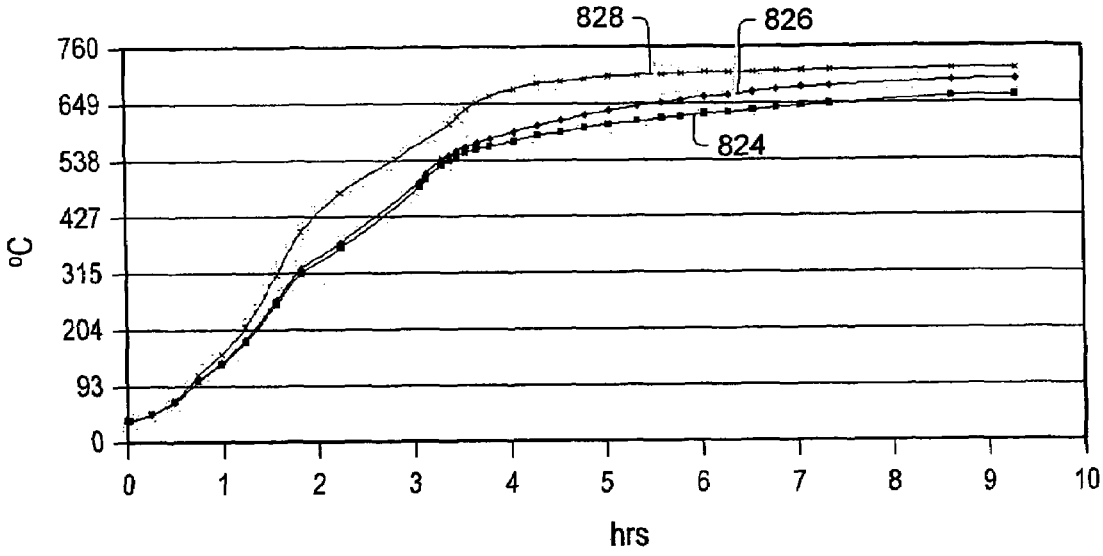

FIG. 141 depicts temperature (° C.) versus time (hrs) for a temperature limited heater. The temperature limited heater was a 1.83 m long heater that included a copper rod with a diameter of 1.3 cm inside a 2.5 cm Schedule XXH 410 stainless steel pipe and a 0.325 cm copper sheath. The heater was placed in an oven for heating. Alternating current was applied to the heater when the heater was in the oven. The current was increased over two hours and reached a relatively constant value of 400 amps for the remainder of the time. Temperature of the stainless steel pipe was measured at three points at 0.46 m intervals along the length of the heater. Curve 824 depicts the temperature of the pipe at a point 0.46 m inside the oven and closest to the lead-in portion of the heater. Curve 826 depicts the temperature of the pipe at a point 0.46 m from the end of the pipe and furthest from the lead-in portion of the heater. Curve 828 depicts the temperature of the pipe at about a center point of the heater. The point at the center of the heater was further enclosed in a 0.3 m section of 2.5 cm thick Fiberfrax® (Unifrax Corp., Niagara Falls, N.Y.) insulation. The insulation was used to create a low thermal conductivity section on the heater (a section where heat transfer to the surroundings is slowed or inhibited (a "hot spot")). The temperature of the heater increased with time as shown by curves 828, 826, and 824. Curves 828, 826, and 824 show that the temperature of the heater increased to about the same value for all three points along the length of the heater. The resulting temperatures were substantially independent of the added Fiberfrax® insulation. Thus, the operating temperatures of the temperature limited heater were substantially the same despite the differences in thermal load (due to the insulation) at each of the three points along the length of the heater. Thus, the temperature limited heater did not exceed the selected temperature limit in the presence of a low thermal conductivity section.

Figure 142:
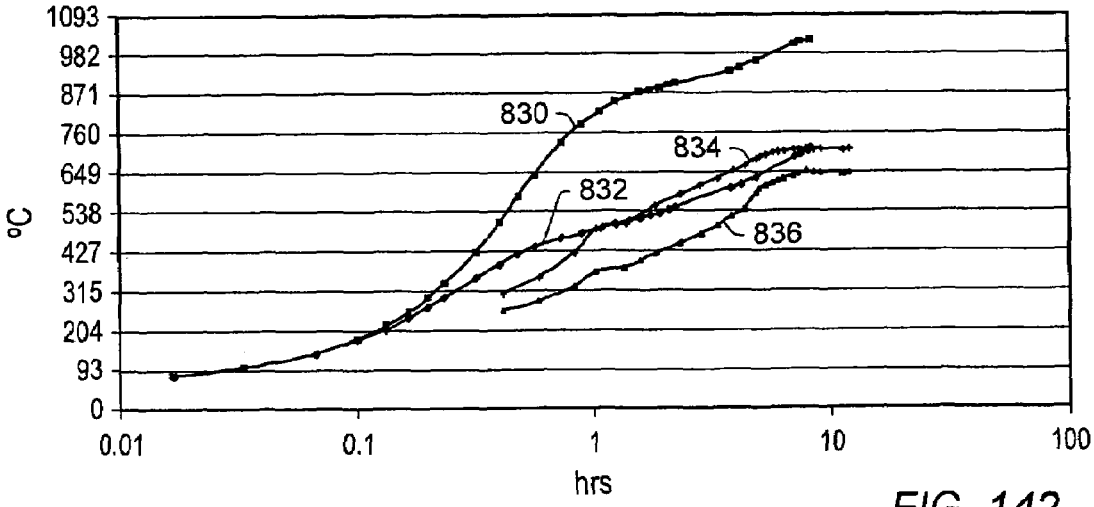

FIG. 142 depicts temperature (° C.) versus log time (hrs) data for a 2.5 cm solid 410 stainless steel rod and a 2.5 cm solid 304 stainless steel rod. At a constant applied AC electrical current, the temperature of each rod increased with time. Curve 830 shows data for a thermocouple placed on an outer surface of the 304 stainless steel rod and under a layer of insulation. Curve 832 shows data for a thermocouple placed on an outer surface of the 304 stainless steel rod without a layer of insulation. Curve 834 shows data for a thermocouple placed on an outer surface of the 410 stainless steel rod and under a layer of insulation. Curve 836 shows data for a thermocouple placed on an outer surface of the 410 stainless steel rod without a layer of insulation. A comparison of the curves shows that the temperature of the 304 stainless steel rod (curves 830 and 832) increased more rapidly than the temperature of the 410 stainless steel rod (curves 834 and 836). The temperature of the 304 stainless steel rod (curves 830 and 832) also reached a higher value than the temperature of the 410 stainless steel rod (curves 834 and 836). The temperature difference between the non-insulated section of the 410 stainless steel rod (curve 836) and the insulated section of the 410 stainless steel rod (curve 834) less than the temperature difference between the non-insulated section of the 304 stainless steel rod (curve 832) and the insulated section of the 304 stainless steel rod (curve 830). The temperature of the 304 stainless steel rod was increasing at the termination of the experiment (curves 830 and 832) while the temperature of the 410 stainless steel rod had leveled out (curves 834 and 836). Thus, the 410 stainless steel rod (the temperature limited heater) provided better temperature control than the 304 stainless steel rod (the non-temperature limited heater) in the presence of varying thermal loads (due to the insulation).

A 6 foot temperature limited heater element was placed in a 6 foot 347H stainless steel canister. The heater element was connected to the canister in a series configuration. The heater element and canister were placed in an oven. The oven was used to raise the temperature of the heater element and the canister. At varying temperatures, a series of electrical currents were passed through the heater element and returned through the canister. The resistance of the heater element and the power factor of the heater element were determined from measurements during passing of the electrical currents.

Figure 143:
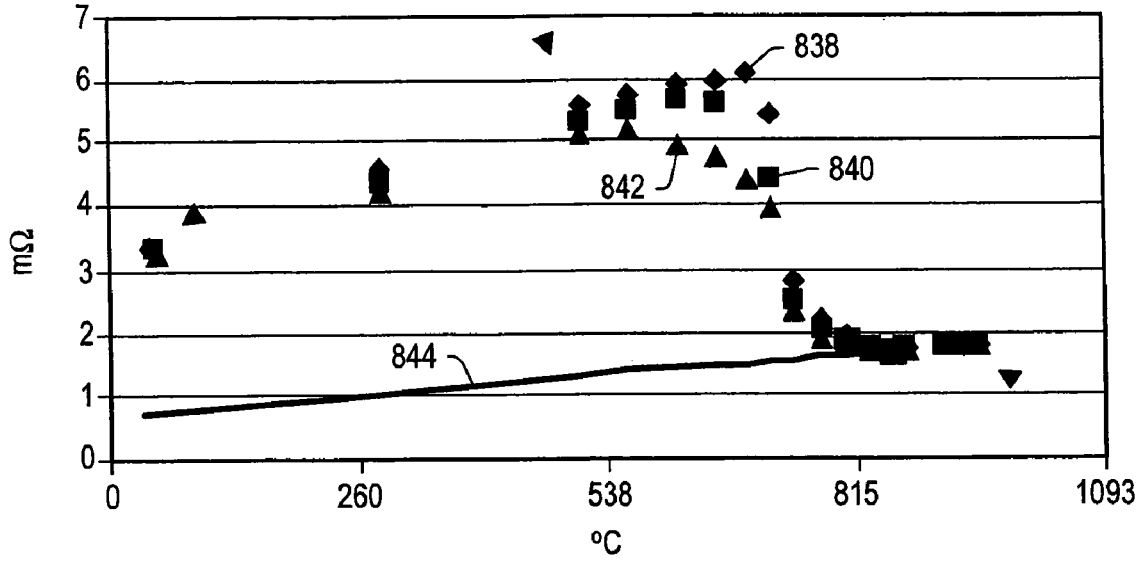

FIG. 143 depicts experimentally measured resistance versus temperature at several currents for a temperature limited heater with a copper core, a carbon steel ferromagnetic conductor, and a 347H stainless steel support member. The ferromagnetic conductor was a low-carbon steel with a Curie temperature of 770° C. The ferromagnetic conductor was sandwiched between the copper core and the 347H support member. The copper core had a diameter of 0.5". The ferromagnetic conductor had an outside diameter of 0.765". The support member had an outside diameter of 1.05". The canister was a 3" Schedule 160 347H stainless steel canister.

Data 838 depicts resistance versus temperature for 300 A at 60 Hz AC applied current. Data 840 depicts resistance versus temperature for 400 at 60 Hz AC applied current. Data 842 depicts resistance versus temperature for 500 at 60 Hz AC applied current. Curve 844 depicts resistance versus temperature for 10 A DC applied current. The resistance versus temperature data indicates that the AC resistance of the temperature limited heater linearly increased up to a temperature near the Curie temperature of the ferromagnetic conductor. Near the Curie temperature, the AC resistance decreased rapidly until the AC resistance equaled the DC resistance above the Curie temperature. The linear dependence of the AC resistance below the Curie temperature at least partially reflects the linear dependence of the AC resistance of 347H at these temperatures. Thus, the linear dependence of the AC resistance below the Curie temperature indicates that the majority of the current is flowing through the 347H support member at these temperatures.

FIG. 144 depicts experimentally measured resistance versus temperature data at several currents for a temperature limited heater with a copper core, a iron-cobalt ferromagnetic conductor, and a 347H stainless steel support member. The iron-cobalt ferromagnetic conductor was a iron-cobalt conductor with 6% cobalt by weight and a Curie temperature of 834° C. The ferromagnetic conductor was sandwiched between the copper core and the 347H support member. The copper core had a diameter of 0.465". The ferromagnetic conductor had an outside diameter of 0.765". The support member had an outside diameter of 1.05". The canister was a 3" Schedule 160 347H stainless steel canister.

Data 846 depicts resistance versus temperature for 100 A at 60 Hz AC applied current. Data 848 depicts resistance versus temperature for 400 A at 60 Hz AC applied current. Curve 850 depicts resistance versus temperature for 10 A DC. The AC resistance of this temperature limited heater turned down at a higher temperature than the previous temperature limited heater. This was due to the added cobalt increasing the Curie temperature of the ferromagnetic conductor. The AC resistance was substantially the same as the AC resistance of a tube of 347H steel having the dimensions of the support member. This indicates that the majority of the current is flowing through the 347H support member at these temperatures. The resistance curves in FIG. 144 are generally the same shape as the resistance curves in FIG. 143.

Figure 145:
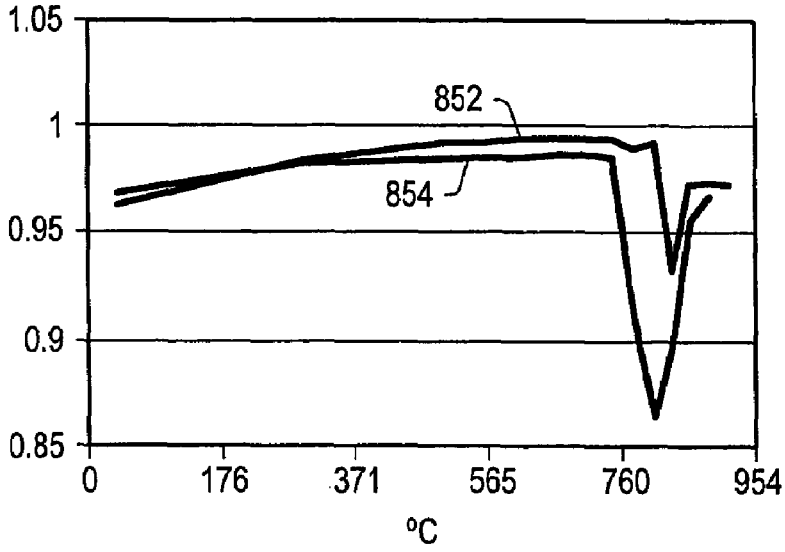

FIG. 145 depicts experimentally measured power factor versus temperature at two AC currents for the temperature limited heater with the copper core, the iron-cobalt ferromagnetic conductor, and the 347H stainless steel support member. Curve 852 depicts power factor versus temperature for 100 A at 60 Hz AC applied current. Curve 854 depicts power factor versus temperature for 400 A at 60 Hz AC applied current. The power factor was close to unity (1) except for the region around the Curie temperature. In the region around the Curie temperature, the non-linear magnetic properties and a larger portion of the current flowing through the ferromagnetic conductor produce inductive effects and distortion in the heater that lowers the power factor. FIG. 145 shows that the minimum value of the power factor for this heater remained above 0.85 at all temperatures in the experiment. Because only portions of the temperature limited heater used to heat a subsurface formation may be at the Curie temperature at any given point in time and the power factor for these portions does not go below 0.85 during use, the power factor for the entire temperature limited heater would remain above 0.85 (for example, above 0.9 or above 0.95a) during use.

Figure 146:
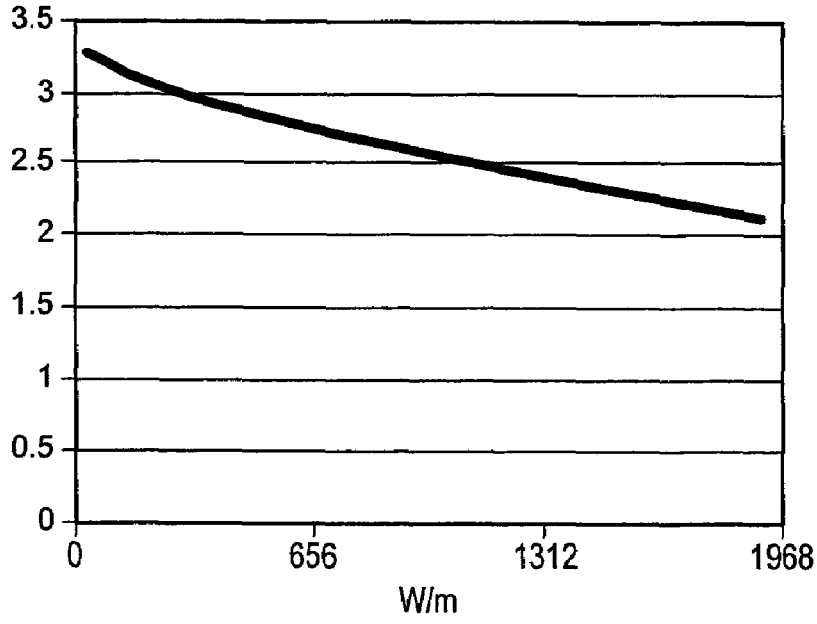

From the data in the experiments for the temperature limited heater with the copper core, the iron-cobalt ferromagnetic conductor, and the 347H stainless steel support member, the turndown ratio was calculated as a function of the maximum power delivered by the temperature limited heater. The results of these calculations are depicted in FIG. 146. The curve in FIG. 146 shows that the turndown ratio remains above 2 for heater powers up to approximately 2000 W/m. This curve is used to determine the ability of a heater to effectively provide heat output in a sustainable manner. A temperature limited heater with the curve similar to the curve in FIG. 146 would be able to provide sufficient heat output while maintaining temperature limiting properties that inhibit the heater from overheating or malfunctioning.

A theoretical model has been used to predict the experimental results. The theoretical model is based on an analytical solution for the AC resistance of a composite conductor. The composite conductor has a thin layer of ferromagnetic material, with a relative magnetic permeability $\mu_2/\mu_0 >> 1$, sandwiched between two non-ferromagnetic materials, whose relative magnetic permeabilities, $\mu_1/\mu_0$, and $\mu_3/\mu_0$, are close to unity and within which skin effects are negligible. An assumption in the model is that the ferromagnetic material is treated as linear. Also, the way in which the relative magnetic permeability, $\mu_2/\mu_0$, is extracted from magnetic data for use in the model is far from rigorous.

In the theoretical model, the three conductors, from innermost to outermost, have radii a<b<c with electrical conductivities $\sigma_1$, $\sigma_2$, and $\sigma_3$, respectively. The electric and magnetic fields everywhere are of the harmonic form:

Electric Fields:

$$E_1(r,t)=E_{S1}(r)e^{j\omega t};r<a; \tag{7}$$

$$E_2(r,t)=E_{S2}(r)e^{j\omega t};a<r<b;\text{ and} \tag{8}$$

$$E_3(r,t)=E_{S3}(r)e^{j\omega t};b<r<c. \tag{9}$$

Magnetic Fields:

$$H_1(r,t)=H_{S1}(r)e^{j\omega t};r<a; \tag{10}$$

$$H_2(r,t)=H_{S2}(r)e^{j\omega t};a<r<b;\text{ and} \tag{11}$$

$$H_3(r,t)=H_{S3}(r)e^{j\omega t};b<b<r<c. \tag{12}$$

The boundary conditions satisfied at the interfaces are:

$$E_{S1}(a)=E_{S2}(a);H_{S1}(a)=H_{S2}(a);\text{ and} \tag{13}$$

$$E_{S2}(b)=E_{S3}(b);H_{S2}(b)=H_{S3}(b). \tag{14}$$

Current flows uniformly in the non-Curie conductors, so that:

$$H_{S1}(a) = J_{S1}(a)(a/2) = \frac{1}{2}a\sigma_1 E_{S1}(a);\text{ and} \tag{15}$$

$$I-2\pi bH_{S3}(b)=\pi(c^2-b^2)J_{S3}(b)=\pi(c^2-b^2)\sigma_3 E_{S3}(b). \tag{16}$$

I denotes the total current flowing through the composite conductor sample. EQNS. 13 and 14 are used to express EQNS. 15 and 16 in terms of boundary conditions pertaining to material 2 (the ferromagnetic material). This yields:

$$H_{S2}(a) = \frac{1}{2}a\sigma_1 E_{S2}(a);\text{ and} \tag{17}$$

$$I=2\pi bH_{S2}(b)+\pi(c^2-b^2)\sigma_3 E_{S2}(b). \tag{18}$$

$E_{S2}(r)$ satisfies the equation:

$$\frac{1}{r}\frac{d}{dr}\left(r\frac{dE_{S2}}{dr}\right) - C^2 E_{S2} = 0, \tag{19}$$

with $$C^2=j\omega\mu_2\sigma_2. \tag{20}$$

Using the fact that:

$$H_{S2}(r) = \frac{j}{\mu_2\omega}\frac{dE_{S2}}{dr}; \tag{21}$$

the boundary conditions in EQNS. 17 and 18 are expressed in terms of $E_{S2}$ and its derivatives as follows:

$$\left.\frac{j}{\mu_2\omega}\frac{dE_{S2}}{dr}\right|_a = \frac{1}{2}a\sigma_1 E_{S2}(a);\text{ and} \tag{22}$$

$$I = 2\pi b\left.\frac{j}{\mu_2\omega}\frac{dE_{S2}}{dr}\right|_b + \pi(c^2 - b^2)\sigma_3 E_{S2}(b). \tag{23}$$

The non-dimensional coordinate, $\chi$, is introduced via the equation:

$$r = \frac{1}{2}(a+b)\left\{1 + \frac{b-a}{a+b}\chi\right\}. \tag{24}$$

$\chi$ is −1 for r=a, and $\chi$ is 1 for r=b. EQN. 19 is written in terms of $\chi$ as:

$$(1+\beta\chi)^{-1}\frac{d}{d\chi}\left\{(1+\beta\chi)\frac{dE_{S2}}{d\chi}\right\} - \alpha^2\chi = 0, \tag{25}$$

with

-continued $$\alpha = \frac{1}{2}(b-a)C; \text{ and} \tag{26}$$

$$\beta=(b-a)/(b+a). \tag{27}$$

$\alpha$ can be expressed as:

$$\alpha=\alpha_R(1-i), \tag{28}$$

with $$\alpha_R^2 = \frac{1}{8}(b-a)^2\,\mu_2\sigma_2\omega = \frac{1}{4}(b-a)^2/\delta^2. \tag{29}$$

EQNS. 22 and 23 are expressed as:

$$\left.\frac{d}{d\chi}\right|_{-1} E_a = -j\gamma_a E_a; \text{ and} \tag{30}$$

$$\left.\frac{d}{d\chi}\right|_{1} E_b = j\gamma_b E_b - j\tilde{I}. \tag{31}$$

In EQNS. 30 and 31, the short-hand notation $E_a$ and $E_b$ is used for $E_{S2}(a)$ and $E_{S2}(b)$, respectively, and the dimensionless parameters $\gamma_a$ and $\gamma_b$ and normalized current $\tilde{I}$ have been introduced. These quantities are given by:

$$\gamma_a = \frac{1}{4}a(b-a)\omega\mu_2\sigma_1;\ \gamma_b = \frac{1}{2}(c^2-b^2)(b-a)\omega\mu_2\sigma_3/b; \text{ and} \tag{32}$$

$$\tilde{I} = \frac{1}{2}(b-a)\omega\mu_2 I/(2\pi b). \tag{33}$$

EQN. 32 can be expressed in terms of dimensionless parameters by using EQN. 29. The results are:

$$\gamma_a=2(\sigma_1/\sigma_2)a\alpha_R^2/(b-a);\ \gamma_b=4(\sigma_3/\sigma_2)(c^2-b^2)\alpha_R^2/\{b(b-a)\}. \tag{34}$$

An alternative way of writing EQN. 34 is:

$$\gamma_a=(\sigma_1/\sigma_2)a\alpha_R/\delta;\ \gamma_b=2(\sigma_3/\sigma_2)(c^2-b^2)\alpha_R/(\delta b). \tag{35}$$

The mean power per unit length generated in the material is given by:

$$\begin{aligned} P &= \frac{1}{2}\Big\{\sigma_1\pi a^2|E_a|^2 + 2\pi\sigma_2\int_a^b dr\,r\,|E_{S2}(r)|^2 + \sigma_3\pi(c^2-b^2)|E_b|^2\Big\} \\ &= \frac{1}{2}\Big\{\sigma_1\pi a^2|E_a|^2 + \frac{1}{2}\pi(b^2-a^2)\sigma_2\int_{-1}^{1} d\chi\{1+\beta\chi\}|E_{S2}(r)|^2 + \sigma_3\pi(c^2-b^2)|E_b|^2\Big\}. \end{aligned} \tag{36}$$

The AC resistance is then:

$$R_{AC} = P\Big/\Big(\frac{1}{2}|I|^2\Big). \tag{37}$$

To obtain an approximate solution of EQN. 25, $\beta$ is assumed to be small enough to be neglected in EQN. 25. This assumption holds if the thickness of the ferromagnetic material (material 2) is much less than its mean radius. The general solution then takes the form:

$$E_{S2}=Ae^{\alpha x}+Be^{-\alpha x}. \tag{38}$$

Then:

$$E_a=Ae^{-\alpha}+Be^{\alpha}; \text{ and} \tag{39}$$

$$E_b=Ae^{\alpha}+Be^{-\alpha}. \tag{40}$$

Substituting EQNS. 38-40 into EQNS. 30 and 31 yields the following set of equations for A and B:

$$\alpha(Ae^{-\alpha}-Be^{\alpha})=-j\gamma_a(Ae^{-\alpha}+Be^{\alpha}); \text{ and} \tag{41}$$

$$\alpha(Ae^{60}-Be^{-\alpha})=j\gamma_b(Ae^{\alpha}+Be^{-\alpha})-j\tilde{I}. \tag{42}$$

Rearranging EQN. 41 obtains an expression for B in terms of A:

$$B = \frac{\alpha + j\gamma_a}{\alpha - j\gamma_a}e^{-2\alpha}A. \tag{43}$$

This may be written as:

$$B = \frac{\alpha_R - i\gamma_a^+}{\alpha_R + i\gamma_a^-}e^{-2\alpha_R+2i\alpha_R}A, \tag{44}$$

with $$\gamma_a^{\pm}=\gamma_a\pm\alpha_R. \tag{45}$$

If $$A=|A|\exp(i\phi_A) \tag{46}$$

and everything is referred back to the phase of A, then:

$$\phi_A=0. \tag{47}$$

From EQN. 44:

$$B=|B|\exp(i\phi_B), \text{ with} \tag{48}$$

$$|B|=(\Gamma_+/\Gamma_-)\exp(-2\alpha_R)|A|; \text{ and} \tag{49}$$

$$\phi_B=2\alpha_R-\phi_+-\phi_-; \text{ where} \tag{50}$$

$$\Gamma_{\pm}=\{\alpha_R^2+(\gamma_a^{\pm})^2\}^{0.5}; \text{ and} \tag{51}$$

$$\phi_{\pm}=\tan^{-1}\{\phi_{\pm}/\alpha_R\}. \tag{52}$$

Then:

$$E_a=|A|\exp(-\alpha_R+i\alpha_R)+|B|\exp\{\alpha_R+i(\phi_B-\alpha_R)\}; \text{ and} \tag{53}$$

$$E_b=|A|\exp(\alpha_R-i\alpha_R)+|B|\exp\{-\alpha_R+i(\phi_B+\alpha_R)\}. \tag{54}$$

Hence:

$$Re[E_a]=|A|\exp(-\alpha_R)\cos(\alpha_R)+|B|\exp(\alpha_R)\cos(\phi_B-\alpha_R); \tag{55A}$$

$$Im[E_a]=|A|\exp(-\alpha_R)\sin(\alpha_R)+|B|\exp(\alpha_R)\sin(\phi_B-\alpha_R); \tag{55B}$$

$$Re[E_b]=|A|\exp(\alpha_R)\cos(\alpha_R)+|B|\exp(-\alpha_R)\cos(\phi_B+\alpha_R); \text{ and} \tag{55C}$$

$$Im[E_a]=-|A|\exp(\alpha_R)\sin(\alpha_R)+|B|\exp(-\alpha_R)\sin(\phi_B+\alpha_R). \tag{55D}$$

The ratio of absolute values of currents flowing through the center and outer conductors is then given by:

$$\frac{|I_1|}{|I_3|} = \frac{a^2\sigma_1}{(c^2-b^2)\sigma_3}\sqrt{\frac{\mathrm{Re}^2[E_a]+\mathrm{Im}^2[E_a]}{\mathrm{Re}^2[E_b]+\mathrm{Im}^2[E_b]}}. \tag{56}$$

The total current flowing through the center conductor is given by:

$$I_2=\sigma_2\pi(b^2-a^2)(A+B)\sin h(\alpha)/\alpha. \tag{57}$$

Now:

$$\sin h(\alpha)/\alpha=(1+i)\{\sin h(\alpha_R)\cos(\alpha_R)-i\cos h(\alpha_R)\sin(\alpha_R)\}/(2\alpha_R)=(S^+ + S^- i), \text{ with} \tag{58}$$

$$S^{\pm}=\{\sin h(\alpha_R)\cos(\alpha_R)\pm\cos h(\alpha_R)\sin(\alpha_R)\}/(4\alpha_R). \tag{59}$$

Hence:

$$\mathrm{Re}[I_2]=\sigma_2\pi(b^2-a^2)\{\{|A|+|B|\cos(\phi_B)\}S^+-|B|\sin(\phi_B)S^-\}; \text{ and} \tag{60}$$

$$\mathrm{Im}[I_2]=\sigma_2\pi(b^2-a^2)\{\{|A|+|B|\cos(\phi_B)\}S^-+|B|\sin(\phi_B)S^+\}. \tag{61}$$

Root-mean-square current is therefore given by:

$$I_{rms}^2 = \frac{1}{2}\{(\mathrm{Re}[I_1]+\mathrm{Re}[I_2]+\mathrm{Re}[I_3])^2+(\mathrm{Im}[I_1]+\mathrm{Im}[I_2]+\mathrm{Im}[I_3])^2\}. \tag{62}$$

Furthermore, EQNS. 40-42 are used to evaluate the second term on the right-hand side of EQN. 29 (neglecting the term in $\beta$). The result is:

$$P = \frac{1}{2}\{\sigma_1\pi a^2|E_a|^2+\pi(c^2-b^2)\sigma_3|E_b|^2+\pi(b^2-a^2)\sigma_2[(|A|^2+|B^2|)\sinh(2\alpha_R)/(2\alpha_R)+2|A||B|\sin(\phi_B+2\alpha_R)/(\phi_B+2\alpha_R)]\}. \tag{63}$$

Dividing EQN. 63 by EQN. 62 yields an expression for the AC resistance (cf EQN. 37).

Given values for the dimensions a, b and c, and $\sigma_1$, $\sigma_2$ and $\sigma_3$, which are known functions of temperature, and assuming a value for the relative magnetic permeability of the ferromagnetic material (material 2), or equivalently, the skin depth $\delta$, A=1 can be set and the AC resistance per unit length $R_{AC}$ can be calculated. The ratio of the root-mean square current flowing through the inner conductor (material 1) and the ferromagnetic material (material 2) to the total can also be calculated. For a given total RMS current, then, the RMS current flowing through materials 1 and 2 can be calculated, which gives the magnetic field at the surface of material 2. Using magnetic data for material 2, a value for $\mu_2/\mu_0$ can be deduced and hence a value for $\delta$ can be deduced. Plotting this skin depth against the original skin depth produces a pair of curves that cross at the true $\delta$.

Figure 147:
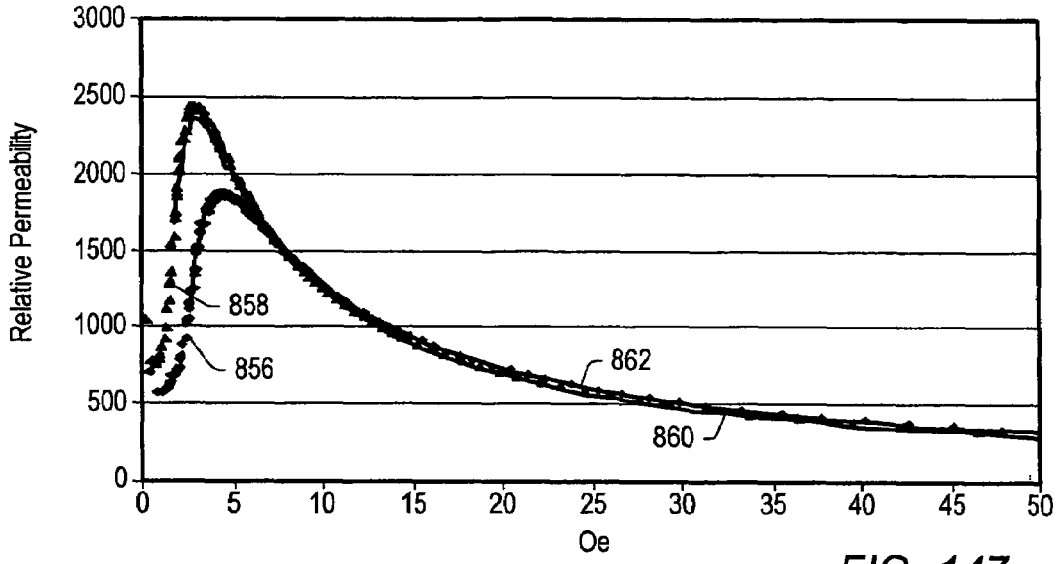

Magnetic data was obtained for carbon steel as a ferromagnetic material. B versus H curves, and hence relative permeabilities, were obtained from the magnetic data at various temperatures up to 1100° F. and magnetic fields up to 200 Oe (oersteds). A correlation was found that fitted the data well through the maximum permeability and beyond. FIG. 147 depicts examples of relative magnetic permeability (y-axis) versus magnetic field (Oe) for both the found correlations and raw data for carbon steel. Data 856 is raw data for carbon steel at 400° F. Data 858 is raw data for carbon steel at 1000° F. Curve 860 is the found correlation for carbon steel at 400° F. Curve 862 is the correlation for carbon steel at 1000° F.

For the dimensions and materials of the copper/carbon steel/347H heater element in the experiments above, the theoretical calculations described above were carried out to calculate magnetic field at the outer surface of the carbon steel as a function of skin depth. Results of the theoretical calculations were presented on the same plot as skin depth versus magnetic field from the correlations applied to the magnetic data from FIG. 147. The theoretical calculations and correlations were done at four temperatures (200° F., 500° F., 800° F., and 1100° F.) and five total root-mean-square (RMS) currents (100 A, 200 A, 300 A, 400 A, and 500 A).

Figure 148:
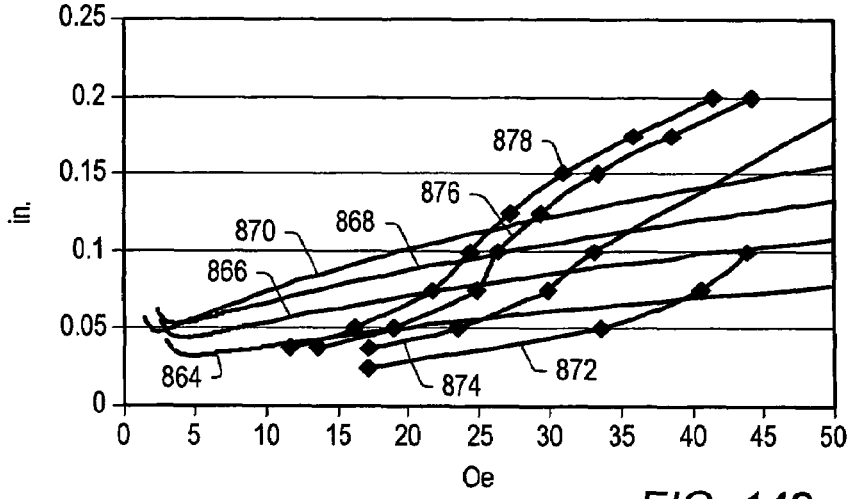

FIG. 148 shows the resulting plots of skin depth versus magnetic field for all four temperatures and 400 A current. Curve 864 is the correlation from magnetic data at 200° F. Curve 866 is the correlation from magnetic data at 500° F. Curve 868 is the correlation from magnetic data at 800° F. Curve 870 is the correlation from magnetic data at 1100° F. Curve 872 is the theoretical calculation at the outer surface of the carbon steel as a function of skin depth at 200° F. Curve 874 is the theoretical calculation at the outer surface of the carbon steel as a function of skin depth at 500° F. Curve 876 is the theoretical calculation at the outer surface of the carbon steel as a function of skin depth at 800° F. Curve 878 is the theoretical calculation at the outer surface of the carbon steel as a function of skin depth at 1100° F.

Figure 149:
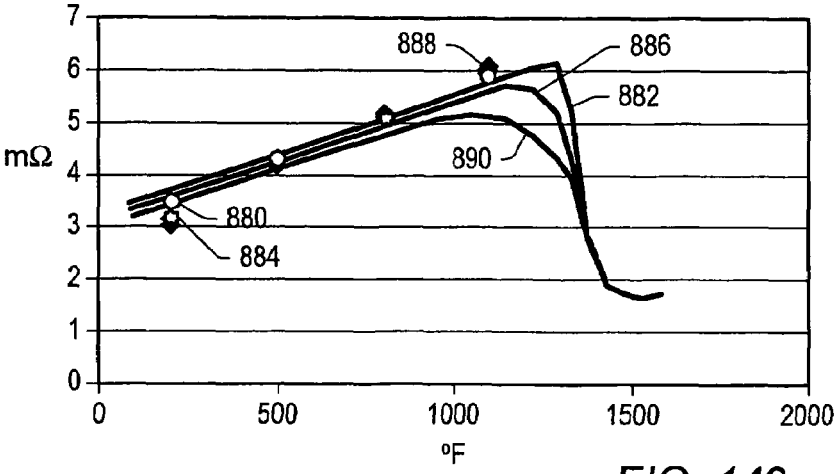

The skin depths obtained from the intersections of the same temperature curves in FIG. 148 were input into the equations described above and the AC resistance per unit length was calculated. The total AC resistance of the entire heater, including that of the canister, was subsequently calculated. A comparison between the experimental and numerical (calculated) results is shown in FIG. 149 for currents of 300 A (experimental data 880 and numerical curve 882), 400 A (experimental data 884 and numerical curve 886), and 500 A (experimental data 888 and numerical 890). Though the numerical results exhibit a steeper trend than the experimental results, the theoretical model captures the close bunching of the experimental data, and the overall values are quite reasonable given the assumptions involved in the theoretical model. For example, one assumption involved the use of a permeability derived from a quasistatic B-H curve to treat a dynamic system.

One feature of the theoretical model describing the flow of alternating current in the three-part temperature limited heater is that the AC resistance does not fall off monotonically with increasing skin depth. FIG. 150 shows the AC resistance (m$\Omega$) per foot of the heater element as a function of skin depth (in.) at 1100° F. calculated from the theoretical model. The AC resistance may be maximized by selecting the skin depth that is at the peak of the non-monotonical portion of the resistance versus skin depth profile (for example, at about 0.23 in. in FIG. 150).

FIG. 151 shows the power generated per unit length (W/ft) in each heater component (curve 892 (copper core), curve 894 (carbon steel), curve 896 (347H outer layer), and curve 898 (total)) versus skin depth (in.). As expected, the power dissipation in the 347H falls off while the power dissipation in the copper core increases as the skin depth increases. The maximum power dissipation in the carbon steel occurs at the skin depth of about 0.23 in. and is expected to correspond to the minimum in the power factor, shown in FIG. 145. The current density in the carbon steel behaves like a damped wave of wavelength $\lambda=2\pi\delta$ and the effect of this wavelength on the boundary conditions at the copper/carbon steel and carbon steel/347H interface may be behind the structure in FIG. 150.

For example, the local minimum in AC resistance is close to the value at which the thickness of the carbon steel layer corresponds to $\lambda/4$.

Formulae may be developed that describe the shapes of the AC resistance versus temperature profiles of temperature limited heaters for use in simulating the performance of the heaters in a particular embodiment. The data in FIGS. 143 and 144 show that the resistances initially rise linearly, then drop off increasingly steeply towards the DC lines. The resistance versus temperature profile of each heater can be described by:

$$R_{AC}=A_{AC}+B_{AC}T;\ T<<T_C;\ \text{and} \tag{64}$$

$$R_{AC}=R_{DC}=A_{DC}+B_{DC}T;\ T>>T_C. \tag{65}$$

Note that $A_{DC}$ and $B_{DC}$ are independent of current, while $A_{AC}$ and $B_{AC}$ depend on the current. Choosing as a form crossing over between EQNS. 64 and 65 results in the following expression for $R_{AC}$:

$$R_{AC}=\frac{1}{2}\{1+\tanh\{\alpha(T_0-T)\}\}\{A_{AC}+B_{AC}T\}+\frac{1}{2}\{1-\tanh\{\alpha(T_0-T)\}\}\{A_{DC}+B_{DC}T\}\ T\le T_0;\ \text{and} \tag{66}$$

$$R_{AC}=\frac{1}{2}\{1+\tanh\{\beta(T_0-T)\}\}\{A_{AC}+B_{AC}T\}+\frac{1}{2}\{1-\tanh\{\beta(T_0-T)\}\}\{A_{DC}+B_{DC}T\}\ T\ge T_0.$$

Since $A_{AC}$ and $B_{AC}$ are functions of current, then:

$$A_{AC}=A_{AC}^{(0)}+A_{AC}^{(1)}I;B_{AC}=B_{AC}^{(0)}+B_{AC}^{(1)}I. \tag{67}$$

The parameter $\alpha$ is also a function of current, and exhibits the quadratic dependence:

$$\alpha=\alpha_0+\alpha_1 I+\alpha_2 I^2. \tag{68}$$

The parameters $\beta$, $T_0$, as well as $A_{DC}$ and $B_{DC}$ are independent of current. Values of the parameters for the copper/carbon steel/347H heaters in the above experiments are listed in TABLE 2.

TABLE 2

| Parameter | Unit | copper/carbon steel/347H |
|---|---|---|
| $A_{DC}$ | mΩ | 0.6783 |
| $B_{DC}$ | mΩ/° F. | $6.53\times10^{-4}$ |
| $A_{AC}^{(0)}$ | mΩ | 3.6358 |
| $A_{AC}^{(1)}$ | mΩ/A | $-1.247\times10^{-3}$ |
| $B_{AC}^{(0)}$ | mΩ/° F. | $2.3575\times10^{-3}$ |
| $B_{AC}^{(1)}$ | mΩ/(° F. A) | $-2.28\times10^{-7}$ |
| $\alpha_0$ | 1/° F. | 0.2 |
| $\alpha_1$ | 1/(° F. A) | $-7.9\times10^{-4}$ |
| $\alpha_2$ | 1/(° F. $A^2$) | $8\times10^{-7}$ |
| $\beta$ | 1/° F. | 0.017 |
| $T_0$ | ° F. | 1350 |

FIGS. 152A-C compare the results of the theoretical calculations in EQNS. 66-68 with the experimental data at 300 A (FIG. 152A), 400 A (FIG. 152B) and 500 A (FIG. 152C). FIG. 152A depicts resistance (mW) versus temperature (° F.) at 300 A. Data 900 is the experimental data at 300 A. Curve 902 is the theoretical calculation at 300 A. Curve 904 is a plot of resistance versus temperature at 10 A DC. FIG. 152B depicts resistance (mW) versus temperature (° F.) at 400 A. Data 906 is the experimental data at 400 A. Curve 908 is the theoretical calculation at 400 A. Curve 910 is a plot of resistance versus temperature at 10 A DC. FIG. 152C depicts resistance (mW) versus temperature at (° F.) 500 A. Data 912 is the experimental data at 500 A. Curve 914 is the theoretical calculation at 500 A. Curve 916 is a plot of resistance versus temperature at 10 A DC. Note that, to obtain the resistance per foot, for example, in simulation work, the resistances given by the theoretical calculations must be divided by six.

A numerical simulation (FLUENT available from Fluent USA, Lebanon, N.H.) was used to compare operation of temperature limited heaters with three turndown ratios. The simulation was done for heaters in an oil shale formation (Green River oil shale). Simulation conditions were:

- 61 m length conductor-in-conduit Curie heaters (center conductor (2.54 cm diameter), conduit outer diameter 7.3 cm)
- downhole heater test field richness profile for an oil shale formation
- 16.5 cm (6.5 inch) diameter wellbores at 9.14 m spacing between wellbores on triangular spacing
- 200 hours power ramp-up time to 820 watts/m initial heat injection rate
- constant current operation after ramp up
- Curie temperature of 720.6° C. for heater
- formation will swell and touch the heater canisters for oil shale richnesses at least 0.14 L/kg (35 gals/ton)

FIG. 153 displays temperature (° C.) of a center conductor of a conductor-in-conduit heater as a function of formation depth (m) for a temperature limited heater with a turndown ratio of 2:1. Curves 918-940 depict temperature profiles in the formation at various times ranging from 8 days after the start of heating to 675 days after the start of heating (918: 8 days, 920: 50 days, 922: 91 days, 924: 133 days, 926: 216 days, 928: 300 days, 930: 383 days, 932: 466 days, 934: 550 days, 936: 591 days, 938: 633 days, 940: 675 days). At a turndown ratio of 2:1, the Curie temperature of 720.6° C. was exceeded after 466 days in the richest oil shale layers. FIG. 154 shows the corresponding heater heat flux (W/m) through the formation for a turndown ratio of 2:1 along with the oil shale richness (1/kg) profile (curve 942). Curves 944-980 show the heat flux profiles at various times from 8 days after the start of heating to 633 days after the start of heating (944: 8 days; 946: 50 days; 950: 91 days; 952: 133 days; 954: 175 days; 956: 216 days; 958; 258 days; 960: 300 days; 962: 341 days; 964: 383 days; 968: 425 days; 970: 466 days; 972: 508 days; 974: 550 days; 976; 591 days; 978: 633 days; 980: 675 days). At a turndown ratio of 2:1, the center conductor temperature exceeded the Curie temperature in the richest oil shale layers.

FIG. 155 displays heater temperature (° C.) as a function of formation depth (m) for a turndown ratio of 3:1. Curves 982-1004 show temperature profiles through the formation at various times ranging from 12 days after the start of heating to 703 days after the start of heating (982: 12 days; 984: 33 days; 986: 62 days; 988: 102 days; 990; 146 days; 992: 205 days; 994: 271 days; 996: 354 days; 998: 467 days; 1000: 605 days; 1002: 662 days; 1004: 703 days). At a turndown ratio of 3:1, the Curie temperature was approached after 703 days. FIG. 156 shows the corresponding heater heat flux (W/m) through the formation for a turndown ratio of 3:1 along with the oil shale richness (1/kg) profile (curve 1006). Curves 1008-1028 show the heat flux profiles at various times from 12 days after the start of heating to 605 days after the start of heating (1008: 12 days, 1010: 32 days, 1012: 62 days, 1014: 102 days, 1016: 146 days, 1018: 205 days, 1020: 271 days, 1022: 354 days, 1024: 467 days, 1026: 605 days, 1028: 749 days). The center conductor temperature never exceeded the Curie temperature for the turndown ratio of 3:1. The center conductor temperature also showed a relatively flat temperature profile for the 3:1 turndown ratio.

FIG. 157 shows heater temperature (° C.) as a function of formation depth (m) for a turndown ratio of 4:1. Curves 1030-1050 show temperature profiles through the formation at various times ranging from 12 days after the start of heating to 467 days after the start of heating (1030: 12 days; 1032: 33 days; 1034: 62 days; 1036: 102 days, 1038: 147 days; 1040: 205 days; 1042: 272 days; 1044: 354 days; 1046: 467 days; 1048: 606 days, 1050: 678 days). At a turndown ratio of 4:1, the Curie temperature was not exceeded even after 678 days. The center conductor temperature never exceeded the Curie temperature for the turndown ratio of 4:1. The center conductor showed a temperature profile for the 4:1 turndown ratio that was somewhat flatter than the temperature profile for the 3:1 turndown ratio. These simulations show that the heater temperature stays at or below the Curie temperature for a longer time at higher turndown ratios. For this oil shale richness profile, a turndown ratio of at least 3:1 may be desirable.

Simulations have been performed to compare the use of temperature limited heaters and non-temperature limited heaters in an oil shale formation. Simulation data was produced for conductor-in-conduit heaters placed in 16.5 cm (6.5 inch) diameter wellbores with 12.2 m (40 feet) spacing between heaters using a formation simulator (for example, STARS from Computer Modelling Group, LTD., Houston, Tex.), and a near wellbore simulator (for example, ABAQUS from ABAQUS, Inc., Providence, R.I.). Standard conductor-in-conduit heaters included 304 stainless steel conductors and conduits. Temperature limited conductor-in-conduit heaters included a metal with a Curie temperature of 760° C. for conductors and conduits. Results from the simulations are depicted in FIGS. 158-160.

FIG. 158 depicts heater temperature (° C.) at the conductor of a conductor-in-conduit heater versus depth (m) of the heater in the formation for a simulation after 20,000 hours of operation. Heater power was set at 820 watts/meter until 760° C. was reached, and the power was reduced to inhibit overheating. Curve 1052 depicts the conductor temperature for standard conductor-in-conduit heaters. Curve 1052 shows that a large variance in conductor temperature and a significant number of hot spots developed along the length of the conductor. The temperature of the conductor had a minimum value of 490° C. Curve 1054 depicts conductor temperature for temperature limited conductor-in-conduit heaters. As shown in FIG. 158, temperature distribution along the length of the conductor was more controlled for the temperature limited heaters. In addition, the operating temperature of the conductor was 730° C. for the temperature limited heaters. Thus, more heat input would be provided to the formation for a similar heater power using temperature limited heaters.

FIG. 159 depicts heater heat flux (W/m) versus time (yrs) for the heaters used in the simulation for heating oil shale. Curve 1056 depicts heat flux for standard conductor-in-conduit heaters. Curve 1058 depicts heat flux for temperature limited conductor-in-conduit heaters. As shown in FIG. 159, heat flux for the temperature limited heaters was maintained at a higher value for a longer period of time than heat flux for standard heaters. The higher heat flux may provide more uniform and faster heating of the formation.

FIG. 160 depicts cumulative heat input (kJ/m)(kilojoules per meter) versus time (yrs) for the heaters used in the simulation for heating oil shale. Curve 1060 depicts cumulative heat input for standard conductor-in-conduit heaters. Curve 1062 depicts cumulative heat input for temperature limited conductor-in-conduit heaters. As shown in FIG. 160, cumulative heat input for the temperature limited heaters increased faster than cumulative heat input for standard heaters. The faster accumulation of heat in the formation using temperature limited heaters may decrease the time needed for retorting the formation. Onset of retorting of the oil shale formation may begin around an average cumulative heat input of $1.1\times 10^8$ kJ/meter. This value of cumulative heat input is reached around 5 years for temperature limited heaters and between 9 and 10 years for standard heaters.

Calculations may be made to determine the effect of a thermally conductive fluid in an annulus of a temperature limited heater. The equations below (EQNS. 69-79) are used to relate a heater center rod temperature in a heated section to a conduit temperature adjacent to the heater center rod. In this example, the heater center rod is a 347H stainless steel tube with outer radius b. The conduit is made of 347H stainless steel and has inner radius R. The center heater rod and the conduit are at uniform temperatures $T_H$ and $T_C$, respectively. $T_C$ is maintained constant and a constant heat rate, Q, per unit length is supplied to the center heater rod. $T_H$ is the value at which the rate of heat per unit length transferred to the conduit by conduction and radiation balances the rate of heat generated, Q. Conduction across a gap between the center heater rod and inner surface of the conduit is assumed to take place in parallel with radiation across the gap. For simplicity, radiation across the gap is assumed to be radiation across a vacuum. The equations are thus:

$$Q=Q_C+Q_R; \tag{69}$$

where $Q_C$ and $Q_R$ represent the conductive and radiative components of the heat flux across the gap. Denoting the inner radius of the conduit by R, conductive heat transport satisfies the equation:

$$Q_C=-2\pi r k_g\frac{dT}{dr};\ b\le r\le R; \tag{70}$$

subject to the boundary conditions:

$$T(b)=T_H;T(R)=T_C. \tag{71}$$

The thermal conductivity of the gas in the gap, $k_g$, is well described by the equation:

$$k_g=a_g+b_gT \tag{72}$$

Substituting EQN. 72 into EQN. 70 and integrating subject to the boundary conditions in EQN. 71 gives:

$$\frac{Q_C}{2\pi}\ln(R/b)=k_g^{(eff)}(T_H-T_C);\ \text{with} \tag{73}$$

$$k_g^{(eff)}=a_g+\frac{1}{2}b_g(T_H+T_C). \tag{74}$$

The rate of radiative heat transport across the gap per unit length, $Q_R$, is given by:

$$Q_R=2\pi\sigma b\epsilon_R\epsilon_{bR}\{T_H^4-T_C^4\}; \tag{75}$$

$$\text{where } \epsilon_{bR}=\epsilon_b/\{\epsilon_R+(b/R)\epsilon_b(1-\epsilon_R)\}. \tag{76}$$

In EQNS. 75 and 76, $\epsilon_b$ and $\epsilon_R$ denote the emissivities of the center heater rod and inner surface of the conduit, respectively, and $\sigma$ is the Stefan-Boltzmann constant.

Substituting EQNS. 73 and 75 back into EQN. 69, and rearranging gives:

$$\frac{Q}{2\pi} = \frac{k_g^{eff}(T_H - T_C)}{\ln(R/b)} + \sigma b \varepsilon_R \varepsilon_{bR}\{T_H^4 - T_C^4\}. \quad (77)$$

To solve EQN. 77, t is denoted as the ratio of radiative to conductive heat flux across the gap:

$$t = \frac{\sigma b \varepsilon_R \varepsilon_{bR}\{T_H^2 + T_C^2\}(T_H + T_C)\ln(R/b)}{k_g^{eff}}. \quad (78)$$

Then EQN. 77 can be written in the form:

$$\frac{Q}{2\pi} = \frac{k_g^{eff}(T_H - T_C)}{\ln(R/b)}\{1 + t\}. \quad (79)$$

EQNS. 79 and 77 are solved iteratively for $T_H$ given Q and $T_C$. The numerical values of the parameters σ, $a_g$, and $b_g$ are given in TABLE 3. A list of heater dimensions are given in TABLE 4. The emissivities $\epsilon_S$ and $\epsilon_a$ may be taken to be in the range 0.4-0.8.

TABLE 3

Material Parameters Used in the Calculations

| Parameter | σ | $a_g$(air) | $b_g$ (air) | $a_g$ (He) | $b_g$ (He) |
|---|---|---|---|---|---|
| Unit | $Wm^{-2}K^{-4}$ | $Wm^{-1}K^{-1}$ | $Wm^{-1}K^{-2}$ | $Wm^{-1}K^{-1}$ | $Wm^{-1}K^{-2}$ |
| Value | $5.67 \times 10^{-8}$ | 0.01274 | $5.493 \times 10^{-5}$ | 0.07522 | $2.741 \times 10^{-4}$ |

TABLE 4

Set of Heater Dimensions

| Dimension | Inches | Meters |
|---|---|---|
| Heater rod outer radius b | ½ × 0.75 | $9.525 \times 10^{-3}$ |
| Conduit inner radius R | ½ × 1.771 | $2.249 \times 10^{-2}$ |

FIG. 161 shows heater rod temperature (° C.) as a function of the power (W/m) generated within the heater rod for a base case in which both the heater rod and conduit emissivities were 0.8, and a low emissivity case in which the heater rod emissivity was lowered to 0.4. The conduit temperature was set at 260° C. Cases in which the annular space is filled with air and with helium are compared in FIG. 161. Plot 1064 is for the base case in air. Plot 1066 is for the base case in helium. Plot 1068 is for the low emissivity case in air. Plot 1070 is for the low emissivity case in helium. FIGS. 162-168 repeat the same cases for conduit temperatures of 315° C. to 649° C. inclusive, with incremental steps of 55° C. in each figure. Note that the temperature scale in FIGS. 166-168 is offset by 111° C. with respect to the scale in FIGS. 161-165. FIGS. 161-168 show that helium in the annular space, which has a higher thermal conductivity than air, reduces the rod temperature for similar power generation.

FIG. 169 shows a plot of center heater rod (with 0.8 emissivity) temperature (vertical axis) versus conduit temperature (horizontal axis) for various heater powers with air or helium in the annulus. FIG. 170 shows a plot of center heater rod (with 0.4 emissivity) temperature (vertical axis) versus conduit temperature (horizontal axis) for various heater powers with air or helium in the annulus. Plots 1072 are for air and a heater power of 500 W/m. Plots 1074 are for air and a heater power of 833 W/m. Plots 1076 are for air and a heater power of 1167 W/m. Plots 1078 are for helium and a heater power of 500 W/m. Plots 1080 are for helium and a heater power of 833 W/m. Plots 1082 are for helium and a heater power of 1167 W/m. FIGS. 169 and 170 show that helium in the annular space, as compared to air in the annulus, reduces temperature difference between the heater and the canister.

FIG. 171 depicts spark gap breakdown voltages (V) versus pressure (atm) at different temperatures for a conductor-in-conduit heater with air in the annulus. FIG. 172 depicts spark gap breakdown voltages (V) versus pressure (atm) at different temperatures for a conductor-in-conduit heater with helium in the annulus. FIGS. 171 and 172 show breakdown voltages for a conductor-in-conduit heater with a 2.5 cm diameter center conductor and a 7.6 cm gap to the inner radius of the conduit. Plot 1084 is for a temperature of 300 K. Plot 1086 is for a temperature of 700 K. Plot is for a temperature of 1050 K. 480 V RMS is shown as a typical applied voltage. FIGS. 171 and 172 show that helium has a spark gap breakdown voltage smaller than the spark gap breakdown voltage for air at 1 atm. Thus, the pressure of helium may need to be increased to achieve spark gap breakdown voltages on the order of breakdown voltages for air.

FIG. 173 depicts leakage current (mA)(milliamps) versus voltage (V) for alumina and silicon nitride centralizers at selected temperatures. Leakage current was measured between a conductor and a conduit of a 0.91 m conductor-in-conduit section with two centralizers. The conductor-in-conduit was placed horizontally in a furnace. Plot 1090 depicts data for alumina centralizers at a temperature of 760° C. Plot 1092 depicts data for alumina centralizers a temperature of 815° C. Plot 1094 depicts data for gas pressure sintered reaction bonded silicon nitride centralizers at a temperature of 760° C. Plot 1096 depicts data for gas pressure sintered reaction bonded silicon nitride at a temperature of 871° C. FIG. 173 shows that the leakage current of alumina increases substantially from 760° C. to 815° C. while the leakage current of gas pressure sintered reaction bonded silicon nitride remains relatively low from 760° C. to 871° C.

FIG. 174 depicts leakage current (mA) versus temperature (° C.) for two different types of silicon nitride. Plot 1098 depicts leakage current versus temperature for highly polished, gas pressure sintered reaction bonded silicon nitride. Plot 1100 depicts leakage current versus temperature for doped densified silicon nitride. FIG. 174 shows the improved leakage current versus temperature characteristics of gas pressure sintered reaction bonded silicon nitride versus doped silicon nitride.

Using silicon nitride centralizers allows for smaller diameter and higher temperature heaters. A smaller gap is needed between a conductor and a conduit because of the excellent electrical characteristics of the silicon nitride. Silicon nitride centralizers may allow higher operating voltages (for example, up to at least 1500 V, 2000 V, 2500 V, or 15 kV) to be used in heaters due to the electrical characteristics of the silicon nitride. Operating at higher voltages allows longer length heaters to be utilized (for example, lengths up to at least 500 m, 1000 m, or 1500 m at 2500 V). In some embodiments, boron nitride is used as a material for centralizers or other electrical insulators. Boron nitride is a better thermal conductor and has better electrical properties than silicon nitride. Boron nitride does not absorb water readily (boron nitride is substantially non-hygroscopic). Boron nitride is available in at least a hexagonal form and a face centered cubic form. A hexagonal crystalline formation of boron nitride has several desired properties, including, but not limited to, a high thermal conductivity and a low friction coefficient.

A downhole heater assembly may include 5, 10, 20, 40, or more heaters coupled together. For example, a heater assembly may include between 10 and 40 heaters. Heaters in a downhole heater assembly may be coupled in series. In some embodiments, heaters in a heater assembly may be spaced from about 7.6 m to about 30.5 m apart. For example, heaters in a heater assembly may be spaced about 15 m apart. Spacing between heaters in a heater assembly may be a function of heat transfer from the heaters to the formation. For example, a spacing between heaters may be chosen to limit temperature variation along a length of a heater assembly to acceptable limits. A heater assembly may advantageously provide substantially uniform heating over a relatively long length of an opening in a formation. Heaters in a heater assembly may include, but are not limited to, electrical heaters (e.g., insulated conductor heaters, conductor-in-conduit heaters, pipe-in-pipe heaters), flameless distributed combustors, natural distributed combustors, and/or oxidizers. In some embodiments, heaters in a downhole heater assembly may include only oxidizers.

FIG. 175 depicts a schematic of an embodiment of downhole oxidizer assembly 1102 including oxidizers 1104. In some embodiments, oxidizer assembly 1102 may include oxidizers 1104 and flameless distributed combustors. Oxidizer assembly 1102 may be lowered into an opening in a formation and positioned as desired. In some embodiments, a portion of the opening in the formation may be substantially parallel to the surface of the Earth. In some embodiments, the opening of the formation may be otherwise angled with respect to the surface of the Earth. In an embodiment, the opening may include a significant vertical portion and a portion otherwise angled with respect to the surface of the Earth. In certain embodiments, the opening may be a branched opening. Oxidizer assemblies may branch from common fuel and/or oxidizer conduits in a central portion of the opening.

Fuel 1106 may be supplied to oxidizers 1104 through fuel conduit 1108. In some embodiments, fuel conduit 1108 may include a catalytic surface (e.g., a catalytic inner surface) to decrease an ignition temperature of fuel 1106. Oxidizing fluid 1110 may be supplied to oxidizer assembly 1102 through oxidizer conduit 1112. In some embodiments, fuel conduit 1108 and/or oxidizers 1104 may be positioned concentrically, or substantially concentrically, in oxidizer conduit 1112. In some embodiments, fuel conduit 1108 and/or oxidizers 1104 may be arranged other than concentrically with respect to oxidizer conduit 1112. In certain branched opening embodiments, fuel conduit 1108 and/or oxidizer conduit 1112 may have a weld or coupling to allow placement of oxidizer assemblies 1102 in branches of the opening.

An ignition source may be positioned in or proximate oxidizers 1104 to initiate combustion. In some embodiments, an ignition source may heat the fuel and/or the oxidizing fluid supplied to a particular heater to a temperature sufficient to support ignition of the fuel. The fuel may be oxidized with the oxidizing fluid in oxidizers 1104 to generate heat. Oxidation products may mix with oxidizing fluid downstream of the first oxidizer in oxidizer conduit 1112. Exhaust gas 1114 may include unreacted oxidizing fluid and unreacted fuel as well as oxidation products. In some embodiments, a portion of exhaust gas 1114 may be provided to downstream oxidizer 1104. In some embodiments, a portion of exhaust gas 1114 may return to the surface through outer conduit 1116. As the exhaust gas returns to the surface through outer conduit 1116, heat from exhaust gas 1114 may be transferred to the formation. Returning exhaust gas 1114 through outer conduit 1116 may provide substantially uniform heating along oxidizer assembly 1102 due to heat from the exhaust gas integrating with the heat provided from individual oxidizers of the oxidizer assembly. In some embodiments, oxidizing fluid 1110 may be introduced through outer conduit 1116 and exhaust gas 1114 may be returned through oxidizer conduit 1112. In certain embodiments, heat integration may occur along an extended vertical portion of an opening.

Fuel supplied to an oxidizer assembly may include, but is not limited to, hydrogen, methane, ethane, and/or other hydrocarbons. In certain embodiments, fuel used to initiate combustion may be enriched to decrease the temperature required for ignition. In some embodiments, hydrogen ($H_2$) or other hydrogen rich fluids may be used to enrich fuel initially supplied to the oxidizers. After ignition of the oxidizers, enrichment of the fuel may be stopped.

After oxidizer ignition, steps may be taken to reduce coking of fuel in the fuel conduit. For example, steam may be added to the fuel to inhibit coking in the fuel conduit. In some embodiments, the fuel may be methane that is mixed with steam in a molar ratio of up to 1:1. In some embodiments, coking may be inhibited by decreasing a residence time of fuel in the fuel conduit. In some embodiments, coking may be inhibited by insulating portions of the fuel conduit that pass through high temperature zones proximate oxidizers.

Oxidizing fluid supplied to an oxidizer assembly may include, but is not limited to, air, oxygen enriched air, and/or hydrogen peroxide. Depletion of oxygen in oxidizing fluid may occur toward a terminal end of an oxidizer assembly. In an embodiment, a flow of oxidizing fluid may be increased (e.g., by using compression to provide excess oxidizing fluid) such that sufficient oxygen is present for operation of the terminal oxidizer. In some embodiments, oxidizing fluid may be enriched by increasing an oxygen content of the oxidizing fluid prior to introduction of the oxidizing fluid to the oxidizers. Oxidizing fluid may be enriched by methods including, but not limited to, adding oxygen to the oxidizing fluid, adding an additional oxidant such as hydrogen peroxide to the oxidizing fluid (e.g., air) and/or flowing oxidizing fluid through a membrane that allows preferential diffusion of oxygen.

FIG. 176 depicts an embodiment of ignition system 1118 positioned in a cross-sectional representation of an oxidizer. Ignition system 1118 may be positioned in guide tube 1120. Ignition system 1118 may include glow plug 1122, insulator 1124, transition piece 1126, follower 1128, and cable 1130. Glow plug 1122 may be a Kyocera glow available from Kyocera Corporation (Kyoto, Japan). A length of ignition system 1118 from an end of follower 1128 to an end of glow plug 1122 may be about 5 cm to about 20 cm. In an embodiment, a length of ignition system 1118 from an end of follower 1128 to an end of glow plug 1122 may be about 9.14 cm. Insulator 1124 may be a ceramic insulator made of alumina, boron nitride, silicon nitride, or other ceramic material. When electricity is supplied to ignition system 1118 through cable 1130, a tip of glow plug 1122 may reach a temperature sufficient to ignite a fuel and oxidizing fluid mixture in oxidizer 1104. Cable 1130 may be a mineral insulated cable. A weld (e.g., a gas tungsten argon weld) may be formed where an outer metal layer of cable 1130 enters follower 1128.

FIG. 177 depicts a cross-sectional representation of an embodiment of transition piece 1126. Transition piece 1126 may include ground wire 1132, ceramic 1134, guide tube 1136, and metal body 1138. Ground wire 1132 may electrically couple metal body 1138 to a first terminal of a glow plug. Guide tube 1136 may allow a conductor of a cable to be electrically coupled to a second terminal of the glow plug. Guide tube 1136 and ground wire 1132 may be welded to terminals of the glow plug (e.g., using gas tungsten argon welding). In some embodiments, metal body 1138 may include threading 1140. Threading 1140 may mate with threading of a follower. In some embodiments, the metal body may be coupled to the follower by a crush fit, friction fit, interference fit, or other type of coupling.

FIG. 178 depicts a cross-sectional representation of ignition system 1118 without a cable. Ignition system 1118 without a cable may be assembled and treated (e.g., fired) prior to insertion of a cable. Preform 1142 may be positioned between follower 1128 and transition piece 1126. Preform 1142 may be made of alumina, silicon nitride, boron nitride, or other ceramic material. Preform 1142 may direct a conductor of a cable to guide tube 1136 of transition piece 1126 when the conductor is being coupled to glow plug 1122. Preform 1142 may support the conductor and inhibit the conductor from establishing an electrical connection with follower 1128 or transition piece 1126. Guide tube 1136 may direct the conductor of the cable to a terminal of glow plug 1122. When preform 1142 is positioned between follower 1128 and transition piece 1126, the follower may be welded to the transition piece. Insulator 1124 may electrically isolate glow plug 1122. Insulator 1124 may be coupled to transition piece 1126 and glow plug 1122 using high temperature cement 1144.

In certain embodiments, fuel may be reacted with catalytic material (e.g., palladium, platinum, or other known oxidation catalysts) to provide an ignition source in a downhole oxidizer assembly. The catalyst material may be, but is not limited to molybdenum, molybdenum oxides, nickel, nickel oxides, vanadium, vanadium oxides, chromium, chromium oxides, manganese, manganese oxides, palladium, palladium oxides, platinum, platinum oxides, rhodium, rhodium oxides, iridium, iridium oxides, or combinations thereof. FIG. 179 depicts catalytic material 1146 proximate oxidizer 1104 in a downhole oxidizer assembly. Tubing 1148 may supply fuel 1106 (e.g., $H_2$) through branches 1150 to one or more orifices 1152 proximate catalytic material 1146. The fuel supplied to catalytic material 1146 may react with the catalytic material at ambient or close to downhole conditions. Fuel supplied to catalytic material 1146 may cause the catalytic material to glow or flame. The content and quantity of the fuel supplied to the catalytic material may be controlled to inhibit development of a flame. A flame may be inhibited to prevent equipment and catalyst degradation due to excessive heat. Glowing catalytic material 1146 may ignite a mixture in oxidizer 1104 proximate the catalytic material. In some embodiments, oxidizers and catalytic material 1146 may be placed in series along a fuel conduit in an oxidizer assembly in any order. Fuel supplied to the catalytic material may be controlled by a valve or valve system so that fuel is supplied to the catalytic material only when the fuel is needed.

FIG. 180 depicts an embodiment of catalytic igniter system 1154. Catalytic igniter system 1154 may include oxidant line 1156, fuel line 1158, manifold 1160, coaxial tubing 1162, mixing zone 1164, shield 1166, and/or catalytic material 1146. In an embodiment, oxidant line 1156 and fuel line 1158 may be 0.48 cm tubing. Oxidant line 1156 may carry air or another oxidizing fluid. Fuel line 1158 may carry hydrogen or another fuel. In certain embodiments, an oxidizing fluid to fuel ratio may range from about 0.8 to 2. In an embodiment, an oxidizing fluid to fuel ratio may be about 1.2 (e.g., 0.156 L/s air and 0.127 L/s hydrogen). Manifold 1160 may direct fuel down a center conduit (e.g., a 0.48 cm center conduit) and oxidant in an annulus between the center conduit and an outer conduit (e.g., a 0.79 cm outer conduit). The oxidant and fuel may mix in mixing zone 1164 before flowing to catalytic material 1146. Catalytic material 1146 may be a packed bed in shield 1166. The packed bed of catalytic material 1146 may be from about 0.64 cm to about 5 cm long. Shield 1166 may have openings that allow reaction product to exit from catalytic igniter system 1154.

FIG. 181 depicts a cross-sectional representation of an embodiment of oxidizer 1104. Oxidizer 1104 may include igniter guide tube 1168. Catalytic igniter system 1154, depicted in FIG. 180, may be positioned in igniter guide tube 1168. In some embodiments, shield 1166, which encloses the catalytic material of the catalytic igniter system, may extend beyond an end of igniter guide tube 1168. When oxidizer and fuel are supplied through oxidant line 1156 and fuel line 1158, a temperature of shield 1166 may rise to a temperature sufficient to initialize combustion of a fuel and oxidizing fluid mixture supplied to oxidizer 1104. Fuel may be supplied to oxidizer 1104 through fuel conduit 1108. Oxidizing fluid may enter oxidizer 1104 through oxidizer orifices 1170.

In some in situ conversion process embodiments, a closed loop circulation system is used to heat the formation. FIG. 182 depicts a schematic representation of a system for heating a formation using a closed loop circulation system. The system may be used to heat hydrocarbons that are relatively deep in the ground and that are relatively large in extent. In some embodiments, the hydrocarbons may be 100 m, 200 m, 300 m or more below the surface. The closed loop circulation system may also be used to heat hydrocarbons that are not as deep in the ground. The hydrocarbons may extend lengthwise up to 500 m, 750 m, 1000 m, or more. The closed loop circulation system may become economically viable in formations where the length of the hydrocarbons to be treated is long compared to the thickness of the overburden. The ratio of the hydrocarbon extent to be heated by heaters to the overburden thickness may be at least 3, at least 5, or at least 10.

In some embodiments, heaters 382 may be formed in the formation by drilling a first wellbore and then drilling a second wellbore that connects with the first wellbore so that piping placed in the wellbores forms a U-shaped heater 382. Heaters 382 are connected to heat transfer fluid circulation system 1172 by piping. Gas at high pressure may be used as the heat transfer fluid in the closed loop circulation system. In some embodiments, the heat transfer fluid is carbon dioxide. Carbon dioxide is chemically stable at the required temperatures and pressures and has a relatively high molecular weight that results in a high volumetric heat capacity. Other fluids such as steam, air, and/or nitrogen may also be used. The pressure of the heat transfer fluid entering the formation may be 3000 kPa or higher. The use of high pressure heat transfer fluid allows the heat transfer fluid to have a greater density, and therefore a greater capacity to transfer heat. Also, the pressure drop across the heaters is less for a system where the heat transfer fluid enters the heaters at a first pressure for a given mass flow rate than when the heat transfer fluid enters the heaters at a second pressure at the same mass flow rate when the first pressure is greater than the second pressure.

Heat transfer fluid circulation system 1172 may include furnace 1174, first heat exchanger 1176, second heat exchanger 1178, and compressor 1180. Furnace 1174 heats the heat transfer fluid to a high temperature. In the embodiment depicted in FIG. 182, furnace 1174 heats the heat transfer fluid to a temperature in a range from about 700° C. to about 920° C., from about 770° C. to about 870° C., or from about 800° C. to about 850° C. In an embodiment, furnace 1174 heats the heat transfer fluid to a temperature of about 820° C. The heat transfer fluid flows from furnace 1174 to heaters 382. Heat transfers from heaters 382 to formation 314 adjacent to the heaters. The temperature of the heat transfer fluid exiting formation 314 may be in a range from about 350° C. to about 580° C., from about 400° C. to about 530° C., or from about 450° C. to about 500° C. In an embodiment, the temperature of the heat transfer fluid exiting formation 314 is about 480° C. The metallurgy of the piping used to form heat transfer fluid circulation system 1172 may be varied to significantly reduce costs of the piping. High temperature steel may be used from furnace 1174 to a point where the temperature is sufficiently low so that less expensive steel can be used from that point to first heat exchanger 1176. Several different steel grades may be used to form the piping of heat transfer fluid circulation system 1172.

Heat transfer fluid from furnace 1174 of heat transfer fluid circulation system 1172 passes through overburden 370 of formation 314 to hydrocarbon layer 254. Portions of heaters 382 extending through overburden 370 may be insulated. Inlet portions of heaters 382 in hydrocarbon layer 254 may have tapering insulation to reduce overheating of the hydrocarbon layer near the inlet of the heater into the hydrocarbon layer.

After exiting formation 314, the heat transfer fluid passes through first heat exchanger 1176 and second heat exchanger 1178 to compressor 1180. First heat exchanger 1176 transfers heat between heat transfer fluid exiting formation 314 and heat transfer fluid exiting compressor 1180 to raise the temperature of the heat transfer fluid that enters furnace 1174 and reduce the temperature of the fluid exiting formation 314. Second heat exchanger 1178 further reduces the temperature of the heat transfer fluid before the heat transfer fluid enters compressor 1180.

FIG. 183 depicts a plan view of an embodiment of wellbore openings in the formation that is to be heated using the closed loop circulation system. Heat transfer fluid entries 1182 into formation 314 alternate with heat transfer fluid exits 1184. Alternating heat transfer fluid entries 1182 with heat transfer fluid exits 1184 may allow for more uniform heating of the hydrocarbons in formation 314.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims. In addition, it is to be understood that features described herein independently may, in certain embodiments, be combined.

What is claimed is:

1. A system configured to heat at least a part of a subsurface formation, comprising:

an electrical power supply;

a heater section comprising one or more electrical conductors electrically coupled to the electrical power supply and configured to be placed in an opening in the formation, at least one of the electrical conductors comprising ferromagnetic material;

wherein the heater section (a) provides a first heat output when time-varying electrical current is applied to the heater section below a selected temperature, and (b) provides a second heat output approximately at and above the selected temperature during use, the second heat output being reduced compared to the first heat output;

wherein the system is configured to allow heat to transfer from the heater section to a part of the formation; and wherein the electrical power supply is configured to provide a relatively constant amount of time-varying electrical current that remains within about 15% of a selected constant current value when a load of the electrical conductors changes.

2. The system of claim 1, wherein the electrical power supply is configured to provide a relatively constant amount of time-varying electrical current that remains within about 10% of a selected constant current value when a load of the electrical conductors changes.

3. The system of claim 1, wherein the electrical power supply is configured to provide a relatively constant amount of time-varying electrical current that remains within about 5% of a selected constant current value when a load of the electrical conductors changes.

4. The system of claim 1, wherein the electrical power supply is configured to provide a current that produces a skin effect in the ferromagnetic material.

5. The system of claim 1, wherein the electrical power supply is configured to provide AC.

6. The system of claim 1, wherein the electrical power supply is configured to provide modulated DC.

7. The system of claim 1, wherein the electrical power supply is configured to provide modulated DC in a pre-shaped waveform, and wherein the pre-shaped waveform is shaped to at least partially compensate for phase shift and/or harmonic distortions in the electrical conductors.

8. The system of claim 1, wherein the heater section automatically provides the second heat output.

9. The system of claim 1, wherein at least a portion of the heater section is positionable adjacent to hydrocarbon material in the formation to raise a temperature of at least some of the hydrocarbon material to or above a pyrolysis temperature.

10. The system of claim 1, wherein the second heat output is at most 90% of the first heat output, the first heat output being at about 50° C. below the selected temperature.

11. The system of claim 1, wherein the electrical resistance of the heater section decreases above the selected temperature to provide the second heat output.

12. The system of claim 1, further comprising a non-ferromagnetic material coupled to the ferromagnetic material, wherein the non-ferromagnetic material has a higher electrical conductivity than the ferromagnetic material.

13. The system of claim 1, wherein the selected temperature is approximately the Curie temperature of the ferromagnetic material.

14. The system of claim 1, wherein the heater section has a turndown ratio of at least about 1.1 to 1.

15. The system of claim 1, wherein at least a portion of the heater section is longer than about 10 m.

16. The system of claim 1, wherein the heater section is elongated.

* * * * *